US008062098B2

(12) United States Patent
Duescher

(10) Patent No.: US 8,062,098 B2
(45) Date of Patent: Nov. 22, 2011

(54) HIGH SPEED FLAT LAPPING PLATEN

(76) Inventor: Wayne O. Duescher, Roseville, MN (US)

( * ) Notice: Subject to any disclaimer, the term of this patent is extended or adjusted under 35 U.S.C. 154(b) by 806 days.

(21) Appl. No.: 12/217,565

(22) Filed: Jul. 7, 2008

(65) Prior Publication Data

US 2010/0003904 A1 Jan. 7, 2010

Related U.S. Application Data

(63) Continuation-in-part of application No. 11/029,761, filed on Jan. 5, 2005, which is a continuation-in-part of application No. 10/816,275, filed on Aug. 16, 2004, now Pat. No. 7,520,800, which is a continuation-in-part of application No. 10/824,107, filed on Apr. 14, 2004, now Pat. No. 7,632,434, which is a continuation-in-part of application No. 10/418,257, filed on Apr. 16, 2003, now abandoned, which is a continuation-in-part of application No. 10/015,478, filed on Dec. 13, 2001, now Pat. No. 6,752,700, which is a continuation-in-part of application No. 09/715,448, filed on Nov. 17, 2000, now Pat. No. 6,769,969.

(51) Int. Cl.
*B24B 27/00* (2006.01)
*B24D 9/10* (2006.01)

(52) U.S. Cl. ..... 451/259; 451/290; 451/360; 451/449; 451/494; 451/550

(58) Field of Classification Search ..... 279/3; 451/259, 451/285–290, 342, 360, 449, 494, 550
See application file for complete search history.

(56) References Cited

U.S. PATENT DOCUMENTS

| | | | | |
|---|---|---|---|---|
| 794,495 | A | 7/1905 | Gorton et al. | 451/529 |
| 1,657,784 | A | 1/1928 | Bergstrom | 51/295 |
| 1,896,946 | A | 2/1933 | Gauss | 451/527 |
| 1,924,597 | A | 8/1933 | Drake | 451/550 |
| 1,941,962 | A | 1/1934 | Tone | 5/295 |
| 2,001,911 | A | 5/1935 | Wooddell et al. | 451/529 |
| 2,108,645 | A | 2/1938 | Bryant | 427/204 |

(Continued)

FOREIGN PATENT DOCUMENTS

WO WO 95/00295 1/1995

OTHER PUBLICATIONS

"Superabrasives and Microfinishing Systems" Product Guide. 3M, 1994, 60-4400-4692-2 (104.3) JR.

(Continued)

*Primary Examiner* — Timothy V Eley
(74) *Attorney, Agent, or Firm* — Mark A. Litman & Associates, PA

(57) ABSTRACT

A rotatable abrasive lapper machine platen assembly is attached to a lapper machine frame. The assembly has at least:

a) a circular-shaped rotatable horizontal platen having
   i) a front surface and
   ii) a back surface;
b) the circular platen having a platen radius, a platen outer circumference and a platen outer periphery;
c) the circular platen front surface having an outer annular planar portion where the platen outer annular planar portion extends radially to the circular platen outer circumference; and
d) a flexible abrasive disk secured in conformable flat contact with the circular platen front surface outer annular planar portion wherein the abrasive disk is positioned concentric with the circular platen.

23 Claims, 52 Drawing Sheets

U.S. PATENT DOCUMENTS

| | | | | |
|---|---|---|---|---|
| 2,115,897 | A | 5/1938 | Wooddell et al. | 451/529 |
| 2,216,728 | A | 10/1940 | Benner et al. | 51/298 |
| 2,242,877 | A | 5/1941 | Albertson | 451/527 |
| 2,252,683 | A | 8/1941 | Albertson | 51/298 |
| 2,292,261 | A | 8/1942 | Albertson | 451/527 |
| 2,520,763 | A | 8/1950 | Goepfert et al. | 451/536 |
| 2,755,607 | A | 7/1956 | Haywood | 451/527 |
| 2,820,746 | A | 1/1958 | Keeleric | 205/114 |
| 2,838,890 | A | 6/1958 | McIntyre | 451/527 |
| 2,907,146 | A | 10/1959 | Dyar | 451/529 |
| 3,048,482 | A | 8/1962 | Hurst | 51/298 |
| 3,121,298 | A | 2/1964 | Mellon | 451/539 |
| 3,246,430 | A | 4/1966 | Hurst | 451/534 |
| 3,423,489 | A | 1/1969 | Arens et al. | 264/4 |
| 3,495,362 | A | 2/1970 | Hillenbrand | 451/527 |
| 3,498,010 | A | 3/1970 | Hagihara | 451/527 |
| 3,517,466 | A | 6/1970 | Bouvier | 451/466 |
| 3,605,349 | A | 9/1971 | Anthon | 451/534 |
| 3,702,043 | A | 11/1972 | Welbourn et al. | 451/213 |
| 3,709,706 | A | 1/1973 | Sowman | 501/103 |
| 3,711,025 | A | 1/1973 | Miller | 239/222.11 |
| 3,859,407 | A | 1/1975 | Blanding et al. | 241/3 |
| 3,916,584 | A | 11/1975 | Howard et al. | 51/308 |
| 3,921,342 | A | 11/1975 | Day | 451/550 |
| 3,933,679 | A | 1/1976 | Weitzel et al. | 252/301.1 |
| 3,991,527 | A | 11/1976 | Maran | 451/529 |
| 4,018,576 | A | 4/1977 | Lowder et al. | 51/309 |
| 4,038,046 | A | 7/1977 | Supkis | 51/295 |
| 4,106,915 | A | 8/1978 | Kagawa et al. | 51/296 |
| 4,111,666 | A | 9/1978 | Kalbow | 51/295 |
| 4,112,631 | A | 9/1978 | Howard et al. | 51/295 |
| 4,142,334 | A | 3/1979 | Kirsch et al. | 451/539 |
| 4,225,322 | A | 9/1980 | Knemeyer | 51/295 |
| 4,251,408 | A | 2/1981 | Hesse et al. | 524/541 |
| 4,256,467 | A | 3/1981 | Gorsuch | 51/295 |
| 4,272,926 | A | 6/1981 | Tamulevich | 51/216 |
| 4,311,489 | A | 1/1982 | Kressner | 51/298 |
| 4,314,827 | A | 2/1982 | Leitheiser et al. | 51/298 |
| 4,315,720 | A | 2/1982 | Ueda et al. | 425/8 |
| 4,327,156 | A | 4/1982 | Dillon et al. | 428/568 |
| 4,341,439 | A | 7/1982 | Hodge | 350/96.22 |
| 4,364,746 | A | 12/1982 | Bitzer et al. | 51/298 |
| 4,373,672 | A | 2/1983 | Morishita et al. | 239/703 |
| 4,393,021 | A | 7/1983 | Eisenberg et al. | 264/143 |
| 4,421,562 | A | 12/1983 | Sands | 106/603 |
| 4,426,484 | A | 1/1984 | Saeki et al. | 524/541 |
| 4,536,195 | A | 8/1985 | Ishikawa | 51/293 |
| 4,541,566 | A | 9/1985 | Kijima et al. | 239/224 |
| 4,541,842 | A | 9/1985 | Rostoker | 51/296 |
| 4,586,292 | A | 5/1986 | Carroll et al. | 451/329 |
| 4,652,275 | A | 3/1987 | Bloecher et al. | 51/298 |
| 4,710,406 | A | 12/1987 | Fugier et al. | 427/389.8 |
| 4,773,599 | A | 9/1988 | Lynch et al. | 241/69 |
| 4,773,920 | A | 9/1988 | Chasman et al. | |
| 4,776,862 | A | 10/1988 | Wiand | 51/293 |
| 4,799,939 | A | 1/1989 | Bloecher | 51/293 |
| 4,863,573 | A | 9/1989 | Moore et al. | 205/50 |
| 4,903,440 | A | 2/1990 | Kirk et al. | 51/298 |
| 4,918,874 | A | 4/1990 | Tiefenbach, Jr. | 51/293 |
| 4,930,266 | A | 6/1990 | Calhoun et al. | 51/293 |
| 4,931,414 | A | 6/1990 | Wood et al. | 501/103 |
| 4,974,373 | A | 12/1990 | Kawashima et al. | 51/295 |
| 5,014,468 | A | 5/1991 | Ravipati et al. | 51/295 |
| 5,015,266 | A | 5/1991 | Yamamoto | 51/293 |
| 5,020,283 | A | 6/1991 | Tuttle | 451/550 |
| 5,090,968 | A | 2/1992 | Pellow | 51/293 |
| 5,107,626 | A | 4/1992 | Mucci | 451/28 |
| 5,108,463 | A | 4/1992 | Buchanan | 51/295 |
| 5,110,659 | A | 5/1992 | Yamakawa et al. | 428/141 |
| 5,127,197 | A | 7/1992 | Brukvoort et al. | 51/204 |
| 5,137,542 | A | 8/1992 | Buchanan et al. | 51/295 |
| 5,142,829 | A | 9/1992 | Germain | 451/537 |
| 5,152,917 | A | 10/1992 | Pieper et al. | 51/295 |
| 5,174,795 | A | 12/1992 | Wiand | 51/295 |
| 5,175,133 | A | 12/1992 | Smith et al. | 501/127 |
| 5,190,568 | A | 3/1993 | Tselesin | 51/293 |
| 5,199,227 | A | 4/1993 | Ohishi | 451/527 |
| 5,201,916 | A | 4/1993 | Berg et al. | 51/293 |
| 5,213,591 | A | 5/1993 | Celikkaya et al. | 51/293 |
| 5,219,462 | A | 6/1993 | Bruxvoort et al. | 51/293 |
| 5,221,291 | A | 6/1993 | Imatani et al. | 51/293 |
| 5,232,470 | A | 8/1993 | Wiand | 51/295 |
| 5,251,802 | A | 10/1993 | Bruxvoort et al. | 228/121 |
| 5,273,805 | A | 12/1993 | Calhoun et al. | 428/156 |
| 5,297,364 | A | 3/1994 | Tuttle | 451/527 |
| 5,304,225 | A | 4/1994 | Gardziella et al. | 51/298 |
| 5,316,812 | A | 5/1994 | Stout et al. | 428/64.1 |
| 5,318,604 | A | 6/1994 | Gorsuch et al. | 51/293 |
| 5,352,254 | A | 10/1994 | Celikkaya | 51/295 |
| 5,368,618 | A | 11/1994 | Masmar et al. | 51/295 |
| 5,397,369 | A | 3/1995 | Ohishi | 51/295 |
| 5,435,816 | A | 7/1995 | Spurgeon et al. | 51/295 |
| 5,437,754 | A | 8/1995 | Calhoun | 156/231 |
| 5,474,583 | A | 12/1995 | Celikkaya | 51/309 |
| 5,489,204 | A | 2/1996 | Conwell et al. | 432/153 |
| 5,496,386 | A | 3/1996 | Broberg et al. | 51/293 |
| 5,549,961 | A | 8/1996 | Haas et al. | 428/143 |
| 5,549,962 | A | 8/1996 | Holmes et al. | 428/144 |
| 5,551,961 | A | 9/1996 | Engen et al. | 51/298 |
| 5,611,825 | A | 3/1997 | Engen et al. | 51/295 |
| 5,611,828 | A | 3/1997 | Celikkaya | 51/309 |
| 5,628,806 | A | 5/1997 | Celikkaya et al. | 51/309 |
| 5,641,330 | A | 6/1997 | Celikkaya et al. | 51/309 |
| 5,653,775 | A | 8/1997 | Plovnick et al. | 51/309 |
| 5,674,122 | A | 10/1997 | Krech | 451/536 |
| 5,704,827 | A * | 1/1998 | Nishi et al. | 451/285 |
| 5,733,175 | A | 3/1998 | Leach | 451/41 |
| 5,820,450 | A | 10/1998 | Calhoun | 451/530 |
| 5,888,121 | A | 3/1999 | Kirchner et al. | 451/41 |
| 5,888,548 | A | 3/1999 | Wongsuragrai et al. | 424/489 |
| 5,910,041 | A | 6/1999 | Duescher | 451/28 |
| 5,910,471 | A | 6/1999 | Christianson et al. | 51/295 |
| 5,921,852 | A * | 7/1999 | Kimura et al. | 451/285 |
| 5,924,917 | A | 7/1999 | Benedict et al. | 451/526 |
| 5,967,882 | A | 10/1999 | Duescher | 451/57 |
| 5,975,988 | A | 11/1999 | Christianson | 451/28 |
| 5,984,988 | A | 11/1999 | Berg et al. | 51/293 |
| 5,993,298 | A | 11/1999 | Duescher | 451/56 |
| 6,017,265 | A | 1/2000 | Cook et al. | 451/41 |
| 6,048,254 | A | 4/2000 | Duescher | 451/28 |
| 6,080,215 | A | 6/2000 | Stubbs et al. | 51/295 |
| 6,083,083 | A * | 7/2000 | Nishimura | 451/41 |
| 6,099,390 | A | 8/2000 | Nishio et al. | 451/36 |
| 6,102,777 | A | 8/2000 | Duescher et al. | 451/36 |
| 6,120,352 | A | 9/2000 | Duescher | 451/41 |
| 6,149,506 | A | 11/2000 | Duescher | 451/59 |
| 6,168,508 | B1 | 1/2001 | Nagahara et al. | 451/527 |
| 6,186,866 | B1 | 2/2001 | Gagliardi | 451/28 |
| 6,217,413 | B1 | 4/2001 | Christianson | 451/28 |
| 6,228,133 | B1 | 5/2001 | Thurber et al. | 51/295 |
| 6,231,629 | B1 | 5/2001 | Christianson et al. | 51/295 |
| 6,261,958 | B1 * | 7/2001 | Crevasse et al. | 438/692 |
| 6,277,160 | B1 | 8/2001 | Stubbs et al. | 51/295 |
| 6,277,161 | B1 | 8/2001 | Castro et al. | 51/309 |
| 6,287,353 | B1 | 9/2001 | Celikkaya | 51/309 |
| 6,299,508 | B1 | 10/2001 | Galiardi et al. | 451/28 |
| 6,312,315 | B1 | 11/2001 | Gagliardi | 451/28 |
| 6,319,108 | B1 | 11/2001 | Adefris et al. | 451/533 |
| 6,371,842 | B1 | 4/2002 | Romero | 451/540 |
| 6,375,559 | B1 | 4/2002 | James et al. | 451/527 |
| 6,485,359 | B1 * | 11/2002 | Li et al. | 451/289 |
| 6,521,004 | B1 | 2/2003 | Culler et al. | 51/298 |
| 6,537,140 | B1 | 3/2003 | Miller et al. | 451/259 |
| 6,540,597 | B1 | 4/2003 | Ohmori | 451/443 |
| 6,551,366 | B1 | 4/2003 | D'Souza et al. | 51/309 |
| 6,592,640 | B1 | 7/2003 | Rosenflanz et al. | 51/309 |
| 6,602,439 | B1 | 8/2003 | Hampden-Smith et al. | 252/79.1 |
| 6,607,157 | B1 | 8/2003 | Duescher | 242/417.3 |
| 6,607,570 | B1 | 8/2003 | Rosenflanz et al. | 51/309 |
| 6,613,113 | B2 | 9/2003 | Minick et al. | 51/298 |
| 6,620,214 | B2 | 9/2003 | McArdle et al. | 51/298 |
| 6,641,627 | B2 | 11/2003 | Keipert et al. | 51/296 |

| | | | | |
|---|---|---|---|---|
| 6,645,624 | B2 | 11/2003 | Adefris et al. | 428/402 |
| 6,669,749 | B1 | 12/2003 | Rosenflanz et al. | 51/309 |
| 6,752,700 | B2 | 6/2004 | Duescher | 451/59 |
| 6,766,817 | B2 | 7/2004 | da Silva | 137/1 |
| 6,769,969 | B1 | 8/2004 | Duescher | 451/59 |
| 6,835,118 | B2 * | 12/2004 | Berkstresser et al. | 451/28 |
| 6,929,539 | B2 | 8/2005 | Schutz et al. | 451/534 |
| 7,001,251 | B2 * | 2/2006 | Doan et al. | 451/41 |
| 7,175,504 | B2 * | 2/2007 | Izumi et al. | 451/5 |
| 7,255,630 | B2 * | 8/2007 | Elledge | 451/8 |
| 2002/0003225 | A1 | 1/2002 | Hampden-Smith et al. | 252/79.1 |
| 2003/0000151 | A1 | 1/2003 | Rosenflanz et al. | 51/309 |
| 2003/0022604 | A1 | 1/2003 | Annen et al. | 451/59 |
| 2003/0024169 | A1 | 2/2003 | Kendall et al. | 51/297 |
| 2003/0110707 | A1 | 6/2003 | Rosenflanz et al. | 51/307 |
| 2003/0110709 | A1 | 6/2003 | Rosenflanz et al. | 51/307 |
| 2003/0114079 | A1 * | 6/2003 | Berkstresser et al. | 451/28 |
| 2003/0115805 | A1 | 6/2003 | Rosenflanz et al. | 51/307 |
| 2003/0126804 | A1 | 7/2003 | Rosenflanze et al. | 51/307 |
| 2003/0143938 | A1 | 7/2003 | Braunschweig et al. | 451/533 |
| 2003/0207659 | A1 | 11/2003 | Annen et al. | 45/526 |
| 2004/0020245 | A1 | 2/2004 | Rosenflanz et al. | 65/469 |
| 2004/0023078 | A1 | 2/2004 | Rosenflanz et al. | 428/702 |
| 2004/0148868 | A1 | 8/2004 | Anderson et al. | 51/308 |
| 2004/0148869 | A1 | 8/2004 | Celikkaya et al. | 51/308 |
| 2004/0148870 | A1 | 8/2004 | Celikkaya et al. | 51/309 |
| 2004/0148966 | A1 | 8/2004 | Celikkaya et al. | 65/17.4 |
| 2004/0148967 | A1 | 8/2004 | Celikkaya et al. | 65/21.2 |

OTHER PUBLICATIONS

"Experimental Study and Neural Network Modeling of the Ligament Disintegration in Rotary Atomization" Atomization and Sprays, vol. 12, pp. 107-121, 2002, Stephan Stemowsky and Gunther Schulte, University of Bremen, Bremen, Germany and Roberto Guardani and Claudio A. O. Nascimento, Chemical Engineering Department (LSCP), University of Sao Paulo, Sao Paulo, Brazil.

"Simulatios of Sol Gel Materials," Gelb Research Group at Washington University in St. Louis, http://www.chemistry.wustle.edu/~gelb/solgel.html. (later version).

"Simulatios of Sol Gel Materials" Gelb Research Group at Washington University in St. Louis, http://www.chemistry.wustle.edu/~gelb/solgel.html. (newer version).

"Silica Aerogels," Microstructures Materials Group, http://eetd.lbl.gov/ECS/aerogels/sa-making.html.

Introduction to Hybrid Organic-Inorganic Materials (12h), University of Bordeaux-1/Doctoral School of Chemical Sciences PhD students, http:www.icmcb.u-bordeaux.fr/duguet/ostdea.htm.

J. B. CalverT, "Colloids," http://mysite.du.edu/~jcalvert/phys/colloid.htm, Dec. 5, 2002.

Malcolm Summers, et al., "Granulation," Dosage Form Design and Manufacture, pp. 364-378.

* cited by examiner

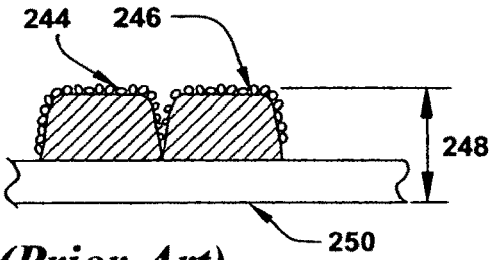
(Prior Art)
Fig. 28
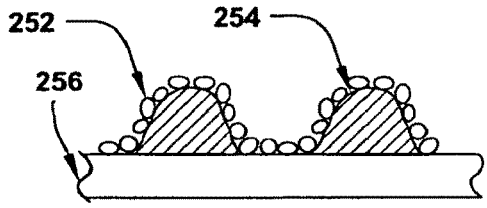
Fig. 29 (Prior Art)
(Prior Art)
Fig. 30
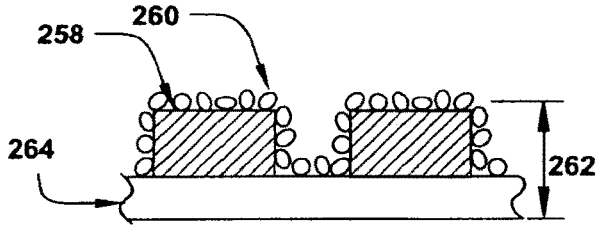
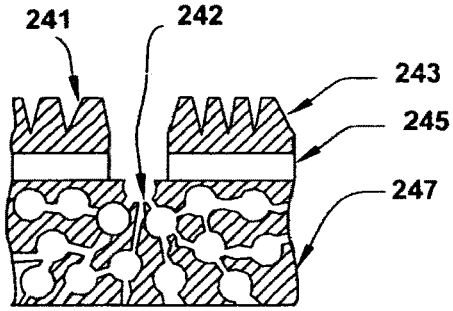
(Prior Art)
Fig. 31
(Prior Art)
Fig. 32
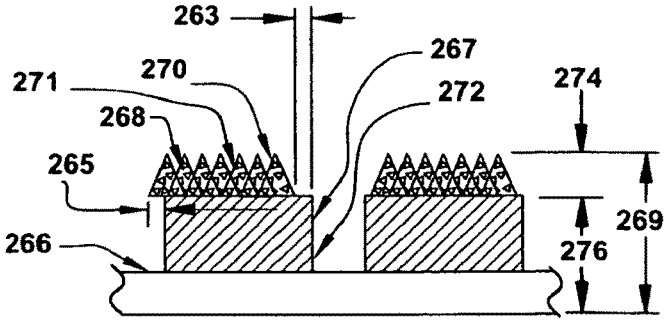

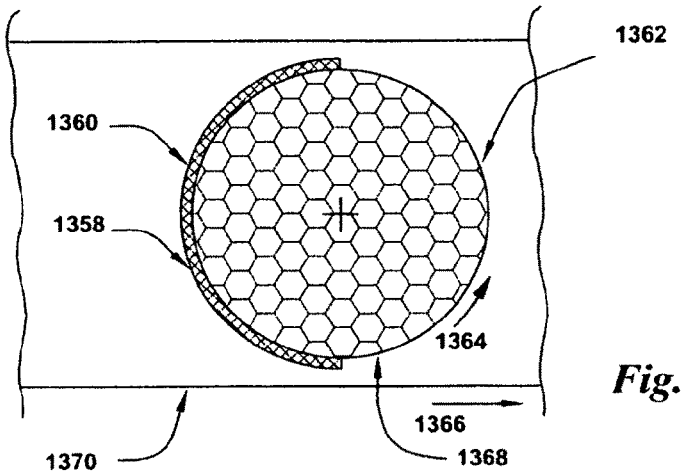
Fig. 131
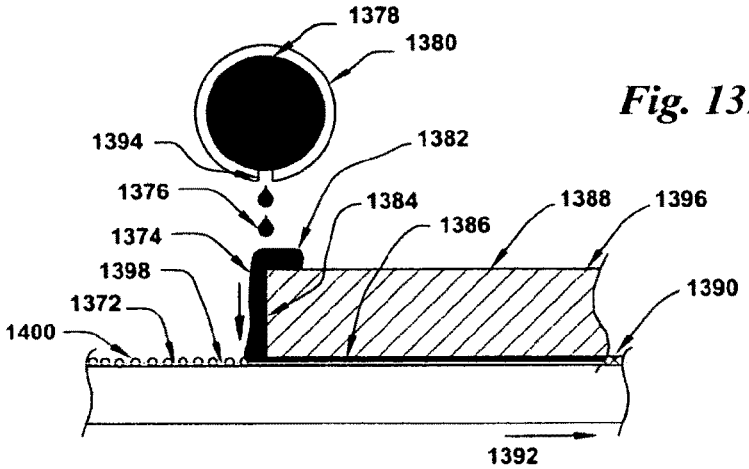
Fig. 132
Fig. 133
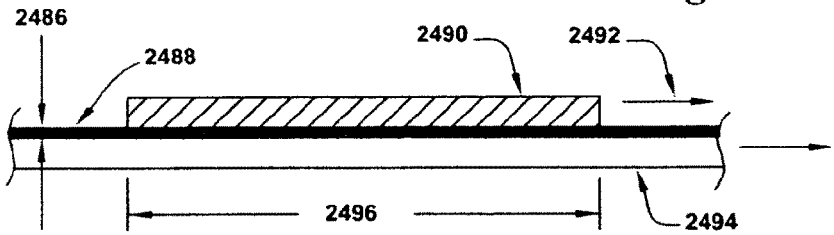
Fig. 134
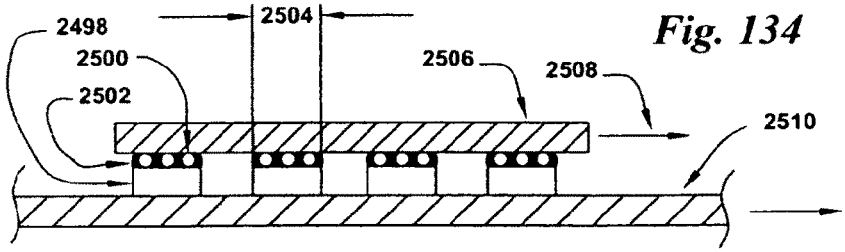

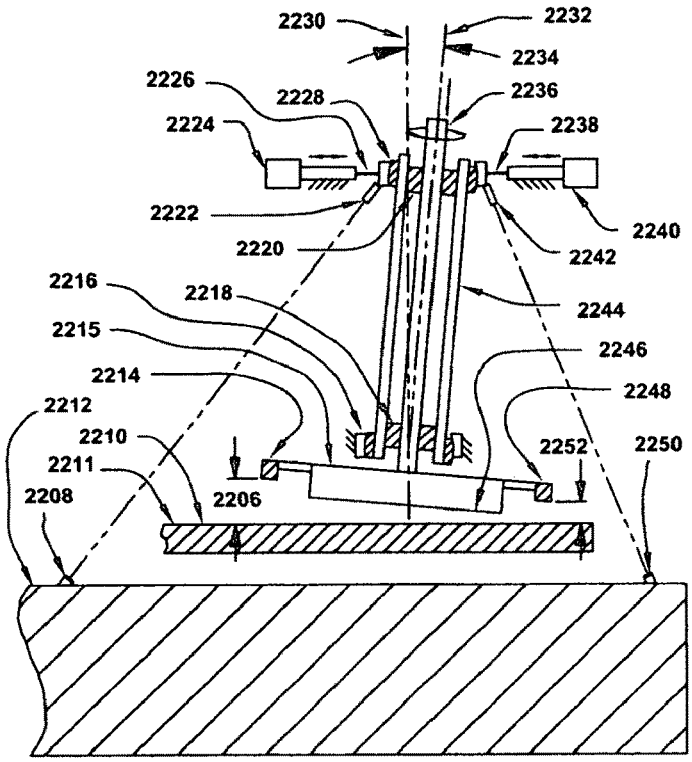
*Fig. 164*
*Fig. 165*
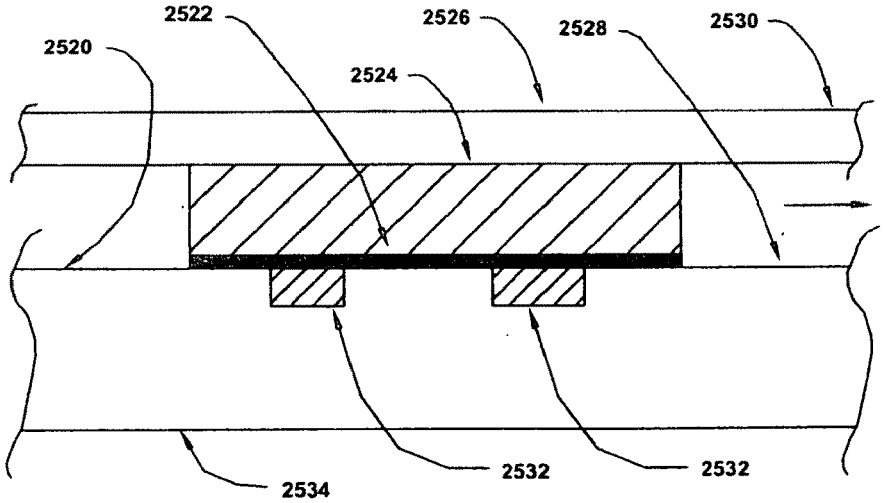

HIGH SPEED FLAT LAPPING PLATEN

RELATED APPLICATIONS DATA

This application is a continuation-in-part of U.S. patent application Ser. No. 11/029,761, filed Jan. 5, 2005, which is a continuation-in-part of U.S. patent application Ser. No. 10/816,275, filed Aug. 16, 2004 now U.S. Pat. No. 7,520,800, which is a continuation-in-part of U.S. patent application Ser. No. 10/824,107, filed Apr. 14, 2004 now U.S. Pat. No. 7,632,434, which in turn is a continuation-in-part of U.S. patent application Ser. No. 10/418,257, filed Apr. 16, 2003, now Abandoned, which is a continuation-in-part of U.S. patent application Ser. No. 10/015,478, filed Dec. 13, 2001, now U.S. Pat. No. 6,752,700, which is a continuation-in-part of U.S. patent application Ser. No. 09/715,448, filed Nov. 17, 2000, now U.S. Pat. No. 6,769,969.

BACKGROUND OF THE ART

Field of the Invention

The present invention relates to flat lapping, polishing, finishing or smoothing of precision hard-material workpiece surfaces with diamond abrasive sheet disks that are operated at high surface speeds. In particular, the present invention relates to providing flexible disks that have annular bands of fixed-abrasive coated flat surfaced raised islands that can be successfully used to flat-lap hard workpieces at high abrading surface speeds in the required presence of coolant water without hydroplaning of the workpieces. These precision thickness abrasive disks are attached with vacuum to the upper flat horizontal surface of precision flatness rotary platens. In order to seal the platen vacuum port holes the flexible disks have a continuous mounting-side backing surface which allow the flexible disk to conform to the platen flat surface to effect the vacuum seal between the disk and the platen.

High speed flat lapping requires a new class of fixed abrasive flexible sheet disk articles. They must be used together with new types of lapping machines and with new types of lapping process procedures. Together, the new abrasive disks, the new lapping equipment and the new procedures provide a lapping system that can successfully flatten and smoothly polish hard material workpieces at high abrading speeds. This system can provide flat lapped workpieces at production rates that are many times faster than the conventional slurry lapping system. However, this system must be operated in a fashion where the precision flatness of the abrasive disk articles is maintained over the full abrading life of the disks.

Attempts have been made to use conventional continuous-coated abrasive lapping film sheet disks for high speed flat lapping but they have resulted in failure because precision flat workpiece surfaces cannot be provided with these disks for this type of lapping. A review of many of the individual process events and variables that occur in water cooled high speed flat lapping is required to provide an understanding of the reasons that the continuous-coated abrasive surface is not successful, and comparatively, why these raised island articles can work so well. These abrasive events and variables and their effects on high speed flat lapping are individually described here. Also, a system of raised island abrasive media, lapper machine equipment and process procedures is described here that successfully provides flat lapped workpieces at very high production rates and large cost savings.

In particular, the behavior of the coolant water is described at each event from when it is first deposited on the surface of the moving abrasive to when it exits the abrading interface gap between the flat workpiece surface and the abrasive. The descriptions here demonstrate how the abrading events and the technical considerations that are required for this high speed flat lapping system are so unique as compared to the events and considerations of traditional lapping or abrading systems. Most of the concepts of the actions and reactions of the unique coolant water events that occur in flat lapping at high speeds are quite complex as compared to those that occur in conventional abrading processes. These concepts and reactions are individually reduced to quite simple but accurate representations of their process effects. They can all be individually verified in discrete event analyses empirically by those skilled in the art of abrading or analytically by those skilled in hydrodynamic analyses. The end result is a precision high speed flat lapping system that is successful, easy to use, and is highly productive.

When non-island flat-surfaced abrasive disk articles that are uniformly coated with very small abrasive particles or abrasive agglomerate spherical beads are used at high abrading speeds during a water cooled flat lapping operation, the fast moving abrasive tends to cause hydroplaning of the workpieces. The causes of this hydroplaning comprise a number of primary sources. One is the angled shape of the workpiece wall. The second is the original surface defects on the surface of the workpiece. The third is the non-flat surface areas as a result of the thickness variations of the abrasive article. The fourth is the use of non-flat platens that support the flexible abrasive sheet article. The fifth is uneven wear that occurs on an abrasive article surface.

For example, small-angled surface-defect areas that exist on the near-flat surface of the non-finished workpiece can form shallow-angled wedge-shaped areas between the near-flat workpiece surface and the contacting flat abrasive surface. Coolant water that is present as a film on the flat surface of the abrasive is driven into these wedge shaped areas by the abrasive, which is moving at high speeds. The surface-defect wedge areas occur randomly over the surface of the workpieces. Hydroplaning is defined here as when the workpieces is lifted and/or tilted by the coolant water during the abrading process. Very large workpiece lifting pressures can be developed in these shallow-angled wedge areas by the hydrodynamic forces generated in this action. This workpiece leading-edge tilting action can then result in new non-flat workpiece surfaces being created by abrading action on the trailing-edge surface of the downstream side of the workpiece that is opposite to the leading-edge upstream-side original workpiece wedge defect. In this way one workpiece defect can cause the generation of another opposing workpiece surface defect and both of these surface defects can become progressively larger during a lapping process due to these high speed hydroplaning effects.

An analogy to workpiece hydroplaning is where the tapered front end of a high speed boat is raised or lifted up as it rides up on the surface of the water and the blunt stern end is "lowered" whereby the whole boat is tilt-angled to the water surface. Higher boat speeds produce larger lifting forces.

Variations in the thickness of an abrasive disk article can result in low-spot disk-surface areas. These thickness variations can be a result of a disk manufacturing process or they may be a result of uneven wear on a disk. Non-flat platen surfaces can also produce these same low-spot areas on the surface of an abrasive disk even when the disk is precisely thick. Small "lakes" of water can be carried in these low spot surface areas by the abrasive that is moving at high speeds. These moving lakes then contact the workpiece surface where they tend to be "rolled up" in the interface gap between the workpiece and the abrasive by water shearing forces. Here, a portion of the workpiece surface is raised upward which results in a tilted workpiece that is abraded unevenly.

During a high speed lapping process it is important to start with a workpiece that has surface defects, abrade it until it is precisely flat and then progressively polish it to the required smoothness without disturbing the required surface flatness that was established in the early process steps.

Hydroplaning is a hydrodynamic event that is well known to those skilled in the study of fluid dynamics and is explained in detail as described in the classical Lubrication Theory analyses as developed by Osborne Reynolds. He defined the large plate separation forces that occur when sliding one slightly-angled flat plate past another flat plate with an interface film of lubricating fluid between the two plate surfaces. The typical 0.001 inch (25 micrometer) thickness of the Reynolds lubricating films in slider plates and rotary journal bearings is approximately the same thickness as the coolant water films that are used in high speed flat lapping. Workpiece hydroplaning tends to occur when very small sized abrasive agglomerate beads are coated in monolayers on disk backings to form substantially smooth continuous flat abrasive surfaces and these disks are used in high speed flat lapping. However, when the continuous abrasive disk surface is broken into the small raised island abrasive tangential segments, as described herein, the effect of hydroplaning is significantly reduced. The raised islands on abrasive disks only require narrow island land lengths measured in a disk tangential direction with tangential recessed gaps between the islands. The abrasive islands break up the abrasive surface into segments that prevent hydroplaning. These same islands can have long-length radial bar segments without affecting hydroplaning because the disk high speed motion is only in the disk tangential direction. An analogy to the use of abrasive raised islands is the hydroplaning of smooth surfaced or worn-bald automobile tires (continuous "smooth" abrasive surfaces) at high speeds on a water-wetted road while a new tire having a distinct tread pattern of individual lugs (raised islands) firmly grips the wetted road surface.

Successful high speed flat lapping requires a lapping system and a lapping process procedure that includes water cooled precision thickness disks having annular bands of abrasive coated raised islands. Here, the disks are mounted on rotary platens that remain precisely flat at all operating speeds. Also, the workpieces are rotated in the same direction as the platen to provide uniform abrading across the workpiece surface and also to provide uniform wear of the abrasive surface. Further, the abrading contact pressure is varied at different abrading events during an abrading process to better control the extremely fast cutting action of the diamond particles operating at high abrading speeds. Further, it can be necessary to mount workpieces on workpiece holders that rotate and that have off-set spherical centers that are located at the workpiece surface to resist workpiece tilting actions due to abrading friction forces. As a workpiece becomes precisely flat and smooth, the coolant water that is present in the interface between the workpiece and the abrasive acts as a drag on the workpiece. When the water film becomes very thin the dragging or stiction force can become very large.

Rotary platens are most often used for high speed flat lapping because they provide a continuous-speed abrading motion. Other high speed lapping equipment systems can employ oscillating workpieces or platens but there are many dynamic problems associated with these systems because of the required periodic change of motion directions. Moving workpieces or platens back and forth at high speeds tend to periodically tilt the workpieces or platens because of the resistance of the system component mass inertias to the fast accelerations and decelerations that accompany changes in motion direction.

The preferred diameter of the abrasive beads used in high speed flat lapping is very small and it is also desired that these small beads have equal sizes. Further, there is a preferred gap between the individual beads that are coated on an abrasive article. Beads that are too small in diameter do not provide a sufficient quantity of abrasive particles to sustain an adequate abrading life for the abrasive disk. Beads that are too large allow the abrasive disk article to have too much uneven wear during the wear-down of the disk.

For high speed flat lapping, diamond particle filled agglomerate beads having a preferred non-worn maximum bead diameter of 0.002 inches (45 micrometers) are used. This preferred maximum bead sized is based on providing an abrasive disk article that initially has a planar abrasive surface area that is precisely flat when first used and that also provides a planar abrasive surface area that still remains precisely flat after extensive use even until the abrasive article is worn enough to be discarded. This means that the abrasive disk article will only be worn down by a total of 0.002 inches (45 micrometers) before it is discarded. Because the total wear of the abrasive disk is limited as described here, these abrasive disk articles act very much like cutting tools that hold almost all of their original shape before they are re-sharpened for re-use. Unlike cutting tools, the abrasive article abrasive particles remain sharp with extended use because new sharp abrasive particles are continuously exposed upon abrasive bead wear down. However, it is not practical to "re-sharpen" or re-flatten one of these abrasive disks when it is partially worn down by cutting down the height of some of the abrasive beads because of the large cost associated with throwing away all of the expensive diamond particles that would be removed from the disk by the re-flattening process. Great care is taken in high speed lapping processes to assure even wear of the abrasive article across the full surface of the abrasive so that the article can be successfully used in flat lapping over the full abrading life of the abrasive disk article.

Workpiece hydroplaning is particularly related to the use of the small sized abrasive particles or abrasive agglomerate beads that are coated on abrasive disk articles that are used for flat lapping. Small diameter beads that have short "heights" relative to the thickness of the coolant water film that is applied to the surface of the high speed moving abrasive are easily flooded. The result is that the water that covers the top surface of the abrasive beads can prevent abrading contact with a workpiece. When these small diameter beads become worn down it is even more difficult to prevent flooding of the abrasive beads because a continuous abrasive surface does not allow the excess coolant water to be channeled away from the top surface of the abrasive beads. Any coolant water in excess of that required to adequately cool both the workpiece and the abrasive materials is considered to be excess water. It is not typically practical to reduce the thickness of the coolant water film as the abrasive disk wears down where the abrasive beads height is severely reduced from their original non-worn heights of only 0.002 inches (45 micrometers). Use of lesser quantities of coolant water to prevent hydroplaning as an abrasive disk wears down can easily result in the danger of producing overheated abrasive particles or overheated workpiece surfaces.

Hydroplaning of a workpiece is somewhat less likely to occur when individually spaced very large sized abrasive particles or abrasive beads are used in conjunction with minimal thicknesses of coolant water. The excess coolant water that would tend to float the workpiece can be routed or "bled off" between the individual abrasive particles or beads during the abrading operation. However, the advantage of using larger sized abrasive beads to prevent the bead flooding problem exists only when the beads are not substantially worn down.

To prevent the occurrence of hydroplaning with continuous surfaced abrasive disk articles at high abrading speeds disk articles having raised island abrasive are used. These raised island disks having recessed area channels between the abrasive coated islands prevents excess water from being trapped between the abrasive surface and the workpiece surface. The recessed channels results in the flow of excess coolant water from the island top surfaces to the recessed channels by the force of gravity even when the abrasive beads are very small in size or are substantially worn down. The raised island disk articles are mounted on a horizontal flat platen, where the raised islands protrude upward from the platen to provide flow of excess water down into the recessed channels and away from the workpiece and abrasive interface areas. Once the excess water is located in the recessed channels it does not move back up to the abrasive island top surfaces. However, if raised island disk articles are used "upside down" as is the case where these disks are mounted on a portable manual hand grinder, gravity does not force the excess water upward into the channels so the excess water does not remain cleared away from the abrasive surfaces.

Flat lapping, as the name indicates, can only be performed on flat workpiece surfaces using flexible abrasive articles that are supported on a rigid flat platen surface. The fixed abrasive coated raised island disks having thin coatings of abrasive that are described here for high speed flat lapping can not be effectively used on curved, convex or concave workpiece surfaces. Abrading occurs simultaneously over the full flat surface of the workpiece. In flat lapping, the highest non-flat workpiece areas are first removed by abrasion to quickly and progressively create a precisely flat surface. After the whole workpiece surface is made precisely flat with the use of large (coarse) abrasive particles then progressively smaller (fine) abrasive particles are sequentially used to develop a smoothly polished workpiece surface.

Even though some abrasive beads may contain large coarse 10 micrometer diamond abrasive particles and other beads may contain small fine 1 micrometer abrasive particles, the bead diameters in both case would typically be 45 micrometers (0.002 inches). Because each of the two example beads contain diamond particles of substantially different sizes, each of the equal sized beads contains approximately the same volume of diamond abrasive particle material. Therefore, an abrasive article that is coated with the 10 micrometer diamond particle beads can have approximately the same cost, the same abrading life and economic performance as the article that contains the 1 micrometer (or even 0.1 micrometer) diamond particle beads. It is critical that the polishing action provided by the subsequent small fine abrasive particles, when used at high abrading speeds, do not change the already-established precisely flat workpiece surface into a non-flat surface.

In comparison with the conventional slow-rotation liquid abrasive slurry lapping system that is presently used to flat lap workpieces the productivity of the high speed raised island flat lapping system using diamond particles has the capability to be many times greater.

Diamond abrasive particles can be used at much higher abrading speeds and have a much greater abrading productivity than other conventional fixed-abrasives such as aluminum oxide. Even though superabrasive abrasive particles, including diamond and cubic boron nitride (CBN), are expensive as compared to conventional abrasive materials such as aluminum oxide, they are preferred for use in high speed flat lapping because their hard-material workpiece cut rates are so high. Diamond is used for non-ferrous and ceramic workpiece material while CBN is used for ferrous material.

The very small sized abrasive particles that are required to produce the smoothly polished flat lapped workpiece surfaces are encapsulated in larger sized porous ceramic spherical beads that are coated in monolayers on the top flat surfaces of the raised islands. As these superabrasive materials are very expensive it is necessary to provide abrasive articles that utilize essentially all of the superabrasive material when the abrasive article is progressively worn down. If an abrasive disk has localized wear problems, the disk is typically discarded at significant economic loss.

Flat lapped workpieces require surface finishes that are both precisely flat and smoothly polished. The measured deviation of the localized workpiece surface height from a plane across the full width of a workpiece is used to establish a workpiece surface flatness. A typical flat lapped workpiece flatness is one lightband (11.1 millionths of an inch or 11.1 microinches or 0.28 micrometers) or much less and the polish is a mirror finish. This degree of accuracy that has to be provided across the full flat surface of a workpiece at high abrading speeds is beyond the capability of conventional abrasive articles. The described flatness variations of a flat lapped workpiece are typically so small that even an exceedingly thin film of coolant water can be wedged into the small workpiece surface angled defects by high speed abrasives and cause substantial hydroplaning.

A typical flat lapped polished mirror surface finish ranges from 0 to 0.5 microinches (0 to 0.013 micrometers). The smoothness or polish of a workpiece surface is established by measuring the deviation movement of stylus probe across a short localized segment of the workpiece surface. Here, a profilometer device is used to measure the depth of workpiece surface scratches to numerically establish the smoothness of the polished surface finish. As the abrading scratches that are produced in a workpiece by an abrasive particle is approximately equal to the size of the particle it is necessary to use diamond abrasive particles that are much smaller in size than 0.1 micrometer (0.0000039 inches) to produce these mirror finishes. Flat lapping requires the use of abrasive particles that are much smaller in size than are used in conventional abrading. However, it is common practice to encapsulate these very small diamond abrasive particles in abrasive agglomerate beads that have a typical bead diameter of 45 micrometers (0.0018 inches), a bead size that is very practical to coat on an abrasive article.

There is a relationship between the size of the individual abrasive agglomerate beads that are coated in a monolayer on the top surfaces of the raised islands and the dynamic flatness of the high speed rigid platen flat lapping system that supports the raised island abrasive sheet article. The spherical abrasive beads contain many individual sharp edged abrasive particles that are much smaller in size than the abrasive bead diameters. This bead-size to platen flatness relationship defines how flat a platen system has to be in order to fully utilize all of the abrasive material that is coated on the abrasive article. If a platen flatness variation exceeds the diameter of the abrasive beads, some of the abrasive beads will be scraped or worn off the abrasive article by the workpiece and some of the other abrasive beads will not even contact a workpiece surface. The scraped-off beads are ejected from the abrasive article surface prior to providing any abrading action. Those other abrasive beads that reside in low-spot areas of a non-flat platen will not be utilized because they do not contact the surface of the workpiece. To fully utilize all of the abrasive that is coated on an abrasive article, it is desired that the total flatness variation of a platen system over the full range of the platen speed (also referred to here as dynamic flatness) be much less than the size of the abrasive beads.

The same type of relationship exists between the size of the abrasive beads and the thickness of the raised island abrasive article to fully utilize all of the abrasive agglomerate beads that are coated on the abrasive article during high speed lapping. Here, it is necessary to provide abrasive articles that have precision thicknesses that are mounted on platen systems that remain precisely flat at all abrading speeds. It is desired that the combined overall thickness variation of the abrasive article and the variation in the flatness of the platen system that is used in high speed flat lapping be less than 50% of the size of the abrasive agglomerate beads or less than 30% or less than 20% or even less than 10% of the average size of the abrasive beads that are coated on an abrasive article. Because the typical unworn abrasive bead size that is coated on an abrasive article used for high speed lapping has a typical approximate 45 micrometers (0.0018 inches) size diameter, at the desired disk thickness variation of 10% of the abrasive bead diameter, the desired allowable abrasive article thickness variation is only 4.5 micrometers (0.00018 inches). Likewise, for this same abrasive bead size, the allowable platen system flatness variation is only 4.5 micrometers (0.00018 inches).

These allowable flatness variations are defined as the variation as measured from a planar surface. However, it is reasonable from a expensive abrasive bead utilization standpoint, that these same allowable article thickness tolerances and the platen system dynamic flatness tolerances be measured from peak-to-valley points which effectively doubles the required precision of the allowable article thickness and platen flatness variations.

Abrasive disk articles that are used for high speed flat lapping typically have large disk diameters of from 12 inches (30 cm) to even 60 inches (152 cm) or more. It is extremely difficult to provide raised island abrasive articles of these disk diameter sizes with these desired thickness tolerances without special and non-traditional raised island disk manufacturing techniques being used. The high speed lapping machine equipment that is required to provide these precision flatness tolerances at the high abrading speeds are also very special and non-traditional. The raised island abrasive disk articles that are described in the prior art simply are not adequately precise in thickness to be successfully used for high speed lapping.

Prior art raised-island abrasive disks have been used to abrade workpieces for many years. However, these disks can not be successfully used to flat lap workpiece surfaces at high abrading speeds. Each of the prior art raised island abrasive disks, as described by Romero in U.S. Pat. No. 6,371,842 and many other earlier prior art raised island patents, all have a missing element in their patents that is critical for high speed flat lapping. The missing element is that they do not provide the extra manufacturing step of assuring that their abrasive disks have the precision thickness across the full abrasive surface that would allow their disks to be used for high speed flat lapping.

All of these Romero and other prior art patents have drawings that were produced by utilizing drafting devices or computer aided design (CAD) systems that inherently show the island abrasive surfaces parallel to, or co-planar with, each other and parallel to, or co-planar with, the bottom mounting surfaces of the abrasive articles. However, even though these drawing views "show" these planar and co-planar features, the prior art actual manufactured abrasive disks are not necessarily co-planar. In order for these surfaces to be co-planar, numerical dimensions and tolerances must specifically define the relative locations of these surfaces. These drawing dimensional specifications are required to define the nominal relative location of components and the allowable tolerance of these dimensional locations. They are not defined by pictorial views. An analogy is a drawing of a house that has floors and walls that are defined by drawing lines. Instead of simply relying on the pictorial views of the house for construction specifications, it is necessary that specific drawing based dimensions and tolerances are be used to accurately define the desired parallelism of the multiple floors. Likewise wall-to-wall dimensions and dimensional tolerances must be used to define the parallelism of the walls and also to define that the walls are perpendicular to the floors. These dimensional specifications allow different builders to construct houses that meet the desired house specifications. Decreasing the size of the allowable dimensional variations adds considerably to the manufacturing cost of an article. To reduce the article cost, typically the allowable dimensional variations are diminished only as much as is permissible for the article to function properly. These critical dimensional variation tolerance teachings are completely lacking in all the prior art raised island abrasive disks.

Defining surfaces to be "roughly approximate in size" or "substantially planar" or "substantially co-planar" also do not satisfy the specification criteria needed to provide the component-to-component planar positioning that is required for high speed flat lapping. High speed flat lapping requires full-face contact of a workpiece flat surface with a flat surfaced abrasive where workpiece material is simultaneously removed across the full surface area of the workpiece by the contacting abrasive. This can only be achieved when all of the individual fast-moving abrasive particles remain precisely in a plane as they contact the abraded flat surface of a workpiece.

In addition, a high speed lapping process comprises the sequential and repeated sequential use of individual abrasive disks that have progressively finer abrasive particles. The first disks have coarse particles to "rough in" a workpiece surface to initially develop a flat workpiece surface; a second sequential disk has medium sized particles to remove the now-flat workpiece top surface material that was scratched by the coarse particles in the previous step; then a third sequential disk is used to develop the smoothly polished workpiece surface that is required for flat lapped workpieces. All three abrasive disks are typically used on the same lapping machine platen as it is too expensive to have separate lapping machines for each abrasive grit size. Also, it is easier and faster to change an abrasive disk than it is to remount a workpiece onto a workpiece holder on a different lapper machine. The abrasive disks are used until they are worn out on an individual disk basis at which time they are discarded and replaced with new disks having the same abrasive particle grit size. In this way, "old" abrasive disks are used interchangeably with "new" abrasive disks. Each time an abrasive disk is re-mounted on a flat surfaced platen the disk must be fully functional with a flat planar abrasive surface without having to re-establish the original wear-in of the disk abrasive. To best achieve this it is preferred that when a partially-worn disk is remounted on a platen that the disk is positioned in the same tangential position on the platen that it had when it was temporarily removed to eliminate any out-of-plane variances that exist on the surface of the platen. When a new unworn abrasive disk initially contacts a workpiece surface the variations in the planar flatness of the abrasive surface can cause uneven wear on the workpiece surface.

Repeated wear-ins of these expensive diamond particle disks is undesirable because of the economic losses that are sustained with the repeated loss of the diamond particles that are expended during this procedure. In addition, the extra process step of the disk reconditioning process is time consuming and expensive. Because the diamond abrasive bead particles typically only have a very small unworn size of 0.002 inches (51 micrometers) small amounts of the existing abrasive bead removal to redevelop the necessary precision planar flatness of the abrasive surface can easily consume a large fraction of the diamond abrasive material that remains on a partially worn abrasive disk. In part, this is why it is required that high speed flat lapper platens maintain very precision flatness planar surfaces throughout the full range of the platen rotational speeds. The abrasive disks described in the prior art do not have the capability to be interchangeably reused where a new unworn disk is substituted for a worn discarded disk because those prior art abrasive disks do not have the required abrasive disk thickness control that is necessary to allow this abrasive disk interchangeability. Removal of substantial amounts of the abrasive top surface by contacting a partially abraded workpiece surface to wear in these uncontrolled-thickness abrasive disks can be very disruptive to a high speed flat lapping process.

A number of construction features must be present in abrasive disks that are used for high speed lapping. First, all of the abrasive particles in the whole top abrading surface area of the abrasive must be located precisely within a plane. Second, it is necessary that the planar top surface of the abrasive must also be precisely coplanar with the bottom mounting surface of the abrasive disk. This coplanar feature is required to allow the plane of the abrasive surface to maintain its planar position even when the platen that the abrasive disk is mounted on is rotated at the high speeds used in high speed lapping. Here, even if an abrasive disk that has a planar abrasive surface that is not coplanar with the disk baking mounting surface is mounted on a platen that operates with a perfectly flat planar surface, the planar abrasive surface will wobble as the platen is rotated. This abrasive wobble will present only the resultant highest elevation abrasive particles to have abrading contact with the workpiece, which results in uneven abrasion of the workpiece surface. This wobble will also generate a periodic impact force that will tend to lift or "float" the workpiece off the abrasive surface as the platen rotates at high speeds, which also results in uneven abrasion of the workpiece surface.

When abrasive disks that have individual abrasive particles, or even some islands, at different elevations than others relative to the back mounting side of the disk, the abrasive particles will not provide uniform abrading across the full surface of the workpiece. Here, only the highest elevation individual abrasive particles will have abrading contact with the workpiece, which also results in uneven abrasion or even localized scratching of the workpiece surface.

Production of flexible abrasive disks that have precision thicknesses where all the abrasive particles have the same height relative to the disk mounting backside adds complexity to the disk manufacturing processes and adds substantial expense to the disks as compared to the traditional raised island abrasive disks described in the prior art. Because the high speed lapping requirement for this precision abrasive disk thickness control of abrasive covered raised islands along with the use of very small abrasive particles was not identified or understood as described in the prior art there was no motivation present then by these inventors to add the more complex and expensive manufacturing steps in the production of their abrasive disks. Their non-precision abrasive disk thickness control was adequate for the prior art raised island abrading disk abrading uses where the extra expenses and efforts of precision disk thickness control would have been wasted. In part, this lack of understanding was related to the more recent knowledge that small sized diamond abrasive particles have a unique capability to abrasively remove very hard workpiece material at very high rates and also achieve very smoothly polished surfaces.

It has been found that a specific metal plated prior art raised island disk as described by Gorsuch in U.S. Pat. No. 4,256,467 can be successfully used on a precisely flat platen to develop a flat workpiece surface in the presence of coolant water at high abrading speeds. However, these metal plated island disks to not have the capability to provide the precisely polished flat surfaces that are required for flat lapping. The subsequent use of continuous coated abrasive disks, having small enough sized abrasive particles at high speeds to produce smoothly polished surfaces, on these same already flattened workpieces resulted in workpieces that were smooth but they were no longer precisely flat. Hydroplaning effects caused the non-flat workpiece surfaces. Other prior art raised island disks did not provide small sized abrasive particles with the required disk thickness accuracy control to allow them to be successfully used at high speeds on a precision flatness rotary platen.

It is well known to those skilled in the art of abrading that raised island abrasive articles must have a precisely flat-surfaced abrasive to successfully abrade a precision planar surface on a workpiece. For example, in prior art, Yamamoto in U.S. Pat. No. 5,015,266 uses a reverse-roll slurry coater to apply a planar liquid abrasive slurry coating to raised island projections that have been embossed into a backing sheet in order to provide an abrasive article that can develop a precision planar surface on a workpiece. Further, Yamamoto states that the abrasive coated raised islands described by Kirsch in U.S. Pat. No. 4,142,334 are inadequate to abrade and finish a precision planar surface workpiece because the Kirsch abrasive article does not have good precision planar layers precision abrasive layers. Also, Yamamoto states that the abrasive coated raised islands described by Kalbow in U.S. Pat. No. 4,111,666 is inadequate to finish a workpiece to be a precise planar surface because the Kalbow abrasive layers are not attached evenly on the raised island surfaces.

Some of the prior art raised island abrasive articles can be used at high speeds to create precision flat surfaces on a workpiece but their usefulness is limited to developing a flat surface rather than flat and polished surfaces. Use of these prior art articles that do not have precision thickness flat-surfaced raised islands results in very localized abrading contact where only some of the islands or only portions of each island is in contact with a workpiece. It is not practical to wear down all of the unequal-height islands on these articles until they all will mutually contact a flat workpiece because of the great economic loss that occurs in this wear-down surface conditioning event when using expensive diamond abrasive particles. Diamond particles are required for use at the very high abrading speeds to provide the resultant unique high cutting rates. A rough analogy to the use of these prior art raised island abrasive articles is where a workpiece is placed in contact with a moving machine tool having only a few cutting bits where each bit independently removes workpiece material. At high speeds these sparse-spaced bits will provide a flat workpiece surface but can not provide the smooth polish required for flat lapping. In addition, the cutting tool must traverse the surface of the workpiece to provide cutting contact with the full surface of the workpiece to avoid cutting tracks from each tool bit. For example a single lathe tool bit can radially traverse a workpiece surface but tool-tracks are left on the workpiece surface. When the flat surfaced raised island abrasive articles of this invention are used all of the islands are in contact with a workpiece without the existence of objectionable abrading tracks on the workpiece surface.

Most of the prior art raised island abrasive disks have disk-center mounting aperture holes and use thick fiberboard backings that provide enough strength for their intended use on manually held disk grinders. These disks typically are coated with very large sized abrasive particles and are used to rough grind workpieces. Little effort or manufacturing expense is expended in precisely controlling the thickness of these raised island disks because in part the disk thickness variations are not a critical issue for a manual grinding operation. Also, almost all of the abrasive particles located on the outer periphery of these disks are fully utilized during a conventional grinding operation because these disks are simply hand-lowered further onto a localized portion of a workpiece surface as the disk abrasive particles are progressively worn away. There were no description of precision abrasive disk thickness control issues with these prior art raised island disks and also no description of mounting these disks on high speed precision flatness rigid platens for use in flat lapping.

Many of the prior art raised island disks are constructed by forming the low-height raised islands with deposited spot areas of resin that were covered with abrasive particles. These raised islands would typically reduce the effects of hydroplaning when the raised islands are sufficiently high to provide paths for the excess coolant water to bleed off the surface of the islands into the recessed areas adjacent to the islands. However, when the abrasive islands become well worn down, then the recessed areas no longer have sufficient depth and hydroplaning will tend to occur. For those raised island articles where the raised island structures are formed prior to coating the island top surfaces with abrasive, the abrasive can become fully worn away and hydroplaning will not occur because the recessed areas still have sufficient depth to provide passageways for excess water.

These manual grinder disks also are generally limited in size to approximately 8 inches (20 cm) in diameter in part as larger diameter disks can be dangerous for use on manual grinders. Disks of this limited size are typically too small for lapped workpieces.

Because a manual grinder abrasive disk has a disk-center mounting aperture hole fastener and a flexible or resilient backup pad, the attached disk can not be hand held in full-disk-diameter flat contact with a flat workpiece to successfully perform a high speed lapping procedure. Full flat surface contact of one of these abrasive disks mounted on a hand held grinder with a large sized flat workpiece can lead to dynamic abrading instabilities and vibrations during a high speed abrading action that will tend to disrupt the workpiece surface finish.

Likewise, the prior art raised island abrasive disk articles that are typically mounted on hand held grinders having flexible disk backup pads have an intended use of presenting the disk abrasive at angled contact with a workpiece surface. Angled bending of the flexible but stiff disk body is required to provide the required disk abrading contact pressure. At the disk bending line only the edges of the raised island structures and little, if any, small sized abrasive particles coated in a monolayer contacts a workpiece surface, a situation that worsens with increases with the height of the island structures. This is an abrading technique that is particularly unsuited for flat lapping operations.

The abrading contact pressures that are used in high speed lapping are typically very low, in part, because the high speed diamond abrasive cuts so fast that the workpiece surface may not be evenly abraded at high contact pressures. Here, the low contact pressures that reduce the abrasive cutting rate are used to prevent the generation of non-flat workpiece surfaces. These low contact pressures also present a significant abrading advantage in that they result in much less subsurface damage to the workpiece as compared to traditional non-slurry abrading techniques.

However, the use of low abrading contact pressures with flat workpieces that are in full-face contact with extremely flat (non-raised island) abrasive surfaces in the presence of coolant water at high operating speeds tends to cause extraordinary hydroplaning of the workpieces. Here, there is insufficient abrading contact pressure to resist the hydrodynamic lifting or tilting forces and the workpiece tips the workpieces edges during the abrading process which causes undesirable non-flat workpiece surfaces. Even at low abrading contact forces the use of precision thickness raised island abrasive disks prevents this hydroplaning and provides precision flat workpiece surfaces. Small abrasive particles that are encapsulated in the abrasive beads provide smoothly polished workpiece surfaces.

In the past when continuous surfaced flat abrasive disks having monolayers of abrasive particle filled agglomerate beads were used at high speeds with the presence of coolant water to attempt to flat lap hardened workpieces, the phenomenon of hydroplaning causing the problem of non flat workpiece surfaces was not recognized. The lack of precision abrasive raised island disk thickness control of the prior art disks to tolerances that correspond to the very small dimensional variations that are allowable for flat lapping prevented them from being successfully used for flat lapping workpieces. Because attempts were not made to use these prior art non-precision raised island abrasive disks to precisely flat lap workpieces the issue of reducing workpiece hydroplaning with these disks was not recognized.

It has long been a goal to utilize the special high speed cutting ability of diamond abrasive particles to flat lap hard material workpieces because the commonly used slurry flat lapping process is so slow. At the present time, flat lapping is predominately done with the use of a rotary table abrasive slurry lapping system that must operate at very slow abrading speeds. In a slurry system, a slurry mixture of loose abrasive particles dispersed in a paste or a liquid is coated on a moving platen and a workpiece is held in flat contact with the moving abrasive particles. The relative motion between the platen and the workpiece shears the layer of liquid abrasive slurry that exists in the gap between the workpiece and the platen. During the shearing action individual free small abrasive particles that are in contact with the workpiece surface are moved relative to the surface to abrasively remove some of the workpiece material.

Abrasive wear that is created by individual abrasive particles has a number of different wear modes. First, the particle may cut a groove in the workpiece. Also, the particle may plough a furrow in the workpiece where some of the workpiece material at both sides of the furrow rises up from the workpiece surface. Further, some of the workpiece material may be fractured away from the sides of a groove or may be fractured into segmented pieces that detach from localized workpiece surface sites. All of the workpiece material that is separated from the workpiece during the abrading process is considered debris. This debris can lodge between the abrasive and the workpiece and cause localized damage or scratches to the workpiece. In the slurry lapping system, the debris is mixed in with the abrasive slurry mixture, which is highly undesirable. Subsurface workpiece damage is also caused by the abrading action of the individual abrasive particles and this damage may or may not be observable from the exterior of the workpiece. Blocky shaped and sharp-edged crystal shaped individual abrasive particles can provide different workpiece cutting actions.

Flat lapping is used to develop the most accurate, precisely-flat and smoothly polished workpiece surfaces of any of the many techniques of abrading flat surfaces. Many of the workpieces that are flat lapped have flat surfaced cylindrical shapes but many other workpieces have square or rectangular surface shapes. Most flat lapped workpieces are high value devices. Some examples of these workpieces are semiconductor devices, optical devices and ceramic seals. Flat lapping is performed where the flat surface of a workpiece is in full-face abrading contact with a flat surface of abrasive media that is supported by a rigid and precision flat surfaced platen. In a flat lapping process only the highest localized areas of the workpiece surface are abraded away to develop a flat surface. As the abrasive is in planar contact with the workpiece, the abrading process starts with only a few workpiece high-spot areas in contact with the abrasive but ends with the full flat surface in contact with the abrasive.

It is critical that the workpiece surface conforms to the flat surface of the abrasive that is supported by the rigid flat platen to develop the required surface flatness and smooth polish over the full surface of the workpiece. In almost all cases, the workpiece is rotated while it is in contact with the abrasive. A workpiece surface can be rigidly held against an abrading surface by mounting the workpiece on a rotating shaft having an axis that is perpendicular to the abrasive surface. Also, the workpiece surface can be allowed to spherically pivot while it is in rotating contact with the abrasive. If a rotating workpiece holder is rigid, the workpiece surface must be held perfectly perpendicular to the abrasive surface during the abrading process. This presents a lapping equipment design challenge that is difficult to accomplish because of the alignment accuracies that are required for flat lapping and also, the rigidity required for the workpiece holder. Here, the structural deflections of both the workpiece and the holder that are caused by the dynamic abrading contact forces can easily result in non-precision-flat workpiece surfaces. Because of these difficulties, most lapped workpieces are allowed to "float" where they self-align their flat surfaces to the flat surface of the abrasive covered platen during an abrading process. Two of many methods used to allow the workpiece to conform flat to the abrasive include: 1) simply laying the workpiece face down on the abrasive; and 2) mounting the workpiece on a spherical-action holder that is lowered onto the abrasive. However, simply laying a workpiece face down on the flat abrasive surface of a high speed rotary abrasive lapper is not practical because dynamic impact forces caused by small variations in the fast moving abrasive surface will tend to throw the workpiece off the abrasive surface. Also, the use of spherical action workpiece holders for high speed lapping requires a spherical action. Preferably the spherical holder has a special off-set center-of-rotation where this rotation center is at or just slightly above the abrasive surface to prevent abrading contact forces from tipping the workpiece during the abrading action.

Very small workpiece abrading contact pressures are used with high speed flat lapping as compared to other types of abrading flat workpiece surfaces. These small abrading contact forces or small workpiece clamping forces are required to avoid even the smallest structural distortion of the workpieces by these forces during the abrading process. For instance, the workpiece surface can be abraded precisely flat during the time that the workpiece is structurally distorted by a workpiece holder clamping forces or by abrading forces. After the forces are removed, the already abraded workpiece structure will spring-back to a new geometric shape that then has an undesirable non-flat shape. Here, the structural relaxation of the workpiece distorts the original abraded-flat workpiece surface. Because the required accuracy of a typical flat lapped surface is so great, even a very minor structural distortion of a workpiece will cause the surface flatness to become unacceptable. This is seldom the case for workpieces that are abraded by conventional abrading methods, particularly those that use traditional aluminum oxide abrasive disk articles During flat lapping, the sizes of the abrasive particles must be sequentially changed from coarse to fine to obtain flat workpieces that are also smooth. Coarse larger sized particles are used to develop a flat surface. Fine smaller sized particles are used to develop smooth surfaces. Typically, the flat lapping is accomplished with the use of multiple individual abrasive disks that have progressively finer abrasive particles. The selection of the abrasive particle sizes for each abrading step is optimized to assure that the subsequent smaller sized abrasive cuts the workpiece material effectively to provide uniform material removal and a smoother finish. During a high-speed flat lapping process, it is preferred that the size of the abrasive particles is progressively reduced in three steps or even less. For example: 6 micrometer particles are used in the first step; 3 micrometer particles are used in the second step; and 1 micrometers are used in the third step.

Rotary platens are used almost exclusively for flat lapping because a rotary platen can provide a system that has a constant abrading speed and smooth lapping machine action throughout an abrading process. However, rotary platens have a disadvantage in the localized abrading surface speed changes with the radial position on the platen. The platen outer radius has high surface speeds and the platen inner radius has low surface speeds. Because the localized abrading cut rate is proportional to the localized abrading surface speed, equalized material removal occurs across the area of the workpiece when the abrading speed is also uniform across the area. As the abrasive located at the inner radius of a disk moves relatively slow, little abrasive surface wear is experienced at these inner locations, which produces an uneven abrasive surface in a radial direction. Uneven wear of an abrasive surface prevents providing a precision flat abrading surface to a workpiece which produces uneven wear on the workpiece. The use of annular bands of abrasive along with the rotation of workpieces in the same direction as the platen rotation minimizes the problem of mutual abrasive and workpiece wear when using a rotary platen, which assures that the full workpiece surface is evenly abraded.

Other abrading equipment such as reciprocal motion platens can be used for flat lapping but they are very limited in performance. Reciprocal platens change motion directions periodically (at the end of each cycle) which is dynamically disruptive and results in non-smooth lapping machine actions. It is important that the lapping machine abrading motions are continuously smooth.

Because the localized abrading cut rate is also proportional to the localized contact pressure, equalized material removal occurs across the area of the workpiece when the contact pressure is also uniform across the area. Great care is taken to provide an even abrading contact pressure across the full surface of a workpiece during an abrading process.

In conventional abrasive slurry lapping, the abrasive media is a paste or liquid slurry mixture of loose abrasive particles that is coated on the surface of a rotary platen. Platens are rotated while the workpieces are typically held at a fixed location in flat surface contact with the abrasive. Individual abrasive particles are trapped in the interface gap between the flat workpiece surface and the moving flat platen. The interface gap has a large thickness relative to the size of the abrasive particles. Here, individual abrasive particles are stacked up within the slurry layer and these particles tend to circulate within slurry layer thickness during abrading action. Slurry lapping is not done with a monolayer of abrasive particles. New individual abrasive particles are continuously presented from the depths of the slurry layer to the workpiece surface by the slurry shearing action provided by the relative motion between the workpiece and platen surfaces. Individual abrasive particles can become dull or the slurry may become contaminated with abraded workpiece material debris in which cases the abrasive slurry is replaced.

This shearing action also results in the high spot areas of the flat surface of the workpiece being abraded away by those abrasive particles in the gap that are in contact with the workpiece and move relative to the workpiece. Because abrading forces are concentrated in the areas of the high spots, more workpiece surface material is removed at high spot locations than in the adjacent low spot areas. Abrading away the high spots flattens the workpiece.

Also, this same abrasive slurry shearing action results in localized areas of the rotational platen being worn away by those abrasive particles in the interface gap that are in contact with the platen surface and move relative to the platen surface. Typically a recessed annular band track is worn into the surface of the moving platen that has an annular width that is equal to the cross sectional dimension of the workpiece that is held in a fixed location. To refurbish the slurry platen that has annular groves worn-in by the workpieces the rotary platen is refinished during use by contacting the platen with a self-rotating heavy metal annular reconditioning ring that spans an annular circumferential track on the platen. The heavy reconditioning ring has annular edge contact with the platen where the abrasive slurry is forced into the gap between the ring surface and the platen surface to remove high portions of the platen surface. Because the ring simply lays on the surface of the platen where the fixed-position ring is freely allowed to travel up and down with the surface of the rotating platen the result is that the platen circumferential out-of-plane variations can remain. To refurbish a platen to have a planar surface a lathe-like tool would be required to dress the platen where the lathe tool bit is not allowed to follow the out-of-plane variations of the rotating platen surface. As the platen rotates slowly during a slurry lapping procedure and because the abrasive slurry typically has a substantial abrading thickness, the effects of circumferential platen surface variations on the workpieces are minimized. However, the necessity of maintaining a flat platen surface to provide flat workpiece surfaces is recognized in the slurry lapping process just as it is in the high speed lapping process.

For comparison, because the abrasive particles are attached to a flexible abrasive disk sheet and the disk sheet does not move relative to a platen surface, the platen surface is not worn during abrading action. Here, the high speed platen surface does not have to be refinished.

During slurry lapping the slow platen speeds allow the workpieces to be rotated, in the same direction as the platen, at only moderate speeds to even-out the abrading surface speeds across the workpiece surface. If the slurry platens have small diameters and high rotating speeds, the workpieces must also be rotated at high speeds to provide even wear. There are many mass-balance and workholder design difficulties that are associated with the high rotation speeds of workpieces. Slurry platens typically have very large diameters and sufficient sized annular abrading surfaces that exceed the width of the workpieces. Workpieces contact the platen only within the annular band surface area. Large platen diameters of 36 inches (91 cm), or even much more, are often required because the workpieces often have diameters or sizes of 12 inches (30.5 cm) or more. This results in platen annular bands that have a band width that is greater than the 12 inches (30.5 cm) width of the workpieces.

Platens typically are also rotated very slowly when used with the abrasive slurry mixtures because of the high viscosity of the slurry paste or liquid. High platen speeds with high viscosity slurries produce high shearing forces on the workpiece which can tip the workpiece during the abrading process. Tipped workpieces during an abrading process tend to prevent the creation of precisely flat workpieces. Also, low platen rotational speeds are required to prevent the liquid abrasive slurry mixture from being radially thrown off the platen surface by centrifugal forces. However, the combination of low platen speeds and low workpiece abrading contact pressures result in very low workpiece material abrading cut rates. It takes a long time to develop a flat and smooth workpiece surface with slurry flat lapping. Slurry lappers are messy and require consider efforts in clean-up operations that are required at each event when progressively changing to smaller abrasive particles. Normally this is a time consuming, messy and tedious process.

Another method of flat lapping workpieces is with the use of flexible fixed-abrasive sheets. These sheets have diamond abrasive particle filled ceramic beads that are adhesively bonded in a continuous monolayer coating to a thin and flexible backing. The sheets are rectangular or circular in shape and are attached to a rotatable platen or a stationary surface plate. Most of the sheets used for lapping have circular disk shapes to enable the use of rotary platens. Circular disks are typically cut out from continuous abrasive coated web material to form disks that also have a continuous coating of diamond particle filled beads over the full surface area of the disks. When these abrasive disks are used at high speeds they cut hard workpiece material rapidly but they tend to produce non-flat workpiece surfaces.

Flat lapping also is often done with stationary granite Toolmaker-quality flat surface-plates using flexible rectangular shaped fixed-abrasive sheets. Abrasive sheets are positioned flat on the surface plate with the non-abrasive backside of the abrasive sheet in direct contact with the granite. The surface plate is stationary and the workpiece is moved manually by hand against the water lubricated flat abrasive with various motion patterns. Typically a highly skilled operator who hand-laps a workpiece periodically inspects the workpiece and continues lapping as required. Extra abrading contact hand pressure is applied to those localized areas that have high spots. This is a particularly slow and tedious process even when using fixed abrasive sheets.

Abrasive slurries are not often used on a surface plate because it is not practical for an operator to recondition the flat surface of a granite surface plate after it is worn down in localized areas by use of a slurry abrasive that is in direct contact with the granite.

I. High Speed Lapping History

The high speed lapping system of the present invention was initially developed for use with conventional diamond abrasive bead coated fixed-abrasive disk articles. These disks have a continuous coating of a monolayer of abrasive beads across the full disk surface. The beads contain small diamond abrasive particles that are enclosed in a soft erodible ceramic matrix. It had been found earlier that these abrasive disks could be used on lapidary polishing machines in the presence of water lubricant at high abrading speeds to polish geological rock samples at very high production cut rates as compared to the slow moving polishing machines or abrasive slurry systems. However, even though the lapping machines used in this early application could provide smooth surfaces on these lapidary workpieces they failed to produce the precisely flat surfaces that are required for use in the flat lapping of precision-surfaced commercial parts or semiconductor workpieces. It was then initially assumed that the simple provision of a more precise, heavy, sturdy and stable rotary-table lapping machine (than the polishing machine used earlier for the lapidary abrading) would allow the simultaneous creation of smoothly polished and precisely flat workpiece surfaces with these same continuous coated fixed abrasive disks. After building different very precise and robust lapping machines that provided very accurate control of abrading pressures along with very flat platens that maintained a very precise flatness abrading surface at high rotational speeds, it was found that this was not the case. These water cooled continuous-surface coated abrasive disks could not produce precisely flat workpiece surfaces when operated at high speeds. However, these same continuous coated abrasive disks, as used on the high speed lapping machines, did very quickly provide smoothly polished (but non-flat) hardened material workpieces. The present abrasive system high speed lapping machine technology is described in Duescher U.S. Pat. Nos. 5,910,041, 5,967,882, 5,993,298, 6,048,254, 6,102,777, 6,120,352, and 6,149,506.

Over a period of time it was progressively determined by the present inventor that a number of new technology issues had to be addressed in order to provide a high-speed flat lapping system that would simultaneously result in both smooth and precisely flat workpieces. For instance, it was found that the new, robust, heavy, precise, aligned and controllable lapping machine alone wasn't sufficient to provide high speed flat-lapping with the existing commercially available continual coated abrasive disks. First, it was found that the abrasive disk surface in contact with the workpiece had to have a significant diameter and to be in the form of an annular band to minimize the abrading speed difference across the radial width of the disk. Then it was found that it was necessary to rotate the workpiece at a significant speed in the same direction as the abrasive disk to further minimize these radial width speed variations while maintaining the workpiece in flat contact with the abrasive surface with uniform contact pressure across the full surface of the workpiece. As the abrading speed of the abrasive disk was increased to high speeds (to obtain the great high speed cutting advantage of diamond abrasive particles) it was found that the workpieces tend to hydroplane when contacting the "smooth" flat surface of the continuous coated diamond bead abrasive sheets. This hydroplaning produced non-flat workpiece surfaces that had a variety of non-flat shapes, including convex, concave and saddle shapes. Furthermore, the heat generated by the abrading contact friction at these high abrading speeds would tend to surface-crack hardened ceramic workpieces even in the presence of excess coolant water during the abrading process. These cracks were the result of thermal stresses generated by uneven temperatures within the body of the workpiece that were cause by the surface heating by the abrading contact friction that was concentrated at the "high spots" of the workpiece surface. The coolant water films did not adequately remove the heat from these localized hot spots.

To verify that hydroplaning was the cause of non-flat workpieces at high abrading speeds in the presence of coolant water, abrasive disks that had raised islands that had diamond particles metal plated to the top surface of the metal island structures. These are the commercially available disks produced by the technology described by Gorsuch in U.S. Pat. No. 4,256,467. These raised island disks were successful in producing precisely flat workpiece surfaces at high abrading speeds. However, it was not possible to produce smoothly polished workpieces with these metal plated raised island disks because the raised island structures did not have uniform heights and because of the presence of the relatively large sized (coarse) individual diamond abrasive particles that were also attached at different elevations on each island structure. The use of large abrasive particles, the height variations of the uneven islands and the abrasive disk thickness variations of these metal bond disks together prevented successful high speed flat lapping. Because the individual diamond abrasive particles are captured on the surface of the islands by partially surrounding the particles with metal plating that leaves the upper portion of each particle exposed for abrading contact it is not practical to provide these disks with the very small fine-sized diamond particles that are required for smooth polishing. Very small abrasive particles would become imbedded within the metal plating and the individual particle sharp edges would not be exposed to abrasively cut the surface of a workpiece.

When measuring the flatness of the non-smooth abraded workpieces it was not possible to measure these surfaces with the use of the optical flat fringe pattern system that is the traditional method of measuring fastnesses of a few bandwidths, or less, because the surfaces were so rough that they would not properly reflect the imposed light that is used to establish the optical fringe patterns. Other direct measurement techniques were employed to determine the workpiece flatness accuracies.

If a workpiece is first successfully abraded precisely flat by raised island abrasive articles at high abrading speeds, it still is not practical to then polish these rough flat surfaces with another continuous coated abrasive article at these high speeds. Here, the resultant hydroplaning would cause the precision flatness to be destroyed as the surface was polished to have a smooth surface.

At that time, it was determined that new-technology abrasive media disks were required to be used with these new lapping machines in order to successfully provide the necessary flatness and surface finish for high speed flat lapping. These new-technology resulted in the use of precision thickness disks having annular bands of abrasive coated raised island structures. The island structures are coated with monolayers of abrasive particle filled beads. Even though many different raised island abrasive articles had been developed in the past, none of them provided accurate control of the abrasive disk article thickness with thin layers of very fine abrasive particles coated on precision thickness raised island structures. The new raised island abrasive articles as described by Duescher in U.S. Pat. No. 6,752,700 and U.S. Pat. No. 6,769,969 can successfully provide precision flat lapped workpieces at high speeds and can also successfully abrade tradition non-lapped workpieces that are processed by prior art raised island abrasive articles. However, the same prior art raised island abrasive articles can not produce flat lapped workpieces at high speeds. The prior art and Duescher raised island abrasive disk articles are not interchangeable in function or results.

Because the abrasive disk has discrete raised island structures, a sufficient amount of coolant water can be used to effectively cool the workpiece abraded surface during the abrading process without causing hydroplaning. As each abrasive island passes a specific hot-spot location on a workpiece, a gap opening between adjacent islands allows coolant water to contact that same open hot-spot area that was just contacted (and friction heated) by the passing island. This consistent cooling of island heated areas immediately after each island contact event allows the friction generated heat to be removed by the coolant water before this localized heat (now concentrated at the workpiece surface) has a chance to soak into the workpiece body and cause thermal stresses. Because the friction-induced thermal stresses are reduced by this effective application of coolant water, thermal surface cracking of the ceramic workpiece surfaces is reduced. Use of continuous coated abrasive surface abrasive articles does not provide for sequential gaps in the abrasive surface that allow coolant water to contact discrete over-heated workpiece high spots.

Also, the advantages of using abrasive disks having equal sized abrasive beads (in place of abrasive disks that were coated with abrasive beads having a variety of bead diameters) were found. To successfully produce a precision high speed flat lapping system, the raised island abrasive disks described here must be used with a robust lapping machine that accurately controls the abrading speeds, the abrading contact pressures and provides a platen that is near-perfect flat at all operating speeds. All of these new technologies are described herein.

At the time of development of this high speed flat lapping system, raised-island abrasive disks had been used at high rotating speeds in the abrasive industry for many years. Some of the early prior art raised island disks were used for dry-grinding, without the use of coolant water. Raised-island disks were originated in part to provide recessed passageways (between the individual raised islands) to allow the grinding debris that was generated in the grinding process to be removed from the abrasive surface and to pass freely in these passageways. The debris traveled radially in the passageways away from the workpiece contact area and was ejected from the outer radial periphery of the abrasive disk surface. The inter-island passageways tended to prevent the debris from clogging-up the surface of the abrasive disk, which is important as clogged abrasive surfaces reduce the cutting capability of the abrasive disk. Also, removal of the debris in the low-level recessed passageways prevented the debris from scratching the surface of the workpiece because the workpiece no longer contacted debris on the surface of the abrasive. As these disks were rotated at high speeds, the grinding debris was propelled radially within the recessed passageways to the disk perimeter by centrifugal forces that were created by the disk rotating action.

There were many methods used to manufacture these early raised island abrasive disks. Some early raised island disks had patterns of localized low-height area spots of resin that were coated with abrasive particles.

In U.S. Pat. No. 794,495, Gorton discloses thick-coated adhesive binder wetted circular spot raised island areas that are applied on a flexible backing disk and depositing abrasive particles on top of the raised-islands. These raised abrasive projections provide passageways for the grinding debris so that it does not rub or grind (scratch) the polished surface of the workpiece and allows the debris to have free passage off the outer periphery of the disk. Gorton's abrasive disks have recessed gap areas between the raised abrasive islands and also have a recessed gap area between all of the raised islands and the outer periphery of the disk that extends around the full periphery of the disk.

In U.S. Pat. No. 2,242,877 Albertson's abrasive coated disks have disk backings that are first formed with rigid flat surfaced raised island structures that are integral to the backing material and where the rib shaped islands project outward from the surface of the backing. For example, his FIG. 23 drawing shows flat surfaced raised island structures having vertical side walls where the island structures are either integral with the backing material or the structures are individually attached to the backing material. These raised island structures have a variety of flat surfaced island shapes that include patterns of rectangular shapes, radial shapes, serpentine shapes and other island shapes. Also, Albertson forms embossed-type fiberboard backings that have corrugated raised island surfaces which have corresponding "open" raised areas in the bottom mounting surface of the backing disk. Here, the bottom mounting surface of the backing is substantially planar even though there is a pattern of raised open areas on the backing bottom surface. After these rigid raised islands are formed in the fiberboard backing, a layer of adhesive is applied to the raised island disk surface and abrasive particles are deposited onto the adhesive. The adhesive is then solidified with a heating process to complete the raised island abrasive disk. Albertson refers to the raised portions as "islands" and the recessed areas adjacent to the islands as grooves. His recessed grooves between the raised islands are described as receiving (grinding debris) and cuttings during the abrading process which allows the cuttings to be radially thrown off the disk by centrifugal action. He also states that in the cases where the recessed grooves are blocked at the periphery of the disk by concentric rib island patterns that the cuttings that reside in the recessed groves are still thrown off the disk when the disk is raised from contact with the workpiece.

In U.S. Pat. No. 3,991,527 by Maran, his raised island disks had raised island structures formed by a variety of methods including embossing a fiberboard backing sheet to form rigid raised island structures that had flat-surfaced island tops that were coated with an adhesive upon which was deposited abrasive particles. He embossed flat substrates to form flat topped raised island structures that had indented openings under each raised island but the bottom mounting side surface of the backing substrate remained substantially planar even with the pattern of indented openings.

In U.S. Pat. No. 6,371,842 Romero describes a raised island abrasive disk article using a two-step abrasive coating process where the island structures are first coated with an adhesive binder and secondly, abrasive particles are deposited onto the binder. His abrasive disk article features of depositing abrasive particles onto the resin coated islands where there is a gap between the raised islands and the disk periphery are features that are all disclosed in prior art.

In addition his claims include the use of raised islands that are "substantially co-planar" and abrasive surfaces that are "substantially planar" but he does not teach either of these elements in his specifications. However, he does refer to the use of raised portions that are die cut from a flat substrate which are "placed into" a laminating adhesive to bond them to a flat disk backing to form raised islands on the backing. These arbitrarily island structure production steps do not result in defined planar or co-planar island surfaces. Also, he does not teach the importance of positioning the upper flat surfaces of each individual die cut island structure parallel to and at an equal distance from the back disk-mounting side of the disk backing. Also he does not teach manufacturing methods to achieve either planar or even "substantially co-planar" locations of the island structures. In addition, he does not teach methods of the application of a resin adhesive to the island top surfaces or the application of the abrasive particles to the adhesive where the resultant top abrasive surface has "substantially planar" or "substantially co-planar" grinding surfaces or the finished raised portions are "substantially planar" or "substantially co-planar". Further, producing an abrasive disk that has "substantially co-planar" features is not the same as producing an abrasive disk that has "precisely co-planar" features. For a raised island abrasive disk to be successfully used in a high speed flat lapping procedure, the island structures must be precisely co-planar to each other and the individual abrasive particles must also be precisely co-planar to each other and further, the islands and the abrasive particles must be precisely co-planar with the back mounting side of the abrasive disk article. Because the Romero abrasive disks do not have this critical abrasive disk top-surface to backside co-planar feature, they can not be successively used for high speed flat lapping.

The present invention provides raised island disk articles by using a one-step coating process where a slurry mixture of abrasive particles or abrasive beads is coated on the flat island structures. This is a raised island abrasive coating process that allows the quantity of abrasive particles that are coated on the abrasive article and the spacing of the individual particles to be accurately controlled, which is different than the Romero two-step resin and deposited abrasive particle coating process.

Romero addressed a specific construction problem that occurs with a unique class of abrasive disks that were fabricated by applying a coat of resin adhesive to full flat surface of a circular backing disk and then depositing abrasive particles onto the resin. This disk production technique of uniformly coating the whole circular disk flat surface with resin tended to produce an undesired raised adhesive resin bead that is located at the outer edge of the disk. The raised resin bead extends around the full outer radial periphery of the disk. When abrasive particles were deposited on the disk resin adhesive, those particles that were located on the top surface of the raised outer periphery adhesive bead were uniquely higher in elevation than were the remainder of those deposited abrasive particles that were located at the interior portion of the disk on the portion of the abrasive disk. Having elevated abrasive particles around the circumference of the disk was undesirable as these elevated beads tended to scratch the surface of a workpiece when the abrasive disk was first used.

To solve this problem of producing a raised resin bead at the peripheral circumference of the abrasive disk Romero provided an abrasive disk that has a pattern of flat surfaced raised island structures where only the island surfaces are coated with a resin adhesive and abrasive particles are then deposited on the island resin. Like Maran in U.S. Pat. No. 3,991,527 Romero embossed flat substrates to form flat topped raised island structures that had indented openings under each raised island where the bottom mounting side surface of the backing substrate remained substantially planar even with the pattern of indented openings. Because he applied his resin adhesive only at individual island spot areas on the disk he did not apply a uniform coating of resin adhesive across the full surface area of the disk and thereby avoided the creation of the raised resin bead around the full circumference of the circular disk. After the resin was applied at the island sites he then deposited abrasive particles onto the adhesive resin.

His islands were positioned to provide recessed areas between the individual islands and also to provide a recessed gap area between the raised island structures and the outer diameter of the disk around the full outer periphery of the abrasive disk. There was no resin applied to the flat recessed non-island areas of the disk backing either between the islands or at the outer periphery of the disk.

Romero's construction of an abrasive disk by coating discrete island areas on a disk backing with an adhesive and then depositing abrasive particles on these adhesive island areas is similar to the construction of raised island abrasive disks as described in many other patents including: U.S. Pat. No. 794,495 (Gorton), U.S. Pat. No. 1,657,784 (Bergstrom), U.S. Pat. No. 1,896,946 (Gauss), U.S. Pat. No. 1,924,597 (Drake), U.S. Pat. No. 1,941,962 (Tone), U.S. Pat. Nos. 2,001,911 and 2,115,897 (Wooddell et. al), U.S. Pat. No. 2,108,645 (Bryant), U.S. Pat. Nos. 2,242,877, 2,252,683 and 2,292,261 (all by Albertson), U.S. Pat. No. 2,520,763 (Goepfert et al.), U.S. Pat. No. 2,755,607 (Haywood), U.S. Pat. No. 2,907,146 (Dynar), U.S. Pat. No. 3,048,482 (Hurst), U.S. Pat. No. 3,121,298 (Mellon), U.S. Pat. No. 3,495,362 (Hillenbrand), U.S. Pat. No. 3,498,010 (Hagihara), U.S. Pat. No. 3,605,349 (Anthon), U.S. Pat. No. 3,991,527 (Maran), U.S. Pat. No. 4,106,915 (Kagawa, et al.), U.S. Pat. No. 4,111,666 (Kalbow), U.S. Pat. No. 4,256,467 (Gorsuch), U.S. Pat. No. 4,863,573 (Moore and Gorsuch), U.S. Pat. No. 5,318,604 (Gorsuch et al.), U.S. Pat. No. 5,174,795 (Wiand), U.S. Pat. No. 5,190,568 (Tselesin), U.S. Pat. No. 5,199,227 (Ohishi), U.S. Pat. No. 5,232,470 (Wiand), and U.S. Pat. No. 6,299,508 (Gagliardi et al.). These patents describe adhesive resin that is applied at discrete island sites with the result of avoiding the buildup of a raised bead of resin at the outer periphery of the abrasive disk. Application of the resin at only these island spot areas is a logical solution to the problem of the raised resin bead at the periphery of the disk. Those prior art abrasive disks listed here have a recessed gap between all of or many of the raised islands and the outer periphery of the circular disk. The recessed areas between the raised islands were described as providing passageways that are useful for removing grinding debris and cuttings from contact with a workpiece. The recessed passageways also allow the debris and cuttings to thrown off the abrasive disk by centrifugal forces that are present due to the rotation of the disk during an abrading action. Further it was described in U.S. Pat. No. 2,242,877 (Albertson) where debris and cuttings could be thrown off the raised island disks even when the raised islands form a continuous ring that is positioned at the outer periphery of the disk and is concentric with the circular disk circumference, similar to the disk peripheral raised islands as described in U.S. Pat. No. 5,174,795 (Wiand). Here the cuttings accumulated in the passageways are thrown off when the outer periphery of the abrasive disk is not in contact with the workpiece.

Each of the prior art raised island disks were "substantially flat" and had individual raised island structures that had top surfaces that were coated with abrasive particles.

None of the prior art raised island disks had abrasive coated raised islands that had a precision controlled thickness abrasive disk articles. There simply was no recognized need for the precision thickness control of the disk articles for the grinding applications that these prior art disks were used for at the time that the disk articles were originated. Persons skilled in the art had not identified the need for the precision thickness control for raised island disks (described here for the present invention) at the time of the present invention.

In those instances where water was used as a coolant, the flatness accuracy was not an issue when using these prior art disks as there was no apparent attempt made by the Inventors to simultaneously provide the combination of precision-flat workpiece surfaces and the highly polished surfaces that are required for flat-lapping. Surface finishes provided by the conventional abrading systems were adequate for the intended use of the conventional workpieces that were abraded by these conventional abrading disk systems. However, these same surface finishes were not acceptable for specialty high quality precision flat-lapped workpieces.

Prior to this invention, hydroplaning of workpieces in the presence of coolant water using continuous abrasive bead coated flexible disks during high speed flat lapping was not identified as the cause of non-flat precision workpieces. This relationship was not identified because of a number of critical components first all had to be individually recognized and then utilized together to create a practical total system that could successfully and efficiently flat lap hard workpiece material at high abrading speeds. These critical components include a sturdy, precise and pressure controllable lapping machine having a rotatable and (preferably an off-set) spherical action workpiece holder. Also included here is a rotary platen having a vacuum abrasive disk attachment systems and precision flatness over a wide range of speeds. Further, the system requires the use of precision thickness abrasive disks having annular bands of abrasive bead coated flat surfaced raised island structures in the presence of coolant water. Together these critical components can be used to high-speed flat-lap hardened workpieces to provide these workpieces with surfaces that are both precisely flat and also are smoothly polished. This high speed flat lapper system produces flat lapped workpieces more conveniently, at less expense, with a cleaner process and much faster than the competitive slurry lapping system.

Determining that workpiece hydroplaning was a significant issue in causing non-flat workpiece surfaces would not have been obvious to a typical person skilled in the art of abrading at the time unless he/she had progressively eliminated all of the other potential causes first. Providing a suitable lapping machine and suitable workpiece holders here eliminated these potential causes. Providing precision flat surfaced and stable platens with a vacuum disk attachment system here eliminated these potential causes. Providing precision thickness flexible abrasive disks here having annular bands of raised island structures that are coated with monolayers of abrasive particle filled beads eliminated these potential causes. Use of precision thickness raised island abrasive disks alone without the use of the other identified critical components of this high speed lapper system will not produce precision flat lapped workpieces. Success of the high speed lapper system ultimately resulted from these incremental and logical steps that all occurred individually (and collectively) as described here. The quest of providing high speed flat lapping was clearly recognized but the implementation required significant development efforts.

II. Present Lapping System

The present abrasive system invention described here originated with the development of high speed lapping machine technology as in Duescher U.S. Pat. Nos. 5,910,041, 5,967,882, 5,993,298, 6,048,254, 6,102,777, 6,120,352, 6,149,506. This work provided rotating precision-flat platen machines that can be operated at the desired 3,000 RPM, or more, to utilize the unique capability of diamond abrasive particles to provide very large material removal rates of very hard workpiece materials. Because the abrading process required the use of progressively finer abrasive particles, a system was developed to quickly change the thin flexible diamond bead coated abrasive sheet disks with a vacuum abrasive disk attachment system. Attachment of the abrasive disks to the platens with vacuum assured that each disk would consistently operate with a precisely flat abrasive surface no matter how many times that the abrasive disk was reused.

The abrasive disks that were first used were commercially available diamond bead coated thin and flexible 12 inch (26.4 cm) diameter abrasive disks that were vacuum attached to the platen flat surface. A raised outer diameter ledge on the platen surface provided a flat surfaced annular band support to the uniform coated flexible abrasive disk where only the outer annular band of the abrasive disk contacted the flat workpiece surface. This raised outer annular band of abrasive assured that the wear of the abrasive was nearly uniform across the surface area of the raised abrasive portion. Here, the abrading surface speed at the inner portion of the annular band was diminished only somewhat from the surface speed at the outer radius of the annular band because the inner annular band radius was only diminished somewhat from the outer annular radius. Minimizing the variance in abrading surface speed across the annular band abrasive surface is important as the amount that the disk abrasive wears is proportional to the relative abrading speed between the workpiece and the abrasive. To compensate for the variation of abrading surface speed between the inner and outer radius of the annular band of abrasive, the flat-surfaced workpiece can be supported by a spherical-action workpiece holder that also rotates in the same direction as the platen to provide an abrading surface speed that can be nearly-equalized across the full surface of the workpiece. When the relative abrading speed across the surface of the workpiece is near-constant, the abrasive workpiece material removal rate across the surface of the workpiece is uniform, which results in a workpiece that is abraded flat.

The spherical action workholder allows slight misalignment of the workholder axis of rotation with the surface plane of the abrasive disk. This spherical action assures that the flat workpiece surface is always presented in flat contact with the platen abrasive and that the contact pressure between the workpiece and the abrasive is uniform across the full surface of the workpiece. A uniform contact pressure is required to provide even wear across the full surface of the workpiece. Precision alignment between the workpiece surface and the abrasive surface is critical because the dimensional tolerances required to produce precision-flat workpiece surfaces is so small. These tolerances for lapped workpieces are typically one or two orders of magnitude greater than the tolerances that are required for the prior art non-lapping abrading applications.

Lapping on a rotating platen can produce a workpiece surface that is flat within 2 lightbands (22.3 microinches or 0.6 micrometers) or less. The aggressive cutting action of plated diamond island style flexible sheets requires a very low abrading contact force at both the start and at the end of the abrading procedure. A typical force of 2.0 lbs. (0.908 kg) can be used for an annular ring shaped workpiece having approximately 3.0 square inches (19.4 square cm) of surface area which results in a abrading contact pressure of 0.67 lbs per sq. inch (0.047 kg per sq. cm). The contact pressures used in high speed lapping is often a very small fraction of the contact forces that are used in traditional disk grinding operations.

Technology was developed and is described in the above referenced Duescher machine technology patents that allowed precision control of the abrading contact pressure to be uniform across the surface of the workpiece. It is well known that the rate of workpiece removal is proportional to the abrading contact pressure. The abrading contact forces must be varied over wide ranges at different stages of the lapping procedures in this system to successfully flat-lap a workpiece at high abrading speeds. Procedures were developed where the abrading contact force starts at near-zero at the beginning of the lapping process, is progressively increased, or changed, during other abrading events, and then is diminished again to near-zero at the end of the abrading process. This procedure of changing contact pressures can be used for each different abrasive particle size abrasive disk. Provision was made for a fast change of the abrasive disks when proceeding from coarse grades of abrasive to finer grades. To make a fast abrasive disk change, vacuum can be shut off from the platen, the thin and flexible abrasive disk quickly removed, and another abrasive disk attached to the platen surface by re-establishing the vacuum disk hold-down. Little or no clean-up is required for the changes of the abrasive disks as the debris flushing action of the coolant water maintains clean disks and a clean platen. Abrasive disks can be used repetitively as no damage occurs to the abrasive disks when these thin, flexible and otherwise fragile abrasive disk sheets are attached to or detached from a platen using the vacuum system. Also, the otherwise fragile abrasive disks typically experience little significant damage when they are subjected to disruptive abrading events. Here, the flexible disk is integrally attached to a massive and strong platen that tends to protect the abrasive disk during these disruptive events.

When lapping with uniform coated diamond bead flexible commercially available, 3 micron diamond fixed abrasive lapping film disks at high abrading speeds in the presence of coolant water, it was found that the workpieces could not be ground precisely flat. Examples of the commercially available polishing products include "IMPERIAL" Diamond Lapping Film (hereinafter IDLF) which is commercially available from Minnesota Mining and Manufacturing Company (3M Company), St. Paul, Minn. The flat workpiece surfaces were forced into out-of-plane positions relative to the planar surface of the abrasive by the action of the moving water. The abrasive disk was held flat in a planar position by the rigid rotating platen and the water was applied to the abrasive surface. This water was driven between the fixed-position workpiece surface and the abrasive surface as the water was carried along with the abrasive beads as the beads traveled under the workpiece surface. Water entering the gap between the edge of the workpiece and the abrasive was considered to lift the leading edge of the workpiece, which tipped the workpiece surface out-of-plane with the abrasive. As the workpiece was rotated at a fixed position, this workpiece tipping action prevented the workpiece from being abraded flat at different portions of the surface. Measurements made on the workpiece surfaces that had been abraded at high speeds with these commercial lapping disks indicated the presence of cone-shaped and saddle-shaped out-flat-shapes. The measured surface dimension variances exceeded the desired flatness by a considerable amount, which made the abrading procedure unacceptable.

To reduce workpiece hydroplaning at high abrading speeds, commercially available abrasive disks having raised islands with diamond particles plated on top of the islands were used to abrade workpieces at high abrading speeds. These metal plated raised island abrasive disks were Flexible-Diamond® Metal Bond plated type of raised island diamond abrasive article sheets that are commercially available from the 3M Company, St Paul, Minn. These metal plated diamond abrasive raised island disks were successful in providing workpieces that were acceptably flat but these abrasive disks were unacceptable from the standpoint of providing a precisely smooth polished surface to workpieces. These metal plated raised island disks were processed using the same high speed lapping machine that the earlier referenced fixed abrasive 3M Diamond IDLF lapping film disks were used on. The flatness of the workpieces abraded by the 3M Metal Flexible Bond plated raised island disks were measured using the same measurement equipment that the fixed abrasive 3M Diamond lapping film disks were measured with. It was concluded that the abrasive raised island structures were effective in breaking up the water boundary layer at high abrading speeds, in most part, because of the improved flatness qualities of the workpieces that were obtained with the island type abrasive disks. However, it also was determined that these raised island metal plated abrasive disks did not have the capability to provide a polished workpiece surface that were acceptable smooth. Workpieces were polished to have an acceptably smooth surfaces with the use of the IDLF continuous coated lapping film disks, but these workpieces were not precisely flat. Here, the large size of the individual plated diamond abrasive particles and the fact that there was no precision control of the elevation or height of the individual raised island diamond abrasive particles prevented these 3M Flexible-Diamond® Metal Bond plated type of raised island diamond abrasive article disks from providing a smooth polished surface on a workpiece.

Because the metal plated raised island abrasive disks were not suitable to provide a smooth polished surface on hard-material workpiece surfaces, a new type of raised island disk having precise thickness control of abrasive bead coated islands was developed. These raised island abrasive disks are described in the Duescher patents U.S. Pat. Nos. 6,752,700 and 6,769,969. The new flexible abrasive disk described in the present invention provides an abrasive disk that will provide a hardened workpiece surface that is abraded both precisely flat and also is very smoothly polished in a single high speed abrading procedure operation. This abrasive disk has raised abrasive coated islands that are arranged in annular array patterns on the surface of the disk. The height of both the island structures and the height of the resin coated abrasive particles are very precisely controlled relative to the bottom mounting surface of the disk backing. The abrasive particles can be individual diamond particles or can be abrasive agglomerate beads which contain small diamond particles in a porous ceramic erodible matrix material. Large diameter raised island abrasive disks having wide annular abrasive bands and large diameter platens allow large sized workpieces to be lapped and polished.

III. High Speed Lap System Equipment

The present invention flat-lap abrading system has a number of critical components comprising: a high speed lapping machine having a precision flat-surfaced rotary platen with a vacuum abrasive disk-attachment chuck; a rotating workpiece holder; precision-thickness fixed abrasive disks having raised islands; a system for applying water coolant to the moving abrasive upstream of the workpiece leading edge; small diameter diamond particle filled erodible abrasive beads that are coated on the flat top surface of the raised islands. Equal sized abrasive beads offer even more improved abrading performance.

The surface flatness and surface-finish roughness accuracies that are prescribed for precision-lapped workpieces require that the dimensional accuracies of all components of the high speed lapping system are precisely controlled in their manufacture and abrading use. The accuracies of the system component sizes and allowable static and dynamic dimensional variations must be small as compared to either the required surface finish accuracies of the workpiece or to the size of the abrasive beads or to both. Small sized individual abrasive particles must be used and the abrasive beads containing these particles must be coated in monolayers on a raised island abrasive disk article that is precisely controlled in overall thickness. The platen must rotate at high speeds without vibration or deflection when subjected to abrading or other process induced forces. Also, the platen must have a flat planar surface that remains perpendicular to the platen axis of rotation as the platen rotates. Workpiece holders must present the flat workpiece surface to the abrasive disk surface with low abrading contact force and where the workpiece lays in flat contact with the abrasive surface. It is preferred that most, or all, of the flat surface of a workpiece to be in full abrading contact with the flat abrasive surface during the abrading process. The application of coolant water to the abrasive surface must be carefully controlled. All of these described system components and process procedures are described here and all of these are practical to implement to successfully accomplish high speed flat lapping by a person skilled in the art.

Workpieces can be flat lapped using this high-speed system at production rates that are many times faster than the competitive slow abrasive slurry systems. These slurry systems are presently the abrading system that are typically used to produce a workpiece surface that is both precisely flat and smoothly polished. Slurry systems are very slow and have very low abrading productivity. Also, the system produces messy sources of contaminated materials that are difficult to clean up. Non-island fixed abrasive lapping films can produce smooth surfaces but not with simultaneous flat workpiece surfaces when abrading at high speeds.

A flexible abrasive disk having an annular band of raised islands that are coated with abrasive material is the preferred abrasive article shape for high speed flat lapping. Use of the annular bands of abrasive eliminates the abrasive that is usually located at the central region of an abrasive disk. The annular bands of abrasive extend only from the outer periphery to an inner radius that is approximately equal to 30% of the outer radius. The inner 30% of the disk is free of abrasive. Abrasive disks made from abrasive coated web sheets that are die cut into disk shape have this undesirable abrasive located at the disk inner radius area. Because the abrading speed of the abrasive located at a disk center is slow, the wear-down of this abrasive is slow and that abrasive disk develops an uneven abrasion surface. A rotating abrasive disk having an uneven abrasive surface can not effectively be used to flat lap a workpiece surface that contacts this inner abrasive area. The circular shaped disks with annular bands of abrasive coated raised islands described in this invention have many attributes that allow the use of precision lapping machine equipment to lap hard-material workpieces at high abrading speeds.

Water coolant is used with these high speed lapping systems to cool both the workpiece and abrasive surfaces. Without water coolant, severe damage would occur. Both the workpieces and the abrasive material would be damaged by the high localized temperatures that are produced by the friction of the abrading action. The use of water at high abrading speeds often results in hydroplaning of the workpieces when non-island abrasive disks are used. Hydroplaning tends to tip the workpieces relative to the flat abrasive surfaces, which results in the workpieces having non-flat abraded surfaces.

Use of raised island abrasive coated abrasive articles diminishes the problem of hydroplaning two ways. First, there are recessed gaps between adjacent island structures that allow the water that tends to form in a standing water bank at the leading edge of the workpiece to enter the recessed passageways between the island structures. Second, the lengths of the island structure surfaces that extend in the tangential direction of the abrasive disk are very short compared to a continuous coated disk surface. Much less water is dragged into the interface gap between the workpiece and abrasive surfaces by shear forces for short island lengths than would be dragged in by long length islands. Third, when an excess of coolant water is applied to the surface of the disk at a location upstream of the workpiece, the excess amount of water tends to flow into the open passageways due to the rotational disk centrifugal action prior to the water traveling up to the workpiece surface. This reduces the size of the standing water bank at the leading edge of the workpiece. Sufficient water wets the surface of the flat islands to provide coolant action to both the abrasive particles and the workpiece for high speed flat lapping.

When the amount of coolant water is limited as in "dry" abrading where a water spray mist is used instead of liquid water, the amount of water is often not sufficient to provide cooling protection to either, or both, the workpiece or the abrasive during high speed lapping.

Abrasive coated raised island abrasive disks allow workpieces to be successfully abraded at high speeds without the severe effects of hydroplaning. Here, abrasive particles or abrasive agglomerate beads are bonded to the precision flat island surfaces, where each island surface is parallel to the back mounting side of the disk backing. The recessed passageways between the raised island structures provide channels for excess coolant water, which limits the thickness of the water film that exists between the island flat abrasive surfaces and the workpiece flat surface. Enough water is present between the abrasive and the workpiece to mutually cool the surface of each but not enough to tip the workpiece significantly out of the abrasive planar surface formed by those islands that are in contact with the workpiece.

Water is driven into the gap between the island top surfaces and the workpiece surface by the dynamic hydraulic action where the high speed but free standing water that is located on the island tops impacts the edge of the workpiece and develops a large hydraulic pressure due to the deceleration upon impact. The high pressure water is then driven into the interface gap between the workpiece and the abrasive surfaces. The rotating abrasive disk moves at a very speed compared to the workpiece that is at a fixed location. The workpiece also rotates while it is at the fixed position location. Here, the rotational surface speed of the workpiece is typically quite slow relative to the surface speed of the outer radius of the rotating abrasive disk.

The amount of water that is driven into and dragged into the gap between a workpiece and an abrasive surface is a function of many process variables. These variables include, but are not limited to: localized abrading surface speed; amount or depth of coolant water applied to an abrasive surface as the abrasive disk is rotated; abrading contact pressure; diameter of raised islands; height of island structure above the top surface of the disk backing; gap spacing between island structures; size of abrasive beads; wear down status of the abrasive beads; lateral gap spacing between abrasive beads; size of abrasive particles that are contained within the abrasive beads; abrasive particle material; the workpiece material; geometry of the leading edge of the workpiece flat surface that is beveled; size of the abrading contact area; surface finish of the workpiece; surface flatness of the workpiece and other variables or parameters.

Abrading contact with a localized area of a workpiece is a sequential series of independent abrading events where one abrasive island after another contacts the workpiece as the abrasive disk rotates. Raised islands are positioned on the abrasive disk in patterns that provide uniform abrasion across the surface of a workpiece. Island location patterns that result in grooves being cut into a workpiece surface by abrading action are avoided.

Flat lapping at high abrading speeds typically requires the use of diamond particles. Diamond is a superabrasive that is primarily used to abrade non-ferrous material workpieces. Cubic boron nitride (CBN) is another superabrasive that can be used to abrade ferrous material workpieces. Aluminum oxide and other abrasive materials can also be used.

The flexible precision thickness abrasive disks described here have annular bands of abrasive particle coated raised island structures where water is used as a coolant to remove the heat generated by the abrading action from both the workpiece and the abrasive disk. These abrasive disks are temporarily attached by use of vacuum to precision-flat platens that are rotated at high speeds for each abrading event. It is preferred that all of the thin layer of abrasive beads that are coated on the island top surfaces contact the workpiece surface, which provides simultaneous uniform wear of both the abrasive media and the workpiece surface. The size of the abrasive particles used progresses in abrading process steps from coarse to fine. The large or coarse abrasive particles coated on an abrasive disk cut the workpiece quickly to establish a flat planar surface and the small or fine particles generate a smooth workpiece surface. When diamond abrasive particles are used at high abrading surface speeds they produce very fast cut rates of very hard materials.

To provide an abundance of very small abrasive particles in a thin, but minimum depth, controlled-thickness abrasive layer, the abrasive particles are encapsulated in porous ceramic spherical agglomerate bead shapes. The abrasive beads are equal in size to provide full utilization of all the bead-contained diamond particles. Equal sized abrasive beads also provide uniform abrasion across the full contact surface of the workpiece. These spherical abrasive beads are coated in a single layer on top of the raised islands. The average size or diameter of the beads used in high speed lapping is preferred to be about 45 microns (0.018 inches). Abrasive beads that are larger or smaller can also be used within practical limitations that are related to the lapping machine equipment and to the workpiece surface accuracy requirements. Beads that are too small will not contain enough abrasive for long abrading life before the abrasive is exhausted within the beads as the beads are worn away. With small beads, some of the beads are easily worn completely off large areas of the abrasive disk, leaving large abrasive-bare areas. Beads that are too large contain large volumes of very expensive diamond particles that are prone to be worn unevenly over the surface of the abrasive disk, where this uneven wear makes the abrasive disk not useful for flat abrading service. Discarding these uneven worn disks having large volumes of unused diamond particles results in significant economic losses.

Annular abrasive disks can be economically manufactured individually in a batch coating process rather than cutting them from continuous web sheets of coated abrasive. A superior performing abrasive product is produced when the annular disks are manufactured independently. Also, it is very difficult to manufacture an abrasive disk having an annular band of abrasive from an uniform abrasive coated web backing material. To make an annular band abrasive disk from uniform and continuous abrasive coated web sheeting it is required that the undesirable portion of abrasive be removed from the inner radius portion of a disk before or after the disk shape is cut from an abrasive coated web sheet. This inner radius area of abrasive must be removed from the abrasive disk to prevent this interior positioned abrasive from wearing slowly, due to the low abrading surface speeds that exist at the inner radius area of a rotating disk. If the inner positioned abrasive wears less than abrasive located on the outer radius area, the disk abrasive progressively develops a continuously changing non-flat abrasive surface. This non-flat abrasive surface can not be used to precisely flat-lap the surface of a workpiece. Great monetary savings are also experienced when the abrasive annular disks are individually manufactured as the expensive diamond particle abrasive material that is located at the inner disk radius is not discarded. Further, the unused abrasive coated web sheet fringe remainder areas that surround the circular cut-out disks are not discarded. These web sheet remainders have tapered intersecting arc shapes that are of little commercial use even though they are coated with expensive diamond abrasive material.

Abrading speeds used in high speed lapping are typically 10,000 surface feet per minute (SFPM), or 3,048 meters per minute or 114 miles per hour. Hydroplaning of workpieces can easily occur at these abrading speeds. Lapping disks that are 12 inches (26.4 cm) in diameter and are operated at 3,000 revolutions per minute (RPM) result in a abrading speed of 9,425 surface feet per minute (2,872 meters per minute). Higher platens speeds that exceed 3,600 or even 5,000 RPM can also be used. The rate of workpiece material removal is well known in the industry to be proportional to the abrading speed. If the abrading speed is doubled, the amount of material removed is doubled and a workpiece part is completed in one half the time. Slurry lapping, which uses a high viscosity mixture of abrasive particles and oil-like liquids typically has surface velocities of only one tenth the speed of high speed lapping, or 1,000 surface feet per minute (305 meters per minute or 11.4 miles per hour). The increase of abrading speed with the use of raised islands and water can allow workpiece parts to be processed with high speed lapping at ten times the rate as compared with the conventional manufacturing using slurry lapping technology. Because of the high viscosity of the lapping fluid mixture, hydroplaning and other undesirable effects prevent the use of high speed abrading with slurry lapping. High speed lapping can be done with coolant water, if abrasive raised islands are used, because water has such low viscosity.

Clean-up and contamination of the lapping machine, the abrasive disks and the workpieces is minimized with this high speed lapping system using the raised island fixed abrasive disks. The system is self-cleaning in that coolant water washes the grinding debris particles off the workpiece and abrasive surfaces. The continuous stream of spent water, containing these debris materials, is easily collected and the small volume of solid abrading debris can be conveniently separated from the water and disposed of. Chemical additives, solvents, liquids, and other materials that promote or increase the effect of mechanical abrasion of a workpiece can be added to the coolant water.

This lapping abrasion system can provide hard-material workpiece surfaces that are both flat and smooth when they are processed at high abrading surface speeds. System components can include a variety of machine designs and configurations but in general they include: a high speed rotary lapping machine; a coolant water system; a workpiece holder that supports and rotates a workpiece; precision thickness flexible abrasive disks having annular bands of raised islands that are top coated with thin layers of abrasive beads that contain small individual abrasive particles. The workpiece holder can support a workpiece by a number of different methods. First, the holder can hold a workpiece rigidly to prevent pivoting of the rotating workpiece as the workpiece contacts the moving flat abrasive surface. This rigid holding action is useful to abrasively develop a flat workpiece surface. Second, the workpiece holder can have a flexible pivot action where the rotating workpiece can align its flat surface with a moving flat abrasive surface when there is a slight misalignment in the perpendicularity between the workpiece holder and the abrasive surface. The second flexible pivot action mechanism also allows disk shaped workpieces having non-parallel surfaces to be positioned flat to a abrasive surface. A third workpiece holder system can have a spherical-gimbal pivot mechanism that allows workpiece flat surfaces to be held in flat contact with an abrasive surface. A fourth workpiece holder system has a friction-free workpiece pivot mechanism with the pivot-center located at the abrasive surface to prevent tipping of the workpiece due to abrading contact forces.

Successful flat lapping of workpieces at high abrading speeds requires that many lapping machine process procedures and protocols be optimized with careful selection of the type and size of the raised island abrasive disks for specific workpieces.

IV. Annular Abrasive Disks

To provide uniform wear across workpiece surfaces when using continuous coated non-island abrasive coated disks, the flat-coated disks can be used on rotary platens that have raised annular abrading areas. These annular platens have significant sized recessed central radius areas that prevent contact of the abrasive located in this central region with the workpiece surface. The central abrasive area is eliminated because the localized tangential surface speed of a rotating platen or disk is proportional to the local radius of the platen and the abrading surface speed provided by a platen is relatively low in this disk-central region. As the abrading workpiece cut rates are proportional to the localized abrading surface speeds there is also a large cut rate difference between the outer disk periphery and a inner radial location. When a disk is operated at the high rotational speeds used for high speed flat lapping the difference in the absolute abrading speeds at the disk outer periphery and an inner radial location can be very large. In fact, the abrading surface speed diminishes to zero at the very center of the disk even when the disk outer radius moves at very high tangential speeds. The relatively low surface speeds that exist at the central radial area of the platen results in relatively low workpiece cut rates in that region. Slow moving abrasive provides little workpiece material removal at the portion of the workpiece that contacts this disk-central regional abrasive area which results in uneven abrasion across the surface of the workpiece. Also, little wear-down of the slower moving abrasive surface that is located in that disk-central region takes place. If the abrasive surface does not wear down uniformly across the full radial abrading surface that contacts a workpiece in an abrading process, the abrasive progressively develops an uneven surface in a disk-radial direction. This uneven abrasive surface can result in creating an uneven workpiece surface in a subsequent abrading operation.

The best flat lapping results occur when the abrading annular band is located only on the outer peripheral area of the platen. Annular platens are configured to minimize the differences in size between the inner radius and the outer radius of this annular band so that there are roughly approximate abrading surface speeds across the full radial width of the platen annular band. A very large diameter platen having an annular band width that is small relative to the diameter is used. This produces an abrading surface where the tangential speed of the platen at the inner radius of the band is only somewhat reduced from the tangential surface speed at the outer radius.

During a flat lapping process, often the workpiece is maintained at a stationary location and the annular rotary platen is rotated to produce the abrading effect. However, the workpiece is also often rotated while it remains at the stationary location to further equalize the platen tangential abrading speeds at the inner and outer radii of the annular platen. Here the workpiece is rotated in the same rotational direction as an annular platen to equalize the abrading surface speeds across the radial width of the band. During rotation of the workpiece, the surface speed of the outer radius of the workpiece is subtracted from the highest surface speed of the outer radius of the platen because they both have localized speeds that have the same vector direction at that location. This effectively reduces the high tangential abrading speed at this outer location. Likewise, the surface speed of the outer radius of the workpiece is added to the lowest surface speed of the inner radius of the platen because they both have localized speeds that have the opposite vector directions at that location. This effectively increases the high tangential abrading speed at this inner location. These speed additions and subtractions of the rotating workpiece tend to develop equalized abrading speeds across the full abrading area. When the rotational speeds of the two are optimized relative to the diameters of the workpiece and the platen, the platen tangential abrading speed that exists between the workpiece and the abrasive can be closely matched across the radii of the annular band area.

Use of fixed abrasive disks on a rotary platen offers a number of process advantages. First, they eliminate the wear of the platen surface that occurs with an abrasive slurry system because the fixed abrasive material is not in direct moving contact with the platen. Only the non-abrasive backside of the disk backing contacts the platen and it is stationary with respect to the platen. Another advantage is the huge reduction of the messy clean-up that is required for an abrasive slurry mixture because all of the abrasive particles are bonded to the backing sheet. Because water is used as a coolant, the disks are washed clean from grinding debris on a continuous basis during the abrading process. Cleaned disks are removed from a platen and placed in temporary storage when another clean disk having different sized particles is attached to the platen. As the water exits the periphery of the rotating platen, it is very easy to collect the contaminated spent water which is filtered to consolidate the undesirable grinding debris into a very small volume for disposal. A further advantage is that these abrasive disks are typically attached to a platen with the use of vacuum which provides robust support for the thin and fragile abrasive sheets. Vacuum attachment allows clean disks to be quickly changed to provide smaller sized abrasive particles for the normal progression of a lapping procedure. This results in substantial savings of lapping process time. Disks can also be interchangeably used with different lapping machines. In addition, another advantage is that the abrading speeds are typically greater than for a slurry system which increases the abrading process productivity.

However, these continuous coated abrasive disks also have a number of significant disadvantages for high speed flat lapping. One disadvantage is that these disks have an abrasive coating that extends across the full surface of the disk. Instead of these continuous coated disks it is desired that these disks only have an annular shaped abrasive band to provide even wear-down of the abrasive during abrading usage. It not practical to construct an annular shaped abrasive disk from a flexible continuous coated web backing sheets because an annular disk having a circular periphery and a substantial central hole results in a structurally unstable device that can not be usefully mounted with the use of vacuum on a platen. Unlike a continuous backing flexible abrasive disk that can easily be centered and laid flat on a platen, the flexible cut-out annular disk ring has a tendency not to lay flat on the platen. After the cut-out annular disk ring is attached to the platen with vacuum, the inner radius edge of the annular disk tends to stick up from the platen surface. Water and abrading debris collects under this raised inside edge during the abrading process. The accumulated edge debris raises the abrasive sheet inner radius edge into a non-planar configuration which results in a non-flat abrasive surface that can not be used in flat lapping. Here, it is difficult to produce a flat workpiece surface when the surface of the abrasive is uneven. Further, all of the expensive diamond abrasive sheeting material that originally resided at the annular band interior and exterior portions of the abrasive coated web that are discarded when making the annular disk result in a great economic loss.

Cutting-out an annular disk band from a web and adhesively bonding the annular band to another continuous disk backing sheet to eliminate the annular disk inside hole also has problems. For instance, it is difficult to provide the overall thickness control to the composite layer disk that satisfies the very precise thickness control that is required for use in high speed flat lapping. Adding another backing sheet to form a continuous backing surface over the full surface area of the composite layer disk is an expensive extra step in the disk manufacturing process.

A continuous backing sheet disk having an annular band of abrasive can be formed from a disk having a uniform coating of diamond abrasive over the full surface of the disk. Here all of the abrasive media that is located at the disk central region is removed by various techniques including abrading or the application of chemicals, heat or other energy or combinations of more than one of these. These annular abrasive disks are not practical from a manufacturing or an economic standpoint because of manufacturing costs and due to the loss of the expensive diamond abrasive material from the disk central region area.

Because the workpiece is in flat full-face contact with the abrasive during high speed flat lapping, the face size of the workpieces is limited by the size of the abrading surface. The rotary platen abrasive surface area dimensions are preferred to be only somewhat larger than the largest surface dimensions of the workpiece. If the workpiece is less wide than the abrasive annular width it becomes necessary to move or oscillate the workpiece across the full radial width surface of the abrasive during the abrading process to avoid wear-grooves in the abrasive. Likewise, if the workpiece is wider than the abrasive it becomes necessary to move or oscillate the workpiece across the full radial width surface of the abrasive during the abrading process to avoid wear-grooves in the workpiece. To minimize having to have the complex action of oscillating a workpiece at the same time that it is rotated during the abrading process it is often desirable to produce raised island abrasive disks that have a variety of raised island annular band widths to match different sized workpieces. As long as the rotatable platen has a continuously flat annular area that is sufficiently wide to accommodate the largest annular width abrasive disk, other abrasive disks having smaller annular widths can also be used on the same rotary platen.

V. Coolant Water Required

Another disadvantage of the use of continuous coated disks is that they can not be used for flat lapping at high speeds in the presence of coolant water because the workpieces often tend to hydroplane which causes non-flat workpiece surfaces. Coolant water is required for high speed lapping to prevent overheating the workpiece and also the diamond abrasive material. This water is typically applied in a stream some distance upstream of the leading edge of the workpiece. When the stream of the required coolant water is applied to the moving surface of one of the abrasive disks, the water tends to spread radially out in a thin film over this portion of the disk surface before the water film contacts the workpiece.

The abrasive disks that are used for flat lapping have extraordinarily smooth and flat surfaces. Abrasive particle filled beads that have a non-worn bead diameter of only 0.002 inches (45 micrometers) are coated in a monolayer on a smooth flexible backing sheet. The abrasive surface of this disk is so smooth that a thumbnail can easily be drawn across the surface with no apparent resistance. A partially worn down abrasive disk is even smoother. Workpieces that are flat lapped typically have substantially flat surfaces even before a lapping operation begins. These workpieces being abraded are placed in full flat surface contact with the water film coated abrasive surface. The amount of localized abrasive contact with the workpiece surface is dependent on the depth of the water film that resides in the interface gap between the workpiece and abrasive surfaces. Too much water film depth prevents the abrasive from contacting the workpiece. Controlling the thickness of the water film is critical for allowing fast workpiece material removal but yet providing sufficient cooling of both the workpiece and the abrasive.

The workpiece and the abrasive both have rigid and flat support surfaces. A film of water is present in the interface gap region between the workpiece and the abrasive. Because the interface water is incompressible it is necessary for any excess water to be uniformly extruded from the depths of the interface to the periphery of the workpiece to allow substantial contact between the abrasive and the workpiece. Large contact pressures can be applied to a workpiece to squeeze this excess water out but this pressure can easily distort the precision workpiece during the abrading operation. Because the abrasive disk surface moves relative to the fixed-position workpiece, "fresh" water is continuously supplied to the interface gap at the leading edge of the workpiece. Likewise, the "old" interface gap water is exhausted at the trailing edge of the workpiece as it is dragged beyond the perimeter of the workpiece by the moving abrasive. During high speed flat lapping, the abrading speed of the abrasive is very high, often in excess of 100 mph (160 km/hr). This high speed can cause hydroplaning of the smooth flat workpiece that is in contact with the water film coated smooth and flat abrasive surface. When the workpiece is hydroplaning, an interface boundary layer of water separates at least a portion of the surface of the workpiece from contact with the abrasive surface. A rough analogy to workpiece hydroplaning during high speed flat lap abrading is the hydroplaning of an auto traveling at these same high speeds on heavy-rain covered roads with bald smooth tires. Contact between the road surface and the tire body can be lost where the car hydroplanes out of control. Hydroplaning of a car is not an issue at low highway speeds (non-high speed abrading) or with dry roads (abrading without the use of water).

Hydroplaning is not an issue with water cooled abrasive surfaces that move slowly. Here, the water is not driven deep into the same interface gaps; and also, the slow moving water does not develop high enough pressures at impact to substantially lift the leading edge of the workpieces. However, if these water cooled disks are instead used at slow abrading speeds to prevent hydroplaning, the productivity of the disks is reduced dramatically.

Even a minimized use of water at high abrading speeds in flat lapping can result in hydroplaning of the workpieces when non-island abrasive disks are used. This occurs because even the smallest amount of hydroplaning affects the abraded flatness of the very precision flat surfaces of the typical flat lapped workpieces.

High abrading speed hydroplaning will occur with the use of either continuous coated full-surfaced abrasive disks or with disks that only have annular bands of continuous coated abrasive material.

Hydroplaning of flat surfaced workpiece parts uniquely occurs with high speed flat lapping because of the combination of high abrading speeds in the presence of water coolant and the extremely low abrading contact pressures that are typically employed in flat lapping.

Traditional grinding or abrading systems seldom experience hydroplaning with coolant liquids because of the high contact pressures between the abrasive and the workpiece that are typically used with this type of grinding. These high abrading contact forces or high contact pressures tend to prevent the separation of portions of a workpiece surface from the abrasive. For instance, when a conventional abrading process uses a system such as a fixed abrasive grinding wheel, the abrasive often contacts the workpiece with only "line" contact. Because the contact area of the "line" is so small, even a small contacting force can result in a large localized abrading contact pressure. Also, grinding wheels typically contact workpieces that are mounted on rigid surfaces which prevent the workpieces from being pushed away from the grinding wheel by the coolant water that exists between the grinding wheel and the workpiece. Hydroplaning does not occur here.

Portable manual disk grinders are not used to flat-lap a workpiece surface. Also, they typically do not use water as a coolant. First, water would create a large clean-up mess as these grinders are used to remove sharp edges and polish rectangular or curved metal workpiece structures that are often located in a open shop floor area. Second, there are great potential dangers to the operators associated with electrical shocks when these manual electric grinders are used in the presence of water. When no water or liquid coolant is used in an abrading process there is no possibility of hydroplaning of a workpiece during the high speed abrading process.

High speed abrading with diamond abrasives typically removes hard workpiece material so fast that the contact pressures have to be minimized to assure that a precision flat surface is provided over the full surface of the workpiece. The very low contact forces used in high speed lapping are highly desired because they also result in significantly lower workpiece subsurface damage than is experienced with conventional abrading systems. The ratio of abrading contact pressure between high speed lapping and typical abrading can be greater than 50:1 or even 100:1. The relationships where the rate of workpiece material removal is proportional to both the applied contact pressure and to the surface speed are well known to those skilled in the art. Also, the relationships between the depth of and the fracture characteristics of subsurface damage of workpiece material and the abrading contact pressure are well known to those skilled in the art.

Water coolant must be used with these high-speed lapping systems to cool both the workpiece and diamond abrasive surfaces. Other coolant liquids can be used but they can present workpiece contamination problems and generally are not as effective as water as a cooling agent. Friction rubbing action of the abrasive surface against the workpiece surface can easily produce very high temperatures at localized regions. Water is deposited on the moving disk abrasive surface upstream of the workpiece for use as a coolant to remove the excess heat that is generated by the friction. This water is carried into the depths of the interface region between the flat workpiece surface and the abrasive surface to cool the surfaces that are remote from the peripheral edges of the workpiece. Without water coolant, severe thermal degradation of the workpiece material or the individual abrasive particles would occur.

Water converts to steam at temperatures above 212 degrees F. (100 degrees C.) when the localized high temperatures cause boiling of some portion of the water which vaporizes in the process. The localized hot spot areas are efficiently cooled because the convection heat transfer coefficient that transfers heat from either the abrasive or workpiece surfaces to the water is extraordinarily high in a boiling (steam production) process. Here, heat is readily transferred from the surfaces into the water, which is vaporized. The huge amount of energy absorbed in this water vaporization conversion process typically provides very substantial cooling at low flat lapping speeds which prevents the workpiece surface temperatures from rising enough to result in material thermal damage. However, it is common for localized thermal stress cracking of ceramic materials such as aluminum titanium carbide (ALTIC) to occur when they are flat lapped at high abrading speeds using a water cooled abrasive disk that has a continuous coating of abrasive. Ceramic materials, semiconductor materials and composite ceramic-metal materials are sensitive to localized heating and are particularly susceptible to thermal stress cracking when flat lapped at high abrading speeds.

The vaporized steam that is formed by friction heating deep in an interface gap between a flat workpiece and a flat abrasive surface has a volume that is 1,600 times greater that that of the precursor liquid water. This high-volume steam tends to be somewhat trapped in the interface region between the workpiece and abrasive surfaces. For instance, a quantity of steam that is located at the center of a flat-surfaced cylindrical disk workpiece has to travel, within the small workpiece interface gap, the full radial distance of the disk to escape at the disk periphery. The presence of steam in the interface gap can "starve" regions of the interface from liquid water which can result in overheating and thermal-cracking areas of the workpiece. Because the escaping steam can also have a significant steam pressure, portions of the workpiece can be raised away from the abrasive surfaces by the steam which can result in the abrading of non-flat workpiece surfaces. If steam is formed in very small quantities at very small localized areas, minute bubbles of the steam can collapse back into liquid water within the interface gap if the small bubbles are cooled sufficiently and quickly enough.

VI. Coolant Water Applied

During hydroplaning, with non-island continuous coated abrasive disks operating at high rotational speeds, water is applied to the moving planar abrasive surface ahead of the leading edge of the flat workpiece surface. This is done to assure that coolant water is present in the interface gap between the workpiece and the abrasive. Typically slow moving water is applied in single or multiple streams that impinge on the surface of the abrasive surface that is moving at a high speed. This water tends to quickly spread out in a water film across the flat and relatively smooth abrasive surface while it is yet located upstream of the leading edge of the workpiece. The water film is spread out due to factors that include the direction of the water stream, the high speed of the rotating platen and to centrifugal forces that are generated by the rotating platen.

Sufficient coolant water is applied to prevent thermal damage to either the workpiece or to the individual abrasive particles. The applied water wets the flat surface of the abrasive where some of it fills the small recessed areas between the individual abrasive beads that are bonded to a backing sheet. Excess water will locally flood over the top of the individual abrasive beads and will be spread out over that local area of the flat surface of the abrasive as the excess water is dragged by the moving abrasive toward the leading edge of the workpiece. The spread-out water film that is carried along by the abrasive surface often has a thickness that is greater than the very small interface gaps that exists between some of the abrasive surface and the workpiece surface. These gaps are often due to small defects that exist on the edges of the workpiece, or to non-flat workpiece surfaces or even due to the design of the workpiece which can have a beveled peripheral edge. If an interface gap is only 0.001 inches (25 micrometers) high then the moving water film thickness must not exceed this height for the moving water to pass freely into the open interface gap. Any of the moving film of water that exceeds this gap height will impact the leading edge of the workpiece wall and also, form a standing bank of water at the leading edge of the workpiece.

When this high speed water impacts the leading edge wall of the workpiece, a portion of the water that impacts the wall has a tendency to be driven into the small interface gap. Penetration of this water, moving at high speeds, into the gaps tends to lift the leading edge of the workpiece from the planar surface of the abrasive due to the water pressure that is developed as the high speed water impacts the leading edge of the workpiece. This happens because of the great pressure that is developed in this impacting water as it is decelerated from a speed that is near-equal to the abrasive speed to a near-zero speed at the workpiece wall surface. As the workpiece leading edge is lifted, the workpiece planar surface is now tipped relative to the planar abrasive surface. Here, most of the abrading action on a tipped workpiece takes place at the trailing edge portion of the workpiece surface where the abrasive is in intimate contact with the tipped workpiece surface. Very little abrading action takes place at the leading edge of the workpiece because the increased thickness of the water film that now exists in the leading edge gap prevents contact of the abrasive particles with that front portion of the workpiece surface. The uneven abrading action on the workpiece surface tends to form a non-flat surface on the workpiece.

Often there are very small portions of the interface area gap that are thicker than other portions due to the out-of-plane flatness of both the abrasive surface and the workpiece surface. If too much thickness of a boundary layer of water exists in a portion of the interface gap area, the abrasive particles do not contact the workpiece surface and no abrading action takes place in that area. If too little water is present in the interface gap, then the moving abrasive overheats either the workpiece or overheats individual abrasive particles, or both.

Even when a minimum of coolant water is applied to a moving abrasive disk surface, the relative size of the water bank height is important. A typical non-worn abrasive bead used in flat lapping is only 0.002 inches (45 micrometers) high and the height of a partially worn abrasive bead is less than that. The gap that exists between a typical flat lapped workpiece and the abrasive is often much less than the height of the abrasive beads. It takes very little coolant water to build up a water bank at the leading edge of the workpiece that is significantly higher than the interface gap that exists between the workpiece and the abrasive.

Water is dragged from the standing water bank into the gap by the shearing action on the water by the abrasive particles traveling under the surface of the workpiece. Because the abrasive disk is moving at great speeds relative to the workpiece, the water that is carried along by the abrasive particles is also moving at a great speed relative to the workpiece edge. When this moving water film that is carried along on the flat surface of the continuous coated abrasive contacts the leading edge of the workpiece the water is abruptly decelerated when it contacts the edge of the workpiece. This water tends to build up in a water-bank at the leading edge of the workpiece where the leading edge is that workpiece edge that faces the incoming abrasive surface. The dynamic energy of the water that was moving at great speed is converted to into a high hydraulic pressure when it is suddenly decelerated as it abruptly contacts the leading edge of the workpiece. An analogy to this creation of a high water pressure is when a moving steam of water from a garden hose is directed against a stationary wall where the moving water is stopped but forms a bank of high-pressure water at the contacting surface of the wall. This high-pressure water can easily penetrate cracks and gaps in the wall surface.

Water that is carried on the outer periphery of a 12 inches (30.5 cm) diameter disk rotating at 3,000 rpm has a surface speed of 107 mph (172 km/hr) and develops a pressure of approximately 95 psi when abruptly decelerated against a workpiece. This pressure would lift 95 lbs if applied to a 1 square inch area (6.5 square cm). For reference comparison, a typical contact force that is applied during flat lapping to a 4 square inch workpiece is from 1 to 2 lbs which is from 0.25 to 0.5 lbs per square inch. Here, the water pressure force caused by the impacting water is from approximately 200 to 400 times greater than the applied abrading contact force. The high-pressure water in the workpiece water bank tends to penetrate the gap that exists between the workpiece leading edge and the moving abrasive surface. This high-pressure water then tends to lift the leading edge of the workpiece from the planar surface of the abrasive. As the workpiece leading edge is lifted, the workpiece planar surface is now tipped upward relative to the planar abrasive surface. Most of the abrading action on a tipped workpiece takes place at the trailing edge portion of the workpiece surface where the abrasive is in intimate contact with the workpiece surface. Very little abrading action takes place at the leading edge of the workpiece because the increased thickness of the water film that now exists there in the gap prevents contact of the abrasive particles with the workpiece surface.

Another analogy to workpiece hydroplaning during high speed flat lap abrading is the hydroplaning of an boat that is traveling at these same high speeds on a river. Because the front of a boat is tapered downward from the bow, the water that passes under the tapered bow at first forces the bow upward and later, in the process of planning, the whole boat rises up as the boat "hydroplanes" on the surface of the water. This same effect takes place when a boat (workpiece) is at anchor (workpiece at fixed position) and very fast river current (water carried on flat abrasive surface) results in the boat (workpiece) being forced upward in the water (interface gap coolant water). Workpieces are often tapered at the peripheral edges or the coolant water is forced under the workpiece leading edges in such a way that the workpiece surface is presented at a tilted angle to the water that is carried at high speeds by the abrasive. Here, the workpiece is raised up in the moving water and positioned away from abrading contact with the abrasive surface VII. Abrasive Beads The production of equal sized abrasive beads, as described here, is not possible with the production processes that are described for manufacturing the prior art abrasive beads. The equal sized beads described here are produced from equal volume mold cavities where the lump-volumes of liquid abrasive dispersion are ejected in a liquid form from the cavity cells. Surface tension forces then act of the ejected liquid dispersion lumps to form them into spherical abrasive dispersion beads that are then dried and sintered. The volumetric size and diameter of each abrasive bead is dependent on the volumetric size of the mold cavity cells.

Other prior art non-mold formed processes that are now used to produce abrasive beads depend on phenomena associated with fluid flow instabilities that promote the periodic formation of lumps of the moving liquid. The liquid lumps are then formed into spheres by surface tension forces. Controlled frequency vibration is often applied to the liquid as it is breaking-up into lump segments to minimize the differences in the formed lump sizes. Vibration is also applied to liquid covered plates to form spherical beads with a process that is roughly analogous to water droplets being formed as moving waves impact rocks on a shoreline. These bead production techniques all produce a range of different sized beads even though the nominal or average size of the produced beads can be controlled.

In one prior art example, abrasive beads are produced by stirring a liquid stream of a slurry of a water based ceramic precursor material mixed with abrasive particles into a container of a dehydrating liquid. The dehydrating liquid is stirred and the slurry liquid tends to break into small lumps due to the stirring action. Faster stirring produces an average of smaller lumps that form into spherical shapes due to surface tension forces acting on the individual liquid slurry lumps. Dehydration of the slurry spheres produces solidified abrasive precursor beads that are heat treated to produce soft ceramic abrasive beads.

In another prior art example, abrasive beads are produced by pouring a liquid stream of a slurry of a water based ceramic precursor material mixed with abrasive particles into the center of a wheel of a atomizer wheel that is rotating at approximately 40,000 RPM (revolutions per minute). The slurry tends to exit the wheel in ligament slurry streams that break up into individual slurry lumps that travel in a trajectory in a hot air environment that dehydrates the slurry lumps. The lumps form into spherical shapes due to surface tension forces acting on the individual liquid slurry lumps. Changing the rotational speed of the wheel changes the average size of the liquid lumps. Dehydration of the slurry spheres produces solidified abrasive precursor beads that are heat treated to produce soft ceramic abrasive beads. These well known prior art abrasive beads produced by these two processes do not have equal beads sizes.

Spray nozzles that break up a stream of pressurized liquid into small droplets is often used but the spray heads produce a large range of droplet sizes.

Pipes or tubes are also used to form liquid beads. This is a process that is roughly analogous to water droplets being formed as moving water exits a garden hose. One disadvantage of the use of small tubes is that the liquid droplets are roughly approximate to twice the inside diameter of the tubes. In order to produce the desired 0.002 inch (51 micrometer) abrasion dispersion droplets, the hypodermic-type tubes would need an inside diameter of approximately 0.001 inches (25 micrometers) which is prohibitively small for abrasive bead manufacturing. Also, the abrasive particles contained in the dispersion liquid would quickly erode-out the inside passageways of these small tubes as the dispersion is forced through them.

Solidified sharp edge abrasive particles are produced from equal volume mold cavities as described by Berg in U.S. Pat. No. 5,201,916. His abrasive particles are fully dense, have a high specific gravity and are hard enough to be used as abrasive particles. They are not porous and soft enough to be used as erodible abrasive particles that can be used to progressively expose diamond particles that are encapsulated within an abrasive bead.

His system is not capable of making spherical abrasive particles. The production of spherical shaped abrasive particles would require that the dispersion used to fill his mold cavities would be ejected from the cavities in a liquid form to allow surface tension forces to act on the ejected dispersion lumps to form them into spherical shapes. However, he must solidify his dispersion while it resides in the cavities for the dispersion lump particles to assume the particle sharp-edge corners from the sharp-edged mold cavities. If the Berg ejected dispersion particles were in a liquid state, surface tension forces would act on them and form the dispersion lumps into spherical shapes with the associated loss of the sharp particle cutting edges. Spherical abrasive particles made of his materials would be useless for abrading purposes because they do not provide sharp cutting edges.

PRIOR ART REFERENCES

Both planar surface and island type abrasive articles have been produced for many years using materials and manufacturing processes that are well known in the abrasive industry. Raised and non-raised island types of abrasive articles having different types of abrasive particle materials are described in U.S. Pat. No. 794,495 (Gorton), U.S. Pat. No. 1,657,784 (Bergstrom), U.S. Pat. No. 1,896,946 (Gauss), U.S. Pat. No. 1,924,597 (Drake), U.S. Pat. No. 1,941,962 (Tone), U.S. Pat. No. 2,001,911 and U.S. Pat. No. 2,115,897 (Wooddell et. al.), U.S. Pat. No. 2,108,645 (Bryant), U.S. Pat. Nos. 2,242,877 and 2,252,683 and 2,292,261 (Albertson), U.S. Pat. No. 2,755,607 (Haywood), U.S. Pat. No. 2,838,890 (McIntyre), U.S. Pat. No. 2,907,146 (Dynar), U.S. Pat. No. 3,048,482 (Hurst), U.S. Pat. No. 3,121,298 (Mellon), U.S. Pat. No. 3,423,489 (Arens et al.), U.S. Pat. No. 3,495,362 (Hillenbrand), U.S. Pat. No. 3,498,010 (Hagihara), U.S. Pat. No. 3,517,466 (Bouvier), U.S. Pat. No. 3,605,349 (Anthon), U.S. Pat. No. 3,921,342 (Day), U.S. Pat. No. 4,256,467 (Gorsuch), U.S. Pat. No. 5,318,604 (Gorsuch et al.), U.S. Pat. No. 4,863,573 (Moore et al.), U.S. Pat. No. 3,991,527 (Maran), U.S. Pat. No. 4,111,666 (Kalbow), U.S. Pat. No. 5,015,266 (Yamamoto), U.S. Pat. No. 5,137,542 (Buchanan), U.S. Pat. No. 5,190,568 (Tselesin), U.S. Pat. No. 5,199,227 (Ohishi), U.S. Pat. No. 5,232,470 (Wiand), U.S. Pat. No. 5,910,471 (Christianson et al.), U.S. Pat. No. 6,231,629 (Christianson et al.), and in U.S. Patent Application Numbers 2003/0143938 (Braunschweig et al.), 2003/0022604 (Annen et al.) and 2003/0207659 (Annen et al.).

Abrasive particles may be aluminum oxide particles or they be comprised of a combination of aluminum oxide and other metal oxide materials. The abrasive particles can have geometric shapes including spherical or pyramid shapes or they may have irregular body shapes. Abrasive agglomerates can be made of a binder that supports small individual abrasive particles. A variety of abrasive particles including aluminum oxide particles, diamond particles, cubic boron nitride particles and other abrasive materials, or a combination of different abrasive materials can be used where they are supported by a organic or non-organic material. The abrasive agglomerates can be comprised of a ceramic binder matrix that surrounds and supports small individual abrasive particles including diamond particles. Non-abrasive and abrasive agglomerates having spherical and non-spherical shapes, solid and hollow structures and their processes of manufacture using materials including water based solutions of metal oxides have been described in patent literature. Individual particles or agglomerates of the abrasive mixtures can be formed by a variety of techniques including coating the mixture onto a surface, drying the mixture and then crushing or breaking-up the coated mixture into particles or agglomerates. Shaped abrasive particles or agglomerates of the mixtures can also be formed by introducing the mixture into mold cavities, drying the mixture to solidify and shrink the shaped forms and then ejecting the individual shape-formed particles from the cavity molds. The shaped particles can then be crushed into smaller particles or agglomerates or they can be used in their original shapes. The particles are subjected to a number of heat process steps. A first step is to first calcine or drive off the bound water. Another step can be to heat the agglomerates to a temperature sufficiently high to form a rigid ceramic matrix that surrounds and supports the agglomerate mixed-in abrasive particles but where the temperature does not exceed the thermal degradation temperature of abrasive particles such as diamond. The temperature limit for processing agglomerates where enclosed diamond particles are not thermally damaged is typically 500 to 600 degrees C., depending on the furnace atmosphere. If an aluminum oxide particle is heated sufficiently hot to create a hardened aluminum oxide abrasive particle, the temperatures required to accomplish this are typically higher than 1000 degrees C. As diamond particles can not withstand this high process temperature, it is not practical to create hardened aluminum oxide abrasive particles from an precursor agglomerate that contains diamond particles. Also, spherical shapes can be formed from the water based metal oxide mixtures that are introduced into dehydrating fluids, induced to form individual lumps while in a free state where lump surface tension forces create spherical lump shapes. The individual spherical shapes are solidified with the use of different dehydrating fluids or with the use of hot air to remove water from the material contained in the spheres as they independently move in the fluid without contacting each other. After the spheres are solidified and are "dry" enough that they do not adhere to each other they are collected together and subjected to further heating processes to develop the desired hardness and strength of each spherical shaped particle. The manufacture of abrasive and non-abrasive agglomerates and particles are described in U.S. Pat. No. 2,216,728 (Benner et al., U.S. Pat. No. 3,709,706 (Sowman), U.S. Pat. No. 3,711,025 (Miller), U.S. Pat. No. 3,859,407 (Blanding et al.), U.S. Pat. No. 3,916,584 (Howard et al.), U.S. Pat. No. 3,933,679 (Weitzel et al.), U.S. Pat. No. 4,112,631 (Howard), U.S. Pat. No. 4,314,827 (Leitheiser et al.), U.S. Pat. No. 4,315,720 (Ueda et al.), U.S. Pat. No. 4,364,746 (Bitzer), U.S. Pat. No. 4,373,672 (Morishita et al.), U.S. Pat. No. 4,393,021 (Eisenberg et al.), U.S. Pat. No. 4,421,562 (Sands), U.S. Pat. No. 4,541,566 (Kijima et al.), U.S. Pat. No. 4,541,842 (Rostoker), U.S. Pat. Nos. 4,652,275 and 4,799,939 (Bloecher), U.S. Pat. No. 4,773,599 (Lynch et al.), U.S. Pat. No. 4,918,874 (Tiefenbach), U.S. Pat. No. 4,930,266 (Calhoun et al.), U.S. Pat. No. 4,931,414 (Wood et al.), U.S. Pat. No. 5,090,968 (Pellow), U.S. Pat. No. 5,107,626 (Mucci), U.S. Pat. No. 5,108,463 (Buchanan), U.S. Pat. No. 5,152,917 (Pieper et al.), U.S. Pat. No. 5,175,133 (Smith et al.), U.S. Pat. No. 5,201,916 (Berg et al), U.S. Pat. No. 5,489,204 (Conwell et al.), U.S. Pat. No. 5,549,961 (Haas et al.), U.S. Pat. No. 5,549,962 (Holms), U.S. Pat. No. 5,888,548 (Wongsuragrai et al.), U.S. Pat. No. 6,017,265 (Cook et al.), U.S. Pat. No. 6,099,390 (Nishio et al.), U.S. Pat. No. 6,602,439 (Hampden-Smith), U.S. Pat. No. 6,186,866 (Gagliardi), U.S. Pat. No. 6,299,508 (Gagliardi et al), U.S. Pat. No. 6,319,108 (Adefris et al.), U.S. Pat. No. 6,371,842 (Romero), U.S. Pat. No. 6,521,004 (Culler, et al.), U.S. Pat. No. 6,540,597 (Ohmori), U.S. Pat. No. 6,551,366 (D'Souza et al.), U.S. Pat. No. 6,613,113 (Minick et al.), U.S. Pat. No. 6,620,214 (McArdle, et al.), U.S. Pat. No. 6,645,624 (Adefris et al.) and in US Patent Application Numbers 2002/0003225 (Hampden-Smith et al.) and 2003/0207659 (Annen et al.).

Processes that are used to form hardened aluminum oxide abrasive particles from a sol-gel alumina material are described in patent literature. These processes include the use of aluminum oxide particles that are suspended in a water solution that is gelled and dried and then crushed. The crushed particles are calcined to remove volatiles and then sintered to produce abrasive particles having a range of particle sizes.

Other processes that are used to form heat-treated hard aluminum oxide abrasive or non-abrasive particles from an alumina material mixture that is heated and quenched are described in patent literature. Ceramic precursor materials include aluminum oxide or other metal oxides or combinations of metal oxides. This method of producing hardened aluminum oxide abrasive particles by heating the aluminum oxide to a high temperature and then rapidly reducing the temperature by quenching it in a cooling atmosphere is analogous to the process of producing hardened metal by heating and quenching high-carbon steel to form fine grained, hard and tough steels. Process temperature cycle conditions can be determined by the use of Time-Temperature-Transformation (TTT) study of the metal oxide mixture materials, very much the same as used for the heat-treat processing of hardened steel compositions. Aluminum or other metal oxide materials can be mixed in a water solution, the mixture milled, ball milled or otherwise mixed. In some embodiments, the mixture is then coated and dried to form a solidified mixture material that is calcined to remove volatiles from the material. The mixture can also be sintered at high temperature to form a composite fused material with no consolidating pressure applied or the material can be pressed together at high temperatures with a hot press or a hot isostatic press. The consolidated material can then be crushed into individual particles that can be further heat treated to allow the particles to be used as abrasive particles. Also, metal oxide particles can be heated to a very high temperature after which they are rapidly cooled by quenching to form fused abrasive material. Crushing of the mixture into small particles can be done early in the ceramic process or it can be done later in the process. Heating methods for the quenching operation include subjecting alumina particles to a variety of heat sources that include gas-flame or plasma-arc torches. There is no precise control of the particle sizes that are produced when these metal oxide materials are crushed or fractured into small pieces which are processed by these high temperature processes. Particles produced by one typical described flame torch method had spherical shapes but ranged in size from a few micrometers up to 250 micrometers. Generally the methods that are used to form heat-treated hardened abrasive particles require heating the materials to high temperatures that can range from 900 degrees C. to 1600 degrees C. However, these high temperatures that are required to form abrasive particles from an aluminum oxide precursor act as a barrier to form agglomerate abrasive particles where the agglomerate has both hardened metal oxide abrasive particles and diamond abrasive particles. It is not possible mix individual diamond abrasive particles with the precursor aluminum oxide materials prior to the heat treatment of the precursor aluminum oxide that will convert it into a hardened form of alumia that is hard enough to act as an effective abrasive. The 900 to 1600 degree C. process temperatures required for the conversion of the aluminum oxide precursor to a hardened alumina are far in excess of that nominal 500 degree C. temperature that will thermally degrade the diamond particles. The processes that create hard alumina preclude the inclusion of diamond particles. Diamond particles can be mixed with metal oxides or silica to form agglomerates where the diamond particles are surrounded by a ceramic matrix. These diamond mixture agglomerates are subjected to high process temperatures but these temperatures are typically limited to 500 degrees C. to protect the diamond from breaking down thermally. The silica ceramic matrix is soft and porous and is sufficiently strong to support the individual diamond particles but the silica ceramic is far too soft to act as a significant abrasive material itself. In fact, the silica is considered to be soft enough to be erodible under abrading action and the eroding action allows new diamond particles to be exposed as the old worn diamond particles are expelled from the agglomerate. Melting already-solidified individual aluminum oxide particles as they travel in space can create abrasive spheres. The moving particles are melted by flame or by plasma heat and surface tension forces acting on the melted particles forms them into spheres as they move through space. These hot spherical particles can then be rapidly cooled or quenched by methods including injecting them into a water bath to form hardened spheres having smooth and rounded exterior surfaces. The hardened spherical shapes produced by these processes can be crushed to produce small abrasive particles that have sharp edges but the crushing process does not produce abrasive particles that have equal sizes. Instead, there is a large random range of particle sizes that are produced by the abrasive material crushing action. In some cases undersized abrasive particles are recycled back into a melt and reprocessed to form the desired sized particles. These abrasive particles are described in U.S. Pat. No. 5,213,591 (Celikkaya et al.), U.S. Pat. No. 5,352,254 (Celikkaya), U.S. Pat. No. 5,474,583 (Celikkaya), U.S. Pat. No. 5,611,828 (Celikkaya), U.S. Pat. No. 5,628,806 (Celikkaya et al.), U.S. Pat. No. 5,641,330 (Celikkaya et al.), U.S. Pat. No. 5,653,775 (Plovnick et al.), U.S. Pat. No. 6,277,161 (Castro et al.), U.S. Pat. No. 6,287,353 (Celikkaya), U.S. Pat. No. 6,592,640 (Rosenflanz et al.), U.S. Pat. No. 6,607,570 (Rosenflanz et al.), and U.S. Pat. No. 6,669,749 (Rosenflanz et al.). These abrasive particles are also described in U.S. Patent Applications 2003/0000151 (Rosenflanz et al.), 2003/0110707 (Rosenflanz et al.), 2003/0110709 (Rosenflanz, et al.), 2003/0115805 (Rosenflanz, et al.), 2003/0126804 (Rosenflanz et al.), 2004/0020245 (Rosenflanz et al.), 2004/0023078 (Rosenflanz et al.), 2004/0148868 (Anderson et al.), 2004/0148869 (Celikkaya et al.), 2004/0148870 (Celikkaya et al.), 2004/0148966 (Celikkaya et al.), 2004/0148967 (Celikkaya et al.), Processes of coating abrasive articles with a variety of abrasive particles and abrasive agglomerates using a variety of backing materials, backing surface treatments, abrasive particle treatments, polymeric adhesives, metal plating and other binders, adhesive fillers or additives, adhesive solvents, and adhesive drying and polymerization are described in U.S. Pat. No. 3,916,584 (Howard et al.), U.S. Pat. No. 4,038,046 (Supkis), U.S. Pat. No. 4,112,631 (Howard), U.S. Pat. No. 4,251,408 (Hesse), U.S. Pat. No. 4,426,484 (Saeki), U.S. Pat. No. 4,710,406 (Fugier), U.S. Pat. No. 4,773,920 (Chasman et al.), U.S. Pat. No. 4,776,862 (Wiand), U.S. Pat. No. 4,903,440 (Kirk et al.), U.S. Pat. No. 4,930,266 (Calhoun et al.), U.S. Pat. No. 4,974,373 (Kawashima et al.), U.S. Pat. No. 5,108,463 (Buchanan), U.S. Pat. No. 5,110,659 (Yamakawa et al.), U.S. Pat. No. 5,142,829 (Germain), U.S. Pat. No. 5,221,291 (Imatani), U.S. Pat. No. 5,251,802 (Bruxvoort et al.), U.S. Pat. No. 5,273,805 (Calhoun et al.), U.S. Pat. No. 5,304,225 (Gardziella), U.S. Pat. No. 5,368,618 (Masmar), U.S. Pat. No. 5,397,369 (Ohishi), U.S. Pat. No. 5,496,386 (Broberg et al.), U.S. Pat. No. 5,549,962 (Holms), U.S. Pat. No. 5,551,961 and U.S. Pat. No. 5,611,825 (Engen), U.S. Pat. No. 5,674,122 (Krech), U.S. Pat. No. 5,924,917 (Benedict), U.S. Pat. No. 6,217,413 (Christianson), U.S. Pat. No. 6,231,629 (Christianson et al.), U.S. Pat. No. 6,319,108 (Adefris et al.), U.S. Pat. No. 6,645,624 (Adefris et al.). Processes of abrading workpieces with abrasive articles are described in U.S. Pat. No. 3,702,043 (Welbourn et al.), U.S. Pat. No. 4,272,926 (Tamulevich), U.S. Pat. No. 4,341,439 (Hodge), U.S. Pat. No. 4,586,292 (Carroll et al.), U.S. Pat. No. 5,221,291 (Imatani), and U.S. Pat. No. 5,733,175 (Leach).

There are two primary methods of applying abrasive particles to the surface of an abrasive article. In one method, a thin make coating of a binder adhesive is applied to a backing surface, abrasive particles are dropped onto the adhesive and then a reinforcing size coating is applied over the particles and backing. In another method, a slurry mixture of a solvent thinned adhesive binder and abrasive particle mixture is applied to the surface of a backing where the coated slurry mixture has a thickness greater than the diameter of the individual abrasive particles. Then, the solvent is removed which reduces the thickness of the binder to exposes the individual abrasive particles that are attached to the backing by the reduced-thickness binder. In other methods, abrasive particles are mixed with a binder, coated on a backing and the binder is eroded away along with dulled abrasive particles to expose new sharp abrasive particles during the abrading process. Further methods of attaching abrasive particles to a backing sheet include electroplating and brazing.

High speed lapping can be accomplished with the use of thin flexible abrasive coated disks or sheets that are very precise in thickness and that are attached to a platen that is very flat and stable. Lapping equipment and lapping process procedures that apply are taught by Duescher in U.S. Pat. Nos. 5,910,041, 5,967,882, 5,993,298, 6,102,777, 6,120,352, 6,149,506, 6,048,254, 6,752,700 and 6,769,969 which are incorporated herein by reference.

The manufacture of flat surfaced raised island abrasive articles that are to be used in lapping or flat-lapping is critical in that the finished article product should have abrasive particles that are all bonded to an abrasive disk article at the same elevation from the backside of the abrasive article. It is not critical to control the absolute height of abrasive flat islands as the depth of the water passage valleys located between the island structures can vary considerably and still perform the function of a simple water passageway. The total thickness of the monolayer abrasive coated abrasive article must be controlled to within a small fraction of the size of the abrasive particles or agglomerates coated on the island surfaces. High speed lapping with a fixed-abrasive sheet takes advantage of the very high material removal rate of diamond abrasive that occurs when it moves at a high surface speed against the surface of a hard workpiece. A preferred form of fixed-abrasive used for lapping is very small abrasive particles having sizes from 0.1 to 3.0 micrometers that are encapsulated into porous ceramic beads that have a modest sized diameter of 45 micrometers. These beads are bonded to the top surface of a thin backing sheet having a precise thickness to form a abrasive sheet article. The small abrasive particles provide a smooth workpiece finish and the larger beads provide sufficient abrasive material for a long life of the abrasive article. Individual large abrasive particles can be coated directly on the surface of a disk backing and used effectively for grinding. However, the small abrasive particles that are required to produce precisely smooth workpiece surfaces are too small to be directly coated on backings. Instead, small abrasive particles are joined together in agglomerates or beads having a larger size and these larger sized beads are coated with space gaps between individual beads on a backing sheet to form an abrasive article. A method is described for forming equal-sized composite spherical glass or ceramic beads with the use of a open mesh screen material. The beads can be solid or hollow. The beads may be comprised of a ceramic material or the beads may be comprised of a agglomerate mixture of different materials including ceramic materials and abrasive particles. Abrasive particles of different sizes may be incorporated into individual beads. Different types of abrasives including diamond, cubic boron nitride, aluminum oxide and other abrasive particles, and also non-abrasive materials including metals and lubricants or combinations thereof can be mixed together within the individual beads. Hollow abrasive beads may be formed where the ceramic and abrasive mixture forms the shell of a hollow abrasive bead. Preferably, the beads are abrasive agglomerates comprised of very small abrasive particles enclosed by an erodible ceramic matrix material.

Use of monolayers (single layers) of abrasive particles or abrasive composite agglomerates maximizes the use of individual abrasive particles and allows flat grinding of composite dissimilar workpiece materials including semiconductor devices that have soft metal conductors embedded within hard ceramic materials. Abrasive monolayers coated on backing sheets or coated on the top surfaces of raised island structures prevent the second-tier level of individual abrasive particles that are bonded at a raised elevation to particles bonded directly to a backing surface from digging out soft material workpiece features from hard workpiece substrate materials. Soft metal material "pick-out" can occur when the elevated non-monolayer abrasive particles are forced down into the workpiece embedded metal electrical conductor material by the abrading contact forces becoming concentrated upon the individual elevated particles as the abrasive moves relative to the workpiece surface.

When an abrasive article used for polishing that has a mono or single layer of abrasive particle or agglomerate or bead coated media, there will be less pick-out of softer materials, or discrete hard foreign nodules, located in pockets on the surface of hard workpiece articles than there will be when abrasive articles having stacked particles on the coated abrasive media. Workpieces having these characteristics that are susceptible to pick-out include devices having soft metal conductor material imbedded in trenches in hard ceramics material and cast cylindrical automotive parts having carbon or other soft precipitated inclusions that are located on the hard part surface.

Spherical bead composite agglomerate abrasive particle shapes are a preferred agglomerate shape for creating a single layer or monolayer of composite agglomerates on a backing sheet. The spherical shape provides more consistency in shape and consistency in slurry coating or abrasive particle drop coating than do a circular shaped or irregular shaped agglomerates formed by crushing a hardened abrasive composite material. The geometry difference between an agglomerate sphere shape and an agglomerate block shape has a pronounced effect on the utilization of individual abrasive particles coated on an abrasive article. The primary bulk of individual abrasive particles contained in a spherical erodible abrasive composite agglomerate are located at the sphere center of the spherical agglomerate which is positioned a sphere radius distance above the surface of a backing sheet. When the agglomerate abrasive spheres are raised to an elevated position above the backing surface, the elevated position of the bulk of the sphere-contained individual abrasive particles assures that most of the particles contained in a spherical agglomerate are effectively used in abrading action as the abrasive article becomes worn down. An abrasive article is usually abandoned prior to wearing all of the agglomerates completely down to the agglomerate base that is adhesively bonded to a backing surface that gives an abrasive particle utilization advantage to spherical agglomerates over block shape agglomerates. Few of the original total quantity of unused individual abrasive particles are contained in the remaining truncated hemisphere small-volume areas of spherical agglomerates that are left attached to a worn-down abrasive article backing-sheet. Comparatively, a larger portion of unused individual abrasive particles reside in the remaining truncated block-shape non-spherical agglomerates worn-down to the same height level above the backing surface as for the worn-down spherical agglomerates. The number of abrasive particles contained in the highly reduced volume in the inverted apex of a diminished truncated sphere are very small compared to the particles contained in the linearly reduced volume agglomerate block shape bonded flat to a backing sheet. Some coated abrasive particles including individual abrasive particles, abrasive agglomerates and spherical abrasive beads are often stacked at different levels where some of the particles are positioned 50% of their diameters above the height of like-sized particles which are located in direct contact with the surface of the backing sheet. Other particles are often stacked in layers that are positioned two or more particle diameters above the backing surface. These "high-positioned" particles are few in number compared to those positioned directly on the backing surface but these high-risers have an exaggerated effect on polishing a workpiece. Although not wanting to be bound by theory, it is believed that the high positioned particles will tend to reach down into the soft portions of a hard substrate surface and gouge out or selectively abrade away the softer material as the abrasive travels in abrading contact with the substrate surface. In the case of the force tensioned abrasive tape system, the abrading contact pressure that acts normal or perpendicular to the substrate or cylindrical journal surface is quite low compared to the normal surface contact pressure present in the nip-roll abrasive system. Less pick-out of soft materials will occur with the abrasive tensioned tape system than with the nipped roll abrasive belt system. The nipped belt, having the relatively high contact pressures in the central land area, will aggressively loosen and dispel the hard foreign surface particles or erode and gouge out soft material areas whenever a raised surface abrasive particle comes in contact with the foreign material nodule or the soft material. All of the localized high nip roll contact pressure tends to become focused on the high level abrasive particles which drives these individual high particles down into the soft material whereas the bulk of the same sized adjacent particles are self-bridged across the soft area and are principally in contact with the hard substrate parent material surface. These high particles or agglomerates also can tend to apply large impact forces to imbedded foreign surface particles when the abrasive is moving at high speeds in contact with the workpiece surface and dislodge the imbedded particle, leaving a crater in the surface of the substrate or cylindrical metal surface. Dislodging foreign particles can occur in the process of high speed lapping; where surface speeds of 10,000 surface feet per minute or more can be reached.

Two common types of abrasive articles that have been utilized in polishing operations include bonded abrasives and coated abrasives. Bonded abrasives are formed by bonding abrasive particles together, typically by a molding process, to form a rigid abrasive article. Coated abrasives have a plurality of abrasive particles bonded to a backing by means of one or more binders. Coated abrasives utilized in polishing processes are typically in the form of circular disks, endless belts, tapes, or rolls that are provided in the form of a cassette. Individual abrasive particles can be attached to a backing by plating or by resin coating.

Presently there are a number of methods used to manufacture abrasive beads. These beads have been used for many years in fixed abrasive articles, particularly those abrasive sheets used for lapping. However, there is a undesirable large variation in size of the beads produced, and used in the abrasive articles, with all of the present manufacturing methods. Abrasive manufactures appear reluctant to discard undersized beads because of the economic loss associated with not using expensive abrasive materials such as diamond and cubic boron nitride (CBN). Also, there is a cosmetic factor in that an abrasive article appears to contain more abrasive if the small undersized beads are also coated onto the abrasive article even if they will never be used in the abrading process. Diamond and CBN are very hard abrasive materials that are used to abrade hard workpiece materials. Diamond is the hardest abrasive material and is commonly rated as being twice as hard as CBN. Because of its molecular makeup diamond has a molecular cubic shape, which is a shape that is a source of the superior qualities of diamond abrasive particles. Even with this hardness difference, CBN is often the preferred choice for abrading iron based workpiece materials at high abrading speeds as the carbon in the diamond abrasive particles tends to combine at high abrading temperatures with the iron to form iron carbide. This formation of diamond carbon to iron carbide requires a very conversion high temperature. These high, localized temperatures exist where a sharp point or sharp edge of a diamond abrasive particle is in high speed rubbing contact with the surface of a workpiece. The friction developed by this rubbing contact generates heat that is concentrated at a very small surface area of the sharp cutting edge of an abrasive particle. Because the abrasive particle abrading sharp edge contact area is so small, the frictional heat generated at the sharp edge does not have a way to dissipate away from the particle edge and the localized sharp particle edge area heats up. The heating continues until the particle edge reaches a temperature high enough to create the iron carbide from the combination of the carbon from the diamond and the iron from a steel workpiece. Visual evidence of the existence of these high abrading temperatures is the presence of white-hot sparks that are produced and thrown off during a high speed grinding operation. The color of a spark is an optical pyrometer test indicator of the temperature of a metal and is used in metal forging processes to indicate and control the temperature of metal parts. A white colored spark indicates a very high temperature and a red color indicates a lesser temperature. When the carbon at the sharp edge of a diamond particle is heated sufficiently to join it together with the iron during formation of the iron carbide, the sharp edge of the diamond particle becomes dull. As the diamond abrasive particles become dull and loose their sharp cutting edges they also loose their cutting ability and simple rub on the surface of the workpiece, which creates more heat and more particle edge damage. If an abrasive particle remains sharp during an abrading process much of the friction heat that is generated during the abrading action is contained in the workpiece chips that are ejected from the workpiece. Removing heat from the workpiece by ejecting hot workpiece abrading chips is an effective way to avoid overheating the surface of a workpiece. This tends to keeps the workpiece cool during the abrading action. Coolant fluids are also used to cool workpieces that are in abrading contact with abrasive media, especially when the abrading process is a high surface speed process. Heat that is generated by the friction of the abrading action is transferred to the coolant liquid and the coolant is then separated from the workpiece. The ejected coolant is replaced by fresh, and cool, coolant that is routed into the contact surface area between the workpiece and the abrasive. Coolant is used in various quantities in abrading processes. In some cases the workpiece is flooded with coolant. In other cases, the abrasion is done in a "dry" environment. However, the "dry" environment is not void of a liquid coolant but rather the workpiece is sprayed with a fine mist of the liquid coolant. Use of generous quantities of liquid coolants when abrading at high surface speeds often creates problems of hydroplaning. This can result in non-flat workpieces.

Among the earliest processes of making abrasive beads is a process developed by Howard in U.S. Pat. No. 3,916,584 where he poured a slurry mixture (of abrasive particles mixed in a Ludox LS 30® solution of colloidal silica suspended in water) into a dehydrating liquid including various alcohols or alcohol mixtures or heated oils including peanut oil, mineral oil or silicone oil and stirred it. Abrasive slurry droplets were formed into spheres by slurry-drop surface tension forces prior to the spheres becoming solidified by the water depleting action of the dehydrating liquid on the individual spheres. Beads vary in size considerably, with a batch of beads produced typically having a ten to one range in size. Adefris, et al., in U.S. Pat. No. 6,645,624 discloses the manufacturing of spherical abrasive agglomerates by use of a high-speed rotational spray dryer to dry a sol of abrasive particles, oxides and water. Bitzer, in U.S. Pat. No. 4,364,746 discloses the use of composite abrasive agglomerates grains which are produced by processes including a fluidized spray granulator or a spray dryer or by agglomeration of an aqueous suspension or dispersion. Hampden-Smith, in US Patent Application No. 2002/0003225 A1 and U.S. Pat. No. 6,602,439 produces abrasive beads by introducing slurry liquid onto the surface of an ultrasonic head operating at 1.6 MHz (1.6 million cycles per second) to produce 2 micrometer or smaller droplets.

U.S. Pat. No. 794,495 (Gorton) discloses thick-coated adhesive binder wetted circular spot raised island areas that are applied on a flexible backing disk and depositing abrasive particles on top of the raised-islands. These raised abrasive projections provide passageways for the grinding debris so that it does not rub or grind (scratch) the polished surface of the workpiece and allows the debris to have free passage off the outer periphery of the disk. Gorton's abrasive disks have recessed gap areas between the raised abrasive islands and also have a recessed gap area between all of the raised islands and the outer periphery of the disk that extends around the full periphery of the disk.

U.S. Pat. No. 1,657,784 (Bergstrom) describes flat surfaced raised island-type rectangular sheet abrasive articles having different geometric patterns of raised island shaped abrasive areas. He applies an adhesive binder in geometric patterns on a backing sheet to form raised islands of binder material where there is difference of height between the binder surface and the non-binder-coated areas that are adjacent to the raised binder islands. The flat surfaced binder raised islands are then coated with abrasive particles to form an abrasive article that has abrasive particle coated flat raised island structures with open passageways between adjacent raised islands. He describes how the heights between the top of the raised island portions and the open formed-channel passageway areas that are adjacent to the raised islands are not limited but can be varied as desired for a specific abrasive article.

FIG. 1 (Prior Art) is a top view of a rectangular sheet of abrasive as shown in U.S. Pat. No. 1,657,784 (Bergstrom) that has alternating strips of abrasive material. An abrasive sheet 2 having a backing 4 that has a pattern of abrasive strips 6 that have abrasive-free recessed areas 8 that are located between the abrasive strips 6. The abrasive sheet 2 has a periphery 7 where recessed areas 5 extends on the two long sides of the abrasive sheet 2 and the recessed areas 5 are located between the abrasive strips 6 and the periphery 7 on these long sides.

U.S. Pat. No. 1,896,946 (Gauss) describes raised island-type abrasive articles having a array of abrasive blocks attached to a thin flexible base that allows each island abrasive block to move independent of the other adjacent blocks.

U.S. Pat. No. 1,924,597 (Drake) describes flat surfaced island-type abrasive disk articles where the raised island structures have a recessed area that extends around the periphery of the disk between the raised island structures and the outer radial edge of the disk.

U.S. Pat. No. 1,941,962 (Tone) describes flat surfaced island-type abrasive rectangular articles having alternating bars of abrasive.

U.S. Pat. Nos. 2,001,911 and 2,115,897 (Wooddell et. al) describes raised island-type abrasive disks and other articles.

FIG. 12 (Prior Art) is a top view of an abrasive disk having raised abrasive islands and a recessed gap area between the islands and the disk edge that extends around the periphery of the disk as shown in U.S. Pat. No. 2,001,911 (Wooddell). The abrasive disk 82 has attached abrasive raised islands 85 and a recessed gap area 90 that extends around the disk 82 periphery 89.

U.S. Pat. No. 2,108,645 (Bryant) describes raised island-type rectangular abrasive articles.

U.S. Pat. No. 2,216,728 (Benner et al.) discloses a porous composite diamond particle agglomerate granule comprised of materials including ceramics and a borosilicate glass matrix that can be fired in an oxidizing atmosphere at 600 degrees C. and then fired at 900 degrees C. in a reducing atmosphere. Diamonds are subject to oxidization at temperatures above 700 degrees C. so a non-oxidizing atmosphere is used up to 1500 degrees C.

U.S. Pat. Nos. 2,242,877, 2,252,683 and 2,292,261 (Albertson) describe raised island types of abrasive disk articles. In U.S. Pat. No. 2,242,877 (Albertson) these disks have "projecting ribs" where the raised non-abrasive coated rib structures are first formed on the surface of a disk backing as an integral structural part of the backing. These raised ribs, having flat upper surfaces, can have a variety of shapes including rectangular shapes and can have a variety of island array patterns including radial patterns. There are recessed channel areas or grooves that surround each of the raised island ribs. The recessed channels or grooves allow grinding swarf or cuttings to be carried to the outside periphery of the disk by centrifugal action during an abrading process. The flat upper surfaces of the formed ribs and also the surfaces of the recessed grooves are coated with an adhesive resin after which loose abrasive particles are deposited by drop-coating or by other deposition techniques onto the resin. Die-molds are then used to press the abrasive particles down into the adhesive coating to form an abrasive-adhesive layer that covers both the raised island structures and the recessed areas. The same die-molds can also be used to geometrically shape the abrasive-adhesive coating to form abrasive particle coated raised-island types of protrusions. In one embodiment, the die-mold forms a uniform-thickness layer of the abrasive-adhesive material over both the top flat surfaces of the raised ribs and also over the recessed channel areas between the raised ribs.

The surfaces of the abrasive disks are substantially flat. Fibrous backing materials are typically used. Condensation type phenolic resins thinned with solvents are used as adhesive binders.

In other embodiments, the die-molds are used to form geometric protrusion shapes of an abrasive-adhesive layer in array patterns directly on the flat surface of a disk backing. Here, a thick coating of phenolic resin is applied to a flat-surfaced disk backing after which loose abrasive particles are deposited onto the resin. Then a die-mold is used to press the abrasive particles down into the adhesive coating to form an abrasive-adhesive layer that covers the flat disk backing surface. The die-molds can also be used to geometrically shape the abrasive-adhesive coating into a variety of abrasive protrusion shapes including island-type shapes.

After the layer of abrasive particles is formed into the desired raised island shapes, a size coat of resin adhesive can be applied over the exposed abrasive particles to cover them and to structurally anchor them to the raised island structures or to the backings. The finished disk may be subjected surface conditioning to wear off the resin caps that form over the abrasive particles during the disk manufacturing process to expose the particles for abrading action.

There is no teaching of the control of the height of each abrasive covered island relative to the backside of the disk backing as would be required for high speed flat lapping usage.

Albertson also teaches about the economic losses that occur when abrasive disk are die-cut from abrasive coated web sheets where the non-circular remnants of the remaining web are discarded.

He specifically teaches the additional application of resin coating to the peripheral edges of a disk backing prior to the deposition of abrasive particles on the resin to prevent the absorption of moisture into the edge of the backing.

In addition, he teaches that only the outer annular periphery portion of an abrasive disk is worn during an abrading operation. Here the outer peripheral edge of the disk is worn first because the outer periphery of the disk has the highest abrading speed and the rate of abrasive wear is proportional to the abrading speed. The wear of the abrasive disk progressively moves inward in a radial direction during an abrading process. His suggestion is to cut off the worn-out outer annular portion of a worn disk and to continue abrading with the "new" disk having a smaller diameter.

Albertson does not teach the use of a slurry mixture of abrasive particles and a resin adhesive to coat raised island structures for manufacturing abrasive disks.

Furthermore, he also teaches that raised island disks have faster cutting action than conventional disks because the abrasive contact area is reduced with islands and the abrading contact pressure is correspondingly increased. It is well known that abrading material removal rates increase proportionally to abrading contact pressure increases.

FIGS. 2, 3 and 3A (Prior Art) show different views of the U.S. Pat. Nos. 2,242,877, 2,252,683 and 2,292,261 (Albertson) raised island shapes and raised island disks.

FIG. 2 (Prior Art) is a cross section view of abrasive particle coated raised islands in U.S. Pat. No. 2,242,877 (Albertson) that are formed by pressing an die-mold tool into a composite fluid of a thick under-layer of adhesive that was applied to a backing disk sheet where the adhesive is over-coated with abrasive particles. A disk backing 10 has both raised island rib structures 12 and island recessed groove channels 13 that are coated with abrasive particles 14. The heights of the islands 12 as measured from the backside of the backing 10 by the island height distance 16 are not defined or controlled by Albertson.

FIG. 3 (Prior Art) is a top view of raised islands on an abrasive disk. The abrasive disk 18 has an aperture center hole 22 and abrasive coated full-sized and reduced-size raised island structures 20, 23 and 25 with recessed areas 35. The disk 18 backing 17 has partial-sized island structures 23 and 25 that are located on the periphery 33 of the disk 18. The reduced-sized islands 23, 25 can be structurally unstable during abrading usage, as the attachment base area of each of these small islands 23, 25 that are attached to the backing 17 can be small as compared to the base area of a full sized island 20. These islands 23, 25 that are located on the disk 18 periphery 33 are particularly sensitive structurally when subjected to abrading leveraging forces for tall-height islands. Undersized islands, having small base areas, that are located in a more interior portion of the disk 18 can also be structurally weak if the height of the small islands, measured from the top of the island to the top surface of the backing 17, is large relative to the base area or the base area dimensions. Albertson does not discuss the use of full sized islands 20 in all areas of the disk 18 including the peripheral edge area of the disk 18. There are recessed-areas 35 that extend around the disk 18 periphery 33 between the raised islands 20 and the disk 18 periphery 33 at the four periphery gap locations 37 locations shown in his U.S. Pat. No. 2,242,877 FIG. 17.

FIG. 4 (Prior Art) is a cross section view of a pattern of rectangular shaped raised rib structures that are formed on a disk surface where the raised rib structures are over-coated with an abrasive-adhesive mixture coating to provide an abrasive disk having raised island ridge structures and adjacent grooves as shown in (FIG. 23) of U.S. Pat. No. 2,242,877 (Albertson). A disk 31 having a backing 26 has attached raised island structures 24 that are coated with abrasive particles 29 and adhesive 28, where the height of the abrasive particles 29 that are adhesively attached to the top surface of the islands 24 is measured from the backside of the backing 26 to the top of the abrasive particles 29 by the distance 30. A recessed area 27 between the raised islands 24 is also shown as coated with abrasive particles 29 and adhesive 28.

FIG. 13 (Prior Art) shows a side view of an abrasive grinding disk that is mounted on a mandrel, or arbor, tool that is used to grind a workpiece with the grinding abrasive disk distorted as it contacts a workpiece surface. This type of abrasive disk article is suitable for rough grinding but lapping can not be accomplished when using it as the raised islands on a angled disk that first come in contact with a flat workpiece tend to scratch the workpiece rather than polish it. This type of manual tool disk article is disclosed in U.S. Pat. Nos. 2,242,877, 2,252,683 and 2,292,261 by (Albertson), U.S. Pat. No. 3,498,010 (Hagihara), U.S. Pat. No. 3,991,527 (Maran) and U.S. Pat. No. 6,371,842 (Romero). A mandrel rotary tool 108 has a disk aperture hole mounting hub 110 that attaches both the flexible tool pad 118 and the abrasive disk 120 to the rotary tool 108 spindle shaft 109. The flexible tool pad 118 that contacts both the abrasive disk 120 and the mandrel hub 110 has un-deformed flat surfaces, is circular in shape and typically has a rubber composition. The disk 120 has attached raised islands 112 that are surface coated with an abrasive coating 114 where a leading-location island 112 abrasive coating 114 contacts a workpiece 122 at a abrasive contact point 116.

U.S. Pat. No. 2,520,763 (Goepfert et al.) describes abrasive coated disks that have raised annular bands of continuous coated abrasive media. The central areas of the disks are abrasive-free.

U.S. Pat. No. 2,755,607 (Haywood) describes abrasive coated articles having a pattern of raised adhesive shapes that are formed on a backing and the raised shapes are then coated with abrasive particles on a continuous web basis to form rectangular shaped abrasive articles.

U.S. Pat. No. 2,838,890 (McIntyre) describes abrasive coated articles having a pattern of backing sheet through holes for the abrasive debris to escape the abrading area.

U.S. Pat. No. 2,907,146 (Dynar) describes raised island-type abrasive disk articles having raised island protrusions that are attached to flexible disk backings where there are recessed areas that extend between the protrusions and the outer periphery around the full periphery of the abrasive disk.

U.S. Pat. No. 3,048,482 (Hurst) describes raised island-type abrasive disk articles.

U.S. Pat. No. 3,121,298 (Mellon) describes raised island-type abrasive disk articles. Recessed channels are provided on a backing sheet, the sheet is adhesive coated and abrasive particles are deposited on top of the adhesive to create an abrasive disk that has raised island structures top surface coated with abrasive particles.

U.S. Pat. No. 3,423,489 (Arens et al.) discloses a number of methods including single, parallel and concentric nozzles to encapsulate water and aqueous based liquids, including a liquid fertilizer, in a wax shell by forcing a jet stream of fill-liquid fertilizer through a body of heated molten wax. The jet stream of fertilizer is ejected on a trajectory from the molten wax area at a significant velocity into still air. The fertilizer carries an envelope of wax and the composite stream of fertilizer and wax breaks up into a string of sequential composite beads of fertilizer surrounded by a concentric shell of wax. The wax hardens to a solidified state over a free trajectory path travel distance of about 8 feet in a cooling air environment thereby forming structural spherical shapes of wax encapsulated fertilizer capsules. Surface tension forces create the spherical capsule shapes of the composite liquid entities during the time of free flight prior to solidification of the wax. The string of composite capsule beads demonstrate the rheological flow disturbance characteristics of fluid being ejected as a stream from a flow tube resulting in a periodic formation of capsules at a formulation rate frequency measured as capsules per second. Capsules range in size from 10 to 4000 microns.

U.S. Pat. No. 3,495,362 (Hillenbrand) describes island-type abrasive disk articles having a thick backing, a disk-center aperture hole and raised abrasive plateaus.

U.S. Pat. No. 3,498,010 (Hagihara) describes island-type abrasive disk articles having a thick backing, a disk-center aperture hole and the backing having patterns of attached raised island structures formed on the backing surface. The islands are mold formed from a mixture of abrasive particles and a phenolic resin. The abrasive disks are used on manually operated portable grinding tools that are shown to distort the abrasive disk article out-of-plane when held with force against a workpiece surface. Comparative tests indicated that the disks had superior material removal rates and produced very smooth finishes as compared to tradition abrasive disks. The disks are very stiff after manufacture so they are subjected to a rotary device that cracks the disk in many places to provide flexibility of the thick disk.

FIG. 14 (Prior Art) shows a cross section view of a disk that is in abrading contact with a workpiece. The abrasive disk 100 is shown by Hagihara to be in abrading contact with a workpiece 106 where the disk abrasive islands 102 and 104 contact the workpiece 106 on the island edges rather than the islands laying in flat contact with the workpiece 106.

U.S. Pat. No. 3,517,466 (Bouvier) describes raised abrasive cylinders mounted on a disk plate.

U.S. Pat. No. 3,605,349 (Anthon) describes raised abrasive islands on an abrasive backing article.

U.S. Pat. No. 3,702,043 (Welbourn et al.) describes a machine used for removing material from the internal surface of a workpiece and the use of a strain gage sensor device that indicates the cutting force exerted by the cutting tool upon the workpiece.

U.S. Pat. No. 3,709,706 (Sowman) discloses solid and hollow ceramic microspheres having various colors that are produced by mixing an aqueous colloidal metal oxide solution. The solution mixture is concentrated by vacuum drying to increase the solution viscosity. Then, the aqueous mixture is introduced into a vessel of stirred dehydrating liquid, the liquid including alcohols and oils, to form solidified mixture green spheres that are fired at high temperatures. Spheres range from 1 to 100 microns but most are between 30 and 60 microns. Smaller sized spheres are produced with more vigorous dehydrating liquid agitation. Another sphere forming technique is to nozzle spray a dispersion of colloidal silica, including Ludox®, into a countercurrent of dry room temperature or heated air to form solidified green spherical particles.

U.S. Pat. No. 3,711,025 (Miller) discloses a centrifugal rotating atomizer spray dryer having hardened pins used to atomize and dry slurries of pulverulent solids.

U.S. Pat. No. 3,859,407 (Blanding et al.) discloses a system of producing shaped abrasive particles by supplying a stream of a plastically formable abrasive mixture into a nipped set of rolls, where one or more of the rolls has a surface pattern of geometric shapes that the formable material is squeezed into as the rolls rotate. A continuous ribbon of the individual shaped abrasive particles that are joined together at the formed particle shape edges exits the rolls. The ribbon is flexed after the particles are solidified to separate the ribbon into individual particles.

U.S. Pat. No. 3,916,584 (Howard et al.), herein incorporated by reference, discloses the encapsulation of 0.5 micron, or less, up to 25 micron diamond particle grains and other abrasive material particles in spherical erodible metal oxide composite agglomerates ranging in size from 5 to 200 microns and more. The Co-inventer of this patent, Sowman, describes the same type of colloidal silica ceramic spheres that do not contain abrasive particles in his earlier U.S. Pat. No. 3,709,706. The large agglomerates do not become embedded in an abrasive article carrier backing film substrate surface as do small abrasive grain particles. In all cases, the composite bead is at least twice the size of the abrasive particles. Abrasive composite beads normally contain about 6 to 65% by volume of abrasive grains, and compositions having more than 65% abrasive particles are considered to generally have insufficient matrix material to form a strong acceptable abrasive composite granule. Abrasive composite granules containing less than 6% abrasive grains lack enough abrasive grain particles for good abrasiveness. Abrasive composite bead granules containing about 15 to 50% by volume of abrasive grain particles are preferred since they provide a good combination of abrading efficiency with reasonable cost. In the invention, hard abrasive particle grains are distributed uniformly throughout a matrix of softer microporous metal oxide (e.g., silica, alumina, titania, zirconia, zirconia-silica, magnesia, alumina-silica, alumina and boria, or boria) or mixtures thereof including alumina-boria-silica or others. Silica and boria are considered as metal oxides. The spherical composite abrasive beads component materials are a slurry mixing of abrasive particles and an aqueous colloidal sol or solution of a metal oxide (or oxide precursor) and water. The beads are formed when the resultant slurry mixture is introduced as a liquid mixture stream into an agitated dehydrating liquid. The liquid abrasive slurry mixture is poured into a stirred dehydrating liquid where the moving dehydrating liquid breaks up the stream of abrasive slurry into lump segments. As an option, he also injects the abrasive slurry through a hollow hypodermic needle tube as a stream into the stirred dehydrating liquid, again where the abrasive slurry is broken into lump segments. During the time that the slurry lump segments are suspended in the moving dehydration liquid, surface tension forces that act on the slurry lumps forms the lumps into a spherical bead shapes. After the spherical abrasive beads are formed the dehydrating fluid removes water from the mixture and the spherical beads become solidified enough that they do not stick to each other.

Examples teach the use of a slurry mixture of abrasive particles mixed in a Ludox® solution of colloidal silica suspended in water. A Ludox® LS 30 solution having a 30% by weight component of nanometer sized silica spheres that are in colloidal suspension in water is mixed with the diamond abrasive particles. The diamond particles are first mixed with water before they are introduced into the Ludox® LS 30 solution. Dehydrating liquids include partially water-miscible alcohols or 2-ethyl-1-hexanol or other alcohols or mixtures thereof or heated mineral oil, heated silicone oil or heated peanut oil. Sowman, in U.S. Pat. No. 3,709,706, also describes various dehydrating fluids.

The abrasive slurry is formed into beadlike masses in the agitated drying (dehydrating) liquid. Water is removed from the dispersed slurry and surface tension draws the slurry into spheroidal composites to form green composite abrasive granules. Other shapes than spheroidal, such as ellipsoid or irregularly shaped rounded granules, can be produced that also provide satisfactory abrasive granules. The green granules will vary in size; a faster stirring of the drying liquid giving smaller granules and vice versa. The resulting gelled spherical abrasive composite granule is in a "green" or unfired gel form. A spherical shaped liquid slurry droplet becomes gelled when enough water has been removed that the nanometer sized silica particles attach to other silica particles to form interconnecting silica strings. Water remains in the void areas between the silica string web-like structures. At this stage, the gelled spherical abrasive mixture beads are not formed into elastic structures that have spring-deflection characteristics. Instead, the beads are formed into an elastic-plastic material that is thixotropic in character. These beads are dimensionally stable at rest but will easily deform and take new shapes when they are subjected to forces. Initially, when the adjacent spherical newly-gelled beads are placed in contact with each other, the beads will adhesively join together to form a new non-spherical shape. Later, when enough water is removed from the abrasive mixture beads by the dehydrating fluid, the individual spherical abrasive mixture beads will develop a non-tacky dry bead surface shell that allows these beads to be placed in contact with each other without the individual beads sticking to each other. Because these partially solidified beads are spherical in shape and do not agglomerate together, they can be easily collected and poured into heating process equipment. Here, they can be individual be subjected to the same drying and furnace firing environments where all of the individual beads develop the same physical structural characteristics when the silica nanometer particles are sintered together by a calcining firing furnace process. In the sintering process, the individual silica particles are fused together at the points where they contact each other. The Ludox® LS 30 solution provides the ceramic precursor material to the abrasive particle mixture; the dehydrating fluid allows the abrasive mixture lump segments to be suspended while the surface tension forces form the lumps into spheres; the dehydrating fluid also provides solidification of the spherical beads; the drying ovens remove residual water from the beads; the firing furnaces form the ceramic precursor material into a matrix of porous ceramic material that contains and supports the individual abrasive particles.

As described by Howard, dehydrated green composite generally comprises a metal oxide or metal oxide precursor, volatile solvent, e.g., water, alcohol, or other fugitives and about 40 to 80 weight percent equivalent solids, including both matrix and abrasive. After dehydration, the solidified composites are dry in the sense that they do not stick to one another and will retain their shape. The green granules are thereafter filtered out, dried and fired at high temperatures. The firing temperatures are sufficiently high, at 600 degrees C. or less, to remove the balance of water, organic material or other fugitives from the green composites, and to calcine the composite agglomerates to form a strong, continuous, porous oxide matrix (that is, the matrix material is sintered). The resulting abrasive composite or granule has an essentially carbon-free continuous microporous matrix that partially surrounds, or otherwise retains or supports the abrasive grains.

The firing temperatures are insufficiently high to cause vitrification or fusion of the whole mass of the bead web-like silica material into a single solid mass. Vitrification of the composite agglomerate or granule is avoided to retain the open porous characteristic of the ceramic matrix. If the beads were processed at a high firing temperature, where the bead were fused into a solid mass, the whole web structure of the silica strings would collapse and the bead would only be a small fraction of its original size. The abrasive particles would then form the major volumetric component of the collapsed bead and individual abrasive particles would dominate the external surface of the bead. The particles also would have little silica material for structural support. In addition, the high vitrification furnace temperatures would damage the contained diamond particles unless a retort furnace, having an inert atmosphere, were used in the process. Also, the external surface of the composite would change into a continuous glassy state, thereby preventing the composite from having a porous external surface.

If the abrasive beads do not have a porous external surface, the anchor sites that are provided when a binder adhesive penetrates the open pores of the porous bead would be lost. Penetration of a polymer binder into the external surface of an abrasive bead provides significant structural bonding of the bead structure to the surface of an abrasive sheet article or to the top flat surfaces of raised island structures. If the bead structure is strongly bonded to a surface, the bead structure is more able to withstand the dynamic impact forces that are imposed on the bead during abrading contact with a workpiece surface. The porous ceramic matrix that is developed by this ceramic bead manufacturing process successfully supports the individual diamond particles that are contained within a bead against the abrading forces. However, it is necessary that the whole bead structure be structurally attached to the abrasive article backing sheet. If the whole bead structure is successfully bonded to a backing, this enables the porous ceramic matrix to support, and release, individual abrasive particles from the bead structure. The abrasive bead polymer binder only contacts the lower portion of the bead structure as it is necessary to leave the upper portion of the bead exposed to a workpiece surface. It is required that the binder support a bead in the critical first stage of bead wear-down when all of the abrading contact forces are imposed at the top surface of a new abrasive bead. The imposed abrading forces at the top bead surface are located at a relatively long distance from the location of the binde, which is located at the bottom surface of the bead. The distance between the imposed forces and the binder acts as a leverage arm, which will tend to break the whole bead structure away from the backing sheet. If the binder system is strong enough to support the bead during the initial first stages of abrading contact, the binder will tend to be strong enough to also support the bead when the bead is substantially worn down, as the leverage arm is now also substantially reduced. Most of the structural support of the bead by the binder is at the lower portion of the bead. The result is that the abrasive particles contained in this lower bead portion are shielded from the abrading action by the binder surface contacting the workpiece when a bead is almost completely worn away. However, there is very little volume of abrasive particles contained in this lower region of the bead due to the geometrical shape of the bead structure. If this small fraction of abrasive particles that were originally contained in a bead structure can't be utilized because of the shielding provide by the layer of binder there is little economic loss. Most of the total volume of the abrasive particles that are located in a bead are located at an elevation that is above a line that is positioned at a lower bead level that is 25% of the bead diameter away from the lowest base attachment point of the bead. There are few abrasive beads that are located in this lowest region of the bead. The spherical abrasive bead shape described here provides a very optimal presentation of small sized abrasive particles to a workpiece surface, where almost all of the particles coated on an abrasive article can be utilized prior to the abrasive article being worn out.

The green-state beads that are fired at up to 600 degrees C. typically shrink the green-state beads by from 10 to 20 percent, or more, due to the furnace firing process step.

Having a porous surface on abrasive beads offers a number of advantages. First, the porous surface allows liquid adhesive binders to penetrate the porous bead surface somewhat, or allows the binder to better wet the bead surface. Here, the improvements related to the binder adhesion to the bead tend to provide increased bonding strength where the abrasive bead is attached to the surface of a backing sheet. Second, the porous beads allow the incorporation of lubricants or liquid grinding aids in the beads to enhance the abrading performance of the abrasive beads. The porosity of the beads can be seen visually when closely examining the beads. When a composite bead granule was submerged in oil having a refractive index of about 1.5 under a microscope at 70-140× the oils penetration into the porous matrix was observed by visual disappearance of the silica matrix and only diamond particle grains throughout the composite bead granule were readily visible. The dispersion of the diamond particle grains throughout the bead granule was disclosed. This oil-absorbing feature of the spherical bead matrix material also permits the incorporation of liquids including lubricants, liquid grinding aids, etc., to enhance performance of the composite in actual abrading operations.

The sintering temperature of the whole spherical composite bead body is limited as certain abrasive granules including diamonds and cubic boron nitride are temperature unstable and their crystalline structure tends to convert to non-abrasive hexagonal form at temperature above 1200 degree C. to 1600 degrees C., destroying their utility. An air, oxygen or other oxidizing atmosphere may be used at temperatures up to 600 degrees C. but an inert gas atmosphere may be used for firing at temperatures higher than 600 degrees C.

The Ludox® colloidal silica solution provides the metal oxide that forms a porous oxide structure that surrounds the individual abrasive particles within the abrasive agglomerate bead. These abrasive composite agglomerate beads incorporate abrasive particles 25 microns and less sized particles, as abrasive particle grains 25 microns and larger can be coated on abrasive articles to form useful materials. Example 1 described a mixture of 0.5 gram of 15-micron diamond powder, 3.3 grams of 30 percent colloidal silica dispersion in water (Ludox LS) and 3 grams of distilled water that was stirred and sonically agitated to maintain a suspension. The formed agglomerates were fired, a backing sheet was coated with a make coat of phenolic resin, and the abrasive spherical agglomerates were drop coated onto the wet resin and the excess of the spherical agglomerates were allowed to fall off. Applying the abrasive spheres to the abrasive backing sheet by this technique results in an abrasive article that has essentially a 100% coating of abrasive spheres with little or no space between individual adjacent abrasive spheres. After heating the abrasive coated backing sheet to pre-cure the phenolic make coat, a size coat of the same resin was applied to the coated spherical agglomerates and the abrasive sheet article was further heated to fully cure the resin. Then this abrasive sheet article was formed into a disk and used for shape-forming and polishing workpieces with the result that this 100% abrasive spherical bead coated article showed a 30-40% higher rate of cut and provided a better surface finish than a conventional 15 micron (micrometer) diamond coated abrasive disk sheet article. It is significant that this comparative test shows that when small abrasive particles are formed into erodible ceramic agglomerate spheres that are coated on a backing sheet, it is not necessary to have a minimum separation between each of the adjacent abrasive spheres to obtain workpiece high cut rates and smooth surfaces.

A balance of the hardness of the ceramic matrix material and the erodibility of the ceramic matrix material described here provides a bead matrix material that can support the individual diamond abrasive particles against the dynamic abrading forces and yet be successfully eroded away when the diamond abrasive particle sharp edges become dulled. Epoxy and other polymer materials can be used to support diamond abrasive particles in abrasive beads, in place of the porous ceramic matrix material, but these polymer bead materials were found not to be as strong as desired by Howard in U.S. Pat. No. 3,916,584.

The erosion of the ceramic matrix material exposes the sharp cutting edges of individual abrasive particle and these fresh sharp cutting edges readily cut material from the surface of a workpiece. The cutting edges of adjacent individual abrasive particles that are located within the confines of an individual abrasive bead are continuously refreshed where the ceramic matrix is worn or eroded away from the area between the adjacent particles. Use of the porous ceramic matrix also provides another advantage with respect to the location of adjacent particles within the bead. Here, the individual abrasive particles are located at different elevations within the spherical bead structure. This difference in abrasive particle elevations tends to provide sharp abrasive cutting edges at an abrasive article surface as compared to an abrasive article that is coated with a continuous surface of closely spaced individual abrasive particles.

Example 8 resulted in composite granules that ranged in diameter from 10 to 100 microns, (a size ratio of 10:1) with an average of about 50 microns and the diamond particle content was approximately 33% of the abrasive composite agglomerates. In example 6, a slurry of the average sized 50 micron abrasive agglomerates was mixed in a phenolic resin and was knife coated with a 3 mil (0.003 inch or 72 micron) knife gap setting which exceeded the size of the agglomerates. In Example 9, beads were screened to be less than 30 microns (0.0012 inches) in size before mixing them in a binder which was coated on a 0.003 inch (75 micron) thick polyester backing sheet using a coating knife opening of 0.002 inches (50 microns) which allowed the beads to pass through the knife opening gap. As the individual abrasive particles were smaller than the depth of the coated resin binder slurry (where the coating depth is approximately equal to the knife opening gap setting), there is indication that enough resin binder solvent was evaporated after coating to expose a substantial portion of the individual coated abrasive agglomerates when the abrasive product was dried.

In Example 1, a backing sheet was coated with a wet make-coat binder and abrasive beads was dropped on the make coat and the excess of beads was allowed to fall off the backing. This type of abrasive coating will produce a uniform layer of abrasive beads across the full surface of the make-coat wetted surface of the backing with little or no spacing between adjacent individual abrasive agglomerate beads. This is an unusual type of coating as spaces are generally provided between adjacent particle. Typically, an abrasive sheet article is not coated with a uniform continuous coating of individual abrasive non-bead solid-particles as the densely packed abrasive will not abrasively remove workpiece material in an aggressive fashion. Instead, the continuous solid-abrasive-particle covered surface can tend to act as a bearing surface that supports, rather than abrades, a workpiece. However, comparative tests by Howard of the densely-packed porous ceramic abrasive bead covered surface showed a 30-40 percent higher rate of cut and provided a better surface finish than a comparative conventional abrasive article.

In other workpiece abrading applications (not described in this Howard patent) where non-bead solid individual diamond abrasive particles are coated on a abrasive article backing sheet with little or no space between the adjacent individual abrasive particles, the article cut rate can be reduced significantly compared to an abrasive article having gap spaces between adjacent abrasive particles. When abrasive particle coating consists of a uniform coating of individual solid abrasive particles (not porous agglomerate abrasive beads that contain small abrasive particles) that are coated with little or no gap spacing between adjacent particles, this close-spaced particle coating can act as a bearing surface for a workpiece rather than a cutting surface. Even though abrasive beads and abrasive particles are coated close enough to each other as to be in contact in each instance, there still is a major difference between the two coated abrasive articles. On the one article, where the porous ceramic abrasive beads are coated adjacently in close proximity, there are still gap spaces that exist between the individual abrasive particles that are located within the confines of the individual abrasive beads. The porous ceramic matrix material that supports the individual abrasive particles contained within an abrasive bead also provides separation distance between the adjacent abrasive particles. On the other article, there is no abrasive article surface-gap separation between the solid abrasive particles that are coated directly on the article surface. Because there is no surface-gap between the individual abrasive particles, the total surface area of this article that is presented in flat contact with a workpiece surface acts as a bearing surface and not a cutting surface.

Porous ceramic matrix material is considerably softer than the hard diamond abrasive particles. This soft porous matrix material erodes when the beads are in moving abrading contact with a workpiece surface. Yet, the remainder of the ceramic matrix material, that is located at a depth below the surface of the ceramic matrix material that was eroded away, still structurally supports the individual abrasive particles.

In Example 10, he produced abrasive beads that contained aluminum oxide abrasive particles that were mixed with a 34% colloidal suspension of silica particles in water. This abrasive particle slurry mixture was poured into an agitated dehydrating solution. The agitation action broke the abrasive slurry mixture up into segments that were formed into solidified spherical beads. The aluminum oxide abrasive beads were fired at 700 degrees C. and the aluminum oxide abrasive particles were visible within the finished beads. These beads that were produced by pouring the abrasive mixture into the agitated dehydrating fluid had a range of size from 20 to 140 micrometer (a 7:1 Size Ratio) with an average size of about 50 micrometers.

U.S. Pat. No. 3,921,342 (Day) discloses a lapping plate that has raised island sections where an abrasive liquid can flow in the recessed channel areas.

U.S. Pat. No. 3,933,679 (Weitzel et al.) discloses the formation of uniform sized ceramic microspheres having 1540 microns and smaller ideal droplet diameters. Mechanical vibrations are induced in an aqueous oxide sol-gel fluid stream to enhance fluid stream flow instabilities that occur in a coaxial capillary tube jet stream to form a stream of spherical droplets. Droplets are about twice the size of the capillary orifice tube diameter and the vibration wavelength is about three times the diameter of the tube. The spherical oxide droplets are solidified in a dehydrating gas or in a dehydrating liquid after which the solidified droplets are sintered. The spherical metal oxide particles have a very narrow size distribution. Reference is made to alternative droplet generators such as spray nozzles, spinning discs and bowls that provide feed stock dispersion at high throughput capacity but these devices produce an undesirably wide droplet size distribution. Generally this vibration enhanced spherical droplet system is effective for making larger sized spheres with the use of capillary tubes having diameters of approximately 630 microns (0.024 inches). The production of 45-micron spheres would require a capillary tube diameter of only 23 microns (0.0009 inches) that is too small for practical use in the production of significant quantities of oxide spheres. Example 2 indicated extreme accuracy in control of the sphere sizes in that 99% of the large sized 599 micron (0.024 inch) microspheres produced had sphere diameters within the relatively narrow range of 0.43 microns (0.000017 inch).

U.S. Pat. No. 3,991,527 (Maran) describes abrasive disk articles having raised island structures that are top coated with a resin adhesive upon which loose abrasive particles are deposited. These disks have disk-center aperture holes that allow the disks to be used on manual mandrel abrading tools. Geometric patterns of island structures are formed on the surface of a fibrous disk backing sheet where the island structures have individual flat top surfaces and recessed valley areas around each raised island structure. The island surfaces are coated with a phenolic or other polymer resin but the recessed valley areas are left adhesive-free. Abrasive particles are then applied (only) to the resin adhesive coated island surfaces to form a abrasive disk that has the top flat surfaces of each individual island coated with abrasive particles while the recessed valley areas that exist between the raised island structures remains free of abrasive particles. Maran describes an electrostatic abrasive particle deposition apparatus. FIGS. 4, 5, 6 and 7 show features of the Maran U.S. Pat. No. 3,991,527 raised island abrasive disks that have recessed gaps between the raised islands and also have recessed gaps extending around portions of the disk periphery. No teaching is made of the use of islands and recessed areas between the islands to break up the water coolant interface boundary layer that forms between a workpiece flat surface and an abrasive article abrasive surface during abrading as occurs with the present invention during high speed lapping.

Maran teaches the use of embossed disks that have flat surfaced raised islands. He describes a "typical and suitable" apparatus for making embossed disk backings that have raised island structures. He also describes an embossing roll that is used in the embossing apparatus. It is well known to those skilled in the art that the process of embossing of flat sheet materials takes many forms where a large number of different apparatus devices can be employed to provide embossed surfaces having flat-surfaced raised island structures. Also, a variety of disk backing materials can be used, including fibrous materials. After the raised islands are coated with an adhesive and abrasive particles are deposited on the adhesive, recessed areas that are located between the raised islands provide passageways for the debris that is generated in the abrading process to be channeled away from the abrading surfaces and to exit the disk periphery during the abrading process.

FIG. 5 (Prior Art) is a top view of the Maran U.S. Pat. No. 3,991,527 abrasive disks having geometric patterns of raised island structures. The disk 67 has raised islands 69, 72 and 73 and recessed channel areas 71 between the islands 69, 72 and 73. The islands 72 are full-sized islands and the islands 69 and 73 are diminished-sized islands that are located on the periphery 74 of the disk 67. Maran does not discuss the use of full sized islands 72 in all areas of the disk 67 including the peripheral edge area of the disk 67. The disk 67 has a disk-center aperture hole 75 that is used to mount the disk 67 to a manual tool mandrel (not shown). The recessed channel areas 71 that exist between the islands 69, 72 and 73 are coplanar with the island top surfaces and are used for scavenging grinding debris from the abrading contact area with a workpiece as the debris is thrown out of the recessed channels at the periphery 74 of the abrasive disk 67. There are recessed areas 76 that exist on the periphery 74 of the disk 67 which form recessed gap areas 78 between the raised islands 72 and the disk 67 periphery 74 at portions of the disk 67 periphery 74.

FIG. 6 (Prior Art) is a cross section view of the Maran U.S. Pat. No. 3,991,527 abrasive coated raised island structures. The abrasive disk 55 has island adhesive areas 57 that bond abrasive particles 59 to the disk 55 backing 61. Each of the raised islands 61 have uncoated island 61 recessed channel areas 65 that are located between the raised islands 61.

FIG. 7 (Prior Art) is a top view of the Maran U.S. Pat. No. 3,991,527 abrasive disks having geometric patterns of raised island structures. The disk 54 has raised islands 50, 53 and 58 and recessed channel areas 52 between the islands 50, 53 and 58. The islands 50 are full-sized islands and the islands 53 and 58 are diminished-sized islands that are located on the periphery 45 of the disk 54. Maran does not discuss the use of full sized islands 50 in all areas of the disk 54 including the peripheral edge area of the disk 54. The disk 54 has a disk-center aperture hole 56 that is used to mount the disk 54 to a manual tool mandrel (not shown). The recessed channel areas 52 that exist between the islands are coplanar with the island top surfaces and are used for scavenging grinding debris from the abrading contact area with a workpiece as the debris is thrown out of the recessed channels at the periphery 45 of the abrasive disk. There are recessed areas 47 that exist on the periphery 45 of the disk 54 which form recessed gap areas 49 between the raised islands 50 and the disk 54 periphery 45 at portions of the disk 54 periphery 45.

FIG. 8 (Prior Art) is a cross section view of one embodiment of embossed raised islands as shown in the U.S. Pat. No. 3,991,527 (Maran) patent where the raised island structures are abrasive coated. The abrasive disk 48 has raised island structures 44 that are coated with a layer of adhesive 42 that bonds deposited abrasive particles 36 to the abrasive top-surface 38 of the raised island structures 44. Each of the raised island structures 44 have uncoated island recessed channel areas 40 that are located between the raised islands 44. Only the top-surface 38 of the raised island structures 44 are resin adhesive 42 coated and the recessed areas 40 are not adhesive 42 coated. The individual raised island structures 44 have flat surface areas 43. It is not taught that the raised island structures 44 can be coated with an abrasive slurry admixture made up of abrasive particles 36 that are premixed with a resin adhesive 42 before this admixture is applied to the island structure 44. There is no described control of the height 46 of the individual abrasive 36 coated islands 44 as measured from the island-top surfaces 38 abrasive particles 36 to the backside of the disk 48 backing. The disk 48 also has recessed areas 39 that extend upward from the bottom surface 41 of the disk 48. The disk 48 bottom surface 41 is substantially planar which allows the disk 48 to be mounted flat on a platen (not shown) to provide a substantially planar surface of the abrasive top-surface 38. The substantially planar bottom surface 41 of the Maran disk 44 having the bottom surface 41 recessed areas 39 allows the disk 44 to be mounted to a platen by the use of disk-center aperture mechanical fasteners; by the use of hook-and-loop fasteners; and by the use of disk-mounting adhesives. However, the bottom surface 41 recessed areas 39 do not allow the disk 44 to be mounted to a flat platen with the use of a vacuum mounting system because the required vacuum hold-down seal that exists at the disk outer periphery can not be maintained because of vacuum leakages that would occur in the recessed areas 39. Vacuum hold-down of raised island disks is used in the present invention.

U.S. Pat. No. 4,038,046 (Supkis) describes abrasive articles made with a blend of urea formaldehyde and alkaline catalyzed resole phenolic binder resins which are cured with the same curing time and temperatures as conventionally used for phenolic resins. Abrasive particles applied by gravity and also by electro-coating methods. A typical oven cure cycle of the web is 25 minutes at 125 degrees F., 25 minutes at 135 degrees F., 18 minutes at 180 degrees F, 25 minutes at 190 degrees F., 15 minutes at 225 degrees F. and 8 hours at 230 degrees F. Yellow and blue dyes are mixed in the binder system.

U.S. Pat. No. 4,106,915 (Kagawa, et al.) describes raised island mandrel-type abrasive disk articles having raised island protrusions that are attached to a circular disk member where there are recessed areas that extend between the protrusions and the outer periphery around the full periphery of the abrasive disk.

U.S. Pat. No. 4,111,666 (Kalbow) describes island-type abrasive articles having a foam backing that has island protuberances that are impregnated with polymer stiffening agent and the top island surfaces coated with a mixture of abrasive particles and a polymer adhesive.

U.S. Pat. No. 4,112,631 (Howard), herein incorporate by reference, discloses the encapsulation of 0.5 micron up to 25 micron diamond particle grains and other abrasive material particles in spherical composite agglomerates ranging in size from 10 to 200 microns. A liquid mixture of abrasive particles and a grinding aid is added into a stirred liquid mixture of a urea-formaldehyde which creates spheres of the abrasive-grinding aid which are encapsulated by a shell layer of the urea-formaldehyde material. The diameters of the spherical abrasive capsules ranged by a ratio of thirty to one as the individual abrasive agglomerate capsules ranged in size from 5 to 150 microns in Example 1. The polymer shells that surround the abrasive particles, which are dispersed in the grinding aid material, provide abrasive agglomerates that can be coated on an abrasive article. Encapsulated 75 micron composite spheres were knife-coated using a knife opening of 3 mils (76 micron) on a polyester film backing with a urethane phenoxy resin make coating that was thinned with methyl ethyl keytone.

U.S. Pat. No. 4,142,334 (Kirsch et al.) describes bar type raised island abrasive articles having a textile backing where the raised bars have embedded abrasive particles.

U.S. Pat. No. 4,251,408 (Hesse) describes phenolic resins used in preparation of abrasives where rapid curing as a result of increasing the curing temperature tends to form blisters which impairs the adherence of the resin to the substrate backing. Special cure cycles are used which have low initial curing temperatures with regulated, progressively increasing temperature which prevent blister formation but the time required for cross-linking is thereby increased. Drying and curing of webs by use of loop dryers or festoon dryers are discussed which provide both the function of driving off the solvents from the binder and to cross-link cure the binder. The cure rate of a resin is defined by the B-time which is the time required to change from a liquid state to reach the rubbery elastomer state (B-state).

U.S. Pat. No. 4,256,467 (Gorsuch), U.S. Pat. No. 4,863,573 (Moore and Gorsuch) and U.S. Pat. No. 5,318,604 (Gorsuch et al.) describe raised island abrasive articles that have abrasive particle coated raised metal island areas that are progressively built up by electroplating island areas through the thickness of a mesh polymer cloth. Metal raised island structures are first formed and then individual diamond abrasive particles are deposited on the surface of these raised islands. Then the particles are attached to the metal island surfaces by further electroplating. The plated-island mesh cloth is stripped from a conductive metal surface and then laminated to a backing sheet to form an abrasive article. These plated metal raised islands are rough in shape, have uneven island-top surfaces and the attached abrasive particles are not precisely located in a common plane. Abrasive disks using this technology provide an aggressive grinding media when used at high abrading speeds that is very effective in high workpiece material removal. However, these disks are not useful for the precision polishing action that is required for flat lapping. The individual abrasive particles are too large to provide smooth surfaces. Also, the thickness of the abrasive disks has too much variation over the surface area of a disk to effectively utilize all of the expensive diamond abrasive particles during high speed flat lapping. It is not feasible to use extremely small abrasive particles on these disks when the variations of the island heights are greater than the size of the individual particles. Variations in the thickness of the mesh cloth and the variations in the laminating process also preclude the effective use of the very small abrasive particles required for flat lapping.

U.S. Pat. No. 4,256,467 (Gorsuch) describes an abrasive article with diamond particles plated onto an electrically insulated mesh cloth which can be cut into a "daisy wheel" articles for use in grinding curved, convex, or concave optical lenses. There is a recessed gap that extends around the periphery of the daisy between the raised islands and the periphery edge of the daisy.

FIG. 9 (Prior Art) is a cross section view of abrasive particle coated plated metal islands as shown in U.S. Pat. No. 4,256,467 (Gorsuch). Island structures 68 are formed by metal plating geometric patterns on a cloth material 60 and abrasive particles 64 are fixtured to the surface of the metal islands 68 by a build-up of plated metal around each individual abrasive particle 64. Abrasive particles 62 also exist in the valleys or recessed areas between the island structures 68. There is no reference to controlling the variation in height 66 between islands or in controlling the height 70 of each individual islands as measured between the top surface of the islands 68 and the backside of the backing 60.

FIG. 11 (Prior Art) is a top view of a "daisy" abrasive article as shown in U.S. Pat. No. 4,256,467 (Gorsuch) that has abrasive particle coated metal plated raised islands that are attached to a cloth backing having petals where there is a recessed gap area that extends around the full periphery between the islands and the periphery edge of the article. The abrasive daisy article 88 has petals 87 that have attached abrasive coated raised islands 86 where there is a recessed gap area 80 between the raised islands 86 and the article 88 periphery 84 edge and the gap area 80 extends around the periphery 84.

U.S. Pat. No. 5,318,604 (Gorsuch et al.) describes abrasive disks made with raised island abrasive structures that are attached to a disk backing. Diamond abrasive particles are plated on the surface of metal hemispheres to form abrasive elements which are mixed in a organic binder to form the raised island structures.

FIG. 10 (Prior Art) is a top view of an abrasive disk article having molded abrasive raised islands as shown in U.S. Pat. No. 5,318,604 (Gorsuch et al.). The abrasive disk 92 has a backing 93 that has attached abrasive mixture molded islands 96 that have recessed channel valley areas 95 that are located between the islands 96. There is a gap between the edges of all the islands 96 and the outer periphery of the disk 92 as shown by the recessed area gap width 94 that extends around the periphery of the disk 92.

Flex-Diamond® electroplated types of raised island diamond abrasive article sheets available from the 3M Company, St Paul, Minn. have been used to flat-grind workpiece surfaces at high rotational surface speeds using 12 inch (30.5 cm) diameter abrasive disks. As described in the Gorsuch patents, the disks have diamond abrasive particle coated raised metal islands that are attached to a mesh polymer cloth. These disks successfully produced workpiece surfaces that had a very precise flatness. Also, there was no indication of the occurrence of hydroplaning of the workpiece using the electroplated raised island product at rotational speed of up to 3,000 RPM in the presence of coolant water. However, these precisely flat workpiece surfaces were not simultaneously polished smooth by the rotating disk abrading action.

U.S. Pat. No. 4,315,720 (Ueda et al.) describes the use of a rotary wheel to produce spherical droplets of metal or slag where a melt material is feed into the wheel center and splits into small diameter linear streams. The spherical droplets that are formed from the streams become solidified and have a diameter larger than the stream diameter.

U.S. Pat. No. 4,272,926 (Tamulevich) describes the use of a abrasive coated sheet to polish the face end of a fiber optic connector where the fiber optic is positioned precisely perpendicular to the abrasive sheet mounted on a flat platen and the connector is moved relative to the sheet to produce a precisely flat and smooth facet. This same type of abrading process may be used to polish other components used with fiber optic systems.

U.S. Pat. No. 4,314,827 (Leitheiser et al.) discloses processes and materials used to manufacture sintered aluminum oxide-based abrasive material having shapes including spherical shapes that are processed in an angled rotating kiln at temperatures up to 1350 degrees C. with a final high temperature zone residence time of about 1 minute.

U.S. Pat. No. 4,341,439 (Hodge) describes the use of abrasive to polish the face end of a fiber optic connector to produce a precisely flat and smooth face on the fibers.

U.S. Pat. No. 4,364,746 (Bitzer et al.) discloses the use of composite abrasive agglomerates. Agglomerates include spherical abrasive elements. Composite agglomerates are formed by a variety of methods. Individual abrasive grains are coated with various materials including a silica ceramic that is applied by melting or sintering. Agglomerated abrasive grains are produced by processes including a fluidized spray granulator or a spray dryer or by agglomeration of an aqueous suspension or dispersion. Composite agglomerates contain between 10 and 1000 abrasive fine P 180 grade abrasive particles and agglomerates contain between 2 and 20 abrasive particles for P 36 grade abrasive.

U.S. Pat. No. 4,373,672 (Morishita et al.) discloses a high speed air-bearing electrostatic automobile body sprayer article that produces 15 micron to 20 micron paint-drop particles by introducing a stream of a paint liquid into a segmented bore opening rotating head operating at 80,000 rpm. Comparatively, a slower like-sized ball-bearing sprayer head rotating at 20,000 rpm produces 55 micron to 65-micron diameter drops. A graph showing the relationship between the size of paint drop particles and the rotating speed of the spray head is presented. The 20 micron paint drops ejected from the sprayer head travel for some time over a distance before contacting an automotive body, during which time surface tension forces will act on the individual drops to form the drops into spherical shapes.

U.S. Pat. No. 4,421,562 (Sands) discloses microspheres formed by spraying an aqueous sodium silicate and polysalt solution with an atomizer wheel.

U.S. Pat. No. 4,426,484 (Saeki) describes phenolic resins that have their cure time accelerated by using special additives.

U.S. Pat. No. 4,541,566 (Kijima et al.) discloses use of tapered wall pins in a centrifugal rotating head spray dryer that produces uniform 50 to 100 micron sized atomized particles using 1.0 to 4.0 specific gravity, 5 to 18,000 c.p. viscosity feed liquid when operating at 13 to 320 m/sec rotating head peripheral velocity.

U.S. Pat. No. 4,541,842 (Rostoker) discloses spherical agglomerates of encapsulated abrasive particles including 3 micron silicone carbide particles or cubic boron nitride (CBN) abrasive particles encapsulated in a porous ceramic foam bubble network having a thin-walled glass envelope. The composites are formed into spherical shapes by blending and mixing an aqueous mixture of ingredients including metal oxides, water, appropriate abrasive grits and conventional known compositions which produce spherical pellet shapes that are fired. Composite agglomerates of 250-micron size are dried and then fired at temperatures of up to 900 degrees C. or higher using a rotary kiln. Heating of the agglomerates to a temperature sufficiently high to form a glassy exterior shell surface on the agglomerates is done in a reducing atmosphere over a time period short enough to prevent thermal degradation of the abrasive particles contained within the spherical agglomerate. A rotary kiln tends to produces 250 micron particles and a vertical-shaft furnace is used to produce agglomerates as small as 20 microns. There is no specific control of the sizes of the agglomerate abrasive beads so they are sorted into the desired size ranges with the use of a screening device.

U.S. Pat. No. 4,586,292 (Carroll et al.) describes an apparatus that provides a complex rotary motion used to lap polish the inside diameter of a spherical surface workpiece.

U.S. Pat. No. 4,652,275 (Bloecher) describes the use of erodible agglomerates of abrasive particles used for coated abrasive articles. The matrix material, joined together with the abrasive particles, erodes away during grinding which allows sloughing off of spent abrasive particles and the exposure of new abrasive grains. The matrix material is generally a wood product such as wood flour selected from pulp. A binder can include a variety of materials including phenolics.

It is important that the binder not soften due to heat generated by grinding action. Instead, it should be brittle so as to breakaway. If too much binder is used, the agglomerate will not erode and if too little is used, the mixture of the matrix and the abrasive particles are hard to mix. The preferred agglomerate is made by coating a layer of the mixture, curing it, breaking it into pieces and separating the agglomerate particles by size for coating use. Agglomerates of a uniform size can be made in a pelletizer by spraying or dropping resin into a mill containing the abrasive mineral/matrix mixture. Agglomerates are typically irregular in shape, but they can be formed into spheres, spheroids, ellipsoids, pellets, rods and other conventional shapes. Other methods of making agglomerates include the creation of hollow shells of abrasive particles where the shell breaks down with grinding use to continually expose new abrasive particles. Other solid agglomerates of abrasive particles are mixed with an inorganic, brittle cryolite matrix. A description is made of conventional coated abrasive articles which typically consist of a single layer of abrasive grain adhered to a backing. Only up to 15 percent of the grains in the layer are actually utilized in removing any of the workpiece material. It follows then that about 85 percent of the grains in the layer are wasted. The agglomerates described here preferably range from 150 micrometers to 3000 micrometers and have between 10 and 1000 individual abrasive grain particles for P180 grains and only 2 to 20 grains of larger P36 grains. These agglomerates far exceed the size required for high speed lapping. In fact, only single layers of diamond particles is required or typically used as a coating for most lapping abrasive articles, so these huge agglomerates have little or no use in lapping. Further, there would not be an effective method of maintaining a flat abrasive surface as the abrasive agglomerates are worn down by abrasive lapping or grinding action.

U.S. Pat. No. 4,710,406 (Fugier) describes a production method for the manufacture of a condensation reaction phenolic resin with different alkali catalysts and which can be diluted up to 1,000 percent.

U.S. Pat. No. 4,773,920 (Chasman et al.) herein incorporated by reference, describes an abrasive sheet article used for abrasive lapping where the backing sheet is less than 0.010 inches (254 micrometers) thick and is preferred to be 0.002 to 0.003 inches (51 to 76 micrometers) thick. Chemical treatments of the backing and mechanical roughing of the backing sheet is described that is used to promote the adhesion between the backing and the abrasive particle binder.

U.S. Pat. No. 4,776,862 (Wiand) discloses diamond and cubic boron nitride abrasive particle surface metallization with various metals and also the formation of carbides on the surface of diamond particles to enhance the bonding adhesion of the particles when they are brazed to the surface of a substrate.

U.S. Pat. No. 4,799,939 (Bloecher) describes use of 70 micrometer diameter hollow glass spheres which are mixed with abrasive particles and a binder to form erodible 150 to 3000 micrometer agglomerates which are used for coating in abrasive articles. The hollow glass spheres are strong enough for the mixing operation and for the process used to form the agglomerate particle. However, they are weak enough that they break when used in grinding. Again, as for U.S. Pat. No. 4,652,275, these agglomerates are much too large and inappropriate for use in high speed lapping.

U.S. Pat. No. 4,903,440 (Larson et al.), herein incorporated by reference, describes the use of different reduced-cost drum cured binder abrasive particle adhesives which allow elimination of the use of web festoon ovens which are used because of the long cure times required by conventional phenolic adhesives used for abrasive webs. Typically a pre-coat, a make coat, having loose abrasive particles imbedded into the make coat and then a size coat are applied to a continuous web backing. No reference is given to processing individual abrasive articles such as abrasive disks. Rather, a continuous backing web is coated with binders and abrasive particles, the binders are cured and then the web is converted into abrasive products such as disks or belts. Resole phenolic resins which are somewhat sensitive to water lubricants are catalyzed by alkaline catalysts and novolac phenolic resins having a source of formaldehyde to effect the cure are described. Viscosity of some binders are reduced by solvents. Fillers include calcium carbonate, calcium oxide, calcium metasilicate, aluminum sulfate, alumina trihydrate, cryolite, magnesia, kaolin, quartz and glass. Grinding aid fillers include cryolite, potassium fluroborate, feldspar and sulfur. Super size coats can use zinc stearate to prevent abrasive loading or grinding aids to enhance abrading. Coating techniques include two basic methods. The first is to provide a pre-size coat, a make coat, the initial anchoring of loose abrasive grain particles and a size coat for tenaciously holding abrasive grains to the backing. The second coating technique is to use a single-coat binder where a single-coat takes the place of the make coat/size coat combination. An ethyl cellosolve and water solvent is referenced for use with a resole phenolic resin.

U.S. Pat. No. 4,918,874 (Tiefenbach) discloses a slurry mixture including 8 micron and less diamond and other abrasive particles, silica particles, glass-formers, alumina, a flux and water, drying the mixture with a 400 degree C. spray dryer to form porous greenware spherical agglomerates that are sintered. Fluxes include an alkali metal oxide, such as potassium oxide or sodium oxide, but other metal oxides, such as, for example, magnesium oxide, calcium oxide, iron oxide, etc., can also be used.

U.S. Pat. No. 4,930,266 (Calhoun et al.) discloses the application of spherical abrasive composite agglomerate beads, made up of fine abrasive particles surrounded by a binder, in predetermined controlled particle location patterns on the surface of abrasive articles. This is done with the use of a commercially available printing plate. Small dots of silicone rubber are created on an aluminum sheet by exposing light through a half-tone screen pattern to a photosensitive material that is coated with a layer of the silicone rubber. The unexposed silicone rubber is brushed off leaving small target islands approximately of silicone rubber on the aluminum sheet. The printing plate is moved through a mechanical vibrated fluidized bed of dry abrasive agglomerates that are attracted to, and weakly bound to, the surfaces of the silicone rubber islands only. The target rubber island dot surfaces are controlled in size to be slightly smaller than the individual abrasive particles where preferably only one abrasive agglomerate is deposited per target dot island. The plate is brought into nip-roll pressure contact with a web backing which is uniformly coated by a binder resin that was softened into a tacky state by heat, thereby transferring each abrasive agglomerate particle from the rubber islands to the web backing. Each abrasive particle is located on the binder coated backing with a prescribed separation distance between the particle and adjacent particles. The particle separation pattern on the abrasive article is a duplicate of the separation pattern of silicone rubber island dots that were initially established on the aluminum transfer sheet. Additional heat is applied to melt the binder adhesive forming a meniscus around each particle, which increases the bond strength between the particle and the backing. Contamination of the printing-type aluminum transfer sheet can occur with some of the resin binder that contacts it during the abrasive particle transfer process. To avoid this contamination, the abrasive particles can be transferred to a transfer roll which has a surface material that has been selected to pick up the abrasive particles from the rubber islands and deposit them on the binder resin on the backing sheet while acting as a release surface in relation to the binder. The resulting abrasive article has prescribed distance gap-spaced abrasive agglomerate particles on the backing. The abrasive agglomerates are attached directly to the backing surface and are not raised away from the flat backing surface. There is no description of transferring abrasive agglomerate beads to the flat surfaces of raised island structures that are attached to an abrasive article backing sheet. The passageway gaps between adjacent raised island structures prevent the continuous planar coating of this type of abrasive article with abrasive particles, or abrasive agglomerates, that have a predetermined lateral spacing between the particles.

Calhoun describes the desirability of using equal sized abrasive agglomerate beads but he does not describe how to manufacture these equal sized beads or cite other references that describe how to manufacture these equal sized beads. The typical abrasive material that is used for high speed lapping is diamond, which is very expensive. Producing diamond particle abrasive beads with manufacturing processes that simultaneously produce a wide range of different bead diameters would require a separate operation to sort out a desired narrow range of the desired size of beads. The remainder of the expensive non-acceptable sized diamond beads would be discarded at a significant financial loss. Size coats are described as being applied to diamond particles to prevent the loss of even a few of these expensive particles. He references three U.S. patents; U.S. Pat. No. 3,916,684 (Howard et al), U.S. Pat. No. 4,112,631 (Howard) and U.S. Pat. No. 4,541,842 (Rostoker), which describe the production of spherical abrasive ceramic agglomerate beads. None of the bead making processes described in these three patents is capable of making equal sized abrasive beads. In U.S. Pat. No. 3,916,684 and U.S. Pat. No. 4,112,631 Howard stirs a stream of a water based abrasive particle liquid mixture and controls the resultant nominal bead size by how fast the mixture is stirred in a dehydrating liquid. There is a wide variance in abrasive beads sizes that are produced simultaneously using this stirring procedure. In U.S. Pat. No. 4,541,842 Rostoker mixes abrasive grits and ceramic precursor materials together and processes the mixture in a high temperature furnace to form spherical glass-type abrasive beads that contain abrasive grits. He controls the nominal bead size by selection of the furnace type. A rotary kiln produces beads that are 250 microns in size and a vertical shaft furnace produces beads that are 20 microns in size. There is a wide variance in abrasive beads sizes that are produced simultaneously using these furnace processing procedures so he uses a screening device to separate the desired size of beads he desires to use for specific abrasive articles.

Each Calhoun composite abrasive agglomerate bead is preferably a equal sized spherical composite of a large number of small abrasive grains in a binder. The agglomerates typically range in size from 25 to 100 microns and contain 4-micron abrasive particles. It is indicated that the composite abrasive agglomerate granules should be of substantially equal size, i.e., the average dimension of 90% of the composite granules should differ by less than 2:1. It is also taught that preferably, the abrasive composite granules have equal sized diameters where substantially every granule is within 10% of the arithmetic mean diameter of the granules that are coated on the abrasive article. Abrasive grains having an average dimension of about 4 microns can be bonded together to form composite sphere granules of virtually identical diameters, preferably within a range of 25 to 100 microns. Here, the equal sized, or non-spherical equiax particles having the same thickness in every direction, abrasive granules protrude from the surface of the binder layer to substantially the same extent where the individual granules can be force-loaded equally upon contacting a workpiece. Granules are spherical in shape or have a shape that has approximately that same thickness in every direction.

Calhoun references U.S. Pat. No. 4,536,195 (Ishikawa) which teaches the desirability of distributing abrasive grains in a controlled manner so that the load working on each grain is even, making a stone abrading article more efficient with a longer life. By individually positioning the equal sized granules to be spaced equally from adjacent granules with the rubber dots, Calhoun describes how his equal sized and predetermined granules have a number of abrading advantages. When the spaces between the granules have sufficient width the gap spaces are used to carry off abrading detritus. The equal sized granules maintain relative uniform cutting action for longer periods of time as compared to sheets coated with irregular shaped granules. These prescribed spaced equal sized granules produce finer finishes at faster cutting rates than attained in prior art. Also, these granules each bear the same load and hence provide an extraordinary uniform finish. Further, the granules wear at substantially identical rates and tend to be equally effective. Consequently, workpieces continue to be polished uniformly. He teaches the desirability of having a monolayer of abrasive particles coated on an abrasive article. One difficulty with this abrasive product, even with abrasive composites having uniform diameters where each composite granule can be positioned to protrude to the same extent from the binder layer, the variation in the thickness in the backing thickness is not considered. He does not teach about the importance of the control of the overall thickness of the abrasive article relative to the size of the abrasive beads that are coated on the article. If there are significant variations in the backing thickness, even equal sized individual composite abrasive agglomerates coated on a abrasive article rotating at high lapping surface speeds of 8,000 surface feet per minute or more will tend to not evenly contact a workpiece surface. Eventually, the highest positioned composite abrasives will wear down and adjacent composite agglomerates will be contacted by the workpiece surface. It is necessary to control the diameter of the composite agglomerates, the thickness variation of the binder and the variation of the coated surface height of the backing, relative to the back platen mounting side of the backing, to some fraction of the diameter of the average diameter of the abrasive composites to attain effective utilization of all or most of the abrasive composite agglomerates in high speed lapping.

There is no reference made to abrasive articles having raised island structures that are coated with abrasive particles or abrasive agglomerate beads.

U.S. Pat. No. 4,931,414 (Wood et al.) discloses the formation of microspheres by forming a sol-gel where a colloidal dispersion, sol, aquasol or hydrosol of a metal oxide (or precursor thereof) is converted to a gel and added to a peanut oil dehydrating liquid to form stable spheriods that are fired. A layer of metal (e.g. aluminum) can be vapor-deposited on the surface of the microspheres. Various microsphere-coloring agents were disclosed.

U.S. Pat. No. 4,974,373 (Kawashima et al.) discloses a lapping abrasive tool having a adhesive bonded layer of abrasive particles where he describes the desirability of having a single layer of abrasive particles on the surface of the tool for lapping of workpieces. He discloses where multiple layers of abrasive particles in particle agglomerates can scratch the surface of a workpiece.

U.S. Pat. No. 5,014,468 (Ravipati et al.), herein incorporated by reference, discloses that it is also feasible for abrasive coated articles to have areas of a backing exposed where the abrasive layer does not cover the entire surface area of the backing. He uses rotogravure rolls to coat backings with an abrasive slurry mixture of abrasive particles and a polymer binder. The individual cells in the rotogravure roll are level-filled with the slurry and a backing is placed in contact with the roll where the slurry that is contained in the roll cells is transferred to the surface of the backing to form three dimensional raised composite abrasive shapes on the surface of the backing. Traditionally these composite abrasive shapes comprise full-sized pyramid (or other) abrasive shapes that are reverse-duplicates of the geometric shapes of the individual cells. However, the slurry that he uses has a sufficiently high viscosity that a significant portion of the slurry that is contained in the individual cells remains in the cell and only a composite abrasive slurry shape that assumes the outline shape of the cell is transferred to the backing. Each resultant raised composite shape has a void area at the shape center and raised sloping abrasive slurry walls that surround the central void area that is devoid of abrasive slurry material. Rotogravure rolls are used in many applications especially in the printing industry where specific area locations of a paper web is printed with colored inks to form localized printed figures or words within the boundaries of the designated specific areas. Likewise patterned rotogravure rolls can easily form patterns of raised abrasive composite structures having recessed gap areas between the raised composite elements on a backing sheet, and also, form recessed gap areas that extend around the periphery of an abrasive article. These abrasive articles are not useful for high speed lapping.

U.S. Pat. No. 5,015,266 (Yamamoto) describes surface-textured abrasive articles that have an abrasive coating applied to the top surfaces of backing sheets having emboss-raised triangular shapes. His raised surface projections or protrusions are angled-wall triangle shapes and not flat surfaced island shapes. He uses a reverse-roll slurry coater to apply a liquid abrasive slurry coating to the embossed pyramid-shaped raised island projections after which surface tension forces act on the coated liquid slurry to force the slurry to conform to the angled-walls and top surfaces of each of the individual raised island pyramids. The reverse-roll coater initially applies a uniform thickness of liquid slurry surface coating in a substantially planar fashion over the full pattern of raised pyramid islands. Here, the slurry loses its "planar top surface" immediately after coating as the surface tension forces disturb the slurry at each localized individual pyramid site whereby the slurry follows the angled contours of the pyramid side walls.

Also, the overall flatness of his abrasive article is dependent on the initial planar flatness of the pyramids that were formed when the embossing die contacts the backing sheet. Some of his embossed raised projections or protuberances are located on the top side only of the backing sheet and others are located on both sides of the sheet. The backing sheets are heated prior to the embossing action. If the embossed pyramids were not successfully positioned in a common plane by the embossing die, the application of a uniform thickness slurry coating on these uneven pyramids will not result in an abrasive article having a flat planar surface. Further, the planar surface of the abrasive article is only established by the location of the top tips of the full pattern of the individual pyramids. These tips contribute very little to the abrading action of the abrasive sheet because the quantity of abrasive coated on each individual pyramid tip is so small. The abrasive tips are quickly worn away and the abrasive article loses its planar surface.

Yamamoto uses the reverse-roll coater in an attempt to provide an abrasive article that can develop a precision planar surface on a workpiece. It is well known to those skilled in the art that raised island abrasive articles must have precisely flat-surfaced abrasive to successfully abrade a precision planar surface on a workpiece. In recognition of this, Yamamoto states that the flat surfaced abrasive coated raised islands described by Kirsch in U.S. Pat. No. 4,142,334 are inadequate to abrade and finish a precision planar surface workpiece because the Kirsch abrasive article does not have good precision planar layers precision abrasive layers. Also, Yamamoto states that the flat surfaced abrasive coated raised islands described by Kalbow in U.S. Pat. No. 4,111,666 are inadequate to finish a workpiece to be a precise planar surface because the Kalbow abrasive layers are not attached evenly in a plane on the raised island surfaces.

U.S. Pat. No. 5,090,968 (Pellow) describes the formation of abrasive filaments by forcing a gelled hydrated mixture of a metal oxide into a moving porous belt to produce abrasive precursor filaments of substantially constant length. The filaments are treated to make them non-sticky as they are still attached to the belt after which they are removed from the belt and fired at a high temperature to convert them into filament abrasive particles. It is not possible to make spherical abrasive particles by this process.

U.S. Pat. No. 5,108,463 (Buchanan) describes carbon black aggregates incorporated into a super size coat which also included kaolin.

U.S. Pat. No. 5,110,659 (Yamakawa et al.) discloses an abrasive lapping tape having very small abrasive particles where the tape has a defined smooth surface. He describes the undesirability of other abrasive particle coated lapping tapes that have agglomerations of fine abrasive particles that produce scratches in the surface of workpieces that include magnetic heads.

U.S. Pat. No. 5,137,542 (Buchanan) describes a coated abrasive article which has a coated layer of conductive ink applied to the surface of the article, either as a continuous film or the back side of the backing or as printed "island" patterns on the abrasive particle size of the article to prevent the buildup of static electricity during use. Static shock can cause operator injury or ignite wood dust particles. The islands coated on the backside of 3M Company, St Paul, Minn. Imperial® abrasive were typically quite large 1 inch (2.54 cm) diameter dots and cover only about 22 percent of the article surface. Further, they are very thin, about 4 to 10 micrometers. No reference is made to the affect of the raised islands on hydroplaning effects when used with a water lubricant and no reference is made to high speed lapping. Raised islands of this height would provide little, if any, benefit for hydroplaning. Further, islands of this large diameter would also develop a significant boundary layer across its surface length. Also, top coatings such as these electrically conductive particle filled materials would not allow the typically small mono layers of diamonds used in lapping films to abrasively contact the workpiece surface until the static coating was worn away, after which time it is no longer effective in static charge build-up prevention. Description is made of using polyester film as a backing material for lapping abrasive articles. Bond systems include phenolic resins and solvents include 2-butoxyethanol, toluene, isopropanol, or n-propyl acetate. Coating methods include letterpress printing, lithographic printing, gravure printing and screen printing. For gravure printing, a master tool or roll is engraved with minute wells which are filled with coatable electrically conductive ink with the excess coating fluid removed by a doctor blade. This coating fluid is then transferred to the abrasive article.

U.S. Pat. No. 5,142,829 (Germain) discloses an abrasive disk article having a disk-center aperture hole that has multiple arms projecting out from the disk center. These disk substrates have different shapes including rectangle, square, hexagon, octagon, oval where these disks are assembled in stacks using the disk-center aperture holes on an arbor or mandrel.

U.S. Pat. No. 5,152,917 (Pieper et al.) discloses a structured abrasive article containing precisely shaped abrasive composites. These abrasive composites comprise a mixture of abrasive grains and an erodible binder coated on one surface of a backing sheet forming patterned shapes including pyramid and rib shapes. The patterned shapes comprised of abrasive particles mixed with an erodible material wear down progressively during abrading use of the abrasion article.

U.S. Pat. No. 5,175,133 (Smith et al.) discloses bauxite (hydrous aluminum oxide) ceramic microspheres produced from a aqueous mixture with a spray dryer manufactured by the Niro company or by the Bowen-Stork company to produce polycrystalline bauxite microspheres. Gas suspension calciners featuring a residence time in the calcination zone estimated between one quarter to one half second where microspheres are transported by a moving stream of gas in a high volume continuous calcination process. Scanning electron microscope micrograph images of samples of the microspheres show sphericity for the full range of microspheres. The images also show a wide microsphere size range for each sample, where the largest spheres are approximately six times the size of the smallest spheres in a sample.

U.S. Pat. No. 5,190,568 (Tselesin) discloses a variety of sinusoidal and other shaped peak and valley shaped carriers that are surface coated with diamond particles to provide passageways for the removal of grinding debris. There are a number of problems inherent with this technique of forming undulating row shapes having wavelike curves that are surface coated with abrasive particles on the changing curvature of the rows. The row peaks appear to have a very substantial heights relative to the size of the particles which indicates that only a very small percentage of the particles are in simultaneous contact with a workpiece surface. One is the change in the localized grinding pressure imposed on individual particles, in Newton's per square centimeter, during the abrading wear down of the rows. At first, the unit particle pressure is highest when a workpiece first contacts only the few abrasive particles located on the top narrow surface of the row peaks. There is a greatly reduced particle unit pressure when the row peaks are worn down and substantially more abrasive particles located on the more gently sloped side-walls are in contact with the workpiece. The inherent bonding weakness of abrasive particles attached to the sloping sidewalls is disclosed as is the intention for some of the lower abrasive particles, located away from the peaks, being used to structurally support the naturally weakly bonded upper particles. The material used to form the peaks is weaker or more erodible than the abrasive particle material, which allows the erodible peaks to wear down, expose, and bring the work piece into contact with new abrasive particles. Uneven wear-down of the abrasive article will reduce its capability to produce precise flat surfaces on the work piece. Abrasive articles with these patterns of shallow sinusoidal shaped rounded island-like foundation ridge shapes where the ridges are formed of filler materials, with abrasive particles coated conformably to both the ridge peaks and valleys alike is described. However, the shallow ridge valleys are not necessarily oriented to provide radial direction water conduits for flushing grinding debris away from the work piece surface on a circular disk article even prior to wear-down of the ridges. Also, a substantial portion of the abrasive particles residing on the ridge valley floors remain unused as it is not practical to wear away the full height of the rounded ridges to contact these lower elevation particles.

U.S. Pat. No. 5,199,227 (Ohishi) describes raised island structure protuberances that are coated with abrasive particles.

FIG. 28 (Prior Art) is a cross section view of the Ohishi U.S. Pat. No. 5,199,227 abrasive coated raised island structures. The protuberances 246 that are attached to a backing sheet 250 are coated with abrasive particles 244. There is no description of precisely controlling the height of the abrasive 244 from the backside of the backing 250 as indicated by the thickness or height dimension 248. The cavities that may be formed into the surface of the belt may be open cells that extend through the thickness of the flexible belt or cavity sheet.

U.S. Pat. No. 5,201,916 (Berg et al) describes abrasive particles that are formed with the use of a mold cavity cell belt or mold sheet that has a planar surface. Berg produces sharp-edged, flat-surfaced abrasive particles from aluminum oxide dispersion materials. His abrasive particles are fully dense (solid), have a high specific gravity (are heavy) where his parent particle material is so hard that it can it can be used to abrasively cut hard workpiece materials. They are not porous and soft enough to be used as erodible abrasive particles that can be used to progressively expose diamond particles that are encapsulated within an abrasive bead.

Also, his system is not capable of making spherical abrasive particles. The production of spherical shaped abrasive particles would require that the dispersion used to fill his mold cavities would be ejected from the cavities in a liquid form to allow surface tension forces to act on the ejected dispersion lumps to form them into spherical shapes. However, he must solidify his dispersion while it resides in the cavities for the dispersion lump particles to assume the particle sharp-edge corners from the sharp-edged mold cavities. If the Berg ejected dispersion particles were in a liquid state, surface tension forces would act on them and form the dispersion lumps into spherical shapes with the associated loss of the sharp particle cutting edges. Spherical abrasive particles made of his materials would be useless for abrading purposes because they do not provide sharp cutting edges.

He describes the use of alpha aluminum oxides that are dispersed in water as colloidal solution. The colloidal solution is then gelled, a process that forms a matrix or interconnected network of branches of alumina fibers or strings. As is well known in colloidal chemistry, once a colloidal oxide solution is gelled, the process is irreversible where the silica particles do not go back into colloidal suspension or reform back into a liquid. After the dispersion is gelled into solidified lumps, the lumps are chopped up with rotary blades (knives) and extruded into the cell cavities with the use of an auger device as shown in his drawings. As would be recognized by those skilled in the art, his blades and augers are not used to process a liquid dispersion. Instead, they would be used to process a solidified material. The molded gelled material is then subjected to heating to assure that the material contained in each individual is further solidified and shrunk. Heating is continued until the alumina material contained in each cavity shrinks enough that the individual alumina particles drop freely out of the cavities due to gravity.

Berg shows a completely passive particle ejection system in his drawings. There are no shown external forces that are applied to the particles to eject them from the cavities. The collection pan that is used to collect the dried and shrunken abrasive precursor particles that fall out of the mold belt allows many particles to be collected in a common mass where the sharp edges of each individual particle is not damaged in the fall into the pan. Also, each individual particle is sufficiently solidified that the individual particles do not fuse to each other as they reside in the collection pan. If these particles were to fuse to each other while residing in the collection pan, those sharp edges of one particle that were joined with an adjacent particle would be destroyed, which would be an very undesirable event for Berg. He does not have to apply a pressure on the mold cavities to eject them (except if his mold filling process is defective).

However, if Berg has a defective mold filling process where some of his gelled dispersion overfills the individual mold cavities and is smeared in a thin layer along the flat surface of the mold sheet, it is impossible for the dried and shrunken particles to fall out of the cavities just due to gravity. Instead, these shrunken particles hang-up on the upper edges of the mold sheet because a undesirable thin dispersion layer overhangs the cavities past the cavity walls. Because the overhang dispersion material is thin and the solidified dispersion is weak and brittle at this stage of solidification, the overhanging edges of the lodged particles can be easily broken off with a small externally applied pressure.

This edge-breakage produces defective abrasive particles that have non-sharp cutting edges on those particle edges (only) that were broken off in the pressure ejection process. The broken-off edges and the defective particles are considered debris. This debris is mixed with the acceptable particles. The debris reduces the quality of his abrasive particle product unless it is separated out, which requires an extra manufacturing step. In addition he has to clean out any cavities that were not emptied. Berg takes great care that it is not necessary to use an external pressure to dislodge particles that are stuck in his mold cavities (see the belt surface scrapping devices in his patent drawings).

Even though the gelled material that resides in each mold cavity still contains a high percentage of water, this is not an indicator that the gelled dispersion is in a liquid state. For instance Jello® is an example of a colloidal gelatin material that is suspended in water. It gels into a wiggly substance but solidified substance even when the gelled dispersion is 90% water. Here, only 10% of the Jello® is comprised of gelatin materials. Long curved fibrous strands of the gelatin that are cross-linked together form the structure of the Jello®. These fibrous strands are contained within the same volume that the water is contained within. After it is gelled, it can be cut into rectangular-shaped cake-piece sections that have sharp edges. These individual cut pieces can be stacked into a bowl (collected together in a common mass) without the sharp edges of the Jello® cut pieces becoming damaged. Furthermore, a single rectangular cut-piece of gelled Jello® can be left standing on a hard surface or can be suspended in air without the occurrence of any "rounding-off" of the sharp edges of the cut-piece. This is a demonstration that surface tension forces do not "round the edges" of a gelled colloidal solution when the gelled entity is not subjected to external or applied forces.

Similarly water of hydration is held in salts (e.g., cupric-sulfate-5H2O) and s present in an amount over 35% by weight of the salt and remains a hard solid. It is clear from these examples that the presence of more than 30% water in a composition does not mean the composition is a liquid.

By comparison to Berg, the present invention describes spherical-shaped abrasive beads from silica (silicone dioxide) dispersion materials. The beads encapsulate already-formed, extremely hard and sharp-edged diamond abrasive particles in a soft, low density and porous silica matrix material. The abrasive beads are erodible where the individual encapsulated sharp and hard diamond particles are continuously exposed during an abrading process as the soft and erodible porous silica matrix material is worn down.

In the present invention, an impinging fluid jet or pressure must be used to eject the liquid dispersion entities from the cavities because the liquid entities are attached or bonded to the walls of the cavities and therefore, can not be ejected from the cavities by use of gravity alone (as in Berg). This is especially the case for the small mold cavities that are used to produce abrasive spheres that are only 50 micrometers (0.002 inches) in diameter. Because the dispersion entities are liquid at the time of ejection from the cavities, where these liquid entities are in full body contact with all the wall surfaces of the cavities, there is liquid adhesion bonding between the entities and the cavity walls. These liquid adhesion forces are so strong that they overcome the cohesion (surface tension) forces that tend to draw the liquid entities together into sphere-like shapes as the liquid entities reside within the cavities. Here the dispersion entities completely fill a cavity but the adhesion forces and the liquid cohesion forces are in equilibrium. To eject the liquid dispersion entities from the cavities, the applied fluid jet ejection forces must be strong enough to overcome the liquid adhesion forces that bond the liquid entities to the wall surfaces of the cavities. Once the adhesion attachment forces are "broken" by the fluid jet forces that are imposed on the liquid entities, the dispersion entities are ejected as a single lump from the cavities. Because the cohesion surface tension forces within the liquid entities are no longer opposed by the adhesion forces (that had attached the entities to the cavity walls) the irregular shaped ejected entities are individually shaped by these surface tension forces into spherical entity shapes.

At this time a critical drying event must take place where the spherical shaped entities are ejected into a dehydrating environment. It is critical that these individual abrasive bead entities become dried sufficiently while they are suspended in the dehydrating fluid environment before they fall into a common pile where they are collected for further heat treatment processing. IF these dispersion entities are not dried at the time of mutual collection, they will stick to each other and the spherical shape of each entity will be destroyed. The production of non-spherical dispersion entities is considered to be a failure of this abrasive bead manufacturing process. By comparison, Berg does not use or need the dehydrating fluid environment immediately after particle ejection from the cavities because his dispersion particle entities are already dry enough that they can be collected together immediately after ejection. His ejected particles are so dry at that time that they do not stick to each other when collected together in a common pile. If his entities did stick together during this common-particle collection event, the sharp edges that he so painstakingly formed on his individual abrasive precursor particles would be lost when adjacent particles merged together into a common mass. Further, even though his ejected particles still contain significant amounts of water, including bound-water, these same ejected particles are not rounded by surface tension forces because they would lose their sharp edges if they did become so-rounded in this post-ejection event.

It would not be possible to substitute a woven wire screen for Berg's cavity molds to manufacture his dispersion entities. The cavity cell volumes formed by the individual interleaved wire strands in the woven screen are interconnected with adjacent cells. The cells "appear" to be separated by the wire strands as viewed from the top flat surface of the screen. However, the actual screen thickness results from the composite thickness of individual wires that are bent around perpendicular wires where the screen thickness is often equal to three times the diameter of the woven wires. Adjacent "cell volumes" are contiguous across the joints formed by the perpendicular woven wires. Level-filling the screen with Berg's dispersion creates adjacent cell dispersion entities that are joined together across these perpendicular wire joints. When Berg dries and solidifies his screen-cell volume dispersion entitles, the entities shrink and some entities would pull themselves apart from each other at the screen wire joints that mutually bridge adjacent cells. However, the entity shrinkage will not be sufficient that the non-joined solidified entities will pass through the screen cell openings. These entities will remain lodged in the screen mesh as the portions of the solidified dispersion entity bodies that extend across the woven wire joints trap them. Berg can not use a woven screen to process his dispersion entities because the trapped solidified entities can not be ejected from the individual woven wire screen cells.

The liquid dispersion entities contained in the woven wire screen cells described in the present invention can be easily ejected from the individual cells because the entities are ejected when they are in a liquid state. The fluid jet that ejects the dispersion entities from their respective cells separates the portions of the dispersion entity main bodies that extend across the woven wire joints to form ejected individual liquid dispersion entities. Surface tension forces acting on the ejected dispersion entities form the entities into spherical shapes.

Fracturing a solid and hardened sharp edged Berg-type aluminum oxide abrasive is not the same as eroding the present invention abrasive agglomerate that encapsulates existing sharp edged abrasive particles in a soft matrix material. When an abrasive particle erodes, the soft matrix material is worn away whereby individual dull edged abrasive particles are ejected from the matrix material and fresh new individual sharp edged abrasive particles are exposed.

Also, it would not be practical or desirable to incorporate pre-formed sharp diamond particles into Berg's hardened aluminum oxide abrasive particles.

FIG. 37 (Prior Art) is a cross section view of the Berg U.S. Pat. No. 5,201,916 triangular shaped abrasive particles and particle forming belt. The particle forming belt 335 has belt wall sections 331 that form cavity openings that are filled to the flat belt surfaces with a gelled mixture of suspended metal or other oxide particles in a water based solution to form a liquid flat sided triangular mixture lump 337 that shrinks to a smaller sized solidified flat sided triangular lump 333 which falls away from the belt 335. Two solidified falling abrasive flat sided triangular shaped lumps 339 are then collected and subjected to heating and firing to convert the abrasive lumps into hardened abrasive flat sided triangular shaped particles.

U.S. Pat. No. 5,221,291 (Imatani) describes the use of a polyimide resin for the combination use as an adhesive bonding agent for abrasive particles, and also, to form an abrasive sheet. Diamond particles were dispersed in solvent thinned polyimide resin and coated on a flat surface with 60 micrometer diamond particles to form an abrasive sheet where 20% of the sheet material is made up of abrasive particles. The sheet was tested at very low speeds of 60 rpm and did abrasively remove workpiece material, leaving a smooth workpiece surface. However, the abrasive particles are principally buried within the thickness of the resin mixture sheet as the abrasive and resin mixture forms the thin abrasive disk sheet article. Much of the expensive diamond particles are located at the bottom layer of the abrading sheet structure and so are not available for use as grinding agents but the polyimide successfully bonds the diamonds within the sheet.

U.S. Pat. No. 5,232,470 (Wiand) discloses one-piece mold-formed abrasive disks having patterns of raised protrusions (raised islands) that contain abrasive particles. Thermoplastic or thermosetting polymers are used to simultaneously form the disk backing and the raised protrusions into a single-piece abrasive article where the protrusions are integral with the backing. In the case where a thermoplastic polymer is used, abrasive particles are mixed with powdered thermoplastic and the mixture is placed in a two-pieced mold. One piece of the mold has a flat surface and the other mold piece has a flat surface that has protrusion-shaped cavities. Then the mixture is heated until it is melted while under pressure to form both the abrasive-polymer protrusions and the flat surfaced disk backing from the melted mixture. After the mixture has cooled and the disk solidified, the mold is disassembled and the polymer disk is removed where the disk has a pattern of protrusions that extend up from the surface of the backing. The top surfaces of the protrusions are co-planar. In the case where a thermosetting polymer is used, abrasive particles are mixed with a liquid thermosetting polymer and the liquid mixture is placed in a two-pieced mold. Then the mixture is heated while under pressure to form both the abrasive-polymer protrusions and the flat surfaced disk backing from the mixture. After the thermosetting mixture has "set-up" or polymerized, the mold is disassembled and the resultant one-piece abrasive disk is removed. Phenolic boards, or perforated sheets, or fiberglass or other mesh materials can also be placed within the mold assembly prior to the introduction of the abrasive mixture. Here, the molded abrasive mixture incorporates the board or mesh into the body of the abrasive disk where the board or mesh acts as a strengthening element.

Diamond or other abrasive particles are embedded within the polymer mixture that forms the protrusions. Also, those expensive abrasive particles that are present in the non-protrusion portions of the abrasive disk can not be utilized in an abrading process which results in substantial economic loss.

The abrasive disks have patterns of the raised protrusions extending in an annular band from near the disk center to near the outer periphery of the disk. In one embodiment, an additional peripheral lip annular ring of the mixture is molded at the outer periphery of the disk. This molded lip ring has a lip height that is equal to the heights of the co-planar protrusions. Because the molded lip that surrounds the disk has significant structural strength compared to individual protrusions and because the lip is located at the disk periphery, the peripheral lip tends to prevent abrading forces from impacting individual protrusions when the moving abrasive article contacts the edges of a workpiece. This protection prevents the breaking-off of individual protrusions from the backing during this stage of abrading. The drawing by Wiand shows a distinct recessed area gap between the raised ring and the nearest island protrusions at the outer periphery of the disk in one embodiment. He also refers to other embodiments that do not have the outer peripheral lips. His use of the outer peripheral lip is not specified in his claims, affirming that his use of the peripheral lip is simply one disk embodiment. In addition, in both of the Wiand References Cited, U.S. Pat. No. 2,907,146 (Dynar) and U.S. Pat. No. 4,106,915 (Kagawa, et al.) teach abrasive disk articles having raised island protrusions where each reference has embodiments that have protrusion-free recessed areas that extend around the outer periphery of the disks.

FIG. 38 (Prior Art) shows a top view of a Wiand U.S. Pat. No. 5,232,470 raised-protrusion abrasive disk having a peripheral lip with a recessed gap area between the outer raised protrusions and the outer peripheral lip ring, as he describes for one embodiment. An abrasive disk 293 has a disk-center aperture hole 296 in the disk backing 302 with the disk backing 302 having attached abrasive raised island protrusions 297. Also, a raised peripheral lip ring 295 is attached to the backing 302 where a recessed gap 294 is present between the outer periphery protrusions 297 and the peripheral lip 295 and extends around the full peripheral circumference of the abrasive disk 293.

FIG. 39 (Prior Art) shows a cross section view of a Wiand U.S. Pat. No. 5,232,470 raised protrusion abrasive disk in his FIG. 3 having a recessed gap area between the outer raised protrusions and the outer peripheral lip ring. An abrasive disk 283 has attached abrasive raised island protrusions 289 and an attached peripheral raised lip ring 291 where there are recessed gap areas 287 between the protrusions 289. There is also a recessed gap 279 that is present between the outer periphery protrusions 289 and the disk 283 periphery 278 edge around the full periphery 278 of the abrasive disk 283.

FIG. 40 (Prior Art) shows a cross section view of a Dyar U.S. Pat. No. 2,907,146 or a Kagawa, et al. U.S. Pat. No. 4,106,915 raised protrusion abrasive disk having a recessed gap area between the outer raised protrusions and the outer periphery of the disk. An abrasive disk 308 has attached abrasive raised island protrusions 306 with recessed gap areas 305 between the protrusions 306. A recessed gap area 307 is present between the outer periphery protrusions 306 and the disk 308 periphery 277 where the gap area 307 extends around the full periphery 277 of the abrasive disk 308.

FIG. 41 (Prior Art) shows a top view of a Kagawa et al. U.S. Pat. No. 4,106,915 raised-protrusion abrasive disk with a recessed gap area between the outer raised abrasive protrusions and the outer peripheral disk edge. An abrasive disk 273 has attached abrasive raised island protrusions 261 with recessed gap areas 255 between the protrusions 261. A recessed gap area 259 is present between the outer periphery protrusions 261 and the disk 273 periphery 257 and extends around the full periphery 257 circumference of the abrasive disk 273.

FIG. 42 (Prior Art) shows a top view of a Dyar U.S. Pat. No. 2,907,146 raised-protrusion abrasive disk with a recessed gap area between the outer raised abrasive protrusions and the outer peripheral disk edge. An abrasive disk 298 has a disk-center aperture hole 300 in the disk backing 304 with the disk backing 304 having attached abrasive raised island protrusions 275 with recessed gap areas 299 between the protrusions 275. A recessed gap area 301 is present between the outer periphery protrusions 275 and the disk 298 periphery 303 and extends around the full periphery 303 circumference of the abrasive disk 298.

U.S. Pat. No. 5,251,802 (Bruxvoort et al.) discloses the use of solder or brazing alloys to bond diamond and other abrasive particles to a flexible metal or non-metal backing material.

U.S. Pat. No. 5,273,805 (Calhoun et al.) discloses the use of a silicone material to transfer abrasive particles in patterns onto a tacky adhesive coated backing.

U.S. Pat. No. 5,304,225 (Gardziella) describes phenolic resins which typically have high viscosity which can be lowered by the addition of solvents or oils.

U.S. Pat. No. 5,316,812 (Stout, et al.) describes abrasive disks that have raised annular bands of continuous coatings of abrasive material where the abrasive bands are located at the outer periphery of the disk. Some of the disks have raised annular band of radial ribs that are attached to the backside of the disk while the abrasive is coated in a continuous layer on the flat smooth surface of the opposite front side of the disk. Stout teaches that there is generally no need to have abrasive material coated on the surface of the center region of an abrasive disk. Tough heat resistant thermoplastic backings are used to make the abrasive disks.

U.S. Pat. No. 5,368,618 (Masmar) describes preparing an abrasive article in which multiple layers of abrasive particles, or grains, are minimized. Some conventional articles have as many as seven layers of particles, which is grossly excessive for lapping abrasive media. He describes "partially cured" resins in which the resin has begun to polymerize but which continues to be partially soluble in an appropriate solvent. Likewise, "fully cured" means the resin is polymerized in a solid state and is not soluble. If the viscosity of the make coat is too low, it wicks up by capillary action around and above the individual abrasive grains such that the grains are disposed below the surface of the make coat and no grains appear exposed. Phenolic resins are cured from 50 degrees to 150 degrees C. for 30 minutes to 12 hours. Fillers including cryolite, kaolin, quartz, and glass are used. Organic solvents are added to reduce viscosity. Typically 72 to 74 percent solids are used for resole phenolic resin binders. Special tests demonstrate that a partially cured resin is capable of attaching loose abrasive mineral grains which are drop coated onto test slides with the result that higher degree of cure results in lower mineral pickup and lower degree of cure results in less mineral pickup. Abrasive grains can be electrostatically projected into the make coat where the ends of each grain penetrates some distance into the depth of the make coat. No description was provided about the desirability, necessity, or ability of the grain application process having a flat uniform depth of the tops of each particle for high speed lapping.

U.S. Pat. No. 5,397,369 (Ohishi) describes phenolic resins used in abrasive production which have excessive viscosity where a large amount of solvent is required for dilution to adjust the viscosity within an appropriate range. Examples of organic solvents with high boiling points include cyclohexanone, and cyclohexanol. Solvents having an excessively high boiling point tend to remain in the adhesive binder and results in insufficient drying. When the boiling point of a solvent is too low, the solvent leaves the binder too fast and can result in defects in the abrasive coating, sometimes in the form of foamed areas. Additives such as calcium carbonate, silicone oxide, talc, etc. fillers, cryolite, potassium borofluoride, etc. grinding aids and pigment, dye, etc. colorants can be added to the second phenolic adhesive (size coat) used in the abrasive manufacture.

U.S. Pat. No. 5,435,816 (Spurgeon et al.) discloses an abrasive article that has a continuous patterned array of pyramid shaped composite abrasive structures that are attached to a flat-surfaced backing sheet. The patterned array of abrasive shaped structures are produced on a continuous web backing material which is converted into abrasive sheet articles after the composite abrasive material is solidified. Reverse-pyramid cavity shapes are formed in an array pattern into the surface of a production tool belt. These belt cavities are level filled with a liquid abrasive-binder mixture, an action that provides flat surfaces of each liquid abrasive mixture entity that is contained in the belt cavities. A flat-surfaced continuous web backing is brought into surface contact with the belt where it is required that the flat-surfaced abrasive mixture entities in each of the belt cavities fully wets the surface of the backing. This abrasive mixture entity wetting action provides adhesion contact of the individual abrasive mixture entities across the full contacting surface of each entity with the flat surfaced backing sheet. Then energy is applied to solidify the abrasive mixture entities so that they individually bond to the backing, and also, so that the entities are "handleable" and retain the cavity formed pyramid shapes after separating the backing from the cavity belt. Polymer binders are used in the abrasive particle mixture that can be partially cured or solidified with the use of radiant energy that penetrates a production tool belt that is fabricated from a variety of polymer materials that can transmit radiant energy. Radiant energy solidifies the abrasive mixture entities while the entities are in wetted contact with the flat-surfaced backing. This solidification assures that a "clean separation" takes place where the abrasive shapes are completely transferred from the belt cavities to the surface of the backing upon separating the abrasive web backing from the cavity belt. In this way, there are no residual portions of the abrasive shaped entities that are left in the individual cavities which assures that the cleaned-out belt cavities can be refilled with abrasive mixture material during the production of a continuous web having undistorted abrasive pyramid shapes. After the abrasive pyramids are transferred to the web, the abrasive pyramids are fully solidified or cured.

During production, the only registration that is required between the web backing and the production tool cavity belt is that the side edges of the belt and the web be mutually aligned. The resultant web backing has a continuous coating of the composite abrasive shapes over the full surface of the web.

U.S. Pat. No. 5,489,204 (Conwell et al.) discloses a non rotating kiln apparatus useful for sintering previously prepared unsintered sol gel derived abrasive grain precursor to provide sintered abrasive grain particles ranging in size from 10 to 40 microns. Dried material is first calcined where all of the mixture volatiles and organic additives are removed from the precursor. The stationary kiln system described sinters the particles without the problems common with a rotary kiln including loosing small abrasive particles in the kiln exhaust system and the deposition on, and ultimately bonding of abrasive particles to, the kiln walls. A pusher plate advances a level mound charge quantity of non-sintered abrasive grains dropped within the heated body of a fixed position kiln having a flat floor to sinter dried or calcined abrasive grains. The depth of the level mound of non-sintered particles is minimized to a shallow bed height to aid in providing consistent heat transfer to individual non-sintered abrasive precursor grains, and in consistently providing uniformly sintered abrasive grains. The abrasive grain precursor remains in the sintering chamber for a sufficient time to fully sinter the complete body volume of each individual particle contained in the level mound bed. The surface of each non-sintered particle is heated to the temperature of the sintering apparatus in less than a 1-second time period.

U.S. Pat. No. 5,496,386 (Broberg et al.) discloses the application of a mixture of diluent particles and also shaped abrasive particles onto a make coat of resin where the function of the diluent particles is to provide structural support for the shaped abrasive particles.

U.S. Pat. No. 5,549,961 (Haas et al.) discloses abrasive particle composite agglomerates in the shape of pyramids and truncated pyramids that are formed into various shapes and sintered at high temperature. Numerous references are made to the deployment of individual abrasive microfinishing beads on a backing but no reference is made concerning the production of these spherical beads by the technology disclosed in this patent. Rather, the creation of composite agglomerates is focused on the production of pyramid shaped agglomerates. The breakdown of abrasive composite agglomerates is characterized in the exposed surface regions of the abrasive composite where small chunks of abrasive particles and neighboring binder material are loosened and liberated from the working surfaces of the abrasive composite, and new or fresh abrasive particles are exposed. This breakdown process continues during polishing at the newly exposed regions of the abrasive composites. During use of the abrasive article of this invention, the abrasive composite erodes gradually where worn abrasive particles are expelled at a rate sufficient to expose new abrasive particles and prevent the loose abrasive particles from creating deep and wild scratches on or gouging a workpiece surface. The composite abrasive particles including diamond contained in the agglomerates range in size from 0.1 to 500 microns but preferably, the abrasive particles have a size from 0.1 to 5 microns.

U.S. Pat. No. 5,549,962 (Holms) describes the use of pyramid shaped abrasive particles by use of a production tool having three-dimensional pyramid shapes generated over its surface which are filled with abrasive particles mixed in a binder. This abrasive slurry is introduced into the pyramid cavity wells and partially cured within the cavity to sufficiently take on the shape of the cavity geometry. Then the pyramids are either removed from the rotating drum production tool for subsequent coating on a backing to produce abrasive articles, or, a web backing is brought into running contact with the drum to attach the pyramids directly to the backing to form an abrasive web article. If a web backing is used is contact with the drum, the apexes of the pyramids are directed away from the backing. If loose discrete pyramids are produced by the drum system, the pyramids can be oriented on a backing with the possibility of having the pyramid apex up, or down or sideways relative to the backing. The pyramid wells may be incorporated into a belt and also, these forms can extend through the thickness of the belt to aid in separating the abrasive pyramid particles from the belt.

Over time, many attempts have been made to distribute abrasive grits or particles on the backing in such a method that a higher percentage of the abrasive grits or particles can be used. Merely depositing a thick layer of abrasive grits or particles on the backing will not solve the problem, because grits or particles lying below the topmost grits or particles are not likely to be used. The use of agglomerates having random shapes where abrasive particles are bound together by means of a binder are difficult to predictably control the quantity of abrasive grits or particles that come into contact with the surface of a workpiece. For this reason, the precisely shaped (pyramid) abrasive agglomerates are prepared. Some pyramid-shaped particles are formed which do not contain any abrasive particles and these are used as dilutants to act as spacers between the pyramid abrasive agglomerates when coated by conventional means. Many different fillers and additives can be used including talc and montmorillonite clays. Care is exercised to provide sufficient curing of the agglomerate binders in the drum cavities so that the geometry of the cavity is replicated. Generally, this requires a fairly slow rotation of the production tooling cavity drum. No description is given to the accuracy of the height or thickness control of the resultant abrasive article which incorporates these very large agglomerate pyramids which typically are 530 micrometers high and have a 530 micrometer base length. Thickness variations of conventional lapping disk abrasive sheets generally are held within 3 micrometers in order for it to be used successfully. The system of using the large pyramids described here cannot produce an abrasive article of the precise thickness control required for high speed lapping for a number of fundamental reasons. Some of these reasons are listed here. First, creation of many precise sized pyramid cavities by use of a belt that is replicated into a plastic form to control the belt cost adds error due to the sequential steps taken in the replication process. Variations in binder cures from production run to run and also variations in binder cures across the surface of a drum belt result in pyramids that are distorted from the original drum wells. For backing belts to be integrally bonded to the pyramids during the formation of the pyramids, it is required that any adhesive binder used to join the agglomerate be precisely controlled in thickness. Thickness control is difficult to achieve with this type of production equipment as there are many thickness process variables that must be controlled that are in addition to those variables that are controlled to successfully create or form precise shaped pyramids. The backing material must be of a precise thickness. Random orientation of the large agglomerates will inherently produce different heights at the exposed tops of the agglomerates depending on whether an agglomerate has its apex up, it lays sideways, or has its sharp apex embedded in a make coat of binder. The use of pyramids where all the apexes are up and the bases are nested close together produces grinding effects that change drastically from the initial use where only the tips of the pyramids contact the workpiece, to a final situation where the broad bases contact the workpiece when most of the pyramid has worn away. There was no description of the inherent advantage of the use of upright pyramids for hydroplaning or swarf removal which is a natural affect of these relatively tall "mountain pyramids" and the "valleys" between them which can carry off the water quite well. There was no discussion of the use of this pyramid material for high speed lapping or grinding. The water lubricant effects on grinding would change significantly as the abrasive article wears down. There is a fundamental flaw in the design of the pyramid for upright use. Most of the abrasive material contained on the pyramid lies at the base which is worn out last during the phase of wear when the variations in thickness of the backing, and other thickness variation sources, prevent a good proportion of the bases from contacting a workpiece surface. When using these large-sized pyramid agglomerates, they are designed to progressively breakdown and expose new cutting edges as the old worn individual abrasive particles are expended as the support binder is worn down, exposing fresh new sharp abrasive particles. Most of the value of the expensive abrasive particles lies in the base, as most of the volume of a triangle is in the base. Here, most of the valuable abrasive particles at the base areas will never be used and are wasted. Further, as wear-down of the pyramids is prescribed by selection of the pyramid agglomerate binder, the level surface of the abrasive disk will vary from the inside radius to the outside radius as the contact surface speed with a workpiece will be different due to the radius affect of a rotating abrasive platen. The pyramids are grossly high compared to the size of abrasive particles or abrasive agglomerates and this height results in uneven wear across the surface of an abrasive article that often is far in excess of that allowable for high speed flat lapping. This uneven wear prevents the use of this type of article for high speed lapping. Inexpensive abrasive materials such as aluminum oxide can be used for the pyramid agglomerates but it is totally impractical to use the extra hard, but very expensive, diamond abrasives in these agglomerates. The flaws inherent in the use of conventional pyramid shaped type of agglomerates, due to the size variations in the agglomerates, would tend to prevent them from being used successfully for flat lapping. First, agglomerates can be made and then sorted by size prior to use as a coated abrasive. Also, the configuration of a generally round shaped conventional agglomerate would certainly wear more uniformly than wearing down a pyramid which has a very narrow spiked top and, after wear-down, a base which is probably ten times more large in cross-sectional surface area than the pyramid top. Random orientation of the pyramid shape does not help this geometric artifact. Another issue is the formulation of the binder and filling used in a conventional agglomerate. A wide range of friable materials such as wood products can be joined in a binder which can be selected to produce an agglomerate by many methods, including furnace baking, etc. The binder used in the production of the pyramids must be primarily selected for process compatibility with the fast cure replication of the drum wells and not for consideration of whether this binder will break down at the desired rate to expose new abrasives at the same rate the abrasive particles themselves are wearing down. It does not appear that this pyramid shaped agglomerate particle has much use for high speed lapping. Use of a polyethylene terephthalete polyester film with a acrylic acid prime coat is described.

U.S. Pat. No. 5,551,961 (Engen) describes abrasive articles made with a phenolic resin applied as a make coat used to secure abrasive particles to the backing by applying the particles while the make coat is in an uncured state, and then, the make coat is pre-cured. A size coat is added. Alternatively, a dispersion of abrasive particles in a binder is coated on the backing. The use of solvents is described to reduce the viscosity of the high viscous resins where high viscosity binders cause "flooding", i.e., excessive filling in between 30 to 50 micrometer abrasive grains. Also, non-homogenous binder resins result in visual defects and performance defects. Both flooding and non-homogenous problems can be reduced by the use of organic solvents, which are minimized as much as possible. Resole phenolic resins experience condensation reactions where water is given off during cross linking when cured. These phenolics exhibit excellent toughness, dimensional stability, strength, hardness and heat resistance when cured. Fillers used include calcium sulfate, aluminum sulfate, aluminum trihydrate, cryolite, magnesium, kaolin, quartz and glass and grinding aid fillers include cryolite, potassium fluoroborate, feldspar and sulfur. Abrasive particles include fused alumina zirconia, diamond, silicone carbide, coated silicone carbide, alpha alumina-based ceramic and may be individual abrasive grains or agglomerates of individual abrasive grains. The abrasive grains may be orientated or can be applied to the backing without orientation. The preferred backing film for lapping coated abrasives is polymeric film such as polyester film and the film is primed with an ethylene acrylic acid copolymer to promote adhesion of the abrasive composite binder coating. Other backing materials include polyesters, polyolefins, polyamides, polyvinyl chloride, polyacrylates, polyacrylonitrile, polystyrene, polysulfones, polyimides, polycarbonates, cellulose acetates, polydimethyl siloxanes, polyfluocarbons, and blends of copolymers thereof, copolymers of ethylene and acrylic acid, copolymers of ethylene and vinyl acetate. Priming of the film includes surface alteration by a chemical primer, corona treatment, UV treatment, electron beam treatment, flame treatment and scuffing to increase the surface area. Solvents include those having a boiling point of 100 degrees C. or less such as acetone, methyl ethyl ketone, methyl t-butyl ether, ethyl acetate, acetonitrile, and one or more organic solvents having a boiling point of 125 degrees C. or less including methanol, ethanol, propanol, isopropanol, 2-ethoxyethanol and 2-propoxyethanol. Non-loading or load-resistant super size coatings can be used where "loading" is the term used in the abrasives industry to describe the filling of spaces between the abrasive particles with swarf (the material abraded from the workpiece) and the subsequent buildup of that material. Examples of load resistant materials include metal salts of fatty acids, urea-formaldehyde resins, waxes, mineral oils, cross linked siloxanes, cross linked silicones, fluorochemicals, and combinations thereof. Preferred load resistant super size coatings contain zinc stearate or calcium stearate in a cellulose binder. In one description, the make coat precursor can be partially cured before the abrasive grains are embedded into the make coat, after which a size coating precursor is applied. A friable fused aluminum oxide can be used as a filler.

U.S. Pat. No. 5,611,825 (Engen) describes resin adhesive binder systems which can be used for bonding abrasive particles to web backing material, particularly urea-aldehyde binders. There is no reference made to forming or abrasive coating abrasive islands. He describes the use of make, size and super size coatings, different backing materials, the use of methyl ethyl ketone and other solvents. Loose abrasive particles are either adhered to uncured make coat binders which have been coated on a backing or abrasive particles are dispersed in a 70 percent solids resin binder and this abrasive composite is bonded to the backing. Backing materials include very flat and smooth polyester film for common use in fine grade abrasives which allow all the particles to be in one plane. Primer coatings are used on the smooth backing films to increase adhesion of the make coating. Water solvents are desired but organic solvents are necessary for resins. Fillers include calcium metasilicate, aluminum sulfate, alumina trihydrate, cryolite, magnesia, kaolin, quartz, and glass. Grinding aid fillers include cryolite, potassium fluroborate, feldspar and sulfur. Backing films include polyesters, polyolefins, polyamides, polyvinyl chloride, polyacrylates, polyacrylonitrile, polystyrene, polysulfones, polyimides, polycarbonates, cellulose acetates, polydimethyl silotanes, polyfluorocarbons. Priming of the backing to improve make coating adhesion includes a chemical primer or surface alterations such a corona treatment, UV treatment, electron beam treatment, flame treatment and scuffing. Solvents include acetone, methyl ethyl ketone, methyl t-butyl ether, ethyl acetate, acetonitrile, tetrahydrofuran and others such as methanol, ethanol, propanol, isopropanol, 2-ethoxyethanol and 2-propoxyethanol. Abrasive filled slurry is coated by a variety of methods including knife coating, roll coating, spray coating, rotogravure coating, and like methods. Resins used include resole and novolac phenolic resins, aminoplast resins, melamine resins, epoxy resins, polyurethane resins, isocyanurate resins, urea-formaldehyde resins, isocyanurate resins and radiation-curable resins. Different examples of make, size and super-size coatings and their quantitative amounts of components were given.

U.S. Pat. No. 5,674,122 (Krech) described screen abrasive articles where the abrasive particles are applied to a make coat of phenolic resin by known techniques of drop coating or electrostatic coating. The make coating is then at least partially cured and a phenolic size coating is applied over the abrasive particles and both the make coat and size coat are fully cured. Make and size coats are applied by known techniques such as roll coating, spray coating, curtain coating and the like. Optionally, a super size coat can be applied over the size coat with anti-loading additive of a stearate such as zinc stearate in a concentration of about 25 percent by weight optionally along with other additives such as cryolite or other grinding aids. In addition, the abrasive coating can be applied as a slurry where the abrasive particles are dispersed in a resinous binder precursor which is applied to the backing by roll coating, spray coating, knife coating and the like. Various types of abrasive particles of aluminum oxide, ceramic aluminum oxide, heat-treated aluminum oxide, white-fused aluminum oxide, silicone carbide, alumina zirconia, diamond, ceria, cubic boron nitride, garnet and combinations of these in particle sizes ranging from 4 to 1300 micrometers can be used.

U.S. Pat. No. 5,733,175 (Leach) describes workpiece polishing machines with overlapping platens that provide uniform abrading velocities across the surface of the workpiece. Hydroplaning of workpieces during abrading action is discussed.

U.S. Pat. No. 5,888,548 (Wongsuragrai et al.) discloses formation and drying of rice starches into 20 to 200 micron spherical agglomerates by mixing a slurry of rice flour with silicone dioxide and using a centrifugal spray head at elevated temperatures.

U.S. Pat. No. 5,910,471 (Christianson et al.) discloses that the valleys between the raised adjacent abrasive composite truncated pyramids provide a means to allow fluid medium to flow freely between the abrasive composites which contributes to better cut rates and the increased flatness of the abraded workpiece surface.

U.S. Pat. No. 5,924,917 (Benedict) describes methods of making endless belts using an internal rotating driven system. He describes the problem of "edge shelling" which occurs on small width endless belts. This is the premature release of abrasive particles at the cut belt edge. He compensates for this by producing a belt edge that is very flexible and conformable. The analogy to this edge shelling occurs on circular abrasive disks also. To construct a belt, an abrasive web is first slit to the proper width by burst, or other, slitting techniques which tends to loosen the abrasive particles at the belt edge when the abrasive backing is separated at the appropriate width for a given belt. These edge particles may be weakly attached to the backing and they may also be changed in elevation so as to stick up higher than the remainder of the belt abrasive particles. Similarly, when a disk is punched out by die cutting techniques from a web section, the abrasive particles located on the outer peripheral cut edge are also weakened. This happens particularly for those discrete particles which were pushed laterally to the inside or outside of the die sizing hole by the matching die mandrel punch. Other types of cutting, slitting or punching abrasive articles from webs also create this shelling problem including water jet cutting, razor blade cutting, rotary knife slitting, and so on. Resole phenolic resins are alkaline catalyzed by catalysts such as sodium hydroxide, potassium hydroxide, organic amines or sodium carbonate and they are considered to be thermoset resins. Novolac phenolic resins are considered to be thermoplastic resins rather than thermoset resins which implies the novolac phenolics do not have the same high temperature service performance as the resole phenolics. Resole phenolic resins are the preferred resins because of their heat tolerance, relatively low moisture sensitivity, high hardness and low cost. During the coating process, make coat binder precursors are not solvent dried or polymerized cured to such a degree that it will not hold the abrasive particles. Generally, the make coat is not fully cured until the application of the size coat which saves a process step by fully curing both at the same time. Fillers include hollow or solid glass and phenolic spheroids and anti-static agents including graphite fibers, carbon black, metal oxides, such as vanadium oxide, conductive polymers, and humectants are used. Abrasive material encompasses abrasive particles, agglomerates and multi-grain abrasive granules. Belts are produced by this method using a batch process. The thermosetting binder resin dries, by the release of solvents, and in some instances, partially solidified or cured before the abrasive particles are applied. The resin viscosity may be adjusted by controlling the amount of solvent (the percent solids of the resin) and/or the chemistry of the starting resin. Heat may also be applied to lower the resin viscosity, and may additionally be applied during the processes to effect better wetting of the binder precursor. However, the amount of heat should be controlled such that there is not premature solidification of the binder precursor. There must be enough binder resin present to completely wet the surface of the particles to provide an anchoring mechanism for the abrasive particles. A film backing material used is PET, polyethylene terephthalate having a thickness of 0.005 inch (0.128 mm). Solvents used include trade designated aromatic 100 and Shell® CYCLO SO 53 solvent.

U.S. Pat. No. 6,017,265 (Cook et al.) discloses abrasive slurry polishing pads that are used for polishing integrated circuits. He references polishing pads that are not highly flat and have variations in thickness where portions of the workpiece will not be in contact with the pad which gives rise to non-uniformities in the shape of the workpiece surface. A desirable thickness variation in these polishing pads is less the 0.001 inch (25 micrometers) in order to improve the uniformity of the polishing process.

U.S. Pat. No. 6,099,390 (Nishio et al.) discloses abrasive slurry polishing pads having raised and recessed surfaces that are used for polishing semiconductor wafers. He references polishing pads that are used to polish semiconductors having level differences on the surface of the semiconductor wafer that are at most 1 to 2 micrometers.

U.S. Pat. No. 6,186,866 (Gagliardi) discloses the use of an abrasive article backing contoured by grinding-aid containing protrusions having a variety of peak-and-valley shapes. Abrasive particles are coated on both the contoured surfaces of the protrusions and also onto the valley areas that exist between the protrusion apexes. The protrusions present grinding aid to the working surface of the abrasive article throughout the normal useful life of the abrasive article. Useful life of an abrasive article begins after the abrasive particle coating that exists on the protrusion peaks is removed, which typically occurs within the first several seconds of use. Initial use, which occurs prior to the "useful life", is defined as the first 10% of the life of the abrasive article. Protrusions contain a grinding aid, with the protrusions preferably formed from grinding aid alone, or the protrusions are a combination of grinding aid and a binder. The protrusion shapes have an apex shape that is coated with an adhesive resin and abrasive particles. The particles are drop coated or electrostatically coated onto the resin and thereby form a layer of abrasive particles conformably coated over both the peaks and valleys of the protrusion shapes. The primary objective of the protrusion shapes is to continually supply a source of grinding aid to the abrading process. There are apparent disadvantages of this product. Only a very few abrasive particles reside on the upper-most portions of the protrusion peaks and it is only these highest-positioned particles that contact a workpiece surface. The small quantity of individual particles contacting a workpiece, which are only a fraction of the total number of particles coated on the surface of the abrasive article, will be quickly worn down or become dislodged from the protrusion peaks. Particles would tend to break off from the protrusion wall surfaces, when subjected to abrading contact forces, due to the inherently weak resin particle bond support at individual particle locations on the curved protrusion walls. Abrasive particles are very weakly attached to the sloping sidewalls of the protrusions due to simple geometric considerations that make them vulnerable to detachment. It is difficult to bond a separate abrasive particle to a wall-side with a resin adhesive binder that does not naturally flow by gravity and symmetrically surrounds the portion of the particle that contacts the wall surface. Abrasive particles attached to a traditional flat-surfaced abrasive backing sheet article tend to have a symmetrical meniscus of resin surrounding the base of each particle but this configuration of meniscus would not generally form around a particle attached to a near vertical protrusion side-wall. Also, the protrusion side-wall is inherently weak as the protrusion body is constructed of grinding aid material. Much of the valuable superabrasive particles located in the valley areas are not utilized with this technique of particle surface conformal coating of both protrusion peaks and valleys. As the abrading action continues, with the wearing down of the erodible protrusions, more abrasive particles are available for abrading contact with a workpiece article. However, the advantage of having protrusion valleys, that are used to channel coolant fluids and swarf, disappears as the valleys cease to exist. The procedure cited for testing the protrusion contoured abrasive article cited the use of a 7 inch (17.8 cm) diameter disk operated at approximately 5,500 rpm indicating an intended high surface speed abrading operation.

FIG. 29 (Prior Art) is a cross section view of the Gagliardi U.S. Pat. No. 6,186,866 abrasive coated raised island protrusion structures. The protrusions 254 that are attached to a backing sheet 256 are coated with abrasive particles 252. There is no description of precisely controlling the height of the abrasive or of the protrusions as measured from the backside of the backing 256.

FIG. 30 (Prior Art) is a cross section view of rectangular-walled Gagliardi U.S. Pat. No. 6,186,866 abrasive coated raised island protrusion structures. The protrusions 258 that are attached to a backing sheet 264 are coated with abrasive particles 260. There is no description of precisely controlling the height of the abrasive or of the protrusions as measured from the backside of the backing 256 as shown by the dimension 262.

U.S. Pat. No. 6,217,413 (Christianson) discloses the use of phenolic or other resins where abrasive agglomerates are drop coated preferably into a monolayer. Leveling and truing out the abrading surface is performed on the abrasive article, which results in a tighter tolerance during abrading.

U.S. Pat. No. 6,231,629 (Christianson, et al.) discloses a slurry of abrasive particles mixed in a binder and applied to a backing sheet to form truncated pyramids and rounded dome shapes of the resin based abrasive particle mixture. Fluids including water, an organic lubricant, a detergent, a coolant or combinations thereof are used in abrading which results in a finer finish on glass. Fluid flow in valleys between the pyramid tops tends to produce a better cut rate, surface finish and increased flatness during glass polishing. Presumably, these performance advantages would last until the raised composite pyramids or domes are worn away. Abrasive diamond particles may either have a blocky shape or a needle like shape and may contain a surface coating of nickel, aluminum, copper, silica or an organic coating.

U.S. Pat. No. 6,299,508 (Gagliardi et al.) discloses abrasive particle coated protrusions attached to a backing sheet where the protrusions have stem web or mushroom shapes with large aspect ratios of the mushroom shape stem top surface to the stem height. A large number of abrasive particles are attached to the vertical walls of the stems compared to the number of particles attached to the stem top surface. Abrasive discs using this technology range in diameter from 50 mm (1.97 inches) to 1,000 mm (39.73 inches) and operate up to 20,000 revolutions per minute. As in Gagliardi, U.S. Pat. No. 6,186,866, the abrasive article described here does not provide that the attachment positions of the individual abrasive particles are in a flat plane which is required to create an abrasive article that can be used effectively for high surface speed lapping.

U.S. Pat. No. 6,312,315 (Gagliardi) discloses abrasive particle coated protrusions that are attached to a backing sheet. The protrusions are formed on a backings, an adhesive make coat binder is coated on the protrusions and abrasive particles are deposited on the binder. Size and supersize coats of the same binder are applied on the abrasive particles to structurally reinforce the particles.

U.S. Pat. No. 6,319,108 (Adefris, et al.), herein incorporated by reference, discloses the electroplating of composite porous ceramic abrasive composites on metal circular disks having localized island area patterns of abrasive composites that are directly attached to the flat surface of the disk. Glass-ceramic composites are the result of controlled heat-treatment. The pores in the porous ceramic matrix may be open to the external surface of the composite agglomerate or sealed. Pores in the ceramic mix are believed to aid in the controlled breakdown of the ceramic abrasive composites leading to a release of used (i.e., dull) abrasive particles from the composites. A porous ceramic matrix may be formed by techniques well known in the art, for example, by controlled firing of a ceramic matrix precursor or by the inclusion of pore forming agents, for example, glass bubbles, in the ceramic matrix precursor. Preferred ceramic matrixes comprise glasses comprising metal oxides, for example, aluminum oxide, boron oxide, silicone oxide, magnesium oxide, manganese oxide, zinc oxide, and mixtures thereof. A preferred ceramic matrix is alumina-borosilicate glass. The ceramic matrix precursor abrasive composite agglomerates are furnace-fired by heating the composites to a temperature ranging from about 600 to 950 degrees C. At lower firing temperatures (e.g., less than about 750 degree C.) an oxidizing atmosphere may be preferred. At higher firing temperature (e.g., greater than about 750 degree C.) an inert atmosphere (e.g., nitrogen) may be preferred. Firing converts the ceramic matrix precursor into a porous ceramic matrix. An organic size coat comprising resole phenolic resin (the resole phenolic was 78% solids in water and contained 0.75-1.8% free formaldehyde and 6-8% free phenol), tap water, silane coupling agent and a wetting agent may be coated over the ceramic abrasive composites and the metal coatings on an abrasive article. Individual diamond particles contained in the composites have metal surface coatings including nickel, aluminum, copper, inorganic coatings including silica or organic coatings. Composite abrasive agglomerates sink through an electroplating solution and land on a conductive backing where they are surrounded by plated metal that bonds the agglomerates to the backing surface. A polymer size coat can be applied over the agglomerates to strengthen the bond attachment of the agglomerates to the backing. Composites may have a mixture of different sizes and shapes but there is a stated preference that the abrasive composites have the same shape and size for a given abrasive article. Diamond particles were mixed with metal oxides to form an aqueous slurry solution that was coated into cavities, solidified, removed from the cavities and at 720 degrees C.

U.S. Pat. No. 6,371,842 (Romero), filed Jun. 17, 1993 describes raised island abrasive disk articles having flat top island surfaces that are adhesive coated and abrasive particles are deposited onto the adhesive. Romero uses the raised island disk article to address a specific disk construction problem that occurs with those specific abrasive disks that were fabricated by applying a coat of resin adhesive to the full flat surface of a circular backing disk and then depositing abrasive particles onto the resin. This disk production technique of uniformly coating the whole circular disk flat surface with resin tended to produce an undesired raised adhesive resin bead that is located at the outer edge of the disk. The raised resin bead extended around the full outer radial periphery of the disk. When abrasive particles were deposited on the disk resin adhesive, those particles that were located on the top surface of the raised outer periphery adhesive bead were uniquely higher in elevation than were the remainder of those deposited abrasive particles that were located at the interior portion of the disk on the portion of the abrasive disk. Having elevated abrasive particles around the circumference of the disk was undesirable as these elevated beads tended to scratch the surface of a workpiece when the abrasive disk was first used.

Like Maran in U.S. Pat. No. 3,991,527 Romero embossed flat substrates to form flat topped raised island structures that had indented openings under each raised island where the bottom mounting side surface of the backing substrate remained substantially planar even with the pattern of indented openings. Because Romero started with flat fiberboard substrates as did Maran, the embossing action produced individual raised island structures that had flat top island surfaces that were of the same thickness as the base fiberboard substrate that was embossed. However, each embossed raised island structure also had a corresponding indentation or open hole area directly below the raised island top surface. This open area occurred because the localized flat substrate fiberboard material was pushed upward by the embossing tool from the flat bottom planar location to the raised island top position. As the flat fiberboard substrate is of substantial thickness and material strength, the flat top surface of the embossed raised island structure is also flat and has substantial strength enough to support abrasive particles in an abrading operation. For both Maran and Romero, the top surfaces of all of the embossed raised islands can be positioned in a substantially co-planar location. Likewise, for both Maran and Romero, the bottom mounting surface of the embossed fiberboard backing disk is also a substantially planar surface as it comprises a embossed flat substrate similar to a paper sheet that is embossed.

To solve this problem of producing a raised resin bead at the peripheral circumference of the abrasive disk Romero provided an abrasive disk that has a pattern of flat surfaced raised island structures where only the island surfaces are coated with a resin adhesive and abrasive particles are then deposited on the island resin. Because Romero applied his resin adhesive only at individual island spot areas on the disk he did not apply a uniform coating of resin adhesive across the full surface area of the disk and thereby avoided the creation of the raised resin bead around the full circumference of the circular disk. After the resin was applied at the island sites he then deposited abrasive particles onto the adhesive resin.

His islands were positioned to provide recessed areas between the individual islands and also to provide a recessed gap area between the raised island structures and the outer diameter of the disk around the full outer periphery of the abrasive disk. There was no resin applied to the flat recessed non-island areas of the disk backing either between the islands or at the outer periphery of the disk.

Romero's construction of an abrasive disk by coating discrete island areas on a disk backing with an adhesive and then depositing abrasive particles on these adhesive island areas is similar to the construction of raised island abrasive disks as described in many other patents including: U.S. Pat. No. 794,495 (Gorton), U.S. Pat. No. 1,657,784 (Bergstrom), U.S. Pat. No. 1,896,946 (Gauss), U.S. Pat. No. 1,924,597 (Drake), U.S. Pat. No. 1,941,962 (Tone), U.S. Pat. Nos. 2,001,911 and 2,115,897 (Wooddell et. al), U.S. Pat. No. 2,108,645 (Bryant), U.S. Pat. Nos. 2,242,877, 2,252,683 and 2,292,261 (all by Albertson), U.S. Pat. No. 2,520,763 (Goepfert et al.), U.S. Pat. No. 2,755,607 (Haywood), U.S. Pat. No. 2,907,146 (Dynar), U.S. Pat. No. 3,048,482 (Hurst), U.S. Pat. No. 3,121,298 (Mellon), U.S. Pat. No. 3,495,362 (Hillenbrand), U.S. Pat. No. 3,498,010 (Hagihara), U.S. Pat. No. 3,605,349 (Anthon), U.S. Pat. No. 3,991,527 (Maran), U.S. Pat. No. 4,106,915 (Kagawa, et al.), U.S. Pat. No. 4,111,666 (Kalbow), U.S. Pat. No. 4,256,467 (Gorsuch), U.S. Pat. No. 4,863,573 (Moore and Gorsuch), U.S. Pat. No. 5,318,604 (Gorsuch et al.), U.S. Pat. No. 5,174,795 (Wiand), U.S. Pat. No. 5,190,568 (Tselesin), U.S. Pat. No. 5,199,227 (Ohishi), U.S. Pat. No. 5,232,470 (Wiand), U.S. Pat. No. 6,299,508 (Gagliardi et al.). These patents describe adhesive resin that is applied at discrete island sites with the result of avoiding the buildup of a raised bead of resin at the outer periphery of the abrasive disk. Application of the resin at only these island spot areas is a logical solution to the problem of the raised resin bead at the periphery of the disk.

Those prior art abrasive disks listed here have a recessed gap between all of or many of the raised islands and the outer periphery of the circular disk. The recessed areas between the raised islands were described in many of the referenced inventions as providing passageways that are useful for removing grinding debris and cuttings from contact with a workpiece. The recessed passageways also allow the debris and cuttings to thrown off the abrasive disk by centrifugal forces that are present due to the rotation of the disk during an abrading action. Further it was described in U.S. Pat. No. 2,242,877 (Albertson) where debris and cuttings could be thrown off the raised island disks even when the raised islands form a continuous ring that is positioned at the outer periphery of the disk and is concentric with the circular disk circumference, similar to the disk peripheral raised islands as described in U.S. Pat. No. 5,174,795 (Wiand). Here the cuttings that accumulated in the recessed passageways are thrown off the disk when the outer periphery of the abrasive disk is not in contact with the workpiece. However, Romero states that his recessed areas do not participate in the grinding which indicates that he is not concerned with providing recessed areas that could route grinding debris away from the interface between the abrasive material and the workpiece surface where it could scratch the workpiece surface. Likewise he does not teach the advantages of the recessed areas between the raised islands providing a disk-cleansing action passageway where the grinding debris could be thrown from the abrasive disk proper by centrifugal forces that are generated by the disk rotation. Radial blockage of the debris movement by a abrasive disk peripheral raised island wall as described in U.S. Pat. No. 5,174,795 (Wiand) therefore is not a disk performance issue for Romero.

Each of the referenced prior art raised island disks were "substantially flat" and had individual raised island structures that had top surfaces that were coated with abrasive particles.

None of the prior art raised island disks had abrasive coated raised islands that had a precision controlled thickness abrasive disk articles. There simply was no recognized need for the precision thickness control of the disk articles for the grinding applications that these prior art disks were used for at the time that the disk articles were originated. Persons skilled in the art had not identified the need for the precision thickness control for raised island disks (described here for the present invention) at the time of the present invention.

In those instances where water was used as a coolant, the flatness accuracy was not an issue when using these prior art disks as there was no apparent attempt made by the Inventors to simultaneously provide the combination of precision-flat workpiece surfaces and the highly polished surfaces that are required for flat-lapping. Surface finishes provided by the conventional abrading systems were adequate for the intended use of the conventional workpieces that were abraded by these conventional abrading disk systems. However, these same surface finishes were not acceptable for specialty high quality precision flat-lapped workpieces.

Prior to this invention, hydroplaning of workpieces in the presence of coolant water using continuous abrasive bead coated flexible disks during high speed flat lapping was not identified as the cause of non-flat precision workpieces. This relationship was not identified because of a number of critical components first all had to be individually recognized and then utilized together to create a practical total system that could successfully and efficiently flat lap hard workpiece material at high abrading speeds. These critical components include a sturdy, precise and pressure controllable lapping machine having a rotatable and (preferably an off-set) spherical action workpiece holder. Also included here is a rotary platen having a vacuum abrasive disk attachment systems and precision flatness over a wide range of speeds. Further, the system requires the use of precision thickness abrasive disks having annular bands of abrasive bead coated flat surfaced raised island structures in the presence of coolant water. Together these critical components can be used to high-speed flat-lap hardened workpieces to provide these workpieces with surfaces that are both precisely flat and also are smoothly polished. This high speed flat lapper system produces flat lapped workpieces more conveniently, at less expense, with a cleaner process and much faster than the competitive slurry lapping system.

Determining that workpiece hydroplaning was a significant issue in causing non-flat workpiece surfaces would not have been obvious to a typical person skilled in the art of abrading at the time unless he/she had progressively eliminated all of the other potential causes first. Providing a suitable lapping machine and suitable workpiece holders here eliminated these potential causes. Providing precision flat surfaced and stable platens with a vacuum disk attachment system here eliminated these potential causes. Providing precision thickness flexible abrasive disks here having annular bands of raised island structures that are coated with monolayers of abrasive particle filled beads eliminated these potential causes. Use of precision thickness raised island abrasive disks alone without the use of the other identified critical components of this high speed lapper system will not produce precision flat lapped workpieces. Success of the high speed lapper system ultimately resulted from these incremental and logical steps that all occurred individually (and collectively) as described here. The quest of providing high speed flat lapping was clearly recognized but the implementation required significant development efforts.

Raised island abrasive disks that are described by Romeo typically have a disk-center aperture hole that allows the disk to be mounted onto a grinding-equipment arbor, or mandrel, with the use of a threaded screw cap that penetrates the abrasive disk aperture hole. When the screw cap is tightened on the mandrel, or arbor, the abrasive disk is deformed at the disk center sufficiently that the enough friction is developed between the mandrel and the abrasive disk that the abrasive disk becomes firmly attached to the mandrel, or arbor. Each typical metal mandrel has a center shaft that allows the mandrel-abrasive disk assembly to be attached to a rotatable tool that is typically a manually operated tool. The metal mandrel tool has a circular stiff flat rubber backing pad that is positioned flat between the abrasive disk and the metal mandrel tool body. The rubber pad allows the workpiece-contacting portion of the flat abrasive disk to be distorted into a position where this disk-portion lays flat against the workpiece surface when the "flat" abrasive disk is forced at an angle against the flat workpiece surface as the mandrel is rotated. Romero incorporates by reference U.S. Pat. No. 5,142,829 (Germain), which describes a variety of types of non-circular abrasive sheet shapes, but again, all of Germain's disks also have center aperture holes for use on a mandrel tool. Romero does not disclose the use of abrasive articles that do not have a disk-center aperture hole. He also does not disclose how any non-aperture hole abrasive disks would be mounted on abrading equipment for abrading use. However, his claims only reference the use and manufacture of raised island abrasive articles that do not have the disk-center aperture holes that he describes in the Specification.

The raised island abrasive hand-tool disks disclosed by Romero are intended to correct a specific problem that occurs in typical non-island disk manufacturing. Here, where preformed circular shaped disk backings are coated with an adhesive binder resin, the binder has a tendency to collect at the outer peripheral disk edge to form a raised narrow high lip circumferential bead of binder coating on the disk backing. This peripheral narrow bead of binder is raised in elevation relative to the remainder of the binder resin that is uniformly coated on the inner flat portion of the backing disk. The radial width of the raised narrow bead of binder that is located only at the outer circumference of the disk is small in comparison to the radial width of the non-raised resin that is coated on the inner radial surface area of the disk. After the binder resin is coated on the flat surface of the disk backing, abrasive particles are deposited onto the binder resin coated surface of the disk, including on the raised high lip bead of binder that exists at the outer periphery of the disk. The binder resin bonds the abrasive particles to the disk backing. The abrasive particles that are attached to the raised circumferential bead lip have a higher elevation than those abrasive particles that are located at the flat inner radial portion of the disk. This raised elevation bead that is coated with abrasive particles causes undesirable workpiece surface scratches and gouges during abrading use. Here, this narrow bead band of raised abrasive particles contacts a workpiece before those abrasive particles located at the inner radial portion do. To prevent the formation of the raised abrasive high lip on a circular disk backing that is resin binder coated and then abrasive particle coated Romero uses a disk that has individual raised island structures that are attached to a circular disk backing. The raised island structures are binder resin coated with the application of abrasive particles to the binder resin. The use of abrasive coated raised island structures that are attached to a backing sheet reduces the formation of the raised abrasive peripheral edge lips on manual hand-tool grinding disk articles.

FIG. 15 (Prior Art) is a top view of a Romero U.S. Pat. No. 6,371,842 described abrasive disk that has an outer periphery polymer adhesive make-coat raised band. The disk 130 has a disk-center aperture hole 134 and a raised polymer peripheral band 132 where both the flat surface of the disk 130 and the outer band 132 are surface coated with abrasive particles 140.

FIG. 16 (Prior Art) is a cross section view of a Romero U.S. Pat. No. 6,371,842 described abrasive disk having a raised polymer band on the outer periphery of the disk. The disk backing 144 has a coating of polymer adhesive 142 that is generally flat across the inner surface of the disk but the polymer adhesive 142 has a outer periphery raised-bead edge 138 where all the adhesive 142 in both the disk 144 flat inner area surface and the top surface of the bead edge 138 has a coating of abrasive particles 136.

FIG. 17 (Prior Art) is a top view of a Romero U.S. Pat. No. 6,371,842 described disk having abrasive coated raised islands. The disk 152 has a center aperture hole 150 and a number of abrasive particle coated raised island structures 148 that are positioned radially on the disk 152 where the inner radius position of all the raised islands 148 have a common island 148 end-position inner radial location diameter 146. The radial islands 148 each have a radial length that is somewhat less than the radius of the disk 152. No teaching is included of the advantage of having the radial islands 148 having a minimum position diameter 146 to reduce the large change of surface cutting speeds of the radial disk from the inner radius portions of the radial islands 148 to the outer radius portions of the radial islands 148. Romero focuses on an abrasive article that has raised islands where there are gap spaces between the islands and the outer periphery of the backing sheet. His use of abrasive coated raised islands that are positioned a gap-distance away from the peripheral edge of the backing sheet is a solution to the addressed problem of the raised peripheral edge bead of abrasive particle coated resin. He does not disclose abrasive articles where the raised islands are positioned directly at the outer periphery of the abrasive article backing sheet without a gap between the raised islands and the backing sheet. His abrasive islands also are adhesive coated on the top island surface only and abrasive particles are drop coated on the island adhesive coated surfaces to form abrasive particle coated islands, and where the recessed valley areas between the raised islands do not have abrasive particles. No other raised island abrasive particle coating techniques, such as applying an abrasive resin slurry directly onto the island top surfaces, are described The Romero abrasive disk articles described are not suggested for nor is awareness indicated for their use in flat lapping or in flat grinding where the disks would be mounted on a flat surfaced rotary platen. Instead the articles are taught to be mounted on hand tool mandrels by the use of mechanical fasteners that penetrate an aperture hole located at the center of the circular disk. No mention or teachings are made of the art of precision flat grinding, or lapping, of flat workpiece surfaces or of using these island disks in that abrasive application area. Also, there is no mention of the precision control of the variation in the thickness of the abrasive disk articles or the use of the precision flatness grinding or lapping machines that are required to produce precise flat workpiece surfaces. There is no mention of the desirability of the existence of a mono (single) layer of coated abrasive particles; or of controlling the variation of the thickness of the abrasive article to a proportion of the diameter of the coated abrasive particles. Further, no mention is made of the problems of hydroplaning of disks or workpieces.

Romero does not teach the advantages or requirements of providing raised islands having top flat surfaces to be parallel to the flat mounting surface of the flat disk backing. However, in one example, he does form raised islands that do have flat top surfaces by die cutting island structure pieces from flat sheets of backing material and adhesively attaching these individual island structure pieces to a disk backing. Here, he does not teach that the height of the top flat surface of each (or even the majority of) die-cut island is to be positioned to be precisely equal relative to the mounting surface of the flat disk backing sheet. Also, there is no discussion of directly or indirectly controlling that the flat areas of the raised islands are individually positioned to be parallel to the mounting surface of the flat disk backing. Further, he does not teach the requirement that the top surfaces of his raised islands lie in a plane or even in a "substantially co-planar surface" in his Specifications descriptions. The only place where he refers to the raised islands being positioned to have "substantially co-planar" features of both un-coated raised islands and abrasive coated raised islands is in his Claims. These "substantially co-planar" surfaces of the raised islands are not taught to be parallel to the flat mounting surface of the disk backing sheet. Here, it is possible to construct an abrasive disk where the top surfaces of all the raised islands are co-planar but yet the island co-planar surface is tilted or angled relative to the disk-backing bottom mounting surface. If the planar group of islands is tilted relative to the backing, those islands on the abrasive disk that are the highest, as measured from the disk backing mounting surface, would be the only islands that contact a workpiece when the disk is rotated at high speeds. An abrasive disk having this island-tilted construction where the island tops are not parallel to the disk mounting surface would not be useful for precision high speed lapping procedures.

As a matter of reference, when the top surface of raised island structures are precisely height controlled, where the height is measured from the island top to the flat mounting surface of a disk backing sheet, to within a small portion (typically 10% or less) of the average size of the abrasive particles or abrasive agglomerates that are coated on the abrasive disk, then the height of the island is thereby controlled sufficiently well that the raised island abrasive disk can be used successfully in high speed lapping procedures. The size of abrasive particles or abrasive agglomerates typically used in high speed lapping is approximately 0.002 inches (50 micrometers) which requires that the raised island top surfaces be height controlled to with 0.0002 inches (5 micrometers) or less for this type of high speed lapping disk. If all or most of the individual raised islands are height controlled within the precision of 10% of the size (or diameter) of the abrasive agglomerates then all of the raised islands can be considered to be "located" within a common plane, and further, that this common plane is parallel (not tilted) to the back mounting surface of it's disk backing. The reason that these islands are considered to be "located" within a common plane is judgmental because it is not possible to exactly locate all of the island tops mathematically in a perfect plane because each island is going to be somewhat different in height due to manufacturing and measurement inaccuracies. By specifying the location of raised island heights to not have variations of greater than a specified percentage of the average size of the abrasive particles or abrasive agglomerates, then the allowable variation in height of the raised islands is defined as to how close an island top has to be to a theoretical plane for all islands to be considered to be in the plane or to be co-planar. Conversely, large particles can be used and the location tolerance can be arbitrarily set at a multiple of the particle size (say, 200%) which means that there can be a wide variation in the heights of the islands and they still would be defined as "co-planar". However, from an abrading usage standpoint, if the islands have a wide range of heights relative to the size of the abrasive particles or agglomerates, many of the abrasive disk abrasive particles would not contact a workpiece surface when the abrasive disk is rotated at high speeds. Only those abrasive particles that have the greatest heights would contact a workpiece near-flat surface even though the abrasive islands of this disk were considered "co-planar". To provide abrasive lapping disks having raised islands with this desired accuracy (0.0002 inches or less) of island height variation control requires very precisely controlled abrasive disk manufacturing procedures. There is no teaching by Romero of the use of these types of precision manufacturing processes to construct his raised island abrasive disks having this lapping-required precision height control.

In his examples, he used large individual (non-agglomerate) 50 Grade abrasive particles that have a size of 0.014 inches (351 micrometers). His large abrasive particles do not require precise control of the height of the island structures to provide an abrasive disk that is acceptable for manual hand-tool rough grinding but the same disk is not useful for lapping because of the excessive abrasive particle size. Lapping typically requires the use of very small abrasive particles or the use of abrasive agglomerates that are approximately 0.002 inches (50 micrometers) in size where these small agglomerates are filled with tiny abrasive particles that are typically only 3 micrometers (0.00012 inches) in size. Here, the large abrasive particles used by Romero in his rough grinding abrasive disks are approximately 100 times larger (0.014 inches compared to 0.00012 inches) than those used in abrasive disks typically that are used in flat lapping process procedures. If he used abrasive particles or agglomerates that were only 50 micrometers (0.002 inches) in size, it would be necessary to precisely control the height of the islands and the abrasive coating so that these small abrasive particles would be effectively utilized in a high speed abrading process. Those small abrasive particles that were recessed from the uppermost portion of the un-even portion of the abrasive disk because of lack of precision control of the particle height, where the height is measured from the top of the particle to the backside of the disk backing sheet, would not contact a workpiece surface when the abrasive disk is mounted on a precisely flat rotating platen.

In Romero, there is no reference given for the use of the island type abrasive articles to be used for creating precision flat workpiece surfaces or precise smooth workpiece surfaces as in a flat-lapping operation. Flat lapping requires extremely flat abrasive disk machine tool platens and the abrasive disk article also must be precisely flat and of uniform thickness to enable all of the coated abrasive particles to be utilized. Further, there is no mention of the advantages of arranging the raised islands in an annular array having a narrow outer radius annular band width of abrasive to avoid having the slow moving abrasive surfaces that are located at the inner diameter area of a disk, to be in contact with a workpiece surface. Uneven wear occurs across the surface of a workpiece when the workpiece is in contact with an abrasive article abrading surface that has both fast and slow surface speeds. Reduced workpiece material removal occurs at the inner diameter area of an abrasive disk, which is slow moving, while the majority of the material removal occurs at the outer diameter area of the disk, which has the highest surface speed area.

Romero's abrasive disks are thick, tough, and strong. They have significant amounts of fibers and other fillers imbedded in the disk backing which tends to produce a disk of limited thickness uniformity. The preferred embodiment of Romeo is a thick fiber filled disk backing. These thick and very stiff abrasive disks generally require "flexing" after manufacturing where portions, or all of, the disk is bent through a out-of-plane angle sufficient that the thick disk is fractured, resulting in many small cracks through the disk thickness. The crack-fractured disk is weaker structurally than a non-cracked disk and has less disk article stiffness, thereby providing a more flexible disk that can more readily conform to a workpiece surface. The backings used for the Romero disks are not as thick as the traditional disk backings and he states that it is not necessary to do the Flex-bending" of his raised island disks to provide a disk having sufficient flexibility. He states that thin backings, having a backing thickness of from 100 micrometers (0.004 inches) to 2500 micrometers (0.100 inches) are too thin and backings of such thickness will easily rip and tear and also can crease and pucker easily when used in his abrading application.

Romero teaches in the Specification about raised island abrasive disks that are intended for use with manual grinding tool mandrel (or manual grinding arbor tool) assemblies where the disk is mounted to the mandrel with a threaded mechanical fastener devise that penetrates the disk aperture hole (or holes) located at the center of the abrasive disk. The described mandrel-type sanding or grinding assemblies are constructed with a flexible rubber support pad disc, a flexible backup disc and a threaded fastener cap that is used to attach his raised island abrasive disk to a mandrel that is rotated to perform a sanding or grinding operation. When his abrasive disk is held in contact with a workpiece surface, the abrasive disk, the rubber disc pad and the backup disc assembly flex radially to present the assembly as a curved abrasive surface to a workpiece. This means that his raised island abrasive surfaces are presented at an angle to the workpiece surface. When the rigid abrasive islands contact a workpiece at an angle, only the leading edge of the islands contact the workpiece. This is a point-contact of the abrasive island with the workpiece. Here when the raised island structure is in angled contact with the workpiece, any abrasive particle that is located at the leading edge of the island structure will tend to be quickly knocked off from the raised island structure. This occurs because of the large localized abrading contact forces that are concentrated on the individual abrasive particles that reside on the leading edge of the island structure. He references the use of very large 1.0 inch (2.54 cm) diameter raised islands having islands heights of 0.030 inches (0.76 mm). These islands are very stiff structures, relative to a thin backing, that will not easily flex to conform to the abrasive disk radial bending action that is experienced in typical abrading procedures. This lack of flexure of the individual raised island structures prevents the simultaneous utilization of all the abrasive particles on the top surfaces of the islands. Use of very large individual abrasive particles is helpful to compensate for the stiff islands as these large particles can extend upward with sufficient height to contact a workpiece when the leading-edge particles become worn down.

Also, the use of very stiff backings that will force the bending of the stiff islands when the abrasive article is subjected to very large abrading contact forces can improve utilization of individual abrasive particles that are attached over the whole island surface areas. The 13.2 lb (6 kg) abrading contact forces typically used for 7 inch (17.8 cm) raised island disk grinding is very excessive compared to the typical contact forces used for abrasive lapping with 12 inch (30 cm) raised island abrasive disks. There is no flexural deflection of raised island disks, or flexing of the individual raised island structures, in lapping as these disks are supported on rigid flat platens having disk-mounting surfaces that do not flex as they rotate. The contact of the abrasive particles that are located on the edge of the islands with a workpiece surface will create the same undesirable scratches and gouges that Romero was trying to avoid with this type of abrasive article. Raised island abrasive articles are designed to be mounted to precision-flat platens when used for precision high speed flat lapping procedures. He does not describe the manufacture of, or abrading use of, non-aperture-hole raised island abrasive disks. Non-aperture-hole disks typically can be mounted to a flexible pad type mandrel with adhesives or mechanical hook-and-loop fasteners but these or other alternative fastening devices are not discussed. Non-aperture-hole disks typically can be mounted to a rigid flat platen by vacuum hold-down systems or with adhesives or mechanical hook-and-loop fasteners but these or other alternative fastening devices are also not discussed.

FIG. 13 shows a flexible disk having abrasive coated raised islands where the disk is mounted on a rotatable arbor and where a portion of the disk is in contact with the flat surface of a workpiece. FIG. 14, FIG. 18 and FIG. 19 shows the leading edges of individual abrasive coated raised islands in angled contact with workpieces. FIG. 25 and FIG. 26 show the uneven abrading contact pressure of manual grinder flexible arbor mounted abrasive disks with flat workpiece surfaces.

With the Romero abrasive disks, the amount of workpiece material removal is of primary concern, rather than controlling the flatness of the workpiece. This type of grinding disk generally would have large sized abrasive particles that are not suitable for polishing or lapping operations. The described abrasive disk is frictionally mounted to a flexible backup pad that is attached to a mandrel with a disk-center-screw-cap that penetrates the disk-center aperture hole and squeezes the disk against the flexible and conformable metal or polymer backup pad. The screw-cap mounting forces result in significant and uneven distortions of both the abrasive disk sheet and the backup pad prior to the moving abrasive contacting a workpiece. Mounting a thin and fragile 0.004 inch (100 micrometer), or less, thick polymer abrasive island backing sheet to a manual abrading tool with a disk-center screw flange to a flexible padded mandrel can easily crease or tear the thin polymer backing in the area of the flange screw where large localized distortions of the backing can take place. Tearing of these thin disk sheets can occur at the outer radius location on a abrasive disk article particularly as the outer radial portions of the thin backing sheet are not attached to the stronger flexible abrasive tool disk pad that is used as a back-up support for the compressive forces (only) that are applied to the abrasive disk article. Abrasive disks used on these types of manual or machine abrasive tools encounter large tangential forces when contacting a workpiece during abrasion action and there is little strength in the independent loose fitting thin disk backings to resist these tangential forces. Grinding disks having thick fiber-reinforced backing sheets can easily resist these large tangential abrading contact forces as these thick disks are very strong in a tangential direction. Also, tearing of thin backing sheet disks would tend to occur at the disk center. Here, the thin disk is attached at the disk center aperture hole area only where a flat surfaced internally threaded attachment nut, or threaded attachment cap, holds the disk in pressure contact with the abrasive tool flexible back-up pad.

Frictional contact between the disk sheet and the attachment nut occurs at only the small outer radial surface area of the diameter of the nut. The outside-flat surfaced nut is tightened by manually rotating the abrasive disk, and the nut, against the manual tool hold-down screw post, which is temporarily held stationary during this disk mounting procedure. Only a very narrow annular band of the flexible and fragile thin abrasive disk at the disk center is in contact with the nut inside annular surface, which, in itself, is not necessarily flat. When the abrasive disk attachment nut inside annular surface is not flat, or the abrasive disk nut-contact annular surface is pressured into a location not parallel with the plane of the abrasive tool flexible mounting pad, the flexible abrasive disk is distorted into a out-of-plane configuration, particularly at the location of the disk center. Out-of-plane distortions that are localized can create stress-risers within the thickness of the disk sheet. These stress risers can multiply any backing material stresses due to abrading forces that are transmitted to this critical center area of the disk, where the disk is attached to the abrasive tool. The narrow annular band of the abrasive disk that is in contact with nut is then subjected to a significant portion of the mounting nut tightening torque force when the disk is attached to the tool, depending how the tightening force is applied to the abrasive disk. Tightening of the nut progresses until the resulting mounting nut disk center compressive force is significantly high to compress and distort the abrasive tool thick flexible backing pad sufficiently to provide a secure attachment of the disk and pad to the manual abrading tool.

A thin abrasive disk article can be easily torn at the abrasive disk center just by this disk attachment mounting procedure. Also, a significant portion of the torque dynamic impact forces that act in a tangential location at the outer periphery of the disk, as a result of the disk contacting a workpiece at the disk periphery during disk abrading procedures, can be transmitted to the disk center where the disk is attached to the small center attachment nut. A disk center mounted thin flexible polymer disk backing has little strength at its center to resist these outer radius tangential forces and will tend to tear at the disk center mounting location as a result of these forces. There is little additional strength that is provided to the thin abrasive disk article backing sheet by the polymer binder that is used to bind the abrasive particles to the backing as this binder layer also is so thin. As a reference, the backing thicknesses typically used for abrasive lapping articles are from 50 to 100 micrometers (0.002 to 0.004 inches) thick and by comparison to grinding disks, these lapping sheet articles are very delicate and fragile. The lapping sheet abrasive articles typically use thin backings sheets that are coated with single-layer abrasive binder coatings to attach 0.002 inch (51 micrometer) diameter abrasive agglomerate beads to the backings.

Lapping sheet abrasive articles that use these thin polymer backings and thin abrasive binder coatings of abrasive materials are used successively for abrasive flat lapping procedures without tearing problems. These lapping sheet abrasive articles are mounted differently to a lapping machine head than are abrasive disks mounted to a manual abrasive tool. First the abrasive disk is not attached to a platen only with a disk-center torque tightened threaded device. Instead the flexible abrasive disk sheet is attached to a flat platen with the use of vacuum which applies a hold-down force pressure of nearly one atmosphere (!4.7 lbs/sq. inch) to all of the flat surface of the abrasive article. A typical abrasive disk has a large surface area which results in a very large total disk hold down attachment force. There is no distortion of the abrasive disk out-of-plane from the original-condition disk surface as the platen is flat and the flexible abrasive disk easily conforms to the flat platen with no localized stress-risers in the disk backing material. Forces that are applied at the abrasive disk outer periphery tend to remain in the outer disk areas where they are applied as they are not transferred to the central area of the disk. These disk outer periphery forces are also not multiplied as they are transmitted to the inner radius of the disk due to the geometry factor where a force applied at the large radius at the periphery increases as a function of being transferred to, and concentrated at, a disk center small radius. Further, there is no multiplication of the disk backing abrading force stresses due to the disk sheet buckling that can occur when a disk sheet experiences a localized out-of-plane distortion.

An abrasive disk that is held to the surface of a platen has a significant coefficient of friction between the disk surface and the platen surface and the disk mounting surface friction resists movement of the abrasive disk sheet relative to the platen surface. The coefficient of friction between the abrasive disk and the platen can be enhanced by surface coatings, etching or otherwise surface conditioning of either the surfaces of the abrasive disk backing or of the platen surface, or both. The Romero backing sheet has integral raised islands that is constructed by a variety of techniques including: 1.) molding a flat disk with integral raised islands; or 2.) adhesively bonding island shapes cut out from sheet material to a backing disk; or 3.) embossing island shapes into the surface of a flat backing disk sheet. None of these three raised island disk manufacturing techniques would be expected to produce islands having precisely flat surfaces where the island height variations, as measured from the backside of the backing, is within the 0.0001 to 0.0003 inch (0.003 to 0.008 mm) tolerance that is typically required for 8,000 or more surface feet per minute SFPM high speed platen flat lapping.

He describes raised island abrasive substrate sheets or strips having rectangle, square, hexagon, octagon and oval shapes. However, these non-circular shapes or strip shapes require sheet-center aperture holes (the same as for aperture-hole circular disks) to allow multiple layers of these non-circular abrasive strip sheets to be mounted on a mandrel. Here, the cut-out abrasive strips are positioned with incremental rotational angles about the aperture hole position relative to each other in a manner that all the stacked strips mutually form an equivalent circular disk shaped abrasive article when they are mutually attached to a mandrel with an aperture screw-cap. However, each of the composite abrasive strips that form the equivalent circular disk shape lays at a different elevation relative to each other due to the stacking of individual strips, which means that a tangential continuous abrasive surface can not be presented to a workpiece surface. There is an incremental step change in elevation of the exposed abrasive particles on the equivalent disk shape at different locations around the periphery of the equivalent disk. Forming a disk from a stack of abrasive coated sheets results in abrading surface contact with a workpiece of only those abrasive particles that reside on the leading edge of each individual abrasive strip. It is necessary for the backing sheet of individual strips to wear away in order to expose those abrasive particles that are located at the trailing edge of each stacked strip. Those abrasive particles located on the trailing edge of a specific attacked strip that are covered by the portion of the abrasive strip that is stacked above the specific strip can not be utilized until the backing of the strip located above it is worn away. In this type of fan-wheel abrasive disk, the disk abrading action takes place primarily at the leading edge of the single outermost strip that is in contact with a workpiece. Stacked fan-wheel types of abrasive articles typically are suited for rough grinding and are not suited for flat lapping.

Romero incorporates by reference U.S. Pat. No. 5,142,829 (Germain) which describes a variety of these same types of non-circular abrasive sheet shapes, all having center aperture holes, where the holes allow them to be progressively stacked on a mandrel for use as a flapper abrasive portable manual tool. Romero does not disclose non-disk abrasive articles having non-aperture hole (or multiple-hole) flat sheets, long strips or belts of abrasive coated raised island articles or disclose where these articles would be used for non-manual tool abrading purposes. Disk articles that have disk-center aperture holes are used principally on portable tool mandrels. The method described by Romero for coating the abrasive disk with abrasive particles is to first coat the island top surfaces with a make coat of binder, deposit loose abrasive particles on the make coat and then add a size coat of binder after which the binders are cured. Coating island top surfaces with an abrasive slurry is not taught. For mandrel mounted abrasive articles it is important that raised island structures do not exist in the center area of the abrasive disk as the screw flange nut, or threaded nut, would contact parts of the raised island structures, thereby making it difficult to attach an abrasive disk to a grinder tool head under this condition.

Romero does not teach the hydroplaning of workpieces surfaces when lapping at very high surface speeds. Hydroplaning would not be an issue when using an abrasive disk on a mandrel tool device as the abrasive article would have a line-shaped area of contact with a workpiece surface due to the abrasive article out-of-plane distortion by the tool operator. Here, a water interface boundary layer between the abrasive an the workpiece does not build up in thickness and create hydroplaning for this type of line-contact abrading surfaces. Also, there is a very highly localized area of contact pressure at the abrading contact line area due to the large applied force that is distributed over the very small abrading contact area. Most of the manual force applied by a mandrel to an abrasive disk is concentrated at the small line-area where the abrasive disk is distorted most where it contacts a workpiece surface. This high contact line-area pressure tends to prevent the boundary layer thickness buildup of coolant water. In the instance of flat lapping, the abrasive contacts the workpiece with a very low contact force across a full surface area that is typically as wide as the width of the workpiece. Due to the low contact force and large contact area, the water interface boundary layer can build up in substantial thickness. In this way, hydroplaning, where a portion of the workpiece is lifted from the abrasive surface by the depth or thickness of the water interface boundary layer, does not tend to occur for mandrel-and-flexible-pad type of manual tool abrading. However, hydroplaning is difficult to avoid when using continuous coated abrasive disks with flat rotary platens that are operated at high surface speeds for flat lapping.

Island types of abrasive articles used for precision flat grinding or lapping are primarily suited for use with rotating flat platen surfaces. The localized individual island sites are structurally stiff due to their increased thickness as compared to the thickness of the adjacent thin backing sheet. The flexural stiffness of the island areas is a function of the total island material thickness cubed, which means a relatively small change in the backing sheet material thickness at the location of a raised elevation island can change the localized stiffness of the island area by a very large amount. These abrasive coated stiff islands will not easily conform to a curved surface. Stiff raised large diameter islands that have a thin flat top surface coating of abrasive material will only be contacted by a workpiece at the central portion of the island abrasive or in a line extending across the surface of an island when contacting a convex workpiece. Only the abrasive outer island peripheral edges of a stiff island would be contacted when abrading a concave workpiece. In either case, abrading action results in uneven wear of both the island coated abrasive and of the workpiece surface. In a like manner, raised island abrasive disk articles having stiff islands that have their flat disk-plane surface distorted by manual pressure when contacting a flat workpiece will only be effective in uniform material removal if the island dimensions are very small, in particularly the tangential direction. Here, small islands can lay flat to a workpiece but only if the adjacent disk backing material that is located next to the islands is flexible enough to allow the island to bend enough to compensate for the disk out-of-plane distortion created by the abrasive tool operator. Even if the backing is flexible, the backing pad would tend to prevent this conforming action.

Stiff and thick backings are generally used with manual abrasive disk articles as thin backings are too fragile for this type of abrading usage. Manual pressure will distort the disk plane in both a radial and tangential direction. This abrasive sheet distortion would prevent the production of a precision flat workpiece surface with this manual apparatus and abrasive article. Flexible sheets of a non-island uniform coated abrasive article having a thin backing will conform to a flat rigid platen which provides a natural flat abrading surface for the whole surface of the abrasive sheet. The thin and flexible and structurally weak lapping sheets assume the flat surface of the platen even if the lapping sheet is not perfectly flat prior to contact with the platen. Vacuum is typically employed to bring the thin lapping sheet into intimate contact with the platen and to hold the abrasive lapping sheet in flat contact with the platen even when the lapping sheet is subjected to significant contact pressures and forces during the abrading action. Likewise, a thin backing sheet or disk having integral raised islands will likewise conform to the flat platen surface where each of the individual islands will be presented with a flat island top surface that is mutually flat to the workpiece surface.

Flexible abrasive sheets or disks having raised islands mounted on flat platens can be used effectively for the flat grinding and smooth lapping of a flat workpiece surfaces. The Romero described abrasive disks as used with conformable screw-cap mandrel pads are not practical for use for precision flat grinding. Conformable pad mandrels are generally used on portable grinding tools that are held with large (6 kilogram or 13 lbs) manual contact forces against a workpiece. This large contact force typically deforms a portion of the flexible abrasive disk-supporting pad to allow a controlled area of the thick and stiff abrasive disk to be in flat contact with a workpiece surface. The whole large applied contact force that is required to deform the outer radial portion of the abrasive disk as it rotates tends to be concentrated at the typical small contact area that exists between the abrasive and the workpiece surfaces. There is a very uneven and non-linear distribution of the abrading contact force in this small abrasive contact area. A greater concentration of the applied force is located at the inner radial portion of the contact area and a much lesser concentration of the force is present at the outer radial portion of the abrasive contact area. The contact pressure (lbs per square inch of contact surface area) is greater at the disk inner radial position and lesser at the outer radial position. As the rate of abrading workpiece material removal is typically proportional to the abrading contact pressure, aggressive material removal occurs at the abrasive distorted-disk inner radial contact position and much less material removal occurs at the outer radial position. This uneven material removal rate results in uneven wear of the workpiece surface when a rotating abrasive disk is presented at an angle to a workpiece surface.

Disk back-up pads provide some radial variance in stiffness to compensate for the requirement that the disk be distorted out-of-plane to achieve flat contact of the disk to the workpiece but they do not provide an uniform contact abrading pressure that is satisfactory for flat lapping of precision workpiece surfaces. The manual abrasive grinding operator typically moves the disk with a random oscillation-type orientation motion relative to the surface of the workpiece. In the comparative case of a flat lapping machine, a low contact force of 1 to 2 lbs (0.5 to 1 kg) is spread evenly over large surface areas of a workpiece having a 3 inch (76 mm) diameter that is supported by a workpiece holder spindle. The workpiece spindle of a flat lapping machine is typically orientated perpendicular to the surface of an abrasive disk that is flat mounted to a rigid platen. A manual abrasive disk tool is typically oriented at a significant angle to the workpiece surface. Very low stresses are induced within the thin and weak abrasive backing sheet used in flat lapping because the relatively large mutual flat workpiece and abrasive contact surface areas do not create localized areas of abrading contact forces. Thin backings as used with the manual tool grinding pad disks is stated by Romero to be a problem as this fragile type of disk easily rips and tears and can crease and pucker the disk article.

FIG. 18 (Prior Art) shows an expanded side view of the FIG. 13 (Romero, and others) abrasive disk that is mounted on a mandrel tool used to grind a workpiece with the disk distorted. The abrasive disk 160 that has attached islands 162, which have a coating of abrasive 164. The abrasive 164 that is located at the edge of the island 162 contacts the workpiece 168 at a contact point 166. When the abrasive 164 contacts the workpiece 168 at a single point 166 during abrading action, the workpiece can be scratched at this single point-contact, rather than the workpiece 168 being polished at this location by the abrasive 164. This scratching occurs because the abrasive disk 160 having abrasive 164 coated islands 162 is typically presented at an angle to the workpiece rather than the abrasive 164 on all the islands 162 being presented in flat contact with the workpiece 168 surface. Mounting of a disk 160 by use of a disk-center threaded screw device with a flexible pad to a hand-tool mandrel tends to prevent all of the flat contact surfaces of the abrasive 164 coated raised islands 162 from lying in a flat plane relative to the workpiece 168 flat plane surface due to distortion of the disk 160 by the threaded screw device, not shown. Any out-of-plane contact of the abrasive 164 with the workpiece 168 will tend to create workpiece 168 scratches. This makes it impractical to use these abrasive disks on manual tool disk mandrel systems to provide flat lapping of workpieces. However, these abrasive disks and mandrels are suitable for rough grinding of a workpiece.

FIG. 19 (Prior Art) shows an expanded side view of a (Romero U.S. Pat. No. 6,371,842, and others, as shown in FIG. 18 single abrasive coated island in angled contact with a flat workpiece. The island 170 having an abrasive coating 176 is positioned at an angle 177 with a workpiece 172 where the leading-edge contact portion of the island 170 and the abrasive 176 both independently contact the workpiece 172. The island structural material contacts the workpiece at the contact point 174. It is typically not desirable for the island non-abrasive structural material to contact a workpiece surface during abrading, especially for precision flat lapping, as the abrading characteristics, or workpiece contamination action, of this island 170 structural material may be unknown. The leading edge of the abrasive 176 also makes a sharp-edge contact area 178 with the workpiece 172. The expanded view of this figure shows a significant sized abrasive 176 contact area 178 even though the area 178 is actually quite small, as the island surface abrasive 176 coating thickness 173 is typically less than 0.002 inches (50 micrometers) for an abrasive lapping article.

FIG. 20 (Prior Art) is a cross section view of Romero U.S. Pat. No. 6,371,842 abrasive coated islands attached to a backing sheet. Raised island structures 186 are coated with a layer of adhesive 184 with abrasive particles 180 and 182 that are deposited onto, or applied to, the adhesive 184 coating. The islands 186 are attached to a backing sheet 187 and a gap 192 exists between the outer edge of the island 186 and the outer periphery 193 of the backing 187. There is no disclosure of control of the relative height (or island height variations) of the island structures 186 as shown by the height variation dimension 188. There is also no control of the thickness or size 190 of the abrasive particles 182 or control of the height of the island structure 186 height 194 as measured from the top of the adhesive 184 coated island 186 and the backside of the backing sheet 187. Also, there is no control of the height of the abrasive particle 182 coated island 186 island structure thickness 195 as measured between the top of the abrasive particles 182 and the backside of the backing sheet 187.

FIG. 21 (Prior Art) is a top view of Romero U.S. Pat. No. 6,371,842 abrasive island disk having an aperture hole and an island gap at the disk periphery. The disk 200 has a disk-center aperture hole 198 that allows the disk 200 to be screw fastener mounted to a manual abrasive grinder tool, not shown. The abrasive coated raised islands 202 have a recessed area gap having a gap-width dimension 204 where this recessed gap extends around the outer periphery of the disk 200 between the edges of the islands 202 and the disk 200 edge. Romero also describes the abrasive particle re-coating of his worn-out abrasive raised island disks. Island structures that are worn down in abrading use are re-coated with an adhesive layer on top of the worn island structures and abrasive particles are deposited on the raised island adhesive layers. After sufficient adhesive is applied to structurally support the individual abrasive particles on the island tops, the adhesive is fully cured to develop the adhesive bond strength. The disk is then appraised by Romero to be suitable for his intended abrading use. It is obvious that this abrading use is not precision grinding or precision flat lapping. All of the mutual-plane flatness, if it originally existed, of the individual abrasive coated islands would have been lost in the first abrading usage of the disk and this lack of flatness would have been retained in the re-coating procedure. It is very difficult to obtain an even or flat in-plane wear of a circular abrasive disk due to the fact that the outer radius of the disk has a higher rate of surface speed than the inner radius of the disk and the disk abrasive will wear down at a faster rate at high surface speeds than at low surface speeds. Other localized areas of the original disk will wear down at faster rates due to causes including, but not limited to, the disk-surface variations in the contact force that is applied between the abrasive disk and the workpiece surface. Abrasive wear rates increase for higher contact forces.

FIG. 22 (Prior Art) is a cross section view of a hypothetical comparative "precisely flat" original-condition Romero U.S. Pat. No. 6,371,842 abrasive island article. Raised island structures 214 are attached to a disk backing sheet 218 where the islands 214 have a top layer coats of adhesive 212 which binds abrasive particles 210 to the islands 214. All of the abrasive particles 210 that are positioned at the top of each of the islands 214 are shown to lie in a mutual flat plane 216 that is parallel to the backside of the backing 218.

FIG. 23 (Prior Art) is a cross section view of the hypothetical comparative precisely flat original-condition Romero U.S. Pat. No. 6,371,842 abrasive island article shown in FIG. 22 that has been subjected to abrading wear where all of the adhesive and abrasive particles that were originally attached to the island top surfaces are worn down. The worn-down island structures 220, 222, 223, and 224 originally had a mutual-plane 226 height location that was parallel to the backside of the backing sheet 228. After partial wear-down of the island structures, the islands 222, 223 and 224 all have top surfaces that lie in a mutual angled plane 225 that is not parallel to the backside of the backing sheet 228. Likewise the top surface of the island 220 is ground to a shape that lies in a different plane 221 and that plane 221 is neither parallel to the backside of the backing 228 or parallel to the plane 225.

FIG. 24 (Prior Art) is a cross section view of the worn-down islands on the backing shown in the Romero U.S. Pat. No. 6,371,842 FIG. 20 that have been recoated with adhesive and abrasive particles. The islands 234 are coated with an adhesive 232 that bonds abrasive particles 230 to the top surfaces of the worn-down islands 234. The abrasive 230 coated island 234 surfaces lie in two different planes 231 and 235 where plane 235 is not parallel to either the original island top surface flatness plane 236 or the island 234 plane 231. In addition, all of the islands 234 have different top surface height locations where the island heights are measured from the backside of the backing sheet 240. In order for the abrasive article to be useful for precision flat grinding or flat lapping, each abrasive coated island on a backing sheet must have the same height elevation relative to the backside if the backings, and also, the top surface of each island must also be flat in a island-mutual plane that is parallel to the backside of the backing 240.

FIG. 25 (Prior Art) is a cross section view of a rotating abrasive mandrel mounted disk and corresponding workpiece abrading contact pressure profile for a Romero U.S. Pat. No. 6,371,842 raised island abrasive disk article. A grinder 206*a* has a rigid grinder hub 200*a* to which a flexible disk pad 208*a* is attached. A flexible abrasive disk 204*a* having abrasive coated raised islands 202*a* is attached to the flexible disk backup pad 208*a* where the grinder 206*a* and the abrasive disk 204*a* is manually held with a force against the flat surface of a workpiece 214*a*. The flexible disk backup pad 208*a* and the abrasive disk 204*a* as shown are both mutually and substantially distorted from their original flat non-abrading planes (not shown) when the grinder 206*a* is manually held against the workpiece 214*a*. The abrading pressure 211*a* varies from a maximum 216*a* at the location 218*a* where the abrasive raised islands 202*a* are located closest to the grinder hub 200*a* and the minimum abrading contact pressure 212*a* occurs at the location 210*a* that is at the outer diameter of the circular abrasive disk article 204*a*. Because both the backup pad 208*a* and the abrasive disk 204*a* are flexible they provide the greatest structural stiffness nearest to the hub 200*a* at the contacting island 202*a* location 218*a* but the least structural stiffness nearest to the outer periphery of the circular abrasive disk 204*a* at the island 202*a* location 210*a*. The result is that the abrading contact pressure 211*a* has a large variation across the abraded surface of workpiece 214*a*. Because the rate of abraded workpiece 214*a* material removal is proportional to the abrading contact pressure 211*a* the workpiece 214*a* is substantially abraded at the location 218*a* but experiences very little abrasion at the location 210*a* even though the localized abrasive speed at location 210*a* is higher that at the location 218*a*. This substantial variation of material removal across the abraded surface of the workpiece by Romero's grinder disk is completely unacceptable for high speed flat lapping.

FIG. 26 (Prior Art) is a top view of the variation of the abrading contact pressure profile for a Romero U.S. Pat. No. 6,371,842 raised island abrasive disk used on a manual grinder. The abrading pressure has a two dimensional variance across the surface of the workpiece 222*a* and all of the abrading contact pressure is concentrated in the abrading contact area 228*a* that is a small portion of the total workpiece 222*a* surface area as shown. The highest contact pressure 220*a* area is closest to the grinder hub (not shown) while the lowest contact pressure area 226*a* is located at the outer radius of the abrasive disk (not shown) while the medium contact pressure area 224*a* is located between the high pressure area 220*a* and the lowest contact pressure area 226*a*. Having a variable abrading contact pressure concentrated in a localized area on a workpiece as described by Romero is starkly different than having a uniform contact pressure encompassing the whole flat surface of a workpiece as described here.

U.S. Pat. No. 6,375,559 (James, et al.) discloses the use of raised island abrasive pads that have multiple-height protrusions molded or formed on a low modulus backing pad surface with channels between the raised islands. Here a mixture of abrasive particles and a polymer binder are molded to form localized raised composite-abrasive islands. These abrasive pads are used with water based fluids having controlled pH levels to perform chemical mechanical planarization (CMP) polishing of semiconductor devices. The height of the raised island protrusions are not precisely controlled relative to the back side of the pad backing so these pads can not be used in high speed lapping operations. James prefers that the heights of the protrusions to be only allowed to wear down to no more than one half of the depth of the largest flow channel to provide consistent polishing performance.

FIG. 27 (Prior Art) is a cross section view of a James U.S. Pat. No. 6,375,559 abrasive island CMP pad article. Composite abrasive-binder raised island structures 211 are attached to large island pad structures 219 that are attached to an abrasive pad 217. There are channels 213 that are between the abrasive particle raised islands 211 and there are larger channels 215 that are between the large raised structures 219.

U.S. Pat. No. 6,511,368 (Halley) describes an off-set abrasive polishing pad holder that has a spherical pivot center of rotation that is nominally located at the flat surface of a semiconductor wafer to diminish "cocking" or "skiing" of the rotating circular shaped abrasive pad relative to the polished surface of the semiconductor. The abrading contact shear forces between the flat surfaced soft and resilient abrasive pads and the flat surfaced wafers cause these cocking and skiing effects. Cocking occurs when the pad holder pivot center is located above the wafer surface (toward the contacting pad) and skiing occurs when the pivot center is located below the wafer surface. When the abrasive pad cocks, the leading edge of the pad digs into the surface of the wafer and the rear edge of the pad lifts up away from the wafer surface. When the abrasive pad skis, the leading edge of the pad lifts up from the surface of the wafer and the rear edge of the pad digs into the wafer surface. The pad holder device has separate movable concentric convex and concave hemispherical surfaced components including an outer cup, an inner cup and a rotor that are nested and loosely interconnected. The convex shaped rotor has sliding pins that allow the rotor to be rotationally driven about an axis by the concave shaped outer cup housing while providing spherical rotation of the rotor relative to the housing. Small localized areas of the semiconductor wafer are polished by the abrasive pads. His off-set pad holder device is moved across the top surface of a much larger edge-supported semiconductor wafer disk where a companion moving back-up hemispherical support device is positioned concentrically with the pad holder on the bottom side of the semiconductor.

The large semiconductor wafers are supported at multiple positions at their peripheral edge by small grooves cut into small rotatable rollers with the result that that semiconductor can only be rotated at slow speeds by these rollers. Care is taken to minimize erosion of the soft metal electrical conductor lines at the surface of the ceramic semiconductor material by the abrasive slurry coated soft and resilient abrasive pads.

The Halley spherical action device components are loosely connected together where the rotor is not forced against or held in contact with the outer cup housing except by the abrading contact forces. There is no independent pad holder mechanism used to restrain the rotor from separating from the outer housing other than the abrading contact force that is applied by the abrasive pad holder. During abrading action the outer cup housing provides a elevated-position reactive force that opposes the abrading contact shear force that resides in the plane of the flat surface of the wafer. However, because the lower edge of the hemispherical shaped outer cup edge is located some distance above the wafer surface, the reactive force provide by the outer cup housing is positioned some elevated distance from the abrading contact force. The off-set distance between these two opposing forces, that act independently on the rotor body, can result in a torque force-couple that tends to rotate or tilt the rotor away from the housing whereby there is no longer mutual "contact" or close proximity between the nested hemispherical surfaces. As the abrasive pad is attached to the tilted rotor, the abrasive pad digs into the surface of the wafer. This undesirable tilting effect can occur even when the abrasive pad holder spherical pivot center is initially positioned exactly at the planar surface of the wafer.

The off-set hemispherical workpiece holders described in the present invention, in U.S. Pat. No. 6,149,506 (Duescher) and also in U.S. Pat. No. 6,769,969 (Duescher) have a single movable hemispherical rotor that holds flat surfaced workpieces conformably against a flat moving abrasive surface of a rotating abrasive disk. The air bearing friction-free convex rotors are forcefully constrained within the concave housings to maintain the mutual nested concentric positions of the rotors and the support housings to assure that the rotor spherical pivot center remains at the planar surface of the moving abrasive even when abrasive shear forces are applied by abrading action.

U.S. Pat. No. 6,521,004 (Culler et al.) and U.S. Pat. No. 6,620,214 (McArdle, et al.) disclose the manufacturing of abrasive agglomerates by use of a method to force a mixture of abrasive particle through a conical perforated screen to form filaments which fall by gravity into an energy zone for curing. U.S. Pat. No. 4,773,599 (Lynch, et al.) discloses an apparatus for extruding material through a conical perforated screen. U.S. Pat. No. 4,393,021 (Eisenberg et al.) discloses an apparatus for extruding a mix of grit materials with rollers through a sieve web to form extruded worm-like agglomerate lengths that are heated to harden them.

U.S. Pat. No. 6,540,597 (Ohmori) describes a raised island polishing pad conditioner that reconditions pads that are used to polish silicon wafers. The raised island structures are coated with abrasive particles.

U.S. Pat. No. 6,551,366 (D'Souza et al.) herein incorporated by reference, describes the manufacture of spherical abrasive agglomerate beads by spray drying a liquid mixture of abrasive particles, a binder, ceramic precursors and water mixture in a high speed rotary spray dryer. The mixture is sprayed into a heated environment to dry the spherically formed beads. He describes the optional use of vibration to control the bead sizes. Heating in a high temperature furnace forms a glass binder that surrounds the abrasive particles within the agglomerate abrasive bead.

U.S. Pat. No. 6,602,439 (Hampden-Smith et al.) and U.S. Pat. Application No. 2002/0003225 (Hampden-Smith et al.) describes the manufacture and use of composite abrasive beads made from slurries of abrasive particles and water soluble salts and other metal oxide water based materials. He introduces the abrasive slurry liquid onto the surface of an ultrasonic head aerosol generator operating at 1.6 MHz (1.6 million cycles per second) to produce 0.1 to 2 micron nominal sized droplets. Also, the ultrasonic heads simultaneously produce a range of other droplets having sizes of mostly less than 5 microns. Here, the abrasive slurry liquid covering the ultrasonic head forms standing slurry waves where the tips of the liquid waves shed droplets that are introduced into a hot air environment where they are solidified. These droplets form abrasive spheres, but again, the spheres have a large variation in size. Droplets are classified or separated by size when they are still in a liquid state by introducing them, after ultrasonic generation, into a moving air stream that is routed at sharp angles between barrier plates. The oversized droplets can't follow the sharp air-turns and impact a barrier wall. The wall impacted droplets change into a liquid that runs down the wall and is collected in a drainpipe. Those spherical slurry droplets that have the desired size are then subjected to heating to first solidify them. Then individual beads are heat treated in a furnace into a single crystal or into a number of crystals or into an amorphous bead. The small 2 micron abrasive spheres produced are used in CMP polishing of workpieces. He can incorporate the chemically active compound ceria into the beads. Ceria is commonly used for polishing technical glasses as it can accelerate the removal of silica by chemically reacting and bonding with the silica surface. The abrasive beads can individually include both CeO2 and SiO2. No mention is made of using lower ultrasonic frequencies in the range of 20,000 Hz that would typically produce droplets of the much larger 45 micron size which is the abrasive bead size that is desired for resin-bond coating onto backing sheets to form fixed-abrasive sheet or disk articles. Droplets produced by ultrasonic heads vary in size, in part, as a function of the oscillation frequency of the ultrasonic head where higher frequencies produce smaller droplets. However, an ultrasonic atomization head always simultaneously produces a wide range of droplet sizes.

U.S. Pat. No. 6,613,113 (Minick et al.) describes island-type flexible abrasive bodies covered with abrasive particles that are attached to a flexible backing sheet.

U.S. Pat. No. 6,641,627 (Keipert, et al.), herein incorporated by reference, discloses the manufacturing of abrasive wheels and discloses the use of grinding aids, lubricants and pigments.

U.S. Pat. No. 6,645,624 (Adefris et al.), herein incorporated by reference, discloses the manufacturing of spherical abrasive agglomerates by use of a high-speed rotational spray dryer. Here, he uses a process where a stream of a liquid mixture of abrasive particles and a solution of extremely small silica particles, that are dispersed and suspended in water, is poured as a stream into the center of a high speed rotary wheel having port holes at its outer periphery. Individual small-streams of the liquid abrasive mixture are ejected from the rotary wheel at each of the wheel port holes and the streams enter into a hot air dehydrating atmosphere. The streams break up into individual lumps while traveling in the hot air after which the lumps form into spherical shapes of the abrasive mixture. These spherical lumps are somewhat dried and solidified into abrasive beads as they reside in the hot dehydrating air. Later they are further dried and sintered to form spherical composite abrasive agglomerate beads. The abrasive beads were then coated on a backing sheet using resin binders that contain methyl ethyl keytone (MEK) and tolulene solvents.

Adefris references U.S. Pat. No. 3,916,584 (Howard et al.), where Howard manufactures the same type of spherical abrasive agglomerates by the use of process where a stream of a liquid mixture of abrasive particles and a solution of extremely small silica particles, that are dispersed and suspended in water, is poured as a stream into a stirred container of a dehydrating liquid to form spherical lumps of the abrasive mixture. These spherical lumps are somewhat dried and solidified into composite abrasive beads as they reside in the dehydrating liquid. Later they are further dried and sintered to form spherical composite abrasive agglomerate beads. The Howard diamond particle filled abrasive beads are refereed to by Adefris as having a soft metal oxide matrix.

In Adefris, an abrasive slurry of abrasive particles mixed in a Ludox® colloidal silica water solution is introduced into the center of a rotating wheel operating at 37,500 revolutions per minute (RPM) where centrifugal action drives the slurry to the outside diameter of the wheel where it exits the wheel into a dehydrating environment of hot air. Typically, when using rotary atomizers, individual slurry streams exit spaced ports located at the wheel periphery and form into thin curved string-like or ligament streams of fluid at each port where the streams have both a large tangential and radial fluid velocity. These individual curved slurry streams are separated into a stream pattern of adjacent individual droplets as the high-speed stream moves through the stationary air. The droplets are then drawn into spheres by surface tension forces acting on the free-falling drops. Sphere sizes of the drops are controlled, in part, by adjusting the wheel rotation RPM. The slurry drops are formed into solidified abrasive beads by the dehydrating action of the hot air. Again, there is a wide distribution of abrasive sphere sizes produced by this method. Abrasive beads can also be formed by simply spraying a slurry mixture, from a paint sprayer type of spray device or other pressurized nozzles, into a dehydrating fluid (either hot air or a liquid bath) but the range of droplets sizes produced by these devices would vary considerably.

U.S. Pat. No. 6,929,539 (Schutz et al.) describes island-type abrasive articles having flexible porous open-cell foam backings that have casually-defined raised island abrasive structures that are top coated with shaped-abrasive coatings. These "raised areas" on the backing sheets exist between the open gap areas on the surface of the porous backings where the gaps extend from the backing surface into the depths of the backing thickness. The "islands" actually are an artifact of the open area recessed gap gullies that extend around the non-recessed portions (islands) of the open cell foam backing. They are not raised above the plane surface of the foam backing but instead the open cells at the foam backing surface that surround the islands extend downward from the planar surface. To produce the raised island abrasive article a thin polymer barrier top-coat is first applied just to the top surface of the porous open cell foam backing sheets. The barrier coat does not bridge over the open cells of the porous foam backing. The barrier coat provides somewhat-flat raised island support bases for the backing sheet raised island abrasive structures. Barrier coat "raised islands" are shown in a drawing figure by Schutz as those open cell backing surface areas that are not bridging over the foam surface open gap areas.

Related to the production of his porous foam abrasive article having raised areas Schutz incorporates by reference U.S. Pat. No. 5,435,816 (Spurgeon et al.) which discloses an abrasive article that has a continuous patterned array of pyramid shaped composite abrasive structures that are attached to flat-surfaced (non island) backing sheets. In Spurgeon, the patterned array of abrasive shaped structures are produced on a continuous web backing sheet material which is converted into individual abrasive sheet articles after the composite abrasive material is fully solidified. For the production process, reverse-pyramid cavity shapes are formed in an array pattern into the surface of a production tool belt. These production tool belt cavities are level filled with a liquid abrasive-binder mixture. A continuous web backing is brought into surface contact with the abrasive mixture filled belt. Then radiant energy is applied to solidify the abrasive mixture entities so that they individually bond to the backing, and also, so that the entities are "handleable" and retain the cavity formed pyramid shapes after separating the backing from the cavity belt.

Polymer binders are used in the Spurgeon abrasive particle mixture that can be partially cured or solidified with the use of radiant energy that penetrates a production tool belt that is fabricated from a variety of polymer materials that can transmit radiant energy. Radiant energy partially solidifies the abrasive mixture entities while the entities are in wetted contact with the flat-surfaced backing. This solidification assures that a "clean separation" takes place where the abrasive shapes are completely transferred from the belt cavities to the surface of the backing upon separating the abrasive web backing from the cavity belt. In this way, there are no residual portions of the abrasive shaped entities that are left in the individual cavities and the deposited abrasive pyramid entities do not have distorted shapes. This also assures that the cleaned-out belt cavities can be reused for the production of another continuous abrasive web. After the abrasive pyramids are transferred to the web, the abrasive pyramids are fully solidified or cured. The resultant web backing has a continuous coating of the adjacent composite abrasive shapes over the full surface of the web.

Schutz teaches how this type of U.S. Pat. No. 5,435,816 (Spurgeon et al.) production tool belt having an array pattern of directly adjacent pyramid cavities can be used to transfer the abrasive mixture pyramids to the surface of the barrier coated open cell porous foam backing. Here, the patterned array of abrasive shaped structures are produced on a porous foam continuous web backing material which is converted into individual abrasive sheet articles after the composite abrasive material is fully solidified. First, reverse-pyramid cavity shapes are formed in an array pattern into the surface of a production tool belt. These belt cavities are level filled with a liquid abrasive-binder mixture, an action that provides flat surfaces of each liquid abrasive mixture entity that is contained in the belt cavities. Then, the Schutz barrier-coated porous foam continuous web backing is brought into direct surface contact with the belt. To provide conformal surface contact between the individual abrasive mixture level filled belt cavities and the somewhat-flat barrier coat, the production tool cavity belt momentarily compresses the porous foam backing. Here, it is desired that the flat-surfaced abrasive mixture entities in each of the belt cavities fully wets the surface of the backing barrier coating. This abrasive mixture entity wetting action provides adhesion contact of the individual abrasive mixture entities across the full contacting surface of each entity with the flat surfaced backing sheet. Portions of the abrasive mixture cavity entities that are not in conformal contact with the barrier coated porous foam top surface will tend to remain in the individual cavities of the production tooling belt after the belt is separated from the porous continuous web. If only a portion of an abrasive cavity pyramid shaped entity is transferred from the cavity to the barrier coating then that entity will have a significantly distorted pyramid shape.

Pyramids in the abrasive mixture level-filed belt cavities will tend to have flat surfaced base shapes. The abrasive mixture shaped bases in some of the cavities will conform to the flat portions of the open cell porous backing. However, those individual abrasive cavities that are located in the free-span recessed areas between the barrier-coated island structures will not be in uniform and conformal base contact with the foam barrier surfaces. Even if the open celled foam backing is significantly compressed during the abrasive pyramid transfer event, the flat bases of the individual cavity entities will be in simultaneous contact with different portions of the foam backing that have different elevations in the un-compressed state. After the abrasive pyramid transfer event, the surface of the foam backing will spring back to its original high elevation state. During this spring-back event some localized portions of the foam backing will be ripped loose from portions of the individual pyramid bases while other portions of the foam backing will remain attached to other portions of these same pyramid bases. This results in some of the individual abrasive pyramids being only weakly attached to the foam backing. They are structurally unable to withstand significant abrading forces without breaking loose from the foam backing during a typical abrading process. Any broken abrasive structures could easily damage a precision workpiece surface. Schutz further teaches that in his process at least part of the shaped abrasive mixture material often remains in the production tool cavities when the abrasive shapes are attached to open celled porous foam backings.

These abrasive pyramids are similar to the shaped abrasive pyramids sold by 3M Company, St. Paul, Minn. under the trade designation "TRIZACT™ as abrasive sheet lapping articles.

Triangular or pyramid shaped pyramid abrasive coatings in general do not provide the even wear across the surface of a workpiece that is required for flat lapping due to the geometric shapes of pyramid abrasive island coating. The tips of the abrasive triangles volumetrically contain very little abrasive material and are very fragile while the triangle base areas contain the bulk of the abrasive material. During abrading action, the tips wear down very rapidly which changes the overall flatness of the abrasive article dramatically in those article surface areas where a workpiece first contacts the abrasive article. Subsequentially, when this unevenly worn abrasive article contacts the surface of a new workpiece, that workpiece surface is abraded unevenly.

This flexible and somewhat fragile abrasive article is suitable for casual polishing of painted automobile curved workpiece surfaces but would not be useful for controlling both the flatness and smoothness of a workpiece surface in a high speed precision flat lapping operation.

The presence of the open cells on the surface of the porous foam backing allows water to freely flow into and out of the foam backing during an abrading operation. However, these porous open cell foam backings prevent the use of vacuum to mount the abrasive article to a flat surfaced platen which is a critical requirement for high speed flat lapping.

There is no teaching of the importance of controlling the height of the raised island structures or of controlling the exact thickness of the shaped abrasive island coatings that would allow this product to be used effectively in high speed or precision flat lapping. Schutz does not address any of these critical abrasive article design feature issues. In comparison, abrasive articles that can successfully produce both flat and smooth workpiece surfaces at high abrading speeds with the presence of coolant water require monolayers of durable and equal-sized abrasive beads that are bonded onto stable and strong flat surfaced island structures that are precision height controlled relative to the backside of an abrasive article backing sheet where the backside has a flat continuous surface that can be sealed for vacuum mounting on a platen.

FIG. 31 (Prior Art) is a cross section view of the Schutz U.S. Pat. No. 6,929,539 raised islands attached to a flexible porous foam backing sheet where the islands have pyramid shaped abrasive coatings. The island structures 243 are attached to a barrier coat 245 that is attached to a backing sheet 247 and the top surfaces of the barrier coat 245 are covered with pyramid shaped abrasive bodies 241 that contain abrasive particles (not shown) which are mixed in a polymer binder (not shown). There are open passageways 242 that penetrate into the surface of the porous backing 247.

U.S. Patent Application No. 2003/0024169 (Kendall et al.), herein incorporated by reference, describes three dimensional island-type composite abrasive structures that are attached to backings to form abrasive articles. The composite structures are a mixture of abrasive particles and a polymer binder. Various types of abrasive particles and various types of polymer binders are described.

U.S. Patent Application No. 2003/0143938 (Braunschweig et al.) describes island-type abrasive articles having backings that have raised island structures that are top coated with shaped-abrasive coatings while the article backside has a mechanical engagement system.

U.S. Patent Application No. 2003/0022604 (Annen et al.) and U.S. Patent Application No. 2003/0207659 (Annen et al.) describe raised island-type abrasive articles having backings that have raised island structures that are top coated with pyramid shaped abrasive coatings. The backings include a variety of polymers and also foam backings. Raised island structures are formed on backings by a variety of methods that include: molding the islands on a backing; attaching or laminating cut-out pieces to a backing; embossing the backing; or screen printing islands onto a backing. A slurry mixture of abrasive particles and polymer resins are then formed into array patterns of pyramid shapes on top of the raised island structure top surfaces.

Annen does not teach how the pyramid abrasive shapes are uniquely attached only to the individual island structures. His raised structures can be flat surfaced but the structures can also have curved top surfaces or be domed shaped. He incorporates by reference U.S. Pat. No. 5,435,816 (Spurgeon et al.) which discloses an abrasive article that has a continuous patterned array of pyramid shaped composite abrasive structures that are attached to flat-surfaced (non island) backing sheets. In Spurgeon, the patterned array of abrasive shaped structures are produced on a continuous web backing material which is converted into abrasive sheet articles after the composite abrasive material is solidified. For production, reverse-pyramid cavity shapes are formed in an array pattern into the surface of a production tool belt. These production tool belt cavities are level filled with a liquid abrasive-binder mixture. A continuous web backing is brought into surface contact with the filled belt and energy is applied to solidify the abrasive mixture so that the mixture bonds to the backing and also retains the pyramid shapes after separating the backing from the cavity belt. During production, the only registration that is required between the web backing and the production tool cavity belt is that the side edges of the belt and the web be mutually aligned. The resultant web backing has a continuous coating of the composite abrasive shapes over the full surface of the web.

It is not taught by Annen how this type of production tool belt having an array pattern of pyramid cavities can be used to transfer the abrasive mixture pyramids to only the surface of the raised islands, particularly if the individual raised island structures are curved or domed. Any of the abrasive mixture that is not in conformal contact with an island top surface will tend to remain in the individual cavities of the production tooling belt after the belt is separated from the island-backing continuous web. Pyramids in the abrasive mixture level-filed cavities will tend to have flat surfaced base shapes. The abrasive mixture shaped bases in some of the cavities will conform to a flat island surface for those individual abrasive pyramid shaped bases that are centrally located on a flat island surface. However, those individual abrasive cavities that are located in the free-span areas between island structures will not be in conformal base contact with the island flat surfaces. These free-span pyramids will not successfully transfer from the belt cavities to the island surfaces when the belt is separated from the island backing. Likewise, flat-based abrasive pyramids that are in contact with curved or domed island structures will also tend not to successfully transfer to the island surfaces because their flat-shaped bases will not be in conformal contact with the curved-surface raised island structures. After the abrasive mixture transfer process, those belt cavities that already contain non-transferred partially solidified abrasive mixture can not be completely refilled with fresh liquid abrasive mixture for the production of new abrasive pyramids on "new" island structures. There is no teaching of registration of the production belt with the raised island backing during production. It is very undesirable for the abrasive pyramids not to be accurately placed within the flat surface confines of the individual raised island structures.

Instead, it is taught by Annen that the pyramids can be formed by coating the abrasive slurry on a shape-patterned tooling belt or a shape-patterned rotogravure roll and by bringing "a backing" into contact with the roll or belt to transfer the shaped-abrasive coating onto the backing. It is not taught that the raised island surfaces are brought into contact with the abrasive filled cavities of the belt or a rotogravure roll to effect the transfer of the abrasive pyramids to the raised island structure surfaces. A "master" belt having cavities is used to produce polymer tooling belts that are used to create the island pyramid shapes. These abrasive pyramids are similar to the shaped abrasive pyramids sold by 3M Company, St. Paul, Minn. under the trade designation "TRIZACT™ as abrasive sheet lapping articles.

Triangular or pyramid shaped pyramid abrasive coatings in general do not provide the even wear across the surface of a workpiece that is required for flat lapping due to the geometric shapes of pyramid abrasive island coating. The tips of the abrasive triangles volumetrically contain very little abrasive material and are very fragile while the triangle base areas contain the bulk of the abrasive material. During abrading action, the tips wear down very rapidly which changes the overall flatness of the abrasive article dramatically in those article surface areas where a workpiece first contacts the abrasive article. Subsequentially, when this unevenly worn abrasive article contacts the surface of a new workpiece, that workpiece surface is abraded unevenly.

One intended use of this abrasive-island product is to reduce "stiction", a form of friction, between the abrasive article and the workpiece. Stiction is defined by Annen as the condition in lapping operations whereby the combination of a coolant fluid such as water and the typical smooth abrasive coating creates a condition whereby the fluid acts as an adhesive between the abrasive coating and the workpiece surface which causes these surfaces to stick together with unwanted results. Stiction tends to occur frequently with lapping type abrasive articles where the abrasive particles are imbedded in a binder that provides a smooth surface to these abrasive sheet articles. The shaped abrasive coatings that are applied to the flat top surfaces of the raised island structures is a pattern of shaped abrasive bodies. Each formed shaped body has an individual height and a volume and body base area and where each shape body has raised and recessed portions. The presence of the recessed valley areas between the raised island structures allows fluid flow at the working face of the abrasive article without undesirable stiction taking place. FIG. 133 and FIG. 134 compare the effects of stiction for continuous coated abrasive articles and raised island articles.

Here, the use of belts that produce pyramid shaped abrasive coatings prevent the production of precision height or precision-overall-thickness controlled abrasive articles. There is no teaching of the importance of controlling the height of the raised island structures or of controlling the exact thickness of the shaped abrasive island coatings that would allow this product to be used effectively in high speed or precision flat lapping. In fact, reference is made specifically that island structures may have varying heights.

In comparison, abrasive articles that can successfully produce both flat and smooth workpiece surfaces at high abrading speeds with the presence of coolant water require monolayers of durable and equal-sized abrasive beads that are bonded onto stable and strong flat surfaced island structures that are precision height controlled relative to the backside of an abrasive article backing.

Annen does not address any of these critical abrasive article design feature issues or recognize the issue of hydroplaning when lapping at high abrading speeds in the presence of coolant water.

In general, the features described by Annen are of non-precision height or thickness controlled abrasive articles that are produced by mass production continuous web processes that each add an element of size, thickness or other dimensional location variability to the finished article. The locations of the individual formed polymer resin pyramid, and other, shapes on the top surfaces of the individual raised island structures are not discussed. Many of the web or sheet or belt or roll shape forming techniques he uses will tend to position some of the individual shaped abrasive shapes on, or over, the edges of the top surfaces of the island structures which will leave them in a precarious structural location. Each of these individual abrasive shapes needs to be firmly anchored to the structure top surface to provide sufficient structural strength to resist the very high local abrading forces that are applied to these individual shapes as they are providing abrading action to the workpiece surface. These localized abrading forces can become significantly high when an individual formed abrasive shape contacts a physical deformity or material inclusion that exists at or on the surface of a workpiece. If the individual abrasive shape is not sufficiently anchored to the raised island structure, either part of or the whole abrasive formed shape can be knocked off the abrasive article and cause a scratch to occur on the workpiece surface during this event. This is very undesirable for workpiece lapping. Because of this shape bond strength vulnerability, the formed abrasive shapes should not overhang the edges of the raised island structures. Also, the surfaces of each raised island should in general be flat, and in particular, the edge areas of the island structures in the areas that support each individual abrasive shape should be flat to provide a structural support to the abrasive shapes. The manufacturing techniques described to form the abrasive shapes generally provide an array of like-sized abrasive shapes that lie in a plane and there is no capability to position an individual abrasive shape on a non-flat island structure. This same problem can occur on the non-flat inner area portion of raised islands rather than just the non-flat island edge portions. An individual abrasive pyramid shape will not be properly attached to a non-flat island surface.

FIG. 32 (Prior Art) is a cross section view of the Annen raised islands attached to a backing sheet where the islands have pyramid shaped abrasive coatings. The island structures 272 are attached to a backing sheet 266 and the flat top surfaces of the island structures 272 are covered with pyramid shaped bodies 270 that contain abrasive particles 268 which are mixed in a polymer binder 271. The shaped pyramid bodies 270 have a height 274 as measured from the top flat surface of the island structures 272 to the apex of the pyramid body 270. The raised island structures 272 have a height 276 measured from the top of the island structure 272 to the backside of the backing 266. The overall thickness 269 of the abrasive article 267 is measured from the top of the abrasive shaped pyramids 270 to the backside of the backing 266. Control of the variance of the height 274 of the pyramids 270 or variance in the overall abrasive article 267 thickness 269 is not discussed by Annen, which indicates a lack of awareness of the article size control features that are required for an abrasive article such as this to be successfully used for precision flatness high speed lapping. When the abrasive pyramids that are attached to the island surfaces of an abrasive article that has raised island structures, or the pyramids are attached to the flat surface of an abrasive article that does not have raised island structures, there tends to be large dimensional wear-down changes in the thickness of the abrasive article even though little of the volume of the abrasive material is worn away.

Also shown are abrasive pyramid shaped bodies 270 that are intentionally shown here as being overhung a distance 265 from the raised island structure 272. In addition, there is shown is a island pyramid 270 attachment border gap that has a gap distance 263 that is a measure of the distance that the abrasive pyramid shaped body 270 could be positioned inward from the wall edge of the raised island structure 272. The overhung distance 265 indicates the structural instability of the outer shaped pyramid 270 because this shaped pyramid 270 base is not fully attached to the surface of the island structure 272. The gap distance 263 is an indication that a shaped pyramid 270 has not sufficient base attachment area to successfully maintain a structural bonded attachment to the raised island structure 272 surface. The gap distance 263 is an indication that a weakly-attached pyramid 270 either broke off the island structure 272 or represents the gap where a pyramid was not successfully bonded to the structure 272. The pyramid body overhang distances 265 and gaps 263 that are caused by the lack of alignment or registration between the leading and following edges of the pyramids 270 and the leading and following edges of the raise island structures 272, as shown here, are not disclosed or taught by Annen. These abrasive articles are satisfactory for casual abrading or polishing use. However, these fragile abrasive articles 267 that have weakly attached abrasive pyramid bodies 270 could easily damage a precision workpiece (not shown) surface if one or more of the shaped bodies 270 broke off an island 272 during an abrading event.

FIG. 33, FIG. 34, FIG. 35 and FIG. 36 (all Prior Art) are cross section views of the Annen pyramid shaped abrasive bodies that are shown in FIG. 32 as the abrasive pyramids are bonded to the top surfaces of raised island structures which are attached to a backing sheet. The abrasive pyramids are shown in the original as-formed, full-height pyramids and then in progressive stages of wear-down, which has a large effect on the height of the pyramids even though little of the volume of abrasive material has been expended in the abrading wear process.

FIG. 33 (Prior Art) is a cross section view of an Annen original as-formed pyramid shaped abrasive body where the abrasive pyramid body 280 is attached to a backing sheet 282 and the pyramid 280 has a full height 281 that is measured from the apex of the pyramid 280 to the base of the pyramid 280.

FIG. 34 (Prior Art) is a cross section view of an Annen abrasive pyramid shaped abrasive body where the abrasive pyramid body 284 has 25% of the original pyramid 280 height, as shown in FIG. 33, worn away. The pyramid 284 is attached to a backing sheet 282 and the pyramid 284 has a new height 285 that is measured from the worn upper flat surface of the pyramid 284 to the base of the pyramid 284. The abrasive pyramid has been reduced in height by 25% but the volumetric loss of abrasive material from the original square pyramid volume is only 1.5% of the original volume.

FIG. 35 (Prior Art) is a cross section view of an Annen abrasive pyramid shaped abrasive body where the abrasive pyramid body 286 has 50% of the original pyramid 280 height, as shown in FIG. 33, worn away. The pyramid 286 is attached to a backing sheet 282 and the pyramid 286 has a new height 288 that is measured from the worn upper flat surface of the pyramid 286 to the base of the pyramid 286. The abrasive pyramid has been reduced in height by 50% but the volumetric loss of abrasive material from the original pyramid volume is still only 12.5% of the original volume.

FIG. 36 (Prior Art) is a cross section view of an Annen abrasive pyramid shaped abrasive body where the abrasive pyramid body 290 has 75% of the original pyramid 280, as shown in FIG. 33, worn away. The pyramid 290 is attached to a backing sheet 282 and the pyramid 290 has a new height 292 that is measured from the worn upper flat surface of the pyramid 290 to the base of the pyramid 290. The abrasive pyramid has been reduced in height by 75% but the volumetric loss of abrasive material from the original pyramid volume is still only 42% of the original volume which means that 58% of the abrasive material contained in the original pyramid still remains in the worn-down pyramid body. When the abrasive article is worn down this much, it is typical that some areas of the abrasive article will wear down much more rapidly than other areas due in part to the location of the workpiece on a specific area of a abrasive article. Also, high spots that initially existed on a workpiece surface will wear down localized portions of the abrasive article surface more than other portions. These worn-down abrasive areas then will not effectively contact a flat workpiece surface during subsequent abrading action. This is a significant reason to limit the initial thickness of an abrasive layer coated on an abrasive article specifically to limit the out-of-plane wear down of a portions of the abrasive article during repetitive abrading use. When an abrasive article is worn into a non-flat condition, it now becomes difficult to generate a flat abrasive surface on a workpiece in precision flat lapping. Non-flat abrasive article areas can produce non-flat workpiece surface areas, which is objectionable. Use of arrays of pyramid shapes of an abrasive particle binder mixture that is coated on the top flat surfaces of raised island structures increases the non-flat wear-down of abrasive articles because so little abrasive material exists at the apex areas of the individual pyramids which results in fast wear-down of the pyramid apex or tip areas.

Annen states the desirability of the abrasive article providing a constant abrasive cut rate but this constant cut rate is very difficult to provide with the pyramid shaped abrasive shaped forms. The cut rate, or material removal rate, of an abrasive is related to the contact pressure (force per unit area) that is applied to the abrasive material that is in contact with a workpiece surface. When a pyramid shaped abrasive structure is worn down, the abrading contact area of the pyramid changes rapidly from a very small area to a very large area. In their original full-sized shape, the pyramid top surfaces have very little area in contact with a workpiece as the applied abrading contact force is concentrated into the small contact areas at the apex of the individual pyramids. As the abrading pressure is equal to the abrading force divided by the abrading area, a very large pressure and very large material removal rate is present when a pyramid shaped abrasive is first used. The sharp apex contact areas of a new pyramid abrasive article even has the capability of scratching a workpiece rather than polishing it due to these concentrated abrasive contact areas. As the pyramids are worn down, a process that occurs rapidly during the first stages of abrading use, the contact area of the individual pyramids also collectively increases very rapidly. Adjusting the abrading contact force to accurately compensate for the change of abrasive contact area to achieve the same or a constant cut rate is difficult to accomplish.

As an example, the top surface area of a triangular shaped pyramid has an extremely small surface area so the contact pressure, consisting of the applied contact force divided by the contact area, is very high. This pressure results in high and localized workpiece cut rates that exists only at the location of the pyramid tips. Workpiece surface areas that are located adjacent to the pyramid tips get no abrading action at all as these adjacent areas are not in contact with the workpiece surface. The change of the pyramid top surface contact areas of worn-down pyramids is very large. A sharp-topped pyramid initially has an infinitesimally small contact area, depending on how sharp the apex of the pyramid is before wear occurs. When 25% of the original pyramid is worn down the pyramid has a flat top and has a truncated pyramid shape that has a small but significant top area that is considered here, for comparison, to have a unity (1.0) sized area. When 50% of the original pyramid is worn away, the pyramid top surface area is now 4.0 times greater than the unity 1.0 area of the 25% worn pyramid. When 75% of the original pyramid is worn away, the pyramid top surface area is now 9.0 times greater than the unity 1.0 area of the 25% worn pyramid. There is still 58% of the original abrasive left in the pyramid at this stage of wear. The pyramid will continue to wear down, the abrading contact surface area will continue its large non-proportional increase and the abrading contact pressure will continue the rapid change reduction. This huge abrading contact area change will produce non-constant wear over the abrading life of the abrasive article having the pyramid shaped abrasive structures coated on the top surfaces of the raised islands. However, this well-worn abrasive article can still provide smooth polishing of a workpiece surface even though the workpiece material removal rate may not be accurately controlled. Also, the large dimensional change in the thickness of portions of an abrasive article having pyramid abrasive shapes on its surface can tend to prevent the workpiece surface being abraded into a precisely flat surface.

This series of pyramid wear-down figures as shown in FIGS. (33-36) also demonstrate why it is impractical to use expensive diamond particle abrasives in the pyramid formed bodies as so much of the abrasive resides in the lower elevations of each pyramid where they will not be used effectively in precision flat lapping, in either low speed or high speed operations.

Another method is described here for the manufacture of equal sized abrasive beads that can be used for abrasive articles. Here, droplets of an abrasive slurry are formed from individual mesh screen cells that have cell volumes that are equal to the desired droplet volumetric size. Screens that are commonly used to size-sort 45 micrometer (or smaller) particles can be used to produce liquid slurry droplets that are individually equal-sized and that have an approximate 45 micrometer size. Larger mesh cell sized screens can be used to compensate for the heat treatment shrinkage of the beads as they are processed in ovens and furnaces. These uniform sized beads prevent the non-utilization and waste of undersized beads that are coated on an abrasive article. Further these equal sized beads have the potential to produce higher precision accuracy workpiece surfaces in flat lapping than can abrasive articles having surfaces coated with a mixture of different sized beads as the workpiece would always be in contact with the same sized beads, each having the same abrading characteristics. The variance in the size of beads can be further reduced by screen sifting processes. Smaller sized beads having small size variations can be effectively used in a variety of abrasive articles. A small change in the nominal bead size is not as important as having a uniform size to the beads that are bonded to an abrasive article.

Abrasive media may require surface conditioning prior to use to remove "high-riser" abrasive beads. Also, when the spherical bead type enclosed body composite agglomerate is bonded to an abrasive article backing, it is necessary to first break the spherical exterior surface of the agglomerate to expose individual sharp edged abrasive particles for use in abrading the surface of a workpiece. The constituent volumetric percentage amount of diamond or other particles used in the agglomerate binder mixture affects the performance of the abrasive article. Composite abrasive agglomerate coated abrasive articles have been marketed for years including those using ceramic and metal oxide encased composite spherical beads that are offered with a variety of size classifications of diamond abrasive particle sizes.

SUMMARY OF THE INVENTION

I. Raised Island Abrasive Articles

Diamond abrasive particles allow high speed abrading which results in very fast workpiece material removal. When flexible raised island abrasive disks having diamond particles are used at very high abrading speeds they can produce precision flat and smoothly polished surfaces on very hard workpieces at production rates that are many times faster than a slurry lapping system. Raised island disks use fixed-position diamond abrasive particles in two-body abrasion compared to the conventional slurry lapping system that uses loose diamond or other particles in three-body abrasion.

A continuous flow of water is used to cool the workpiece and the abrasive particles when using raised island abrasive disks, which results in a continuous self-cleaning of the abrasive disks. The use of water also allows easy collection of the grinding debris as compared to the difficult and messy clean-up that is required for abrasive slurry systems.

Water is used as a coolant when abrading with diamond particles at high speeds to remove the heat from the individual abrasive particles and from the workpiece surface. Heat is generated due to the rubbing friction between the abrasive and the workpiece as the abrasive is moved against the workpiece at the typical high abrading surface speeds of approximately 10,000 surface feet per minute (3,048 meter per minute) or more than 100 miles per hour. Generally, an excess of water is used to "flood" the surface of the abrasive. Also, the abrading cooling action can be made "dry", where only a mist of water is applied during the abrading action but a mist of water typically would not provide enough cooling action during high speed lapping to protect either or both the abrasive particles or the workpiece from thermal degradation. Overheated diamond particles tend to have their sharp edges dulled by this frictional heating process. Here, localized excessive friction-induced particle edge temperatures dull the tips of those individual particles that are in contact with a workpiece surface. Dull abrasive particles cut at a reduced rate and tend to increase frictional heating even more. Overheated or unevenly heated workpieces can develop surface cracks or out-of-plane surface distortions especially for those workpieces that are constructed from hard ceramic materials.

When diamond particles or abrasive agglomerate beads that contain diamond particles are used at high abrading speeds using conventional flat surfaced continuous coated abrasive sheet articles, hydroplaning of the workpiece often occurs. A workpiece that hydroplanes during abrading typically can not be ground or lapped flat because the hydroplaning tends to tilt a workpiece or raise localized portions of the workpiece away from the abrasive surface while other portions of the workpiece are in contact with the moving abrasive. Those portions of the workpiece that are in contact with the abrasive are ground down while those portions that are lifted-up or separated from the workpiece surface by an interface boundary layer film of water are protected from the abrading action. The end result is non-even grinding of the workpiece surface during the condition where hydroplaning occurs which prevents flat grinding of a workpiece surface. The resultant non-flat workpiece surface may be smoothly polished but in most instances it is unacceptable. In flat lapping it is required that a workpiece product have both a precisely flat and smooth surface to be acceptable for its intended use.

Use of raised island structures that are coated with abrasive agglomerate beads in place of continuous-coated abrasive disks can prevent significant hydroplaning of a workpiece during a high speed abrading process. The raised islands allow the excess coolant water to flow down or around the wall sides of the elevated islands. An analogy is the use of auto tires that have tread lugs instead of bald tires for use on rain water wetted highways. Bald tires hydroplane and lugged tires do not. These abrasive raised islands can provide both a smooth-polished and flat workpiece surface in the same abrading process step. It is not necessary to first flat-grind a workpiece surface with abrading techniques that result in a rough but flat workpiece surface and then to smoothly polish the rough surface in another independent low-speed abrading step to provide a smoothly polished and flat workpiece surface.

Raised island abrasive articles have been in use for some time but have only been useful for rough grinding a workpieces. These well known prior art articles do not have precision height island structures and typically are not coated with abrasive beads. The raised islands described here are coated with abrasive beads and the variation in the height of the islands, and the variation in the overall thickness of the abrasive article are both controlled to within a small percentage of the diameter of the abrasive beads which are coated in a monolayer on the top surface of the island structures. Control of the thickness of the abrasive article uniformly across the abrasive surface assures that the article can be successfully used for high speed flat lapping.

It is the combination of abrasive beads, that contain small abrasive particles, and precision thickness control of the raised island abrasive articles that provide the capability to provide workpiece surfaces at high abrading speeds that are both precisely flat and polished smooth. The materials of construction, the coating techniques, the material curing (oven heating and other curing) processes and other manufacturing processes that are used in the production of the prior art raised island abrasive articles are all well known in the art. Many of the same known construction materials, the coating techniques, the material curing (oven heating and other curing) processes and other manufacturing processes, or elements of them, that are described and used to produce the prior art raised islands can be employed in the manufacture of the raised island abrasive articles described here. A number of variations in these materials and processes are described here also to provide adequate guidance that someone skilled in he art can easily produce the described raised island abrasive articles.

II. Abrasive Beads

The use of equal sized abrasive agglomerate beads that are coated on a flat backing sheet offers full utilization of all or most of the abrasive particles that are contained in the beads as the abrasive sheet is progressively worn down during an abrading process. Use of equal sized abrasive beads also provides a superior workpiece abrasive media in that all of the abrasive beads coated on the backing sheet have the capability of being in contact with a workpiece surface during the abrading process. The surface of the workpiece is then abraded away more uniformly across its surface as compared to a backing sheet that is coated with abrasive beads that have a significant variation in size. For example, when the variation in abrasive bead size is greater than 20% of the average bead size, the utilization of the abrasive particles contained within the beads and the uniform polishing of the workpiece surface are lesser than if the bead size variation is less than 5%. Small diameter abrasive beads that are coated by conventional coating techniques with large diameter abrasive beads on a flat backing sheet typically do not contact the surface of a workpiece until the abrasive article is worn down substantially. No abrading action takes place on the surfaces of a workpiece that are located adjacent to the non-contacting undersized small abrasive beads. All abrading action takes place only in the localized workpiece surface locations where the large sized abrasive beads contact a workpiece surface.

It is desired that the full surface of a workpiece be actively contacted by all the abrasive beads coated on an abrasive backing sheet in the region of the abrasive article that contacts a workpiece during the abrading process. When this occurs, the full surface of the workpiece is abraded by many beads rather than just by a few large sized beads. Full contact with equal sized abrasive beads assures uniform abrasion of all localized regional areas of a workpiece surface. Uniform abrasion of the surface of workpieces comprising fiber optics or semiconductor workpieces is more effectively conducted with abrasive articles coated with equal sized abrasive beads as compared to abrasion of these workpieces with abrasive articles coated with random sized abrasive beads.

A method of manufacturing abrasive beads that produces beads with a very narrow range of bead sizes compared to other bead manufacturing process is described here. The process requires a very low capital investment by using inexpensive screen material that is widely available for the measurement and screening of beads and particles. Perforated or electrodeposited screen material can also be used. The beads can also be produced with very simple process techniques by those skilled in the art of abrasive particle or abrasive bead manufacturing. Those skilled in the art of abrasive article manufacturing can easily employ the new equal sized abrasive beads described here with the composition materials and processes already highly developed and well known in the industry to produce premium quality abrasive articles.

The new equal-sized beads can be bonded to abrasive articles using coating techniques already well known. The coated layer of abrasive beads is controlled to minimize the occurrence of more than a single (mono) layer of beads on an island surface. The resultant sheet or disk form of abrasive article has a single layer of abrasive particles bonded to island surfaces where the variation of height, measured from the backside of the abrasive particle backing, of adjacent particles on islands is preferred to be less than one half the average diameter of the particle. One objective in the use of a single layer or monolayer of abrasive beads is to utilize a high fraction of the expensive particles, particularly for the two super abrasives, diamond and cubic boron nitride (CBN) that are contained in each bead. Another objective is to minimize the dimensional change in the flatness of the abrasive article due to wear-down. A preferred abrasive bead size for lapping sheet articles is from 30 to 45 micrometers and most preferred is a nominal size of 45 micrometers. When the abrasive beads are half worn away, the abrasive surface of the islands has therefore only changed by approximately 0.001 inch (25.4 micrometers).

A number of the commercial abrasive articles presently available are coated with erodible composite agglomerate shapes including beads or spheres, pyramids, truncated pyramids, broken particle and other agglomerate shapes. These shapes have nominal effective diameters of two to ten times, or more, of the individual abrasive particles contained in the agglomerate body shapes. Large agglomerates can wear unevenly across the abrasive article surface from abrading contact with workpiece articles are can be due to a number of factors. If the abrading contact size of the workpiece is smaller than an abrasive disk article surface and is held stationary, a wear track will occur where the workpiece contacts the abrasive. Also, there often is an increased abrasive wear-down at the outer diameter portion of an abrasive disk article, having high surface speeds, and decreased wear-down at the inside diameter having slower surface speeds. When the agglomerate wears down unevenly on a portion of its surface and this uneven abrasive surface is presented to a new workpiece article, the new workpiece tends to wear unevenly. Uneven wear of a workpiece article reduces the capability of a lapping process to quickly and economically create flat surfaces on the workpieces. However, the same non-flat workpieces may be smoothly polished due to the characteristics of the fine abrasive particles embedded in the erodible agglomerates even though the workpieces are not flat.

A wide range of abrasive particles that can be used to coat abrasive articles and to be encapsulated within the spherical composite abrasive beads is disclosed. These abrasives include diamond, cubic boron nitride, fused aluminum oxide, ceramic aluminum oxide, heated treated oxide, silicone carbide, boron carbide, alumina zirconia, iron oxide, ceria, garnet, and mixtures thereof. These abrasive materials are widely used in the abrasive industry.

A method to produce equal sized spherical agglomerates from ceramic materials is described. These spheres can contain abrasive particles that can be coated on the surface of a backing to produce an abrasive article. The spheres can contain other particles or simply consist of ceramic or other materials. After solidifying the spherical agglomerates in heated air or a dehydrating liquid by techniques well know in the art, the spherical particles are fired at high temperatures to create spherical beads having abrasive particles distributed in a erodible porous ceramic material, again by well known techniques. Equal sized abrasive beads have many abrading advantages over the non-equal-sized beads presently used in abrading articles. A primary advantage is that all of the expensive diamond or other abrasive material is fully utilized with equal sized beads coated on an article in the abrading process compared to present articles where a large percentage of the undersized beads do not contact a workpiece and are not utilized.

III. High Speed Lapping Machines

Because flat lapped workpieces typically require a flatness of 1 lightband (11 millionths of an inch) or better, the abrasive disks must be precisely flat and the lapping machine platens that the disks are mounted upon must also be precisely flat. In addition the platens must provide a surface that remains precisely flat over a wide range of abrading speeds. The flexible abrasive disks must have abrasive surfaces that are precisely co-planar with the disk bottom mounting surface to allow them to be used successfully for high speed flat lapping.

It is also required that the abrasive disks have annular bands of abrasive covered raised islands where the bands have a radial width are approximately the width of the contacting workpiece flat surfaces. Further, it is desired that the differences between the inner and outer radii of the annular abrasive band are minimized to provide similar abrading contact speeds across the full disk abrasive surface area. Higher abrading speeds produce increased rates of material removal. Abrasive disks having a very small inner annular radius and a large outer radius will result in an undesirable large difference in workpiece material removal rates at the inner and outer radius portions. The use of large diameter abrasive disks with relatively narrow annular raised island abrasive bands assures that the workpiece surface is abraded evenly and that the abrasive material also wears evenly across the full abrasive surface during the abrading events. An uneven raised island abrasive surface can not produce precisely flat workpiece surfaces. Typically the workpiece is also rotated in the same rotational direction to provide a more even abrading speeds across the full radial width of the annular abrasive band.

Workpieces often have substantial sizes, which makes it necessary that these abrasive disks have large diameters. It is very difficult and expensive to produce abrasive lapper machines that have very large diameter platens that can provide precision flat platen surfaces over a wide speed range when using traditional roller bearing platen support bearings. Lapper machines that have large diameter platens that can operate at high speeds where the platen surface flatness remains precisely flat are described here. They use air bearings to support the platen structure assembly. This construction allows relatively inexpensive high speed lapper machines to be built that provide precision-flat platen surfaces and are robust for stable use over long periods of production time.

The use of air bearings to support a large diameter platen results in localized cooling of the platen assembly components due to the temperature drop of the pressurized air that passes through the air bearing pads as the air pressure diminishes. The air pressure that is supplied to the air pads is typically 60 pounds per square inch gauge, or more, and this air is exhausted at ambient pressure. The pressurized air expansion as it loses its pressure as it passes through the air bearing pad results in a large air temperature drop. When the pressurized air expands and cools it also gains a substantial air velocity which results in a substantial heat transfer convection coefficient.

The combination of cold air and high heat transfer reduces the temperature of the platen assembly component parts that are in contact with this moving cold air. When these platen components are cooled they shrink due to material thermal coefficient of thermal expansion effects. The shrinkage contraction of the components can result in very large thermal stresses in the components and also in other structurally coupled components. These structurally coupled components can be substantially distorted by the shrinkage contraction of the cooled and shrunken components. Also, the distortion often can be substantially multiplied in magnitude due to the leveraged interconnection of the platen assembly component parts. The resultant surface flatness of the structurally coupled platen can be easily distorted out-of-plane by amounts that substantially exceed the flatness requirements that are required for successful high speed flat lapping. A platen assembly that was manufactured with a platen that is precisely flat before pressurized air is provided to the air bearings can distort unacceptably when pressurized air is routed through the air bearing support pad. A platen assembly system is described here that diminishes these thermal shrinkage effects from distorting the critical platen assembly parts but yet structurally support the platen assembly.

An abrasive disk vacuum mounting systems allows the disks to be quickly changed on a lapper machine platen to progressively smaller abrasive particle grit sizes for developing a flat and smooth and workpiece surface. Here only a single lapper machine is required to abrade these workpieces that are typically made of very hard ceramic materials. Because the raised islands have flat surfaces that are in flat contact with a workpiece surface these abrasive disks can be used to polish semiconductor workpieces without eroding-out the metal interconnect lines that are present.

In addition, special construction features are described here that allow the construction of inexpensive precision flat platens that have vacuum abrasive disk hold-down capabilities. These platens are used in place of expensive sandwich layer type platens that have internal vacuum passageways. Here, a system is provided that allows these vacuum passageways to be constructed in the platen surface by the use of surface grooves that have passageway covers. Some of these covers have vacuum port holes to provide vacuum to the mounting side of the abrasive disk to attach the disk conformably to the platen flat surface. Other covers that are used to route the vacuum to various portions of the platen do not have port holes. Those covers that have port holes that become worn due to the ingestion of abrasive particles can be easily replaced.

BRIEF DESCRIPTION OF THE DRAWINGS

FIG. 28 (Prior Art) is a cross section view of the Ohishi U.S. Pat. No. 5,199,227 abrasive coated raised island structures.

FIG. 29 (Prior Art) is a cross section view of the Gagliardi U.S. Pat. No. 6,186,866 abrasive coated raised island protrusion structures.

FIG. 30 (Prior Art) is a cross section view of rectangular-walled Gagliardi U.S. Pat. No. 6,186,866 abrasive coated raised island protrusion structures.

FIG. 31 (Prior Art) is a cross section view of the Schutz U.S. Pat. No. 6,929,539 raised islands attached to a flexible porous foam backing sheet where the islands have pyramid shaped abrasive coatings.

FIG. 32 (Prior Art) is a cross section view of the Annen raised islands attached to a backing sheet where the islands have pyramid shaped abrasive coatings.

FIG. 121 is a cross sectional view of a workpiece that is angled downward and is abraded by a water coated moving raised island abrasive article.

FIG. 122 is a cross sectional view of a workpiece that is angled downward and is abraded by a water coated moving raised island.

FIG. 123 shows a cross section view of an offset rotation center spherical motion workpiece holder with a workpiece in flat contact with a raised island abrasive disk.

FIG. 124 shows a cross section view of a spherical motion workholder having a hemispherical shaped rotor where the rotor has an offset spherical center of rotation.

FIG. 125 shows a cross section view of a spherical motion workholder having a hemispherical shaped rotor where the rotor has an offset spherical center of rotation.

FIG. 126 is a top view of a wide workpiece contacting an annular band of rotating abrasive.

FIG. 127 is a top view of a narrow workpiece contacting an annular band of rotating abrasive.

FIG. 128 is a cross section view of an offset hemispherical workpiece holder apparatus.

FIG. 129 is a cross section view of an offset hemispherical workpiece holder apparatus.

FIG. 130 is a cross section view of an offset hemispherical workpiece holder apparatus.

FIG. 131 is a top view of a rotating circular workpiece that has coolant water applied at the front leading edge of the workpiece.

FIG. 132 is a cross section view of a workpiece that has coolant water applied at the front leading edge of the workpiece.

FIG. 133 is a cross sectional view of two flat plates in contact with a thin film of water separating the plates.

FIG. 134 is a cross sectional view of a flat plate workpiece in contact with water wetted abrasive bead coated raised islands.

Figure 135:
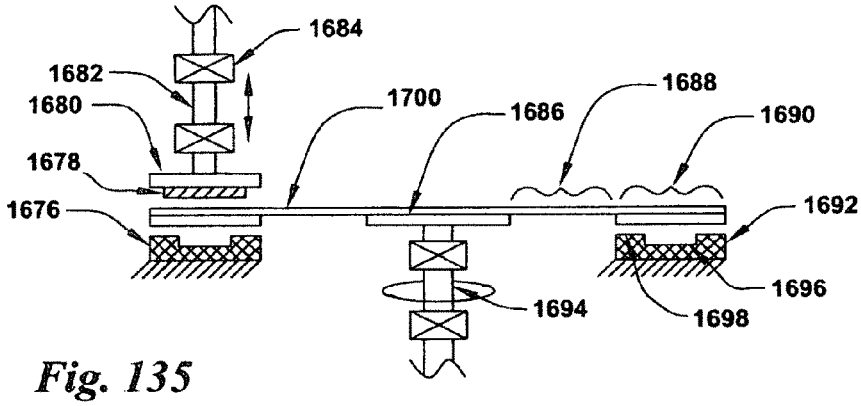

FIG. 135 shows a cross section view of a platen that has a thin and flexible annular middle section and a stiff annular outer periphery.

Figure 136:
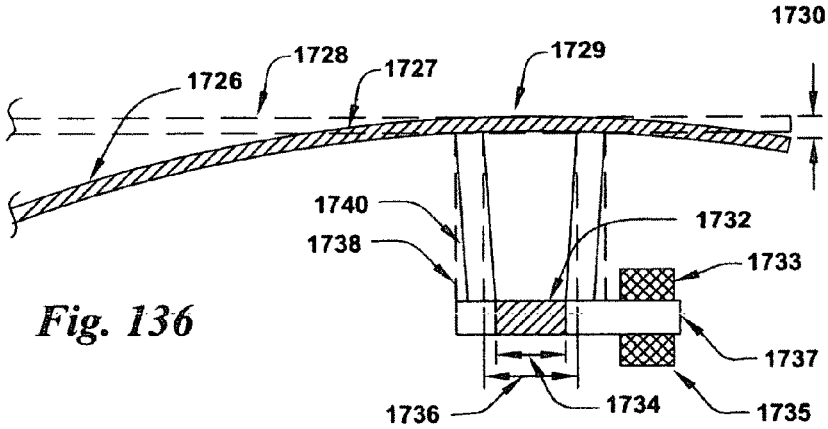

FIG. 136 is a cross section schematic view of the outer radial periphery of a horizontal high speed flat lapper platen and air bearing platen support system.

Figure 137:
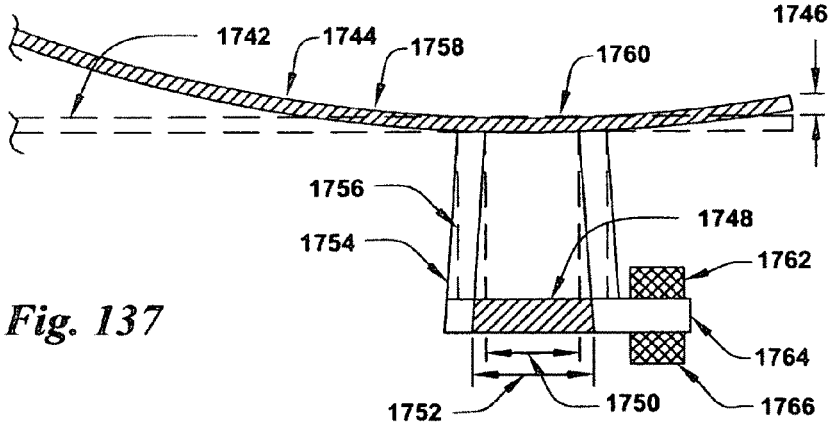

FIG. 137 is a cross section schematic view of the outer radial periphery of a horizontal high speed flat lapper platen and air bearing platen support system.

Figure 138:
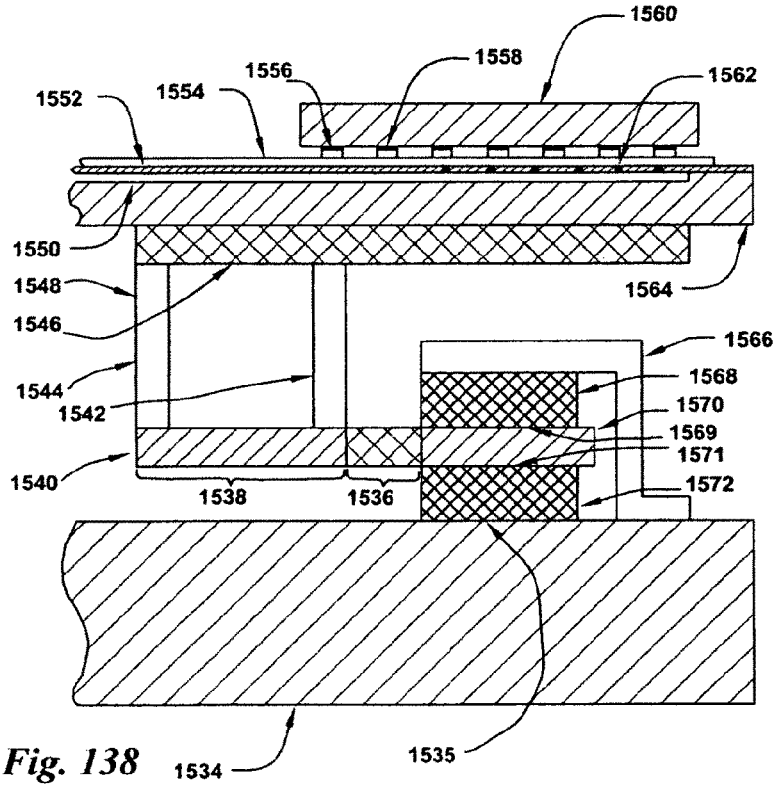

FIG. 138 is a cross section view of the outer radial periphery of a horizontal high speed flat lapper platen and air bearing platen support system.

Figure 139:
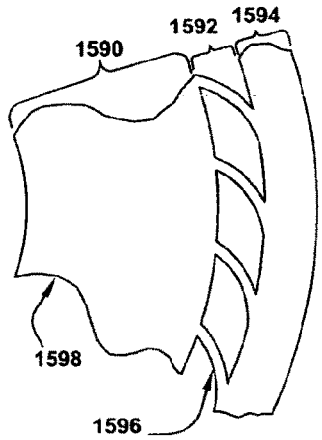

FIG. 139 is a top view of a section of the outer radial periphery of a horizontal high speed flat lapper platen and air bearing platen support rail having flexible ribs.

Figure 140:
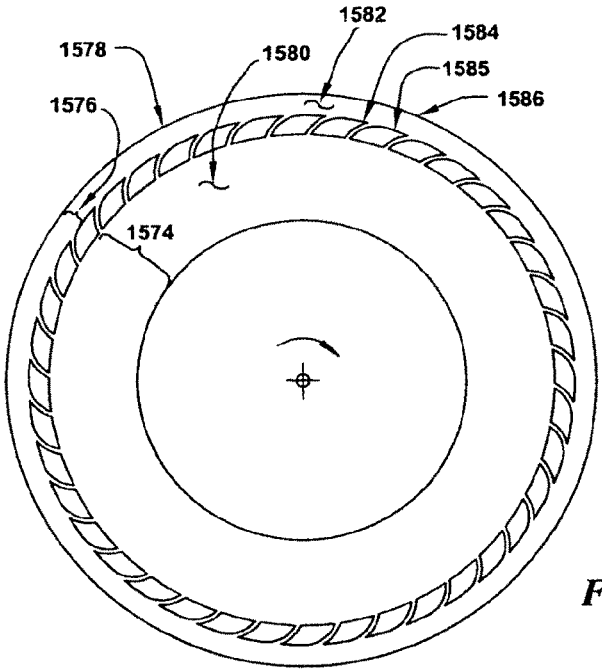

FIG. 140 is a top view of a section of a horizontal high speed flat lapper platen air bearing platen support rail having flexible ribs.

Figure 141:
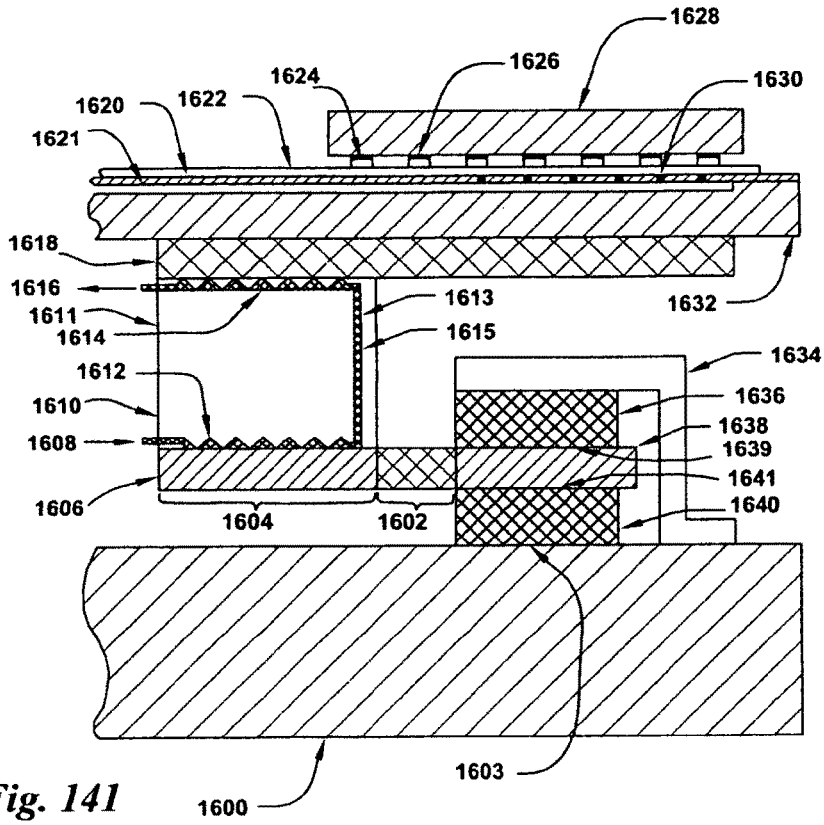

FIG. 141 is a cross section view of the outer radial periphery of a horizontal high speed flat lapper platen support system having internal heat transfer fluid passageways.

Figure 142:
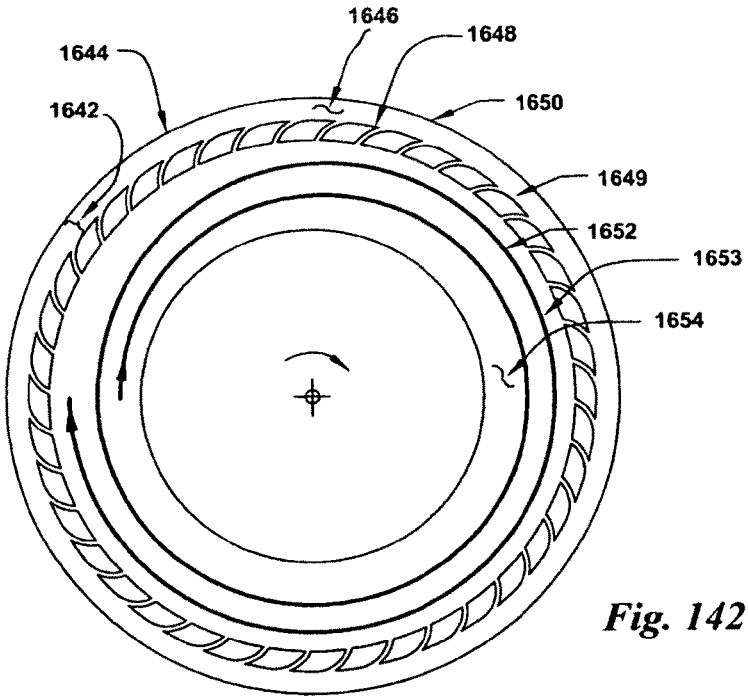

FIG. 142 is a top view of a section of a platen support rail and internal fluid passageways.

Figure 143:
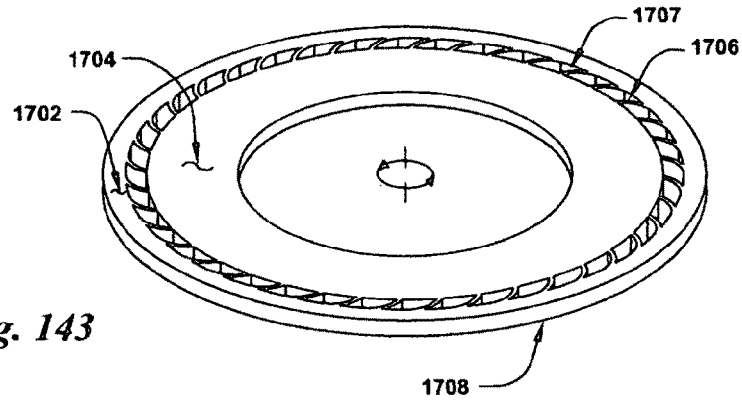

FIG. 143 is an orthogonal view of a lapper platen annular air bearing platen support rail plate.

Figure 144:
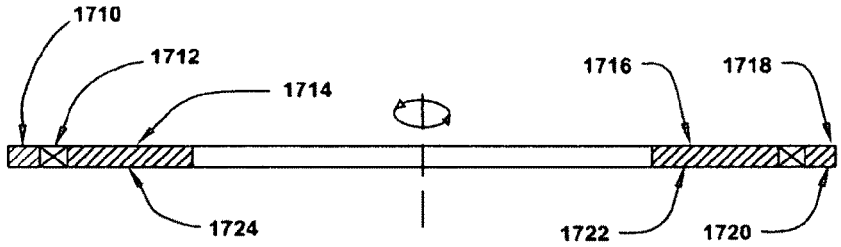

FIG. 144 is a cross section view of a lapper platen annular air bearing platen support rail plate.

Figure 145:
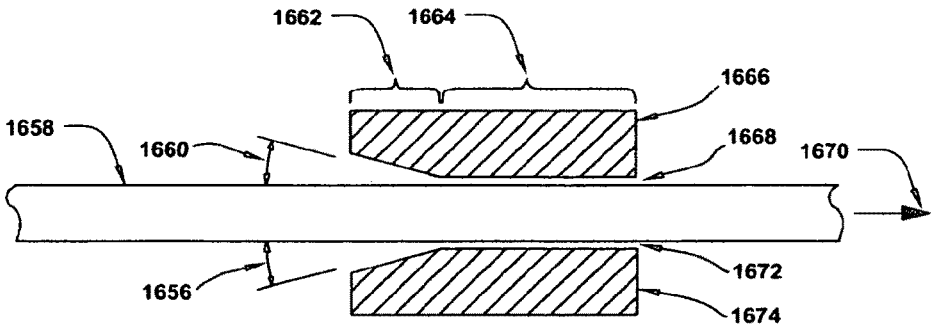

FIG. 145 is a side view of a section of a platen support rail with tapered-edge air bearing pads.

Figure 146:
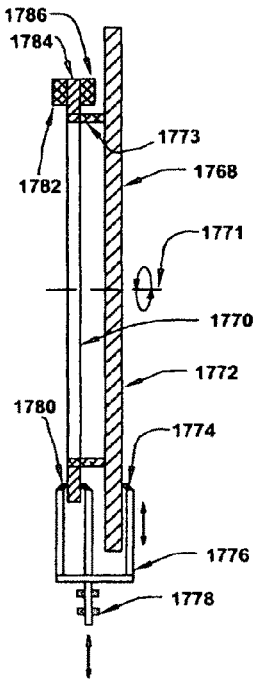

FIG. 146 is a cross section view of a high speed flat lapper platen and lathe tool apparatus.

Figure 147:
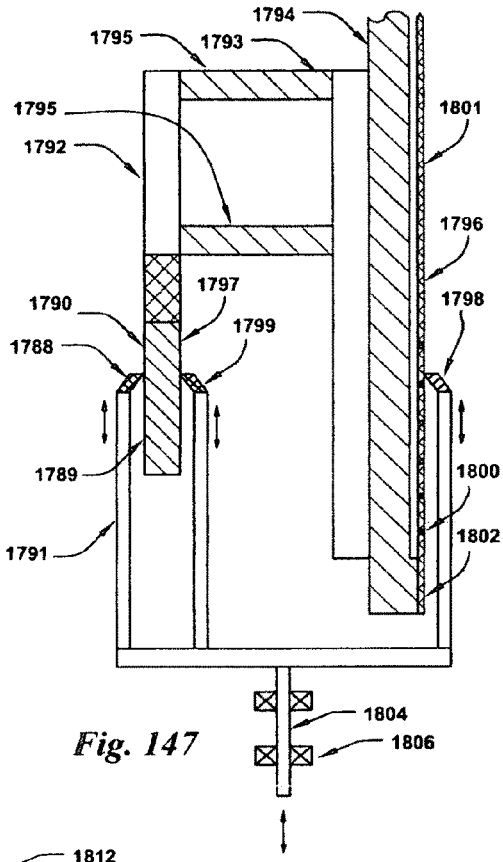

FIG. 147 is a cross section view of a peripheral section of a platen and lathe tool apparatus.

Figure 148:
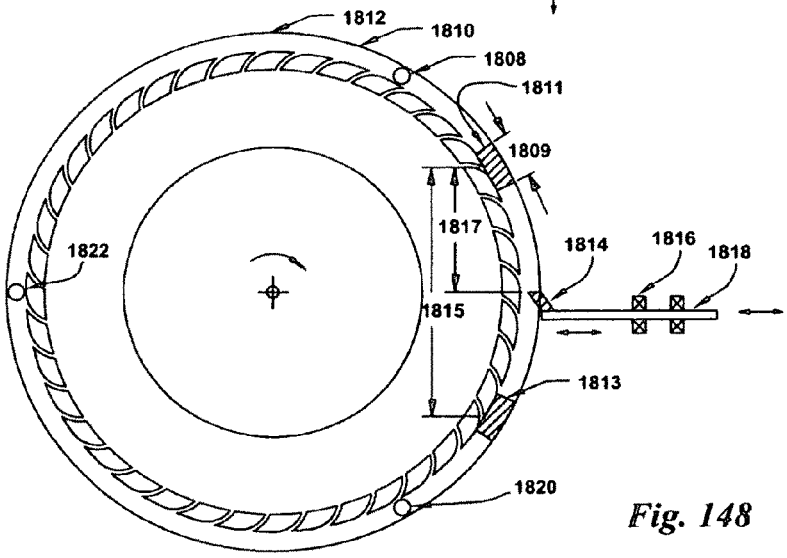

FIG. 148 is a top view of a peripheral section of a platen and lathe tool apparatus.

Figure 149:
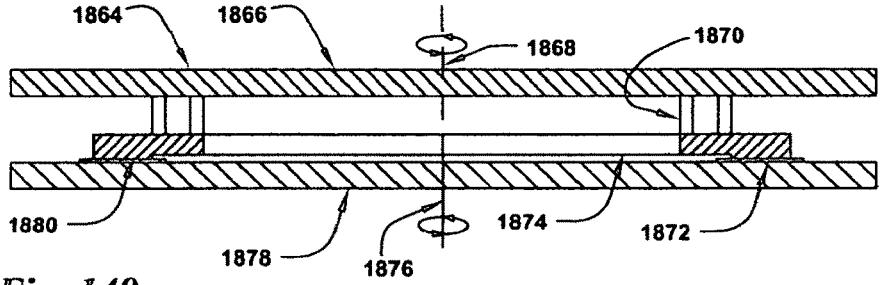

FIG. 149 is a cross section view of a platen assembly and a slurry lapper platen.

Figure 150:
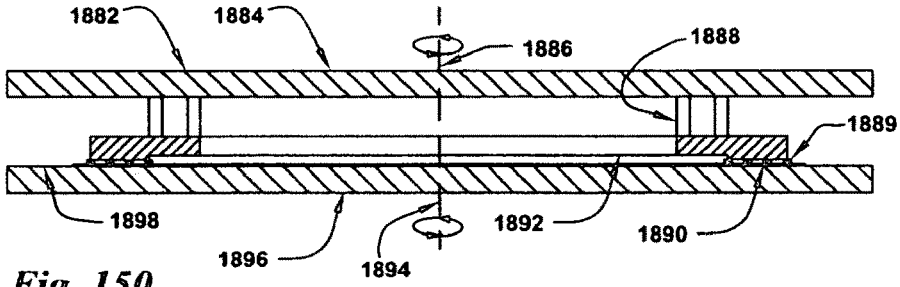

FIG. 150 is a cross section view of a platen assembly and a raised island abrasive disk lapper platen.

Figure 151:
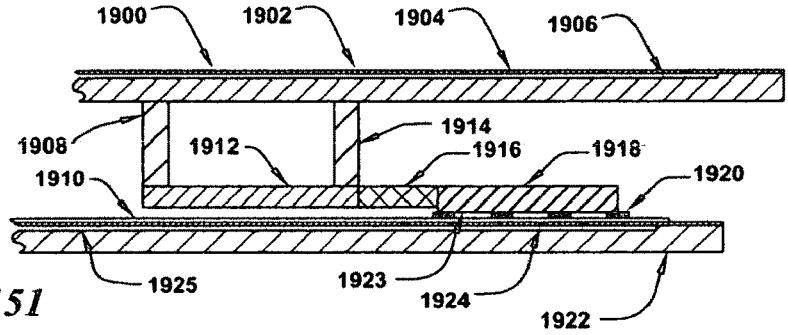

FIG. 151 is a cross section view of an outer periphery section of a high speed flat lapper platen assembly and a raised island abrasive disk lapper platen.

Figure 152:
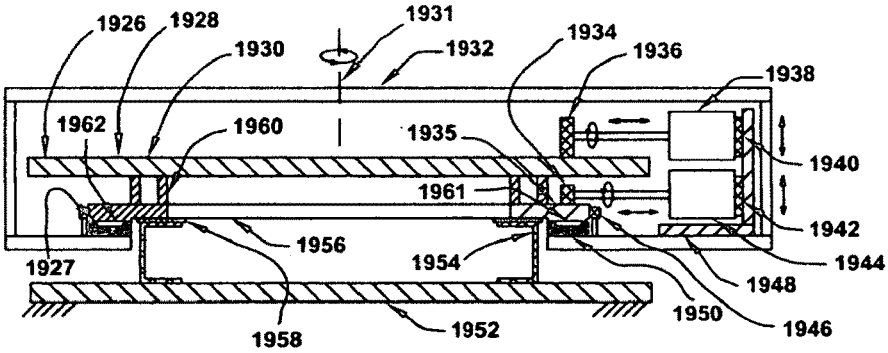

FIG. 152 is a cross section view of a flat lapper platen assembly and a platen assembly surface grinder system.

Figure 153:
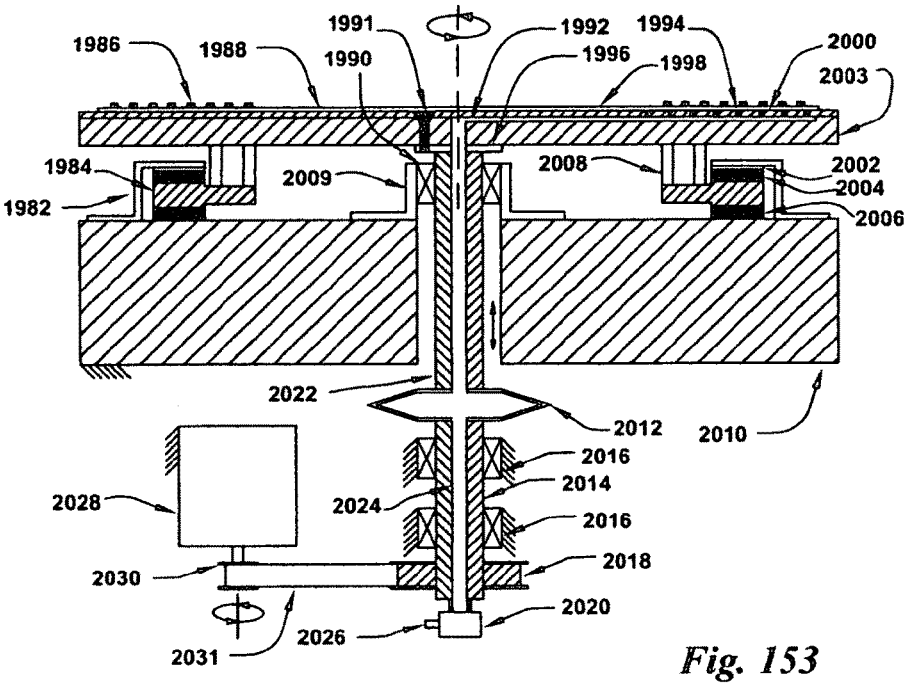

FIG. 153 is a cross section view of a platen assembly and machine base with an opposed-air bearing platen assembly support.

Figure 154:
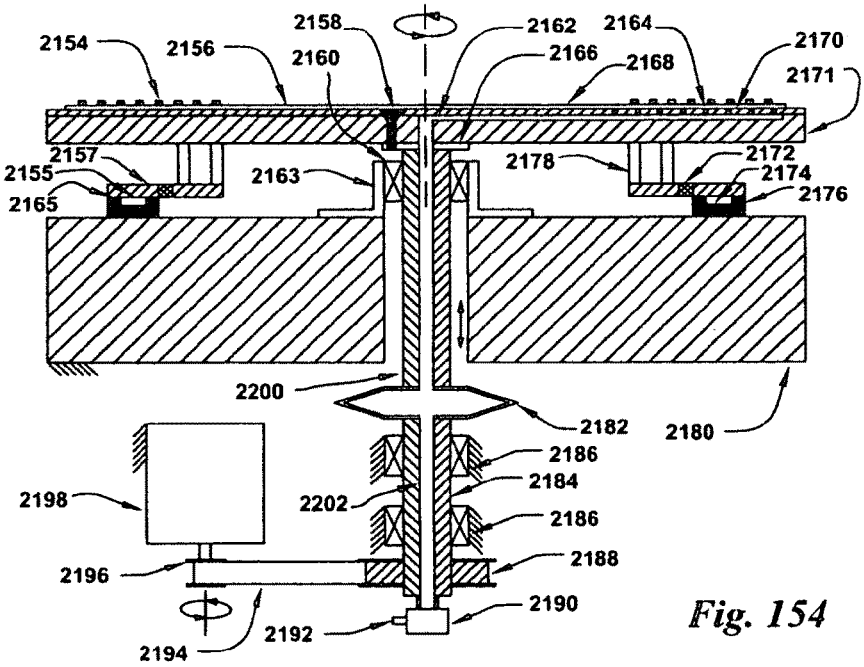

FIG. 154 is a cross section view of a platen assembly and machine base with a single-sided vacuum air bearing platen assembly support.

Figure 155:
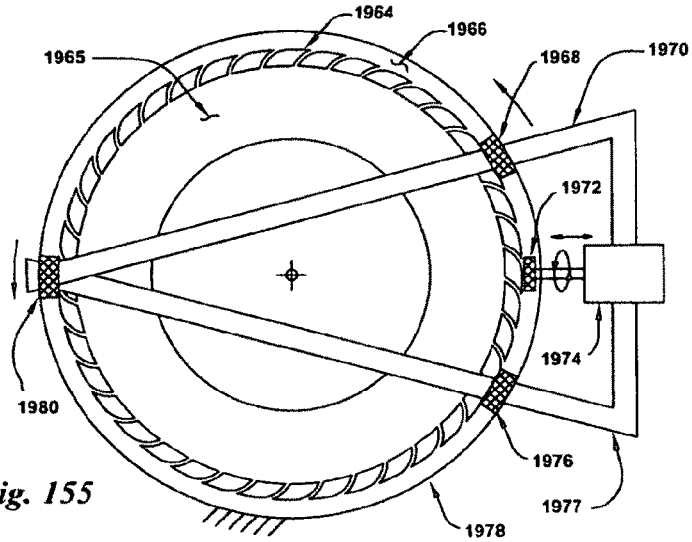

FIG. 155 is a top view of a high speed flat lapper platen assembly with a grinder apparatus.

Figure 156:
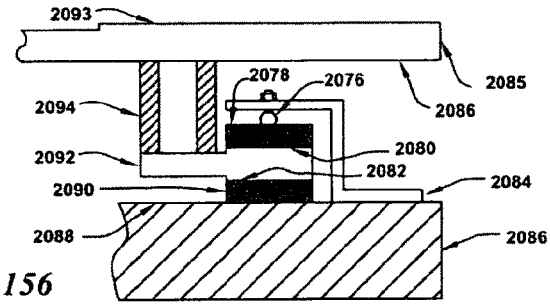

FIG. 156 is a cross section view of a platen assembly with an opposed air bearing support.

Figure 157:
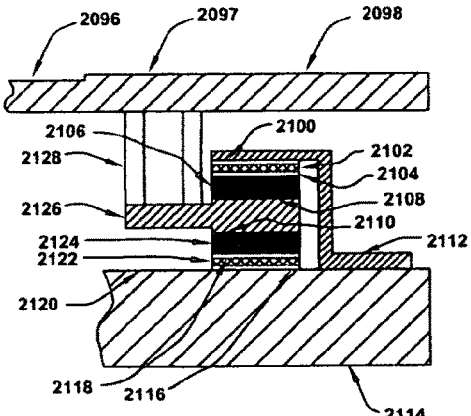

FIG. 157 is a cross section view of a platen assembly with an opposed air bearing support.

Figure 158:
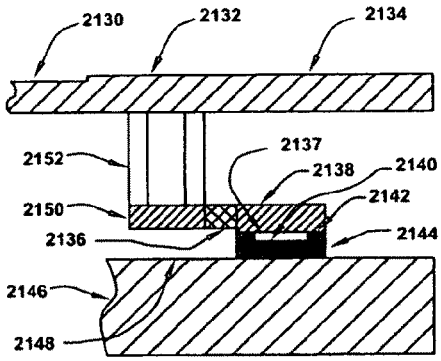

FIG. 158 is a cross section view of a platen assembly with an single-sided air bearing support.

Figure 159:
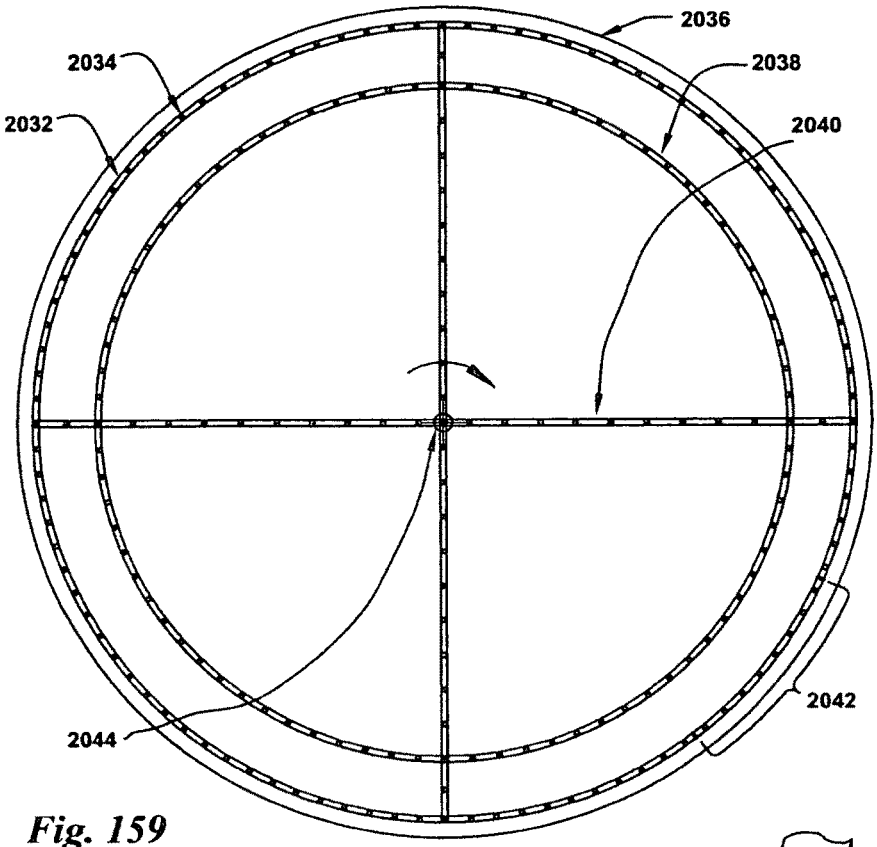

FIG. 159 is a top view of a flat lapper platen assembly that has vacuum passageway covers.

Figure 160:
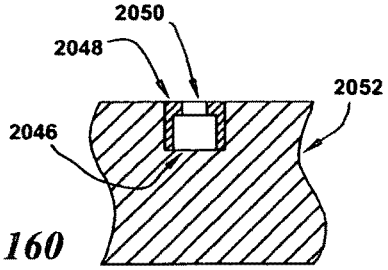

FIG. 160 is a cross section view of a portion of a platen having vacuum grooves and covers.

Figure 161:
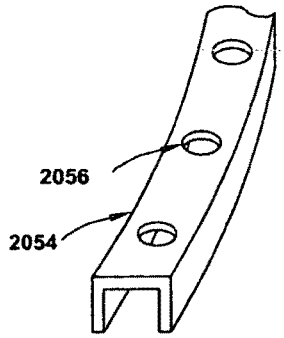

FIG. 161 is an orthographic view of a portion of a platen vacuum groove U-shaped cover plate.

Figure 162:
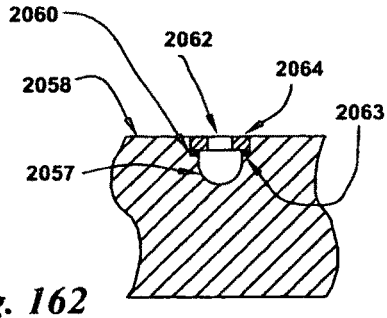

FIG. 162 is a cross section view of a portion of a platen round bottomed vacuum passageway.

Figure 163:
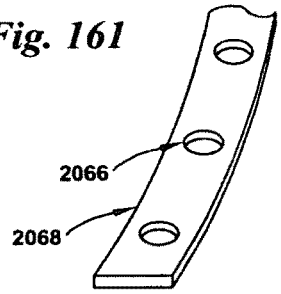

FIG. 163 is an orthographic view of a portion of a platen vacuum groove flat cover plate.

FIG. 164 is a cross section view of an adaptive controlled workpiece holder rotational axis position alignment system of a high speed lapper machine.

FIG. 165 is a cross section view of a semiconductor workpiece abraded by a flat raised island.

DETAILED DESCRIPTION OF THE INVENTION

The present invention may be further understood by consideration of the figures and the following description thereof.

In this application:

"abrasive particle" means, without limitation, an individual particle of abrasive material, the abrasive material including diamond, cubic boron nitride (CBN), aluminum oxide and other abrasives.

"abrasive agglomerate" means, without limitation, abrasive agglomerates comprised of abrasive particles in a matrix of supporting material where the agglomerate can have shapes that include spherical, near-spherical, irregular shaped lumps and other shapes.

"abrasive bead" means, without limitation, spherical abrasive agglomerates comprised of abrasive particles in a matrix of supporting material where the supporting material includes porous metal oxides or polymeric resins.

"bead" means, without limitation, a material or a number of different materials that are formed into a spherical shape where the bead is solid, porous or hollow.

"particle" means, without limitation, a material or a number of different materials that have or are formed into a shape, where the shape includes, without imitation, spheres, beads, rounded, irregular, cylindrical, triangular, pyramid and truncated pyramid shapes.

"stiction" means, without limitation, the condition when a drag force is exerted between a smooth workpiece and smooth abrasive article surface when there is a presence of coolant fluid between the mutual flat surfaces of the workpiece and the abrasive and there is a relative motion between both surfaces whereby the fluid acts as an adhesive between the abrasive coating and the workpiece surface which causes them to stick together.

"interface boundary layer" means, without limitation, the condition when there is a presence of coolant fluid in the gap between a smooth workpiece and a smooth abrasive article surfaces and there is a relative motion between both surfaces whereby the thin layer of fluid in the gap is sheared by the relative motion.

"hydroplane" means, without limitation, the condition when there is a presence of coolant fluid in the gap between a smooth workpiece and a smooth abrasive article surfaces and there is a relative motion between both surfaces whereby the thin layer of fluid in the gap has a variable thickness and the fluid layer thickness is sufficient to prevent contact of some abrasive particles with a portion of the workpiece surface.

Planarization of Ceramic-Metal Semiconductor Wafers

Problem: It is desired to quickly abrade the surfaces of circular wafers of hard ceramic workpiece wafer precursor materials that are used to fabricate ceramic-metal semiconductor devices. Ceramic materials are grown into cylindrical log shapes that have diameters that range from 200 mm (8 inches) to 300 mm (12 inches) or more. Semiconductor materials include silicon, aluminum titanium carbide (ALTIC), gallium arsenide, germanium and other materials. These wafers are both very hard and brittle which makes them susceptible to crack or break if they are scratched on their flat surfaces. The cylindrical logs are then saw-cut into ceramic wafers that have a wide range of thicknesses. For example, a 200 mm (8 inch) diameter wafer can have a saw-cut thickness of 725 micrometers (0.029 inches). For ease of handling in the variety of process procedures that are used to make individual semiconductor devices from these wafers, large 300 mm (12 inch) wafers have a initial thickness that is typically greater than the typical thickness of wafers that are 200 m (8 inches) or less in size. Larger wafers of equal thickness are less stiff than small diameter wafers and they will break if they are bent too far from a planar shape. The precursor ceramic material wafers must be initially abraded on both sides to develop flat surfaces that are parallel to each other, and also; to provide very smooth surfaces to each flat side. Areas of these ceramic wafers are then developed by deposition and abrading events with the use of photolithography masks into individual semiconductor devices that are interconnected with metallic paths. Upon completion of the deposition process steps, the many individual, but identical, discrete semiconductor areas are positioned on one side of each wafer.

Typically, the semiconductor devices and interconnecting circuits that make up a semiconductor device only have a total thickness of approximately 10 microns (0.0004 inches). The remainder of the thickness of the wafer, which is electrically non-active, makes up most of the thickness of the wafer. When operational, heat is generated by the electrical operation of the semiconductor device and this heat travels through the backside thickness of the wafer material before it is conducted away by the semiconductor enclosure case. It is desired that this backside non-active thickness of the semiconductor device be as thin as possible to improve the heat transfer away from the electrically active semiconductor circuits that reside on the front surface of the semiconductor device. To reduce the thickness of the non-semiconductor backside of the wafer, this surface is backside ground to remove most of the ceramic material originally contained in the wafer. Some of the large wafers are reduced to a total thickness that is less than 100 micrometers (0.004 inches) which makes them susceptible to both warpage and breakage. When a wafer is background, the wafer is attached to a flat platen and a flat-surfaced annular cup-wheel grinding having fixed abrasives is brought into flat or near-flat contact with the wafer. Typically the wafer is rotated as the grinding wheel is held in contact with the wafer surface and the grinding wheel is traversed over the surface of the wafer. A coarse abrasive media wheel is used to abrade away most of the removed material. Then a fine abrasive media wheel is used to develop a smooth polished surface on the wafer. Because the abrading contact area is concentrated along an angular segment of an annular abrasive coated "cup-edge" at the leading or trailing edge portion of the annular cup-wheel surface, the abrading contact force is concentrated along the annular segment, which typically results in relatively high abrading contact pressures. These high contact pressures occur particularly if the cup-wheel encounters portions of the workpiece that require increased amounts of material removal as the cup-wheel moves across the workpiece surface. These high cup-wheel abrading pressures can result in substantial workpiece material sub-surface damage.

Further, it is desired to quickly abrade the surfaces of hard ceramic workpiece slices that have semiconductor areas or paths of soft metal that is interspersed with the hard ceramic materials to develop a common surface to both the ceramic and metal that is both flat ands smooth. Dishing-out of the soft metal regions when abrading the hard ceramic material must be avoided. Planarization of the surface of the thin ceramic or ceramic-metal wafer slices is done by abrading these surfaces until they are precisely flat with all planar discontinuities removed.

Solution: As high speed raised island abrading system can be particularly useful for the planarization of hard workpieces such as semiconductors that are constructed from a composite of ceramic and metal materials where the both the flatness and surface finish are critical. Here, flat workpiece surfaces can be provided that have a polished smooth surfaces. The flat surface of the individual islands that are coated with fixed abrasive beads can not penetrate down into the soft metal paths as the rigid abrasive islands translate across the mutual ceramic and metal workpiece surfaces during an abrading operation. Coarse abrasive particles that reside inside spherical abrasive beads can be used to aggressively remove the surface discontinuities and unwanted blemishes very quickly from ceramic wafers workpieces with little heating of the surface of the workpiece due to use of coolant water during the abrading procedure. A smoothly polished surface can also be quickly developed with the progressive use of smaller abrasive particles. Thin slices of the ceramic wafers can be made that have surfaces that are parallel to each other by abrading flat one wafer surface and then remounting the wafer to abrade the second wafer surface. This procedure can be progressively repeated if desired to remove residual wafer deformations that are artifacts of mounting wafer slices that are not perfectly flat when abrading the opposite side of the wafer.

The low abrading pressures used in high speed lapping can result in substantial reductions in workpiece material subsurface damage as compared to the damage caused by high cup-wheel abrading pressures.

The same chemically-reactive materials that are typically used in chemical mechanical planarization (CMP) abrading processes for abrading or lapping semiconductor wafers can be used with the precision thickness flat surfaced abrasive bead coated raised island abrasive articles. These chemical materials aid in breaking down the inter-granular bonds between ceramic grains which reduces the amount of mechanical abrading energy that is required to separate and remove the elevated grains from a wafer surface during a planarization process. These chemicals can be applied to the abrasive or wafer surface during a high speed fixed-abrasive lapping process to provide very high speed lapping of the semiconductor surface with little erosion or gouging-out of the soft metal electrical conductors that are imbedded into the semiconductor ceramic surface. Hydroplaning is minimized because of the presence of the raised island structures. The elevated surfaces of both the hard material ceramic material and the soft metal paths are mutually reduced in height by the precision flat raised island surfaces that bridge across the metal paths during the abrading process. Because the abrasive particles are fixed to the surface of the raised islands the abrasive particles do not intrude down into the soft metal paths as do the loose individual particles in an abrasive slurry mixture. Chemicals or other materials that can be used with the raised islands in addition to water comprise ceria, aluminum oxide, alkaline solutions, KOH, potassium hydroxide, potassium oxide, potassium peroxide, potassium superoxide, hydrogen peroxide, ammonium hydroxide-peroxide and others or combinations thereof. Here, abrasive particles are suspended in a chemically-reactive solution is used as an abrasive slurry in addition to the diamond or CBN fixed-abrasive particles that are coated on the island top surfaces. If desired, the precision thickness flat surfaced diamond particle agglomerate bead coated raised islands in this CMP process can be supported by resilient foam backings as described in U.S. Pat. No. 6,752,700 (Duescher).

Subsurface Damage

When a workpiece surface is abraded, subsurface damage occurs that is not visible from the outside surface. It is well known to those skilled in the art that the amount and depth of the subsurface damage is related in part to the size of the abrasive particles and to the abrading contact pressure. The depth of the subsurface damage is typically equal to or up to three times the size of the abrasive particles. Increased abrading contact pressure also results in increased subsurface damage. During an abrading process, workpiece material is removed with larger sized abrasive particles and then an abrasive article having smaller particles is used to remove all of the subsurface damage that was caused by the previous step larger sized particles. This process of progressively reducing the size of the abrasive particles is repeated until the abrasive particles are small enough to produce a surface that has satisfactory smoothness. The more that subsurface damage occurs, the more material has to be removed in the next abrading step and the more time is consumed in the abrading process. The raised island abrasive disk articles described in the present invention allows the use of very low abrading contact forces during high speed flat lapping, which substantially reduces the depth and amount of the subsurface damage to a workpiece. For instance, the ratio of abrading contact pressure between high speed lapping and typical abrading can be greater than 50:1 or even 100:1. An abrading system that allows quick changes of abrasive articles having different sized abrasive particles with a minimum of subsurface damage for each abrasive particle size results in a highly efficient abrading processes.

Raised Islands

Use of the abrasive disks of this invention having annular bands of abrasive coated raised islands substantially reduces the effect of hydroplaning at high abrading speeds. Each of the raised islands has a flat surface that is coated with a monolayer of diamond particle filled ceramic beads. The dimensions of the islands in the tangential direction are short to reduce the effect of a continuous abrasive coating. Typically the islands are cylindrical in shape and are located on the backing in annular geometric arrays where there are no open tangential tracks of island-less abrasive areas. Open recessed area passageways exist between each raised island.

The recessed areas between the raised islands perform a number of advantageous functions. First is the reduction in the quantity of the built-up water on the surface of the abrasive as it is carried along from the water source to the leading edge of the workpiece that is flat planar contact with the abrasive surface. A second is to provide passageways for excess water and for debris that is generated by the abrading action to exit the abrasive disk. A third effect of the tangentially short island dimensions is to reduce the amount of the applied coolant water that can be supported by an individual island surface. This small amount of excess water can be sheared off by the leading edge of the workpiece as the flat island passes under the leading edge without substantially lifting the leading edge of the workpiece. Fourth, any excess water that tends to build up at the leading edge of the workpiece either falls into a recessed passageway that follows a moving island or the water is driven into a passageway because the open passageway offers no hydraulic resistance. Fifth, the recessed areas provide free passageways for any steam that is formed by abrading friction heating of the water coolant. Here, the steam can pass from the center of the workpiece to the outer perimeter with developing a pressure that can lift the workpiece away from the surface of the abrasive. Collectively, the effects of the abrasive bead coated flat surfaced raised islands is to provide an abrasive disk that can successfully flat-lap abrade flat workpieces at great abrading speeds. Sixth, the recessed passageways between the individual raised islands allow unrestricted escape pathways for any high volume steam that is formed by localized friction heating caused by the abrading process. These recessed passageways prevent the potential buildup of large localized steam bubbles that could raise the surface of a workpiece away from the abrasive surface.

This results in precisely flat and smoothly polished workpieces that are produced at high production rates. These flat and smoothly polished workpieces can not be produced at high speeds when using the continuous coated abrasive disks that have the same diamond particle filled ceramic abrasive beads.

The raised island abrasive disks in the present invention have a number of features that make them unique from the many other prior art raised island abrasive disks. The present disks can be used successfully in the art of high speed flat lapping. None of the other raised island prior art disks can be used successfully for this process procedure for a variety of reasons. The present disks have precision thickness flat-surfaced raised island structures that are coated with a monolayer of small erodible ceramic beads that are filled with very small diamond abrasive particles. The size of the small beads is typically only 0.002 inches (45 micrometers). The overall thickness of the abrasive disk is precisely controlled over the whole abrasive portion of the disk to within a small fraction of the non-worn beads. The overall thickness of the abrasive disk is measured from the top surface of the abrasive beads to the back side (mounting) surface of the disk backing. Control of the disk thickness assures that each abrasive disk can be used repetitively and that all of the expensive diamond particle abrasive that is coated on a disk will be utilized before a worn disk is discarded. Each of the individual islands has a significant sized surface area but this surface area has dimensions that are limited in size in a disk tangential direction. By limiting the island areas to roughly approximate tangential dimensions of 0.25 inches (0.64 cm), the disk can be used at high abrading speeds successfully in the presence of water coolant without hydroplaning of the workpiece. Because the workpiece does not hydroplane, the workpiece can be successfully abraded where it has both a precisely flat and smoothly polished surface. The raised islands are located in arrays where the center portion of the disk is free of islands to assure that no slow moving abrasive is presented to a workpiece surface.

The present invention raised island abrasive disks can only be used on a rigid flat platen and can only be used to abrade a flat workpiece surface. These disks can not be used on either convex or concave workpiece surfaces. In particular, these disks can not be used on disk-center arbors using flexible rubber backup pads that allow the raised island abrasive disk surface to assume a curved non-planar shape. This usage limitation occurs in part because the raised island surfaces are coated with a very thin 0.002 inches (45 micrometers) layer of (non-worn) abrasive beads. Very thin monolayer coatings of abrasive material that are bonded to the island flat top surfaces prevents the abrasive material to wear down sufficiently to conform to the workpiece curvature without completely wearing away portions of the abrasive. It is undesirable for the island structure material to be in direct contact with a workpiece surface during an abrading process. This can easily occur when the extra-thin partially-worn abrasive layer is penetrated by the workpiece at the curvature location.

Also, another important factor in preventing the use of raised islands on curved workpieces is the localized stiffness of the individual raised island structures that are attached to a flexible backing sheet. Because the raised island structures are thicker than the backing sheet, the combined thickness of the structures and the backing sheet is considerably thicker than the thickness of the backing sheet alone. The localized stiffness of the individual raised island structures is proportional to the cube of the total thickness. An island structure that is double in thickness compared to the backing has a stiffness that is eight times that of the backing. As a result, the abrasive disk has an array of localized stiff raised island structures with recessed gaps between the raised islands that are attached to a very flexible backing sheet. Only the flexible polymer backing material, having a typical thickness of just 0.004 inches (90 micrometers), supports the disk in these recessed areas. In abrading use, if an attempt is made to bend these islands to conformably fit the curvature of a workpiece there will be a tendency for each island structure to simply pivot about the recessed gap adjacent to the island. Here, the flexible backing located in the recessed gap would act as a hinge joint because the backing alone in these gap areas is flexible and the adjacent individual island structures are stiff. This is analogous to flexing the thin-lip "living hinge" that mutually joins the two stiff half-cover structures of a molded plastic box when the box is opened or closed. The box lip is flexed but neither of the box halves are significantly distorted. It is not possible for any of the individual islands to be in full-flat contact with the curved workpiece. The sharp edges of those islands that do contact the curved workpiece can easily scratch and damage the workpiece surface. Also, when the islands are pivoted upward, the edges of the stiff islands can easily be caught by a protuberance on a workpiece which would tend to rip the individual islands off the backing sheet.

Likewise the present invention raised island abrasive disks can not be mounted on disk-center arbors using flexible rubber backup pads and then be used to flat-lap abrade a flat workpiece surface. Here, the disk planar surface is manually held at an angle to the workpiece surface and then the disk is forcefully pressed into contact with the flat workpiece surface. An attempt would be made to bend the raised island disk with the use of the flexible backup pad so that a portion (only) of the outer periphery of the disk conforms with the flat surface of the workpiece. Again, there will be a tendency for each island structure to simply pivot about the recessed gap adjacent to the island when a portion of the disk is distorted back into a partially flat configuration as the disk is rotated. If all of the individual islands are not in full-flat contact with the workpiece, the sharp edges of those pivot-tilted islands that contact the curved workpiece can easily scratch and damage the workpiece surface.

In the present invention, removable or replaceable raised island flexible annular-band abrasive disks are attached to a support rotary platen exclusively with vacuum. Use of mechanical hook-and-loop abrasive disk attachment devices are avoided because these mechanical attachment systems can not provide sufficiently precise disk thickness control for flat lapping. In particular, the mechanical disk attachment system that uses a screw cap to attach a disk to a disk-center arbor is avoided because of the great out-of-plane disk distortions that are caused by the arbor screw. These disk distortions completely prevent flat lapping. Likewise the use of disk adhesive layers between the disk sheeting and the platen are avoided because these adhesive attachment systems also can not provide sufficiently precise disk thickness control for flat lapping. It is necessary that each raised island abrasive disk has a very precise thickness and is mounted on a platen that maintains very precise flatness even when the platen is operated at high rotating speeds. Raised island disks used for flat lapping typically use a monolayer of abrasive beads that only are 45 micrometers (0.002 inches) in diameter when the beads are unworn. Any variation in the abrasive disk thickness caused by a disk-to-platen attachment system that exceeds even a fraction of these abrasive bead sizes precludes that abrasive disk from being used in flat lapping. When the abrasive beads are substantially worn to even one fourth their original size, the abrasive disk still has excellent abrading performance. However, an abrasive disk having substantially worn abrasive beads is even more susceptible to height or thickness changes that are imposed by the disk attachment system. Vacuum attachment consistently provides a near-zero influence on the abrasive disk thickness, where this thickness is measured from the top surface of the abrasive to the top surface of the platen. Once one of these expensive diamond abrasive coated precision thickness raised island disks is used in a non-flat state caused by a disk attachment system, this disk is destroyed for further use. Here, all of the abrasive is removed from the disk "high-spot areas" by abrading action which then exposes the bare disk backing to a workpiece surface, a condition that is unacceptable for flat lapping. The combination of precision thickness raised island disks and precision-flat platens is required to provide flat lapped workpiece surfaces.

It is desirable for all of the abrasive coated raised islands to be positioned in annular bands on the disk backing sheet where a substantial portion of the inner disk radius has an absence of abrasive. Workpieces are presented in flat abrading contact with the whole surface of the rotating annular band to assure even wear-down of all the abrasive on the disk. It is necessary for the abrasive disk to maintain a precision planar-flat abrasive surface for the disk to provide precisely flat workpiece surfaces as the abrasive disk wears down with usage.

The raised islands are coated with equal sized small ceramic beads that are filled with very small diamond abrasive particles which provide smoothly polished workpiece surfaces. Coolant water is required to protect expensive diamond abrasives and also, the workpiece surface, from overheating due to abrasive friction during high speed flat lapping. However, the presence of water at these high speeds causes unstable hydroplaning of a workpiece as it is abraded. Hydroplaning tends to temporarily or consistently tip the workpiece and cause uneven abrasive wear of the workpiece surfaces. This tipping action has in the past consistently prevented the formation of precision flat workpiece surfaces when using precision thickness continuous abrasive bead coated disks. Many factors related to the uniformity of the workpiece surface, the geometric shape of the workpiece, the quality and performance of the lapping machine and lapping process variables affect hydroplaning.

Use of conventional non-precision flat and non-uniform thickness raised island abrasive disks that were modified to have abrasive annular band shapes were used in the presence of water at high speeds in an attempt to flat lap workpieces. These disks had raised islands that were formed by metal plating island structures and then bonding diamond abrasive particles to the island top surfaces with additional metal plating. They provided flat workpiece surfaces but they failed to also produce surfaces that were smoothly polished.

However, the precision thickness raised island abrasive disks of the present invention can successfully allow precision flat lapping at these high speeds in the presence of water where the workpieces have both smoothly polished and precisely flat surfaces.

The capability of a raised island abrasive disk to provide a flat surface on a workpiece is directly related to the flatness of the abrasive disk when used on a rotary platen at high abrading speeds.

The allowable variation in the thickness of a raised island abrasive disk is directly related to the size of the abrasive beads that are coated on the island flat top surfaces. It is necessary to provide monolayers of small sized abrasive particle filled ceramic beads on the surface of raised islands to optimize the use of expensive diamond abrasive material. A nominal bead size of 45 micrometers (0.002 inches) is the preferred size for use of diamond particles that range from 0.01 micrometers to 10 or even 20 micrometers. It is not practical to coat the top surfaces of raised island with monolayers of diamond particles that have sizes of less than 20 micrometers because the abrasive article would have such limited abrading wear life. It is not preferred to use abrasive beads that have a size much larger than 45 micrometers (0.002 inches) because it is desired to limit the total wear down distance of the monolayer of abrasive particles over the abrading life of the abrasive article. In this way, an abrasive disk has an original precision flatness at the beginning of the abrasive life of the disk and even when the article has fully worn down, the thickness of the disk has changed only by the original non-worn size of the beads, which is 0.002 inches (45 micrometers). In flat lapping, the required flatness of these workpieces is typically much less than the full size of the beads. If the abrasive disk has a thickness variation across the surface of the disk abrasive that is greater than 0.001 inch (23 micrometers).

Spherical shaped beads are the optimum shape to present the very small sized diamond abrasive particles that are required to produce smooth workpiece surfaces. Pyramids, blocks and other agglomerate shapes are not nearly as efficient in the utilization of the diamond.

The abrasive articles and processes used in the rotary platen high-speed flat lapping system as described here are distinguished from conventional abrading articles and processes. Flat lapping is most often done with a slow speed flat surfaced flat platen that is coated with a liquid slurry mixture of loose small abrasive particles. A flat workpiece surface is held in full-surface contact with the slurry coated moving slow rotation platen to slowly remove the high regions of the workpiece. The workpiece can be held stationary or rotated. Slurry abrasive mixtures are messy and require extensive clean up after an abrading event. A workpiece can also be flat lapped with a fixed abrasive sheet that has a monolayer of small abrasive particles or abrasive beads that are bonded to a backing sheet with a resin adhesive. The abrasive sheet can be placed with backside contact with a flat stationary surface plate and the workpiece placed in full-surface flat contact with the exposed abrasive. Typically the workpiece is moved in a geometric motion pattern while the workpiece is held by hand with a small contact pressure against the abrasive in the presence of water. For precision flat lapping, great care is taken not to structurally distort even a stiff workpiece with uneven finger pressure to avoid creating very small out-of-plane surface abraded areas. A film of water is used as an abrading lubricant to provide a nominal separation of the workpiece from the abrasive and to wash the abrading debris from the abrading contact area.

Conventional abrasive articles also include abrasive disks that are attached to rigid flat surfaced rotating platens that can be used to grind the surface of a workpiece. In addition, conventional abrasive articles also include abrasive disks that are attached to flexible or rigid bevel shaped backup pads that are supported by a disk-center arbor that is attached to a body-sander type of manual rotating tool device. These arbor-mounted disks can be used to grind the surface of a workpiece but they can not be used to precision flat lap a workpiece surface. Arbor mounted disks include continuous abrasive surfaced disks, stacked flapper disks and raised island disks. These same type of disks that do not have an arbor aperture hole can also be mounted to an abrading tool with the use of adhesives or mechanical hook-and-loop attachment devices, both of which do not provide sufficient control of the flatness of the abrasive surface for flat lapping. They are intended to provide abrading line contact or abrading spot contact with a workpiece neither of which is appropriate for flat lapping. None of the many prior art raised island abrasive disks have precisely controlled abrasive disk thicknesses which disallows them for flat lapping. A raised island disk that is mounted on a cone-shaped beveled rigid backup pad results in abrading line contact with a flat workpiece and because of this line contact can not be used for flat lapping. All of these conventional abrasive articles, including abrasive slurry articles, can not be used to simultaneously provide precision-flat and smooth-polished workpiece surfaces when they are used at high abrading speeds in the presence of the required water coolant. The present abrasive articles described in this invention are particularly different from abrasive disk articles that are mounted on an arbor and used on a manual body-sander type of tool.

The abrasive raised islands articles of the present invention have abrasive coated flat-topped protrusions that are attached to a flexible backing sheet disk. The overall thickness of the abrasive disk articles is very accurately controlled to within a fraction of the size of the small abrasive particle filled abrasive beads that are coated on the island flat top surfaces. This high-speed system is particularly useful for the planarization of hard workpieces such as semiconductors that are constructed from a composite of ceramic and metal materials where the both the flatness and the smoothly polished surface finish of the workpieces are critical. Here, the semiconductor workpiece surfaces are provided that are mutually flat across both the ceramic and metal regions without dishing-out of the soft metal materials. It is desirable to avoid abrading the metal pathway surfaces so they are below the surface of the adjacent ceramic material. Maintenance of common plane surfaces of the metal and ceramic occurs because the controlled-flatness abrasive is fixtured to the flat surfaces of the raised islands and the moving abrasive is held in the plane of the localized hard ceramic region bridges that surround the soft metal regions. The metal portion is reduced in thickness only when the hard ceramic material that surrounds the metal is also reduced in thickness. Because the abrasive beads contain very small abrasive particles, a smoothly polished workpiece surface is provided simultaneously with a precision flat surface.

The use of the raised island abrasive disk articles and the lapping equipment described in this invention allows changing of the abrasive disks to be made quickly with little clean-up or other preparations.

Precision workpiece flatness that is typically required of flat lapping procedures is 1 lightband or even much less. For reference, 1 lightband represents a flatness that is 11.1 millionths of an inch (11.1 microinches or 0.28 micrometers). Measuring these flatness variations across the surface of a workpiece to determine the numerical values of these small dimensional variations with traditional Toolmaker's mechanical measuring devices is very difficult, as these tools typically do not have this accuracy resolution. Instead, an optical flatness measuring devices is often used that indicates these flatness variations by optical fringe patterns that can be viewed visually. Here, each fringe line represents a 1 lightband variation in surface flatness across the surface of the workpiece. Other types of optical measurement devices can also be used to establish the precise flatness of a workpiece.

Smoothly polished precision workpiece surface finishes that are typically required of flat lapping procedures is 1 Ra (1 microinch) or even much less. These workpieces have surface finishes that are measured with the use of surface indention probe devices or with the use of optical measuring devices. Probe devices measure surface variations in a selected straight-line segment on the surface of a workpiece. Numerical information is presented that represents the vertical movement of the probe tip as it contacts and traverses the workpiece surface over a short line segment. These surface finish measurements are usually categorized as roughness average variations (Ra), which measures peak and valley-bottom distances. The valleys that exist on the surface of an abraded workpiece are produced by the exposed cutting edges of individual abrasive particles that contact the workpiece. There are other measurements that are used to categorize the surface roughness of a workpiece, such as the maximum height between peaks and valleys. A surface finish measurement of Ra=1, as used in the machining industry, is often referred to as 1 microinch (1 millionth of an inch or 0.0254 micrometers or 25.4 nanometers). Workpieces having highly polished mirror finishes have roughness measurements that range from 0 to 0.5 microinches.

Providing a smooth surface on a workpiece requires the use of progressively smaller sized abrasive particles. Typically the depth of a scratch that is formed on the surface of a workpiece is approximately the size of the abrasive particle that made the scratch. A polished workpiece is one that has been abraded by progressively smaller abrasive particles where the smaller particles remove the deep scratches generated by the preceding larger particles. Large abrasive particles remove large amounts of workpiece material, which is effective in generating a flat surface, but they leave large and deep scratches. A polished workpiece having a mirror (reflective) surface is one that still has a pattern of very small surface scratches. To produce scratches that are small enough to produce a mirror surface requires abrasive particles that have size dimensions that are less than 1 micrometer (0.000039 inch) in size. Small abrasive particles are not used exclusively as a single abrading step in workpiece flat lapping procedures because it would take too long for the small particles to provide a surface that is flat in addition to being smooth.

Raised Island Abrasive Disks

Raised island abrasive articles have been in use for many years but have only been useful for rough grinding a workpiece. These well known prior art raised island abrasive articles do not have precision height island structures and are coated with abrasive particles but these raised islands are not coated with abrasive agglomerate beads. The raised islands described here are coated with abrasive beads and the variation in the height of the islands, and the variation in the overall thickness of the abrasive article are both controlled to within a small percentage of the diameter of the abrasive beads which are coated in a monolayer on the top surface of the island structures. It is the combination of abrasive beads, that contain small abrasive particles, and precision thickness control of the raised island abrasive articles that provide the capability to provide workpiece surfaces at high abrading speeds that are both precisely flat and polished smooth. The materials of construction, the coating techniques, the material curing (oven heating and other curing) processes and other manufacturing processes that are used in the production of the prior art raised island abrasive articles is well known in the art. Many of the same construction materials, the coating techniques, the material curing (oven heating and other curing) processes and other manufacturing processes, or elements of them, that are described and used to produce the prior art raised islands can be employed in the manufacture of the raised island abrasive articles described here. A number of variations in these materials and processes are described here also to provide adequate guidance that someone skilled in he art can easily produce the described raised island abrasive articles.

Individual raised island abrasive articles can be cut out from web backings without disturbing the structural integrity of either the raised island structures or the abrasive coatings on the structures by cutting out the article with a cutting pattern that avoids cutting through the thickness of the raised island structure, but instead, by cutting through the thickness of the backing sheet adjacent to the raised islands.

The preferred method of manufacturing an abrasive article having abrasive particle coated raised island structures that are attached to a flexible continuous-web backing sheet material is to first produce a web having non-coated raised island structures that have island top surfaces that are precisely located in a plane that is parallel to the flat mounting side of the backing sheet. Then, it is preferred that an abrasive coating be applied to the flat surfaces of the raised islands. The same preference exists for manufacturing raised island abrasive articles from individual sheets of non-continuous-web backing material. Precisely flat abrasive island structures that are attached to a backing sheet are first manufactured and then these island structures are coated with abrasive particles or abrasive agglomerates. If uncoated island structures can be produced sufficiently flat in a common plane that is precisely parallel to the back mounting surface of a backing sheet the structures can be coated with a monolayer of abrasive particles or abrasive agglomerates where the coated abrasive article will also have a precision thickness as measured from the top surface of the abrasive to the backside of the backing if each equal sized abrasive particle is attached directly to the planar surface of the island structures with no resin gap space between the particle and the island surface. The required flatness of the uncoated island structures is related to the size of the abrasive particles or agglomerates that are coated in a monolayer onto the structure surfaces. A very large particle diameter size allows the possibility of having less accurate island structure height or thickness control as most of a particle would be consumed by abrading action before a workpiece contacted the uncoated portion of the surface of a raised elevation out-of-plane island structure. The thickness tolerance of the allowable variation of island structure thickness can be defined as a percentage of the diameter or equivalent diameter of the abrasive particles or abrasive agglomerates that are coated on the island structures. The goal is to coat a structure with a monolayer of abrasive particles or abrasive agglomerates and then to utilize most of the volume quantity of hard abrasive material that is contained in each abrasive particle. Spherical shaped abrasive particles or abrasive agglomerates offer an advantage over square block or truncated pyramid shaped particles in that the sphere shape presents the volume bulk of abrasive material to a workpiece at a distance equal to the sphere radius at a elevation removed from the top surface of the island structure. These spheres all tend to consistently contact the structure surface at a sphere contact point that provides a uniform height location of each sphere above the structure surface. Most of the sphere abrasive material volume is located at the center of the sphere that is positioned above the sphere island structure contact point by a distance equal to the sphere radius. It is preferred that the standard deviation in the uncoated island structure thickness which is measured from the top of the uncoated raised island surface to the back mounting side of the backing sheet be less than 80% of the equivalent diameter of the abrasive particles or agglomerates that are to be coated on the structures. It is more preferred that the standard deviation be less than 50% and even more preferred that the deviation be less than 30%. If a thin resin coat is first applied to island structure surfaces and abrasive particles are drop coated or electrostatic propelled into the resin coat it is important that the particles have a consistent penetration into the resin coat material to maintain the uniform flatness and described thickness of the abrasive article coating. Drop coating abrasive particles into thick resin coatings or into non uniform thickness resin coatings can create abrasive article thickness control problems as some particles may penetrate deeply into the resin and some other particles may reside on the top surface of the thick resin coating which can result in non precise abrasive article thickness at portions of the article abrasive surface. If a slurry mixture of a polymer resin and abrasive particles or abrasive agglomerates is coated on the island structures, it is important that the coating is applied with techniques that provide a uniform precision thickness of the finished abrasive coated article. It is difficult to adjust the precision thickness of the abrasive coatings to compensate for non-flat surfaces of the island structures. There are many different methods and combinations of methods that can be used to manufacture flexible sheet abrasive articles having raised island structures that can have many article forms including but not limited to continuous abrasive surfaced disks, annular abrasive surfaced disks, rectangular sheets, long strips or bands, and continuous belts that have precision thickness abrasive coated islands which allow them to be used in precision low or high speed grinding and lapping operations. Some methods and combinations of methods of manufacturing are described here in detail but many other combinations that are not described can also be used create these precision thickness raised island abrasive articles.

Precision Thickness Abrasive Disks

If thin flexible abrasive coated sheet disks of abrasive do not have a very precise thickness controlled to 0.0005 inches (0.013 mm) or less, there is a significant problem with their use with very high speed rotating platens operated at 3,000 or more RPM as only the few very highest areas of abrasive will contact the surface of a workpiece held against its surface. Wherever the local thickness of the abrasive sheet is less than the disk total area average thickness, this "low" area will not be utilized for grinding as the workpiece does not have sufficient time to be lowered into contact with the abrasive located in this low valley area due to the high rotational speed of 3,000 RPM or 50 revolutions per second. To maintain contact with all portions of the hills and valleys would require the workpiece to travel from high abrasive points to low abrasive points at a rate of 50 times per second. This is not practical due to the mass weight of the workpiece part and the mass of the associated workpiece part holder assembly. To minimize the workpiece vertical travel at high platen RPM and to utilize the whole area of coated or plated abrasive it is desirable that the total thickness variation of the abrasive disk be within 0.0001 inch (0.0025 mm) or less.

Abrasive Disk Island Patterns

Problem: When using thin diamond coated lapping disks such as 3M Company brand 12 inch (30.5 cm) diameter disks on a lapper platen rotating at 3000 RPM with water as a lubricant, the water film tends to form an interface boundary layer between the workpiece surface and the abrasive which tends to tip the part and prevents a flat grind of the workpiece within 1 to 2 Helium light bands (11.6 to 23.2 microinch or 0.25 to 0.51 micrometers). This tipping action occurs particularly with low friction spherical wobble head workpiece holders because a continuous film of water which exists between the workpiece and the continuous smooth abrasive surface. The water film is sheared across its thickness by the relative stationary velocity where it contacts the workpiece surface and the very high speed where it contacts the abrasive surface. The shear force imparted by the moving abrasive across the water film thickness to the workpiece surface tends to tip the workpiece part held by the spherical action workholder. The interface boundary layer can build in thickness along the continuous length of uninterrupted water film that exists between the moving abrasive and the surface of the workpiece.

Solution: Breaking up the continuous smooth surface of the abrasive into discrete patterns so that gaps exist between the independent islands of abrasive will also break up the continuous film of water in the developed interface boundary layer between the workpiece and the abrasive. Whenever the water is moved across a gap, as the abrasive island moves with the abrasive sheet, the continuous interface boundary layer is broken and not allowed to build further in height or thickness. Whenever the interface boundary layer path is shortened, its thickness is reduced and the workpiece is not lifted as high from the abrasive surface which minimizes the tipping angle between the workpiece part surface and the abrasive. Whenever the interface boundary layer thickness shear force is reduced, less tipping of the workpiece occurs and less of a cone shape is produced on the workpiece surface. Many different shapes can be produced to make these islands of abrasive with the recessed water channels between them which can aid in breaking up the interface boundary layers forming in a tangential direction along the abrasive disk surface on the moving platen.

Raised Island Height Wire Gap Spacer Grid

Problem: It is desired to form raised island structures that are attached to a backing sheet where all the raised island top surface areas are at the same height from the front surface of the precision thickness backing sheet. This construction provides a raised island backing sheet article where the thickness of the backing sheet article is the same at the locations of all of the attached islands. When a precision thickness of abrasive particles is attached to the top surface areas of all the island structures with a polymer binder the resultant abrasive sheet article has a precisely uniform article thickness as measured from the backside of the backing sheet to the top surface of the attached abrasive particles over the whole surface of the abrasive article. This precision thickness raised island abrasive article is then suitable for use in high-speed abrasive lapping operations.

Solution: Liquid polymer material can be deposited at island sites that are formed in array patterns on the upper surface of precision thickness backing sheets. After the polymer is deposited at the sites, a grid array of spaced precision thickness wires can be positioned on the top surface of the backing sheet where the individual wires are positioned in regions that are between the polymer island depositions. The backing sheet can then be positioned to lay flat on a horizontal lower flat mounting plate surface. Another flat plate can be brought in contact with the raised surfaces of the polymer depositions where the upper plate progressively forces down the top surface of each polymer lump deposition, causing them to flow laterally across the surface of the backing sheet in areas that are localized around each polymer deposition site. The upper plate will continue to spread out each polymer deposition outward in all directions from the original deposition site to form flat-topped raised islands at each deposition site. The island surface areas will increase as the upper plate continues in a downward direction until the surface of the upper plate contacts the top surface of the wires that are supported by the upper surface of the backing sheet. The height of each island will be determined by the gap between the upper plate and the upper surface of the backing sheet where the localized gap at each polymer material island site is determined by the diameter of the grid wires that are located in the immediate area that is adjacent to the polymer island. The two plates are maintained in this equilibrium position until the polymer at each site partially or fully solidifies after which, the upper plate and the wire grid array are separated from the backing sheet. It is preferred that the polymer does not contact and contaminate the grid wires which lay in the channel areas between the formed polymer raised islands. The wire grid may then be reused to form another array of raised island structures that are to another backing sheet. Grid wires can be formed into serpentine shapes to allow routing of the wires between raised islands that are positioned in array patterns not having straight passageways between the islands. Flexible backing sheets are preferred but rigid backing sheets may also be used. The island backing sheets may be made from materials including: polymer, glass, ceramic, metal or composite materials. Precision height raised islands may be formed on circular disk backings, rectangular shaped backings or on strip or tape backings.

Precision diameter electrical discharge machine (EDM) wire or wire sections that are selected to have the same precise diameter can be used to construct the spacer wire grid that is used to establish a precision sized island height gaps at all positions on the backing sheet. Release coatings may be applied to the wires prior to the island height molding operation. A stiff precision-flat bottom base plate such as a machinist granite block tooling plate can be used or a metal tooling plate or a plate having somewhat lesser flatness accuracy can be used as a base plate. Both the stiff base plate and the flexible upper plate are positioned horizontally on a structurally stiff and stable bench or some other mounting surface. Preferably, the stiff bottom base plate is supported by three equally spaced supports so that base plate is consistently supported at the same three locations even if the base plate is mounted on non-flat portions of the bench or other mounting surfaces. Some flexure is desired in the upper island mold plate to allow the surface of the upper plate to conform locally to the surface of the lower mold plate at all of the individual polymer island sites. This upper plate flexure assures that the island height gap of a specific island is established only by the gap-wire sections that are present in the immediate area that surround each polymer island site. Flexure of a horizontally positioned upper plate due to gravity forces acting on the upper plate allows the plate to bend or deform in localized regions of the upper plate enough that the upper plate contacts most of the lengths of the spacer wires that are supported by the stiff base plate. The lower stiff base plate provides a reasonably flat planar reference surface for the island height forming process. The backing sheet to which the islands are attached has a very precise thickness and is very flexible which assures that the backing sheet will conform to the surface of the backing sheet. When a backing sheet having a thickness variation of less than 2.5 micrometers (0.0001 inches) is used, the upper surface of the backing sheet is consider to be sufficiently parallel to the reference surface of the lower base plate in order to produce wire gap molded raised island structures by this technique that have an acceptable precision uniformity of thickness as measured from the top of the island structures to the backside of the backing sheets. The spacer grid wires that are small in diameter, typically from 0.13 to 1.3 mm (0.005 to 0.050 inches) would be flexible enough to readily conform to the surface of the island backing sheet that is mounted conformably to the surface of the base plate. Use of this flexible upper plate grid wire island mold system tends to prevent the formation of too-high islands when a stiff upper mold plate bridges across a specific island that resides at a low-spot surface of a lower reference base mold plate and where the backing has conformed to the base plate low-spot. Likewise, use of this flexible upper plate grid wire island mold system tends to prevent the formation of too-low islands when a stiff upper mold plate bridges across a specific island that resides at a high-spot surface of a lower reference base mold plate and where the backing has conformed to the base plate high-spot. However, the flexible upper plate would be selected to have a sufficient thickness that it is stiff enough that a flat and precision height island top surface area is formed even when the plate bridges across a number of islands that are spanned by two adjacent gap wires. There would be little sagging of the upper mold plate between two adjacent grid wires.

The flexible upper mold plates can be constructed from materials that include sheet metal, sheet polymer material and precision thickness thin glass sheets. The glass sheets can range in thickness from less than 0.8 to more than 3.2 mm (0.032 to more than 0.125 inches) in thickness. The backing material can include many different materials including metal and polymer material and would have backing thicknesses that range from 0.05 to more than 1.6 mm (0.002 to more than 0.062 inches). The stiff reference base plate would also be the heaviest component used in the island height molding process so the deflection of the surface of the base plate would established when the base plate is mounted on a bench or other mounting surface and supported by the three-point supports. The backing material sheet, the grid wire, the island structure material and the upper flexible plate would all be lightweight in comparison to the base plate and when these components are mounted on the flat stiff base plate, the added weight of the components will not tend to significantly change the deflection of the surface of the base plate. However, in the case when the lower reference base plate is deflected somewhat by the additional weight of the added components, the island heights as measured to the backside of the backing is still very accurately established by the thickness of the grid wires because all of the components conform to the surface of the reference base plate.

In another embodiment, the upper mold plates can be constructed from silicone rubber coated aluminum, or other metal or polymer, printing plates that are used in the printing industry. The silicone rubber would provide a release coating on the sheet metal plate that would reduce the adhesion of the island structure material to the upper sheet metal mold plate. A uniform pressure would be applied across the surface of the upper mold plate during the island molding operation to provide a uniform localized distortion of the silicone rubber due to pressurized contact with the spacer grid wires. As all of the wires would penetrate an equal distance into the silicone rubber layer, the height of each island above the backing sheet would be equal. Abrasive particles or abrasive agglomerate beads can be attached to the top surface of the raised islands with a polymer binder prior to full solidification of the raised island surfaces or the abrasive particles or beads can be attached to the islands after the island polymer structure is fully cured and fully solidified. After the abrasive particles or beads are deposited on a polymer binder that is coated on the island surfaces or a dispersion slurry mixture of abrasive particles or beads and an adhesive binder is coated on the island top surfaces, abrasive binder is then cured. The binder can be cured by process methods that include heat, ultraviolet, polymer chemical reaction, electron beam or combinations thereof. Individual abrasive sheet articles can be cured or fully solidified by attaching the individual sheets to a conveyor belt that routes the sheets into and through the process equipment that provides the energy sources that apply curing energy to both the abrasive particle polymer binder and the raised island structure polymer material. The final solidification cure of abrasive particle binder and the island structure material can be accomplished at the same time or the cure events can be conducted separately.

Mold release agents can be applied to the surface of the upper plate that contacts the island structure polymer to reduce adhesion of the polymer to the surface of the upper plate. Further, a film coating of metal oxides can be applied to the upper plate to act as a mold release agent or as a barrier agent to minimize adhesion of the island structure liquid polymer on the surface of the mold plate. The barrier film of metal oxides, which include silica, will not tend to contaminate the surface of the polymer raised islands in a way that would reduce the adhesion of abrasive binders that are used to attach abrasive particles to the raised island top surfaces. Some of the barrier coat of metal oxides would be transferred in the island flattening process procedure but the extremely small particles of metal oxide would be absorbed into the abrasive particle binder adhesive material when this binder adhesive is coated on the flat island top surfaces. It is possible that the introduction of the same metal oxide particles into the binder coating could strengthen the binder coating rather than weakening it. The metal oxide barrier coating would be applied to the upper plate by coating the plate surface with a wet thin layer of Ludox®, which has colloidal silica suspended in water, and then drying the surface of the plate to provide a very thin layer of the silica that is attached to the surface layer of the upper plate. This Ludox® solution can also be used to provide a barrier coat on other molding apparatus devices which require a release agent that prevents contamination of a surface by a polymer adhesive but where it is important not to contaminate the same polymer in a way that reduces the adhesion of other adhesives to the same polymer after the polymer has solidified. Some mold release agents that can be used to coat the surface of the upper plate to prevent adhesion of the island structure polymer material to the upper plate surface can also be transferred to the polymer island top surfaces when the upper plate contacts the island material polymer at the island sites. Also, release liner sheets can be positioned on top of the polymer islands to act as a barrier between the polymer and the upper plate.

Abrasive Coated Island Bead Edges

Problem: When a dispersion mixture of abrasive particles and an adhesive is transfer coated on the flat raised island structure surface there is a tendency for the dispersion mixture to form a small raised bead around the periphery of the individual island structures due to surface tension forces. Here the elevation of the dispersion bead is somewhat higher than the dispersion that is coated on the planar central surface area of the island structure. Likewise when an adhesive layer is coated on the flat surface of a raised island structure, a raised adhesive bead or ridge will tend to form at the island edges and those abrasive particles that are deposited on the bead or ridge surface of the liquid adhesive will also be elevated relative to those particles that reside on the planar central surface area of each island. Having a raised elevation bead or ridge abrasive surface on the periphery of each island structure is not desirable.

Solution: The formation of the island edge beads can be minimized by rounding-off the peripheral edges of the individual island structures prior to the application of an abrasive particle dispersion mixture or an adhesive. The island structures can be formed with rounded off edges or the islands can be formed with sharp edges and these edges rounded off by various techniques including sand blasting. The amount of edge rounding that is required to provide abrasive flat coated raised islands for abrasive disk articles that are used for high speed flat lapping is very small because the abrasive coatings used on these disks are very thin. For example, the abrasive beads that are coated in a monolayer on the islands are typically only 0.0018 inches (45 micrometers) in diameter with a typical overall coating thickness of less than 0.0025 inches (63.5 micrometers). The amount of edge rounding is desired to be greater than the thickness of the abrasive coating to result in a near-planar abrasive coating. It is also desired that the edge rounding not to be excessive to reduce the presence of expensive abrasive particles on the rounded edges at an elevation that is below the elevation of the planar surfaces of the islands as those low-level particles will not be utilized in an abrading operation.

Also, raised island structures having sharp edges and solidified abrasive edge beads or ridges can be surface conditioned to remove the raised elevation portions of the edge beads. The surface conditioning process comprises contacting the moving surface of a newly manufactured abrasive article with a moving or stationary abrading to abrade the raised island abrasive article surface sufficiently to remove only the raised elevation portion of the abrasive beads to provide a planar abrasive surface for each individual raised island.

Figure 1:
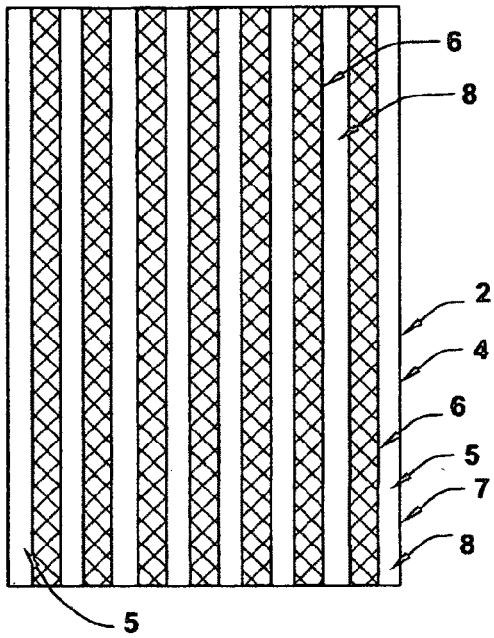
(Prior Art) Fig. 1
FIG. 1 (Prior Art) is a top view of a rectangular sheet of abrasive as shown in U.S. Pat. No. 1,657,784 (Bergstrom) that has alternating strips of abrasive material.
Figure 2:
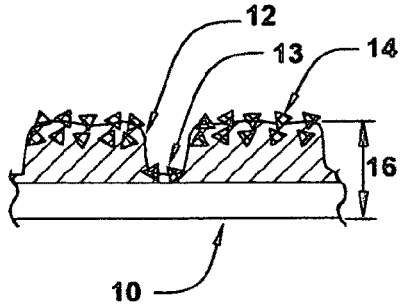
(Prior Art) Fig. 2
FIG. 2 (Prior Art) is a cross section view of abrasive particle coated raised islands in U.S. Pat. No. 2,242,877 (Albertson).
Figure 3:
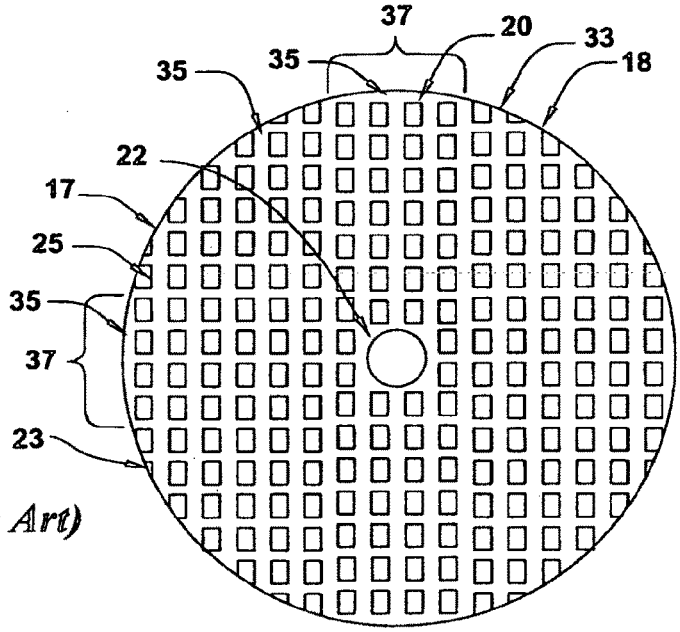
(Prior Art) Fig. 3
FIG. 3 (Prior Art) is a top view of raised islands on an abrasive disk.
Figure 4:
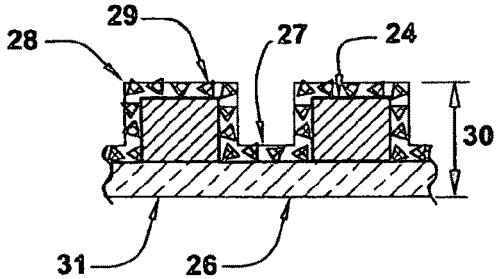
(Prior Art) Fig. 4
FIG. 4 (Prior Art) is a cross section view of a pattern of rectangular shaped raised rib structures in U.S. Pat. No. 2,242,877 (Albertson).
Figure 5:
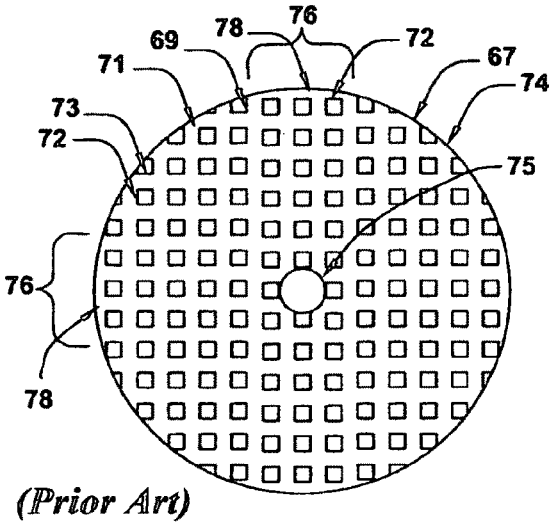
(Prior Art) Fig. 5
FIG. 5 (Prior Art) is a top view of the Maran U.S. Pat. No. 3,991,527 abrasive disks having geometric patterns of raised island structures.
Figure 6:
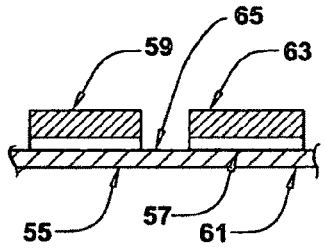
(Prior Art) Fig. 6
FIG. 6 (Prior Art) is a cross section view of the Maran U.S. Pat. No. 3,991,527 abrasive coated raised island structures.
Figure 8:
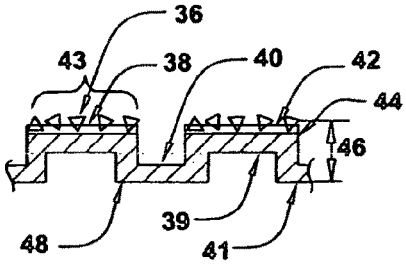
(Prior Art) Fig. 8
FIG. 8 (Prior Art) is a cross section view of one embodiment of embossed raised islands as shown in the U.S. Pat. No. 3,991,527 (Maran) patent where the raised island structures are abrasive coated.
Figure 7:
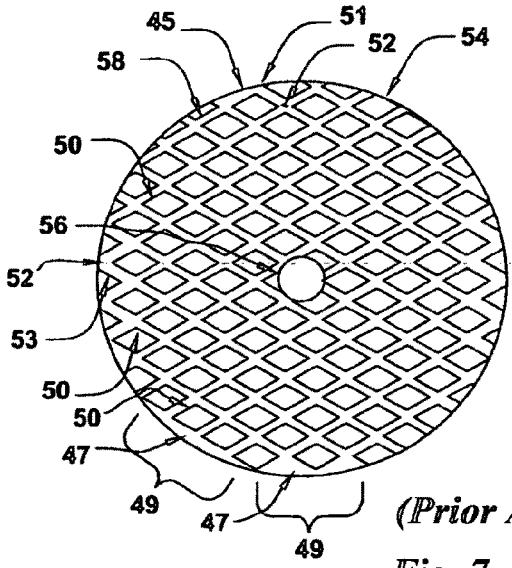
(Prior Art) Fig. 7
FIG. 7 (Prior Art) is a top view of the Maran U.S. Pat. No. 3,991,527 abrasive disks having geometric patterns of raised island structures.
Figure 9:
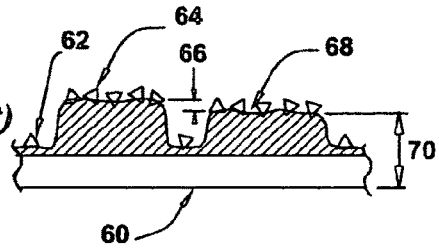
(Prior Art) Fig. 9
FIG. 9 (Prior Art) is a cross section view of abrasive particle coated plated metal islands as shown in U.S. Pat. No. 4,256,467 (Gorsuch).
Figure 10:
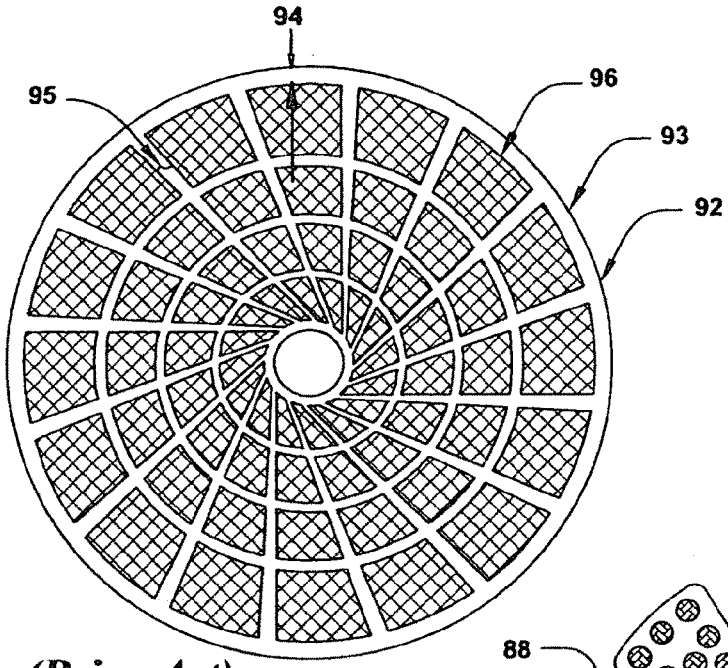
(Prior Art) Fig. 10
FIG. 10 (Prior Art) is a top view of an abrasive disk article having molded abrasive raised islands as shown in U.S. Pat. No. 5,318,604 (Gorsuch et al.).
Figure 11:
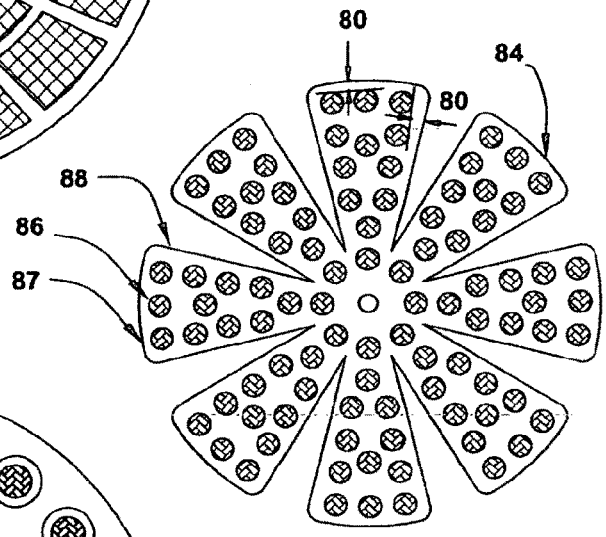
(Prior Art) Fig. 11
FIG. 11 (Prior Art) is a top view of a "daisy" abrasive article as shown in U.S. Pat. No. 4,256,467 (Gorsuch).
Figure 12:
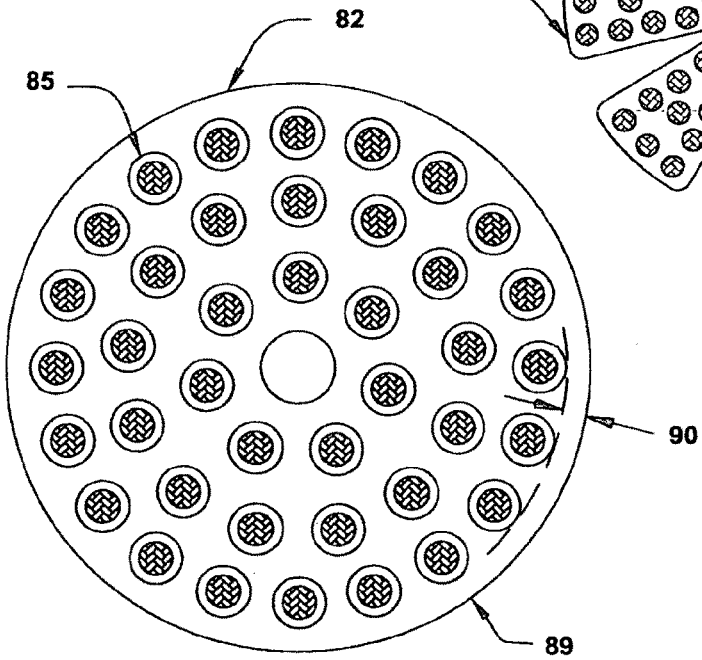
Fig. 12 (Prior Art)
FIG. 12 (Prior Art) is a top view of an abrasive disk having raised abrasive islands and a recessed gap area between the islands and the disk edge that extends around the periphery of the disk as shown in U.S. Pat. No. 2,001,911 (Wooddell).
Figure 13:
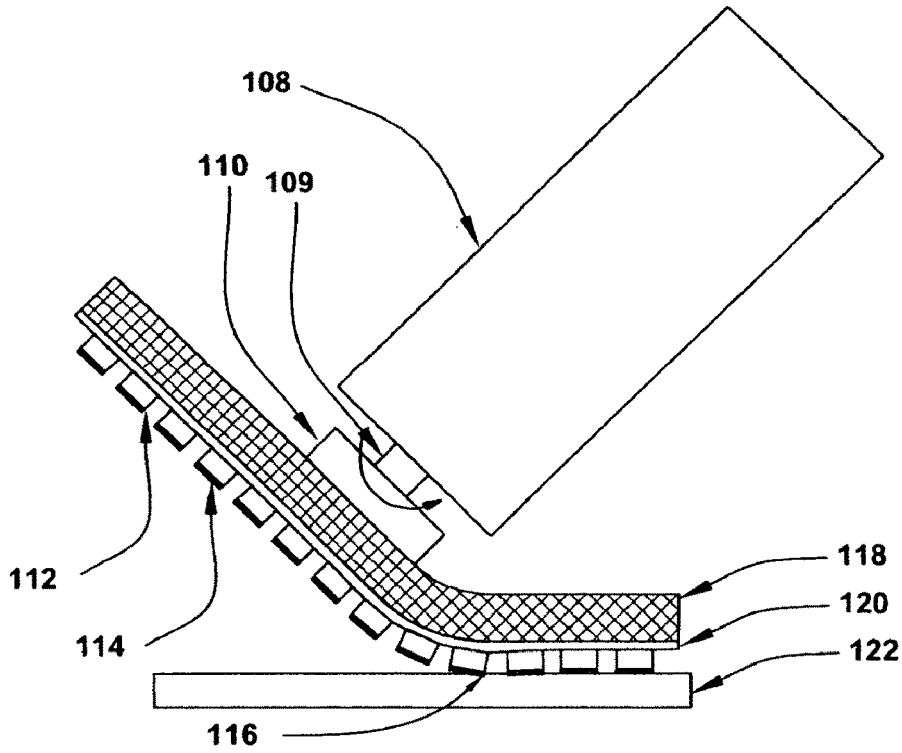
Fig. 13 (Prior Art)
FIG. 13 (Prior Art) shows a side view of an abrasive grinding disk that distorted as it contacts a workpiece surface.
Figure 14:
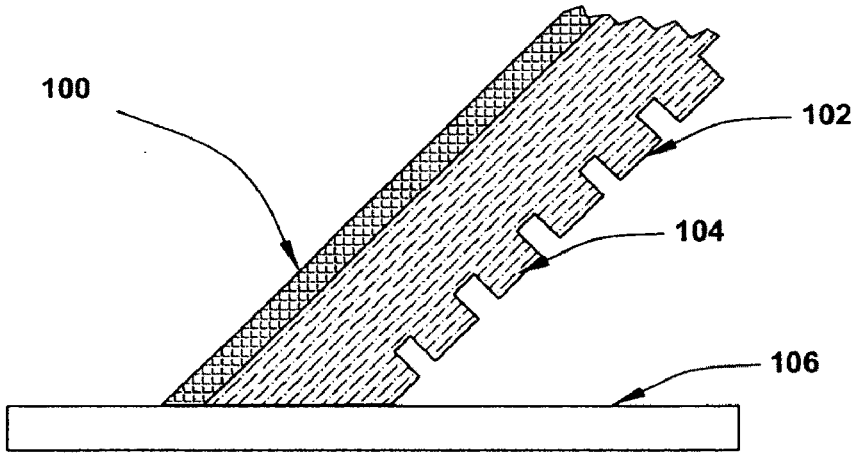
Fig. 14 (Prior Art)
FIG. 14 (Prior Art) shows a cross section view of a disk edge that is in abrading contact with a workpiece.
Figure 15:
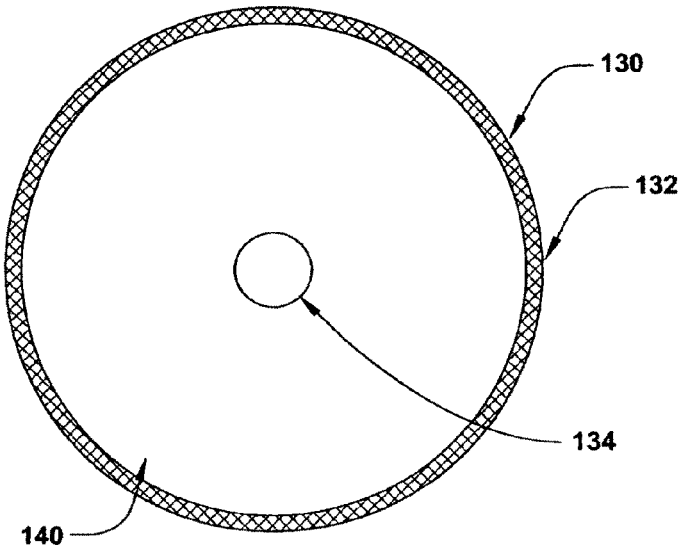
(Prior Art) Fig. 15
FIG. 15 (Prior Art) is a top view of a Romero U.S. Pat. No. 6,371,842 described abrasive disk that has an outer periphery polymer adhesive make-coat raised band.
Figure 16:
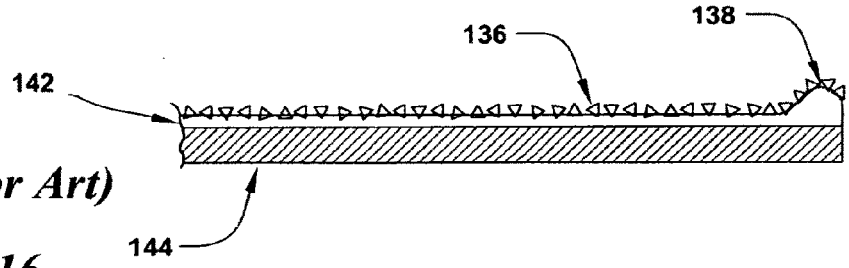
(Prior Art) Fig. 16
FIG. 16 (Prior Art) is a cross section view of a Romero U.S. Pat. No. 6,371,842 described abrasive disk having a raised polymer band on the outer periphery of the disk.
Figure 17:
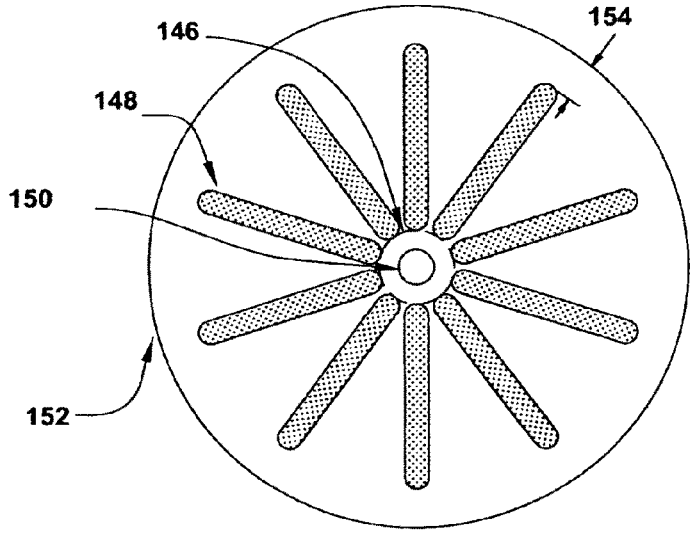
Fig. 17 (Prior Art)
FIG. 17 (Prior Art) is a cross section view of Romero U.S. Pat. No. 6,371,842 abrasive coated islands attached to a backing sheet.
Figure 18:
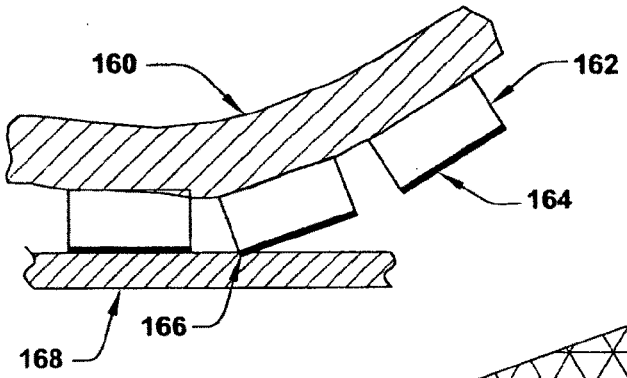
(Prior Art) Fig. 18
FIG. 18 (Prior Art) shows an expanded side view of the FIG. 13 (Romero U.S. Pat. No. 6,371,842, and others) abrasive disk that is mounted on a mandrel tool used to grind a workpiece with the disk distorted.
Figure 19:
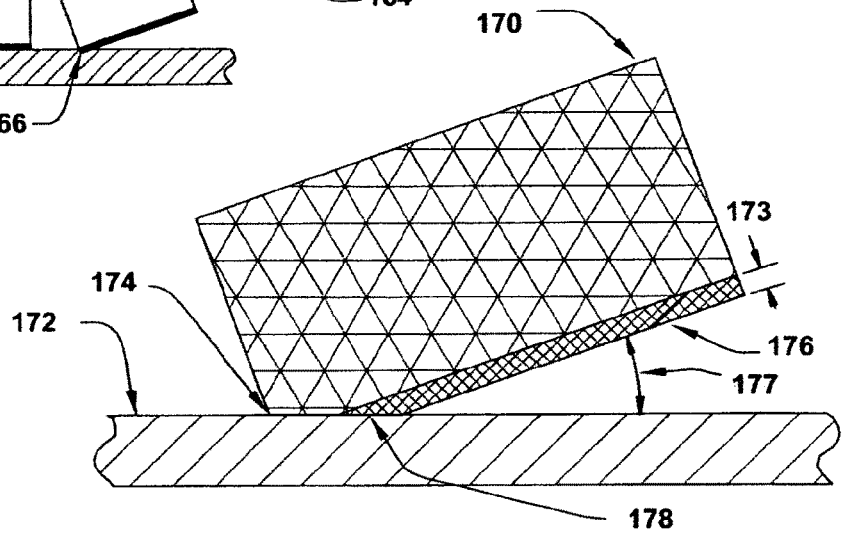
(Prior Art) Fig. 19
FIG. 19 (Prior Art) shows an expanded side view of a (Romero U.S. Pat. No. 6,371,842, and others) single abrasive coated island in angled contact with a flat workpiece.
Figure 20:
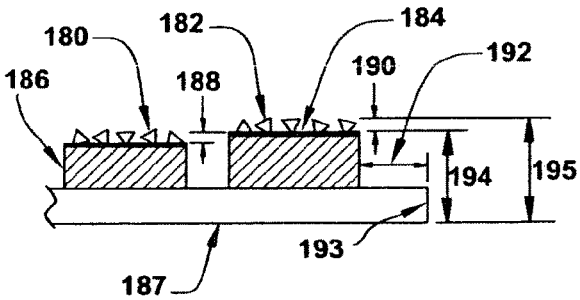
(Prior Art) Fig. 20
FIG. 20 (Prior Art) is a top view of a Romero U.S. Pat. No. 6,371,842 described disk having abrasive coated raised islands.
Figure 21:
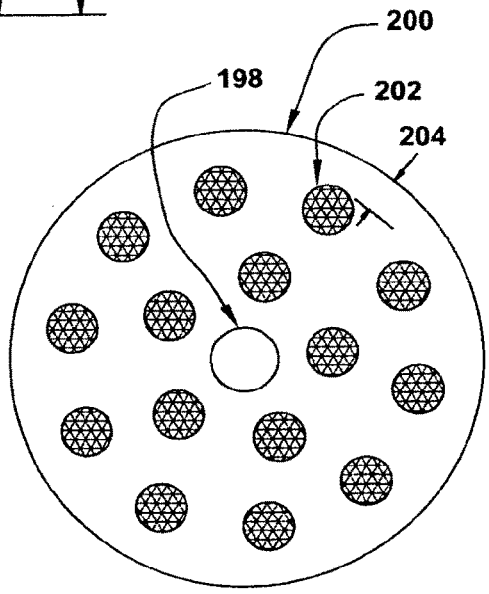
(Prior Art) Fig. 21
FIG. 21 (Prior Art) is a top view of Romero U.S. Pat. No. 6,371,842 abrasive island disk having an aperture hole and an island gap at the disk periphery.
Figure 22:
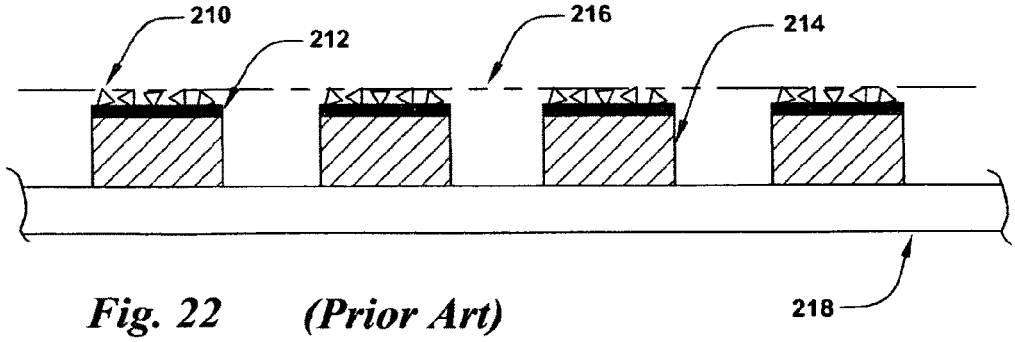
Fig. 22 (Prior Art)
FIG. 22 (Prior Art) is a cross section view of a hypothetical comparative "precisely flat" original-condition Romero U.S. Pat. No. 6,371,842 abrasive island article.
Figure 23:
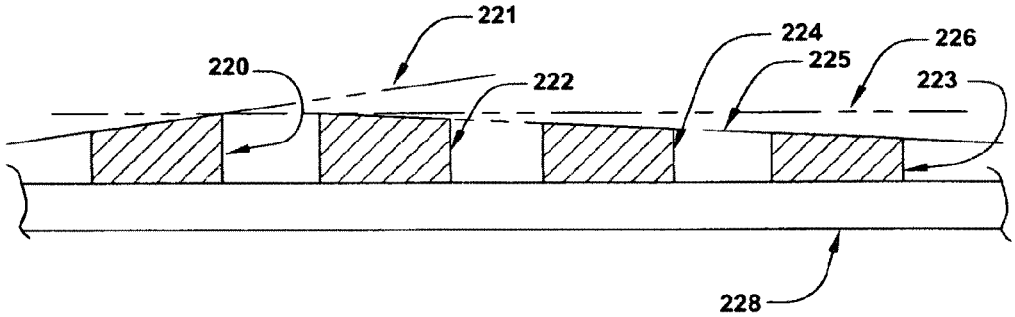
Fig. 23 (Prior Art)
FIG. 23 (Prior Art) is a cross section view of the hypothetical comparative precisely flat original-condition Romero U.S. Pat. No. 6,371,842 abrasive island article that has been subjected to abrading wear.
Figure 24:
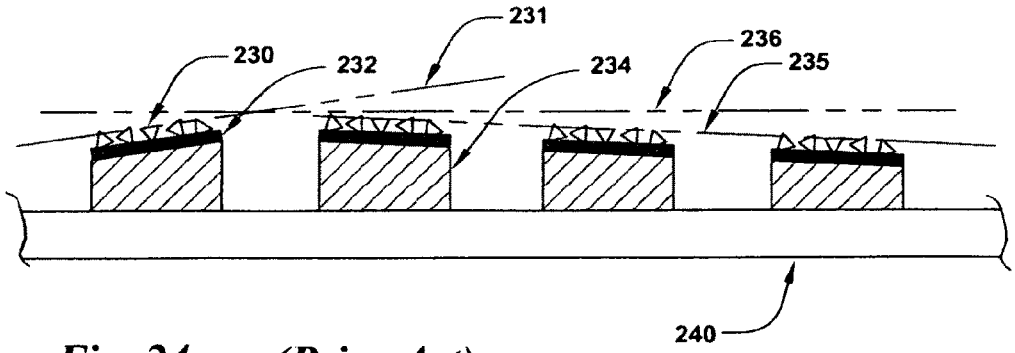
Fig. 24 (Prior Art)
FIG. 24 (Prior Art) is a cross section view of worn-down islands shown in Romero U.S. Pat. No. 6,371,842.
Figure 25:
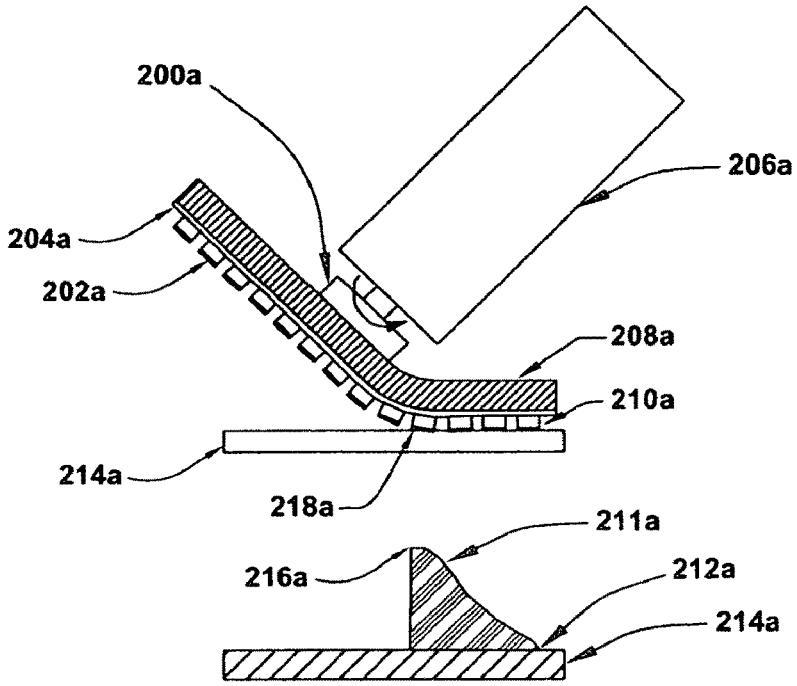
(Prior Art) Fig. 25
FIG. 25 (Prior Art) is a cross section view of a mandrel mounted disk and contact pressure profile for a Romero U.S. Pat. No. 6,371,842 raised island abrasive disk article.
Figure 26:
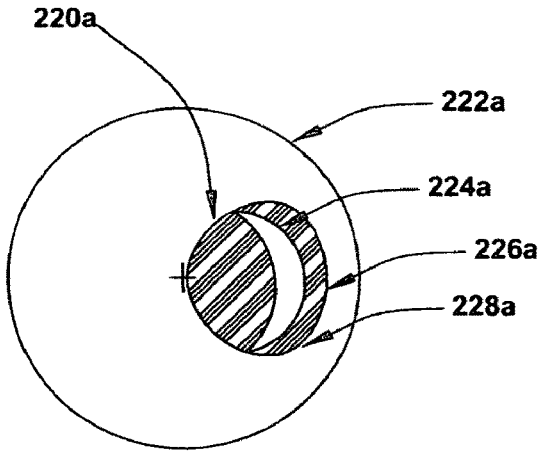
(Prior Art) Fig. 26
FIG. 26 (Prior Art) is a top view of the variation of the abrading contact pressure profile for a Romero U.S. Pat. No. 6,371,842 raised island abrasive disk used on a manual grinder.
Figure 27:
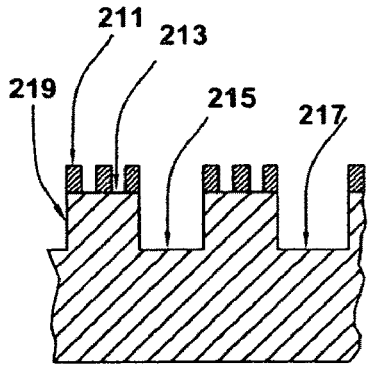
(Prior Art) Fig. 27
FIG. 27 (Prior Art) is a cross section view of a James U.S. Pat. No. 6,375,599 abrasive island CMP pad article.
Figure 33:
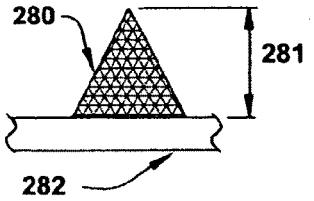
Fig. 33 (Prior Art)
FIG. 33 (Prior Art) is a cross section view of an Annen original as-formed pyramid shaped abrasive body.
Figure 34:
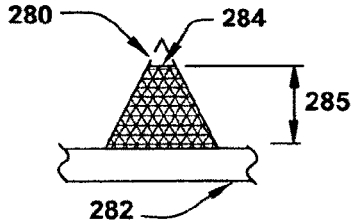
Fig. 34 (Prior Art)
FIG. 34 (Prior Art) is a cross section view of an Annen pyramid shaped abrasive body.
Figure 35:
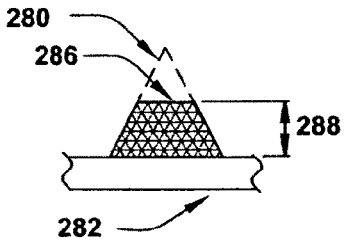
Fig. 35 (Prior Art)
FIG. 35 (Prior Art) is a cross section view of an Annen pyramid shaped abrasive body.
Figure 36:
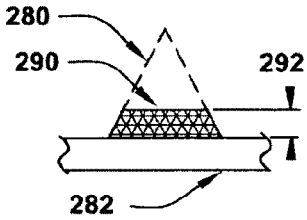
Fig. 36 (Prior Art)
FIG. 36 (Prior Art) is a cross section view of an Annen pyramid shaped abrasive body.
Figure 37:
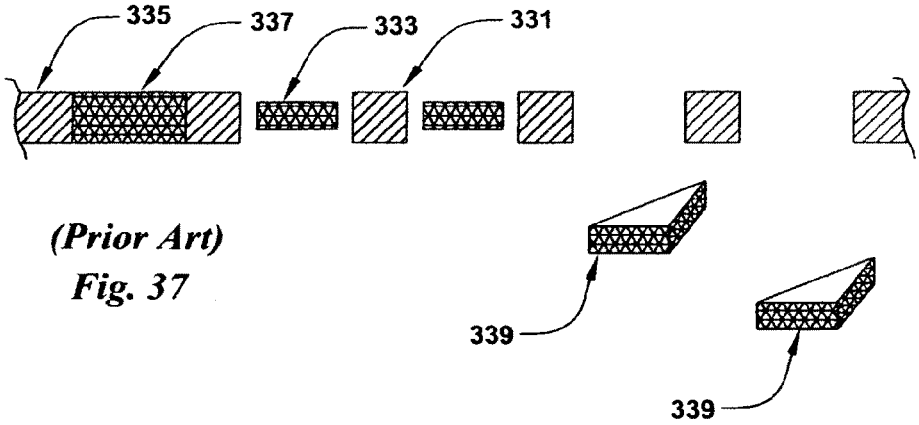
(Prior Art) Fig. 37
FIG. 37 (Prior Art) is a cross section view of the Berg U.S. Pat. No. 5,201,916 shaped abrasive particles.
Figure 38:
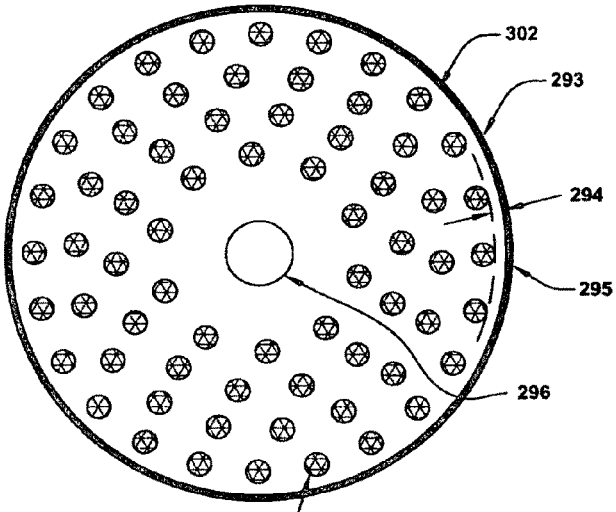
(Prior Art) Fig. 38
FIG. 38 (Prior Art) shows a top view of a Wiand U.S. Pat. No. 5,232,470 raised-protrusion abrasive disk.
Figure 39:
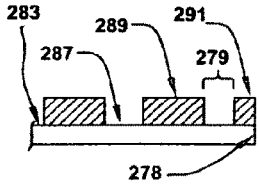
(Prior Art) Fig. 39
FIG. 39 (Prior Art) shows a cross section view of a Wiand U.S. Pat. No. 5,232,470 abrasive disk.
Figure 40:
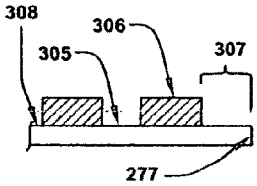
(Prior Art) Fig. 40
FIG. 40 (Prior Art) shows a cross section view of a Dyar U.S. Pat. No. 2,907,146 or a Kagawa, et al. U.S. Pat. No. 4,106,915 raised protrusion abrasive disk having a recessed gap area between the outer raised protrusions and the outer periphery of the disk.
Figure 41:
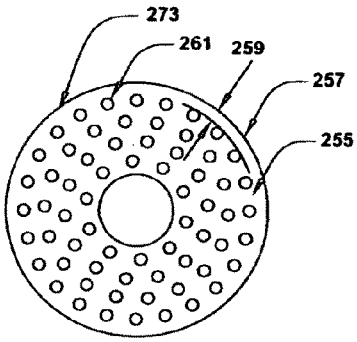
(Prior Art) Fig. 41
FIG. 41 (Prior Art) shows a top view of a Kagawa et al. U.S. Pat. No. 4,106,915 raised-protrusion abrasive disk with a recessed gap area between the outer raised abrasive protrusions and the outer peripheral disk edge.
Figure 42:
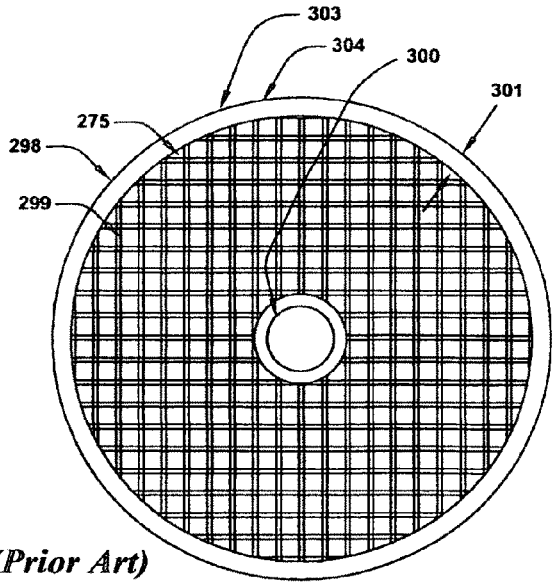
(Prior Art) Fig. 42
FIG. 42 (Prior Art) shows a top view of a Dyar U.S. Pat. No. 2,907,146 raised-protrusion abrasive disk with a recessed gap area between the outer raised abrasive protrusions and the outer peripheral disk edge.
Figure 43:
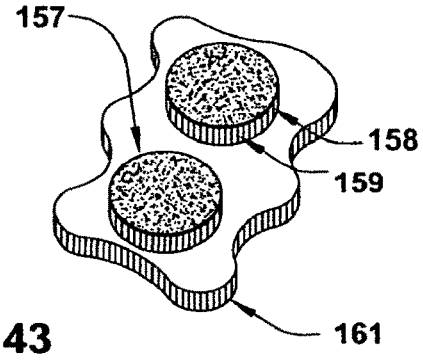
FIG. 43 is an orthographic view of raised islands that are attached to a backing sheet.

FIG. 43 is an orthographic view of raised islands that are attached to a backing sheet. A backing sheet 161 shows raised island structures 159 that are coated with an adhesive layer 158 which is coated with abrasive bead particles 157. Alternatively, the abrasive beads 157 can be mixed with an adhesive to form an abrasive-adhesive slurry mixture which can be applied to the island structure 159 top surfaces where the abrasive beads 157 are coated in a monolayer on the island structures 159.

Figure 44:
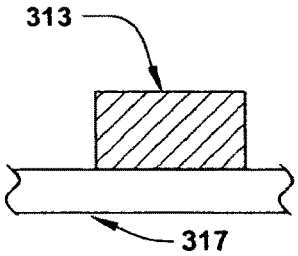
FIG. 44 is a cross section view of a flat surfaced raised island structure on a backing sheet.

FIG. 44 is a cross section view of a flat surfaced raised island structure that is attached to a backing sheet. The raised island structure 313 is attached to a backing sheet 317.

Figure 45:
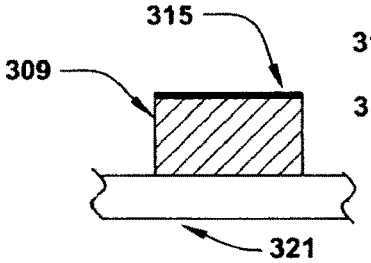
FIG. 45 is a cross section view of an adhesive resin coated raised island structure.

FIG. 45 is a cross section view of an adhesive resin coated raised island structure that is attached to a backing sheet. The flat surfaced raised island structure 309 having an adhesive resin coating 315 is attached to a backing sheet 321.

Figure 46:
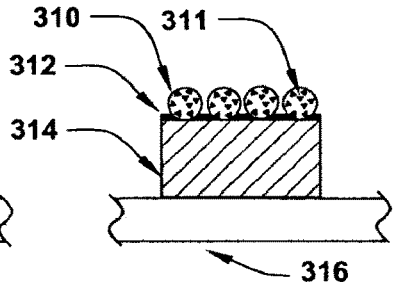
FIG. 46 is a cross section view of an abrasive agglomerate bead coated raised island structure.

FIG. 46 is a cross section view of an abrasive agglomerate bead coated raised island structure that is attached to a backing sheet. The flat surfaced raised island structure 314 having an adhesive resin 312 coating is attached to a backing sheet 316 where abrasive beads 310 containing abrasive particles 311 are resin 312 bonded to the island structure 314.

Figure 47:
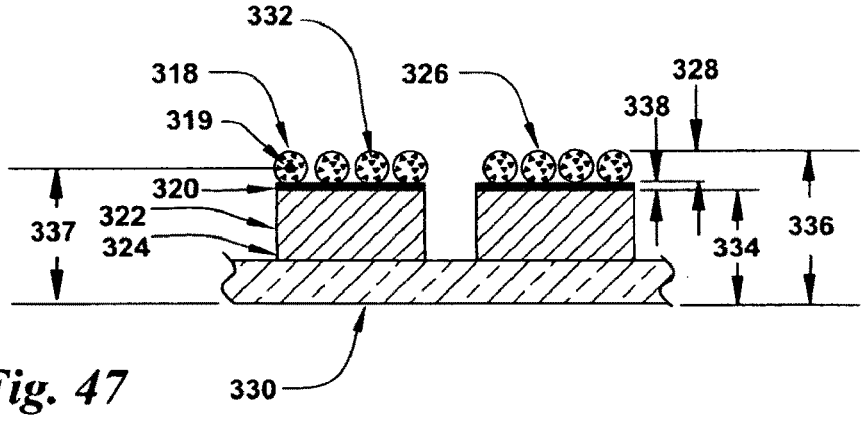
FIG. 47 is a cross section view of raised island structures with abrasive agglomerate beads.

FIG. 47 is a cross section view of an abrasive article 324 having adhesive resin 320 coated raised island structures 322 that are attached to a flexible backing sheet 330 where abrasive agglomerate beads 318, 326 containing abrasive particles 332 are supported by the adhesive 320. The island structures 322 are attached to the backing sheet 330 and the abrasive article 324 can have many shapes including a circular disk shape, a rectangular shape, a strip shape and an elongated tape shape. The adhesive resin 320 layer has an adhesive thickness 338. The abrasive article 324 is constructed so that all or most of the abrasive particles 332 that are contained within the abrasive beads 318, 326 that are resin 320 bonded to the article 324 are utilized in a typical abrading process. Abrasive particles 332 can include diamond, CBN, aluminum oxide, ceria, and other abrasive material or combinations thereof. Equal sized abrasive particle beads 318, 326 are shown. The abrasive beads 318, 326 diameter (or size) 328 is used as a reference for establishing the control, or allowable variation, of the height 334 of the island structure 322 as measured from the top of the non-adhesive coated island structure 322 to the backside of the abrasive article backing sheet 330. The diameter (or size) 328 of the abrasive beads 318, 326 is also used as a reference for establishing the control, or allowable variation, of the height (or thickness) 336 of the raised island abrasive article 324 as measured from the top of the island beads 318, 326 to the backside of the abrasive article backing sheet 330. The heights (or thicknesses) 336, 334 are controlled to have a standard deviation, or size variation, that is only a percentage of the size 328 of the abrasive beads 318, 326 where the standard deviation is typically less than 50% of the size 328 of the abrasive beads 318, 326. Having island structures 322 that have precision heights 334 aids in the manufacturing of abrasive articles 324 that have precision thicknesses 336. However, it is the precise height 336 or thickness 336 of the abrasive article 324 that provides the desired performance of the precision flatness abrasive article 324. It is desired that the abrasive beads 318, 326 have a small diameter of a preferred size of 45 micrometers (0.002 inches) for abrasive lapping articles 324 as a bead 318 size 328 that is smaller than this does not provide enough abrasive for a significant abrading life of an abrasive article and beads 318, 326 that are much larger than this provide too much variation in the thickness of the article 324 bead 318, 326 abrasive layer which results in uneven or non-flat article 324 abrading surfaces after some abrading usage of the article 324. The abrasive article 324 thickness 336 and the island height 334 are shown at one specific island structure 322 location. The overall abrasive surface flatness of an abrasive article 324 is established by use of a theoretical abrasive plane that is a statistical best-fit of the top exposed surfaces of the abrasive particles or abrasive beads 318, 326 that are attached by resin 320 to the flat top surfaces of the island structures 322. The island abrasive plane is then angle referenced to a backing sheet plane that is parallel to the backside (article 324 mounting side) of the backing 330. The optimum flatness of an abrasive article 324 exist when the abrasive plane contacts all the individual abrasive beads 318, 326 and the abrasive plane is parallel to the backing plane and the angle between the abrasive plane and the backing plane is zero. It is not desirable to have an abrasive article 324 construction where all of the abrasive beads 318, 326 are in flat alignment with the abrasive plane but where this abrasive plane is angled with respect to the backing plane, which results in a article 324 non-flat abrasive surface being presented to a flat surfaced workpiece that contacts the abrasive article 324 during an abrading process.

The thickness 336 of article 324 is important at all island structure 322 locations and at all abrasive bead 318, 326 locations. Quality assurance measurements of the thickness 336 of an article 324 would be made at a number of locations on the article 324 to establish that the abrasive article 324 has a uniform thickness 336, which indicates also that the article 324 also has a flat abrading surface. During production of the article 234 there will be some variance in the thickness 336 of the abrasive article 324 at different locations on the article 324 due to manufacturing tolerances of beads 318, 326 sizes 328, of island heights 334, of resin coating thicknesses 338 and of backing 330 thicknesses but as long as these article 324 thickness 336 variations are small relative to the size 328 of the abrasive beads 318, 326 then the article 324 will be sufficiently flat for precision lapping. As there is some variance in the size 328 of the abrasive beads 318, 326 coated on an article 324, the measurement comparisons of the variation in the thickness 336 of the article 324 are judged relative to the average size 328 of all the beads 318, 326 that are coated on the article 324 flat top surfaces of the island structures 322. Large bead 318, 326 sizes 328 allow the existence of larger variances in the thickness 336 of the article 324 for abrasive particle 332 utilization. Here, larger size 328 beads 318, 326 contain more particles 332 than smaller sized 328 beads 318, 326 and the bulk of the particles 332 are located at a higher elevation from the surface of the backing 330, and therefore, the bulk of the particles 332 in the larger size 328 beads 318, 326 will be brought into abrading contact with a workpiece (not shown) as the beads 318, 326 wear down. As a smaller size 328 bead 318, 326 is worn down on an article 324 having the same variation of thickness 336, the variations in an article 324 thickness 336 will prevent abrading contact of some of the smaller beads 318, 326. It is preferred that the abrasive article 324 thicknesses 336 have a standard deviation of less than 50% of the desired average bead size 328 or a standard deviation of less than 23 micrometers (0.001 inches) for 45 micrometers (0.002 inches) beads. It is more preferred that the standard deviation of thickness 336 is less than 40% and even more preferred that it be less than 30% and even more highly desired that it is less than 20% of the average size 328 of the beads 318, 326. For instance, it is more preferred that the deviation be less than 10 micrometers (0.0004 inches) and even more preferred that the deviation be less than 5 micrometers (0.0002 inches) for the 45 micrometer (0.002 inch) beads. If abrasive beads 318, 326 have sizes 328 that are larger or smaller than 45 micrometers (0.002 inch) then the article 324 thickness 336 standard deviation is reduced proportionately to the size 328. The largest portion of the abrasive particles 332 that are contained in abrasive beads 318, 326 are located at the spherical center of the abrasive beads 318, 326. It is most important that the bulk of the abrasive particles 326 are contacted by a workpiece. The abrasive particles 332 that are located at an elevation within the beads 318, 326 that is above the spherical center of the beads 318, 326 are assured of abrading contact with a workpiece as this lesser quantity of particles 332 must be worn away before the bulk quantity of particles 332 that is located at the bead 318, 326 center is contacted. This means that the far lesser quantity of abrasive particles 332 that are located at the far-distant portion of the beads 318, 326 in the area where the resin 320 bonds the beads 318, 326 to the backing 330 are not necessarily assured of abrading contact because of the manufacturing variations in the article 324 thickness 336. It is not very important that all of the abrasive particles 332 located in the far-distant portion of the beads 318, 326 are fully utilized as they represent only a small portion of all the particles 332 that were contained in the original sized beads 318, 326. These far-distant particles 332 are often sacrificed as an abrasive article 324 is completely worn down in most of the article 324 abrasive surface areas. Variations of the flat surface of a moving platen or a stationary surface plate to which the abrasive article 324 is mounted can also provide out-of-flat positioning of the article 324 abrasive surface. These platen or surface plate variations or imperfections can result in uneven wear-down of abrasive beads 318, 326, the same as occurs for the condition of large variations of the thickness 336 of an abrasive article 324. It is not desirable that all the abrasive is worn off the top surfaces of some of the raised island structures 322 resulting in contact of the surface of a workpiece with the resin coating 320 or the island structure 322 material. This condition of exposing the island structure 322 material can occur if the resin coating 320 is worn away by the workpiece. The resin coating 320 material or the island structure 322 material may contaminate the workpiece or can degrade the workpiece surface due to frictional heating of portions of the workpiece that contact these non-abrasive areas which are exposed.

The spherical center 319 of the abrasive beads 318, 326 is the point where the bulk of the abrasive particles 332 is located within each of the individual beads 318, 326. The bead 318, 326 spherical distance 337 that is measured between the spherical centers 319 and the backside of the abrasive article 324 backing 330 is an important indicator of the flatness of the abrasive surface of the article, and therefore, a measure of how effectively all of the abrasive particles 332 can be utilized in a flat lapping abrading procedure with an article 324. An optional method to provide a precision flatness of the abrasive surface on an abrasive article 324 is to control the bead 318, 326 center 319 distance 337 variations in proportion to the size 328 of the beads 318, 326. It is preferred that the abrasive article 324 center distance 337 have a standard deviation of less than 50% of the desired average bead size 328 or a standard deviation of less than 23 micrometers (0.001 inches) for 45 micrometers (0.002 inches) beads. It is more preferred that the standard deviation of center distance 337 is less than 40% and even more preferred that it be less than 30% and even more highly desired that it is less than 20% of the average size 328 of the beads 318, 326. The center distance 337 of article 324 is important at all island structure 322 locations and at all abrasive bead 318, 326 locations. Quality assurance measurements of the center distance 337 of an article 324 would be made at a number of locations on the article 324 to establish that the abrasive article 324 has a uniform center distance 337, which indicates also that the article 324 also has a flat abrading surface. During production of the article 234 there will be some variance in the center distance 337 of the abrasive article 324 at different locations on the article 324 due to manufacturing tolerances of beads 318, 326 sizes 328, of island heights 334, of resin coating thicknesses 338 and of backing 330 thicknesses but as long as these article 324 center distance 337 variations are small relative to the size 328 of the abrasive beads 318, 326 then the article 324 will be sufficiently flat for precision lapping. The spherical center distance 337 can be measured with the use of optical measuring devices to examine and measure the peripheral edges of an abrasive article 324 or the edges of sample strips cut from an abrasive article 324. Abrasive particles other than spherical abrasive beads 318, 326 can be resin 320 bonded to the island structures 322. These abrasive particles may be abrasive agglomerates or blocky shaped abrasive particles that do not have a spherical shape. However, these particles do have a geometric effective-diameter and a particle volume center 319. Other measurement techniques can be used to establish the variation in the center distances 337 including making an abrasive article 324 thickness 336 measurement with a mechanical measurement device such as a caliper and subtracting out the effective-radius of the abrasive non-abrasive bead particle that is located where the thickness 336 measurement was made. In the case of a spherical abrasive particle, the effective-diameter and the effect-radius are equal to the actual spherical diameter and actual spherical radius respectively.

Figure 48:
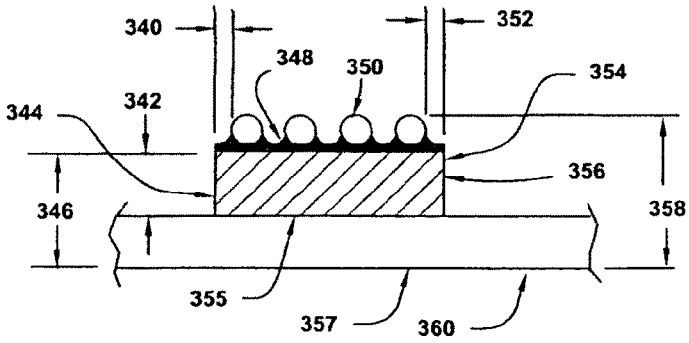
FIG. 48 is a cross section view of an abrasive agglomerate bead coated raised island structure.

FIG. 48 is a cross section view of an abrasive agglomerate bead coated raised island structure that is attached to a backing sheet. The abrasive article 344 has a flat surfaced raised island structure 356 attached to a backing sheet 360. The structure 356 has a wall 354 and a resin 348 coating that supports abrasive agglomerate beads 350 which are positioned gap distances 340 or 352 away from the structure wall 354 to assure sufficient resin 348 surrounds the beads 350 in the gap distance 340,350 areas to provide structural support of the edge-positioned beads 350. The raised island structure 356 has a precision uniformity of thickness 346, which is measured from the top of the structure 356 to the support side 357 of the backing sheet 360. The raised island structure 356 also has a precision uniformity of thickness 342, which is measured from the top of the structure 356 to the island side 355 of the backing sheet 360. The abrasive article 344 has a uniform and precise thickness 358, which is measured from the top of the abrasive beads 350 to the support side of the backing sheet 360.

Figure 49:
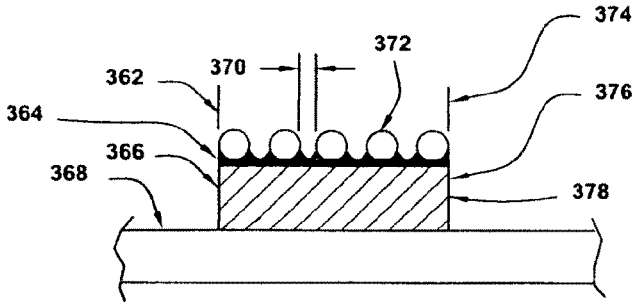
FIG. 49 is a cross section view of an abrasive agglomerate bead coated raised island structure.

FIG. 49 is a cross section view of an abrasive agglomerate bead coated raised island structure that is attached to a backing sheet. The abrasive article 366 has a flat surfaced raised island structure 378 attached to a backing sheet 368. The structure 378 has a wall 376 and a resin 364 coating that supports abrasive agglomerate beads 372 which are positioned with gap distances 370 between adjacent beads 372. The beads 372 are also positioned with the side of the bead 372 in a flush position with the wall 376 as shown by the flush wall line 374.

Figure 50:
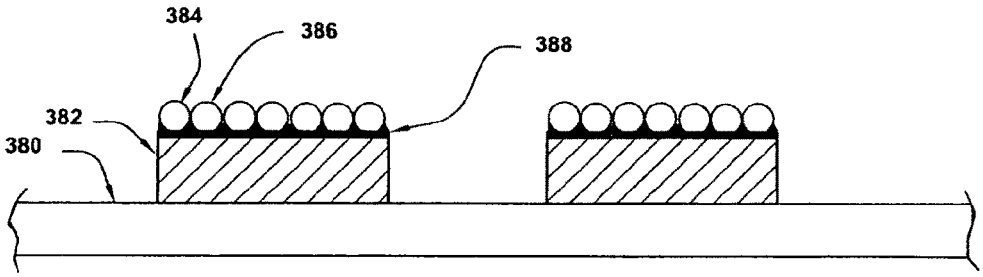
FIG. 50 is a cross section view of abrasive agglomerate bead coated raised island structures.

FIG. 50 is a cross section view of abrasive agglomerate bead coated raised island structures that are attached to a backing sheet. The abrasive article has flat surfaced raised island structures 382 attached to a backing sheet 380. The structures 382 have a resin 388 coating that supports abrasive agglomerate beads 386 which are positioned with no gap distances between adjacent beads 386.

Figure 51:
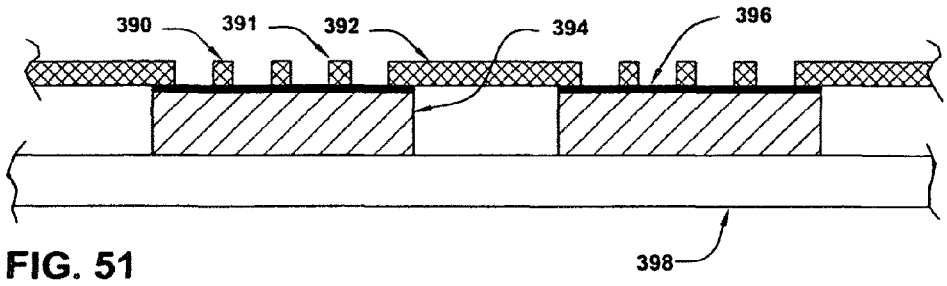
FIG. 51 is a cross section view of resin coated raised island structures having an abrasive bead placement font sheet.

FIG. 51 is a cross section view of resin coated raised island structures having a electrodeposited metal abrasive bead placement font sheet. Flat surfaced raised island structures 394 are attached to a backing sheet 398. The structures 394 have a resin 396 coating that is applied to the top flat surface of the island structures 394. An abrasive bead placement font sheet 392 having sheet walls 390 and sheet openings 391 is placed in flat contact with the resin 396.

Figure 52:
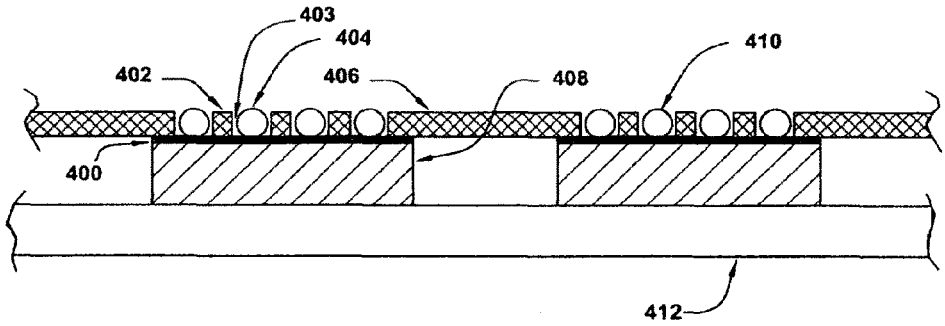
FIG. 52 is a cross section view of resin coated raised island font sheet with abrasive beads in contact with the resin.

FIG. 52 is a cross section view of resin coated raised island structures having a electrodeposited metal abrasive bead placement font sheet with abrasive beads in contact with the resin. Flat surfaced raised island structures 408 are attached to a backing sheet 412. The structures 408 have a resin 400 coating that is applied to the top flat surface of the island structures 408. An abrasive bead placement font sheet 406 having sheet walls 402 and sheet openings 403 is placed in flat contact with the resin 400 and abrasive beads 404,410 are positioned in the font sheet 406 openings 403 in direct contact with the resin 400.

Figure 53:
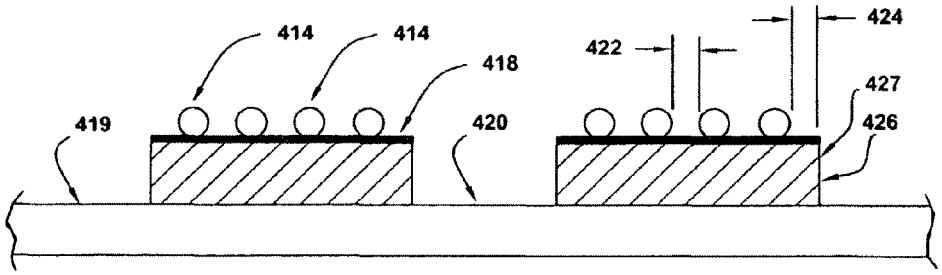
FIG. 53 is a cross section view of abrasive agglomerate bead coated raised island structures.

FIG. 53 is a cross section view of abrasive agglomerate bead coated raised island structures that are attached to a backing sheet. The abrasive article 419 has a flat surfaced raised island structure 426 attached to a backing sheet 420. The structure 426 has a wall 427 and a resin 418 coating that supports abrasive agglomerate beads 414 which are positioned gap distances 424 away from the structure wall 427. The beads 414 are positioned with gap distances 422 between adjacent beads.

Figure 54:
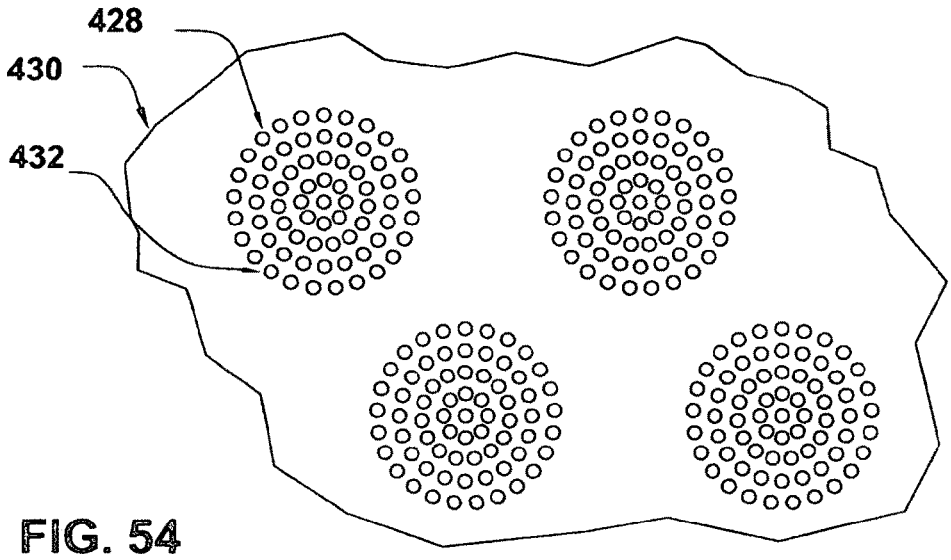
FIG. 54 is a top view of an abrasive bead font sheet.

FIG. 54 is a top view of an electroplated abrasive bead font sheet that can be used to position individual beads on the top surface of resin coated raised island structures. The font sheet article 430 has circular pattern arrays 432 of individual through holes 428. The sheet article 430 can be aligned with and placed on the top surface of wet resin coated raised islands (not shown) that have the same size and relative location as the pattern arrays 432 and individual abrasive beads (not shown) can be inserted into the font sheet article 430 through holes 428 whereby the beads will contact only the wet resin and become attached to the top surface of the islands. Beads that contact the font article 430 at positions other than the through holes 428 will not be deposited on the raised island article at those position locations as the non-hole portions of the font sheet article act as a barrier to those beads.

Figure 55:
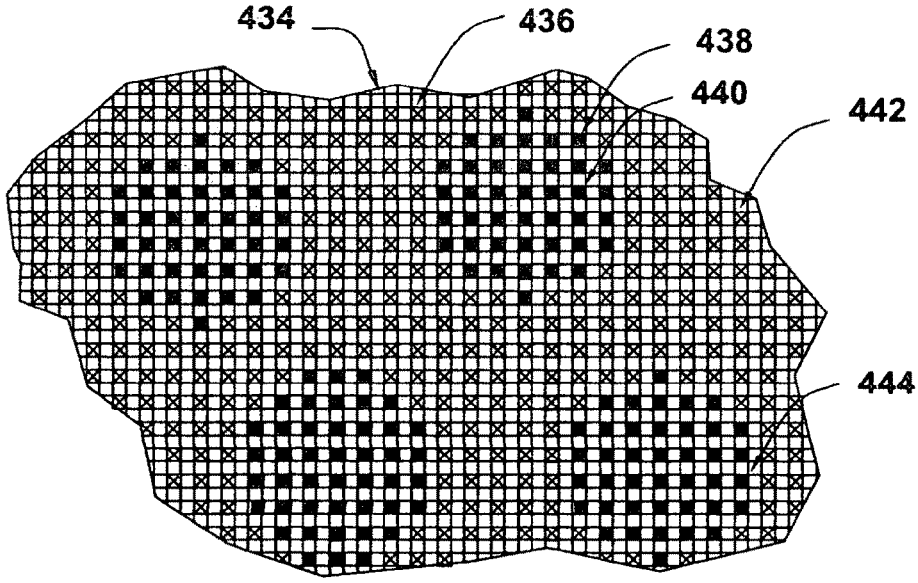
FIG. 55 is a top view of a mesh screen bead font sheet.

FIG. 55 is a top view of a mesh screen bead font sheet that can be used to position individual beads on the top surface of resin coated raised island structures. The font sheet article 434 has circular pattern arrays 438 of individual open-cell through holes 440, 444. Areas of the screen article 434 that surround the circular pattern arrays 438 have filled screen cells 436, 442 that block the introduction of the beads (not shown) into a screen mesh cell. The sheet article 434 can be aligned with and placed on the top surface of wet resin coated raised islands (not shown) that have the same size and relative location as the pattern arrays 438 and individual abrasive beads can be inserted into the font sheet article 434 through holes 440, 444 whereby the beads will contact only the wet resin and become attached to the top surface of the islands. Beads that contact the font article 434 at positions other than the through holes 440, 444 will not be deposited on the raised island article at those position locations as the non-open-hole portions of the font sheet article act as a barrier to those beads.

When different sized abrasive beads are coated on a precisely flat raised island structure having a precise thickness resin coating only some of the largest sized abrasive beads will contact a flat workpiece surface.

Figure 58:
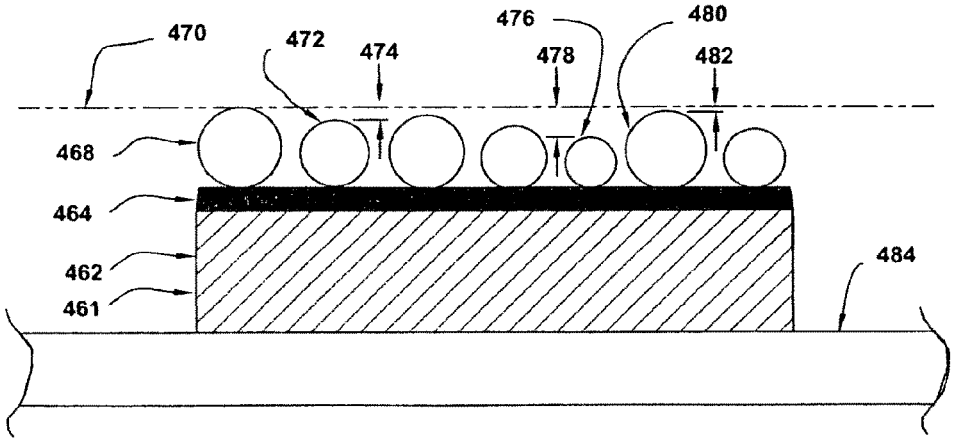
FIG. 58 is a cross section view of an abrasive bead coated raised island attached to a backing.

FIG. 58 is a cross section view of an abrasive agglomerate bead coated raised island structure that is attached to a backing sheet. The abrasive article 461 has a flat surfaced raised island structure 462 attached to a backing sheet 484. The structure 462 has a resin 464 coating that supports different sized abrasive agglomerate beads 468, 472, 476, 480. A flat plane 470 that is parallel to the back mounting side of the backing sheet 484 is shown in flat contact with the top surface of the largest beads 468,480 and there is a gap distance 474 between the plane 470 and the top surface of the medium sized bead 472. There is a gap distance 478 between the plane 470 and the top surface of the small sized bead 476. When an abrasive article 461 is used to abrade a flat surfaced workpiece (not shown) only the large abrasive beads 468, 480 will contact the workpiece surface and the smaller sized abrasive beads 472, 476 will not be in contact with the workpiece until the large sized beads 468, 480 wear down. A method to provide a continuous flat top surface of a abrasive coated raised island structure having different sized abrasive beads is to coat the island structure with a thick coating of resin and then depositing the different sized abrasive beads onto the liquid state resin. Then a flat plate can be applied to the surfaces of all the abrasive beads to push them individually down into the resin layer. The flat plat abrasive bead contacting surface would be maintained in a position that is parallel to the back side of the backing which is the mounting side of the abrasive article backing sheet as the flat plate is advanced toward the raised island structure. The largest beads would be pushed the deepest into the resin layer and the smallest beads would penetrate least into the resin layer. The plate is advanced until all of the beads have their top surfaces in a common plane that is parallel to the backside of the backing sheet. Then, or after partial solidification of the resin, the plate is separated from the abrasive beads thereby leaving all the bead surfaces in a flat common plane. If desired a precision thickness release liner sheet can be applied to the abrasive bead top surfaces prior to contact with the beads with the flat plate which will prevent contamination of the plate by the resin which can be squeezed up from between the beads as the beads are pressed down into the resin. After the plate is separated from the beads, the release liner sheet can also be removed from the bead surfaces. Precision thickness release liner sheets can be made by applying a release coating material including but not limited to wax, petroleum jelly, silicone oil or polytetrafluoroethylene (PTFE) to a sheet of polyester or polyethylene terephthalate (PET) backing material. Also, skived PTFE sheet supplied by ENFLO Corporation, Bristol, Conn. can be used as a release liner sheet.

Figure 59:
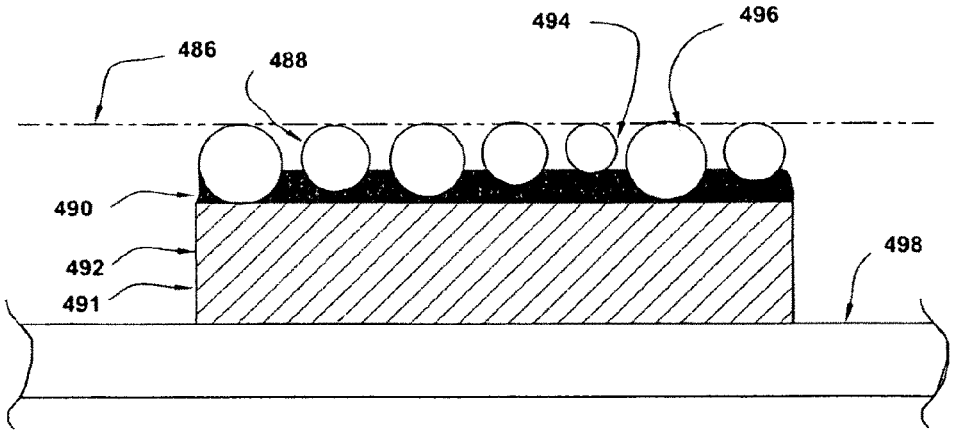
FIG. 59 is a cross section view of an abrasive coated raised island having surface leveled beads.

FIG. 59 is a cross section view of an abrasive agglomerate bead coated raised island structure having surface leveled beads. The abrasive article 491 has a flat surfaced raised island structure 492 attached to a backing sheet 498. The structure 492 has a thick resin 490 coating that supports different sized abrasive agglomerate beads 488, 494, 496. A rigid flat plate (not shown) having a contact surface in a plane 486 that is parallel to the back mounting side of the backing sheet 498 was used to position the top surfaces of all of the beads 488, 494 and 496 in the common plane 486. Only one raised island structure is shown but the technique of using the flattening plate is applied to all the islands that are attached to a typical abrasive article.

The same type of abrasive bead leveling as described here can be done on an abrasive article by passing the abrasive article through a set of rigid precision gap spacer rollers that have gap-opposing roller surfaces that are precisely parallel to each other. Rigid gap-spaced rolls can also be used to position abrasive beads on raised islands that are attached to a continuous web by passing the continuous web through a set of the precision gapped rolls. The same technique of using a rigid flat plate to level the surfaces of different sized abrasive beads on a backing sheet can also be used to level abrasive beads on raised island structures that are not precisely flat or are not precisely located in a common plane that is parallel to the backside of the backing sheet.

Positioning the top surface of all the abrasive beads on a raised island disk article in a common plane that is precisely parallel to the backside of the disk backing is very desirable for high speed flat lapping to ensure that all of the individual abrasive beads are utilized in the abrading process. The adhesive coating that supports the beads must be sufficiently thick that when the largest sized beads are pushed by the rigid flat platen surface into direct contact with the raised island structure surface that the rigid platen also pushes small sized beads, that are directly adjacent to the large sized beads, a substantial depth into the adhesive. Each bead, whether large or small, must have sufficient adhesive in contact to provide structural support of the bead to resist abrading contact action.

This technique of using rigid precision flat platens or rigid precision surfaced rollers to provide these common-plane positioned beads is distinctly different from the traditional technique of using resilient rubber rollers to simply push abrasive particles or beads down into a layer of make-coat adhesive resin.

Rubber rolls have a conformable surface that allows them to deform under pressure. Here a nipped rubber roll contact area tends to spread out laterally in a direction that is perpendicular to the roll axis to form a contact land area instead of a contact line. By comparison, a pressure nipped rigid roll will maintain a contact line because the roll contact pressure does not distort the cylindrical roll surface. This localized rubber roll land area distortion also provides a scrubbing action to the abrasive particles or beads that are contacted by the distorted roll surface. The rubber roll scrubbing action tends to sequentially move contacted individual particles or beads laterally in both upstream and downstream directions as they reside in the liquid resin. Lateral movement of the particles or beads is undesirable because the common plane particle or bead elevation locations can be lost or adversely affected by the scrubbing action.

Because the rubber roll nipped land area contact surface is resilient, the locally compressed rubber roll tends to independently push all of the individual particles or beads into contact with the backing or island structure substrate surfaces. Small abrasive particles or beads that are directly adjacent to large sized particles or beads are independently pushed further down into the resin than the large particles or beads that tend to bottom-out when they are forced against the abrasive article substrate that typically is relatively rigid. The result is that the top exposed surfaces of all of the particles or beads are not in a common plane. Here the small particles or beads are positioned at surface levels that are substantially below the surface levels of the large sized particles or beads.

To assure that the resin adheres to each individual particle or bead in this roll or platen flattening process, the resin must have sufficient liquidity that the individual particles or beads remain resin-wetted when they are re-positioned by the roll or platen. In some cases, this localized land-area distortion of the pressure nipped rubber roll surface will result in some of the liquid resin being pushed upward whereby the resin contacts and contaminates the rubber roll surface. If the rubber roll surface is contaminated with liquid resin the process must be discontinued. However, if the resin is partially solidified prior to the particle or bead re-positioning process, the original wetted-bond can be broken between the resin and the particle or bead when the particle or bead is moved downward toward the substrate with a resin-shearing action by the roll or platen. By comparison, because a rigid precision flat roll or platen has only line contact at the top exposed surfaces of the particles or beads and only pushes the particles or beads downward enough to establish that they all are positioned in a common plane, there is little tendency for the excess resin from rising up and contacting the surface of the rigid roll or platen.

Further, when a rubber roll is used, the particles or beads are all independently moved toward the substrate surfaces. If the substrate surface is defective from a precision flatness standpoint, then the particles or beads will assume positions that mirror the defective substrate flatness. Here, if one island flat surface is at a lower elevation than adjacent island flat surfaces, the flexile rubber roll will conform to all the island surfaces, resulting in abrasive coated islands that have different elevations. These different-elevation abrasive islands can not be used for high speed flat lapping even though they can be used for traditional abrading processes. This abrasive article precision flatness and article-thickness requirement is unique to high speed flat lapping.

The use of the precision-surfaced and precision-aligned rigid rollers and platens corrects deficiencies that are present with non-precision flat raised island substrates and also with spherical abrasive beads that do not have equal sizes. Use of these rolls and platens assures that the top exposed surfaces of the individual abrasive beads are positioned in a plane that is precisely parallel to the backside surface of the abrasive article backing. They provide a simple but effective correction of problems with inherently deficient abrasive article components (including non-flat islands and non-equal sized beads) to allow the processed article to be successfully used for high speed lapping where all of the expensive diamond abrasive particles are fully utilized. Processing a raised island abrasive disk article having these same deficiencies with a traditional rubber roll held in pressure contact with the disk surface would result in an expensive abrasive disk that would have little abrading value in high speed lapping.

The downward position of the backing backside surface aligned roller or platen is controlled in a flattening process so that the downward spherical bead movement is terminated when or before the largest sized abrasive bead contacts the surface of the backing or island substrate. If bead contact with the substrate is made, the largest bead is in mutual contact with the roller or platen and the substrate surface. This establishes the elevation location of the bead-surface plane and the rigid roll or rigid platen downward motion is instantly terminated. All of the other platen-contacted abrasive bead upper surfaces are then aligned in a plane that includes the top surface of the largest particle and whereby the plane is precisely parallel with the backside of the abrasive article backing. There is considerable equipment expense and process complexities that are required to provide precision rigid rollers or flat platens that are precisely aligned in parallel with surfaces that support the backside of the abrasive article and that have the sensors and controllers to instantly interrupt the downward motion of the platen. This equipment is required to consistently provide the surface planar alignment of the top surfaces of the abrasive beads with the backside of the backings. The process and equipment is even more complex when considering that raised island abrasive disks typically have very large diameters than can exceed 18 or even 60 inches (45 or 152 CM) and the roll or platen positioned particles must typically be positioned within 0.0001 inches (2.5 micrometers) for successful use of the abrasive articles in high speed flat lapping. By comparison, it takes very little expense or strategy or process complexity to simply press a resilient rubber roll against the surface of an abrasive article as it move past the roller as used for traditional abrasive articles. These rubber roll flattened raised island abrasive articles are not suited for high speed lapping.

Coating of Abrasive Particles on Disk Islands

Problem: Abrasive coated annular disks need to have abrasive coated islands to minimize hydroplaning at high operation speeds due to use of water cooling during the abrading or lapping process. The preferred form of abrasive coated raised island articles is to have a single or mono layer of abrasive particles or abrasive agglomerate beads coated on the top flat surfaces of precision height or thickness islands so that each individual abrasive particle or bead can be brought in abrading contact with a flat workpiece surface at high abrading speeds. Use of a mono layer of abrasive particles or abrasive agglomerates prevents the top particles of a stacked layer of particles from shielding workpiece contact with adjacent or lower-level particles which lay deeper within the abrasive particle coating layer. The topmost sharp edges of the exposed abrasive particles contained within the individual abrasive beads must lie precisely flat in a plane parallel to the bottom surface of the disk backing whereby the thickness of the abrasive article is precisely equal over the full raised island portion of the disk article. This precise article thickness control allows all of the typically small, 25 to 45 micrometer (or about 0.001 to 0.002 inches) diameter beads to successfully contact the flat workpiece surface at 8,000 or more SFPM (surface feet per minute) speeds when using a precision flat surface rotating platen system.

Applying a wet coating of liquid adhesive binder, followed by a dusting or sprinkling of a top coating of loose abrasive particles or abrasive agglomerate beads, with an option of another top sizing coat of liquid adhesive, does not necessarily produce an abrasive disk article having with a precisely flat top surface or a precision-thickness abrasive disk article. This problem of non-flat or uneven abrasive coating can occur as the typical coater head device may not have a total thickness measurement reference to allow the height of the abrasive to be accurately controlled. When a layer of adhesive is applied to the top flat surfaces of raised islands and individual abrasive particles are deposited onto this adhesive, the depth of the penetration of individual abrasive particles or beads into the adhesive can vary substantially. In addition, when abrasive particles or abrasive beads having a range of sizes are deposited onto the adhesive, the top surfaces of these beads or particles are typically not located in a plane and therefore are not capable of providing abrading contact with a flat workpiece surface. These unequal sized beads or particles are a source of height, thickness, or flatness errors and they are difficult to level.

Solution: An annular pattern of raised island foundations can be formed on a backing sheet. This annular group of islands can be ground precisely flat on the tops with all islands having the same precise height from the bottom surface of the backing. A number of methods can be used to transfer a solvent-based liquid adhesive coating mixture that contains abrasive particles to the top surface of the independent islands. Various coating techniques include transfer of a coating liquid from a transfer sheet that has been coated as an intermediary step for transfer of a portion of the coating liquid to the top surfaces of the islands. Also, a rotogravure roll can be used to top coat the islands with the abrasive slurry mixture.

In transfer sheet coating, a liquid slurry mixture of abrasive particles or abrasive agglomerate beads mixed with a polymer resin and a solvent can be applied to a flexible transfer sheet and this sheet can be pressed against the flat surfaces of an array of raised islands that are attached to a backing sheet. Here, the liquid abrasive mixture slurry is in pressure contact with the surfaces of uncoated raised island structures and each island surface is wet-coated with a portion of the transfer-sheet abrasive slurry. The transfer sheet can then be separated from the raised islands with the result that at least 5% or up to 50% or more of the thickness of the abrasive slurry mixture originally coated on the transfer sheet is transferred to the island structure surfaces. After coating the raised island structures, the transfer sheet now has an uneven coating of abrasive slurry on its surface as a portion of the slurry thickness was removed at each island-contacting site on the transfer sheet. New abrasive slurry can be spread as an even coating on the original transfer sheet and this transfer sheet then used again to coat another array pattern of raised island structures with abrasive slurry. Different coating process variables including, but not limited to, the viscosity of the slurry, the thickness of the slurry and the speed at which the transfer sheet is separated from the raised islands can be optimized to provide a consistent abrasive particle slurry thickness being coated on the top surface of the island structures. After the islands are coated the solvent is evaporated from the abrasive coating mixture thereby shrinking the polymer binder adhesive component of the mixture. This binder shrinkage exposes the top portion of the individual abrasive beads from the substantially flat surface of the shrunken and solidified binder adhesive that attaches the beads to the top flat surfaces of the raised island structures. It is preferred that the top two thirds of the individual abrasive beads are exposed from the binder surface while the bottom third of the bead is surrounded by the binder adhesive. A preferred binder adhesive is a phenolic polymer where a number of different solvents or combinations of solvents that are well known for use with phenolic binders is used in the phenolic abrasive slurry mixture.

Figure 60:
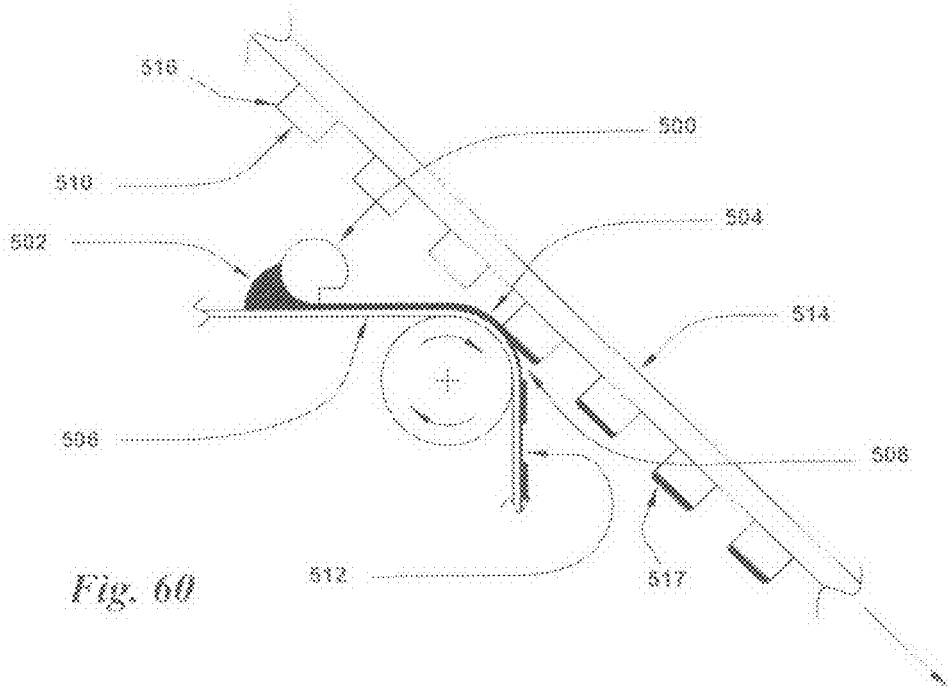
FIG. 60 is a side view of an adhesive binder and abrasive particle coating slurry mixture being applied to the top surface of abrasive island foundations by a transfer coating system.

FIG. 60 is a side view of an adhesive binder and abrasive particle coating slurry mixture being applied to the top surface of abrasive island foundations by a transfer coating system where the binder mixture is first coated on a web sheet and then a portion of this coating is transferred to the island tops. A notch-bar knife 500 meters the abrasive-binder slurry mixture or a non-abrasive coating material binder fluid mixture from a fluid coating bank 502 to apply a layer of 504 to a transfer web backing 506 which can either be a discrete disk backing or a continuous web backing. The abrasive-binder slurry mixture layer 504 splits at the region 508 after making contact with the island 516 top surfaces 510 with the result that approximately 50 percent of the binder slurry coating 504 remains on the transfer web 506 as a remaining binder layer 512 and approximately 50 percent of the binder 504 becomes bonded as a mixture coating 517 to the island top 510 where the island 516 is attached to the abrasive backing sheet 514. The same type of island coating apparatus can also be used to apply non-abrasive adhesive coatings 522 to the top surfaces 510 of islands 516.

Figure 61:
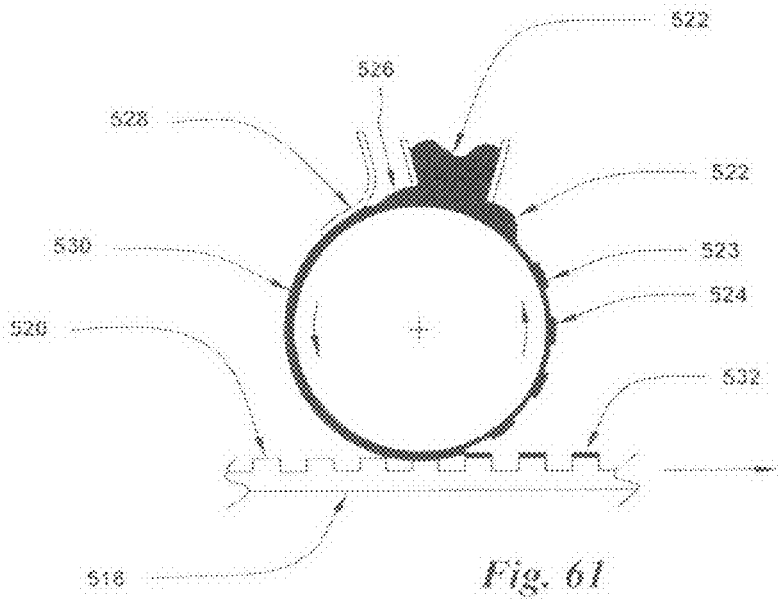
FIG. 61 shows a side view of an abrasive disk having islands coated with an abrasive particle filled liquid adhesive slurry mixture.

FIG. 61 shows a side view of an abrasive disk or a continuous abrasive web backing 518 having integral bare island structures 520 which have either a liquid adhesive coating or an abrasive particle filled liquid adhesive slurry mixture coating 522 applied to the top of the islands 520 by rolling contact of the knurl rotogravure roll 524 with the tops of the island structures 520. Coating mixture fluid 522 is supplied to the surface of the knurl roll 524 by use of a liquid slurry mixture coating dam 526 to create a knurl roll 524 surface that is level-filled 530 with liquid slurry mixture coating 522 by use of a flexible smoothing knife blade 528 to create transfer-roll 524 coated islands 532. Remaining slurry segments 523 that originate from the spaces between the islands 520 and that are attached to the knurl roll 524 are recirculated into the bulk slurry mixture 522 as the roll 524 rotates.

Monolayer Abrasive Bead Transfer Coated Islands

Problem: It is desired to transfer coat an abrasive bead and binder slurry mixture to the top flat surfaces of raised island structures where the individual abrasive bead top portions are fully exposed for abrading action. The size of the coated abrasive beads is preferred to be very small, approximately 45 micrometers (0.002 inches) in diameter. It is also desired that a monolayer of abrasive beads are transfer coated in a single flat layer on the flat island top surfaces.

Solution: An abrasive bead slurry mixture of spherical abrasive agglomerate beads can be mixed with an adhesive binder and a solvent and this mixture then coated onto a flexible transfer sheet backing. The coated slurry thickness is approximately twice the thickness of the average mixture bead diameter. For example, when 50 micrometer (0.002 inch) abrasive beads are used, the thickness of the slurry on the transfer sheet is preferred to be 0.004 inches (100 micrometers) thick. The transfer sheet slurry coating thickness can be very precisely controlled by a number of traditional coating techniques comprising roll coating and notch-bar knife coating. Then the slurry coated transfer sheet can be lightly pressed into slurry contact with the top flat surfaces of raised islands where the liquid slurry fully wets the bare dry-surfaced island structure surfaces. The transfer sheet can then be peeled away from the island surfaces thereby leaving approximately one half of the thickness of the transfer sheet slurry on the top surface of the raised islands. The thickness of the slurry coating on the island tops is now approximately equal to the average diameter of the spherical beads.

A slurry mixture that has a wide range of abrasive bead sizes can be transferred to island top surfaces and the slurry will tend to split evenly in half when the transfer sheet is peeled away from the islands. However, it is much preferred that equal sized abrasive beads be used in the slurry mixture. Here the individual beads within the transfer split-coating slurry binder layer on the islands are nominally positioned where one spherical bead surface contacts the island top surface and the opposing end of the spherical bead is nominally level with the top exposed surface of the transfer coated liquid binder. This process is particularly suited to the use of spherical shaped abrasive agglomerate beads because spherical beads tend to remain uniformly distributed within a slurry mixture and also within a coated slurry layer. These beads have very low surface areas for their volumes and do not assume undesired positions within a coated area as compared to acicular-shaped abrasive agglomerates or abrasive particles.

Because the slurry binder fully wets both the transfer sheet surface and the raised island surfaces, the slurry tends to split into two slurry layers that are approximately equal in thickness. Also, the liquid slurry binder is thoroughly mixed to fully wet each of the individual small low density porous ceramic abrasive beads with the result that the beads tend to remain suspended in the binder liquid and they exert little influence on the rheological characteristics of the binder fluid. After the split-coating transfer, one half-thickness layer remains attached to the transfer sheet surface and the other half-thickness layer is transferred to the surfaces of the islands. This slurry splitting action only occurs in the localized transfer sheet areas that are in contact with the raised island areas. No slurry splitting takes place in those regions of the transfer sheet that do not contact the raised islands.

A number of tests samples were made where this slurry transfer coating technique was used to transfer coat spherical beads where the bead diameter sizes were approximately equal to the thickness of the transferred coated slurry. Two different methods were used to form a double-thick slurry coating that was split upon separation of the transfer sheet from a rigid or flexible substrate. In one case, a notch bar coater knife having 0.0045 inch (114 micrometer) raised sides was used to apply an approximately 0.0045 inch (114 micrometer) thick layer of a slurry mixture of glass beads and epoxy to a thin flexible polyester backing. In another case, a roller having raised edges was used to spread out an approximately 0.0045 inch (114 micrometer) thick layer of the slurry between two layers of the polyester backing sheets. Here, glass beads having an average size of 66 micrometers (0.0026 inches) diameter were mixed in a quick set epoxy binder and the slurry mixture was coated approximately 0.0045 inches (114 micrometers) thick on a 0.002 inch (50 micrometer) thick polyester backing sheet. Another 0.002 inch (50 micrometer) thick polyester backing sheet was pressed into wet contact with the liquid slurry coated transfer sheet to form a polyester sheet "sandwich" containing an internal liquid slurry layer. The transfer sheet was then peeled away from the backing sheet to perform the slurry splitting procedure. In another case, the two polyester backings with the slurry coating between them were peeled apart.

When the slurry coating was split in two by the transfer sheet peeling action, it was found that the presence of the beads in the epoxy adhesive binder had little influence on the coated slurry splitting action. Also, both backing sheets had equal thickness slurry coatings with monolayers of glass beads on their surfaces. In addition, the distribution density of the beads was also approximately equal on both backing sheets. This was an indication that those beads that resided at the central region in the original thickness slurry coating also divided evenly upon the slurry-splitting event. Here one half of these central beads traveled with the split binder to one backing sheet and the other half of these centrally located beads remained with the split binder on the other backing sheet. Further, those beads that were originally located near to or in contact with the surface of a backing stayed in contact with the respective backing. Further tests were made using a bead-slurry coated 0.002 inch (50 micrometer) thick polyester backing sheet and a stiff paper board, and also a metal substrate, with the same results of even splits of the bead filled epoxy binder. In all cases the slurry binder liquid was continuous throughout out its coated thickness and also along the surface of the transfer sheet even though the individual abrasive beads were dispersed throughout the thickness of the coated slurry layer.

The amount of solvent that is in a initially coated slurry mixture is preferred to be approximately 70% by volume. After the abrasive slurry is transfer coated to the islands the abrasive article is slowly heated to drive off the solvents which results in shrinkage of the adhesive binder. Enough time is allowed in the heating process that the solvent can diffuse through the binder thickness to the binder surface without degrading the physical characteristics of the binder. Those abrasive beads that were inadvertently positioned some distance above the flat island structure surface are brought closer to the surface because the volume of the binder that is between the individual abrasive bead and the island surface is reduced by the binder shrinkage. In addition, when a slurry layer is initially coated on an island top surface, the binder is nominally level with the top surfaces of the individual abrasive beads. When 70% of the solvent has evaporated, the height of the remaining binder is only approximately 30% of the height of the original coating. The shrinkage height reduction of the binder due to loss of solvent reduces the binder bead support height to approximately one third of the height of the beads, leaving the top portion of the beads exposed for abrading contact.

As the transfer sheet is pulled away from the raised islands, some of the abrasive particles or slurry material can inadvertently be pulled up or away from direct contact with the flat island structure surfaces which is undesirable as this results in an uneven island surface or weakly supported beads. To minimize these problems an air jet can be focused on the island edges to dislodge those beads that tend to overhang the island edge and to nominally flatten out the slurry coating on the island top surface. In addition, after partial drying of the slurry by solvent removal, a bar or roller or a flat platen can be pressed into contact with the exposed beads or the partially solidified slurry coating to provide a planar surface to the coated islands that is precisely parallel to the backside mounting surface of the abrasive article. If desired, a release liner sheet can be placed between the exposed abrasive beads and the flattening bar or roller or platen. The abrasive disk articles can have a rectangular shape, a circular disk shape or other shapes.

In one embodiment, a transfer sheet can be coated using a knife coater that provides an abrasive and resin slurry mixture coating on the transfer sheet that is twice the desired thickness of the coating that remains on the flat island surfaces after approximately half of the abrasive slurry is transferred to the islands. In another embodiment, an abrasive slurry coating that is twice the desired thickness of the coating that remains on the flat island surfaces can be provided on the surface of a roll and approximately half of this abrasive slurry coating can be transfer coated on to the islands flat top surfaces.

Figure 62:
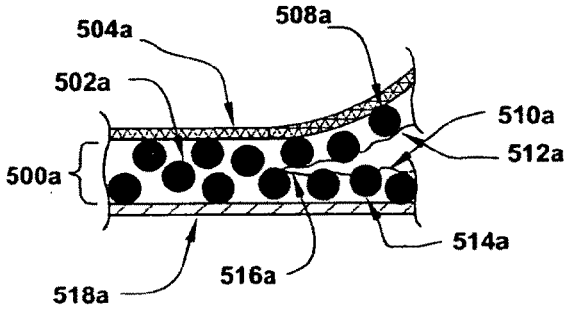
FIG. 62 shows a side view of two sheets having a layer of a slurry mixture of a solvent based adhesive and abrasive beads between a transfer sheet and a slurrycoated sheet.

FIG. 62 shows a side view of two sheets having a layer of a slurry mixture of a solvent based adhesive and abrasive beads between a transfer sheet and a slurry coated sheet. As shown here, a transfer sheet 504*a* and another sheet 518*a* have an abrasive and resin slurry mixture coating 502*a* that is mutual to both sheets 504*a* and 518*a* where the coating 502*a* has a uniform thickness 500*a* that is approximately twice the diameter of equal sized abrasive beads 508*a* and 514*a*. When the sheet 504*a* is peeled apart from the sheet 518*a* where the coating 502*a* tends to split evenly at the location 516*a* where approximately one half of the coating thickness 500*a* remains attached to the sheet 504*a* as a coating 512*a* and approximately one half of the coating thickness 500*a* remains attached to the sheet 518*a* as a coating 510*a*. Here, a monolayer of abrasive beads 514*a* is coated on the lower sheet 518*a* and a monolayer of abrasive beads 508*a* remains attached to the upper sheet 504*a*.

Figure 63:
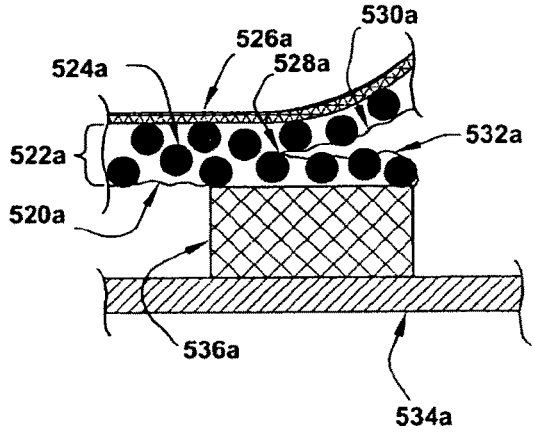
FIG. 63 shows a cross section view of a transfer sheets depositing a monolayer of abrasive beads on a raised island.

FIG. 63 shows a cross section view of a transfer sheets depositing a monolayer of abrasive beads on a raised island. As shown here, a transfer sheet 526*a* having a resin slurry mixture coating 520*a* that has a uniform thickness 522*a* that is approximately twice the diameter of equal sized abrasive beads 54*a*. The coating 520*a* is also in wetted contact with a raised island structure 536*a* that is attached to an abrasive article backing sheet 534*a*. When the sheet 526*a* is peeled apart from the island 536*a* the coating 520*a* tends to split evenly at the location 528*a* where approximately one half of the coating thickness 522*a* remains attached to the transfer sheet 526*a* as a coating where the beads 54*a* are substantially surrounded by a solvent filled resin 530*a*. A coating where the beads 54*a* are substantially surrounded by a solvent filled resin 532*a* that is approximately one half of the coating thickness 522*a* remains attached to the island 536*a* top flat surface. Here, a monolayer of abrasive beads 54*a* that are substantially surrounded with a solvent filled resin 532*a* is coated on the top flat surface of the island 536*a*.

Figure 64:
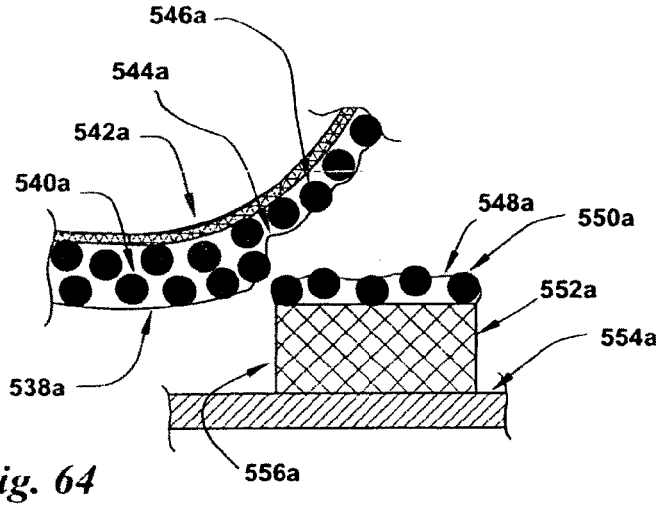
FIG. 64 shows a cross section view of a transfer sheets depositing a monolayer of abrasive beads on a raised island.

FIG. 64 shows a cross section view of a transfer sheets depositing a monolayer of abrasive beads on a raised island. As shown here, a transfer sheet 542*a* having a resin slurry mixture coating 538*a* that has a uniform thickness that is approximately twice the diameter of equal sized abrasive beads 540*a*. The coating 538*a* is shown as being separated from a raised island structure 552*a* that is attached to an abrasive article backing sheet 554*a*. When the sheet 542*a* is peeled apart from the island 552*a* approximately one half of the coating 538*a* remains attached to the island 552*a* and the coating 538*a* is split at the location 544*a*, which is located at the front edge 556*a* of the island 552*a*. Here, a monolayer of abrasive beads 550*a* substantially surrounded by solvent filled resin 548*a* is coated on the top flat surface of the island 552*a*.

Figure 65:
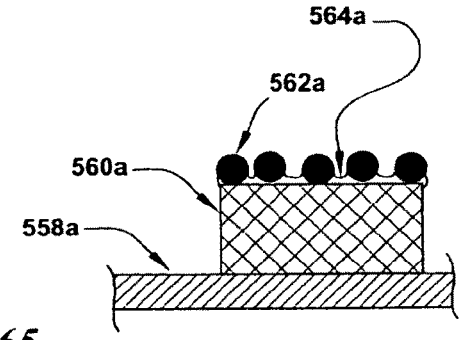
FIG. 65 shows a cross section view of abrasive beads bonded to a raised island with shrunken solvent based adhesive binder.

FIG. 65 shows a cross section view of abrasive beads bonded to a raised island with shrunken solvent based adhesive binder. When the solvent filled resin 548*a* of FIG. 64 is processed in an oven (not shown), the solvent evaporates and the resin 548*a* surrounding the beads 562*a* shrinks to form a shrunken resin layer 564*a* that structurally bonds the beads 562*a* to the island structure 560*a* that is attached to the abrasive article backing 558*a*. The top portion of the beads 562*a* are now fully exposed when the resin 564*a* shrinks as shown and are no longer substantially surrounded by the resin 564*a*.

Surface Conditioning of Annular Coated Abrasive Articles

Problem: It is desired that ceramic spherical or non-spherical shaped agglomerates that are coated in a single or monolayer on a abrasive article backing sheet or on the top island surfaces of an raised island abrasive article all have the same height relative to the mounting side of a backing sheet. It is also desirable that stray double-layered abrasive particles, spherical abrasive agglomerates and non-spherical shaped abrasive agglomerates that are inadvertently coated on raised islands be removed. Further, it is desirable that oversized abrasive particles or oversized abrasive agglomerates that are inadvertently coated on raised islands be removed or abrasively adjusted in height-size so their top surfaces all have the same height relative to the mounting side of a backing sheet. In addition, it is desired that the outer non-abrasive material exterior surfaces of individual abrasive particle agglomerate beads be initially abraded away to expose the abrasive particles which are contained within the bead sphere surfaces prior to abrading use of an abrading article.

When a dispersion mixture of abrasive particles and an adhesive is transfer coated on the flat raised island structure surface there is a tendency for the dispersion mixture to form a small raised bead around the periphery of the individual island structures where the elevation of the dispersion bead is somewhat higher than the dispersion that is coated on the planar surface of the island structure.

Solution: After an abrasive article having an annular band of coated abrasive agglomerates or single abrasive particles or an abrasive article having agglomerate coated raised islands is manufactured, the article can be surface conditioned to remove stray double-level agglomerates. The article can also be surface conditioned to remove the upper portion of the agglomerate enclosure exterior surfaces. The surface conditioning process comprises pre-grinding or conditioning the abrasive article by contacting the moving or stationary surface of a newly manufactured abrasive article with a moving or stationary abrading device including a rigid block or an abrasive surface prior to using the newly manufactured abrasive article to abrade a workpiece surface. The abrasive article would be mounted on a rotatable platen and another abrading surface would be brought into abrading contact with the surface of the annular band abrasive article that is to be preconditioned. Either the contacting abrading surface can be moved relative to the annular article or the annular article can be moved relative to the contacting abrading surface while contact pressure is maintained during the abrading contact. Only enough abrading action is provided to knock off, or partially wear down, the unwanted second-level particles or agglomerates or oversized particles or agglomerates or raised abrasive beads that are located on the periphery of individual islands, thereby developing a single depth particle surface on the abrasive article abrasive surface. Some additional grinding is further applied to grind away only the upper portion of the agglomerate encapsulating exterior surface to expose the very top-surface particles enclosed in the spherical composite agglomerates. Abrasive particle agglomerates may be spherical agglomerates or composite agglomerates having shapes other than spherical shapes and the agglomerates may include ceramic matrix material or other erodible abrasive particle support matrix material.

Figure 87:
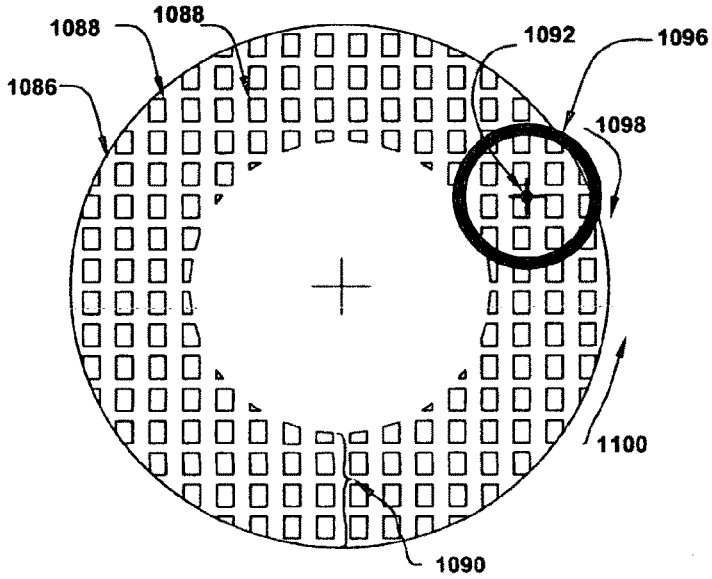
FIG. 87 shows a top view of a conditioning ring in contact with an abrasive article.
Figure 88:
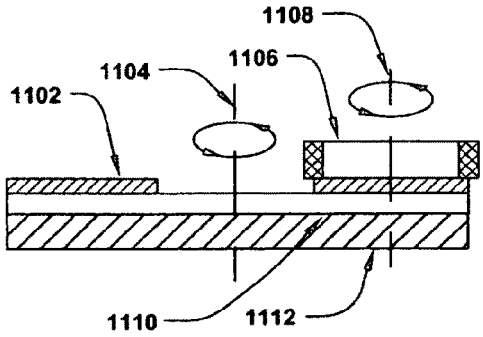
FIG. 88 shows a cross section view of a conditioning ring in contact with an abrasive article.

Spherical agglomerate beads are shown in FIGS. 78, 79, 80, 81, 82, 83, 84, 85 and 86 to illustrate issues related to agglomerate bead coatings and wear-down including the removal of second level abrasive beads by surface conditioning. These issues and their corrective techniques can also be applied to abrasive articles having individual abrasive particles in addition to composite spherical bead agglomerates. Stray or oversized individual abrasive particles or spherical abrasive beads or non-spherical abrasive agglomerates can be removed or worn-down to the level of the average sized particles by use of an abrasive conditioning plate. The surface conditioning plate can be moving or stationary. FIGS. 87 and 88 show an abrasive article mounted on a rotary platen and a surface conditioning ring-plate in flat surface contact with the top surface of the abrasive article.

Figure 78:
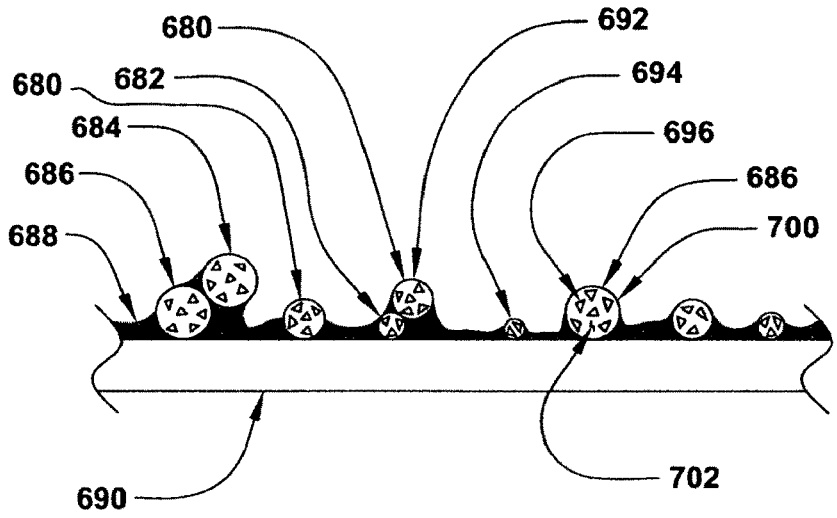
FIG. 78 is a cross-section view of different sizes of spherical stacked abrasive particle agglomerates, or abrasive beads that are bonded on a backing.

FIG. 78 is a cross-section view of different sizes of spherical stacked abrasive particle agglomerates, or abrasive beads that are bonded on a backing sheet (or on the top flat surface of a raised island structure). It is desirable to remove the stacked agglomerate beads from their elevated second-level positions by surface conditioning prior to initiation of abrading action of the abrasive article. These elevated beads are resin bonded to the bottom-layer beads and require significant forces to either dislodge them or to wear them down to a mutual planar level with the bottom beads. Elevated or stray or oversized individual abrasive particles or spherical abrasive beads or non-spherical abrasive agglomerates can be removed or worn-down to the level of the average sized particles by use of an abrasive conditioning plate. The surface conditioning plate can be moving or stationary when in surface contact with a moving abrasive article or a moving conditioning plate can be translated across the surface of a stationary abrasive article.

Figure 86:
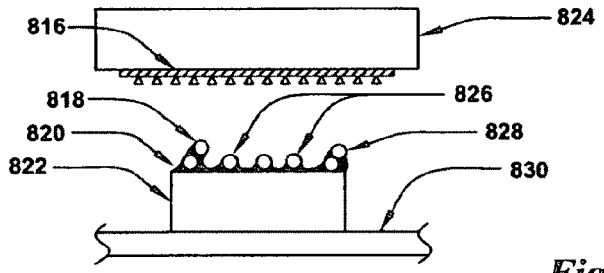
FIG. 86 is a cross-section view of a surface conditioning plate having an abrasive sheet article used to grind off elevated second-level abrasive agglomerates.

FIG. 86 is a cross-section view of a surface conditioning plate having an abrasive sheet article used to grind off elevated second-level abrasive agglomerate beads attached with a resin to raised island structures attached to a backing sheet. A grinding or surface conditioning plate 824 having an attached abrasive covered abrasive sheet article 816 is brought into abrading contact with the elevated second-level abrasive beads 818, 828 that are resin 820 bonded to the upper surfaces of first-level abrasive beads 826 that are resin 820 bonded to a raised island 822 that is attached to a flexible backing sheet 830. Abrading action continues until the elevated second-level beads 818, 828 are removed. This conditioning plate 824 can be used on non-monolayer beads that are attached to raised islands, or, the conditioning plate 824 can be used on annular bands of abrasive particles or agglomerate beads or non-bead abrasive agglomerates that are coated directly on the backing surface of a non-raised island abrasive article. A flat wear-plate or other hard abrading surface articles can be used in place of the abrasive sheet article attached to the conditioning plate 824 to perform the function of removing second-level agglomerates or can be used for abrading away the upper portion of agglomerate exterior surfaces to expose enclosed abrasive particles.

FIGS. 87 and 88 show two views of a conditioning ring that can be used for this abrasive article surface conditioning function. The conditioning ring can be rotated while in contact with the annular band abrasive surface of the abrasive article as the article is rotated. Rotation of the conditioning ring can be in the same rotational direction as the abrasive article that is mounted on a platen or it can be rotated in a direction that is opposite of the driven platen. The conditioning ring can be used continuously in an abrading process or it can be used occasionally or only at low platen rotational speeds to provide a flat surface across the full surface of the annular abrasive band after the annular band is worn unevenly during abrading use. Using this method, the surface of annular abrasive band is reconditioned periodically. The use of a conditioning ring is minimized with expensive superabrasive materials, including diamond and CBN, because those abrasive particles that are removed from an abrasive article by the ring are lost and the abrading life of the abrasive article is reduced. A conditioning ring can also be employed to surface condition a new abrasive article by removing the unwanted non-monolayer abrasive agglomerates that are attached to an abrasive article. A conditioning ring typically is designed as an annular ring that has a surface coating of hard materials on the annular ring edge that contacts an abrasive article. The outer diameter on the conditioning ring is somewhat larger than the width of the annular band of abrasive and the ring is positioned on the annular band of abrasive where the ring extends over both the inner and outer diameters of the annular band of abrasive.

FIG. 87 shows a top view of a conditioning ring in contact with an abrasive article. The abrasive article 1086 has abrasive coated raised islands 1088 that are attached to the article 1086 in an annular band 1090. The article 1086 is shown rotating in an anticlockwise direction 1100. A conditioning ring 1096 having a center of rotation 1092 is shown positioned at the center of the annular abrasive band 1090 with the outer diameter of the ring 1096 extending over both the inner diameter and outer diameters of the annular abrasive band. The annular conditioning ring 1096 is shown rotating in a clockwise direction 1098.

FIG. 88 shows a cross section view of a conditioning ring in contact with an abrasive article. The conditioning ring 1106 has an axis of rotation 1108 and the ring 1106 is positioned in contact with an annular band of abrasive coated raised islands 1102 that are attached to a abrasive article backing disk 1110 which is mounted on the flat surface of a platen 1112 which has a axis of rotation 1104

Abrasive Bead History

Diamond abrasive particles have been the abrasive particle of choice for high speed abrading of ceramic or non-ferrous materials for many years because of their capability to remove large amounts of hard workpiece materials when used at high abrading speeds. Diamond is referred to as a superabrasive. Water is used as a coolant to protect both the diamond particles and the workpiece from the friction caused heat that is generated during the abrading process.

Examination of the abrasive porous ceramic beads that are coated on commercially available diamond lapping film abrasive disk articles showed a wide range of the size of the beads that are coated on each individual of these disk articles. The largest of these abrasive beads coated on a abrasive disk are the only ones that are utilized in the abrading procedures. The smallest abrasive beads that are coated on the abrasive articles are seldom utilized and are thus wasted. Furthermore, there are variations in the amount of localized abrading that is applied to very precision workpiece surfaces by these abrasive articles that are coated with a wide range of sizes of abrasive beads. The flat abrasive bead coated surface areas of abrasive articles that contain large amounts of the larger sized beads perform aggressive abrading while those surface areas that have concentrations of the smallest sized beads perform lesser abrading.

An abrasive bead manufacturing process described in this present invention defines a simple method using a mesh screen that produces abrasive bead agglomerates that are near-equal in bead size. The new equal sized solidified diamond abrasive beads are produced from equal sized droplets of an abrasive slurry mixture of diamond abrasive particles and a water solution containing a suspension of very small particles of silica. The abrasive slurry droplets are formed with the use of a commonly available mesh screen device. The mixture of diamond abrasive particles and water suspended silica used here to produce the equal sized abrasive slurry droplets is the same type of diamond particle mixture composition that is well known and has been in use for years in the abrasive industry to produce the non-equal sized abrasive beads that are presently in common use. One of the presently used methods of producing solidified abrasive beads is to form abrasive slurry mixture droplets by directing a liquid stream of the abrasive mixture into a vat of stirred dehydrating liquid. The abrasive mixture stream is broken into droplets by the stirring action of the vat liquid. However, the droplets formed by the stirring action of a batch mixture of the abrasive slurry have a wide variation in droplet sizes, which is undesirable. Because the abrasive slurry droplets vary in size, the solidified abrasive beads made from these slurry droplets also vary in size. Another presently used method to produce abrasive beads is to introduce a stream of the liquid abrasive slurry mixture into the rotating head of a mechanical spray drier that operates at very high speeds, typically 40,000 revolutions per minute. Narrow filament streams of the liquid abrasive slurry exit the rotary head port windows and enter a hot air dehydrating environment. The filament streams break up into individual slurry droplets as the filament travels in the hot air environment. Here again, the abrasive slurry droplets that are formed from a specific batch mixture of the abrasive slurry have a wide range in sizes. In both abrasive bead forming process methods, the slurry droplets form spherical shapes which are solidified quickly by the drying action of the dehydrating fluids. Because the diamond particles enclosed within the formed spherical abrasive bead shapes are expensive, the formed abrasive beads produced in the bead forming process are simply collected and coated on a backing sheet which is converted into coated abrasive articles. Few, if any of the expensive non-equal sized abrasive beads are typically discarded.

The abrasive slurry mixture dehydration processes used here are the same type of dehydration processes that are well known and been in use for years in the industry to form the typical non-equal sized diamond abrasive beads in present use for making commercial diamond lapping film abrasive sheet products.

After dehydration, the solidified equal abrasive sized beads are subjected to heating processes to form the rigid, but erodible, porous soft ceramic matrix surrounding the individual diamond abrasive particles that are contained within each of the abrasive beads. The bead heat treatment processes used here to heat and form the rigid porous ceramic abrasive beads are the same type of bead heating processes that are well known and been in use for years in the industry to form the typical non-equal sized diamond abrasive beads in present use for making diamond lapping film abrasive sheet products.

It is desirable, but not necessary, to have equal sized abrasive beads coated on the raised islands for high speed lapping. Non-equal sized abrasive beads can be used to provide flat and smooth workpiece surfaces with the described lapping system. Conversely, if the platen is slowly rotated, the time to lap a workpiece is increased. If water is not used as a coolant, the abrasive is overheated and also, the workpiece surface is locally overheated. If non-precision thickness abrasive disks are used, not all of the abrasive coated on the disk islands will be utilized and vibrations will be set up in the abrading process. If non-precision flatness rotating platens are used, not all of the abrasive coated on the disk islands will be utilized and vibrations will be set up in the abrading process. If non-rotating platens are used, such as reciprocating machine mechanisms, the start-stop, acceleration-deceleration of either the moving workpieces or the moving abrading machine components tend to move them out-of-plane during the abrading operation. These out-of-plane motions are measured relative to the allowable surface dimensional variations that define precise-flat workpieces. The result is that acceptably flat workpieces are not produced. If the localized abrading contact pressure that exists between the abrasive and the workpiece is not accurately controlled over the whole abrading surface of the workpiece, it is not possible to abrade a workpiece surface that is both precisely flat and smooth. If abrasive agglomerate beads are not equal sized then some beads are not utilized in an abrading process and are wasted if the abrasive disk is discarded because of localized wear-down of only the largest beads. Non-equal sized beads also tend to generate non-even wear of a workpiece surface. All of the factors described here, and more, must be controlled to provide a high-speed flat lapping system. If an abrasive disk has raised islands do not have flat abrasive-coated surfaces that are equidistant in height from the back mounting side of an abrasive disk, or if the abrasive particles are not positioned at equal heights on the islands, these abrasive disks can typically be used to produce a flat workpiece; however, this same workpiece tends not to be smooth over the full surface of the workpiece. Likewise, a typical abrasive grinder can make a workpiece flat, but this same grinder can not also make the workpiece smooth in the same abrading operation.

The process of abrasively flat-lapping the flat surfaces of workpieces with fixed abrasive sheet articles requires both uniform thickness abrasive sheeting articles and flat abrasive article mounting surfaces, even at low abrading surface speeds. If an abrasive sheet is mounted on a moving platen or other abrasive mounting surface, the platen or mounting surface must be maintained in a flat plane while in motion to provide a flat abrading surface to a workpiece. An abrasive platen that wobbles as it rotates, or a linear motion platen surface that deviates from a plane as it translates will not provide a flat abrading surface to a workpiece. Likewise, when a workpiece is moved against a stationary abrasive surface where the workpiece wobbles as it rotates, or the workpiece surface deviates from a plane as the workpiece translates with a linear motion will not provide a flat workpiece surface to a flat abrasive surface. To obtain an abrasively flattened workpiece surface, where all of the thin layer of abrasive that is coated on a fixed abrasive sheet article is fully utilized, it is necessary that the abrasive article have a uniform thickness and that the article is mounted on a platen surface that is flat when it is stationary and also remains flat when it is in motion. In the case where a rotary platen is used with a circular abrasive disk the abrasive disk should have an annular band of abrasive to avoid having very slow moving abrasive material at the center of a disk in abrading contact with a workpiece surface. The disk-center slow moving abrasive will not remove much material from the workpiece and this abrasive material will not become equally worn down level with the abrasive located at the outer periphery of the disk. An abrasive disk having an abrasive coating that is worn unevenly from the inner radius to the outer radius can prevent the flat-abrasion of a workpiece surface.

The technique of producing equal sized spherical beads from a liquid material using a mesh screen can be used to produce beads of many different materials that can be used in many different applications in addition to abrasive beads. Equal sized beads can be solid or hollow or have a configuration where one spherical shaped material is coated with another material. Bead materials include ceramics, organics, inorganics, polymers, metals, pharmaceuticals, artificial bone material, humane implant material and materials where the materials are encapsulated and coated, or covered, with another material in the same mesh screen bead forming process. It is only necessary to form a material into a liquid state, apply it to a mesh screen and eject it from the screen cells into an environment that will solidify the surface tension formed spherical beads. A material can be made into a liquid state by mixing it or dissolving it in water or other solvents or by melting it and using a screen that has a higher melting temperature than the melted material. For example, molten copper metal can be processed with a stainless steel screen and molten polymers can be processed with a bronze screen. Equal sized beads can have many sizes and can be used for many applications including but not limited to: abrasive particles; reflective coatings; filler bead materials; hollow beads; encapsulating beads; medical implants; artificial skin or cultured skin coatings; drug or pharmaceutical carrier devices; and protective coatings.

High speed grinding or lapping is used to remove material from hard workpieces quickly as diamond superabrasive particles cut very rapidly and efficiently at high abrading surface speeds. There are a number of different methods that can be used to abrade workpieces at high surface abrading speeds with a moving abrasive surface including: the use of an abrasive disk mounted on a rotary platen; a moving abrasive belt; and an abrasive sheet mounted on an oscillatory table. Methods of moving a workpiece by rotation or translation at high surface speeds in contact with stationary abrasive surfaces are more complicated than the use of moving abrasives. Use of an abrasive particle slurry mixture at high abrading speeds is difficult because of the shearing action that takes place within the slurry mixture.

The most practical method to provide grinding or lapping at high surface speeds of 10,000 surface feet per minute, SFPM, (3,050 surface meters per minute) is with the use of a rotary platen. A rotary platen used for high-speed flat lapping is fundamentally a variable speed abrasive disk supporting device that is slowly brought up to speed at the start of a lapping process and reduced in speed at the end of a lapping process. It should be capable of high rotational speeds of 3,000 or more revolution per minute (RPM) without vibration. It typically needs a platen diameter of 12 inches (30.5 cm) or more, which provides high surface speeds of 10,000 SFPM (3,050 surface meters per minute) or more at the outer periphery of the platen. Platens can be manufactured with sufficient precision to provide a uniform flat mounting surface for a circular shaped abrasive sheet disk and to also provide a disk-mounting surface that remains "true" and precisely flat across the full disk area as the platen is rotated. To provide a precisely flat mounting surface for abrasive sheets, as the platen is rotated at low speeds and also at high speeds, it is preferred that the platens have a planar surface. This platen surface must be held precisely perpendicular to the platen axis of rotation as the platen rotates. The platen axis of rotation must be fixed and stable during all times that the platen is rotated. It is most critical that the platen surface be flat in a tangential direction as the platen shaft is rotated. Next, the platen surface must be precisely linear in a radial direction but it is preferred that the platen abrasive mounting surface is planar rather than tapered radially. If a platen has a surface that is slightly tapered in a radial direction, the flexible abrasive sheet will conform to this slight angle that exists only in a radial direction. In this case, a rotating workpiece that is mounted in a rotating spherical workpiece holder will contact the platen radial-angled abrasive and still be abraded to produce a flat workpieces surface. However, if the workpiece is mounted to a rotating rigid workpiece holder and is abraded by the radial angled abrasive, the workpiece will not be abraded flat. Because the platen is continuously rotated in only one direction, the mass inertia of the platen does not impede the operation of the platen, and the attached abrasive disk, during the high speed abrading process.

Platens used for high speed abrading with thin polymer backing sheet lapping disks can have a vacuum disk mounting system that is used to quickly attach an abrasive disk to the flat surface of the platen. Adhesive bonding disk attachment systems or hook-and-loop disk-attachment systems are not practical to use for high speed flat lapping because they can not provide both the precision disk thickness control and the ease of repeated-use mounting of specific individual abrasive disks. Vacuum is provided to the outer flat surface of the platen, which results in atmospheric air pressure acting to force the abrasive sheet disk tightly against the flat disk-mounting surface of the platen. The vacuum system provides a very large clamping force to the abrasive disk because the atmospheric pressure acts against the large surface area of the disk. A 12 inch diameter circular disk having a total surface area of 422 square inches that is acted upon by 14 lbs per square inches of vacuum induced pressure will have a total disk clamping force of 6,333 lbs that is evenly applied over the flat surface of the disk. This large vacuum induced clamping force does not distort the abrasive disk as the force is applied over the whole disk area and the force acts through the thickness of the abrasive disk, which is very stiff in this direction. A large clamping force offers an important advantage in that it does tend to prevent the possibility of lifting up a portion of an abrasive disk from a platen surface during abrading action and to prevent tearing of a disk that is constructed from a thin backing material. Abrasive disks that are used for lapping are most often constructed with the use of thin polymer backings. An abrasive disk that is constructed from a thin polymer backing sheet is very flexible and conforms readily to a flat platen surface but is weak and tends to buckle in a disk-plane direction. This requires that the disk be attached to and supported by a strong and rigid surface such as a platen surface when the disk is used in high speed lapping. If a thin and somewhat fragile abrasive disk having a 0.004 inch (51 micrometer) thick polymer backing is attached by vacuum to a platen, the disk will remain attached flat to the platen surface and will not experience damage even when the disk is operated at 10,000 SFPM in forced contact with a flat workpiece surface.

The vacuum disk attachment system allows an abrasive disk to be used repetitively. A disk can be used to abrade a workpiece after which it is quickly removed from the platen by releasing the vacuum. Then another disk having smaller abrasive particles is quickly attached to the platen and abrading of the same workpiece continued. The platen surface can be coated with a mist of water, which aids in sealing the disk-to-platen surface to prevent vacuum-air leakage and to assure the presence of the vacuum induced disk-clamping force. The process of abrading a workpiece with a succession of finer abrasive grits is easily accomplished with a platen vacuum disk mounting system. When a new workpiece is abraded, the same original abrasive disks having different grit sizes can be used again in the same succession to complete the abrading of the new workpiece. A workpiece is first contacted by coarse abrasive grits and is finished with very fine abrasive grits.

Vacuum abrasive disk mounting systems can be used with rotary or linear translating platens or with stationary platens. Platen surfaces can have many different shapes including circular and rectangular shapes. Abrasive sheet-type disks can have polymer or metal backings and the backings can be thick or thin. A thick backing mounting surface has to be flat to obtain a vacuum seal between the backing and the platen. A thin backing is flexible which allows it to conform to the surface of the platen. It is very important that the surface of the abrasive disk be smooth to effect the vacuum seal. A rough surface on the mounting side of a backing can allow air leakage between the backing and the platen, which can reduce the vacuum disk clamping force.

Abrasive Beads

Abrasive particles can have many different forms and shapes and can be formed of a single abrasive material or can be a mixture of an abrasive material that is combined with other materials in abrasive agglomerate particles. For example naturally occurring diamond particles having a blocky shape can be used as abrasive particles. Also, man-made diamond particles can have a blocky shape or they can be chemically formulated to have crystalline characteristics that promote the formation of sharp diamond slivers when the original particles are worn down. In another example, cubic boron nitride (CBN) can be chemically formulated to have different fracture characteristics so that specific CBN formulations can be used with workpieces of different hardness. The CBN wear-breakdown characteristics are controlled in CBN material formulations where the CBN particles will break down and produce new sharp cutting edges when abrading these different workpiece materials. CBN formulations can be matched to workpiece hardness where a more fragile CBN particle is used with softer workpieces and more robust CBN particles are used with very hard workpiece materials. There are a wide variety of aluminum oxide abrasive particles that are produced to have abrading characteristics that are matched with different workpiece materials.

In addition, there are many techniques that are used to produce abrasive particles of different sizes. Generally, grinding or polishing of a workpiece is done by using a progression of different abrasive particle sizes where workpiece material removal scratches that are produced by an abrasive particle is approximately proportional to the size of the abrasive particle. Large or coarse abrasive particles produce deep scratches but these deep scratches, which are reduced in scratch size by the subsequent use of progressively smaller sized abrasive particles. Abrasive grinding may start with 200 micrometer particles and progress on to where the workpiece finish polishing may use abrasive particles that are only 0.1 micrometers, or less, in size.

There are a variety of methods that are used to produce abrasive particles that have a desired particle size. Most often abrasive particles are produced with the use of high temperature furnaces that provide very large lumps of abrasive material that are crushed into smaller particles that are sorted by size with the use of a screen device. These crushed abrasive particles tend to have jagged shapes with multiple sharp edges.

Other abrasive particles that have consistent or uniform sizes are the category of structured shapes such as pyramids where the structured particle has a formed shape that encapsulates small abrasive particles in a binder matrix. The binder matrix material is often a polymer material but can also be a ceramic material. Loose structured abrasive particles can be coated on the surface of a backing sheet with the use of a polymer binder. Also, the structured abrasive shapes can also be mold-cast directly on the surface of a backing sheet. The typical backing-sheet cast structured abrasive shape is a pyramid shape. Molded pyramids are small on their top or apex surfaces, which allows a shape-molding apparatus to separate easily from the backing sheet after a structured abrasive slurry mixture is molded on the surface of a backing sheet. Structured abrasive can be formed from materials that can be hardened into an abrasive particle such as aluminum oxide material. However, it is necessary to heat this aluminum oxide material in a furnace to convert the raw aluminum oxide material into a hardened aluminum oxide material that can be used as an abrasive particle. The conversion heat treatment temperatures are far in excess of that which polymer backing materials can withstand so these types of structured aluminum oxide particles are not produced by first being deposited on polymer backings and the backings subjected to the required high temperature furnace environments. Instead, the hardened aluminum oxide materials are formed into structural shapes and these shapes are subjected to the high furnace temperatures, cooled and then the loose individual structural abrasive particles are adhesively bonded to a backing sheet with the use of a polymer binder adhesive.

Another shape of abrasive particles in common use is that of a spherical bead agglomerate where abrasive particles such as diamond particles are encapsulated in a matrix of a soft ceramic material. Other abrasive material particles comprising CBN, aluminum oxide and the many other abrasive materials that are in common use in the abrasive industry can also be encapsulated in spherical bead shapes. It is preferred that these abrasive beads have an erodible soft ceramic matrix but these spherical beads can also have other erodible polymer matrix materials comprising epoxy and other polymer materials. The spherical agglomerate bead shape is a convenient way to package many very small diamond abrasive particles into a larger agglomerate particle that is big enough to coat on a backing sheet where the abrasive sheet article can provide substantial abrading action before all the small abrasive particles are exhausted. With the use of the spherical abrasive beads, an abrasive article can have enough very small particles to successfully polish a very hard workpiece material. The soft ceramic abrasive particle support matrix material is strong enough to hold the abrasive particles in place while they are cutting a workpiece. However, the ceramic is also soft enough that it will erode away as the abrasive particles become dull from the cutting action. Dulled abrasive particles are released from the bead when the ceramic erodes and new sharp abrasive particles are exposed within the bead to continue the workpiece cutting action.

There are a number of different processes that can be used to produce these spherical abrasive beads that have a soft ceramic matrix material. The ceramic matrix that encapsulates the diamond particles can be formed by first mixing a solution (sol) of extremely small silica particles that are suspended in water with small abrasive particles such as diamond particles to form a liquid mixture. In one process, a stream of the liquid mixture is stirred into a dehydrating liquid and the stirring action breaks up the stream into different sized independent lumps. The liquid lumps, which are suspended in the dehydrating liquid, are acted upon by surface tension forces, which convert the lumps into spherical lumps. Dehydration causes partial solidification of the spherical lumps which coverts the lumps into "green" abrasive mixture beads. The green beads, which do not stick to one another are collected and subjected to elevated temperature heat treatment processes to further dry the beads and to rigidize the beads. In another process, the mixture is propelled from the periphery of a rotary wheel in liquid filament-streams that travel into a dehydrating hot air environment where the streams break up into independent different sized liquid mixture lumps. The liquid lumps, which travel independently in a free-fall trajectory in the dehydrating hot air, are acted upon by surface tension forces, which convert the lumps into spherical lumps. Dehydration causes partial solidification of the spherical lumps which coverts the lumps into "green" abrasive mixture beads. The green beads are collected and subjected to elevated temperature heat treatment processes to further dry the beads and to rigidize the beads.

A method is described in this present invention where an open mesh screen is used to form equal sized liquid abrasive slurry mixture lumps within the open cells of the screen. The slurry lumps are then ejected from the screen into a liquid or hot air dehydrating fluid. Surface tension forces then act upon these ejected liquid slurry lumps to form equal sized spherical shaped beads of liquid abrasive slurry. Then dehydrating liquids solidify the beads that are further dried and fired in a furnace to form abrasive beads containing abrasive particles surrounded by a porous ceramic matrix material.

The mesh screen has rectangular shaped openings that all have the same precise size. As the screen has a uniform woven wire thickness and equal sized rectangular shaped openings, the volume of liquid slurry fluid that is contained within each level-filled screen cell opening is the same for all the screen cells. The cell volume is approximately equal to the cross sectional area of the rectangular cell opening times the thickness of the screen material. These precision cell sized mesh screens are typically used to precisely sort out particle materials by particle size. Each mesh screen cell opening has a precise cross sectional area and a screen thickness where the combination of the area and the thickness forms a cell volume. Each cell volume in each cell is equal sized. The equivalent "walls" of a mesh screen cell are not flat planar wall surfaces. Instead the screen cell "walls" are irregular in shape when viewed along the thin edge of the screen. This is due to the fact that the cell "walls" are formed from interwoven strands of wire that are individually bent into curved paths as they intersect other perpendicular strands of wire. Even though the "walls" each of the wire mesh screen cells are not flat-surfaced walls, the volumes of the liquid slurry that is contained in each of the individual cells are equal. If a more perfect cell shape is desired, a cell sheet can be formed from a perforated cell sheet or an electroplated cell sheet where each of the cell openings has planar or flat-surfaced walls.

Use of a sol or solution of water based suspended silica particles with small diamond abrasive particles provides a method of forming a porous structural ceramic matrix that is supports the abrasive particles in a spherical shaped abrasive agglomerate. Porosity of the silica ceramic support matrix provides a system where a low viscosity polymer adhesive binder can partially penetrate the surface porosity of the ceramic abrasive bead shell which increases the adhesive bond strength between the adhesive binder and the porous abrasive bead as compared to a non-porous abrasive bead. The penetration of the adhesive binder into the bead surface provides a strong structural bond that resists the application of dynamic abrading forces that tend to dislodge the abrasive beads from the surface of a backing sheet.

The porosity of the silica is achieved in part because of the characteristics of the silica sol where many extremely small silica particles are suspended in a water solution. The silica particles each have a particle charge that repels adjacent particles from each other so the space between adjacent silica particles is filled with water. When the silica/water sol is mixed with small diamond abrasive particles to form an abrasive slurry mixture, a portion of the mixture is water. The lumps of liquid abrasive slurry are formed into spheres while in the dehydrating fluid. During dehydration, where a spherical lump of the abrasive mixture is dried, water is expelled from the spherical lump and the lump tends to shrink to compensate for the water that is lost. The rate of dehydration of the abrasive spherical beads affects the ultimate size and the porosity of the sphere bodies. As is well known in the formation of gelled silica sols, the loss of water at the outer surface of the individual slurry mixture spheres forms connections between strings of adjacent silica particles as the water separating these particles is removed. The rate of the water removal from these slurry spheres and the size of the spheres is affected by a number of process variables comprising: the type of dehydrating fluid used, the temperature of the dehydrating fluid, the speed that the sphere travels in the dehydrating fluid environment and the time that the spheres are exposed to the dehydrating fluid.

The silica particles are only a very small fraction of the size of the diamond abrasive particles. After full dehydration, there is point-to-point contact between individual silica particles and between the silica particles and the diamond particles but there are void spaces between the silica particles and between the silica and diamond particles. The void spaces between particles within the abrasive beads are the source of the porosity of the abrasive bead. The porosity of the abrasive beads, after sintering them in a high temperature furnace, is a source of the erodibility of the abrasive beads during abrading action. For reference, if a silica water sol is allowed to air-dry over a long period of time, there will be substantial shrinkage of the bead and the bead will have little, if any, porosity. A fully solidified abrasive bead will not have the desired erodible action.

The beads that comprise the silica and diamond particles are subjected to furnace temperatures of approximately 500 degrees C., which increases the particle-to-particle structural bond between particles. This 500 degree C. temperature is sufficient to convert the silica particles into a strong but porous ceramic matrix but this temperature is lower than the degradation temperature of the diamond particles. This porous silica ceramic provides a diamond particle bonding strength that is considered to be greater for a spherical abrasive agglomerate bead than for comparable abrasive beads that are constructed using polymer binders to bind abrasive particles in place of the porous ceramic material. However, this silica ceramic is fragile enough that the porous silica will erode away during abrading action which allows worn or dull-edged diamond particles to be expelled during abrading action and new sharp-edged diamond particles to be exposed from within the abrasive bead. This optimization between erodibilty and bonding strength of silica porous ceramic matrix is particularly important when the diamond particles are small in size such as, for diamond particles that are 3 micrometer or less in size.

Because the production process and materials are more expensive than for the production of aluminum oxide abrasive materials, the abrasive bead production is generally limited to use with expensive abrasive materials such as diamond.

The preferred abrasive agglomerate particles used to provide a precision-flatness surface and a smooth surface on hard workpiece materials have historically been diamond particle filled porous ceramic spherical shaped beads. These diamond beads are typically coated on flexible backing sheets and are referred to as fixed abrasive lapping media.

Lapping is also done with the use of a slurry mixture of abrasive particles that are mixed with a liquid but there are many problems associated with the use of the abrasive slurries. Slurry lapping is very slow as compared with using fixed abrasive media at high abrading surface speeds. Also, the slurry lapping process is quite messy and requires special procedures for handling and disposing of the spent slurry mixture.

Different fixed abrasive sheets have specific sizes of diamond particles encapsulated within the ceramic bead structures to allow a progression of workpiece polishing steps. A workpiece is first rough abraded with coarse abrasive particles, followed by polishing with medium sized particles and then the workpiece is smoothly finished with fine sized abrasive particles. Changing the abrasive fixed abrasive media sheets from coarse to medium and to smooth is fast and easy with a vacuum hold-down sheet platen. The abrasive agglomerate beads that are coated on a backing sheet can have a range of diameters but generally it is desired that all the abrasive beads have the same diameter so that they all wear down evenly in the abrading process. An abrasive bead is typically 45 micrometers in diameter even though the individual abrasive particles that are enclosed within the bead can be very fine or of medium size or relatively coarse in size. Beads that are coated on a specific fixed abrasive article either encapsulate fine abrasive particles or medium abrasive particles or coarse abrasive particles. It is not preferred that fine, medium and coarse abrasive particles are encapsulated within the confines of a single bead structure even though it is possible to do.

The process of polishing a workpiece surface by use of abrasive particles is a process of providing scratches on a workpiece surface where the scratches progressively diminish in depth and width. When the workpiece surface has a finish that has a satisfactory smoothness, depending on the workpiece application requirements, the polishing is complete. An abrasive particle typically produces a scratch that has a depth that is proportional to the size of the abrasive particle. A large abrasive particle produces a deep scratch and removes a large quantity of workpiece surface material, which aids in the process of making the workpiece surface flat. A medium sized abrasive particle removes less material but it produces scratches that are not so deep. A fine sized abrasive particle removes little material but produces fine sized scratches that create a smooth workpiece surface. The size of the individual abrasive particles contained within a bead can have a wide range of sizes that range from a small fraction of a micrometer to many micrometers. It is desired that the maximum size of individual abrasive particles that are encapsulated within an abrasive agglomerate bead is less that one half the diameter of the bead. As a preferred diameter of abrasive beads that are used in lapping is approximately 45 micrometers this means that abrasive particles of up to 22 micrometers could be encapsulated within the bead envelope. For abrasive particles that are larger than 22 micrometers beads larger than 45 micrometers can be produced and coated on fixed abrasive media. Abrasive backing sheets are typically thin and flexible and those used for fixed abrasive lapping articles are commonly made of polymer materials. Metal backing materials that are thin and flexible can be also be used for lapping or other abrading processes. The fixed abrasive articles can have circular disk shapes, rectangular sheet shapes. The beaded abrasive articles also can be manufactured into thin stranded tapes or continuous belts.

Abrading action may be provided by moving an abrasive article relative to a workpiece or by moving the workpiece relative to the abrasive article. Water is often employed to cool the workpiece during abrading action, especially when high surface abrading speeds are employed as frictional heat generated by the abrasion process can damage either the workpiece or the abrasive, or both. When an abrasive surface contacts a localized small-area raised portion of a non-level workpiece surface the abrading contact stress on that small-area region increases due to the concentration of the contact force there. The large contact stress increases the localized abrading contact friction force in this small area and the friction force generates localized friction heating of the workpiece surface as the abrasive moves relative to the workpiece. The amount of friction heat energy that is developed during abrading is proportional to the abrading speed. Abrading a non-level workpiece at high surface speeds to take advantage of the increased cutting rate of diamond abrasive at high speeds can easily cause localized heating of a workpiece surface with thermal stresses induced in the workpiece material due to uneven heating of the workpiece surface. Heating produces higher temperatures and the higher temperature workpiece material expands as a function of this temperature due to the coefficient of expansion of the material. When uneven expansion of a workpiece surface takes place thermal stresses result which can fracture the surface of a hard and brittle workpiece during the abrading action. Water is used to cool the workpiece surface during abrading to prevent workpiece cracks. Coolant water is also used to prevent the abrasion of temporally raised workpiece areas that are raised due to the thermally expanded material being swollen to a higher elevation.

Attaching abrasive beads to the top surfaces of an array of raised island structures that are formed onto a backing sheet allows higher surface speeds, and therefore, higher material removal rates as compared to coating abrasive beads to the flat surface of a backing sheet. The raised abrasive islands also can provide better access of coolant water to the surface of a workpiece surface during the abrading action. It is preferred that the abrasive bead spheres coated on a abrasive article are near-equal in size, that the abrasive article has a uniform thickness and that the abrasive article is attached to a flat mounting surface to assure that all the abrasive beads are in contact with a workpiece. Precise-flat workpiece surface deviations that establish workpiece flatness are measured in a few micrometers across the workpiece surface. The typical diameter of a non-worn abrasive bead is about 45 micrometers. Precision lapping with fixed abrasive articles requires that the rotating or stationary abrasive sheet article mounting platens have precision surfaces and that the abrading action motions are controlled. Care is also taken to maintain even wear across the surface of an abrasive article to assure that one portion of the article does not wear down relative to other portions of the abrasive article. An abrasive media article that does not have a flat surface can generate a non-flat workpiece surface.

Small abrasive bead agglomerates are produced by a variety of manufacturing processes using a dispersion mixture of abrasive particle and a colloidal suspension of metal oxide particles in water. These processes include, but are not limited to: stirring the abrasive dispersion mixture into a dehydrating liquid; spraying the dispersion mixture out of a nozzle into dehydrating hot air; forming ligament streams of dispersion mixture with a high speed rotary wheels where the streams are broken into spheres as they travel in dehydrating heated air; and forming spheres of abrasive dispersion by the use of ultrasonic, or higher frequency, anvils acting on shallow pools of the dispersion. All of the manufacturing methods mentioned simultaneously produce a wide range of sizes of beads rather than produce beads that all have near-equal sizes. The process disclosed in this present invention forms an abrasive particle filled dispersion into pre-formed, equal-sized lumps that are individually ejected into a dehydrating fluid where they form equal-sized spherical shapes that are solidified. The dried and solidified dispersion spheres are then collected and calcined in a heating process to remove all the bound water from the sphere bodies. Further heating sinters the metal oxide materials of the spheres to form abrasive particle agglomerate beads where a porous ceramic material structurally supports the individual abrasive particles that are contained within the envelope of the spherical bead. These equal sized abrasive beads can be formed from a mixture of the same basic hydrosol metal oxide materials and diamond or other abrasive particles and can be processed with the same heat treatments as described in U.S. Pat. No. 3,916,584 (Howard et al.). The temperatures employed in the heat treatment processes are below those temperatures that would thermally damage the diamond abrasive particles that are contained in the agglomerate abrasive beads. The porous ceramic matrix material that surrounds the individual abrasive particles is relatively soft as compared to a hardened aluminum oxide abrasive particle but the matrix material is sufficiently strong to support the individual abrasive particles as they are subjected to dynamic force during abrading action. Howard indicates that for comparison, when diamond abrasive particles are dispersed in a spherical bead having an organic polymer support materials, e.g., epoxy resins, the resultant spherical beads are not as strong as desired. He also describes bead shrinkage of 20% or more during the heating step.

Abrasive Articles With Patterned Beads

Problem: It is desired that an abrasive article is coated with patterns of uniform height abrasive structures where most of the volume of the abrasive particles contained in the structures is elevated from the abrasive article backing surface. When conventional abrasive articles having patterns of pyramid shaped structures are substantially worn down, there is a good likelihood that the article backing sheet will come in contact with the workpiece at those locations where a non-precision-flat platen surface has high area sections. Contact of a workpiece surface with a polymer backing sheet material moving at high speeds is undesirable. The abrasive sheet article typically is discarded at that time with a resultant loss of all the unused abrasive particles that still reside on the discarded sheet article. This undesirable workpiece-to-backing-sheet contact event occurs because such a large percentage of the abrasive particles reside in the lowest elevation of the pyramids and the abrasive article is not discarded until most of the abrasive is expended. If relatively inexpensive aluminum oxide abrasive particles are used, the economic loss is tolerable but if expensive sn diamond or cubic boron nitride abrasive particles are used then discarding the abrasive article is economically unacceptable.

The pyramid shaped abrasive agglomerates also result in another disadvantage. Here, the gap spaces between the tops of the pyramids provide flow channels for coolant water during the initial use of the abrasive article provide superior abrading performance of the abrasive article. However, because such a small percentage of the total volume of abrasive particles contained in a specific abrasive agglomerate pyramid structure is contained in the tip of the pyramid, the pyramid tips are quickly worn away. When the pyramids are substantially worn down, a large percentage of the abrasive particles still remain but the overall surface of the abrasive article assumes a more flat-like surface with very shallow or non-existent water flow channels between the adjacent low height pyramid bases. Because the water channels are substantially diminished, the initial superior abrading performance of the abrasive article is diminished, particularly when hydroplaning occurs in higher speed abrading events.

In addition, casting of abrasive particle filled pyramid structures on a backing sheet requires complex manufacturing processes and expensive process equipment.

Solution: Instead of pyramids, equal sized large-diameter spherical shaped abrasive agglomerate beads that contain the same volumes of abrasive particles as the pyramids can replace the pyramid abrasive structures. However, because these large beads present most of the bulk of the abrasive particles at an elevation that is well above the surface of the backing sheet because the primary volume of the particles is located at the center of the spheres. The sphere centers are raised from the surface of the backing by the sphere radius distance. When the abrasive beads are almost entirely consumed, there still is substantial distance between the remaining abrasive top abrading surfaces and the backing sheet. In this case, contact of the backing with the workpiece is avoided.

Furthermore, even when the abrasive beads are substantially worn down, the worn bead surfaces still retain a significant height above the backing sheet and these elevated beads still provide water channel passageways between adjacent individual beads. These water channels allow even a worn beaded abrasive article to be used at higher abrading speeds than an equivalent worn pyramid type abrasive article.

If desired, the beads can be positioned directly adjacent to each other with no separation gaps between the adjacent beads. The use of equal sized abrasive beads assures that the abrasive surface is level. Equal sized beads can be produced in a wide range of sizes up to 0.125 inches (0.32 cm) or even greater. The abrasive beads can contain a wide variety of abrasive materials providing an abrasive quality, e.g., diamonds (natural, synthetic and polycrystalline), nitrides (e.g., cubic boron nitride), carbides, borides, aluminum oxide, or any abrasives preferably of highest hardness or any combination thereof. The erodible matrix material that binds the particles together in the spherical bead shapes can be a ceramic material or can be a polymer material comprising epoxy or phenolic or other polymers or combinations thereof. These equal sized abrasive beads or even non-abrasive beads can be produced with the use of metal or polymer or other non-metal font sheets that have equal sized open cells as described herein. Liquid bead material volumes that are ejected from the cells can be formed into spherical shapes by surface tension forces. These ejected spherical beads can be solidified by subjecting them to energy sources comprising hot air, microwave energy, electron beam energy and other energy sources while the beads independently travel in space between the cell sheet and a bead collection device. In one embodiment ejected spherical beads can be temporarily suspended in a moving jet stream of hot air. Only the outer surface of the beads has to be solidified to avoid individual beads adhering to other contacting beads when the beads are collected together. Full solidification of the whole beads can take place at a later time in other bead processing events. Beads can also be suspended in heated liquids comprising oils or solvents comprising alcohols to effect solidification prior to collection. Filler or other materials can also be incorporated within the spherical beads.

Production of the abrasive articles having abrasive beads in uniformly spaced patterns is easy to do with simple process procedures and the required process equipment is relatively inexpensive. A simple moving mesh screen belt can be used to locate each spaced bead while the beads are brought into contact with a make coat layer of resin adhesive that is coated on a moving web backing sheet material. Pull rolls can transport the continuous web and the screen belt. A size coat of polymer can be applied after the beads are adhesively attached to the backing. The size coating will tend to collect at the base of the individual beads and provide excellent structural support of the beads to resist abrading contact forces. The woven wire screens can have different diameter wires to control bead spacing and the screens can have different angular orientations to control the deposited bead patterns on the backing. Perforated metal font sheets having controlled sheet thicknesses, bead hole diameters, bead location patterns and bead spacing can also be used to provide these bead belts. If desired the woven wire screens can be easily reduced in thickness with reductions in the size of the screen openings by processing the screen through a calendar-roll system. The screen can be routed past the web backing without the screen contacting the liquid resin coating to avoid contamination the screen with the resin.

In another embodiment, small drops of liquid resin can be deposited on the surface of a backing web in array patterns with spaces between each resin deposition. Each individual resin site area has a diameter size that is from 10 to 90% the projected-area diameter size of the abrasive beads that are to be deposited on the resin sites. Then an excess of loose abrasive spherical beads can be deposited on the resin drop coated backing. When the excess of abrasive beads covers the resin sites, only one bead will be attached to the liquid resin at each deposition site. The backing is now coated with a distributed array pattern of spaced abrasive beads. After partial or full solidification of the resin which bonds the beads to the backing, additional resin can be applied as a size coat or can be applied in multiple size coats. These size coats of resin gather at the base of the spherical beads and provide structural support of the individual abrasive beads to resist abrading contact forces.

Figure 109:
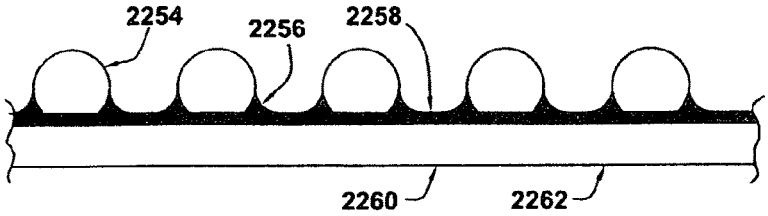
FIG. 109 is a cross-section view of equal sized spherical abrasive beads on a backing sheet.

FIG. 109 is a cross-section view of equal sized spherical abrasive beads coated on a backing sheet. An abrasive article 2262 having attached spherical abrasive beads 2254 that are bonded to a backing sheet 2260 with a make coat polymer resin 2258 and a size coat resin 2256.

Figure 110:
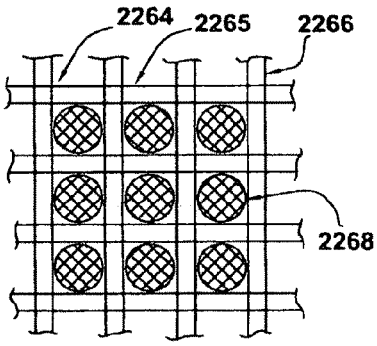
FIG. 110 is a top view of equal sized spherical abrasive beads nested in a woven wire screen segment.

FIG. 110 is a top view of equal sized spherical abrasive beads nested in a woven wire screen segment. A wire screen 2264 having wires 2265 that are oriented at right angles to wire 2266 contain loose abrasive beads 2268. The screen segment 2264 can be part of a font sheet or it can be a part of a continuous belt.

Figure 111:
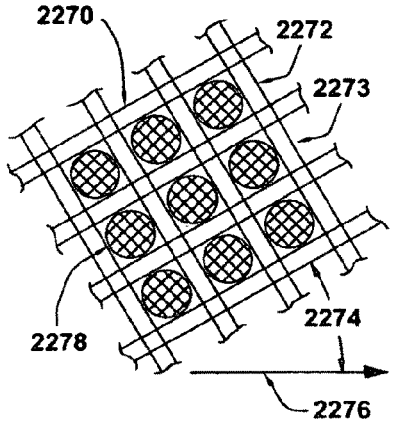
FIG. 111 is a top view of equal sized spherical abrasive beads nested in a woven wire screen segment.

FIG. 111 is a top view of equal sized spherical abrasive beads nested in an angled woven wire screen segment. A wire screen 2272 having wires 2270 that are oriented at right angles to wire 2273 contain loose abrasive beads 2278. The screen 2272 moves in a direction 2276 where the wires 2270 are positioned at an angle 2274 with the direction 2276 to provide a bead-to-bead orientation that does not have between-bead tracks as the beads 2278 are deposited on a backing (not shown) as the backing moves in a direction 2276. The screen segment 2272 can be part of a font sheet or it can be a part of a continuous belt.

Figure 112:
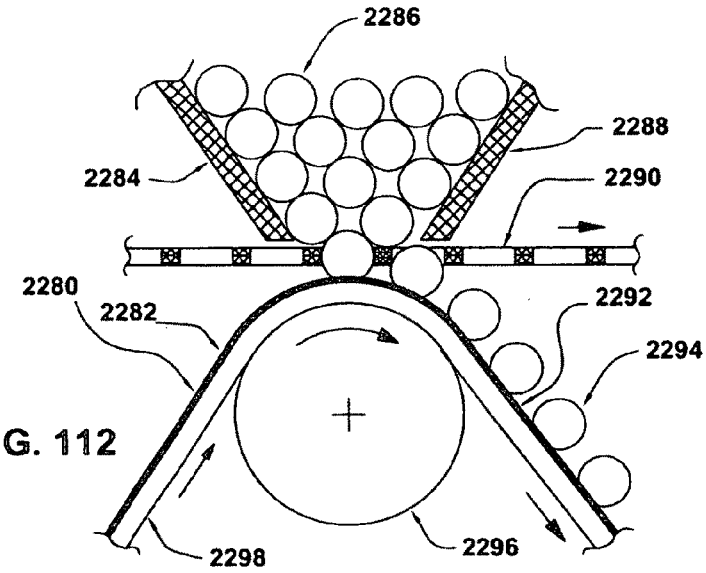
FIG. 112 is a cross-section view of a web bead coating apparatus that uses a screen belt to distribute evenly space abrasive beads on a continuous web backing.

FIG. 112 is a cross-section view of a web bead coating apparatus that uses a screen belt to distribute evenly space abrasive beads on a continuous web backing. A rotating roll 2296 drives an abrasive web article 2280 having a non-solidified polymer resin coating 2282 on a web backing 2298. A open celled woven wire mesh screen 2290 captures spherical abrasive beads 2286 that are individually introduced into each of the screen 2290 mesh holes as the screen belt 2290 moves horizontally at the same surface speed as the web article 2280. These abrasive beads 2286 become attached to the non-solidified polymer resin 2282 to form an abrasive bead coated web 2292. The equal diameter abrasive beads 2286 provide an uniform thickness abrasive coated web 2292. A bead hopper 2288 has hopper sides 2284. There is a gap space between the screen 2290 and the liquid resin 2282 to prevent contact between the screen 2290 and the liquid resin 2282.

Abrasive Bead Wear

Spherical agglomerate beads are shown in FIGS. 78, 79, 80, 81, 82, 83, 84 and 85 to illustrate issues related to agglomerate bead coatings and wear-down including the removal of second level abrasive beads by surface conditioning. These issues and their corrective techniques can also be applied to abrasive articles having individual abrasive particles in addition to composite spherical bead agglomerates. Stray or oversized individual abrasive particles or spherical abrasive beads or non-spherical abrasive agglomerates can be removed or worn-down to the level of the average sized particles by use of an abrasive conditioning plate. The surface conditioning plate can be moving or stationary.

FIG. 78 is a cross-section view of different sizes of spherical stacked abrasive particle agglomerates, or abrasive beads, on a backing sheet. Spherical abrasive particle composite agglomerate beads including large agglomerates 686, medium sized agglomerates 680, medium-small agglomerates 682 and small sized agglomerates 694 are bonded with a polymer resin 688 to a backing sheet 690. Each of the spherical agglomerate beads 682, 686, 680 and 694 have an agglomerate exterior surface 700, shown for agglomerate 686 that encloses small abrasive particles 696 surrounded and fixed in position by an erodible porous ceramic matrix 702. Raised second-level abrasive agglomerates 684, 692 are shown attached with resin 688 to the upper surfaces of agglomerates 682 and 686 respectively, that are bonded directly to the backing surface 690. It is desirable to remove the stacked agglomerate beads 684 and 692 from their elevated second-level positions where they are resin 688 bonded to the bottom-layer agglomerate beads 682 and 686. The stacked agglomerates 692 can be broken off their resin 688 moorings on top of agglomerates 682 and 686, or, the agglomerates 684, 692 can be worn down to expose the top apex surface of agglomerates 682 and 686 agglomerates.

Figure 79:
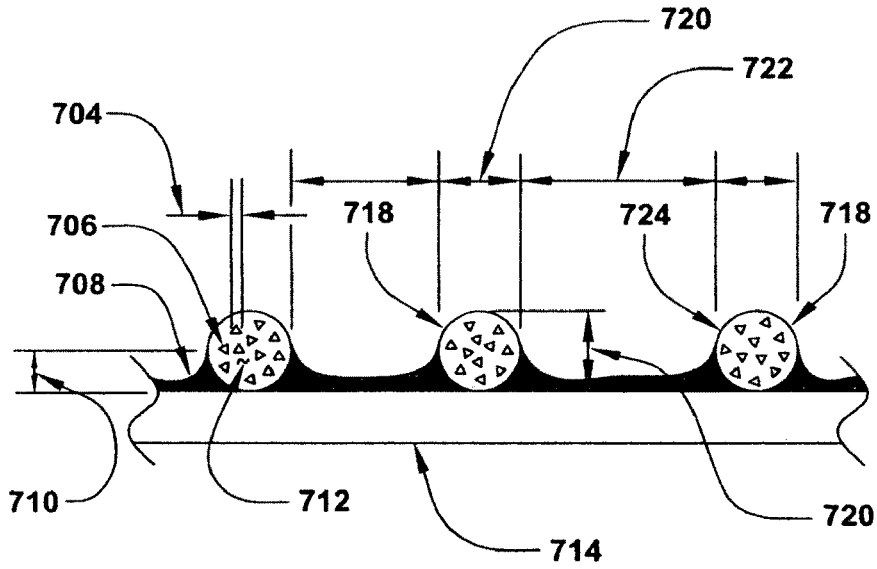
FIG. 79 is a cross-section view of mono or single layer equal-sized spherical composite agglomerate beads having gap spaces between the beads.

FIG. 79 is a cross-section view of mono or single layer equal-sized spherical composite agglomerates having gap spaces between agglomerates that are resin bonded to a backing sheet. Agglomerates 718 having a agglomerate exterior surface 724 enclosing individual abrasive particles 706 held in an erodible porous ceramic matrix 712 are resin 708 bonded to a backing sheet 714 with a defined space 722 between agglomerates 718 having a agglomerate diameter 720. Individual composite agglomerates 718 having approximate 3-micrometer size 704 individual abrasive particles enclosed in the agglomerates 718 that have an approximate 30-micrometer diameter size 720. The agglomerates 718 are sparsely positioned on the backing 714 with a particle space gap size 722 having a range from 60 to 1000 micrometers, or more, and where the gap size 722 distance is measured parallel to the surface of the backing 714 between each adjacent agglomerate 718. Grinding debris and swarf generated by the abrading action on a workpiece (not shown) surface travels in the gap space 722 between the agglomerates 718. The resin 708 is shown as having a resin 708 height or thickness 710 that is approximately 33% of the agglomerate 718 diameter 720 where the resin 708 provides structural support to the agglomerate 718 but does not impede the removal of the debris or grinding swarf (not shown) generated by abrading a workpiece (not shown). When a solvent filled slurry coating, comprising a mixture of spherical abrasive agglomerates 718 or other block shaped abrasive particles and a resin 708 having a solvent component, is coated on a backing sheet 714, the slurry resin height 710 can equal or exceed the agglomerate 718 diameter 720 when the resin coating 708 is first applied to the backing 714. After the solvent is removed by evaporation from the resin 708 by partial or full drying of the slurry resin 708 coated backing 714, the volume of the slurry coating resin 708 is reduced from its original coated volume that fully exposes the upper surface of agglomerates 718. The resin 708 remaining after solvent evaporation tends to form a meniscus-shaped resin 708 structural support of the agglomerates 718. Another technique used to obtain the meniscus-shaped resin 708 support of agglomerates 718 is to level-coat a backing 714 with a resin adhesive 708 and drop or propel or deposit abrasive agglomerates 718 into the thickness depth of the coated resin adhesive 708 thereby forming a meniscus-shape resin 708 support of the agglomerates 718. An additional resin size coat can be applied to increase the structural support of the agglomerates 718.

FIGS. 80, 81, 82 and 83 are cross-section views of full sized abrasive particles composite agglomerates attached to a backing sheet at different stages of wear-down.

Figure 80:
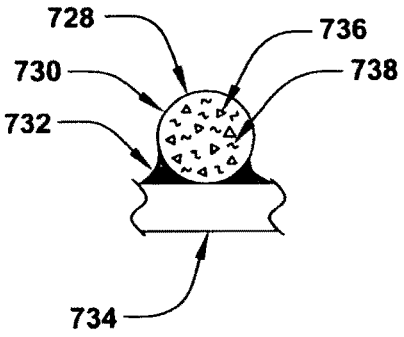
FIG. 80 is a cross-section view of a spherical non-worn agglomerate abrasive bead.

FIG. 80 is a cross-section view of a spherical agglomerate un-ground or non-worn agglomerate abrasive bead 730 having an exterior surface 728 that surrounds a porous ceramic matrix 738 holding individual abrasive particles 736. The abrasive bead 730 is attached to a backing 734 by a polymeric adhesive resin 732.

Figure 81:
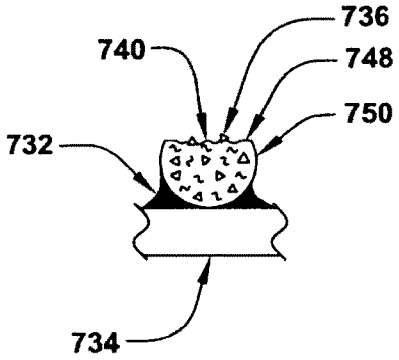
FIG. 81 is a cross-section view of a partially worn-down abrasive bead.

FIG. 81 is a cross-section view of a partially worn-down abrasive bead 748 having an exterior surface 750 that surrounds a porous ceramic matrix 740 holding individual abrasive particles 736. The abrasive bead 748 is attached to a backing 734 by a polymeric adhesive resin 732.

Figure 82:
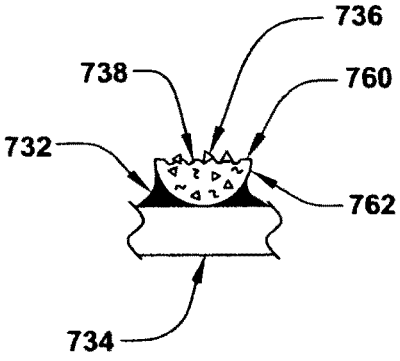
FIG. 82 is a cross-section view of a half worn-down abrasive bead.

FIG. 82 is a cross-section view of a half worn-down abrasive bead 760 having an exterior surface 762 that surrounds a porous ceramic matrix 738 holding individual abrasive particles 736. The abrasive bead 760 is attached to a backing 734 by a polymeric adhesive resin 732.

Figure 83:
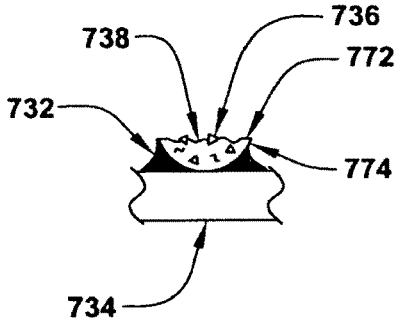
FIG. 83 is a cross-section view of a substantially worn-down abrasive bead

FIG. 83 is a cross-section view of a substantially worn-down abrasive bead 772 having an exterior surface 774 that surrounds a porous ceramic matrix 738 holding individual abrasive particles 736. The abrasive bead 772 is attached to a backing 734 by a polymeric adhesive resin 732. The wear experienced by the agglomerates 730, 748, 760 and 772 occurs progressively from the start of the abrading life of a flexible backing abrasive article to the end of the useful life of the article. The resin 732 must bond the agglomerates, having different wear-down geometric configurations as represented by the agglomerates 730, 748, 760 and 772, to the backing with sufficient strength to resist abrading forces resulting from abrading contact with a workpiece from the initiation of abrading to the final use of the abrasive article.

Figure 84:
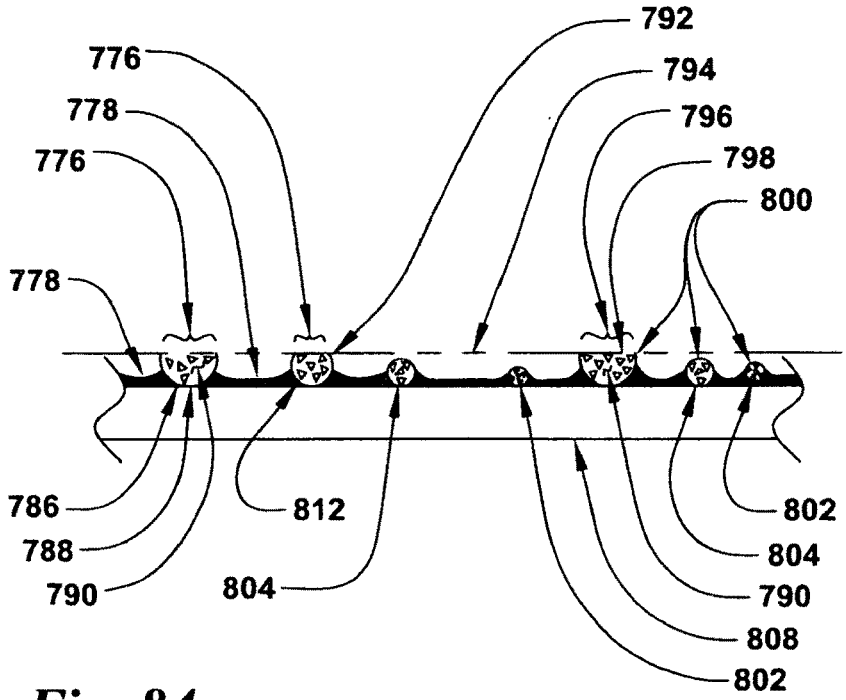
FIG. 84 is a cross-section view of a monolayer of partially worn spherical composite beads having different bead sizes.

FIG. 84 is a cross-section view of a monolayer (a single layer) of partially worn spherical composite abrasive agglomerate beads having different agglomerate bead sizes. Large agglomerates 788, medium agglomerates 812, small agglomerates 804 and very small agglomerates 802 are resin 778 bonded to a backing sheet 808. Agglomerates 786, 798 and 812 are partially worn-down where a portion of the agglomerate exterior surface 792 is removed, thereby exposing an area 776 of individual abrasive particles 800 and an erodible ceramic matrix 790. The wear-down line 794 defines the common elevation location of the partial removal of the upper portions of the agglomerates 786 and 812 caused by the abrading contact with a workpiece (not shown). Agglomerates 802 and 804 lie below the wear-down line 794 indicating they have escaped contact with the workpiece and thus have not been useful in the workpiece abrading process.

Figure 85:
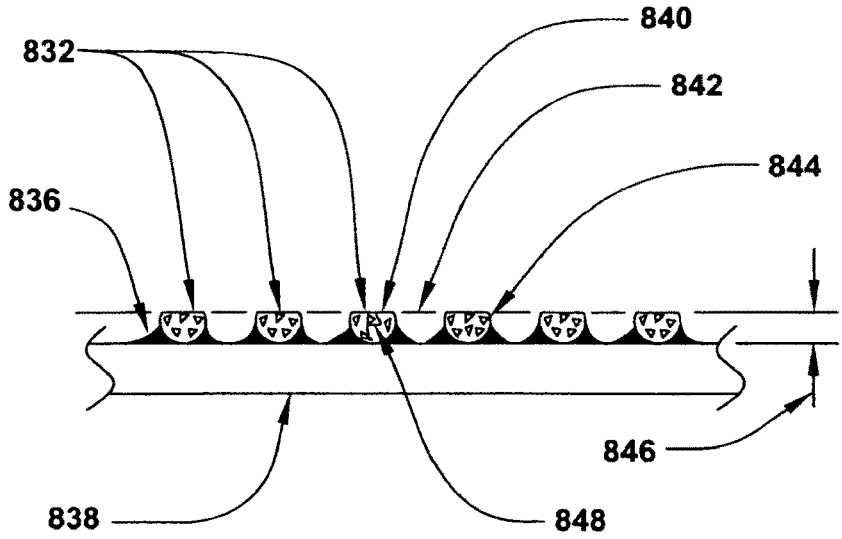
FIG. 85 is a cross-section view of equal sized abrasive agglomerates worn-down to the same level.

FIG. 85 is a cross-section view of equal sized abrasive agglomerates worn-down to the same level. Equal-sized abrasive agglomerates 832 resin 836 bonded to a backing sheet 838 have an outer exterior surface 844 enclosing small abrasive particles 848 held in a porous ceramic matrix 840. All of the equal-sized worn agglomerates 832 having substantially the same size original non-worn diameters are positioned in a single layer or monolayer in direct proximity on the top surface of a backing sheet 838 and are resin 836 bonded to the backing sheet 838. The wear of each abrasive agglomerate 832 contacting a workpiece (not shown) is substantially equal at the position indicated by the wear line 842. The wear line 842 also indicates the equal wear down of agglomerates 832 to a height 846 above the backing 838 as workpiece abrading wear occurs. The top portion of an agglomerate outer exterior surface located at the wear line 842 is shown partially removed to expose new sharp abrasive particles 848 and the porous ceramic matrix 840 as the ceramic matrix 840 is eroded away and ejected from the agglomerate 832 exterior surface 844 enclosure.

Manufacture of Abrasive Beads

Abrasive sheet articles that can be used for lapping workpieces that are made from hard materials are well known. Use of ceramic materials to encapsulate small diamond abrasive particles in agglomerate beads provided a method to use diamond particles that are too small to be coated individually directly on a backing sheet to provide an abrasive sheet article. The ceramic agglomerate abrasive beads are spherical in shape and are easy to coat on a thin polymer backing sheet with the use of a polymer adhesive binder. The ceramic matrix that supports the individual diamond particles within the bead is soft enough to be eroded in a fashion that ejects dulled diamond particles and exposes new sharp diamond particles within the worn-bead as the abrading process continued.

Abrasive Agglomerates

Abrasive agglomerates can have many shapes including spherical and blocky shapes that have rounded edges. Abrasive agglomerate bead shapes can have spherical or non-spherical or near-spherical shapes. Agglomerates can also have sharp edged shapes that can be of a blocky form shape or a crystalline shape that has many irregular edges.

Abrasive agglomerates can have a wide range of abrasive particle materials that are enclosed with a binder material. The binder material can include a range of erodible materials including: polymers, ceramics, organics and inorganics or combinations thereof where the erodible binders wear away during abrading action to release worn or dull edged abrasive particles and to expose new sharp abrasive particles to a workpiece.

Bead shaped agglomerates according to the present invention can comprise different individual abrasive material particles or combinations of different abrasive material particles where each particle material is selected to enhance to the abrading action of specific workpiece materials. These materials, combinations thereof and usage are well known in the abrasive industry. Cerium oxide is recognized in its use for polishing optical glass, fiber optics, glass used for a liquid crystal, glass used for magnetic hard disks and glass used to fabricate electronic circuits. Cerium oxide can be capsulated as an abrasive bead or cerium oxide particles can be mixed with a silicone dioxide water based suspension solution to form an aggregarate abrasive bead. Also, cerium oxide particles can be mixed with a silicone dioxide water based suspension solution and other abrasive particles, including diamond abrasive particles, to form an aggregate abrasive bead that contains both cerium oxide and one or more different material abrasive particles. Other well known abrasive materials that are useful in the present invention are discussed.

Abrasive beads can comprise a variety of abrasive materials including but not limited to: aluminum oxide, silicone carbide, alumina-zirconia, garnet, diamond, cubic boron nitride, cerium oxide, boron carbide, titanium carbide, chromium oxide and mixtures thereof.

Abrasive beads can comprise a variety of diluent particles such as marble, gypsum, flint, silica, iron oxide, aluminum silicate, glass, glass bubbles, and glass beads.

Abrasive beads can comprise a variety of lubricants such as metallic salts of fatty acids (e.g. lithium stearate, zinc stearate, solid lubricants (e.g. polytetrafluoroethylene (PTFE), graphite, and molybdenum disulfide), mineral oils and waxes, carboxylic acid esters (e.g. butyl stearate), poly(dimethylsiloxane) gum, and combinations thereof.

Abrasive beads can comprise a variety of foaming agents or blowing agents such as water, low-boiling liquids (e.g. cyclopentane) and chemicals that decompose to evolve gases and air or other gases can be incorporated or entrained into the bead mixture composition.

Abrasive beads can comprise a variety of grinding aids such as waxes, organic halide compounds, halide salts, and metals and mixtures thereof.

Abrasive beads according to the present invention can comprise a variety of coloration pigments such as titanium dioxide or iron oxide. Special colors can be selected to specifically indicate that that abrasive beads are equal-sized beads as compared to colors presently used in the abrasive industry where a specific color is used to denote the specific size of the abrasive particles that are encapsulated within the individual abrasive beads. Specific colors of the beads can be used to denote the size of the individual abrasive particles that are enclosed within the abrasive beads where and additional color or color hue can be added toe the basic size-color to distinguish the bead equal sized feature. In addition, other types of abrasive article marking options including but not limited to: employing color marks; color bands; color combinations; numbers; colored numbers, letters or figures; letters; alphanumeric characters; symbols; icons; pictures; scenes; holographic figures or combinations thereof can be applied to the surface or edges of the abrasive article or to the backing of the abrasive article to denote the fact that the abrasive article is constructed with use of equal-sized abrasive beads or to denote the size of the abrasive particles contained within the beads or both. Also, other types of abrasive article marking options including but not limited to the use of a single color identifying mark such as a black or red mark: employing; a color mark; single-color bands; numbers; single-colored numbers, letters or figures; letters; alphanumeric characters; symbols; icons; pictures; scenes; holographic figures or combinations thereof can be applied to the surface or edges of the abrasive article or to the backing of the abrasive article to denote the fact that the abrasive article is constructed with use of equal-sized abrasive beads or to denote the size of the abrasive particles contained within the beads or both.

Abrasive beads according to the present invention can be used on: coated abrasive articles such as flexible abrasive disks, abrasive sheets, abrasive belts, abrasive strips, abrasive wheels, abrasive fiber-wheels, abrasive drums, abrasive hand tools, abrasive pads and as a component of liquid abrasive slurries.

Abrasive products using small abrasive particles encapsulated in composite erodible spherical agglomerates or abrasive beads have been sold for a number of years. The 3M Superabrasives and Microfinishing Systems, 3M Abrasive Systems Division Product Guide (copyright) 3M 1994 60-4400-4692-2 (104.3) JR describes diamond particle spherical ceramic bead shaped agglomerates coated on flexible backing. The 3M Imperial™ Diamond Lapping Film, Type B is described as "diamond particles are contained in ceramic beads which makes this product more aggressive than the standard product. Grade for grade a Type B product will yield more cut, longer life, and a coarser finish. Recommended for extremely hard materials and larger parts." Different ceramic bead lapping films comprise: the 3M Product I.D. Number 3M 662X, Imperial Diamond Lapping Film—Type B has a 3 mil. backing; and the 3M 666X, Imperial Diamond Lapping Film—Type B PSA has a PSA (5 mil.) backing. Different Micron Grade particle sizes for various ceramic bead lapping films have individual identifying product color codes comprising: 0.5 micron type B (Off White); 1 micron type B (Lavender); 3 micron type B (Pink); 6 micron type B (Brown); 9 micron type B (Blue); and 30 micron type B (Green). Microscopic examination of the Type B Lapping film abrasive articles reveals a number of product characteristics of the abrasive media.

Examination of these 3M samples reveals much useful information related to this invention. The examined abrasive articles were used to abrade a workpiece on a experimental Keltech Engineering of St. Paul, Minn. designed lapping machine having a raised annular land area on the platen to which the 12 inch (304 mm) diameter disks were mounted with a vacuum attachment system. Each of the subject Imperial Diamond Lapping Film disks had been subjected to 2000 to 3000 rpm rotational abrading wear on an raised precision flatness annular area of the platen extending from 8.375 inch (21.3 cm) inside diameter to 11.0 inch (27.9 cm) outside diameter. Wear of the abrasive disk article was concentrated on the annular band surface of the disk that corresponded in location to the raised annular band surface area of the platen with little or no abrading wear occurring in the central disk area extending out to 8.375 inches (21.3 cm) diameter. Visual and microscopic examination of the 3-micron disk indicated that each spherical abrasive particle agglomerate coated on the 3-micron abrasive article has a pink color that results in a overall pink coloration of the abrasive disk. The 3-micron abrasive particles are contained in spherical beads that range in size from approximately 45 microns to 15 microns. Approximately 30% of the beads were about 45 micron in size, approximately 30% were about 30 micron and approximately 30% were about 15 micron. This size range represents a bead diameter ratio of 3:1 Substantial numbers of 30 micron to 15 micron beads were resin bonded sparsely adjacent to the large 45-micron beads. Each size of the spherical bead agglomerates exhibited the same pink color, indicating the full range of sizes of beads was manufactured by the same bead forming process. Also, there were occasional scattered approximate 10 to 15 micron shiny light-reflective beads having an intense red hue color that were resin bonded to the backing. A significant number of 15-micron abrasive beads were submerged in the solidified resin. The worn annular portions of the abrasive disk article could be compared to the adjacent unworn disk portions that were located at the inner radius portion of the same disk. The larger diameter beads were approximately half worn away but the adjacent smaller diameter beads were untouched. There were large gap openings between adjacent abrasive beads of all sizes and some beads were positioned in adjacent contact with other beads. The gap openings between individual large beads were substantially greater than the average gap between smaller beads. Full-sized beads made up less than 20% of the total quantity of beads. Some of the large full-sized beads were oblong or had a joined double-bead configuration where the internal erodible matrix was common to both of the original spherical bead shapes. The large beads were approximately half worn away that revealed the basic structure of the individual beads. Individual diamond abrasive particles imbedded in a (presumably porous ceramic) matrix were exposed within the confines of the open semi-hemispherical shaped worn abrasive beads. Individual abrasive beads exhibited a light-reflective glassy exterior surface. Most of the worn large beads had a distinct thin white-appearing exterior shell that surrounded the opaque interior in which individual abrasive particles were imbedded. The thin white exterior shell thickness was less than 5% of the diameter of the overall bead body. The exterior thin shell was worn down evenly with the worn body of the interior portion of the bead.

Abrasive Agglomerate Beads

Problem: It is desired to provide effective and consistent abrading characteristics in an abrasive article with the use of equal sized abrasive agglomerate beads.

Solution: Thin metal font sheets can be fabricated to provide a precise thickness with precision sized cavity openings that together form precision sized cavity volumes that are equal in volume size. One embodiment is an electrodeposited sheet that has very precise sized cavity through-holes that are positioned on the sheet with precision locations. These electrodeposited mold cavity sheets are similar to perforated metal sheets and have a variety of uses in the manufacture of equal sized abrasive spherical shaped agglomerates. The electrodeposited sheets that can be used in these applications can be obtained from the Thin Metal Parts Company, located at Colorado Springs, Colo. Stainless metal can be electrodeposited with a 0.002 inch (51 micrometer) thickness to form 0.0025 inch (64 micrometer) diameter holes with a 0.002 inch (51 micrometer) space between holes in any array pattern with 0.0001 inch (2.5 micrometer) accuracy.

Different patterns of these electrodeposited mold cavity sheets can be fabricated for use as a cavity array font sheet to form precision equal sized abrasive beads from a solution mixture of abrasive particles and a metal oxide sol. Sols include Ludox®, a colloidal silica sol that is a suspension of minute particles of silica in water, a product of W.R. Grace & Co., Columbia, Md. These oxide sols can be used with 1 micrometer, or other sized, diamond particles to form a dispersion mixture solution. After the electrodeposited font sheet precision hole cavities are level-filled with the abrasive particle sol mixture, the contents of each cavity is ejected with fluid pressure or a fluid jet and the ejected cavity lumps are formed into spheres by surface tension forces acting on the liquid lumps as they are free falling or are suspended in a dehydrating atmosphere. The abrasive spheres become solidified in this free-fall or suspension event and are collected for further heating to remove bound water and to fuse the oxide material that surrounds the abrasive particles into a porous ceramic to form the equal sized abrasive beads. For circular shaped cavity holes, each of the independent hole cavities in the array of cavities in the electrodeposited metal cavity sheets are consistently of circular form, are very consistently precise in diameter size and the sheet has a precise thickness. The volume of the abrasive dispersion mixture entities that are contained in each cavity, when the cavities are level filled with the mixture to the top and bottom flat surfaces of the font sheet, is therefore also consistently equal from cavity to cavity. These equal sized volumes can then be ejected from the cavity font sheet and formed into spheres and then solidified and fired to produce equal sized abrasive agglomerate particles (abrasive agglomerate beads), which are spherical in shape. These spherical abrasive beads are easy to handle in bulk form as they pour easily. Individual beads are easy to separate and do not tend to join-up or bond with each other to form large sized agglomerates made up of a number of individual beads. The beads provide special advantages in providing uniform coated abrasive articles because of these special bulk handling characteristics. Also, the spherical round surface shapes of the beads allow them to be positioned independently in circular receptor holes in a bead-placement font sheet that allows each independent bead to be located with a prescribed gap distance between adjacent beads they are coated on an abrasive article.

The metal oxide based abrasive mixtures shrink when water is removed in the dehydration process of solidifying the beads so the volumes of the cavities is oversized to compensate for this shrinkage. Larger sized cavities produce larger sized beads, which allows a wide range of beads to be produced by this technique simply by changing the screen cavity sizes.

The description here of this bead producing technique is based on the formation of abrasive particle filled metal oxide materials. However, this same bead forming technique can be used to produce equal sized beads of many different material compositions. Either solid, porous or hollow ceramic equal sized beads can be made simply by selecting the component materials that are mixed into a liquid mixture solution. The liquid mixture is introduced into the font sheet cavities and the individual cavities that are level filled. Then the mixture entities are ejected from the cavities after which, the ejected mixture entities are formed into spherical shapes that are then solidified. These same bead mixture component materials are well known for use with other bead forming techniques that are used to form a variety of beads that are comprised of different abrasive and non-abrasive materials. Bead forming techniques include the use of pressurized nozzle spray dryers and rotary wheel spray dryers that atomize the material into beads.

The font cavity sheets can be also used to form equal sized beads of materials the are heated into a liquid state and the liquid introduced into cold, warm or heated cavity font sheets after which the liquid material is ejected from the cavities into an atmosphere that cools off the surface tension formed spherical particles into partial or wholly solidified beads. These melt-formed beads can also be solid, porous or hollow, again depending on the bead material selection. Furthermore, other non-heated bead materials can be selected that allow a liquid material to be introduced into the font sheet cavities and after ejection of the liquid material lumps from the cavities, the ejected entity lumps can be formed into spheres by surface tension forces. Then the formed bead sphere material can be partially or wholly solidified by either a chemical reaction of the bead component materials or by subjecting the beads to energy sources including convective or radiant heat, ultraviolet or electron beam energy or combinations thereof. The beads formed here can be porous, solid or hollow, depending on the selection of the bead materials.

Beads my contain a variety of materials where some of the bead materials are used to form the beads structure while other of the bead materials are present to perform another function or combination of functions. Porous beads may be used as a carrier device for other materials where an open porous lattice structure of the porous carrier material can allow fluids, including gases and liquids, to penetrate or diffuse into the porous bead structure and contact the other materials that are distributed throughout the bead structure. Examples of the use of porous beads containing other materials include, but are not limited to, the use of catalysts, medicines or pharmacology agents.

Woven wire mesh screens can also be used to gap position abrasive beads on the flat surface of a planar backing sheet or on the top surfaces of raised island structures that are attached to a flexible backing sheet. Individual abrasive beads can be placed in the open cells of a wire mesh screen where the woven wires that form the mesh hole openings act as barriers that separate adjacent beads. Here, a wire mesh is placed in flat contact with a wet resin coated backing sheet, an excess of beads is spread over the surface of the wire mesh and all the beads other than those positioned in the mesh opens are removed. The beads will contact and become fixture to the resin after which, the mesh screen is separated from the backing sheet to leave a monolayer of abrasive beads attached to the backing with a precisely controlled gap between each individual bead. The gap spaces between the beads would be typically greater than the diameter of the bead when a screen mesh has openings that are slightly greater than the diameter of the beads. Mesh screens suitable for use with 45 micrometer beads can be obtained from TWP, Inc in Berkley, Calif. where the screens are constructed from stainless or bronze woven wire. If desired, the screen material can be flattened by a hammering process where the thickness of the screen is reduced by 30 to 40% while the rectangular screen cell openings retain their original shape. The open cells are reduced in cross sectional size and the thickness of the woven wires increase laterally along the screen surface, which has the desirable effects of providing more gap space between individual beads. Also, the walls that form each rectangular cell opening become more solid with less space between the individual wires that are woven together to form the open cells. The mesh screen can be coated with release agents that are well known to prevent the adhesion of resin or other materials to the screen body. A filler material may be applied to certain areas of the screen to block some of the open screen cells but yet leave patterns of open cells in the screen sheet. Here, island areas of a screen may be left open but all the screen areas that surround the island areas may be filled level with the screen surfaces with materials that include but are not limited to epoxy or other polymers. This screen can then be aligned and placed in contact with a sheet having attached wet resin coated island structures and abrasive beads introduced into the open screen cell openings where they contact and are bonded to the resin. When the screen is separated from the islands, the islands have a monolayer of abrasive beads that have gap spaces between each individual bead and there can be a gap between beads and the outer top surface perimeter of the raised island structures.

In addition, woven wire mesh screens can also be used to manufacture equal sized spherical abrasive beads from an abrasive water based solution of suspended metal or silicone oxides mixed with abrasive particles using the same techniques described for the electrodeposited electrodeposited metal hole font sheets. Hammering the mesh screens to a reduced thickness provides screen cell walls that have more flat-surfaced cell defining walls than does a non-flattened screen. Screen open cells that have equal cell opening contained volumes are helpful in forming equal sized volumes of liquid abrasive mixtures that are ejected from the screen cells and then converted into spherical ceramic abrasive beads. Hammered screens can produce improved definition of the cell wall structures.

Figure 56:
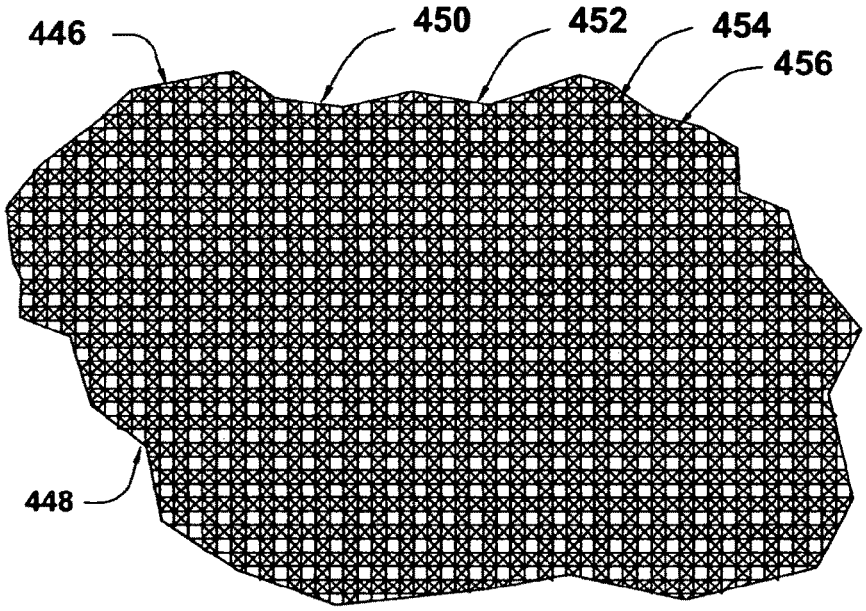
FIG. 56 is a top view of a mesh screen bead font sheet used to manufacture spherical beads.

FIG. 56 is a top view of a mesh screen bead font sheet that can be used to manufacture spherical abrasive beads. The font sheet article 448 is constructed of wires 446, 450 that are woven together to create individual open-cell through holes 452, 454, 456. This type of mesh screen article can be used to mass produce equal sized abrasive spherical beads.

Figure 57:
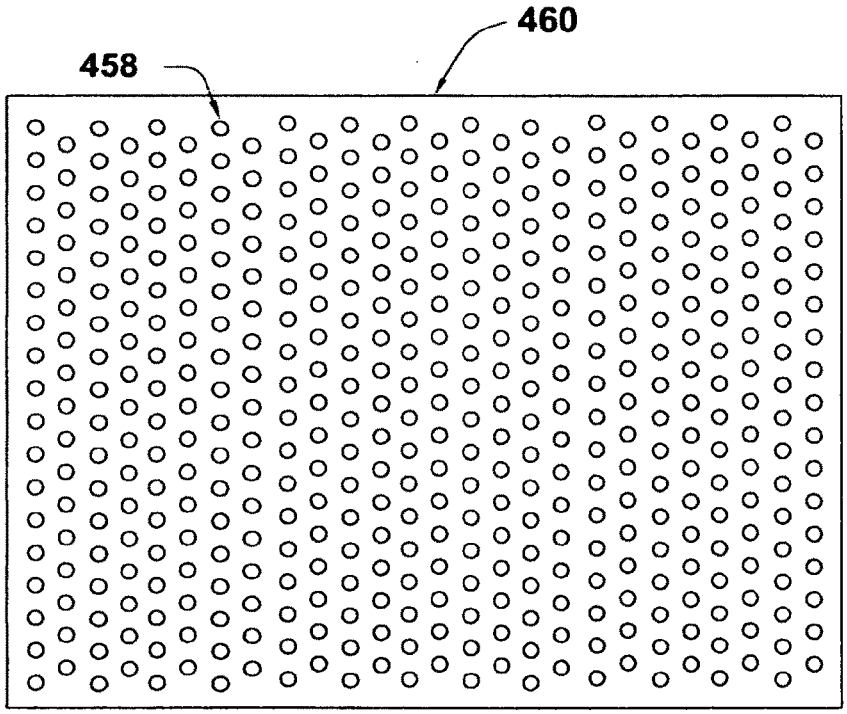
FIG. 57 is a top view of a perforated hole font sheet used to manufacture beads.

FIG. 57 is a top view of an electrodeposited perforated hole font sheet that can be used to manufacture spherical abrasive beads. The font sheet article 460 is constructed of metal that is electrodeposited in patterns to create individual open-cell through holes 458 in the sheet article 460.

Flat Rolled Abrasive Bead Wire Screens

Problem: It is desired to provide woven wire mesh screens with open cell walls that are more continuous than the individual woven wire strands to form equal sized liquid abrasive slurry dispersion beads. It is desired to use woven wire screens to produce equal sized abrasive beads because the wire screen material is inexpensive compared to equivalent cell sized perforated or electroplated screens and because a wide variety of sizes of wire screen material is readily available.

Solution: Woven wire screens can be easily reduced in thickness with reductions in the size of the screen openings by processing the screen through a calendar-roll system. In one example, a bronze wire mesh screen rated for 140 micrometer (0.0055 inches) screening that is constructed from 0.0045 inch (114 micrometers) diameter wire, which had an original sheet thickness of 0.0095 inches (241 micrometers), was reduced in sheet thickness to 0.0045 inches (114 micrometers). All of the rectangular cell holes in the screen remained rectangular in shape but had smaller cross section dimensions. Also, the open gap areas that connecting adjacent screen cells which were originally located at the corners where the woven right-angle wires strands intersected were significantly reduced in size. Rolling the woven wire flat had the result that the irregular shaped formed wire "walls" rectangular open cells now had near-continuous "walls". These new "walls" reduce the amount of mutual dispersion-fluid that can bridge across two adjacent cells with the result that less of the dispersion has to be separated at these locations when the liquid dispersion volumes are simultaneously ejected from a woven mesh cell screen. Woven screens processed through the nipped calendar roll system had uniform sized rectangular cell openings along the downstream length of the wire screen material with the result that the level-surfaced liquid contained in each of the reduced thickness cells is substantially equal in volume. These equal sized liquid dispersion cell volumes can be ejected from the flat-rolled screens cells to form equal sized abrasive beads. In another example, the same 140 micrometer (0.0055 inches) screen material was calendar roll flattened to 0.0035 inches (89 micrometers) to produce cells having even more continuous cell "walls". The wire mesh screen size and the amount that the screen is reduced in thickness by the calendar rolls are selected to produce the desired liquid volumes contained in the screen cells to create the desired bead sizes.

Screen Formed Spherical Ceramic Abrasive Agglomerates

Problem: It is desired to form spherical ceramic abrasive particle composite agglomerates or beads that are made of abrasive powder particles mixed with metal or non-metal oxides or other materials where each of the agglomerates or beads have the same nominal size. It is also desired to form equal sized spherical non-abrasive beads that are made of ceramic or non-organic materials, organic materials, or combinations thereof. Production of equal-sized beads increases the bead product utilization and increases the functional performance of the beads. For instance, beads that are not of the desired size in their application use do not have to be discarded because they are not utilized or perform their function well. In the case of abrasive bead coated abrasive articles, the wasted use of undersized beads that do not contact a workpiece surface is avoided.

Non-abrasive beads that are used as light or other wavelength reflectors will have better reflection performance when equal sized beads having optimized size selections are used as compared to the circumstance when a random size range or a wide range of bead sizes are used in a single reflective coating application. Another use for equal-sized non-abrasive spherical beads is for creating raised islands on a backing sheet by resin coating island areas and coating the wet resin areas with these beads to form equal height island structures that can be resin coated to form island top flat surfaces. Equal sized beads can also be used in many commercial, agricultural and medical applications.

Spherical composite abrasive agglomerate beads that are produced by the present common methods of bead manufacturing tend to result in the simultaneous production of agglomerate beads having a wide range of sizes. This wide range of bead sizes is inadvertently established during the process of forming spherical shaped beads that have a specific desired size. In one bead manufacturing process, a stream of a liquid dispersion mixture is poured as a stream into a stirred moving dehydrating liquid where the nominal bead size is established by changing the speed of the stirring action. A wide range of bead sizes is produced even at a single stirring speed. In another bead manufacturing process, a stream of dispersion liquid is introduced into the center of a high-speed rotating wheel that throws out filament streams of the liquid dispersion into a hot air dehydrating environment where the nominal bead size is established by changing the rotational speed of the wheel. A wide range of bead sizes is produced even at a single wheel rotation speed. Beads can also be produced by pressure spraying the liquid dispersion into a heated dehydrating environment but again, a wide range of beads is produced even at a single pressure setting with a specific sized spray nozzle opening. In all of the three described bead manufacturing processes, the liquid dispersion is a mixture of sharp abrasive particles, a metal oxide, including silica, and water. The abrasive agglomerate beads are formed into spheres by surface tension forces acting on the individual liquid dispersion segments or dispersion entities that are formed by the bead manufacturing processes. Non-abrasive beads are formed from non-abrasive dispersions or from other non-abrasive liquid materials by the same bead manufacturing processes that are well known in the art.

When this wide range of different sized agglomerate beads are coated together on an abrasive article, the capability of the article to produce a smooth finish is primarily related to the size of the individual abrasive particles that are encapsulated within a bead body, rather than being related to the diameter of the bead body. Also, when abrasive beads are coated in a monolayer on the surface of an abrasive article, it is desired that each of the individual beads have approximately the same diameter to effectively utilize all of the abrasive particles contained within each bead. If small beads that are mixed with large beads are coated together on an abrasive article, contact of the small beads with a workpiece surface is prevented because the adjacent large diameter beads contact the surface first. Typically the number of particles contained within a small bead is insufficient to provide a reasonable grinding or lapping abrading life to the abrasive article before all of the particles are worn away. The number of individual particles encapsulated within the body volume of a spherical agglomerate bead is proportional to the cube of the diameter of the bead sphere but the average height of the bulk of the particles, located close to the sphere center, is directly proportional to the sphere diameter. A small increase in a bead diameter results in a modest change of the bulk agglomerate center height above the surface of a backing sheet, but the same diameter change results in a substantial increase in the number of individual abrasive particles that are contained within the bead body. Most of the volume of bead abrasive particles are positioned at a elevation raised somewhat off the surface of the backing sheet, or the surface of a raised island, that results in good utilization of nearly all the encapsulated abrasive particles during the abrading process before the bead agglomerate is completely worn down. Even though the spherical bead shape is consumed progressively during the abrading process, the body of the remaining semi-spherical agglomerate bead structure has sufficient strength and rigidity to provide support and containment of the remaining abrasive particles as they are contacted by a moving workpiece surface.

It is not a simple process to separated the undesirable under-sized beads from larger sized beads and crush them to recover the expensive abrasive particle material for re-processing to form new correct-sized beads. In many instances, the too-small beads are simply coated with the correct-sized spherical agglomerate beads even though the small beads exist only as a cosmetic component of the abrasive coated article. It is preferred that equal-sized bead agglomerates have a nominal size of less than 45 micrometers when enclosing 10 micrometer, or smaller, abrasive particles that are distributed in a porous ceramic erodible matrix for use in high speed flat lapping of hard workpiece surfaces.

It is necessary to provide gap spacing between adjacent agglomerate beads to achieve effective abrading. Gaps between the beads allow water to flush away the grinding debris that is generated in the abrading action. The presence of coated undersized non-contacted agglomerate beads results in the water and swarf passageways existing between the large diameter agglomerate beads being blocked by the small agglomerates.

The nominal size of the abrasive bead diameters is also selected to have sufficient sphere-center heights to compensate for both the thickness variations in the abrasive sheet article and also the out-of-flatness variations of the abrasive sheet platen or platen spindle. Overly small beads located in low-spot areas on a non-flat platen rotating at very high rotational speeds are not utilized in the abrading process as only the largest sized beads, or the small beads located at the high-spot areas of a rotating abrasive disk article, contact the surface of a workpiece. When a non-flat abrasive surface rotates at high speeds, a workpiece is typically driven upward and away from low-spot areas due to the dynamic impact effects of abrasive article high-spots periodically hitting the workpiece surface during the high speed rotation of a workpiece contacting abrasive platen. Workpieces subjected to these once-around impacts are prevented from quickly traveling up and down to remain in abrading contact with the uneven abrasive surface due to the mass inertia of the workpiece or the mass inertia of the workpiece holder. Most of an abrasive article beads can be utilized if the abrasive non-flat platen is operated at sufficiently low rotational speeds where a small or low mass inertia workpiece can dynamically follow the periodically changing contour of a non-flat moving abrading surface. However, the abrasion material removal rate is substantially reduced at these low surface speeds as the material removal rate is known to be proportional to the abrading surface speed.

Use of very large diameter agglomerate spheres or beads addresses the problem of abrasive article thickness variations or platen surface flatness variations. However, very large beads do introduce the abrading process disadvantage where they tend to create a non-level or non-flat abrading surface during abrading operations from an originally flat abrading surface. Here, the coated abrasive is too thick, due to the over-sized abrasive beads, to retain its original-reference precision flatness over extended abrading use because low spot areas are worn into the abrading surface. When smaller sized abrasive beads are used, the smaller beads become worn away as low spot areas develop and the abrasive article is discarded before an abrading article having significant non-flat low spot areas is used to abrade a workpiece that requires a very precision flat surface. A non-flat abrasive surface typically can not generate a precision flat surface on a workpiece. There is a trade-off in the selection of the abrasive coating thickness or selection of the size of abrasive beads coated on an abrasive article. If the abrasive coating is too thick or the beads too large, the original flat planer surface of the abrasive article ceases to exist as abrading wear proceeds. If the abrasive coating is too thin, or the beads are too small, the abrasive article will wear out too fast.

High surface speed abrading operations with very hard superabrasive particles, including diamond and cubic boron nitride, is very desirable for abrading manufacturing processes because of the very high material removal rates experienced with these abrasives.

Solution: A microporous screen endless belt or microporous screen sheet having woven wire rectangular openings can be used to form individual equal-sized volumes of an aqueous based ceramic slurry containing abrasive particles. The screen cell volumes of a fine 325 rating mesh screen having an opening of 44 micrometers (0.0017 inches) are approximately equal to the volume of the desired size spherical agglomerates or beads. Cell volumes are approximately equal to the thickness of a screen multiplied by the open cell cross sectional area. The screen cells are filled with a liquid abrasive slurry mixture and an impinging fluid is used to expel the liquid cell slurry volumes into a gas or liquid dehydration environment. Surface tension forces acting on the suspended or free-traveling slurry lumps first forms the liquid slurry volumes into individual spherical bead shapes that are then solidified by the dehydrating fluid. Beads can then be collected, dried and fired to produce abrasive composite agglomerate beads that are used to coat flexible abrasive article sheet backing material. Box-like cell volumes that are formed by screen mesh openings have individual cell volumes equal to the average thickness of the woven wire screen times the cross-sectional area of the rectangular screen openings. The screen cell volume size is selected to compensate for the shrinkage of the liquid abrasive slurry as the slurry is processed through the various drying and firing steps that are required to produce the ceramic abrasive beads that have the desired bead size.

Individual rectangular cell openings formed by the screen interwoven strands of wire have irregular side walls and bottom and top surfaces due to the changing curved paths of the woven screen-wire strands that are routed over and under perpendicular wires to form the screen mesh. The cells formed by the individual interleaved wire strands in the woven screen are interconnected with adjacent cells. The cells "appear" to be separated by the wire strands as viewed from the top flat surface of the screen. However, the actual screen thickness results from the composite thickness of individual wires that are bent around perpendicular wires where the screen thickness is often equal to three times the diameter of the woven wires. Adjacent "cell volumes" are contiguous across the joints formed by the perpendicular woven wires. Level-filling the screen with Berg's (U.S. Pat. No. 5,201,916) dispersion creates adjacent cell dispersion entities that are joined together across these perpendicular wire joints. When Berg dries his screen-cell entitles, the entities shrink and some entities would pull themselves apart from each other at the screen joints. However, the entity shrinkage will not be sufficient that the non-joined solidified entities will pass through the screen openings. The entities will remain lodged in the screen mesh as trapped by the portions of the entity bodies that extended across the woven wire joints. Berg can not use a woven screen to process his dispersion entities.

In comparison, in the present invention liquid slurry lumps can be easily ejected from adjacent bridged-slurry-material cells as the mutual-joined liquid slurry material is easily pulled apart at the mesh screen cell corners with the use of modest ejection forces. The slurry lumps are ejected into a dehydrating fluid that removes enough water from the slurry lumps that they become partially solidified prior to the slurry lumps being collected together. The partial dehydration prevents the individual slurry lumps form sticking to each other and to prevent adjacent slurry lumps from bonding together to form larger sized lumps after they are collected together. The ejected slurry lumps can form spherical slurry lumps due to surface tension forces acting on the liquid lumps while they are in a free trajectory travel in the dehydrating fluid before the lumps are collected together. Also, the slurry lumps can be gelled enough or dehydrated enough or have a thixotropic fluid characteristic before they are ejected that the lumps retain the outline shape of the cell walls after they are ejected even though the ejected slurry lumps are still a non-solidified fluid material at the time they are ejected from the cell sheets. The slurry mixture may consist of water or other solvents mixed with aluminum oxide or other metal oxides or combinations thereof or the slurry mixture may consist of a water based metal oxide mixed with abrasive particles including diamond or CBN particles.

These irregular rectangular cell openings can be made more continuous and smooth by immersing the screen in a epoxy, or other polymer material, to fully wet the screen body with the polymer, after which, the excess liquid polymer is blown off at each cell by a air nozzle directed at an angle to the screen surface. The polymer remaining at the woven wire defined rectangular mesh edges of each cell will tend to form a more continuous smooth surface shape to each cell due to surface tension forces acting on the polymer, prior to polymer solidification. Screens can also be coated with a molten metal that has excess metal residing within the rectangular cell shape interior that is partially removed by mechanical shock impact, or vibration, or air jet to make the cell wall openings more continuous and smooth. Also, screens can be coated with release agents including wax, mold release agents, silicone oils and a dispersion of petroleum jelly dissolved in a solvent, including acetone or Methyl ethyl keytone (MEK). Screen materials having precision small sized openings are those woven wire screens commonly used to sieve size-grade particles that are less than 0.002 inches (51 micrometers) in diameter. These screens can be used to form small sized abrasive agglomerates. Another open cell sheet material having better defined cell walls than a mesh screen is a uniform thickness metal sheet that has an array pattern of circular, or other shaped, perforation holes created through the sheet thickness by chemical etching, laser machining, electrical discharge machining (EDM), drilling or other means. Also, perforated metal sheets can be fabricated by the electro deposition of metal. The smooth surface of both sides of the electrodeposited metal sheet cell-hole material allows improved hole slurry filling, slurry expelling and slurry clean-up characteristics as compared to a mesh screen cell-hole material. A endless screen or perforated belt can be made by joining two opposing ends of a very thin mesh screen, or of a perforated sheet, or an electrodeposited sheet, together to form an joint that is welded or adhesively bonded. Butt joint, angled butt joint, or lap joint belts can be constructed of the cell-hole perforated sheet material or sheet screen material. A belt butt joint that has inter-positioned serrated joint edges that are bonded together with an adhesive, solder, brazing material or welding material allows a strong and flat belt joint to be made. Butt joint bonding materials that level-fill up belt material cell holes may extend beyond the immediate borders of the two joined belt ends to strengthen the belt joint as these filled cell holes are not significant in number count compared to the remainder of open cell holes contained in the belt. The belt lap joint is practical as a 25 micrometer (0.001 inch) thick cell sheet material would only have a overlap joint thickness of approximately 50, micrometers (0.002 inches) and preferably would have a 0.5 to 1.5 inch (12.7 to 38 mm) long overlap section. This overlap section area can easily pass through a doctor blade or nip roll cell filling apparatus. Cell openings that reside at the starting and trailing edges of the joint may be smaller than the average cells but these undersized cells would be few in number compared to the large number of cells contained in the main body of the belt. Cell openings within the belt joint overlap area would typically be filled with adhesive. Extra small agglomerates produced by the few extra small cells located at the leading and trailing belt joint edges can simply be discarded with little economic impact. The endless belt can have a nominal width of from 0.25 to 40 inches (0.64 to 101.6 cm) and a belt length of from 2.5 to 250 inches (6.4 to 640 cm) or more. The belt can be mounted on two rollers and all or a portion of the rectangular or round cell openings in the belt can be filled with abrasive slurry. Belt cell holes would be filled level to the top and bottom surfaces of the belt by use of a nipped coating roll, or one or more doctor blades, or by other filling means. Two flexible angled doctor blades can be positioned directly above and below each other on both sides of the moving belt to mutually force the slurry material into the cell holes to provide cells that are slurry filled level with both surfaces of the belt. Another form of open cell hole sheet or screen that can be used to form spherical beads is a screen disk that has an annular band of open cell holes where the cell holes can be continuously level filled in the screen cell sheet with a oxide mixture solution, or other fluid mixture material, on a continuous basis by use of doctor blades mutually positioned and aligned on both the upper and lower surfaces of the rotating screen disk. The solution filled cell volumes can then be continuously ejected from the screen cells by an impinging fluid jet, after which, the cell holes are continuously refilled and emptied as the screen disk rotates. Inexpensive screen material may be thickness and mesh opening size selected to produce the desired ejected mixture solution sphere size. The screen disk can be clamped on the inner diameter and the inner diameter driven by a spindle. The screen disk may also be clamped on the outer diameter by a clamp ring that is supported in a large diameter bearing and the outer support ring rotationally driven by a motor which is also belt coupled to the inner diameter support clamp ring spindle shaft. A stationary mixture solution dual doctor blade device would level fill the screen cell openings with the mixture solution and a stationary blow-out head located at another disk tangential position would eject the mixture solution cell volume lumps from the disk screen by impinging a fluid jet on the screen. Multiple pairs of solution filler and ejector heads can be mounted on the disk screen apparatus to created the ejected solution lumps at different tangential locations on the disk screen. A disk screen apparatus can be constructed with many different design configurations including those that use hollow spindle shafts and support arms that clamp the outer screen diameter. Also, the screen cell holes located in the area of the support arms may be permanently filled to prevent filling of the cell holes with a liquid mixture solution in those areas to prevent ejected solution lumps from impacting the support arms. A cone shaped screen can also be constructed using similar techniques as those used for construction of the disk screens An abrasive particle fluid slurry can be made of a water or other solvent based mixture of abrasive particles and erodible filler materials including metal or non-metal oxides and other materials, or mixtures thereof. Equal sized spherical shaped abrasive or non-abrasive hollow or solid or porous beads can be made in open-cell sheets, disks with an annular band of open cell holes or open cell belts from a variety of materials including ceramics, organic materials, polymers, pharmaceutical agents, living life-forms, inorganic materials or mixtures thereof.

Hollow abrasive beads can be produced that would have an outer spherical shell comprised of an agglomerate mixture of abrasive particles, a metal oxide material. However, a dispersion mixture of water, gas inducing material, metal oxide and abrasive particles would be substituted for the water mixture of metal oxides and other gas inducing materials that are used to make non-abrasive glass or ceramic spherical beads. Hollow beads would be created after forming the dispersion mixture lump entities in the open cells of the screen and ejecting these lumps from the screen cavities to form spherical entities. The entities would then be heated to form gasses that in turn form the liquid entities into hollow entities by the same type of techniques that are commonly used to form hollow ceramic spheres from lumps of a water mixture of ceramic materials. These liquid hollow entities would then be dehydrated to solidify them into non-sticky hollow spheres before they were in physical contact with each other.

It is well known in the industry that the simple addition of "chemical agents" to the slurry mixture can be used in the manufacture of non-abrasive hollow beads. To produce equal sized hollow beads, a liquid dispersion mixture that contains a gas inducing material is used to fill equal sized mold cavities to form dispersion entities. These dispersion entities are then ejected from the cavities and they are formed into spherical shapes by surface tension forces. Gasses are typically formed inside the spherical slurry lump entities when the entities containing the chemical agents are heated. The gasses act inside the spherical entities to form outer spherical entity shells where a gaseous void is formed in the internal central region of each of the spherical entities. This results in the formation of hollow spherical shaped entities. These chemical agents can comprise organic materials and/or inorganic materials. There are a variety of expressions in use for these chemical agents including: gas inducing material; hollow sphere forming mixtures; foaming agents; gas-forming substances; and blowing agents.

A metal oxide material that is often used to make ceramic-type beads is Ludox®, a colloidal silica sol that is a suspension of silica in water, which is a product of W.R. Grace & Co., Columbia, Md. Ceramic beads based Ludox® or other oxide sols are used in many commercial applications including use as plastic fillers, paint additives, abrasion resistant and corrosion resistant surface coatings, gloss reduction surface coatings, organic and inorganic capsules, and for a variety of agricultural, pharmaceutical and medical capsule applications. Porous cell-sheet spheres can be saturated with specialty liquids or medications and the spheres can be surface coated with a variety of organic, inorganic or metal substances. A large variety of materials can be capsulized in equal sized spheres for a variety of product process advantages including improving the material transport characteristics of the encapsulated material or to change the apparent viscosity or rheology of the materials that are mixed with the capsule spheres.

It is preferred that the individual abrasive or other material particles have a maximum size of 65% of the smallest cross-section area dimension of a cavity cell that is formed by the rectangular opening in the wire mesh screen, or perforated belt circular holes, to prevent individual particles from lodging in a belt cell opening. A fluid jet stream, including air or other gas or water or solvent or other liquids, or sprays consisting of liquids carried in a air or gas can be directed to impinge fluid on each slurry filled cell to expel the volume of slurry mixture from each individual cell into an environment of air, heated air or heated gas or into a dehydrating liquid. A liquid or air jet having pulsating or interrupted flows can also be used to dislodge and expel the volume of slurry contained in each belt cell hole from the belt. It is desired to expel the full volume of slurry contained in a cell opening out of the cell as a single volumetric slurry entity rather than as a number of individual slurry volumes consisting of a single large volume plus one or more smaller satellite slurry volumes. Creation of single expelled slurry lumps is more assured when each slurry lump residing in a cell sheet is subjected to the same dynamic fluid pressure slurry expelling force across the full cross-sectional area of each cell slurry surface. The fluid jet nozzles can have the form of a continuous fluid slit opening in a linear fluid die header or the linear fluid jet nozzle can be constructed from a single or multiple line of hypodermic needles joined at one open end in a fluid header. The linear nozzle would typically extend across the full width of the cell sheet or belt. A fluid nozzle can also have a single circular or non-circular jet hole and can be traversed across the full width of the cell sheet or cell belt. Slurry volumes would be expelled from the multiple cell openings that are exposed to a fluid jet line where the cell sheet or cell belt is either continuously advanced under the fluid jet or moved incrementally. A fluid jet head can also move in straight-line or in geometric patterns in downstream or cross-direction motions relative to a stationary or moving cell sheet or cell belt. Further, a linear-width jet stream can be directed into the gap formed between two closely spaced guard walls having exit edges positioned near the cell sheet surface. The guard walls focus the fluid stream into a very narrow gap opening where the fluid impinges only those cells exposed within the open exit slit area. Another technique is to use a single guard wall that concentrates and directs a high energy flux of fluid toward slurry filled cell holes as they arrive under the wall edge from an upstream belt location of a moving cell belt. Other mechanical devices can be used that expose a fixed bandwidth of slurry filled cells to the impinging fluid on a periodic basis where sections of a cell belt or screen are advanced incrementally after each bandwidth of slurry lumps are fluid expelled from the cell sheet during the previous fluid expelling event. Slurry lumps can also be expelled from cells holes by mechanical means instead of impinging fluids by techniques including the use of vibration or impact shock inputs to a filled cell sheet. Pressurized air can be applied to the top surface or vacuum can be applied to the bottom surface of sections of slurry filled cell sheets or belts to expel or aid in expelling the slurry lumps from the cell openings.

A cell belt may be immersed in a container filled with dehydrating liquid and the slurry cell volumes expelled directly into the liquid. Providing a dry porous belt that does not directly contact a dehydrating liquid reduces the possibility of build-up of dehydrated liquid solidified agglomerate slurry material on the belt surface as a submerged belt travels in the dehydrating liquid. The expelled free-falling lump agglomerates can individually travel some distance through air or other gas onto the open surface of a dehydrating liquid where they would become mixed with the liquid that is still or agitated. The agitated dehydrating liquid can be stirred with a mixing blade to assure that the slurry agglomerates remain separated and remain in suspension during solidification of the beads. The use of dehydrating liquids is well known and includes partially water-miscible alcohols or 2-ethyl-1-hexanol or other alcohols or mixtures thereof or heated mineral oil, heated silicone oil or heated peanut oil. In the embodiment where one end of the open-cell belt is submerged in a container of dehydrating liquid provides that the slurry lumps are expelled directly into the liquid without first contacting air after being expelled from the belt. The expelled free-falling agglomerates can also be directed to enter a heated air, or other gas, oven environment. A row of jets can be used across the width of a porous belt to assure that all of the slurry filled belt cell openings are emptied as the belt is driven past the fluid jet bar. The moving belt would typically travel past a stationary fluid jet to continuously expel slurry from the porous belt cell openings. Also, the belt would be continuously refilled with slurry as the belt travels past a nip-roll or doctor blade slurry filling station. Use of a moving belt where cells are continuously filled with slurry that is continuously expelled provides a process where production of spherical beads can be a continuous process. Surface tension forces, or other forces, acting on the individual ejected free-traveling or suspended slurry lumps causes them to form spherical agglomerate beads. In aqueous ceramic slurry mixtures, water is removed first from the exterior surface of the beads that causes the beads to become solidified sufficiently that they do not adhere to each other when collected for further processing. Agglomerate beads are solidified into green state spherical shapes when the water component of the water-based slurry agglomerate is drawn out at the agglomerate surface by the dehydrating liquid or by the heated air. Instead of using a slurry mixture in the open cell sheets, molten thermoplastic-type or other molten cell filling materials may be maintained in a liquid form within the sheet or belt cell openings with a high temperature environment until they are fluid spray jet ejected as a liquid into a cooling fluid median to form sphere-shaped beads. A flat planar section of open-cell mesh screen material or of perforated-hole sheet material can also be used in place of an open cell sheet belt to form slurry or other material beads.

Dehydrated green composite agglomerate abrasive beads generally comprises a metal oxide or metal oxide precursor, volatile solvent, e.g., water, alcohol, or other fugitives and about 40 to 80 weight percent equivalent solids, including both matrix and abrasive, and the composites are dry in the sense that they do not stick to one another and will retain their shape. The green granules are filtered out, dried and fired at high temperatures to remove the balance of water, organic material or other fugitives. The temperatures are sufficiently high to calcine the agglomerate body matrix material to a firm, continuous, microporous state (the matrix material is sintered), but insufficiently high to cause vitrification or fusion of the agglomerate interior into a continuous glassy state. Glassy exterior shells can also be produced by a vitrification process on oxide agglomerates, including abrasive agglomerates, where the hard glassy shell is very thin relative to the diameter of the agglomerate by controlling the ambient temperature, the dwell time the agglomerate is exposed to the high temperature and also by controlling the speed that the agglomerate moves in the high temperature environment. Using similar techniques glassy shells can be produced by the oxide vitrification process to produce glassy shells on hollow agglomerates. The sintering temperature of the whole spherical composite bead body is limited as certain abrasive granules including diamonds and cubic boron nitride are temperature unstable at high temperatures. Solidified green-state composite agglomerate beads can be fired at high temperatures over long periods of time with slowly rising temperature to heat the full interior of an agglomerate at a sufficiently high temperature to calcine the whole agglomerate body. Solidified agglomerates that are produced in a heated air or gas environment, without the use of a dehydrating liquid, can also be collected and fired. A retort furnace can be used to provide a controlled gas environment and a controlled temperature profile during the agglomerate bead heating process. An air, oxygen or other oxidizing atmosphere may be used at temperatures up to 600 degrees C. but an inert gas atmosphere may be preferred for firing at temperatures higher than 600 degrees C. Dry and solidified agglomerates having free and bound water driven off by oven heating can also be further heated very rapidly by propelling them through an agglomerate non-contacting heating oven or kiln. The fast response high temperature agglomerate bead surface heating can produce a hard shell envelope on the agglomerate surface upon cooling. The thin-walled hardened agglomerate envelope shell can provide additional structural support to the soft microporous ceramic matrix that surrounds and supports the individual hard abrasive particles that are contained within the spherical agglomerate shape. The spherical agglomerate heating can be accomplished with sufficient process speed that the interior bulk of the agglomerate remains at a temperature low enough that over-heating and structurally degrading enclosed thermally sensitive abrasive particles including diamond particles is greatly diminished. Thermal damage to temperature sensitive abrasive particles located internally within the spherical agglomerates during the high temperature process is minimized by a artifact of the high temperature convective heat transfer process wherein very small spherical beads have very high heat transfer convection coefficients resulting in the fast heating of the agglomerate surface. Agglomerates can be introduced into a heated ambient gas environment for a short period of time to convectively raise the temperature of the exterior surface layer while there is not sufficient time for significant amounts of heat to be thermally conducted deep into the spherical agglomerate interior bulk volume where most of the diamond abrasive particles are located. The diamond particles encapsulated in the interior of the agglomerate are protected from thermal damage by the heat insulating quality of the agglomerate porous ceramic matrix surrounding the abrasive particles. Special ceramics or other materials may be added to the bead slurry mixture to promote relatively low temperature formation of fused glass-like agglomerate bead shell surfaces.

Equal sized abrasive beads formed by open cell sheet material can be attached to flat surfaced or raised island metal sheets by electroplating or brazing them directly to the flat sheet surface or to the surfaces of the raised islands. Brazing alloys include zinc-aluminum alloys having liquidus temperatures ranging from 373 to 478 degrees C. Corrosion preventing polymer coatings or electroplated metals or vapor deposition metals or other materials may be applied to the abrasive articles after the beads are brazed to the article surface. These beads can be individually surface coated with organic, inorganic and metal materials and mixtures thereof prior to the electroplating or brazing operation to promote enhanced bonding of the beads to the electroplating metal or the brazing alloy metal. Bead surface deposition metals can be applied to beads by various techniques including vapor deposition. Metal backing sheet annular band abrasive articles having resin coated, electroplated or brazed abrasive particles or abrasive agglomerates bonded to raised flat-surfaced islands are preferred to have metal backing sheets that are greater than 0.001 inch (25.4 micrometers) and more preferred to be greater than 0.003 inches (76.2 micrometers) thickness in the backing sheet areas located in the valleys positioned between the adjacent raised islands.

It is desired to use a color code to identify the nominal size of the abrasive particles encapsulated in the abrasive equal sized beads that are coated on an abrasive sheet article. This can be accomplished by adding a coloring agent to the water based ceramic slurry mixture prior to forming the composite agglomerate bead. Coloring agents can also be added to non-abrasive component slurry mixtures that are used to form the many different types of spherical beads that are created by mesh screen or perforated hole sheet slurry cells to develop characteristic identifying colors for the resultant beads. Coloring agents used in slurry mixtures to produce agglomerate sphere identifying colors are well known in the industry. These colored beads may be abrasive beads or non-abrasive beads. The formed spherical composite beads can then have a specific color that is related to the specific encapsulated particle size where the size can be readily identified after the coated abrasive article is manufactured.

The stiff and strong spherical form of an agglomerate bead provides a geometric shape that can be resin wetted over a significant lower portion of the bead body when bonding the bead to a backing surface. The wet resin forms a meniscus shape around the lower bead body that allows good structural support of the agglomerate bead body. Resin surrounding the bottom portion of a bead reinforces the bead body in a way that prevents total bead body fracture when a bead is subjected to impact forces on the upper elevation region of the bead. This resin also provides a strong bonding attachment of the agglomerate bead to a backing sheet or to an island top surface after the resin solidifies. It is desired that very little, if any, of the resin extend upward beyond the bottom one third or bottom half of the bead. A strong resin bond allows the top portion of the bead to be impacted during abrading action without breaking the whole bead loose from the backing or the island surfaces.

Equal sized composite ceramic agglomerate abrasive beads may have a nominal size of 45 or less micrometers enclosing from less than 0.1 micrometer to 10 micrometer or somewhat larger abrasive particles that are distributed in a porous ceramic erodible matrix. Composite beads that encapsulate 0.5 micrometer up to 25 micrometer diamond particle grains and other abrasive material particles in a spherical shaped erodible metal oxide bead can range in size of from 10 to 300 micrometers and more. Composite spherical beads are at least twice the size of the encapsulated abrasive particles. A 45-micrometer or less sized bead is the most preferred size for an abrasive article used for lapping. Abrasive composite beads contain individual abrasive particles that range from 6 to 65% by volume. Bead compositions having more than 65% abrasive particles generally are considered to have insufficient matrix material to form strong acceptable abrasive composite beads. Abrasive composite agglomerate beads containing less than 6% abrasive particles are considered to have insufficient abrasive particles for good abrading performance. Abrasive composite beads containing from 15 to 50% by volume of abrasive particles are preferred. Preferred abrasive particles comprise diamond, cubic boron nitride, fused aluminum oxide, ceramic aluminum oxide, white fused aluminum oxide, heat treated aluminum oxide, silica, silicone carbide, green silicone carbide, alumina, zirconia, ceria, garnet, tripoli or combinations thereof. The abrasive particles are distributed uniformly throughout a matrix of softer microporous metal or non-metal oxides (e.g., silica, alumina, titania, zirconia, zirconia-silica, magnesia, alumina-silica, alumina and boria, or boria) or mixtures thereof including alumina-boria-silica or others.

Spherical agglomerate beads having equal sizes that are produced by use of screens or perforated sheets can be bonded to the surface of a variety of abrasive articles by attaching the beads by resin binders to backing materials, and by attaching the beads by electroplating or brazing them to the surface of a metal backing material. Individual abrasive article disks and rectangular sheets can have open cell beads attached to their backing surfaces on a batch manufacturing basis. Screen or perforated sheet beads can also be directly coated onto the flat surface of a continuous web backing material that can be converted to different abrasive article shapes including disks or rectangular shapes. These beads can be bonded directly on the surface of backing material or the agglomerates can be bonded to the surfaces of raised island structures attached to a backing sheet, or the agglomerates can be bonded to both the raised island surfaces and also to the valley surfaces that exist between the raised islands. Disks may be coated continuously across their full surface with cell sheet beads or the disks may have an annular band of abrasive beads or the disks can have an annular band of beads with an outer annular band free of abrasive. The cell sheet beads may be mixed in a resin slurry and applied to flat or raised island backing sheets or the backing sheets can be coated with a resin and the beads applied to the wet resin surface by various techniques including particle drop-coating or electrostatic particle coating techniques. Agglomerate beads may range in size from 10 micrometers to 200 micrometers but the most preferred size would range from 20 to 60 micrometers. Abrasive particles contained within the agglomerate beads include any of the abrasive materials in use in the abrasive industry including diamond, cubic boron nitride, aluminum oxide and others. Abrasive particles encapsulated in cell sheet beads can range in size from less than 0.1 micrometer to 100 micrometers. A preferred size of the near equal sized abrasive agglomerates for purposes of lapping is 45 micrometers but this size can range from 15 to 100 micrometers or more. The preferred standard deviation in the range of sizes of the agglomerates coated on an abrasive article is preferred to be less than 100% of the average size of the agglomerate, or abrasive bead, and is more preferred to be less than 50% and even more preferred to be less than 20% of the average size. Abrasive articles using screen abrasive agglomerate beads include flexible backing articles used for grinding and also for lapping. These cell sheet beads can also be bonded onto hubs to form cylindrical grinding wheels or annular flat surfaced cup-style grinding wheels. Mold release agents can be applied periodically to mesh screen, or perforated metal, sheet or belt materials to aid in expelling slurry agglomerates and to aid in clean up of the sheets or belts. Mesh screens and cell hole perforated sheets can be made of metal or polymer sheet materials. The mesh screens or metal perforated sheets can also be used to form abrasive agglomerates from materials other than those consisting of an aqueous ceramic slurry. These materials include abrasive particles mixed in water or solvent based polymer resins, thermoset and thermoplastic resins, soft metal materials, and other organic or inorganic materials, or combinations thereof. Abrasive slurry agglomerates can be deposited in a dehydrating liquid bath that has a continuous liquid stream flow where solidified agglomerates are separated from the liquid by centrifugal means, or filters, or other means and the cleaned dehydrated liquid can be returned upstream to process newly introduced non-solidified abrasive slurry agglomerates. Dehydrating liquid can also be used as a jet fluid to impinge on slurry filled cell holes to expel slurry volume lumps from the cell holes.

Near-equal sized spherical agglomerate beads produced by expelling a aqueous or solvent based slurry material from cell hole openings in a sheet or belt can be solid or porous or hollow and can be formed from many materials including ceramics. Hollow beads would be formulated with ceramic and other materials well known in the industry to form slurries that are used to fill mesh screen or perforated hole sheets from where the slurry volumes are ejected by a impinging fluid jet. These spherical beads formed in a heated gas environment or a dehydrating liquid would be collected and processed at high temperatures to form the hollow bead structures. The slurry mixture comprised of organic materials or inorganic materials or ceramic materials or metal oxides or non-metal oxides and a solvent including water or solvent or mixtures thereof is forced into the open cells of the sheet thereby filling each cell opening with slurry material level with both sides of the sheet surface. These beads can be formed into single-material or formed into multiple-material layer beads that can be coated with active or inactive organic materials. Cell sheet spherical beads can be coated with metals including catalytic coatings of platinum or other materials or the beads can be porous or the beads can enclose or absorb other liquid materials. Sheet open-cell formed beads can have a variety of the commercial uses including the medical, industrial and domestic applications that existing-technology spherical beads are presently used for.

Commercially available spherical ceramic beads are presently produced by a number of methods including immersing a ceramic mixture in a stirred dehydrating liquid or by pressure nozzle injecting a ceramic mixture into a spray dryer or with the use of high speed rotary wheels. The dehydrating liquid system and the spray dryer systems have the disadvantage of simultaneously producing beads of many different sizes during the bead manufacturing process. The technology of drying or solidifying agglomerates into solid spherical bead shapes in heated air is well established for beads that are produced by spray dryers. The technology of solidifying agglomerate beads in a dehydrating liquid is also well established. The use of There are many uses for equal-sized spherical beads that can, in general, be substituted for variable-sized beads in most or all of the applications that variable-sized beads are presently used for. They can be used as filler in paints, plastics, polymers or other organic or inorganic materials. These beads would provide an improved uniformity of physical handling characteristics, including free-pouring and uniform mixing, of the beads themselves compared to a mixture of beads of various sizes. These equal sized beads can also improve the physical handling characteristics of the materials they are added to as a filler material. Porous versions of these beads can be used as a carrier for a variety of liquid materials including pharmaceutical or medical materials that can be dispensed over a controlled period of time as the carried material contained within the porous bead diffuses from the bead interior to the bead surface. Equal-sized beads can be coated with metals or inorganic compounds to provide special effects including acting as a catalyst or as a metal-bonding attachment agent. Hollow or solid equal-sized spherical beads can be used as light reflective beads that can be coated on the flat surface of a reflective sign article.

Figure 66:
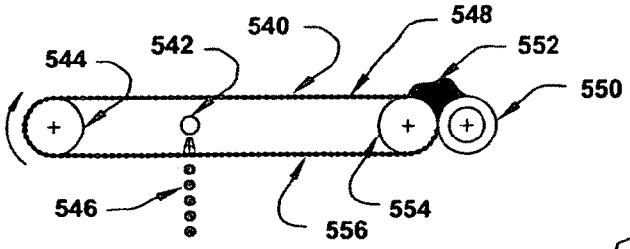
FIG. 66 is a cross-section view of a screen belt used to form liquid spherical agglomerates of an abrasive particle filled ceramic slurry that are ejected from the screen by pressurized air jets.

FIG. 66 is a cross-section view of a screen belt used to form liquid spherical agglomerates of an abrasive particle filled ceramic slurry that are ejected from the screen by pressurized air jets. A screen belt 540 having a multitude of through-holes is mounted on and driven by a drive roll 554 and is also mounted on an idler roll 544. Abrasive slurry 552 is introduced into the unfilled portion 548 of the screen belt 540 mesh opening holes by use of a stiff or compliant rubber covered nip roll 550 supplied with bulk abrasive slurry 552 to produce a section of slurry filled screen belt 556 that is transferred by the belt motion to a fluid-jet blow-out bar 542. High speed air exiting from the jet bar 542 ejects the abrasive slurry contained in each belt 540 mesh opening to create ejected agglomerates 546 that assume a spherical shape due to surface tension forces acting within the ejected agglomerates 546 as they travel in free space independently from each other in an oven or furnace heated air or gas environment (not shown) or dehydrating liquid that is adjacent to the belt. The spherical agglomerates 546 will each tend to have a similar volumetric size as the volume of each of the screen mesh openings are equal in size.

Figure 67:
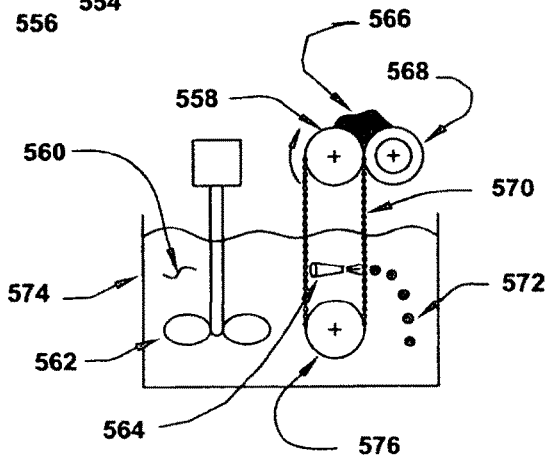
FIG. 67 is a cross-section view of a solvent tank having an immersed abrasive slurry filled screen belt and fluid blowout jet bar.

FIG. 67 is a cross-section view of a solvent tank having an immersed abrasive slurry filled screen belt and fluid blowout jet bar. Abrasive slurry is provided as a slurry bank 566 contained in the top area common to a rubber covered driven nip roll 568 and a screen belt idler roll 558 mounted above a liquid container 574 where the slurry is forced into the screen belt pore holes by the slurry pressure action of the nipped roll 568. The screen belt 570 mounted on the idler rolls 558 and 576 transfers the slurry filled pores downward into a liquid solvent 560 filled container 574 past a fluid jet 564 that blow-ejects individual agglomerates in a trajectory away from the screen belt into the volume of solvent 560. The agglomerates 572 form into spherical shapes due to surface tension forces while in a free state in the solvent 560 fluid that has been selected to dry the spherical agglomerates 572 by drawing water from the agglomerates 572 as they are in suspension in the solvent 560. The spherical agglomerates 572 will each tend to have a similar size, as each of the screen openings is equal in size. A solvent stirrer 562 can be used to aid in suspension of the agglomerates 572 in the solvent 560.

Figure 68:
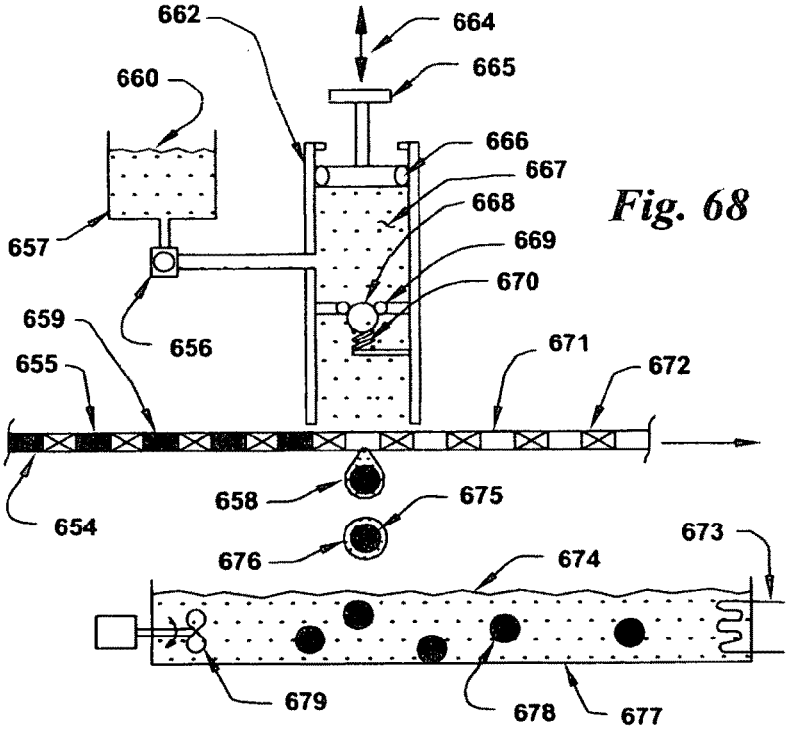
FIG. 68 is a cross-section view of a screen belt used to form liquid spherical by pressure impulses of liquids comprising oils or alcohols.

FIG. 68 is a cross-section view of a screen belt used to form liquid spherical agglomerates of an abrasive particle filled ceramic slurry that are ejected from the screen by pressure impulses of liquids comprising oils or alcohols. In one embodiment, the ejecting liquid can be a high viscosity room temperature oil where the ejected dispersion lumps having a very small amount of lump-surrounding oil are ejected into a large vat of dispersion lump dehydrating heated oil. The small amount of room temperature oil that is carried into the heated oil vat has little temperature effect on the heated oil. However, the high viscosity of the ejecting oil improves the capability of the ejecting oil to successfully eject whole lumps of the dispersion from the sheet cells without breaking up the ejected lumps into smaller lump entities. Also, the ejecting oil acts as a mold release agent that coats the belt cell molds and tends to repel the water based abrasive dispersion that is introduced into the sheet or belt mold cells to improve the release of the dispersion lump entities from the mold cells. In another embodiment, the ejecting liquid and the collection vat liquid can be an dehydrating alcohol.

A screen belt 654 having a multitude of through-holes cells 671 and non-open cell belt portions 672 is moved incrementally or constantly in close proximity to a liquid ejector device 662. A water based suspended oxide and abrasive particle slurry dispersion mixture 659 is introduced into the unfilled cells 671 of the screen belt 654 to produce dispersion filled cells 655 that progressively advance to the center exit opening of the ejector device 662. The cylindrical ejector device 662 has a plunger 665 that has an o-ring seal 666 that acts against the cylindrical wall of the ejector device 662. An impact force or impact motion 664 is applied to the plunger 665 by a solenoid or other force device (not shown). When the plunger 665 is driven downward as shown by 664 the liquid ejecting oil 667 is pressurized and a check valve ball 668 is driven away from a ball o-ring seal 669 where the ball 669 is nominally held by a compression spring 670 that compresses when the plunger 665 is advanced downward. Upon completion of the downward plunger 665 stroke, a pump 656 pumps more oil 660 into the ejector device 662 from the oil reservoir tank 657 that is filled with oil 660 and returns the plunger 665 to the original pre-activation position. On the downward plunger 665 stroke, oil 667 contained in the ejector device 662 ejects the dispersion lump 658 from the dispersion filled cell 655 along with a lump 658 coating of ejected oil 667. Surface tension forces act on both the oil 676 coating and the dispersion lump 675 to form an oil 667 coated spherical bead 675 as the bead 675 falls by gravity into a tank 677 that is filled with heated oil 674 that is heated by a heating element 673. The heated oil 674 is stirred by a driven stirrer device 679 and the dispersion beads 678 are heated by the hot oil 674 which results in water being removed from the beads 678 which results in the beads 678 becoming solidified. The solidified beads 678 are then collected, dried and subjected to a high temperature furnace process to fully solidify the beads 678.

Figure 69:
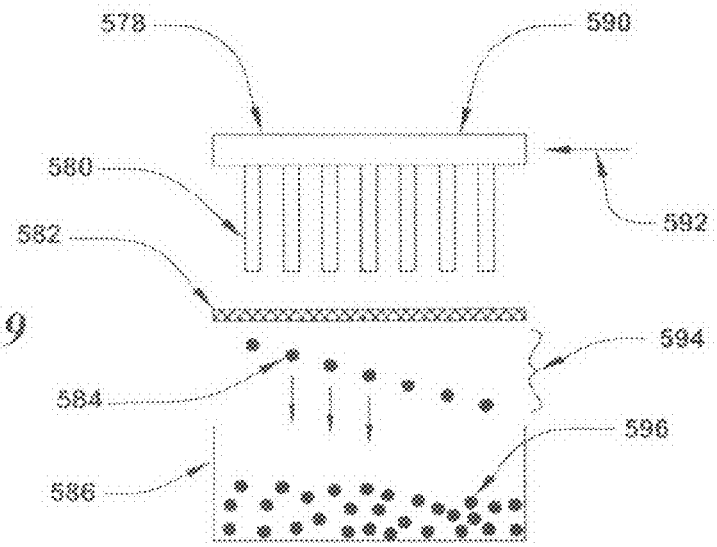
FIG. 69 is a cross-section view of an air-bar blow-jet system that ejects liquid precursor abrasive agglomerates from a screen into a heated atmosphere of air or different gasses.

FIG. 69 is a cross-section view of an air-bar blow-jet system that ejects liquid precusor abrasive agglomerates from a screen into a heated atmosphere of air or different gasses. The cell screen belt 582 or cell screen segment 582 can be filled with a slurry mixture comprised of water based abrasive particles and ceramic material and individual wet agglomerates 584 can be blow-ejected by an air-bar 590 into a heated gas atmosphere 594 that will dry the agglomerates 584 that are collected as dry agglomerates 596 in a container 586. The free traveling individual agglomerates 584 form spherical shapes due to surface tension forces as they travel from the cell screen belt 582 or cell screen segment 582 to the bottom of the container 586. The air bar 590 can be constructed of a line of parallel hypodermic tubes 580 joined together at one end at an air manifold 578 that feeds high pressure air or other gas 592 into the entry end of each tube 580.

Figure 70:
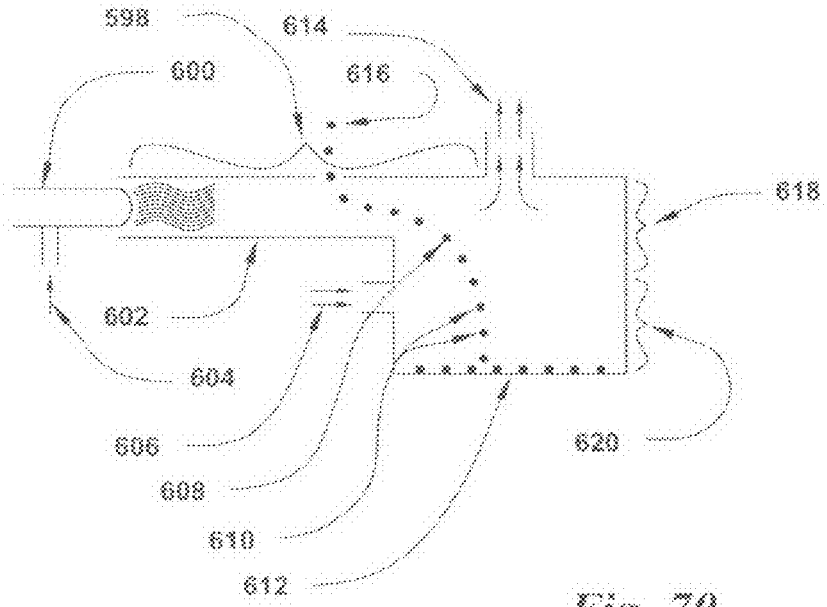
FIG. 70 is a cross-section view of a duct heater system that heats green state solidified ceramic abrasive agglomerates introduced into the duct hot gas stream.

FIG. 70 is a cross-section view of a duct heater system that heats green state solidified ceramic abrasive agglomerates introduced into the duct hot gas stream. A hydrocarbon combustible gas 604 is burned in a gas burner device 600 to produce a flow of temperature controlled gaseous combustion products inside a heat duct 602 that exit the container 612 as exhaust stream 614. The heater zone 618 has a mixture of hot and cold air and therefore has a moderate zone temperature. Green-state solidified agglomerates 616 are introduced into the duct 602 where the agglomerates are heated by the hot gaseous products as the agglomerates 616 are carried along the length of the duct high temperature zone 598 before falling into a low temperature zone 620. Cooling air introduced at the air inlet duct 606 into the agglomerate bead container 612 chills the surface of the hot agglomerates 608 that are collected as chilled agglomerate beads 610.

Screen Disk Production of Equal Sized Beads

Problem: It is desired to produce equal sized spherical beads of materials with the use of a mesh screen device that can produce the beads on a continuous production basis.

Solution: The materials formed into spherical beads include those materials that can be liquefied and then introduced into a flat disk shaped mesh screen having open cells to form equal sized cell-lumps. Mixing some solid materials with solvents can liquefy them and other solid materials can be heated to melt or liquefy them. These lumps are ejected from the screen to free-fall into an environment where the lumps form spherical shapes due to surface tension forces acting on the lumps. Dehydration of the water or solvent based spherical lumps solidifies the material into beads. Subjecting the melted ejected lumps to a cooling environment solidifies the melted material that that is ejected in lumps from the screen cells. The solidified lumps are sufficiently strong that they can hold their structural shapes when they are collected together for further drying or other heat treatment processes.

A disk screen can be formed from a mesh screen sheet that is cut into a circular disk shape where the cut screen disk is mounted on a machine shaft that is supported by bearings where the shaft and screen disk can be rotated. An annular band of open cells are present in the mesh screen flat surface area that extends from the outer periphery of the screen disk to an inner screen open-cell diameter. An inner radial portion of the screen disk cells can be filled with a solidified polymer or metal material to block the introduction of a slurry material into these filled cells. Likewise an outer periphery radial portion of the screen disk cells can be blocked with a polymer or metal. These filled, or blocked, screen cells will tend to structurally reinforce either or both the inner and outer radius areas of the cell disk. Here, the inner diameter of the annular band of open cells can be larger than the screen disk support shaft to form an annular band of open mesh screen cells. All of the screen cells would have equal cell cross-sectional open areas and the screen disk would have a uniform screen thickness.

Also, some other select portions of the open cell annular band can be filled with a polymer or metal material to structurally reinforce the screen disk to allow the disk to better resist torsional forces that are applied by the shaft to the thin screen disk. An open cell bead disk can also be constructed from a perforated sheet that has a uniform thickness and equal sized through-holes where each of the through-holes forms an open material or slurry material cell. In addition, when a woven wire mesh screen is used, a polymer or metal liquid filler material can be applied to the screen to fill in the corners of the woven wire screen cells. Excess filler material is removed from the woven screen prior to solidification of the filler material to provide cells that are open in the central cell areas but filled in at the woven wire cell corners. The removed filler material will tend to leave the mesh cell openings with continuous cell walls and provide that the wire-joint areas of the wires that bridge between the adjacent mesh cells are filled with the added filler material. Liquid slurry material can be more easily ejected from a woven wire screen cell when the mesh screen has been woven-wire-joint-treated with the wire-joint filler material. The mesh screen filler material can be a solvent based flexible filler material that is applied in a number of application steps to gradually fill up the mesh cell woven wire corners where the wires that form adjacent screen cells intersect due to the screen wire weaving process The open cells in the horizontal screen sheet disk can be level filled with a water, or solvent, based slurry mixture after which the material lumps contained in each cell can be ejected from the screen disk by impinging a jet or stream of a liquid against the surface of the screen. The lumps can be ejected into a dehydrating fluid that will remove the water or solvent from the lumps that fall freely in the dehydrating fluid while the liquid lumps are subjected to surface tension forces that form the lump into a spherical shape as they fall through the dehydrating fluid. After the lumps are formed into spheres, they are solidified enough that they can be collected together without adhering to each other. The screen disk can be constantly rotated in the process where the open screen cells are continuously filled or re-filled with the liquid material, and also, the material contained in the filled cells can continuously be ejected into the dehydrating environment. Here the screen disk cells are continuously filled with the slurry mixture to form equal volume sized slurry lumps within the confines of the equal sized mesh screen cells and the ejected cell material lumps are formed into equal volume spherical shaped beads.

The rotational speed of the disk screen can be optimized for the formation of slurry material beads. The rotational speed will depend on many process factors including: the diameter of the screen disk, the annular width of the screen cell disks, the viscosity of the slurry or material mixture, the size of the mesh screen cells, the type of apparatus used to level fill the screen cells with the slurry, the type of apparatus that is used to eject the slurry lumps and other factors. Mesh screen disks can also be used to produce non-spherical equal sized abrasive particles by solidifying increased-viscosity ejected slurry lumps before surface tension forces can produce spherical shapes from the ejected liquid lump shapes.

Different shaped areas of screen cells located in the annular band of open screen cells can be filled with a solidified structural polymer material where the shapes include "X" or other structural shapes. These structural polymer shapes can provide structural stiffening of the screen sheet in a planar direction to enable the screen sheet disk to resist torsional forces that are applied by a screen disk shaft to rotate the screen disk during the material lump formation process. The reinforcing polymer shapes that would extend across the annual band of open sheet cell holes would also be flush with the planar surface of the cell sheet. The flush-surfaced polymer shapes provide that the open cell holes that are in planar areas adjacent to the structural polymer reinforcement shapes can be level filled with liquid materials with the use of a wiper blade that contacts the surface of a rotating screen disk as the disk is continuously filled with the liquid material as the disk rotates.

The technique of producing equal sized spherical beads from a liquid material using a mesh screen or perforated sheet can be used to produce beads of many different materials that can be used in many different applications in addition to abrasive beads. Equal sized beads can be solid or hollow or have a configuration where one spherical shaped material is coated with another material. Bead materials include: ceramics, organics, inorganics, polymers, metals, pharmaceuticals, artificial bone material, human implant material, plant, animal or human food materials and other materials. The equal sized material beads produced here can have many sizes and can be used for many applications including but not limited to: abrasive particles; reflective coatings; filler bead materials; hollow beads; encapsulating beads; medical implants; artificial skin or cultured skin coatings; drug or pharmaceutical carrier devices; and protective coatings. It is only necessary to form a material into a liquid state, introduce it into the mesh screen cells where the cells are fully filled and eject it from the screen cells into an environment that will solidify the beads.

A material can be made into a liquid state by mixing it or dissolving it in water or other solvents. Also, a material can be melted, introduced into mesh screen cells using a screen material that has a higher melting temperature than the melted material after which the melted material is ejected from the screen cells. Surface tension forces acting on the ejected equal sized cell lumps form the lumps into spherical shapes during their free fall into a cold environment, which solidifies the spherical shaped material lumps. For example, molten copper metal can be processed to form spherical copper beads with a stainless steel screen as the stainless steel screen material has a higher melting temperature than the molten copper. When the molten copper lumps are ejected from the screen cells, they are first formed into spherical shapes and then are solidified as they travel in a free-fall in a cooling air environment.

Spherical material lumps having equal sizes, or non-spherical lump equal sizes, where the lumps can be formed by use of a mesh screen that has uniform volume sized cells where the ejected material lumps have individual volumes approximately equal in volumes to the screen cells contained volumes. The screen cell volumes are equal to the open cross-sectional screen-plane cell areas times the average thickness of the screen. A uniform thickness sheet material that is perforated with circular or non-circular through-holes where each independent hole has a hole cross-sectional area that is equal in area size can be used in place of a mesh screen to form equal volume size material beads. Spherical beads having diameters that range in size from less than 0.001 inch (25.4 micrometers) to more than 0.125 inches (3.18 mm) can be formed with screen sheets or perforated sheets using the process described here.

The screen disk equal sized material bead production system allows a portion of the disk to be operated within an enclosure and another portion of the disk to be operated external to the enclosure. Here, the external portion of the rotating disk can be continuously filled with a liquid material in an environment that is sealed off from the material lump ejection and solidification environments. The material filling environment can operate at room or cold or elevated temperatures and can be enclosed to prevent the loss of solvents to the atmosphere. The enclosed ejection environment may be a gaseous liquid or it may a liquid. The ejection environment can be held at an elevated temperature or the environment can be maintained at a cold temperature. Also, enclosure of the ejection environment prevents the escape of solvent fumes during the bead lump solidification process.

Figure 71:
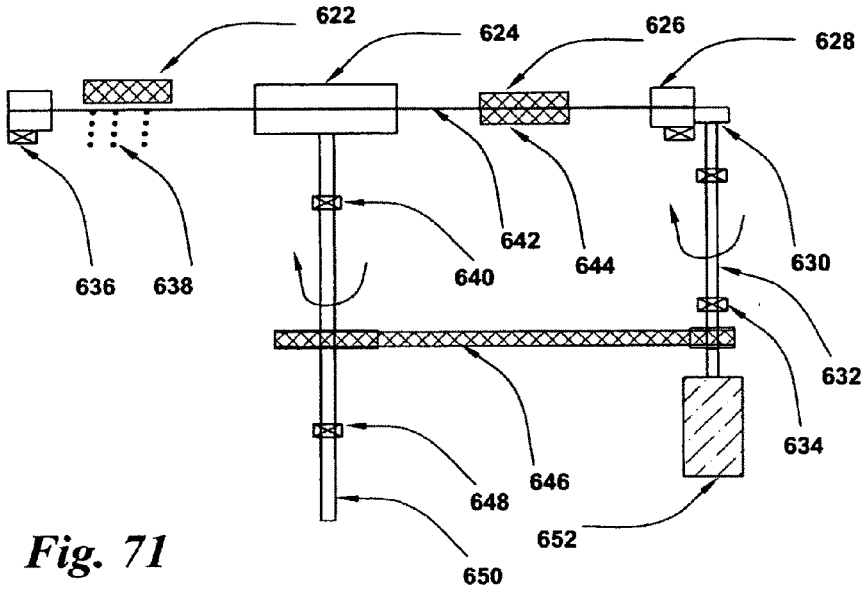
FIG. 71 is a cross-sectional view of a screen disk agglomerate manufacturing system.

FIG. 71 is a cross-sectional view of a screen disk agglomerate manufacturing system. A screen disk 642 is clamped with a inner diameter clamp 624 that is mounted on a spindle shaft 650 that is supported by shaft bearings 640 and 648. The disk 642 is also supported by an outside-diameter ring clamp 628 that is supported by a ring bearing 636 and the clamp 628 is also rotated by a gear 630 that is mounted on a shaft 632 that is supported by shaft bearings 634. The shaft 632 is driven by a drive motor 652 and the shaft 632 is drive belt 646 coupled with belt pulleys to the disk spindle shaft 650 to allow the screen disk 642 to be rotated mutually by the drive motor 652 at both the inner and outer disk 642 diameters to overcome friction applied to the screen surface by the mixture solution application devices 626 and 644. The stationary upper mixture solution application device 626 introduces the solution mixture into the rotating screen disk screen cells and a doctor blade portion of the application device 626 levels the solution contained in the screen cells to be even with the top surface of the screen 642. The stationary lower doctor blade device 644 is aligned axially with the upper doctor blade device 626 to allow the lower device 644 to level the solution mixture contained within the moving cells to be even with the lower surface of the screen resulting in screen cells that are completely filled with a mixture solution level with both the upper and lower surfaces of the screen disk. The filled cells rotationally advance to a blow-out or ejector head 622 where the mixture solution fluid is ejected from the screen cells by a jet of fluid from the ejector head 622 to form lumps 638 of mixture solution material where each lump has a volume approximately equal to the volume of the individual screen cells.

Figure 72:
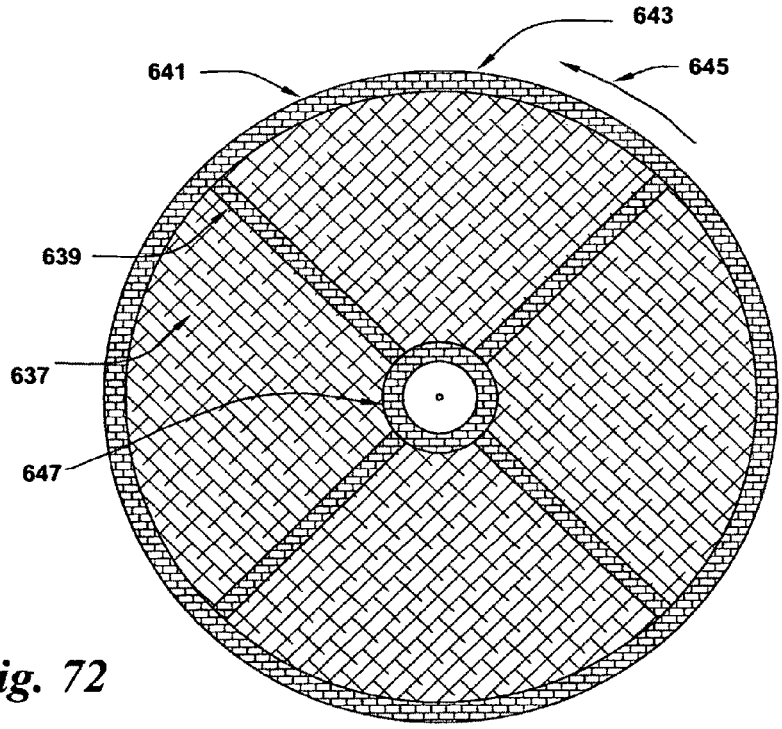
FIG. 72 is a top view of an open cell screen disk used to make equal sized beads

FIG. 72 is a top view of an open cell screen disk used to make equal sized beads. The screen disk 641 has four central annular band segments 637 having open cell holes and has a outer periphery band 643 and an inner radius band 647 that have filled non-open cell holes. The screen disk 641 would rotate in a direction 645. Also, portions of the central annular band of open cell holes have four radial bars 639 that have filled cell holes where the bars 639 provide structural reinforcement of the open cell hole central band area primarily to resist torsional forces that are applied to the screen 641 at the inner band 647 by a rotating shaft (not shown). The cell hole filler material can include polymers or metal materials where the hole filler material is flush with the two surface planes of the screen disk 641 and the band segments 637. Open mesh woven wire screen materials used to fabricate the screen disk 641 are nominally weak or flexible in both in-plane directions and out-of-plane directions. Filling some of the open cell holes with a structural polymer or a metal filler material can reduce the disk 641 flexibility. Screen 641 patterns of structural material filled holes can have a variety of bar patterns, such as the shown bars 639, that provide structural beam members that lie within the plane surface s of the disk. The screen disk 641 is shown with structural beam element bars 639 that are radial but other beam bars can intersect with each other and act as spokes to structurally join both the inner annular band 647 and the outer annular band 643. In addition to using a open mesh screen to construct a open-cell disk, a open cell disk can be constructed from sheet metal that is perforated with equal sized through holes. An open cell disk 641 can also be fabricated by electro-depositing metal to form an equal thickness disk that has patterns of equal sized open cell through holes. Both the perforated sheet metal and electrodeposited open celled disks have good torsional rigidity and structural strength so it would not be necessary to fill bar patterns 639 of holes in theses disks to provide torsional structural rigidity. Open cell bead disks can have open cell annular outside diameters that range in size from less than 4 inches (10.2 cm) to greater than 48 inches (122 cm) to provide large continuous quantities of equal sized beads from one bead making apparatus.

Spherical Ceramic Abrasive Agglomerates

Problem: It is desired to form spherical shaped composite agglomerates of a mixture of abrasive particles and an erodible ceramic material where each of the spheres has the same nominal size. Applying a single or mono layer of theses equal sized spheres to a coated abrasive article results in effective utilization of each spherical bead as workpiece abrading contact is made with each bead. The smaller beads coated with the larger beads in the coating of commercially available abrasive articles presently on the market are not utilized until the larger beads are ground down. A desired size of beads is from 10 to 300 micrometers in diameter.

Solution: Various methods to manufacture like-sized abrasive beads and also specific diameter, or volume, beads include the use of porous screens, perforated hole font belts, constricted slurry flow pipes with vibration enhancement and flow pipes with mechanical blade or air-jet periodic fluid droplet shearing action. Each of these systems can generate abrasive bead sphere volumes of a like size.

Abrasive beads having equal sizes can be manufactured with the use of the constricted slurry flow pipes where these constricted flow pipes have small precision sized inside diameters. Precision diameter hypodermic needle tubing can be used for these constricted slurry flow pipes. Liquid slurry is propelled by pumps or by high pressure from a slurry reservoir through the length of the tubes where the slurry exits the free end of the tubes as slurry droplets into a dehydrating fluid. Equal sized abrasive beads can be produced with the use of a single slurry flow tube that is excited by a vibration source. Also, multiple slurry tubes can be joined together as a tube assembly that is vibrated where liquid abrasive slurry bead droplets exit the ends of each independent slurry tube. The hypodermic tubing can have controlled lengths to provide equal velocity liquid abrasive slurry fluid flow through each independent equal length and equal inside diameter tube. The excitation vibration can be applied at right angles to the axis of the tubes or the vibration can be applied at angles other than right angles, relative to the tube axis, or the vibration excitation can be applied along the tube axis. In addition, the vibration excitation can be simultaneously applied in multiple directions on the tube or tube assembly. The amplitude and vibration frequency of the excitation vibration can be changed or optimized for each abrasive bead manufacturing process. Here, the vibration is controlled as a function of other process parameters including: the inside diameter of the tubes; the velocity of the slurry flow in the tubes; the Theological characteristics of the liquid abrasive slurry; and the desired size of the liquid abrasive slurry droplets.

Equal sized liquid abrasive slurry beads can also be produced with the use of commercially available woven wire mesh screen material having rectangular "cross-hatch" patterns of open cells. Screens that are in sheets or screens that are joined end-to-end to form continuous screen belts can be used to manufacture equal sized abrasive beads. Each individual open cell in the "cross-hatch" woven screen device has an equal sized cross-sectional rectangular area. Each open mesh cell also has a depth or cell thickness where the thickness is equal to the thickness of the mesh screen sheet material. The depth or thickness of the rectangular cell cavity is determined by the diameter of the woven mesh wire that is used and the type of wire weave that is used to fabricate the woven wire screen. The open cells of the mesh screen are used to mold-shape individual volumes of liquid abrasive slurry where the volume of the liquid slurry contained in each independent cell mold is equal in size. Each independent cell hole is uniformly filled with the liquid abrasive slurry by filling each of the open mesh cells to where both the top and the bottom surfaces of the slurry volumes contained in the individual cell holes of a horizontally positioned mesh screen are level with the top and bottom surfaces of the mesh screen sheet. The cell molds impart a rectangular block-like shape to the volumes of liquid slurry that are contained in the screen cells. After the open screen cells are filled with the liquid slurry mixture, the liquid slurry volumes contained in the screen cells are then individually expelled from the screen cells in block-like liquid slurry lumps into a slurry dehydrating fluid. Surface tension forces form the expelled slurry blocks into spherical slurry shapes as the slurry blocks are suspended in a dehydrating fluid. The dehydrating fluids solidify the slurry mixture spherical shapes into spherical beads that are dried and fired. The volumes of the individual liquid abrasive particle-and-ceramic material spheres are equal to the volumes contained within each the independent contiguous block-like slurry lumps that were ejected from the screen cells.

Another embodiment of manufacturing equal sized abrasive beads is to create a pattern of controlled volumetric through-hole slurry cells in a continuous belt by making the belt of an open mesh screen material where the belt thickness is the screen material thickness. Continuous belts, or cell hole sheets, can also be made from perforated sheet material or electro-deposited or etched sheet material. The side walls of the cell holes in the perforated sheets, electro-deposited sheets or the etched sheets are preferred to be circular in shape as compared to the rectangular shaped cell holes in the mesh screen sheets. Perforated sheets can also have rectangular, or other geometric shape, through holes if desired. For perforated sheet material, the ejected liquid slurry sphere volumes are also equal to the perforated cell hole volume. A ceramic abrasive sphere is again produced by filling the open cell hole in either the screen or belt with a slurry mixture of abrasive particles and water or solvent wetted ceramic material. A simple way to level-fill the screen or belt openings is to route the belt through a slurry bank captured between two nip rolls. The slurry volume contained in each slurry cavity is then ejected from the cavity by use of a air jet orifice or mechanical vibration or mechanical shock forces. Liquid slurry lumps that are ejected from these circular shaped cell holes tend to have flat-ended cylindrical block shapes instead of the rectangular brick-shaped slurry blocks that are ejected from the mesh screen sheets. Each ejected slurry volume will form a spherical droplet due to surface tension forces acting on the droplet as the drop free-falls or is suspended as it travels in the dehydrating fluid. If the dehydrating fluid is hot air, the liquid spherical slurry bead lumps tend to travel in a trajectory path as the hot air in the continuously heated atmosphere dries and solidifies the slurry lump droplet beads as they travel. When the beads are heated during the solidification process, the release of the water from the slurry droplets cool the hot air that is in the hot air containment vessel. Heat is continuously provided to the hot air in order to maintain this hot air environment at the desired bead processing temperature. The beads are collected, dried in an oven and then fired in a furnace to develop the full strength of the bead ceramic matrix material. The abrasive particles can constitute from 5 to 90% of the bead by volume. Abrasive bead sizes can range from 10 to 300 micrometers.

In the bead manufacturing techniques described here, mesh screens can be used to also create non-abrasive ceramic beads and non-abrasive non-ceramic beads having equal sizes. For abrasive beads, the slurry can be gelled before it is introduced into the screen cavity openings to increase the adhesion of the liquid slurry material to the screen body. However, it is required that the gelled lumps that are ejected from the screen cavities remain in a free flowing state sufficient that surface tension forces acting on the slurry lumps can successfully form the lumps into spherical shapes before solidification of the lumps.

When an open mesh screen is used to form equal sized liquid abrasive slurry mixture lumps, the mesh screen has rectangular shaped openings that all have the same precise opening size. As the screen has a uniform woven wire thickness and equal sized rectangular shaped openings, the volume of liquid slurry fluid that is contained within each level-filled screen cell opening is the same for all the screen cells. The cell volume is approximately equal to the cross sectional area of the rectangular cell opening times the thickness of the screen material. These precision cell sized mesh screen are typically used to precisely sort out particle materials by particle size. During a particle screening process, a batch of particles is placed on the screen surface and the screen allows only the small particle fraction of the batch to pass through the mesh screen openings. Each mesh screen cell opening has a precise cross sectional area that can be viewed in a direction that is perpendicular to the flat surface of the screen. The screen thickness can be viewed in a direction that is parallel to the flat surface of the screen. Each cell opening in the mesh screen forms a cell volume when considering that the cross sectional area of the rectangular cell opening has a cell depth that is equal to the localized average thickness of the mesh screen sheet material. For purposes of visualization only, the mesh screen cell volume consists of a rectangular brick shape that has six flat-sided surfaces. The cell volumes of all the screen mesh cells are equal in size. Each screen mesh cell is used as a cavity mold that is used to form equal sized lumps of liquid abrasive slurry material. The equal volume lumps are formed by level filling each of the open cell mold cavities with the slurry, after which, these equal volume liquid slurry lumps are ejected from the open cell mold cavities. The ejection of the lumps is caused by the imposition of external forces that quickly accelerate the lumps from the confines of the cell cavities. The near-instantaneous fast motion of each ejected liquid slurry lump breaks the adhering attraction of the slurry liquid lump with the cell walls. The ejection motion also breaks apart any portion of the slurry liquid lump that is mutually attached to a slurry lump that is contained in an adjacent mesh cell mold cavity.

The equivalent "walls" of a mesh screen cell are actually not flat planar wall surfaces. Instead the screen cell "walls" are irregular in shape when viewed along the thin edge of the screen. This is due to the fact that the cell "walls" are formed from interwoven strands of wire that are individually bent into curved paths as they intersect other perpendicular strands of wire. Each cell "wall" typically consists of a single strand of bent wire that extends in a generally diagonal direction across the width of the cell "wall". The typical diameter of the screen mesh wire is approximately the same size as the rectangular cross sectional gap openings in the mesh cells used here. This angled wire strand that forms the cell "wall" is a substantial portion of an equivalent flat-surface wall for a same-sized cell (that has the same rectangular opening and same cell thickness). When a liquid slurry mixture, of abrasive particles and a colloidal solution of silica particles in water, is introduced into these small screen cell cavities and level filled with the screen two flat surfaces, the cell contained-liquid slurry mixture assumes a stable state. Here, the contained liquid slurry lump tends to attach itself to the screen cell "wall" wire strands. Immediately after the screen cells are level filled with the slurry, the screen can be readily moved about and the slurry lumps remain stable within each screen cell. The bond between the slurry lumps and the wire mesh walls is so great that it is necessary to apply substantial external forces to the slurry lumps in order to dislodge and eject these screen lumps from their screen cells. Care is taken with the application of the slurry lump ejection forces that the slurry lumps remain substantially intact as a single lump during and after the ejection event rather than breaking the original cavity cell lumps into multiple smaller slurry lumps.

Bending of the individual strands of wire around other strands of wire at each intersection locks the wire strands together at their desired positions where they are precisely offset a controlled distance from other parallel wire strands. Offsetting parallel screen wire strands in two perpendicular directions forms the precision rectangular gap openings that the particles pass through when the particles are sorted by particle sizes. Bending of the wires about each other structurally stabilizes the shape of each mesh cell in order to maintain its cell opening size when the mesh screen is subjected to external forces.

Even though the "walls" each of the wire mesh screen cells do not have flat wall surfaces, the volume of the liquid slurry that is contained in each wire mesh screen opening cell is substantially equal to the volumes of slurry contained in the other screen cells. Each rectangular shaped screen cell acts as a mold cavity for the liquid abrasive slurry mixture that is introduced into each of the screen cells. Also, each rectangular cell cavity is level filled with the slurry mixture. Because the "walls" that form the rectangular shape of the screen cells are constructed of single curved strands of wire, there is a common mutual joined area of small portions of the liquid slurry volume lumps that are located in adjacent cells. These small joined areas of slurry material exist at the locations in a cell "wall" above and below the wire strands that form the cell "walls". When the slurry lumps are forcefully ejected from the mesh screen cells these portions of liquid slurry that are mutually joined together in the areas of the "wall" wire strands are sheared apart by the stationary wires as both of the slurry lumps are in motion. Cutting of the slurry lumps by the woven wires is somewhat analogous to using a strand of wire to cut a lump of cheese. Some of the slurry portion that was sheared apart by the mesh wires tend to break into small liquid lumps that form into undesirable small liquid slurry spheres. These undersized liquid spheres can be separated by various well known process techniques from the large mold formed slurry lumps. They can be collected for immediate recycling into another mesh screen slurry lump molding event with little or no economic loss.

The mesh screen slurry ejection action produces individual rectangular brick-shaped slurry lumps that are initially separated from adjacent lumps by the width of the screen wires. After leaving the body of the screen, surface tension forces acting on the independent free-space traveling liquid slurry lumps quickly form these irregular shaped lumps into liquid slurry spherical bead shapes. Because the spherical bead shapes are dimensionally smaller than the same-volume slurry distorted-brick shapes, the individual slurry beads are even more separated from adjacent slurry beads that are traveling in a dehydrating fluid.

If a more perfect cell shape is desired than that provided by a woven wire mesh screen, a cell cavity sheet can be formed from a perforated sheet where each of the cell openings has planar or flat-surfaced walls. A preferred cavity hole shape is a cylindrical hole as the cylinder provides a single flat surfaced wall that also has flat ends. This cylindrical shape is easy to level fill with liquid slurry and the hole-contained slurry lumps tend to remain together as a single-pieced lump when it is ejected from the perforated sheet. Here, the volume of the slurry mold cavity can be controlled by either changing the diameter of the hole or by changing the thickness of the perforated metal sheet. The thickness of the perforated sheet can be controlled to provide elongated cavity tubes to improve the stability of the liquid slurry within the tube slurry mold cell. Perforated sheets can be manufactured by punching holes in a sheet metal or in sheets of polymer material, or other sheet material. Sheets that have cavity holes in them can be manufactured by many other production techniques that are all referred to here as perforated sheets. Examples of theses perforated sheets include mechanical or laser drilled sheets, etched metal sheets and electroformed sheet material. In the descriptions of the processes used to form equal sized abrasive beads, and also non-abrasive beads, the bead mold cavity sheets are most often referred as screens but in each case a perforated sheet can also be used in place of the screen sheet, and vice versa. Mesh screen material is very inexpensive and is readily available which makes it economically attractive as compared to perforated sheets, However, the abrasive bead end-product that contains expensive diamond particles can easily make the use of the perforated sheets very attractive economically. Mold cavities having flat-sided walls can be much easier to use in the production of equal sized abrasive beads as compared to the use of open mesh screen material.

The bead droplet dehydration process described here starts with equal sized spherical abrasive slurry bead droplets. In precision-flatness abrading applications, the diameter of the individual abrasive beads that are coated on the surface of an abrasive article are more important than the volume of abrasive material that is contained within each abrasive bead. An abrasive article that is coated with individual abrasive beads that have precisely the same equal sizes will abrade a workpiece to a better flatness than will an abrasive article that is coated with abrasive beads have a wide range of bead sizes. The more precise that the equal sizes of the volumes of the liquid abrasive slurry droplets are the more equal sized are the diameters of the resultant abrasive beads. Any change in the volumes of the abrasive slurry that are contained in the liquid state droplets, that are initially formed in the bead manufacturing process, affect the sizes, or diameters, of the spherical beads that are formed from the liquid droplets. However, as the diameter of a spherical bead is a function of the cube root of the droplet volume, the diameter of a bead has little change with small changes in the droplet volumes. When droplets are formed by level filling the cell holes in mesh screens or a perforated sheets there is the possibility of some variation of the volumetric size of the droplets. These variations can be due to a variety of sources including dimensional tolerances of the individual cell hole sizes in the mesh screens or the perforated sheets that are used to form the equal sized droplets. Also, there can be variations in the level filling of each independent cell hole in the screens or perforated sheets with the liquid abrasive slurry material. The cell hole sizes can be controlled quite accurately and the processes used to successfully level-fill the cell holes with liquid slurry are well known in the web coating industry. As the mesh screen liquid slurry droplet volumes are substantially of equal size, the diameters of the abrasive beads produced from them are even more precisely equal because of the relationship where the volume of the spherical beads is proportional to the cube of the diameter. Abrasive beads described by Howard indicate a typical bead diameter size variation of from 7:1 to 10:1 for beads having an average bead size of 50 micrometers. These beads having a large 7 to 1 range in size would also have a huge 343 to 1 range in bead contained-volume. Beads that are molded with the use of screen sheets that have a bead volume size variation of 10% will only have a corresponding bead diameter variation of only 3.2%. Beads that have a bead volume size variation of 25% will only have a corresponding bead diameter variation of only 7.7%. Beads that have a bead volume size variation of 50% will only have a corresponding bead diameter variation of only 14.5%. Beads that are produced by the 10% volume variation, where some of the beads are 10% larger in volume than the average volume size and some of the beads are 10% smaller in volume than the average volume size, would produce beads that were only 3.2% larger and only 3.2% smaller in diameter than the average diameter of the beads. Here, if the average size of the beads were 50 micrometers, then the largest beads would only be 51.6 micrometers in size and the smallest beads would still be 48.4 micrometers in size (a 1.07 to 1 ratio). This is compared to 50 micrometer averaged sized beads produced by Howard that vary from 20 to 140 micrometers in diameter (a 7 to 1 ratio). The combination of accurately sized cell holes and good-procedure hole filling techniques will result in equal sized liquid abrasive slurry droplets.

Figure 73:
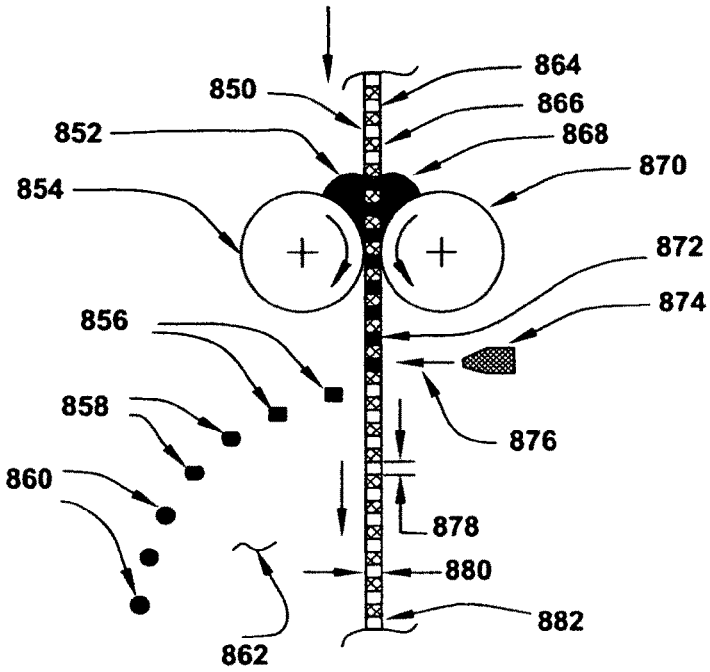
FIG. 73 is a cross-sectional view of a mesh screen abrasive agglomerate manufacturing system using a open mesh screen that is level-filled with an abrasive slurry mixture with nipped rolls.

FIG. 73 is a cross-sectional view of a mesh screen abrasive agglomerate manufacturing system using a open mesh screen that is level-filled with an abrasive slurry mixture with nipped rolls. A open mesh screen or a perforated metal sheet 850 moves in a downward direction between two rotating nipped rolls 870 that force a abrasive slurry mixture 868 into the open screen cells 864 that are adjacent to screen cell walls 866. The cell walls 866 can be either a woven wire or other woven material or can be a perforated metal or other perforated material. The open cells 864 can have a circular shape or can be rectangular or can have a irregular or even discontinuous shape such as formed by a woven wire mesh. Each open cell shape will have a consistent average equivalent cross-sectional area that is shown, in part, by the cell opening dimension 878 as this drawing cross section view is two dimensional where the depth of the open cell 864 is not shown. The thickness of the screen 880 also is the thickness of the open cell 864. The open cell 864 contained volume is defined by the open cell 864 cross-section area which is comprised of the open cell 864 area (not shown) which is comprised of the cell length 878 and the cell depth (not shown) multiplied by the screen thickness 880. The small change in the overall cell 864 volume due to the non-perfect cell wall distortions created by the interleaving of the woven wires that form the cell wall 866 is not significant in determining the volumetric size of the ejected slurry volumes 856 that originate in the slurry filled cells 872 as the ejected volumes 856 would be consistent from cell-to-cell. Precision-sized perforation holes 864 that can be formed in sheet material typically would not have the same amount of hole wall 866 size or surface variation as would a woven wire screen mesh hole. The screen 850 can be in continuous motion which would present slurry filled cells 872 to a fluid nozzle 874 that projects a interrupted or pulsed or steady flow fluid stream 876 against the filled cells 872 that causes lumps of slurry 856 to be ejected from the screen 850 body, thereby leaving a screen section 882 having empty screen cell holes. The slurry lumps 856 travel in a free-fall motion into a dehydrating fluid 862 and surface tension forces acting on the liquid droplet lumps 856 form lumps having a more spherical shape 858 and the drop shape formation continues until spherical shaped 860 slurry droplets are formed before the slurry shape 860 sphere or slurry bead is solidified. The slurry bead forming and ejection process can take place when all or a portion of the apparatus is enveloped in a dehydrating fluid 862 including being submerged in a dehydrating liquid 862 or located within or adjacent to a hot air dehydrating fluid 862. A release liner sheet made of materials including polytetrafluoroethylene (PTFE), silicone rubber, silicone coated paper or polymer, waxed paper or other release liner material can be placed between the rolls 854 and 870 and the mesh screen 850 to prevent adhesion of the abrasive slurry mixture 868 to the roll 854 and roll 870 surfaces by placing the release liner on the surface of the rolls 854 and 870 before the rolls 854 and 870 surfaces contact the liquid dam of slurry mixture 868.

Figure 74:
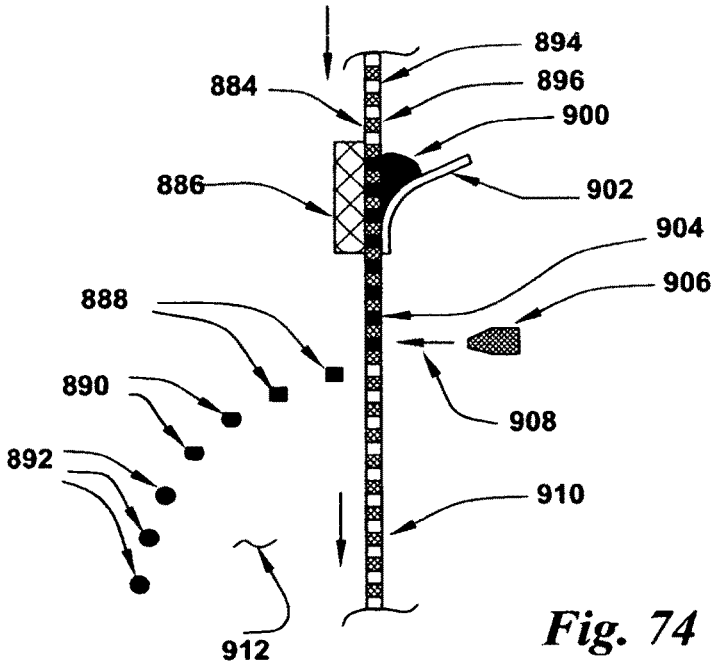
FIG. 74 is a cross-sectional view of a mesh screen abrasive agglomerate manufacturing system using an open mesh screen level-filled with an abrasive slurry mixture with a doctor blade.

FIG. 74 is a cross-sectional view of a mesh screen abrasive agglomerate manufacturing system using a open mesh screen that is level-filled with an abrasive slurry mixture with a doctor blade. A open mesh screen or a perforated metal sheet 884 moves in a downward direction between a doctor blade 902 and a support base 886 that force a abrasive slurry mixture 900 into the open screen cells 894 that are adjacent to screen cell walls 896. The cell walls 896 can be either a woven wire or other woven material or can be a perforated metal or other perforated material. The open cells 894 can have a circular shape or can be rectangular or can have a irregular or even discontinuous shape such as formed by a woven wire mesh. The screen 884 can be in continuous motion which would present slurry filled cells 904 to a fluid nozzle 906 that projects a interrupted or pulsed or steady flow fluid stream 908 against the filled cells 904 that causes lumps of slurry 888 to be ejected from the screen 884 body, thereby leaving a screen section 910 having empty screen cell holes. The slurry lumps 888 travel in a free-fall motion into a dehydrating fluid 912 and surface tension forces acting on the liquid droplet lumps 888 form lumps having a more spherical shape 890 and the drop shape formation continues until the spherical shaped 892 slurry droplets are formed before the slurry shape 892 spheres or slurry beads are solidified. The slurry bead forming and ejection process can take place when all or a portion of the apparatus is enveloped in a dehydrating fluid 912 including being submerged in a dehydrating liquid 912 or located within or adjacent to a hot air dehydrating fluid.

Figure 75:
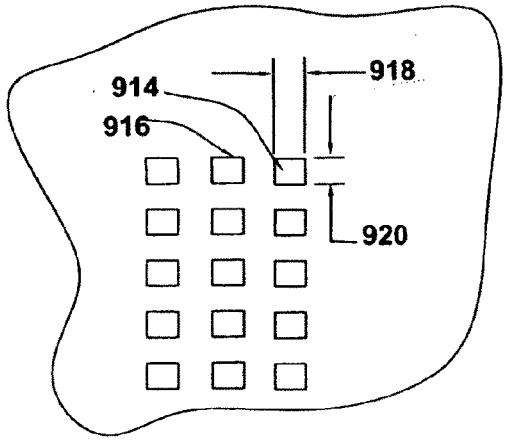
FIG. 75 is a top view of an open mesh screen with a rectangular array of rectangular open cells.

FIG. 75 is a top view of an open mesh screen that has a rectangular array of rectangular open cells 916 that have cross-sectional areas 914 where the areas 914 are equal to the open cell 916 length 920 multiplied by the open cell 916 depth 918.

Figure 76:
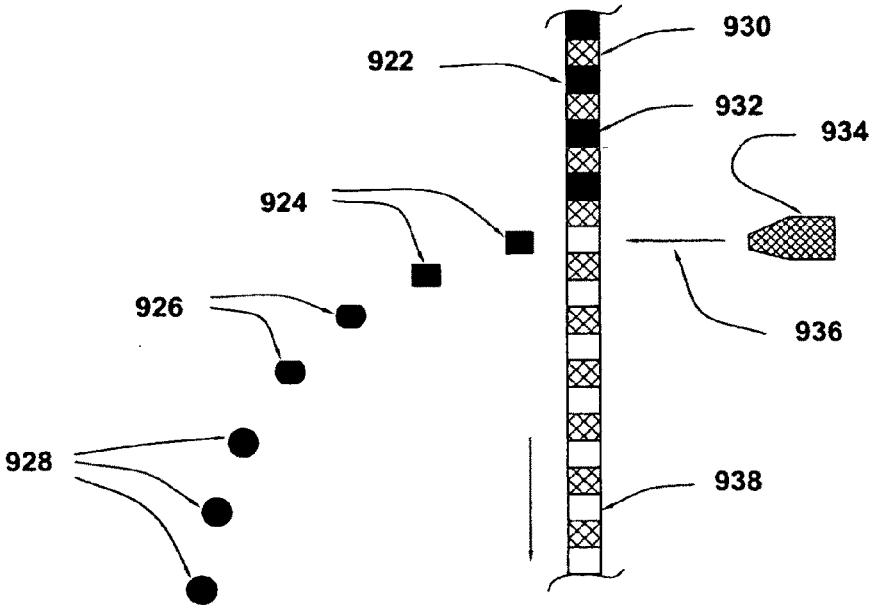
FIG. 76 is a cross-sectional view of an open mesh screen level-filled with an abrasive slurry mixture.

FIG. 76 is a cross-sectional view of an open mesh screen that is level-filled with an abrasive slurry mixture. A open mesh screen or a perforated metal sheet 922 moves in a downward direction where the screen sheet 922 has abrasive slurry mixture filled cells 932 that are adjacent to screen cell walls 930. The screen 922 can be in continuous motion which would present slurry filled cells 932 to a fluid nozzle 934 that projects a fluid stream 936 against the filled cells 932 that causes lumps of slurry 924 to be ejected from the screen 922 body, thereby leaving a screen section 938 having empty screen cell holes. The slurry lumps 924 travel in a free-fall motion where surface tension forces acting on the liquid droplet lumps 924 form lumps having a more spherical shape 926 and the drop shape formation continues until spherical shaped 928 slurry droplets are formed before the slurry shape 928 sphere or slurry bead is solidified.

Abrasive Bead Screen Plunger

Problem: It is desired to create abrasive particle or other material spherical beads that have an equal size by applying a consistent controlled pressure fluid ejection on each liquid bead material cell resulting in uniform sized ejected beads.

When a liquid slurry mixture, of abrasive particles and a colloidal solution of silica particles in water, is introduced into these small screen cell cavities and level filled with the screen two flat surfaces, the cell contained-liquid slurry mixture assumes a stable state. Here, the contained liquid slurry lump tends to attach itself to the screen cell "wall" wire strands. Immediately after the screen cells are level filled with the slurry, the screen can be readily moved about and the slurry lumps remain stable within each screen cell. The bond between the slurry lumps and the wire mesh walls is so great that it is necessary to apply substantial external forces to the slurry lumps in order to dislodge and eject these screen lumps from their screen cells. Care is taken with the application of the slurry lump ejection forces that the slurry lumps remain substantially intact as a single lump during and after the ejection event rather than breaking the original cavity cell lumps into multiple smaller slurry lumps.

Solution: A mesh screen having a screen thickness and open cells where the volume of an open cell thickness and cross-sectional area is approximately equal to the desired volume of a material sphere can be filled with a liquid mixture of abrasive particles and a binder material, including a ceramic sol gel or a resin binder. Nonabrasive material may be used to fill the screen cells also to produce nonabrasive beads. After the screen is surface level filled with the liquid bead material, the liquid in the cells can be ejected from the cells with the use of a plunger plate that traps a fluid between the plate and the screen surface as the plate is rapidly advanced towards the surface of the screen from an initial position some distance away from the screen. The fluid trapped between the plate and the screen can be air, another gas, or preferably a liquid including water, oil dehydrating liquid, dehydrating liquids including different alcohols, or a solvent, or mixtures thereof. The screen is rigidly supported at the outer periphery of the plate cross section area thereby leaving the central portion of the screen open in the screen area section corresponding to the plunger area that allows the individual screen cell material to be ejected from each of the individual cells at the side of the screen opposite of the plunger plate. The fluid material lumps are ejected into hot air or a dehydrating liquid. An enclosure wall positioned on the outer periphery of the plunger plate is held in contact with the screen surface and acts as a fluid seal for the plunger and results in a uniform fluid pressure being applied to the material in each cell whereby the ejection force is the same on each cell material. Air is compressible so the fluid ejecting pressure will build up as the plunger advances until the cell material is ejected. A liquid fluid is incompressible and has more mass than air so the speed that the cell material is ejected is controlled by the plunger plate advancing speed and a uniform fluid pressure would tend to exist even when a few cells become open in advance of other cells. The plunger plate can be circular or rectangular or have other shapes. Cell material may be ejected into either an air environment or ejected when the material is submerged in a liquid vat. In either case, surface tension on the ejected material lump produces a spherical material shape.

Figure 77:
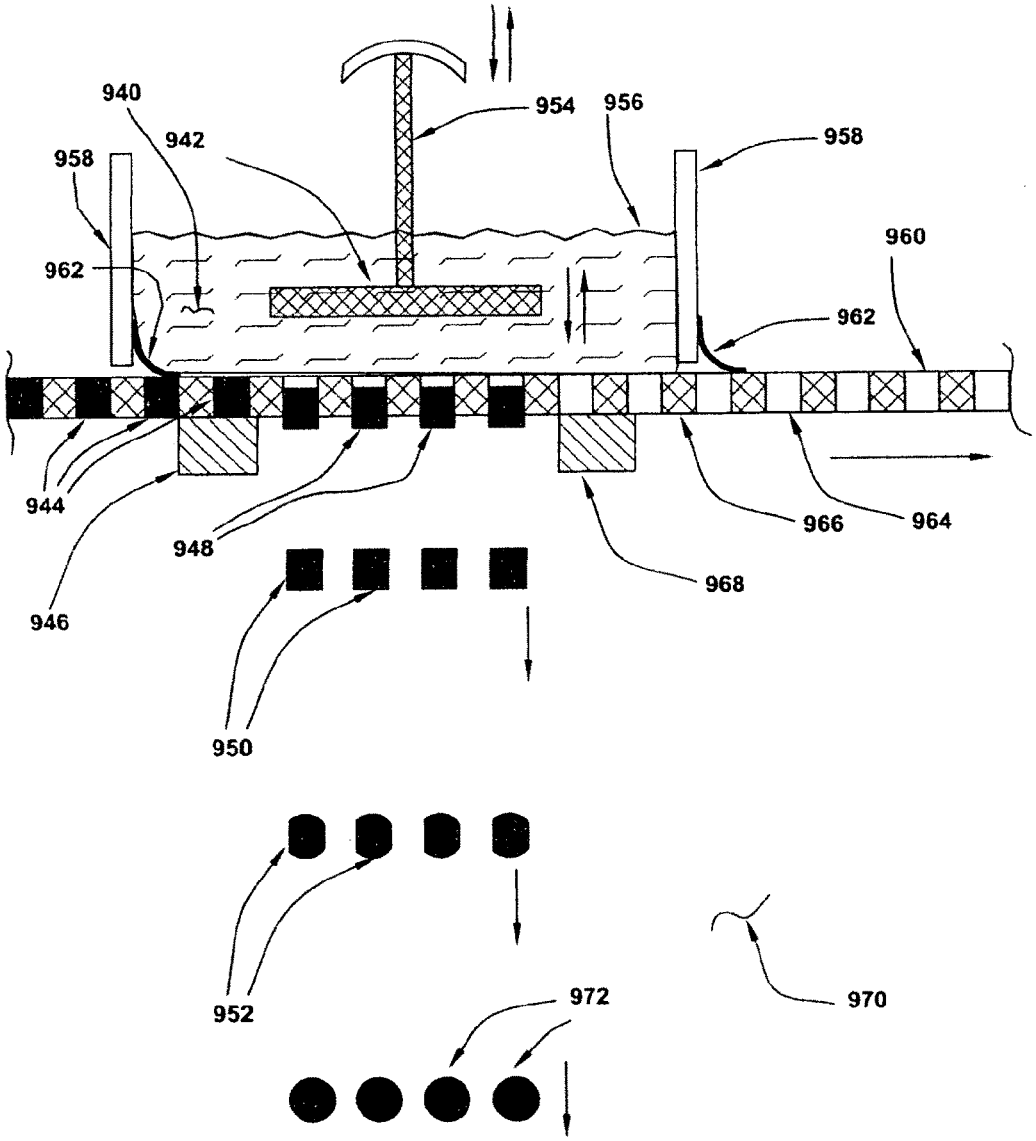
FIG. 77 is a cross-section view of a screen slurry lump plunger mechanism ejector that is used to form equal sized abrasive or non-abrasive spherical beads.

FIG. 77 is a cross-section view of a screen slurry lump plunger mechanism ejector that is used to form equal sized abrasive or non-abrasive spherical beads. A screen 960 moves along two screen support bars 946 and 968 where abrasive or non-abrasive slurry volume lumps 948 are ejected from the screen 960 having mesh screen wires 966 that divide screen openings 964 by driving a plunger 954 having a plunger plate 942 from a controlled distance above the screen 960 toward the screen 960 until the plunger plate 942 is in close proximity to the screen 960 surface. A wire mesh screen 960 is shown but a perforated sheet could also be used to form the same abrasive or non-abrasive spherical beads 972 in place of the wire mesh screen 960. Slurry volume lumps 948 are shown partially ejected from the screen 960. The lump ejecting fluid 940, located between the plunger plate 942 and the screen 960, is driven vertically toward the horizontal screen 960 by the plunger plate 942 as some of this fluid 940 is trapped between the plunger plate and the screen 960 surface as the plate 942 descends. The ejecting fluid 940 is shown here as a liquid but it can be either a liquid or it can be a gas, the gas including air. The liquid ejecting fluid 940, has a free-fluid liquid surface 956 and is contained by the shown fluid walls 958 and other walls not shown, where the shown walls 958 have flexible wiper fluid seals 962 that contact the screen 960 and prevent substantial loss of the fluid 940 from the wall 958 fluid container. The moving plunger 942 develops a fluid 940 dynamic pressure between the plunger plate 942 and the screen 960 and this fluid pressure drives the slurry lumps 948 from the screen 960 to form ejected liquid slurry lumps 950 that free-fall travel downward within a dehydrating fluid 970 environment. The dehydrating fluid 970 includes hot air or a dehydrating liquid. As the slurry lumps 950 travel in the dehydrating fluid 970, surface tension forces on the liquid lumps 950 rounds them into semi-spherical lumps 952 that are further rounded into spherical lumps 972. The screen support bars 946 and 968 provide structural support to the section of flexible screen 960 that extends across the width of the plunger plate 942 and which screen section is subjected to the fluid 940 dynamic pressure exerted by the moving plunger plate 942. The bar 946 also tends to shield or protect the other non-plunger-screen area remote-location slurry lumps 944 that are contained in screen mesh cells that are located upstream of the bar 946 within the moving screen 960 body from the plunger plate 942 induced fluid 940 pressure. The bar 946 shields the ejecting action of the sides of the moving plunger plate 942 by preventing this ejection fluid flow through the screen 960 in the protected screen 960 areas and tends to prevent these remote-location slurry lumps 944 located in the protected areas from being partially or wholly ejected from the screen 960. The plunger plate 942 movement is preferred to be limited to only that excursion which is required where the fluid 940 is driven downward to successfully eject the slurry lumps 948 from the screen 960. If the ejecting fluid 940 is a liquid, only a limited amount of the stationary liquid will leak through the screen 960 into the dehydrating fluid 970 region as the typical screen openings 964 are small enough that the liquid will not freely pass through the screen 960 unless driven by the plunger 942. Here, a typical very fine 325 mesh screen can be used to produce very small sized liquid-state precursor abrasive or non-abrasive beads due to the fact that the mesh cell openings in the screen 960 are only 45 micrometers (0.002 inches). The mesh sizes in the screens, or the through-hole sizes in a perforated font sheet, are selected to produced oversized liquid-state ejected abrasive slurry lumps that will form oversized liquid-state spherical beads to compensate for the bead shrinkage that takes place when the beads are dehydrated and are heat treated to form abrasive particle beads. If the fluid 940 is air or another gas, the volume of gas that passes through the screen 960 with each plunger plate 942 action is small compared to the typical volume of the dehydrating fluid 970, which can be either a liquid or gas, and will not disrupt the dehydrating action of the slurry dehydrating fluid 970 system. The ejecting downward motion speed of a plunger plate 942 can be slower with a liquid ejecting fluid 940 as compared with a gaseous ejecting fluid 940 because the viscosity and mass of the liquid is greater than that of a gas and the impinging liquid will more easily eject lumps 948 from the screen 960 than will a gaseous fluid 940. Screens 960 having larger mesh openings can also be used to produce larger sized slurry beads and ejecting fluid 940 leakage into the dehydrating fluid 970 can be minimized by the use of narrow plunger plates 942.

Compare Abrasive Beads with Abrasive Pyramid Shapes

FIGS. 89-108 are used to describe the comparative difference in abrasive wear-down between an abrasive lapping sheet that is coated with abrasive beads and particularly one that is coated with pyramid abrasive structures. These figures show why the beads that have most of their contained volume of abrasive particle raised from the surface of the backing offer the great advantage of avoiding contact of the workpiece with the backing material as an abrasive article wears down or when a platen has slight out-of-plane height variations. Pyramid structures have an inherent disadvantage for these two conditions because most of the abrasive particles contained in the pyramid shape reside at the pyramid base immediately adjacent to the backing surface. In order to completely utilize most of the pyramid-contained abrasive particles, the pyramid has to be completely worn down which results in undesirable contact of the workpiece with the backing.

Primitive Shapes of Abrasive Coatings

Problem: It is desired to optimize the primitive shapes of the abrasive coatings that are attached to abrasive articles for high speed flat lapping.

Solution: Abrasive particles can be coated on raised island abrasive articles or on to non-island abrasive articles in a number of primitive shapes.

FIGS. 89-108 show different primitive abrasive coating shapes that can be used to coat either raised island abrasive articles or non-island flat abrasive backing sheets when using expensive small sized diamond abrasive particles for use in a high speed flat lapping abrading process. Typical diamond abrasive particles used for this purpose have a size range from 0.1 micrometers to 15 micrometers. These diamond abrasive particles are comparatively shown as encapsulated in a number of different primitive shapes including: spherical beads, individual pyramids, arrays of nested pyramids and a uniform coating of the diamond particles contained in a binder adhesive. The typical size of the diamond particle abrasive beads that are used in this lapping process have a diameter of 0.002 inches (45 micrometers) which is a small size compared to the abrasive particle sizes that are used in conventional non-lapping abrading processes. The largest portion of the manufacturing costs that are associated with the production of these abrasive articles is the cost of the diamond particles that are used. For this reason, all of the primitive shapes that are compared here have the same quantity of the diamond abrasive particles coated per unit area of the abrasive article surface.

Most of FIGS. 89-108 show the primitive shapes as attached to raised island surfaces but the same primitive shapes can be attached to non-island abrasive articles to make the same types of comparisons. As can be seen from the figures, there are many distinct advantages to the use of abrasive beads as compared to the other primitive shapes. First, beads are easy to handle and control during manufacturing where the desired monolayers of beads are coated on island surfaces or on to non-island abrasive articles. Second, the beads allow the abrasive article to be run-in during initial abrading operations without a significant loss of the expensive diamond particles. Third, the abrasive beads are the most forgiving to undesirable variations in the flatness of platens that tend to vary when operated at high lapping speeds. Because the as-new coating of the diamond abrasive is so thin (only 0.002 inches or 45 micrometers) and because this coating wears to a even much smaller size during the abrading life of the abrasive article, it is required that the lapping machine platen operate with extremely small flatness variations. Lapping machines that have the large sized platens to accommodate the desired 12 to 36 inch diameter abrasive lapping disks presented here and yet provide the required flatness tend to be expensive. If the platens are not precisely flat, the expensive lapping abrasive disks are typically destroyed and must be discarded at great economic loss. The use of abrasive beads reduces this platen-induced loss of abrasive disk articles as compared to the other primitive shapes. Fourth, the undesired hydroplaning effects of using the required water coolant at high abrading speeds during a lapping process is significantly reduced with the use of abrasive beads as compared to the other primitive abrasive shapes.

Figure 89:
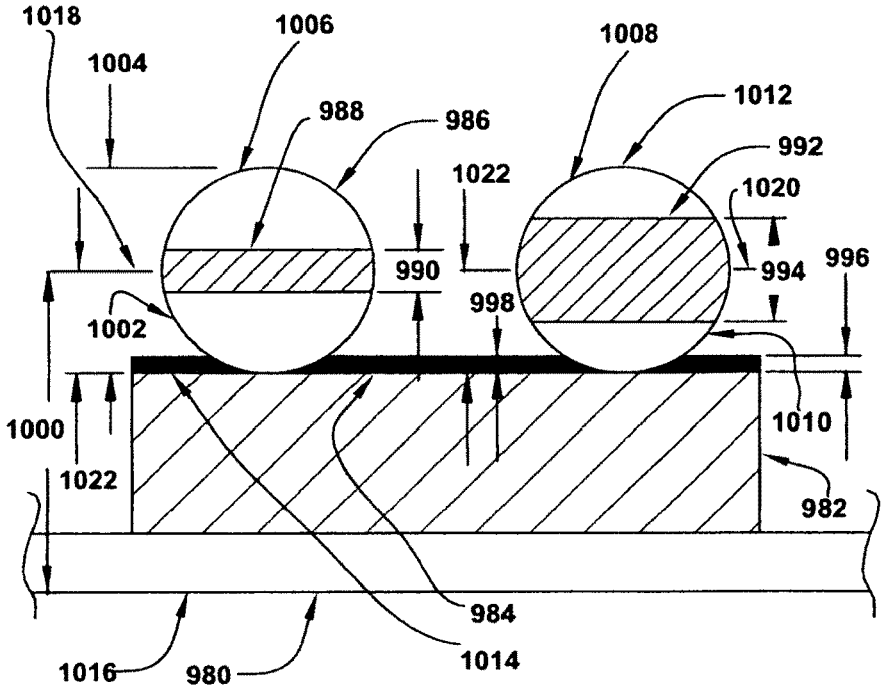
FIG. 89 is a cross-sectional view of a raised island abrasive article that is coated with equal sized abrasive beads.

FIG. 89 is a cross-sectional view of an abrasive article 1016 that has attached raised islands 982 having horizontal flat top surfaces 1014 that are coated with equal sized abrasive beads 986, 1012.

Each bead 986, 1012 contains abrasive particles (not shown) that are typically made of diamond materials. A backing sheet 980 has attached raised islands 982 that are coated with a polymer binder 984 that has a binder thickness 996. Equal sized abrasive particle filled spherical beads 986, 1012 are attached to the raised islands 982 by the polymer binder 984 where the binder 984 contacts the abrasive beads 986, 1012 lower portion up to a distance 998. The distance 998 is measured from the portion of the beads 986, 1012 that contacts the raised island 982 upper flat surface 1014 to an elevation on the beads 986, 1012 that extends upward on the bead the distance 998. Each of the beads 986, 1012 has an equal sized diameter 1004 and the centerlines 1018, 1020 of these spherical beads 986, 1012 are located a distance 1000 from the backside of the backing sheet 980. The spherical bead 986 is shown with a bead-body center section 988 that has a vertical band having a band thickness 990 that is equal to 20% of the bead diameter 1004 where the abrasive particle material contained in the vertical band section 988 is 30% of the total abrasive material that is contained in the bead 986. A typical abrasive bead 986 size or diameter 1004 that is coated on a fixed-abrasive article 1016 used in abrasive lapping is approximately 44 micrometers (0.0017 inches). This 44 micrometers (0.0017 inches) size is obtained by mesh screen selection processes where all of the beads that pass through the openings in an abrasive industry standard 325 size mesh screen are coated on a abrasive article 1016. Beads 986 that are smaller in diameter 1004 than 44 micrometers don't provide enough of the typically used small 3 micron (0.0001 inch), or smaller, abrasive particles to provide sufficient abrading life to an abrasive article 1016. Beads 986 that are larger than 44 micrometers in diameter 1004 may not provide sufficient flatness to the abrasive article 1016 after the article is partially worn down; however, these larger-than 44 micron sized beads 986 can be used, if desired, on an abrasive article 1016. Equal sized abrasive beads that are larger than 44 micrometers are practical to manufacture by the process described in this present invention because the individual beads are mold-formed from equal-volume mold cells that are filled with a liquid abrasive slurry mixture. Other methods of producing these larger sized beads 986, as described in U.S. Pat. No. 3,916,584 (Howard) and U.S. Pat. No. 6,645,624 (Adefris, et al.) tend to also produce significant quantities of undesirable smaller-sized abrasive beads 986 that have little, if any, utility when coated on an abrasive article 1016 along with the desired larger sized abrasive beads 986. A polymer backing sheet 980 having a backing thickness of 0.004 inches (102 micrometer) is typically used to manufacture non-island abrasive disk articles that are used in lapping.

Examples are given here to illustrate the abrasive system precise flatness that is required to abrasively lap a workpiece with a raised island abrasive sheet disk article. The abrasive sheet article 1016 must initially have a very precise uniform thickness over the whole abrasive surface of the article. Then the abrasive sheet article 1016 must be progressively worn down uniformly across the whole abrasive surface of the article. If the article 1016 is worn down evenly across the whole abrasive surface, the abrasive article 1016 can be used to abrade a workpiece and then the article 1016 can be removed from a platen for multiple reuse at later times. If the abrasive article 1016 is not evenly worn down, it can not be reused for flat lapping and must be discarded, which results in a significant economic loss as diamond particle coated abrasive articles 1016 are expensive. It is always necessary to use the precision thickness abrasive articles 1016 on abrasive equipment platens that provide a flat abrasive sheet-mounting surface that remains flat at full platen operating speeds.

There are three approximately equal volumetric amounts of the abrasive particles in bead 986, which is shown with three separate band segments that were arbitrarily sized to illustrate the large amount of abrasive particles that are contained at the center portion of a bead 986. Most of the volume of a spherical shape is concentrated at the equator of the sphere. A narrow band located at the sphere equator region contains more particles than does a relatively wide band located at the pole regions of the sphere. Consumption of most of the bead 986 contained volume of abrasive particles that are located near the equator of the spherical bead 986 is a function of the very small bead 986 dimensional size changes that occur as the bead 986 is worm down. Specifically, the original unworn bead 986 central band segment 988 contains 30% of the total abrasive particles that are contained in the non-worn bead 986 and both the upper and lower bands segments each contain 35% of the total abrasive particles. The non-worn size 1004 of the bead 986 is 50 micrometers (0.002 inches) and the central band segment 988 has a band segment width 990 that is only 10 micrometers (0.0004 inches).

Bead 1012 has a wider central band segment width 994 than the bead 986 central band segment width 990. Here, bead 1012 is divided into band segments where the central band segment 992 is one half of the diameter 1004 of the bead 1012 and the upper and lower band segments each have band segment widths that are equal to one quarter of the bead 1012 diameter size 1004. In bead 1012, most of abrasive particles reside in a central band segment 992 that is located at the bead 1012 equator and there are only a limited amount of abrasive particles that reside in the upper and lower band segments that are located at the spherical bead 1012 polar regions. Specifically, the original unworn bead 1012 central band segment 992 contains 69% of the total abrasive particles that are contained in the non-worn bead 1012 and both the upper and lower bands segments each contain 15% of the total abrasive particles. The non-worn size 1004 of the bead 1012 is 50 micrometers (0.002 inches), the same size 1004 as the bead 986, and the central band segment 992 has a band segment width 994 that is 25 micrometers (0.001 inches). It is even more apparent with this bead 1012 how critical it is when small dimensional changes to the bead 1012 take place during bead 1012 wear-down. If a platen has defective areas that are out-of-flat by only 0.001 inches (25 micrometers) or if an abrasive article 1016 has defective areas where the thickness varies by only 0.001 inches (25 micrometers) then the beads 1012 located in these "high positioned" defective areas can lose 69% of their abrasive particles when these beads 1012 contact a flat workpiece. Or, most (69%) of the abrasive particles contained in the "low positioned" abrasive beads 1012 in these defective areas will not even contact an workpiece surface.

In the first example, the relative original size of a typical abrasive bead 986 diameter 1004 is compared to the bead 986 dimensional size change that occurs when a bead 986 experiences a loss of 30% of the original abrasive particles that are enclosed in the bead 986 center band 988. Very little dimensional wear-down has to occur for the bead 986 to lose 30% of its abrasive particles. This small change of bead 986 wear-down that produces such a large loss of the abrasive particles is due to the fact that most of the bead 986 abrasive particles are contained at the location at the central portion of the spherical shaped bead. If the bead 986 diameter 1004 is 50 micrometers (0.002 inches), then the total thickness 990 of the central band 988 containing 30% of the original bead 986 particles of abrasive material is only 10 micrometers (0.0004 inches) and the center line 1018 is located a distance 1022 that is 25 micrometers (0.001 inches) above the island 982 top surface 1014. The top surface of the central band 988 is only 5 micrometers (0.0002 inches) from the geometric centerline 1018 of the bead 986 where the centerline 1018 is located at a distance 1000 from the backside of the backing 980. Likewise, the bottom surface of the band 988 is only 5 micrometers (0.0002 inches) from the geometric centerline 1018 of the bead 986. Here, a significant portion of the abrasive material (30%) is contained within a distance that is only 5 micrometers (0.0002 inches) from the geometric center 1018 of the bead 986. In order for this central portion 988 of the bead 986 abrasive containing 30% of the total of all of the abrasive bead 986 material to be abraded away uniformly across all of the beads 986, 1012 that are coated on, or attached to, the islands 982 flat top surfaces 1014 (other islands not shown), the abrasive article 1016 must have a very precise narrow tolerance of the variation of the bead 986 center location distance 1000, typically where the desired allowable variation of the distance 1000 is less than 0.0001 inch (2.5 micrometers). Not only must the diameter 1004 of the beads 986, 1012 be controlled to be equal sized, the height of the raised islands 982 and the beads 986, 1012 centerline distances 1000 must be precisely controlled. Also, the surface flatness of a platen (not shown) must be held to variation tolerances that are approximately less than 0.0001 inch (2.5 micrometers) as the platen rotates, in order to provide precision flat lapping with these abrasive articles 1016. The very precise abrasive article 1016 thickness tolerances that are required can only be held by using very precision manufacturing techniques which are not required, or used, to produce raised island abrasive disk articles that are typically used for manually-held abrasive disk grinders.

Another example is given here, as also shown in FIG. 89, to illustrate the relative original size of a typical abrasive bead 1012 diameter 1004 is compared to the bead 1012 dimensional size change that occurs when a bead 1012 experiences a loss of 69% of the original abrasive particles that are enclosed in the bead 1012. Very little dimensional wear has to occur for the bead 1012 to lose 69% of its abrasive particles. This small change of wear-down that produces such a large loss of the abrasive particles is again due to the fact that most of the bead 1012 abrasive particles are contained at the location at the central portion 992 of the spherical shaped bead 1012. If the bead 1012 diameter is 50 micrometers (0.002 inches) then the total thickness 994 of the central band 992 containing 69% of the original bead 1012 particles of abrasive material is only 25 micrometers (0.001 inches) and the center line 1020 is located a distance 1022 that is 25 micrometers (0.001 inches) above the island 982 top surface 1014. The top surface of the central band 992 is only 12 micrometers (0.0005 inches) from the geometric centerline 1020 of the bead 1012 where the centerline 1020 is located at a distance 1000 from the backside of the backing 980. Likewise, the bottom surface of the band 992 is only 12 micrometers (0.0005 inches) from the geometric centerline 1020 of the bead 1012. Here, a significant portion of the abrasive material (69%) is contained within a distance that is only 12 micrometers (0.0005 inches) from the geometric center 1020 of the bead 1012. In order for this central portion 992 of the bead 1012 abrasive containing 69% of the total of all of the abrasive bead 1012 material to be abraded away uniformly across all of the beads 1012 that are coated on the islands 982 flat top surfaces 1014 (other islands not shown), the abrasive article 1016 must have a very precise narrow tolerance of the variation of the bead 1012 center location distance 1000, typically where the desired allowable variation of the distance 1000 is less than 0.0001 inch (2.5 micrometers). Not only must the diameter 1004 of the beads 1012 be controlled to be equal sized, the height of the raised islands 982 and the beads 1012 centerline distances 1000 must be precisely controlled; and the rotating flatness of a platen (not shown) must be held to variation tolerances that are approximately less than 0.0001 inch (2.5 micrometers) in order to provide precision flat lapping with these abrasive articles 1016. Again, these very precise abrasive article 1016 thickness tolerances that are required can only be held by using very precision manufacturing techniques which are not required, or used, to produce raised island abrasive disk articles that are typically used for manually-held abrasive disk grinders.

When abrasive beads 986 that are attached to an abrasive article 1016 are abraded away, it is important that all of the individual beads 986 that are coated on all of the individual raised islands 982 are worn down an equal amount to provide uniform abrasion of a workpiece (not shown) surface that is in abrading contact with the abrasive article 1016. If some of the beads 986 are worn down too much, these worn-down beads 986 will not provide sufficient abrading action to that portion of the workpiece that they contact during the abrading process. If only a select few of the beads 986 are located in positions where only they are in contact with a workpiece, these few beads 986 will provide very aggressive abrading action to the localized portion of the workpiece that they contact during an abrading process, resulting in uneven wear of a workpiece surface. To achieve uniform abrasion or material removal of a workpiece surface, the whole abrasion system must provide near-equal sized abrasive beads that are presented in a common plane with uniform pressure against a workpiece flat surface. This uniform-wear system requires precise thickness abrasive articles 1016 having equal height abrasive raised islands 982 that are coated with equal sized abrasive beads 986 where the abrasive articles 1016 are mounted on a flat platen (not shown).

Abrasive articles 1016 are typically used repetitively on the same platen to abrade different workpieces at different process times. This requires that an abrasive article experience uniform wear across its surface so that the article 1016 can be used to abrade a workpiece, then be removed from the platen and later, re-mounted at a random position on the same platen, or a different platen, and continue to provide uniform abrasion to a different flat workpiece surface. In the example shown here, a good portion (30%) of the original abrasive particles (not shown) that are contained within the typical-sized abrasive beads 986 are located within a thickness 990 band that is very narrow, having a total top-to-bottom dimension of only 10 micrometers (0.0004 inches). When these beads 986 experience wear at the bead centerline 1018 of only 10 micrometers (0.0004 inches), then a full 30% of the bead 986 abrasive particles are expended by this very small amount of abrasive article 1016 wear-down. Wear of only 10 micrometers (0.0004 inches) is so small that these abrasive article 1016 wear-variations are even difficult to accurately measure with the use of measurement devices that are typically used in a production abrading process environment.

It is necessary to expend great care to provide both an abrasive article and abrasive lapping equipment that can provide the precision control of the abrading process to utilize all of the abrasive material that is coated on an abrasive article 1016 and also, to abrade flat surfaces that are abraded to be uniform across the full surface of workpieces. Use of precision-thickness 1000 abrasive articles 1016 on a non-flat platen will not provide full utilization of all the abrasive particles that are coated on an abrasive article 1016 and also, will not produce workpieces that have flat surfaces across the whole workpiece surface. Likewise, use of a precision flat platen that is used with abrasive articles 1016 that do not have precision thickness 1000 control will not provide full utilization of all the abrasive particles that are coated on the abrasive article 1016 and also, will not produce workpieces that have flat surfaces across the whole workpiece surface. Here, it can be seen that a precision abrading system is required where the system is comprised of both precision thickness abrasive articles 1016 that are coated with equal sized abrasive beads 986 and precision-flatness rotating platens. The abrasive articles 1016 are assumed here to have precision thicknesses if the precisely equal sized abrasive beads 986, 1012 centerlines 1018, 1020 have precisely equal distances 1000 as measured to the back mounting side of the backing 980.

In both examples presented here, the abrasive beads 986 and 1012 are both of equal size and both beads 986 and 1012 are coated on the top surface 1014 of the raised islands 982 that have equal heights, where the heights are measured from the backside of the backing 980. In the first example, it is shown how close the required flatness control tolerance of the complete abrading system is to fully utilize the 30% of the original abrasive particles that are contained within the beads 986. In the second example, it is also shown how close the required flatness control tolerance of the complete abrading system is to fully utilize the 69% of the original abrasive particles that are contained within the beads 1012. It is easily seen from the FIG. 89 that the flatness tolerance of the abrasive article 1016 and the abrading equipment both require extreme control to effectively use these types of abrasive articles 1016 in a high speed precision flat lapping of workpiece surfaces.

The upper portion 1006 of the abrasive bead 986 that is located above the middle portion 988 of the bead 986 contains 35% of the abrasive material that is contained in the whole bead 986. The lower portion 1002 of the abrasive bead 986 that is located below the middle portion 988 of the bead 986 contains 35% of the abrasive material that is contained in the whole bead 986.

The upper portion 1008 of the abrasive bead 1012 that is located above the middle portion 992 of the bead 1012 contains only 15% of the abrasive material that is contained in the whole bead 1012. The lower portion 1010 of the abrasive bead 1012 that is located below the middle portion 992 of the bead 1012 also contains only 15% of the abrasive material that is contained in the whole bead 1012. In abrading use, the small amount of abrasive material that is contained in the upper portion 1008 of abrasive beads 1012 is quickly expended during the time that a abrasive article 1016 is first contacted by the surface of a workpiece. The top curved surface area of the bead 1012, that is located at the apex of the spherical bead 1012, which is in the initial contacts a workpiece is very small because of the spherical shape of the bead 1012. It is necessary for the top curved surface of the bead 1012 to be worn down somewhat to expose the abrasive particles that are contained within the envelope of the abrasive bead 1012. Very little material is removed from a workpiece surface during the event where the initial workpiece contact is made with the abrasive beads 1012. By the time that the beads are worn down sufficiently that enough abrasive particles are exposed at each of the beads 1012 that significant workpiece abrading action is taking place, then a good portion of the upper portion 1008 is worn away. At this time, only 15% of the total abrasive particles that are enclosed within the beads 1012 are consumed and the 50 micrometer (0.002 inch) diameter bead 1012 has been worn down only by 0.0005 inches (12 micrometers). When the bead 1012 is worn to the top surface of the upper portion 992 of the bead 1012 then consistent and effective abrading action of the abrasive article 1016 takes place. In order for all the abrasive beads 1012 that are coated on the island 982 top surfaces 1014 to be evenly worn down initially in the abrasive article 1016 surface conditioning event, then it is necessary that all of the equal sized beads 1012 have the same elevation from the backside of the backing 980 and the abrasive article 1016 is mounted on a platen that provides a very precise flat mounting surface for the abrasive article 1016.

Most of the abrasive particles contained within the bead 1012 envelopes lie in the portion of the bead 1012 that is below the upper portion 1008. However, when the abrasive article 1016 is almost worn out, the beads 1012 are abraded below the center portion 992 into the lower portion 1010. Then at the end of the abrading life of the abrasive article 1016, it becomes likely that some of the workpiece surface sections will contact the surface 1014 of the island 982 structure. This undesired contact occurs because even the upper part of the lower portion 1010 is located at a distance that is only 0.0005 inches (12 micrometers) away from the top surface 1014 of the island 982 structure. The slightest variation in the thickness of the abrasive article 1016 or variation of the raised island 982 heights or variations in the dynamic flatness of the platen, when rotated at high speeds, or non-flat portions of the workpiece surface can cause workpiece contact with some portions of the islands 982 top surfaces. Most of the abrasive particles are contained in the central band 982, which is only 0.001 inches (25 micrometers) thick for a 50 micrometer (0.002 inch) diameter bead 1012. The abrading system must be capable of providing repetitive use of these abrasive articles 1016 where uniform wear is experienced across the flat surface of workpieces, and also, where flat surface wear is experienced across the flat surfaces of the abrasive article 1016.

Figure 90:
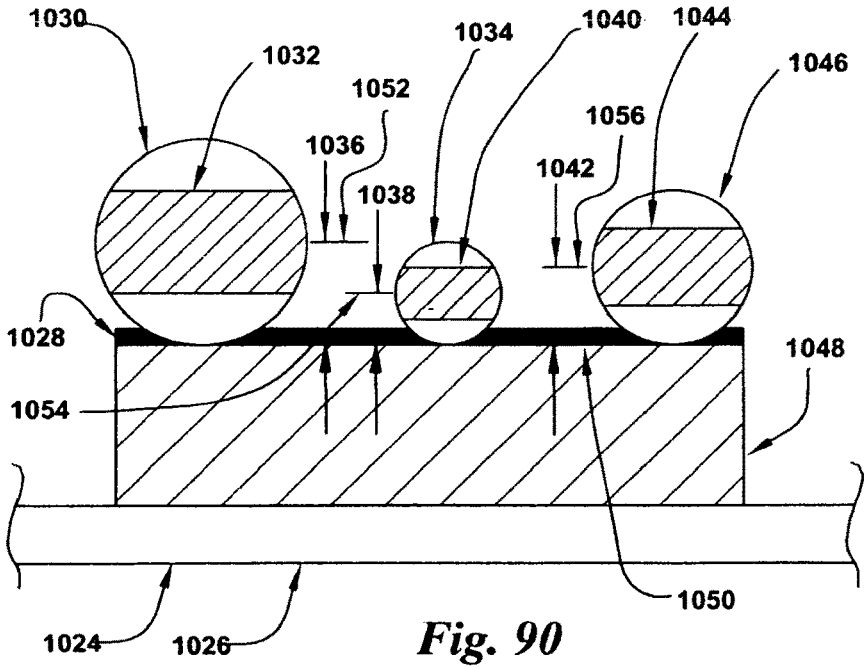
FIG. 90 is a cross-sectional view of a raised island abrasive article that is coated with different sized abrasive beads.

FIG. 90 is a cross-sectional view of an abrasive article 1024 that has attached raised islands 1048 having horizontal flat top surfaces 1050 that are coated with different sized abrasive beads 1030, 1034 and 1046. The thickness of the central portions of each of the different sized beads 1030, 1034 and 1046 are each equal to one half of the respective bead diameters and therefore, the volumetric amount of the abrasive particles (not shown) that are contained in these central portion segments equal 69% of the total volume of the abrasive particles that are contained in the respective non-worn beads 1030, 1034 and 1046. The centerlines of each bead 1030, 1034 and 1046 central segment are also the centerlines of the bead diameters. Showing the individual centerlines of the beads central segments allow a visual appraisal of how the bulk of the abrasive particles in each of the different sized beads 1030, 1034 and 1046 sequentially wear down during an abrading process. Here, it can be seen that the different sized beads 1030, 1034 and 1046 do not have individual significant simultaneous contributions to the abrading process as the abrasive article 1024 wears down. Most of the workpiece (not shown) material removal is generated by the abrading action by the largest beads 1030. The undersized beads 1046 generate much less material removal. The small beads 1034 generate very little material removal. Those abrasive surface areas on an abrasive article 1024 that contain the full sized abrasive beads 1030 provide aggressive abrading action. However, those abrading surface areas on an abrasive article 1024 that contain the undersized abrasive beads 1046 and small sized abrasive beads 1034 provide substantially reduced or little abrading action. The to-scale views of the abrasive beads 1030, 1034 and 1046 illustrate that most of the abrasive particles that are contained in the central segment of a full sized bead can be fully consumed before little, if any, of the abrasive particles that are located in the central segments of small sized beads is utilized in a flat lapping abrading process. Abrasive bead 1030 is full-sized and bead 1034 is one half the size of the full sized bead 1030. The undersized bead 1046 is three quarters the size of the full sized bead 1030. The bead 1030 has a centerline 1052, bead 1034 has a centerline 1054 and bead 1046 has a centerline 1056.

The full sized bead 1030 has a central portion segment 1032 that contains 69% of the non-worn bead 1030 abrasive particles and the centerline 1052 of both the bead 1030 and the central segment 1032 is positioned a distance 1036 above the raised island 1048 flat top surface 1050. The small bead 1034 has a central portion segment 1040 that contains 69% of the non-worn bead 1034 abrasive particles and the centerline 1054 of both the small bead 1034 and the central segment 1040 is positioned a distance 1038 above the raised island 1048 flat top surface 1050. The undersized bead 1046 has a central portion segment 1044 that contains 69% of the non-worn undersized bead 1046 abrasive particles. The centerline 1056 of both the undersized bead 1046 and the central segment 1044 is positioned a distance 1042 above the raised island 1048 flat top surface 1050. The small bead 1034 centerline distance 1038 is equal to 0.5 the full-sized bead 1030 centerline distance 1036. The undersized bead 1046 centerline distance 1042 is equal to 0.75 the full-sized bead 1030 centerline distance 1036. The beads 1030, 1034 and 1046 are all attached by the polymer binder 1028 to the raised islands 1048 top flat surfaces 1050.

For comparative purposes here three different sized beads are shown. One bead has a full sized diameter, the second bead has a three-quarter-sized diameter and the third bead has a half-sized diameter. For reference, the contained volume of the full-sized bead 1030 is considered to be a unity-sized volume. For comparison, the contained volume in the three-quarter quarter sized (undersized) bead 1046 is only 42% of the volume of bead 1030. For further comparison, the contained volume in the half-sized (small) bead 1034 is only 12% of the volume of the full-sized bead 1030. Here, the three beads 1030, 1034 and 1046 all have sizes that appear visually to be only somewhat different in size. It can easily be assumed, in error, that the two smaller beads 1034 and 1046 both have substantial utility in an abrading process when the larger full-sized bead 1030 wears down. However, the three-quarter-sized (undersized) bead 1046 contains less than half of the abrasive particles than the full-sized bead 1030. Also, the centerline 1056 of the undersized bead 1046, a location where most of the abrasive bead 1046 particles reside, is substantially lower than the centerline 1052 of the full-sized sized bead 1030. Much of the abrasive particles in the full-sized bead 1030 has to be exhausted before the bulk of the abrasive particles in the undersized bead 1046 are utilized. When non-equal sized abrasive beads are simultaneously worn down, the abrading characteristics of different abrading areas of the abrasive article 1024 change when the large abrasive beads 1030 are worn down and the smaller beads 1046 and 1034 are exposed and they independently enter the abrading action. Prior to partial wear down of the large full-sized beads 1030, neither the undersized size bead 1046 or the very small bead 1034 were active at all in the abrading process. One half of the large full-sized bead 1030 has to wear away before even the very top surface of the small bead 1034 becomes engaged in the flat abrading process. Further, when the small bead 1034 is first engaged, only the top segment of this small bead 1034 presents abrasive particles to a workpiece surface. The amount of abrasive particles that are present in this upper segment of the small bead 1034 is a very small percentage of the total particles that are present in an un-worn small bead 1034. Further, the total number of abrasive particles in the whole non-worn small bead 1034 is insignificant relative to the number of abrasive participles that are present in an non-worn full sized bead 1030. Here, the total of all of the abrasive particles contained in the non-worn small bead 1034 is only 12% of the total abrasive particles that were contained in a non-worn full sized bead 1030. Even though, the undersized beads 1046 and the small beads 1034 are present on the abrading surface of the abrasive article 1024, their presence is simply cosmetic for the user. They have very little abrading utility. They also change the abrading characteristics of the abrasive article 1024 as the article 1024 wears down, and these undersized beads become engaged in the abrading process while the abrading contribution of the full-sized beads 1030 becomes diminished.

The importance of manufacturing abrasive articles 1024 having a backing sheet 1026 where all of the beads are equal sized is illustrated by the large differences in sizes of beads 1030, 1034 and 1046 where unequal bead sizes on an abrasive article 1024 results in uneven material removal of flat surfaced workpieces during an abrading event.

FIGS. 91,92,93, and 94 are used to describe the differences in the characteristics and the performances of abrasive articles having gap-spaced individual abrasive primitive agglomerate shapes that are coated on abrasive articles as compared to abrasive articles that have a uniform coating of abrasive particles that are contained in a polymer binder. Also, the relationship between the precision flatness of the abrasive article platens and the different shape-types of abrasive agglomerates are described. The primitive agglomerate shapes consist of square rectangular blocks, non-truncated pyramids and spheres.

Figure 91:
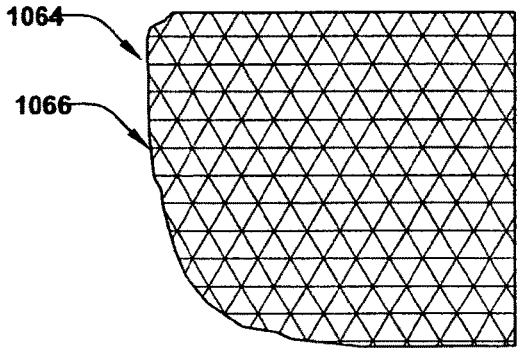
FIG. 91 is a top view of an abrasive article that has an uniform coating of abrasive particles.
Figure 92:
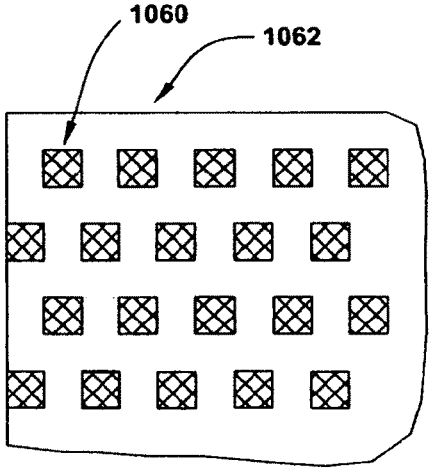
FIG. 92 is a top view of an abrasive article that has a coating of square agglomerate blocks.
Figure 93:
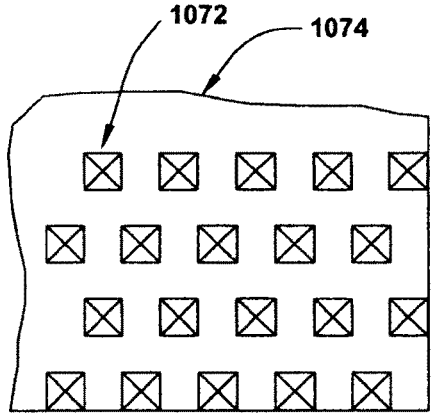
FIG. 93 is a top view of an abrasive article that has a coating of pyramid agglomerate blocks.
Figure 94:
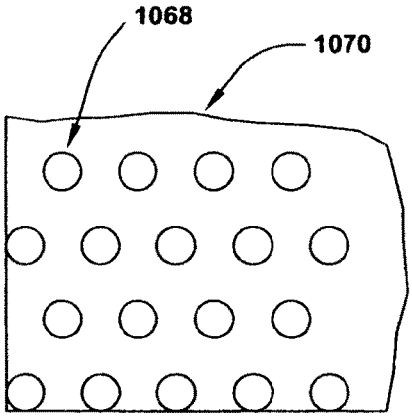
FIG. 94 is a top view of an abrasive article that has a coating of spherical agglomerate blocks.

FIGS. 91-94 are top views of three individual example abrasive agglomerate shapes, and also, a comparative conventional uniform coating example of abrasive material. All four of the example abrasives are attached to the flat abrading surface of abrasive articles. There is an equal plan-view cross sectional size of the three abrasive particle agglomerate shapes that are coated on the abrasive articles for each of the three comparative samples. In FIG. 91 the abrasive particles coatings that are embedded in an erodible adhesive binder are coated in a thin uniform layer on the abrasive article. In FIGS. 92,93,94 three different primitive shapes of abrasive particle agglomerates having equal cross sectional sizes are coated in monolayers on the abrasive article flat surfaces with gap spaces between each of the abrasive agglomerates. Approximately 25% of the flat abrasive coated surface area of the abrasive article is covered with the individual abrasive agglomerates and approximately 75% of the article surface area consists of gaps between the agglomerates. The sides of the square blocks and the equal sized cross sectional sides of the pyramids and the diameters of the spheres are all equal sized for this comparison.

FIG. 91 is a top view of an abrasive article 1064 that has a thin uniform thickness of abrasive particles 1066 that are coated on the flat abrading surface of the article 1064.

FIG. 92 is a top view of an abrasive article where the abrasive particles are formed into square rectangular agglomerate blocks and a monolayer of these blocks are coated on the abrasive article where there are spaced gaps between each block that are equal to the dimensional cross sectional size of the block. The square abrasive agglomerate blocks 1060 are coated on the flat surface of the abrasive article 1062.

FIG. 93 is a top view of an abrasive article where the abrasive particles are formed into agglomerate non-truncated pyramids and a monolayer of these pyramids are coated on the abrasive article where there are spaced gaps between each pyramid that are equal to the dimensional cross sectional size of the pyramid. The abrasive agglomerate pyramids 1072 are coated on the flat surface of the abrasive article 1074.

FIG. 94 is a top view of an abrasive article where the abrasive particles are formed into agglomerate spheres and a monolayer of these spheres are coated on the abrasive article where there are spaced gaps between each row and column of spheres that are equal to the diameter of the spheres. The abrasive agglomerate spheres 1068 are coated on the flat surface of the abrasive article 1070. The relative heights of the four abrasive shaped examples are not shown in FIGS. 91,92, 93 and 94 but the heights of the blocks 1060, the pyramids 1072 and the spheres 1068 are all much greater than the thickness of the abrasive coating 1066 as the amount of abrasive particles per unity surface area of the abrasive articles 1064, 1062, 1074 and 1070 are roughly-approximately equal.

The height (not shown) of the abrasive blocks 1060 is approximately four times the thickness (not shown) of the uniform abrasive coating 1066. The apex height (not shown) of the pyramids 1072 is much higher than the abrasive blocks 1060. The apex height (not shown) of the abrasive spheres 1068 is equal to that of the abrasive blocks 1060 but the spheres 1068 contain somewhat less abrasive material than do the blocks 1060. Little of the abrasive particle material is contained in the high-level apex portion of the pyramids 1072 as most of the pyramid 1072 abrasive material is contained in the broad pyramid 1072 bases at a position immediately adjacent to the abrasive article 1074 top surface. As little of the abrasive particle material is contained at either the apex and the attachment base of the abrasive spheres 1068, most of the spheres 1068 abrasive particles reside at the center of the spheres 1068 where the center is located some distance up from the top surface of the abrasive article 1070. An equal amount of abrasive particle material is located at all elevations of the abrasive blocks 1060.

The location of the abrasive particle material within each of the four different example abrasive coating technologies is very important relative to the wear-down characteristics of abrasive articles when there is even very small undesired variations in the dynamic operational flatness of the platens that support the abrasive articles during abrading processes. Diamond particle abrasive articles that are used in flat lapping operations are very expensive which requires that all or most of the diamond particles coated on the articles be utilized prior to discarding the article. The diamond particle coatings on these lapping articles also tend to be very thin because of the large expense of the diamond particle material. When these thin coated abrasive articles are used with platens that are not precisely flat, then some areas of the abrasive material that is located on the "high" portions of the platens tends to wear away first, thereby exposing the abrasive article supporting surface to a workpiece surface. Contact of a non-abrasive coated abrasive article backing material with a workpiece surface is undesirable and usually requires that the article be discarded even though other abrasive surface areas on the article have not experienced much wear, if any. Premature discarding of partially worn abrasive articles results in an economic loss.

The thin coatings of the uniform coated abrasive 1066 provide little capability for use with platens that are not precisely flat. Platens that have large diameters to be used with lapping large workpieces are difficult and expensive to manufacture to have flat surfaces that remain flat during high-speed operations. High-speed operation is required to take advantage of the unique capability of diamond abrasive particles to provide very fast workpiece material removal rates at high abrading surface speeds. Pyramids 1072 are very high and they initially contact a workpiece surface in concentrated areas with apex peaks that have very small contact surfaces. These sharp pyramid apex peaks can tend to scratch a workpiece surface at the locations where the sharp peaks contact the workpiece. Also, the pyramids 1072 peaks wear down very rapidly because so little abrasive particle material is contained in the peaks. When the pyramids 1072 do wear down to a location near their bases, where most of the abrasive particle material is located, then small variations in the flatness of the platens can easily erode away all of some of the pyramid abrasive material in small localized portions of the abrasive article 1074 which requires premature discarding of the abrasive article 1074.

The gap spacing between the abrasive agglomerate blocks 1060 and the spheres 1068 often are as shown in these FIGS. 92,93 and 94. The gap spacing shown between the pyramids 1072 can be as shown for this comparison or the pyramids may be spaced in closer proximity. When the primitive shaped abrasive agglomerates 1060, 1072 and 1068 have heights that are significantly greater than the typical thin layers of a uniform coating 1066, these agglomerates are not as susceptible to localized area wear-out on the surfaces of the articles 1064, 1062, 1074 and 1070 due to dimensional variations in the flatness of the abrasive article support platens (not shown) as is the uniform coating 1066. The relative heights and relative wear-down of these primitive abrasive agglomerate shapes attached to raised islands or flat surfaced backings are further compared to the wear-down of a uniform abrasive coating in FIGS. 95-108.

Figure 95:
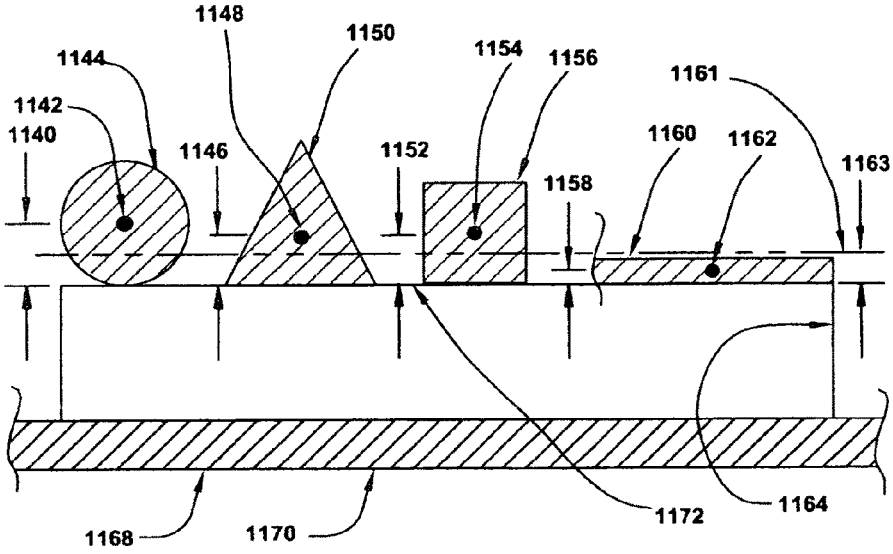
FIG. 95 is a cross section view of four primitive abrasive agglomerative shapes that are attached to a raised island.

FIG. 95 is a cross section view of the three primitive abrasive agglomerative shapes or structures along with a uniformly thick abrasive coating where all four of these equal-volume example shapes are shown as bonded on the top flat surface of an common raised island that is attached to a backing sheet. All four individual types of abrasive coatings on the abrasive article 1168 are shown here attached to a common raised island for visual comparison purposes. A typical abrasive article 1168 would only have one of the three primitive abrasive agglomerate shapes or the uniform abrasive coating attached to an island top surface. Each of the three primitive agglomerate shapes, the sphere 1144, the pyramid 1150 and the block 1156 are components that have individual geometric shapes as does the continuous abrasive coating 1160 which are all are attached to a raised island 1164 that is attached to an abrasive article 1168 backing sheet 1170.

For purposes of comparing the three primitive agglomerate shapes 1144, 1150 and 1156 with the uniform coating 1160 all four examples are shown here as attached to the flat surface of a raised island 1164. However, the example abrasive shapes agglomerate shapes 1144, 1150 and 1156 and the uniform coating 1160 could also be attached directly on the top surface of an non-raised-island abrasive article (not shown) backing sheet 1170 where all of the factors described here of the relative wear-down of the four individual abrasive shape examples and the related issues concerning the flatness variations of non-flat platens (not shown) apply to these non-island abrasive articles. There are significant advantages of using spherical shaped abrasive agglomerates both for raised-island abrasive articles and non-raised-island abrasive articles. The volumetric quantity of each of the three primitive agglomerate shapes per unit surface area of the backing abrasive is equal to each other and also to the volumetric quantity of the uniformly-thick abrasive coating. The amount of abrasive particles that are used to manufacture a unity area of abrasive articles having these four different geometric shape forms of abrasive is equal. The abrasive particles in the uniform abrasive coatings of abrasive particles that are embedded in an erodible adhesive binder 1160 and 1204 respectively are coated in a thin uniform layer on the abrasive article. The three different primitive shapes 1144, 1150 and 1156 and the coating 1160 of abrasive particle agglomerates have unit-area equal volumetric sizes and are attached in monolayers on the abrasive article flat surfaces with gap spaces between each of the abrasive shapes 1144, 1150 and 1156 where the coating 1160 is a continuous coating.

Approximately 25% of the flat abrasive coated surface area of the abrasive article is covered with the individual abrasive agglomerates and approximately 75% of the article surface area consists of gaps between the agglomerates. The same number of individual primitive shapes 1142, 1150 and 1158 and 1178, 1184 and 1192 are attached per unit cross sectional area to the abrasive articles 1168 and 1198. The sides of the square blocks and the equal sized cross sectional sides of the pyramids and the diameters of the spheres are all equal sized for this comparison.

The three primitive agglomerate shapes 1144, 1150 and 1156 are individually sized to have equal sized volumes where the block shape 1156, having all sides that are equal in size, is four times the height of the thickness of the uniform abrasive coating 1160. The volume of the square-pyramid 1150, having equal sized base dimensions that are equal to the pyramid 1150 height, is equal to the volume of the block 1156. The volume of the sphere 1144 is equal to the volume of the pyramid 1150 and to the volume of the block 1156. The three primitive agglomerate shapes 1144, 1150 and 1156 and the uniform abrasive coating 1160 all have the same volumetric density of abrasive particles (not shown) and also have the same total amount of abrasive particles per unit area of the raised island 1164 surface 1172. The abrasive particle mass center 1142 of the abrasive sphere 1144 is located a distance 1140 from the top surface 1172 of the raised island 1164.

The abrasive particle mass center 1148 of the abrasive pyramid 1150 is located a distance 1146 from the top surface 1172 of the raised island 1164. The abrasive particle mass center 1154 of the abrasive block 1156 is located a distance 1152 from the top surface 1172 of the raised island 1164. The abrasive particle mass center 1162 of the abrasive uniform coating 1160 is located a distance 1158 from the top surface 1172 of the raised island 1164. For comparison, it can seen from the figure that the abrasive particle mass center 1162 of the abrasive uniform coating 1160 is located a distance 1158 from the top surface 1172 of the raised island 1164 that is just a fraction of the abrasive particle mass center distances 1140, 1146 and 1152 of the sphere 1144, the pyramid 1150 and the block 1156. The small mass center distance 1158 results in the thin uniform abrasive coating 1160 being extra susceptible to distance 1163 variations in the flatness of platens to which the abrasive article 1168 is attached.

The typical size of a diamond particle filled abrasive spherical bead 1144 that is attached to an abrasive article 1168 used for lapping is 0.002 inches (50 micrometers) and a typical flat-sheet disk diameter (not shown) of the abrasive article 1168 is 12 inches (30.5 cm) but the disk diameter could range in size up to 36 inches (91.5 cm) or more. It is critical that the flatness of the platen remain flat when it is rotated, particularly at high speeds of 3,000 or more RPM, so that all of the abrasive spheres 1144 or other agglomerate shapes or uniform abrasive coatings that are coated on the abrasive article 1168 contact the surface of a workpiece (not shown) during each abrading action. Any small variation in the flatness of the platen or any small variation in the thickness of the abrasive article 1168 can result in uneven wear of the abrasive surface of the abrasive article 1168. Because the 0.002 inches (50 micrometers) abrasive spherical beads 1144 that are used for abrasive lapping processes are so small, it is required that the variation in surface flatness of a rotating platen is considerably less than the size of the abrasive bead 1144 in order to have uniform wear of all the beads 1144 that are coated on the abrasive article 1168. A reference line 1161 shows a variation in the platen flatness having a variation dimension 1163 measured from the top surface 1172 of the raised island 1164 to the reference line 1161 where the platen flatness variation dimension is 0.0005 inches (12.7 micrometers). Great care and expense is required to provide a 12 inch (30.5 cm) platen that will remain flat within 0.0005 inches (12.7 micrometers) at rotational speeds from 0 to 3,000 RPM or more over extended operational periods of weeks or months. Even more care and expense is required to provide larger sized 36 inches (91.5 cm) or more platens having the same flatness requirements for use with large sized workpieces. The desired flatness variation of the platen surface that is to be used with the 0.002 inches (50 micrometers) diameter abrasive beads should be even more precise than the shown 0.0005 inches (12.7 micrometers) platen flatness variation that is used in the example here. The actual desired flatness variation of the platen surface for this-sized abrasive beads is 0.0001 inches (2.5 micrometers), which results in a considerably more expensive lapping equipment system as compared to a platen having a 0.0005 inches (12.7 micrometers) platen flatness variation.

A 0.0005 inch (12.7 micrometer) platen flatness variation with 0.002 inch (50 micrometers) abrasive beads as shown allows a visual appraisal of the importance of both providing precisely flat platens and providing uniform thickness abrasive articles for the beads 1144 and also for the other primitive shapes, the pyramids 1150, the blocks 1156 and particularly for the uniform coating 1160 all of which have the same amount of abrasive particle material per unit surface are of the abrasive article 1168. Here the variation in platen flatness 1163 exceeds the total thickness of the uniform abrasive coating 1160. This will result in some areas of the abrasive article 1168, having only a uniform abrasive coating 1160, not being utilized during abrading as some of the abrasive 1160 will not contact the surface of the workpiece in a high speed abrading operation. Here also, the abrasive coating 1160 will be completely worn away in other areas of the article 1168, which will result in premature discarding of the abrasive article 1168. It is unrealistic to make thicker abrasive coating 1160 layers, with the same diamond particle volumetric density, of the uniform abrasive coating 1160 to compensate for the platen flatness variation 1163 because of the large expense of the required extra diamond abrasive particles that would be wasted. Using a thicker layer of the abrasive coating 1160 where the volumetric density of the coating 1160 is reduced proportional to the increased layer thickness would result in fewer abrasive particles contacting the surface of a workpiece. All of three of the primitive agglomerate shapes, 1144, 1150, 1156 and the continuous coating 1160 have the same diamond abrasive particle density. If there are variations in the thickness of the raised islands 1164 or the thickness of the backing 1170 that are equivalent to the dimensional variation 1163, then the same described uneven abrasive wear problems that occur because of variations in the platen flatness 1163 will also exist. It is desired to manufacture abrasive articles that have thin coatings of small abrasive agglomerate beads that have a long abrading life and also, that wear down evenly across the whole flat abrasive surface of the abrasive article. Large sized abrasive beads can be used on an abrasive articles but if these articles are mounted on a platen that has a non-flat surface, the abrasive articles will tend also to develop non-flat abrading surfaces during abrading action. When the non-flat abrasive articles are removed from a platen and are remounted on a platen at a later time they will not present a flat abrading surface to a contacting workpiece surface. The precision-lapping system relationships between the size of the small abrasive beads that are used in abrasive lapping processes and the variation of the thickness of a raised island abrasive articles, and also, between the flatness variation of a support platen for these abrasive articles are established here. Small abrasive particles or small abrasive agglomerate shapes can not be fully utilized in high speed lapping with non-uniform thickness abrasive articles or with non-flat platens.

Figure 96:
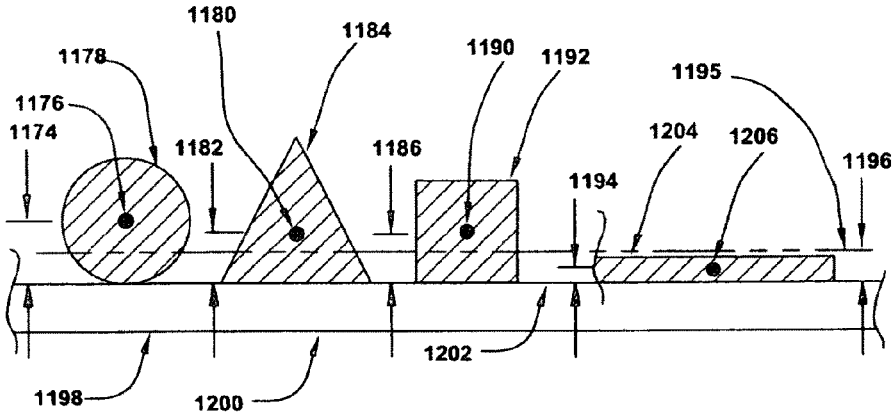
FIG. 96 is a cross section view of four primitive abrasive agglomerative shapes that are attached to a backing sheet.

FIG. 96 is a cross section view of the three primitive abrasive agglomerative shapes along with a uniformly thick abrasive coating where all four of these example shapes are shown as bonded on the top flat surface of a backing sheet. All four individual types of abrasive coatings on the abrasive article 1198 are shown here attached to a common backing sheet 1200 for visual comparison purposes. A typical abrasive article 1198 would only have one of the three primitive abrasive agglomerate shapes or the uniform abrasive coating attached to a backing sheet. Each of the three primitive agglomerate shapes, the sphere 1178, the pyramid 1184 and the block 1192 are components that have individual geometric shapes as does the continuous abrasive coating 1204 which are all are attached to an abrasive article 1198 backing sheet 1200. There are significant advantages of using spherical shaped abrasive agglomerates for non-raised-island abrasive articles. The volumetric quantity of each of the three primitive agglomerate shapes per unit surface area of the backing abrasive is equal to each other and also to the volumetric quantity of the uniformly-thick abrasive coating. The amount of abrasive particles that are used to manufacture a unity area of abrasive articles having these four different geometric shape forms of abrasive is equal. The abrasive particles in the uniform abrasive coatings of abrasive particles that are embedded in an erodible adhesive binder 1160 and 1204 respectively are coated in a thin uniform layer on the abrasive article. The three different primitive shapes 1178, 1184 and 1192 and the coating 1204 of abrasive particle agglomerates have unit-area equal volumetric sizes and are attached in monolayers on the abrasive article flat surfaces with gap spaces between each of the abrasive shapes 1178, 1184 and 1192 where the coating 1204 is a continuous coating.

The three primitive agglomerate shapes 1178, 1184 and 1192 are individually sized where the block shape 1192, having all sides that are equal in size, is four times the height of the thickness of the uniform abrasive coating 1204. The volume of the square-pyramid 1184, having equal sized base dimensions that are equal to the pyramid 1184 height, is equal to the volume of the block 1192. The volume of the sphere 1178 is equal to the volume of the pyramid 1184 and to the volume of the block 1192. The abrasive particle mass center 1176 of the abrasive sphere 1178 is located a distance 1174 from the top surface 1202 of the backing sheet 1200.

The abrasive particle mass center 1180 of the abrasive pyramid 1184 is located a distance 1182 from the top surface 1202 of the backing sheet 1200. The abrasive particle mass center 1190 of the abrasive block 1192 is located a distance 1186 from the top surface 1202 of the backing sheet 1200. The abrasive particle mass center 1206 of the abrasive uniform coating 1204 is located a distance 1194 from the top surface 1202 of the backing sheet 1200. For comparison, it can seen from the figure that the abrasive particle mass center 1206 of the abrasive uniform coating 1204 is located a distance 1194 from the top surface 1202 of the backing sheet 1200 that is just a fraction of the abrasive particle mass center distances 1174, 1182 and 1186 of the sphere 1178, the pyramid 1184 and the block 1192. The small mass center distance 1194 results in the thin uniform abrasive coating 1204 being extra susceptible to distance 1196 variations in the flatness of platens (not shown) to which the abrasive article 1198 is attached.

The typical size of a diamond particle filled abrasive spherical bead 1178 that is attached to an abrasive article 1198 used for lapping is 0.002 inches (50 micrometers) and a typical flat-sheet disk diameter (not shown) of the abrasive article 1198 is 12 inches (30.5 cm) but the disk diameter could range in size up to 36 inches (91.5 cm) or more. It is critical that the flatness of the platen remain flat when it is rotated, particularly at high speeds of 3,000 or more RPM, so that all of the abrasive spheres 1178 or other agglomerate shapes or uniform abrasive coatings that are coated on the abrasive article 1198 contact the surface of a workpiece (not shown) during each abrading action. Any small variation in the flatness of the platen or any small variation in the thickness of the abrasive article 1198 can result in uneven wear of the abrasive surface of the abrasive article 1198. Because the 0.002 inches (50 micrometers) abrasive spherical beads 1178 that are used for abrasive lapping processes are so small, it is required that the variation in surface flatness of a rotating platen is considerably less than the size of the abrasive bead 1178 in order to have uniform wear of all the beads 1178 that are coated on the abrasive article 1198. A reference line 1195 shows a variation in the platen flatness having a variation dimension 1196 measured from the top surface 1202 of the backing sheet 1200 to the reference line 1195 where the platen flatness variation dimension is 0.0005 inches (12.7 micrometers). Great care and expense is required to provide a 12 inch (30.5 cm) platen that will remain flat within 0.0005 inches (12.7 micrometers) at rotational speeds from 0 to 3,000 RPM or more over extended operational periods of weeks or months. Even more care and expense is required to provide larger sized 36 inches (91.5 cm) or more platens having the same flatness requirements for use with large sized workpieces. The desired flatness variation of the platen surface that is to be used with the 0.002 inches (50 micrometers) diameter abrasive beads should be even more precise than the shown 0.0005 inches (12.7 micrometers) platen flatness variation that is used in the example here. The actual desired flatness variation of the platen surface for this-sized abrasive beads is 0.0001 inches (2.5 micrometers), which results in a considerably more expensive lapping equipment system as compared to a platen having a 0.0005 inches (12.7 micrometers) platen flatness variation.

Showing a 0.0005 inch (12.7 micrometer) platen flatness variation with 0.002 inch (50 micrometers) abrasive beads in the figure allows a visual appraisal of the importance of both providing precisely flat platens and providing uniform thickness abrasive articles for the beads 1178 and also for the other primitive shapes, the pyramids 1184, the blocks 1192 and particularly for the uniform coating 1204 all of which have the same amount of abrasive particle material per unit surface are of the abrasive article 1198. Here the variation in platen flatness 1196 exceeds the total thickness of the uniform abrasive coating 1204. This will result in some areas of the abrasive article 1198, having only a uniform abrasive coating 1204, not being utilized during abrading as some of the abrasive 1204 will not contact the surface of the workpiece in a high speed abrading operation. Here also, the abrasive coating 1204 will be completely worn away in other areas of the article 1198, which will result in premature discarding of the abrasive article 1198. It is unrealistic to make thicker abrasive coating 1204 layers, with the same diamond particle volumetric density, of the uniform abrasive coating 1204 to compensate for the platen flatness variation 1196 because of the large expense of the required extra diamond abrasive particles that would be wasted. Using a thicker layer of the abrasive coating 1204 where the volumetric density of the coating 1204 is reduced proportional to the increased layer thickness would result in fewer abrasive particles contacting the surface of a workpiece. As shown, all of three of the primitive agglomerate shapes, 1178, 1184, 1192 and the continuous coating 1204 have the same diamond abrasive particle density. If there are variations in the thickness of the backing 1200 that are equivalent to the dimensional variation 1196, then the same described uneven abrasive wear problems that occur because of variations in the platen flatness 1196 will also exist. It is desired to manufacture abrasive articles that have thin coatings of small abrasive agglomerate beads that have a long abrading life and also, that wear down evenly across the whole flat abrasive surface of the abrasive article. Large sized abrasive beads can be used on an abrasive articles but if these articles are mounted on a platen that has a non-flat surface, the abrasive articles will tend also to develop non-flat abrading surfaces during abrading action. When the non-flat abrasive articles are removed from a platen and are remounted on a platen at a later time they will not present a flat abrading surface to a contacting workpiece surface.

The relationships are established here between: the size of the small abrasive beads that are used in abrasive lapping processes; the variation of the thickness of abrasive articles; and also, between the flatness variation of a support platen for these abrasive articles. Small abrasive particles or small abrasive agglomerate shapes can not be fully utilized in high speed lapping with non-uniform thickness abrasive articles or with non-flat platens. Lapping with expensive diamond superabrasive material having the typical small sized abrasive beads requires a lapping system that has precision flatness platens. The platens must be dimensionally stable over short periods of time when the lapping machine is operated in a single process where a number of different abrasive articles having different particle grit sizes are progressively used to provide a flat and smooth workpiece surface. The same interchangeable abrasive articles are progressively used over again to process different workpieces in subsequent processes, which may occur minutes or days later after the first operations with a given abrasive article. During abrading processes it is also necessary to substitute new abrasive articles for discarded worn-out abrasive articles without affecting the quality of the workpiece surface when a new abrasive article, having a specific size of abrasive particles, is used in conjunction with other old abrasive articles that have different sizes of abrasive particles that are enclosed within the abrasive agglomerate spheres.

Figure 97:
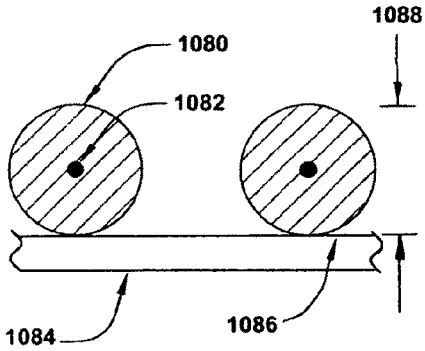
FIG. 97 is a cross section view of an abrasive bead.
Figure 100:
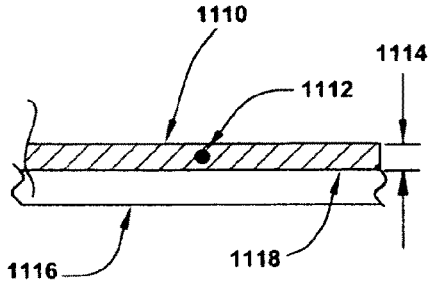
FIG. 100 is a cross section view of an abrasive continuous coating.
Figure 98:
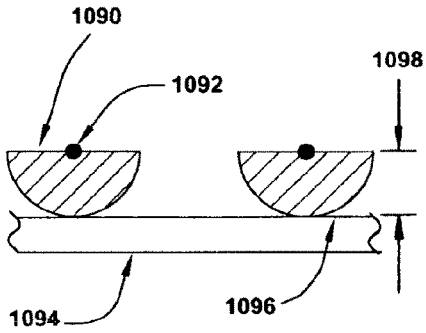
FIG. 98 is a cross section view of an abrasive bead that is half worn-down.
Figure 99:
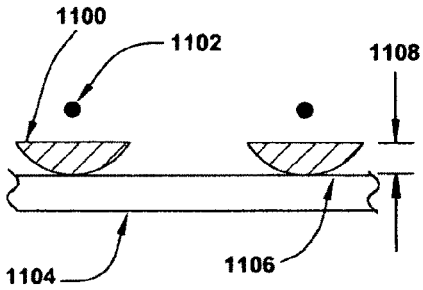
FIG. 99 is a cross section view of an abrasive bead that is three quarters worn-down.

FIGS. 97-102 are used to describe the comparative difference in abrasive wear-down between an abrasive lapping sheet that is coated with abrasive beads and an abrasive lapping sheet that has a continuous level coating of abrasive particles that are embedded in an erodible adhesive binder. These figures show the abrasive coated directly on a backing sheet but the abrasive can also be coated on the surface raised island structures for the same comparison. In FIGS. 97-102, a comparison of the beads and a uniform coating is shown in three sets of two figures each: FIGS. 97 and 100; FIGS. 98 and 101 and FIGS. 99 and 102. In FIG. 97 the bead is unworn and in FIG. 100 the uniform coating is also unworn. In FIG. 98 the bead is 50% worn down in height and in FIG. 101 the uniform coating is also worn down in height by 50%. In FIG. 99 the bead is 75% worn down in height and in FIG. 102 the uniform coating is also worn down in height by 75%. In these figures, the original centroids of abrasive coatings are shown at their original locations. This allows a visual comparison of the relative height of the centroids from the surface of the backing sheet. This also allows a visual comparison of the height location of the original centroid to the new abrading surface locations of the respective remaining abrasive material. The abrasive centroid location is important as it indicates the distance location or height of the "volumetric" center of the original abrasive material away from the backing surface. If the height is small, as is the case for the uniform abrasive coating, then small variations in the lapping machine platen height can easily wear away whole portions of the abrasive material. This results in the abrasive article being discarded. The sensitivity to platen height variations is increased as the abrasive is worn away. The abrasive beads are much less sensitive to platen height variations, even when almost all of the abrasive beads are worn away.

In FIG. 100 the abrasive particles in the uniform abrasive coatings 1110 of abrasive particles that are embedded in an erodible adhesive binder are coated in a thin uniform layer on the abrasive article. In FIG. 97 the spherical primitive shapes 1080 are coated in monolayers on the abrasive article flat surfaces with gap spaces between each of the abrasive agglomerates. Approximately 25% of the flat abrasive coated surface area of the abrasive article is covered with the individual spherical abrasive beads and approximately 75% of the article surface area consists of gaps between the beads. The volume density of the abrasive particles is equal for the individual abrasive beads 1080 and for the abrasive coating 1110 so the number of individual abrasive particles per unit surface area of the abrasive article is the same for both abrasive articles.

FIG. 97 is a cross section view of an abrasive bead. In FIG. 97 where the bead is unworn and in FIG. 100 where the uniform coating is also unworn, the abrasive bead 1080 has a centroid 1082 where the top surface of the bead 1080 that first contacts a workpiece (not shown) surface has a contact height distance of 1088 above the top surface 1086 of the backing 1084.

FIG. 100 is a cross section view of an abrasive continuous coating. In FIG. 100 where the uniform coating is also unworn, the abrasive coating 1110 has a centroid 1112 where the top surface of the coating 1110 that first contacts a workpiece (not shown) surface has a contact height distance of 1114 above the top surface 1118 of the backing 1116. For comparison, it can be seen that the workpiece contact distance 1088 of the bead 1080 is much greater than the workpiece contact distance 1114 of the coating 1110.

FIG. 98 is a cross section view of an abrasive bead that is half worn-down. In FIG. 98 the bead is 50% worn down and in FIG. 101 the uniform coating is also worn down by 50%. The half-worn abrasive bead 1090 has a centroid 1092 where the top surface of the worn bead 1090 that contacts a workpiece (not shown) surface has a contact height distance of 1098 above the top surface 1096 of the backing 1094. Because half of the bead 1090 is worn away, the centroid 1092 is located at the location where the workpiece contacts the bead 1090.

Figure 101:
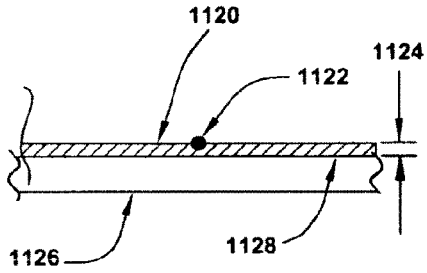
FIG. 101 is a cross section view of an abrasive continuous coating that is half worn-down.

FIG. 101 is a cross section view of an abrasive continuous coating that is half worn-down. In FIG. 101 where the uniform coating is also 50% worn down, the abrasive coating 1120 has a centroid 1122 where the top surface of the coating 1120 that contacts a workpiece (not shown) surface has a contact height distance of 1124 above the top surface 1128 of the backing 1126. Because half of the coating 1120 is worn away, the centroid 1122 is located at the location where the workpiece contacts the coating 1120. For comparison, it can be seen that the workpiece contact distance 1098 of the bead 1090 is much greater than the workpiece contact distance 1124 of the coating 1120.

FIG. 99 is a cross section view of an abrasive bead that is three quarters worn-down. In FIG. 99 the bead is 75% worn down and in FIG. 102 the uniform coating is also worn down by 75%. The three quarters worn abrasive bead 1100 has a centroid 1102 where the top surface of the worn bead 1100 that contacts a workpiece (not shown) surface has a contact height distance of 1108 above the top surface 1106 of the backing 1104. Because three quarters of the bead 1100 is worn away, the centroid 1102 is located above the location where the workpiece contacts the bead 1100.

Figure 102:
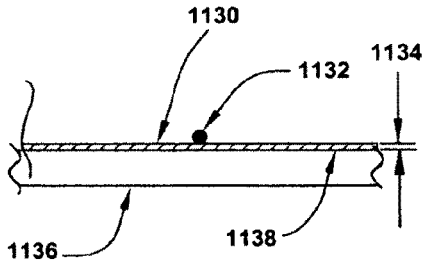
FIG. 102 is a cross section view of an abrasive continuous coating that is three quarters worn-down.

FIG. 102 is a cross section view of an abrasive continuous coating that is three quarters worn-down. In FIG. 102 where the uniform coating is also 75% worn down, the abrasive coating 1130 has a centroid 1132 where the top surface of the coating 1130 that contacts a workpiece (not shown) surface has a contact height distance of 1134 above the top surface 1138 of the backing 1136. Because three quarters of the coating 1130 is worn away, the centroid 1132 is located above the location where the workpiece contacts the coating 1130. For comparison, it can be seen that the workpiece contact distance 1108 of the bead 1100 is much greater than the workpiece contact distance 1134 of the coating 1130. At this stage of abrasive wear-down, there is little height variation in the platen height that can be tolerated before the abrasive layer 1130 is penetrated and the abrasive article has to be discarded. For the same amount of wear-down, there still is a generous amount of platen height variation that can be tolerated by the three quarters worn bead 1100. In fact, it can be seen from these figures that the abrasive height 1108 of the three quarters worn bead 1100 is approximately the same as the original height 1114 of the unworn coating 1110. These figures show how much greater is the tolerance of platen height variations for the beads 1080 as compared to the uniform coatings 1110.

Figure 103:
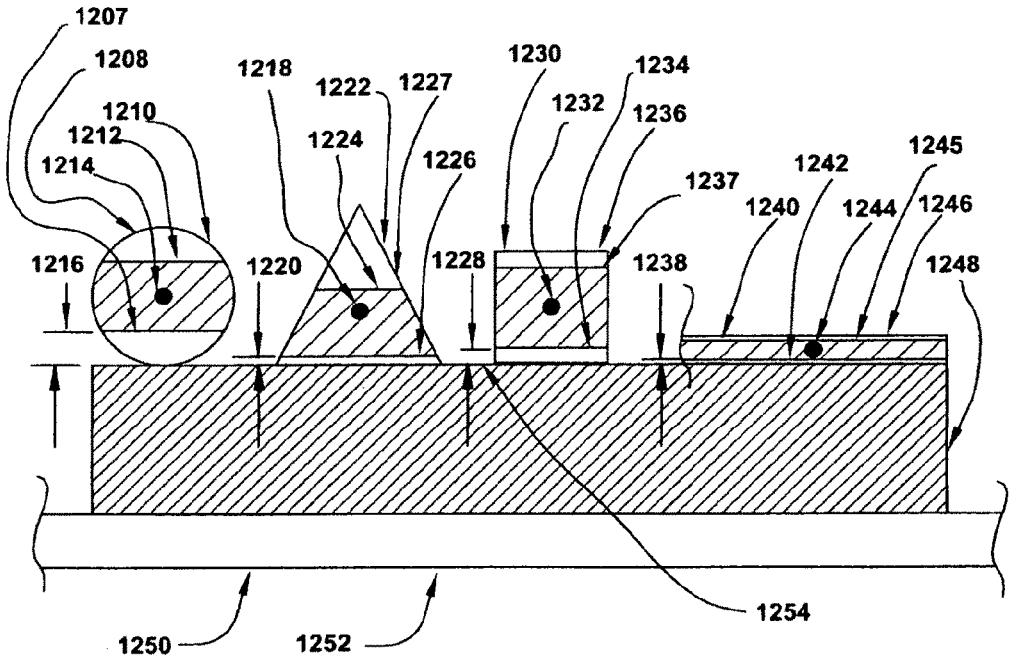
FIG. 103 is a cross section view of four primitive abrasive agglomerate shapes and an abrasive continuous coating that are all located on the top flat surface of a raised island structure.

FIG. 103 is a cross section view of three primitive abrasive agglomerate shapes and an abrasive continuous coating that are all located on the top flat surface of a raised island structure. The top and bottom 15% portions of the total volume of each primitive shape is shown to allow visualization of the advantage of using abrasive spherical beads as opposed to the other primitive shapes. The top 15% portion represents the amount of abrasive material that has to be removed during an abrading process before the primary bulk of each primitive shape is utilized. The central portion of each primitive shape contains 70% of the total primitive shape volume which is the bulk of the abrasive particles that is contained in the primitive volumes. The thickness of the bottom 15% portions of each primitive shape indicates how little that the abrasive disk article 1250 supporting platen (not shown) can vary in height or flatness in order that the last 15% of the abrasive particles can be successfully utilized in abrading operations. If this thickness is small compared to the platen flatness variations, some areas of abrasive can be penetrated to the island 1248 top surface 1254 by the workpiece (not shown) and the abrasive article 1250 is then discarded at a economic loss. The three primitive agglomerate shapes 1210, 1222 and 1230 are individually sized to have equal sized volumes where the block shape 1230, having all sides that are equal in size, is four times the height of the thickness of the uniform abrasive coating 1240. The volume of the square-pyramid 1222, having equal sized base dimensions that are equal to the pyramid 1222 height, is equal to the volume of the block 1230. The volume of the sphere 1210 is equal to the volume of the pyramid 1222 and to the volume of the block 1230. The three primitive agglomerate shapes 1210, 1222 and 1230 and the uniform abrasive coating 1240 all have the same volumetric density of abrasive particles (not shown) and also have the same total amount of abrasive particles per unit area of the raised island 1248 surface 1254. The island 1248 is attached to a backing 1252.

The abrasive bead sphere 1210 has an abrasive particle mass center 1214, a top 15% volume portion 1208, a central 70% portion 1212, and a bottom 15% volume portion 1207 having a bottom portion thickness 1216. The abrasive pyramid 1222 has an abrasive particle mass center centroid 1218, a top 15% volume portion 1227, a central 70% portion 1224, and a bottom 15% volume portion 1226 having a bottom portion thickness 1220. The abrasive block 1230 has an abrasive particle mass center 1232, a top 15% volume portion 1236, a central 70% portion 1237, and a bottom 15% volume portion 1234 having a bottom portion thickness 1228. The abrasive continuous coating 1240 has an abrasive particle mass center 1244, a top 15% volume portion 1246, a central 70% portion 1245 and a bottom 15% volume portion 1242 having a bottom portion thickness 1238.

The spherical bead 1210 has a substantial top portion 1208 that allows "run-in" platen (not shown) height variations before the central bulk portion 1212 is fully engaged in the abrading action. Likewise the bead 1210 also has a substantial thickness 1216 bottom portion 1207 that allows relatively generous platen height variations without having to prematurely discard the abrasive article as only 15% of the abrasive particles reside in this bottom portion 1207.

The pyramid 1222 has a very large and thick top portion 1227 that requires a correspondingly undesirable large change in height during platen "run-in" and the during the first abrading contact before the central bulk portion 1224 is fully engaged in the abrading action. However, the pyramid 1222 also has an extremely small thickness 1220 bottom portion 1226 that does not allow much platen height variation without having to prematurely discard the abrasive article.

The block 1230 has a medium thick top portion 1236 that requires a medium change in height during platen "run-in" and the during the first abrading contact before the central bulk portion 1237 is fully engaged in the abrading action. The block 1230 also has a medium thickness 1228 bottom portion 1234 that allows a medium amount of platen height variation without having to prematurely discard the abrasive article. The top 1236 and bottom 1234 portions of the block 1230 are less tolerant of platen height variations than for the abrasive bead 1210 top 1208 and bottom 1207 portions.

The continuous coating 1240 has a very thin top portion 1246 that allows very little changes in height during platen "run-in" and the during the first abrading contact before the central bulk portion 1245 is fully engaged in the abrading action. The continuous coating 1240 has a very thin, thickness 1238, bottom portion 1242 that allows very little platen height variation without having to prematurely discard the abrasive article. The top 1246 and bottom 1242 portions of the continuous coating 1240 are very much less tolerant of platen height variations than for the abrasive bead 1210 top 1208 and bottom 1207 portions.

For a raised island or a non-raised island abrasive article to be used in high speed lapping, the preferred abrasive bead 1210, as shown, would have a diameter of 0.002 inches (45 micrometers). The bottom 15% volume 1207 then has a 1216 thickness of 0.0005 inches (12.7 micrometers) which allows only 15% of the total volume of the bead 1210 to be sacrificed if the supporting platen has a height or flatness variation or the island 1248 structure has a thickness variation, or a combination of both, that is equal to the bottom volume 1207 0.0005 inch (12.7 micrometers) thickness before the workpiece penetrates to the surface 1254 of the island 1248. Keeping the total height variation of the platen and the abrasive article to within the described 0.0005 inch (12.7 micrometers) thickness tolerance while the platen is rotating at high speeds in excess of 3,000 RPM is practical for abrasive article disks having a 12 inch (30.5 cm) diameter. However, it is significantly much more difficult to achieve this same dynamic height tolerance when using 18 inch (45 micrometer) or 36 inch (91 micrometer) or larger disks that are required for lapping medium or larger sized workpieces. Providing high speed large diameter lapper machine platens that are dynamically stable for long periods of time and that have height or flatness variations less than this described absolute 0.0005 inches (12.7 micrometers) requires the use of sophisticated equipment that is actively maintained. Decreasing this process tolerance by even a small amount can easily result in a large increase in the lapper machine cost. Use of non-spherical primitive shapes of abrasive agglomerates or even an equivalent continuous coated abrasive all require platen and overall height tolerances that are much reduced from that required for the spherical beads. These decreased tolerances can result in a prohibitive lapping machine costs to minimize the potential losses from abrasive articles that are penetrated by a workpiece before the useful life of the abrasive article was expended. This problem of providing extraordinary thickness control of abrasive articles and super precision flat-platen lapper machines is uniquely required for high speed lapping with these abrasive articles. Lesser-quality abrasive articles and lesser-quality abrading machines can be used for other types of abrading processes.

For comparison, the abrasive pyramid 1222 bottom 15% volume 1226 then has an equivalent thickness 1220 of only 0.00012 inches (3.0 micrometers) which is only one fourth that of the abrasive bead 1210 thickness 1216. The lapper machine flatness variation tolerance for the pyramid 1222 would result in a prohibitive lapper machine cost. Likewise, the abrasive block 1230 bottom 15% volume 1234 then has an equivalent thickness 1228 of only 0.00022 inches (5.6 micrometers) which is only one half that of the abrasive bead 1210 thickness 1216. The lapper machine flatness variation tolerance for the block 1230 would result in a much larger lapper machine cost. For further comparison, the continuous abrasive coating 1240 bottom 15% volume 1242 then has an equivalent thickness 1238 of only 0.00006 inches (1.3 micrometers) which is only one eighth that of the abrasive bead 1210 thickness 1216. The lapper machine flatness variation tolerance for the continuous coating 1240 would result in a beyond-reasonable lapper machine cost.

Figure 104:
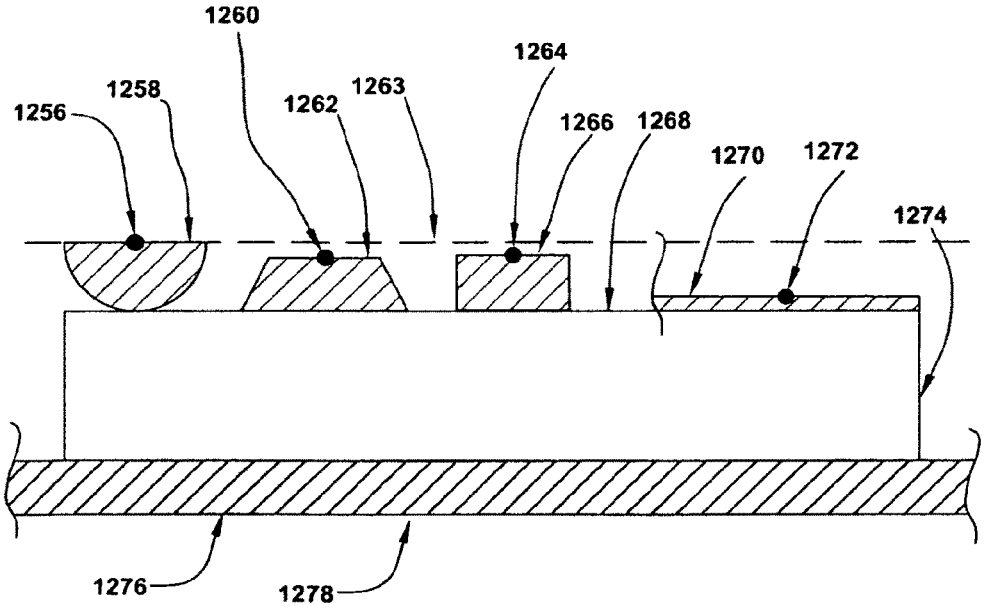
FIG. 104 is a cross section view of four primitive abrasive agglomerate shapes and an abrasive continuous coating located on the top flat surface of a raised island structure that are half worn.

FIG. 104 is a cross section view of three primitive abrasive agglomerate shapes and an abrasive continuous coating that are all located on the top flat surface of a raised island structure. These are the same primitive abrasive shapes shown in FIG. 103 but each have 50% of their original abrasive particle volume worn away. The abrasive article 1276 has raised island structures 1274 attached to a backing 1278 where a spherical abrasive bead 1258, an abrasive pyramid 1262, an abrasive block 1266 and an abrasive continuous coating 1270 are attached to the top surface 1268 of the island 1274. The non-worn bead centroid 1256 of the half worn bead 1258 is shown where the horizontal wear reference line 1263 passes through the center of the centroid 1256. The half worn pyramid 1262 has a centroid 1260 that is located below the wear reference line 1263 and the half worn block 1266 centroid 1264 is also below the wear reference line 1263. The centroid 1272 of the half worn continuous coating 1270 is located a relatively large distance below the reference wear line 1263.

These relative heights of non-worn and partially worn and fully worn primitive shapes are shown in the following figures as being attached to the top flat surface of a raised island structure but the effects of the differences of the relative heights of the shapes is also the same for shapes that are directly coated on the flat surface of a n abrasive article backing sheet.

Figure 105:
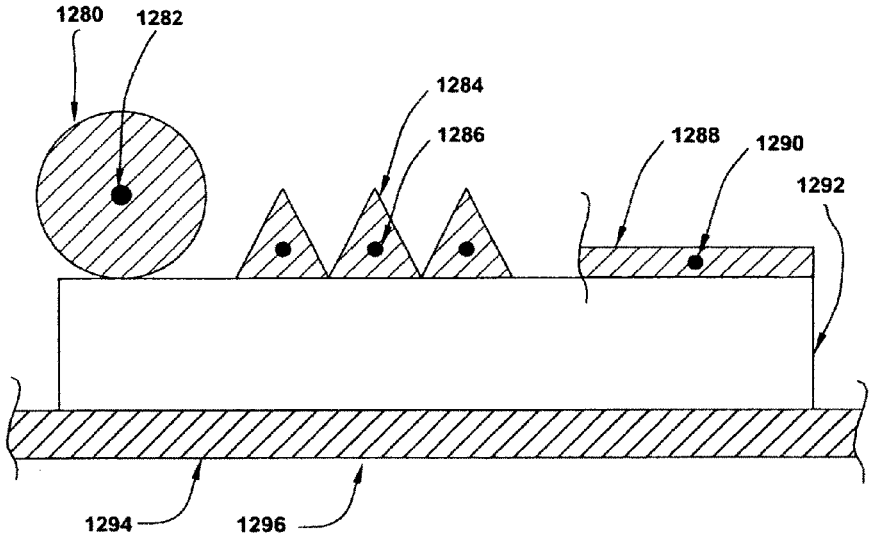
FIG. 105 is a cross section view of relative sizes and heights of primitive shaped non-worn abrasive beads, pyramids, and a uniform adhesive coating.

FIG. 105 is a cross section view of relative sizes and heights of the primitive shaped non-worn abrasive beads, pyramids, and a uniform adhesive coating. The abrasive beads are shown in a cross section view as coated in a spaced pattern on the top surface of a raised island structure along with a uniform coating of directly-adjacent pyramid abrasive shapes and also, a uniform coating of abrasive particles. This figure shows a composite of beads 1280, pyramids 1284 and a continuous coating 1288 on a single island 1292 surface here just to compare the geometric characteristics and effects of the three primitive abrasive coating shapes. When beads 1280 are conventionally coated on islands there are gap spaces between the individual beads. The pyramids 1284 and the continuous coatings 1288 shown here on the island 1292 represent abrasive coatings that are uniform across the full surface of the islands 1292 with no coating gap spaces on the islands 1292. The abrasive article 1294 has abrasive particles (not shown) in the uniform abrasive coatings 1288 where the abrasive particles that are embedded in an erodible adhesive binder are coated in a thin uniform layer on the top surface of the raised island structure 1292 which is attached to a backing 1296. The spherical bead primitive shapes 1280 have centroids 1282 and are coated in monolayers on the islands 1292 flat surfaces with gap spaces between each of the abrasive agglomerates. Approximately 25% of the flat abrasive coated surface area of the abrasive island 1292 is covered with the individual spherical abrasive beads and approximately 75% of the island 1292 surface area consists of gaps between the beads. Also shown is a portion of the island 1292 top surface that has an array pattern of directly-adjacent abrasive pyramids 1284 having centroids 1286 are attached to the island 1292. There are no gap spaces between the individual adjacent abrasive pyramids 1284. The volume density of the abrasive particles is equal for the individual abrasive beads 1280 and for the abrasive coating 1288 and for the pyramids 1284 so the number of individual abrasive particles per unit surface area of the island 1292 is the same for the beads 1280, the pyramids 1284 and the uniform coating 1288. The relative sizes and heights of the unworn beads 1280, the unworn pyramids 1284 and the unworn uniform coating 1288 can be seen from the figure.

Figure 106:
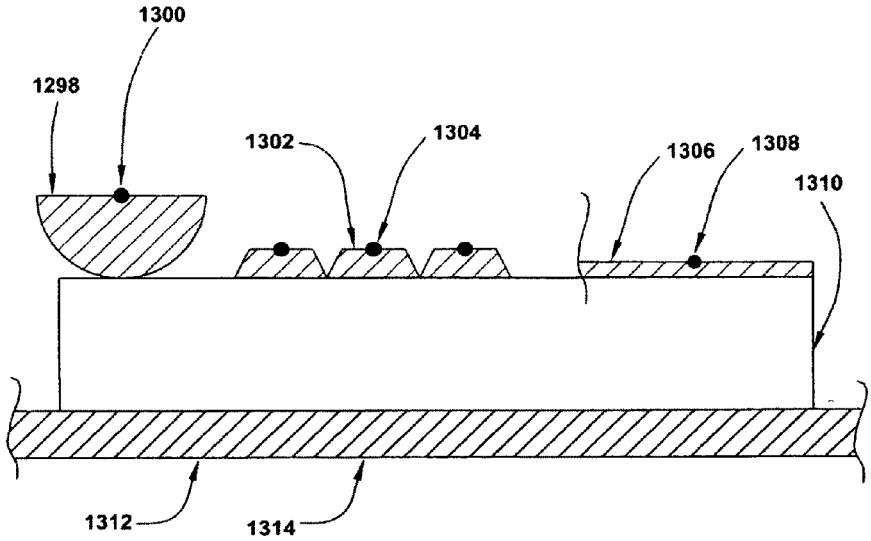
FIG. 106 is a cross section view of relative sizes and heights of primitive shaped half-worn beads, pyramids, and a uniform adhesive coating.

FIG. 106 is a cross section view of relative sizes and heights of the primitive shaped half-worn beads, pyramids, and a uniform adhesive coating shapes or structures that only have 50% of their original volumes as the structures are shown worn down to their centroids. The relative sizes and heights beads are shown in a cross section view as partially worn beads 1298, pyramids 1302 and the uniform coating 1306 as can be seen from the figure where all contain only 50% of their original volumes. The unworn centroid 1300 of the worn bead 1298, the unworn centroid 1304 of the worn pyramid 1302 and the unworn centroid 1308 of the worn uniform coating 1306 are also shown for visual reference. All of the abrasive primitive shapes 1298, 1302 and 1306 are attached to the islands 1310 that are attached to a backing 1314. Again most of the bulk of the individual abrasive particles (not shown) that reside in the beads are favorably positioned well above the surface of the island 1310 whereas the bulk of the individual abrasive particles contained in the pyramids 1302 is positioned very close to the island 1310 surface which is most undesirable from an abrasive article 1312 wear standpoint. Also, the bulk of the individual abrasive beads contained in the uniform coating 1306 is positioned very close to the island 1310 surface which also is very undesirable from an abrasive article 1312 wear standpoint.

Figure 107:
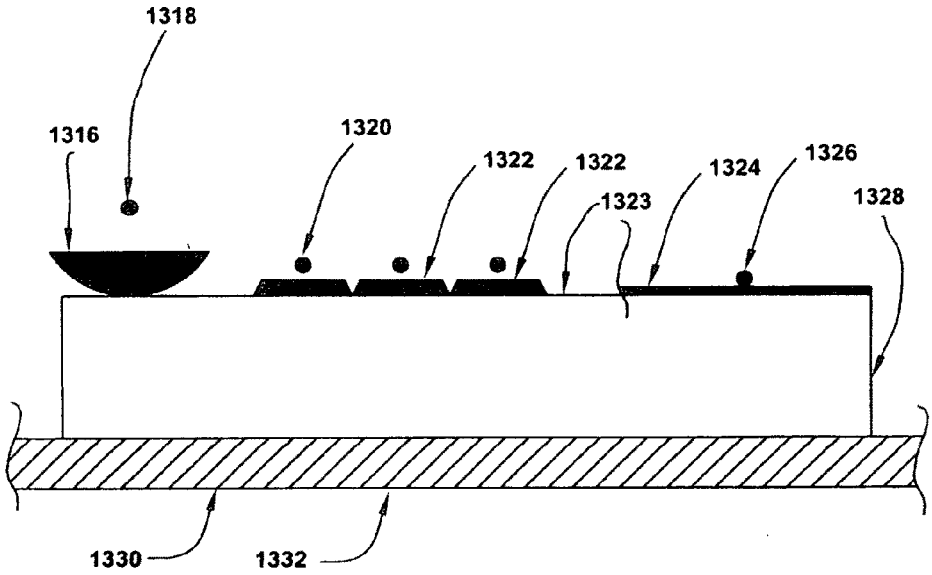
FIG. 107 is a cross section view of relative sizes and heights of primitive shaped three quarter-worn beads, pyramids, and a uniform adhesive coating.

FIG. 107 is a cross section view of the relative sizes and heights of the primitive shaped significantly partially worn beads 1316, pyramids 1322 and the uniform coating 1324 where all three primitive shapes having continued wear to where each of the primitive shapes have thicknesses that are only 50% of their half-volume centroid heights. The heights of the unworn centroid 1318 of the worn bead 1316, the unworn centroid 1320 of the worn pyramid 1322 and the unworn centroid 1326 of the worn uniform coating 1324 are also shown for visual reference. All of the abrasive primitive shapes 1316, 1322 and 1324 are attached to the top flat surface 1323 of the islands 1328 that are attached to a backing 1332. Most of the bulk of the individual abrasive particles (not shown) that yet remain in the well-worn beads 1316 are favorably positioned well above the surface 1323 of the island 1328 whereas the bulk of the individual abrasive particles contained in the worn pyramids 1322 is positioned very close to the island 1328 surface 1323 which is most undesirable from an abrasive article 1330 wear standpoint. Also, the bulk of the individual abrasive beads contained in the uniform coating 1324 is positioned very close to the island 1328 surface 1323 which also is very undesirable from an abrasive article 1330 wear standpoint.

Figure 108:
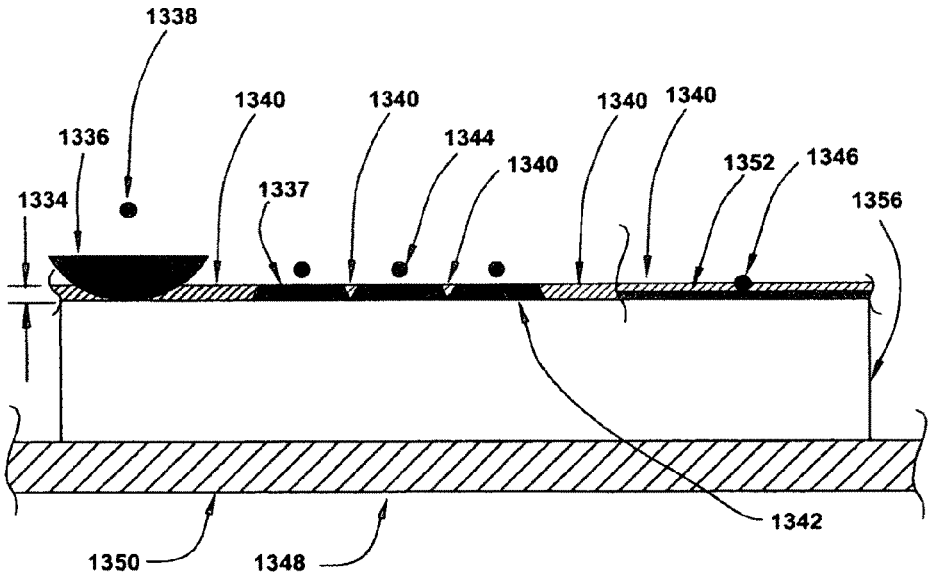
FIG. 108 is a cross section view of relative sizes and heights of primitive shaped three quarter-worn beads, pyramids, and a uniform adhesive coating with an adhesive resin coating.

FIG. 108 is a cross section view of relative sizes and heights of the primitive shaped partially worn beads 1336, pyramids 1337 and the uniform coating 1352 can be seen with a film layer of coolant water 1340. Coolant water 1340 is required for use with high speed lapping to prevent heat generated by the abrading process friction from damaging either the workpiece (not shown) or the abrasive particles (not shown). The film layer of coolant water 1340 is shown on and about the primitive abrasive shapes 1336, 1337 and 1352 that are attached to the flat top surface 1342 of the island 1356 to show the hydroplaning effect of the thickness 1334 of the water 1340 on the different primitive shapes 1336, 1337 and 1352 when they have advanced wear and are used at high abrading speeds. The issues of the depth or thickness 1334 of the water 1340 relative to the remaining thickness of the primitive abrasive shapes 1336, 1337 and 1352 shown here also are present when these same primitive shapes are coated directly on the flat non-island surface of a backing sheet. The raised islands 1356 are specifically originated to minimize the effects of hydroplaning by preventing the existence of continuous films of coolant water that is carried on the top surface of continuous flat layers of a coated abrasive that is moving at high speeds under the surface of a flat workpiece. Even though the primitive shapes are shown as attached to an island 1356 top and flat surface 1342, the occurrence of hydroplaning can be seen from the figure when the water depth 1334 is greater than the thickness of the remaining abrasive primitive shape. As in FIG. 107, all three primitive shapes 1336, 1337, and 1352 shown here have continued wear to where each of the primitive shapes have only 50% of their original partially-worn thicknesses as shown in FIG. 106. For reference, FIG. 106 showed these primitive shapes as having 50% of their original volumes being worn away. The unworn centroid 1338 of the worn bead 1336, the unworn centroid 1344 of the worn pyramid 1337 and the unworn centroid 1346 of the worn uniform coating 1352 are also shown for visual reference. All of the abrasive primitive shapes 1336, 1337 and 1352 are attached to the islands 1356 that are attached to a backing 1350. Most of the bulk of the individual abrasive particles that yet remain in the well-worn beads 1336 are favorably positioned well above the surface 1342 of the island 1356 whereas the bulk of the individual abrasive particles contained in the worn pyramids 1337 is positioned very close to the island 1356 surface 1342 which is most undesirable from an abrasive article 1348 wear standpoint. Also, the bulk of the individual abrasive contained in the remaining uniform coating 1352 is positioned very close to the island 1356 surface 1342 which also is very undesirable from an abrasive article 1348 wear standpoint. The well-worn abrasive beads 1336 have a non-worn diameter of 0.002 inches (45 micrometers) but the three quarter worn beads 1336 have a thickness of only 0.0005 inches (13 micrometers) where the worn beads 1336, as shown, contain only 15% of the volume of the non-worn beads.

The film layer of coolant water 1340 having a thickness 1334 is shown level with the only partially worn abrasive pyramids 1337 which still contain 41% of the non-worn abrasive pyramid particles even though the pyramids 1337 heights are so worn down. When the coolant water 1340 thickness 1334 level, shown as 0.0017 inches (0.04 micrometers), is greater than the height of the worn pyramids 1337, the workpiece will have a tendency to hydroplane on the surface of the abrasive pyramids that are moving at high abrading speeds. If the workpiece hydroplanes, this results in uneven abrading of the workpiece surface which prevents establishing a precision-flat workpiece surface. This figure demonstrates how small the thickness 1334 of the coolant water 1340 film can be to induce hydroplaning or liquid floatation of the workpiece to occur, particularly when the article 1348 abrasive coatings are well worn. Typically, coolant water is applied in a stream (not shown) to a moving lapping abrasive surface where the result coolant water film that is formed on the flat abrasive surface is often much in excess of the very thin coolant water 1340 thickness 1334 level shown here as 0.0017 inches (0.04 micrometers). By comparison, the well-worn abrasive bead 1336 that only has 15% of the original abrasive particles yet remaining, is still positioned well above the very thin layer of coolant water 1340 and no hydroplaning takes place for these beads 1336. The same film layer of coolant water 1340 is shown at an elevation that floods the worn uniform abrasive coating 1352, where the coating 1352 still contains 25% of the original abrasive particles, results in hydroplaning of the workpiece. Coolant water is often applied in a falling stream that is directed toward a flat abrasive article that is rotating at high rotational speeds where the diameter of the water stream can be as much as 0.25 inches (0.64 cm). When this large stream of water contacts the abrasive surface, the water stream is spread out into a flat water layer in part, by centrifugal forces that are due to the rotational speed of the article. The resultant thickness of this surface water layer often is far in excess of the height of worn or even non-worn abrasive beads that are used in high speed flat lapping. In the case of a non-island uniform abrasive coating 1352 that experiences little wear-down, hydroplaning will tend to occur at high abrading speeds because any applied coolant water 1340 will tend to flood the continuous abrasive surface 1352 because of the absence of recessed abrasive surface channels that can collect excessive amounts of the applied coolant water. As seen here, a film layer of coolant water 1340 having a thickness 1334 that is much thinner than the 0.0005 inches (13 micrometers) thickness worn bead 1336 can easily induce hydroplaning of a workpiece at high abrading speeds. When a workpiece surface is separated by coolant water 1340 from an abrasive surface during high speed lapping, hydroplaning is considered to exist. Abrasive articles 1348 that have advance wear are particularly sensitive to hydroplaning effects. Abrasive pyramids 1337 can operate without hydroplaning during the first phases of wear-down but are particularly sensitive to hydroplaning when the pyramids 1337 reach an advanced state of wear-down.

A variety of abrasive particle materials can be used for these abrasive articles including both inexpensive materials such as aluminum oxide and expensive superabrasive materials such as CBN and diamond. Diamond abrasive material is commonly used for high speed abrading and lapping of non-ferrous hard workpiece material. CBN abrasive material is commonly used for high speed abrading and lapping of ferrous hard workpiece material. It is important that these expensive abrasive materials that are coated on abrasive articles are fully utilized in abrading operations. Any non-utilization of these superabrasive materials that are coated on an abrasive article can result in significant economic losses for the user. It is also important that the abrasive articles perform their intended function of rapid material removal from a workpiece that results in a precisely flat workpiece surface.

Abrasive particles can be formed into different abrasive agglomerate shapes with different types of binders to allow the use of very small particles that are consolidated into the agglomerates. The agglomerates have sufficiently large sizes that they can be coated on abrasive articles using conventional article coating techniques. It is necessary to use small sized abrasive particles to produce smooth workpiece surfaces. When small abrasive particles are formed into the commonly used ceramic agglomerate bead shapes, the porous ceramic matrix materials that are used to hold these beads together can have especially large particle-retaining strengths as compared to the polymer binders. Polymer binders are commonly used for forming abrasive shapes including pyramids, truncated pyramids and other blocky shaped agglomerates. Polymer binders are also commonly used as a make coat to attach individual abrasive particle, and spherical abrasive beads, to backing sheets in conventional continuous abrasive particle coating processes. Generally, polymer binders are not used to form spherical diamond abrasive beads because these binders do not have sufficient strength to satisfactorily structurally support the individual small diamond abrasive particles when they are used in abrading processes.

The localized dynamic abrading forces that impact the individual diamond particles tend to break the particles loose from the spherical bead structure before the sharp cutting edges of the particles are worn away. Diamond agglomerate spherical beads are made with the use of ceramic matrix precursor materials that are fired in a furnace at high temperatures. Porous ceramic abrasive agglomerates that are formed in the firing process do have sufficient particle binding strength to withstand the dynamic abrading forces. It is not possible to form a continuous uniform thickness ceramic binder type of abrasive coating layer on a polymer backing sheet with this ceramic precursor material to create the same structural support of individual diamond abrasive particles as occurs with the porous ceramic diamond abrasive beads. If it were practical, it would be possible to avoid use of the two-step process of forming the abrasive beads in one manufacturing process step and coating a polymer binder mixture containing these beads on a backing sheet in another process step. The polymer backing sheet can not withstand the high furnace firing temperatures that are required to form the porous ceramic matrix material from the mixture of ceramic precursor materials and diamond abrasive particles. The spherical shaped abrasive agglomerate beads can be easily coated in a monolayer on an abrasive article when using conventional coating techniques because of the spherical shapes of the beads. It is difficult to form a monolayer of other non-spherical shaped loose abrasive agglomerates, including pyramids, where all of these individual abrasive agglomerates reside in the same geometric orientation on the surface of an abrasive article when using conventional coating techniques. Spherical shaped abrasive beads can be bonded to flat-surface abrasive articles or to raised-island abrasive articles. Raised island abrasive articles are required to successfully perform high speed lapping that both produce a flat and smooth surface to hard workpiece materials such as ALTIC, (aluminum titanium carbide), tungsten carbide, semiconductor or ceramic materials.

FIGS. 92-94 are top views of the three individual abrasive agglomerate shapes that are attached to abrasive articles where each individual abrasive shape has a gap space that is equal to the size of the abrasive agglomerate shape between adjacent agglomerate shapes. Approximately 25% of the surface of the three abrasive articles is covered with spaced individual abrasive shapes and the abrasive surfaces of these three abrasive articles have 75% void (non abrasive agglomerate shape) areas between the individual abrasive shapes. As shown in the top views of the three individual abrasive agglomerate shapes in FIGS. 92-94 that are attached to abrasive articles, the individual abrasive shapes are in a rectangular array pattern where only one in four (25%) of the equal sized array cells contains an abrasive shape. For comparison, FIG. 91 is a top view of an abrasive article that has a conventional uniform thickness make coat of abrasive particles that are dispersed in a polymer binder. There are three primitive abrasive agglomerate shapes that are compared: a spherical agglomerate bead shape; a pyramid agglomerate shape and a square abrasive block shape. All three of these abrasive shapes are used for abrasive articles. Spherical abrasive agglomerate beads are easy to handle and control in the manufacturing of abrasive articles where the beads are typically coated in a monolayer on the flat surfaces of the abrasive articles. Square or non-square blocks of abrasive agglomerate materials are in common use but it is difficult to coat these blocks on an abrasive article where one flat side of each block lays flat in a monolayer on the flat surface of the abrasive article. Square pyramid or truncated pyramid shapes of abrasive agglomerate materials can be readily produced but it is difficult to coat these blocks on an abrasive article where one flat side of each pyramid shape lays flat in a monolayer on the flat surface of the abrasive article. More often these abrasive particle pyramid shapes are molded directly on the surface of an abrasive article.

Each of the three primitive agglomerate shapes has the same cross sectional size as viewed from the top.

FIG. 91 is a top view of an abrasive article 1064 that has a uniform thickness abrasive binder coating 1066.

FIG. 92 is a top view of an abrasive article 1062 that has square cube shapes 1060 containing abrasive particles (not shown) that are attached flat to the flat surface of the abrasive article 1062.

FIG. 93 is a top view of an abrasive article 1074 that has square pyramid shapes 1072 containing abrasive particles (not shown) that are attached flat to the flat surface of the abrasive article 1074. The height (not shown) of the square pyramids 1072 is equal to the two base sides of the pyramid, which are also equal in size.

FIG. 94 is a top view of an abrasive article 1070 that has spherical abrasive agglomerate shapes 1068 containing abrasive particles (not shown) that are directly attached to the flat surface of the abrasive article 1070. The total volume of abrasive particles per unit surface area of the abrasive articles are the same for the three different geometric shapes 1060, 1072, 1068 of the abrasive agglomerates and also, for the conventional uniform coating 1066 in all the FIGS. 91-94. The three different geometric shapes 1060, 1072, 1068 have different sizes but all three individual shapes have the same contained volume. The heights of each of the three primitive shapes is different to provide an abrasive particle density over a unit surface area of the abrasive articles that is equal for all the three primitive shapes and also for the uniform thickness abrasive coating.

Abrading with Abrasive Particles and Beads

Abrasive particles that are referred to as diamond blocky particles in the abrasives industry describe diamond particles that have block shapes with rounded or somewhat-sharp edges. Another common diamond particle shape is that of crystalline diamond particles which have many sharp edges and which tend to split during abrasion to form new sharp edges as the particle wears. In some cases, abrading action takes place where a sharp edged abrasive particle cuts or peels away some of the workpiece material. In other cases workpiece material is removed when a hard particle plows a furrow in the softer workpiece surface. Blocky diamond particles can also have sharp cutting edges on each individual particle as diamonds tend to form shapes having planar walls that are at right angles to each other. When an abrasive article coated with blocky shaped diamond particles is moved against the surface of a hardened workpiece, the workpiece tends to progressively wear away the top surface of the individual diamond particles. In addition the diamond particle can fracture along planar surfaces where new sharp cutting edges are formed. As the individual abrasive particle wears down, the sharp leading cut-edges of the particle is progressively reestablished at lower elevations as the particle becomes smaller in height. Both natural and artificial diamonds have different break-down and toughness characteristics. These characteristics can be controlled in the manufacture of artificial diamonds to suit the abrading requirements of different abrasive product articles. This abrasive particle sharp cutting edge removes material from the workpiece as the abrasive moves relative to the workpiece and the abrasive is held against the workpiece with a controlled contact force. In this way the workpiece keeps re-sharpening the abrasive particles and the particles keep removing material from the workpiece as the abrading process continues. When an abrasive particle is worn down or becomes dull it is desired that new abrasive particles are brought in contact with the workpiece.

Large sized diamond particles can be coated independently of the surface of an abrasive article but these abrasive articles are used for their bulk material removal capabilities and not for their mirror-smooth polishing capabilities. To perform the mirror-smooth polishing, very small diamond abrasive particles are formed into abrasive beads where the beads have sizes that are equivalent to the size of the independent diamond particles that are coated directly on an abrasive article. The abrasive beads can have a high percentage content of small diamond abrasive particles which provides substantial abrading life to the article even though the individual diamond particles are so small.

The nominal size range of the abrasive beads that are typically selected by abrasive product manufacturers that are used for precision lapping abrasive articles is quite narrow. These beads have evolved to be an average of 45 micrometers (0.0018 inches) in size for the largest abrasive beads that are coated on a lapping sheet article. The beads can easily be larger in diameter but they provide an increased abrasive layer thickness that can wear down unevenly which can tend to result in non-flat workpiece surfaces. Smaller diameter abrasive beads can also be used but they do not contain enough of the diamond particles to provide a satisfactory abrading life to the abrasive article. Diamond abrasive particles are expensive so if an article is rendered unsatisfactory by non-flat abrading wear and is discarded before all the abrasive is utilized, this becomes an economic loss. Lapping machine set-up costs are substantial so discarding short-lived small abrasive bead coated abrasive articles because the beads are too small is also expensive. If a monolayer of equal sized abrasive particles is coated on a backing sheet, the abrasive article is worn out when the equal sized abrasive particles are worn down. If an abrasive article is coated with multiple layers of abrasive particles, new abrasive particles are exposed to contact a workpiece surface when the top layer abrasive particles are worn away.

Equal sized mold formed aluminum oxide particles can be produced by depositing an aluminum oxide (alumina) water based dispersion slurry in equal sized mold cavities. However, these equal sized mold shaped particles tend to be large in size and are often crushed into a wide range of sizes prior to the heat treatment process step that converts a soft form of alumina into a abrasive-type hardened form of alumina. In the production of these particles, after deposition of the slurry in the shaped cavities, the aluminum oxide is dried sufficiently to produce shrinkage of the aluminum oxide that is contained in the mold cavities. The aluminum oxide particles that are shrunk as they reside in the mold cavities are also solidified at the same time that the shrinkage occurs. These reduced size and solidified particles tend to withdraw from the constraining walls of the mold cavities as the particles shrink, which allows easy extraction of the molded particle shapes from the cavities. The solidified mold shaped aluminum oxide shaped particles retain the overall shape of the mold cavities as the molded particles are smaller in size than the cavities they are free to fall from the cavities. The disadvantage to this process of forming solidified mold shaped particles is that the individual particles must be solidified while the alumina slurry is still contained within the mold cavities. Applying heat to the cavity mold to solidify and shrink the mold formed alumina particles is relatively complex and time consuming particularly when forming very small particles. The particle cavity molds are constructed of materials including polymers and metals. The solidified molded aluminum oxide particles are abrasive particle precursors. These solidified precursor particles that are separated from the molds have rigid equal sized particle shapes but the particles are very soft and fragile as compared to hard and tough abrasive particles. The cavity mold shaped solid precursor particles are then collected and subjected to further heating process processes to completely dry or calcine the particle material. Then the solid particles are fired at high temperatures to convert the precursor aluminum oxide into hard and tough material particles that can be used as abrasive particles. Converting forms of alumina into hardened abrasive particles by high temperature heat treating processes include the process of the conversion of alumina into alpha alumina, a process that is well known in the abrasives industry. The high temperature metal oxide heating events must be applied only to the aluminum oxide particles after they are removed from the polymer or metal cavity molds. These molds are not able to withstand the aluminum oxide conversion firing temperatures that range up to 1600 degrees C., which is far in excess of the melting temperature of either the polymer or metal cavity mold materials.

Spherical shaped abrasive particles that have equal sizes and smooth shapes allow easier control of the individual abrasive particles during the manufacture of abrasive articles as compared to jagged edged particles that are produced from large abrasive material ingots that are mechanically crushed into small sizes. Crushed particles tend to have sharp edges but they often are acicular in shape and are difficult to classify by shape using a screen sieve device as small diameter but long shaped particles can pass through a screen opening along with small diameter particles. Rounded near-spherical abrasive particles tend to flow as independent particles without agglomerating or collecting together into common-lumps of abrasive particles in equipment that is used to apply the abrasive particles to the surface of an abrasive article. Common-lumps of abrasive particles can prevent the formation of monolayers of abrasive particles on the surface of abrasive articles. A particular advantage of equal sized spherical particles is that they can easily be coated where there is only a single substantially planar layer of abrasive particles coated on an abrasive article. Equal sized spherical shaped solid abrasive particles provide that all the abrasive material is utilized on a coated abrasive article as compared to the condition where small particles that are coated together with large particles.

It is well known in the abrading industry that a workpiece should simultaneously contact most of the abrasive particles in a localized abrading area. Here, the abrading contact force-pressure should be evenly distributed to those individual abrasive particles that reside in that localized abrading area. It is also well known that if the abrasive particles are evenly distributed with consistent distances between individual particles and the particles have equal particle sizes then a workpiece can be abraded with good cutting rates and provide smooth surfaces without creating undesirable scratches. An abrasive article having a few oversized particles will tend to scratch a workpiece at those locations where only these large particles are in contact with a workpiece. Use of equal sized abrasive beads that are manufactured with the use of mesh screens or perforated sheets having controlled screen-opening sizes assures that the equal sized abrasive beads produced are consistent in size over long periods of production time. Often the abrasive beads or abrasive particles that are coated on continuous web sheets vary in nominal size and coated particle-to-particle spacing when they are used to produce large rolls of web sheets that are referred to as jumbo rolls. When these large jumbo rolls are converted into abrasive disks or other abrasive products at later dates, there are often large variations in the cute rate performance of these abrasive articles that originate from the different jumbo rolls. The abrading performance difference of articles from different jumbos is most noticeable when the abrading is accomplished with robotic abrasive machinery that has defined consistent operating parameters.

Equal sized near-spherical shaped abrasive particles or abrasive beads also can provide a more uniform wear rate and surface finishing characteristic when used for fixed abrasive wheel type abrasive articles as compared to an abrasive wheel that is constructed with abrasive particles that have a range in particle sizes. In lapping, small individual abrasive particles make small workpiece material removal scratches and large particles make large scratches during the abrading process. Large particles are used initially in an abrading process for quick material removal to establish the geometrical configuration of the workpiece. Then, abrasive articles containing smaller individual abrasive particles are used to develop a smooth finish on the workpiece. It is most desirable that all the abrasive particle scratches have the same size for optimal abrading at each progressive stage of the abrading process. Then, the amount of material, which has to be removed to develop a smoother surface by the next smaller sized abrasive particles, is uniform across the surface of the workpiece.

Smaller particles have lower material removal rates so the correction of localized deep scratch defects from an earlier abrading stage can consume large amounts of production time.

Different processes can be used to produce soft-ceramic abrasive agglomerate beads. In U.S. Pat. No. 3,916,584 (Howard) described where he poured a slurry mixture (of abrasive particles mixed in a Ludox® solution of colloidal silica suspended in water) into a dehydrating liquid including various alcohols or alcohol mixtures or heated oils including peanut oil, mineral oil or silicone oil and stirred it. The liquid stream of abrasive slurry mixture breaks up into individual droplets as it is introduced into the stirred dehydrating liquid. The abrasive slurry droplets are formed into spheres by slurry-drop surface tension forces prior acting on the slurry droplets as the droplets are suspended in the dehydrating liquid. After the slurry droplets are formed into spherical shapes these spherical shaped droplets become solidified by the water depleting action of the dehydrating liquid on the individual spheres. The dehydrating liquid draws water out of the individual spherical slurry lumps whereby the spherical slurry lumps change from a liquid state and become solidified into spherical shaped abrasive beads. Beads produced by Howard in this patent vary in size considerably, with a batch of beads produced typically having a ten to one range in size for a given production lot where the process parameters are not changed during production of the lot. Howard described in detail all of the materials and processes he used to manufacture the abrasive agglomerate beads. In addition, he also described in detail the materials and processes that he used to coat the abrasive beads on a backing sheet to produce an abrasive sheet article. Further he described abrading tests of workpieces using the resultant abrasive article.

In U.S. Pat. No. 6,645,624 (Adefris, et al.) discloses the manufacturing of spherical abrasive agglomerates by use of a high-speed rotational spray dryer to dry a sol of abrasive particles, oxides and water. An abrasive slurry of abrasive particles mixed in a Ludox® colloidal silica water solution is introduced into the center of a rotating wheel operating at 37,500 revolutions per minute (RPM) where centrifugal action drives the slurry to the outside diameter of the wheel where it exits the wheel into a dehydrating environment of hot air. Typically, when using rotary atomizers, individual slurry streams exit spaced ports located at the wheel periphery and form into thin curved string-like or ligament streams of fluid at each wheel exit port opening. The slurry streams that exit the wheel have both a large tangential and radial fluid velocity. These individual curved slurry ligament streams are separated into a stream pattern of adjacent individual liquid slurry droplets as the high-speed stream moves through the stationary air. The individual liquid state slurry droplets are then drawn into individual slurry spheres by surface tension forces acting on the free-falling drops. Sphere sizes of the drops are controlled, in part, by adjusting the wheel rotation RPM. The slurry drops are formed into solidified abrasive beads by the dehydrating action of the hot air. Again, there is a wide distribution of abrasive sphere sizes produced by this method for a given production lot where the process parameters are selected and not changed during production of the lot.

Adefris described in detail all of the materials and processes he used to manufacture the abrasive agglomerate beads. In addition, he also described in detail the materials and processes that he used to coat the abrasive beads on a backing sheet to produce a resultant abrasive sheet article. Further he described abrading tests of workpieces using his resultant abrasive sheet article. Also he included comparative tests on his resultant abrasive bead sheet article as compared to an abrasive sheet article that uses the abrasive beads produced by the descriptions and technology in Howard's U.S. Pat. No. 3,916,584. Both the U.S. Pat. No. 3,916,584 (Howard) and U.S. Pat. No. 6,645,624 (Adefris, et al.) describe abrasive beads and abrasive sheet articles that are flat-coated with these beads. They do not describe the use of these abrasive beads where they are coated on the top surfaces of raised island structures that are attached to a backing sheet to produce raised island abrasive sheet articles.

Abrasive beads can also be formed by simply spraying a slurry mixture, from a paint sprayer type of spray device or other pressurized nozzles, into a dehydrating fluid (either hot air or a dehydrating liquid bath) but the range of liquid slurry droplets or abrasive beads sizes produced by these devices would vary considerably in a given production batch or in a given continuous production run.

Manufacture of Agglomerate Abrasive Beads

It is desired to produce equal sized abrasive particle filled ceramic spherical or near-spherical shaped agglomerate beads that can be coated on backing sheets or on backing-sheet raised island top surfaces to produce abrasive articles.

Among the earliest processes of making abrasive beads is a process developed by Howard in U.S. Pat. No. 3,916,584 where he poured a liquid slurry mixture of abrasive particles mixed in a Ludox® solution of colloidal silica suspended in water into a stirred dehydrating liquid. Stirring of the dehydrating liquid, as a stream of the slurry mixture was poured in, breaks up the slurry stream into small droplets having a variety of droplet sizes. As the stream of the liquid abrasive slurry mixture is broken up into segments, each broken elongated segment tends to draw together which provides a separation between adjacent slurry lump segments. Spherical liquid abrasive slurry mixture droplets were formed from the slurry lump segments by slurry-drop surface tension forces acting on the droplet lumps as they independently travel in a free-state while being stirred in the dehydrating liquid. The formation of the spherical droplet shapes occurs prior to the abrasive slurry spheres becoming solidified. Solidification of the spherical slurry droplets into spherical beads takes place as a function of the water-depleting action of the dehydrating liquid on the colloidal silica that is contained in the individual slurry mixture droplet spheres. The beads are formed from the mixture of abrasive particles and colloidal silica. Here, the abrasive particles are contained in a matrix of colloidal silica where the abrasive particles are much smaller in equivalent diameter size than the diameter of the formed abrasive-colloidal silica spheres. These abrasive beads produced by Howard vary in size considerably, with the beads produced in a single processed batch of beads typically having a ten to one range in size. Dehydrating liquids include various alcohols or alcohol mixtures or heated oils including peanut oil, mineral oil or silicone oil.

Adefris, et al., in U.S. Pat. No. 6,645,624 discloses the manufacturing of spherical abrasive agglomerates by use of a high-speed rotational spray dryer. Like Howard, he uses a liquid slurry solution mixture of abrasive particles, colloidal oxides and water. Here, the liquid abrasive slurry mixture is directed into the center of a rotating wheel having portholes positioned around the periphery of the wheel. Small streams of the liquid abrasive mixture are thrown out from the outer periphery of the wheel at each port hole opening due to the centrifugal forces that are imposed on the liquid when the wheel is rotated at high rotational speeds. The independent streams of the slurry mixture breaks up into small droplet segment lumps as the small and fragile curved streams of liquid travel at high velocity through an environment of relatively-stationary hot air. The droplet lumps have different lump sizes. As the stream of the liquid abrasive slurry mixture is broken up into segments, each broken elongated segment tends to draw together which provides a separation between adjacent slurry lump segments. Spherical liquid abrasive slurry mixture droplets are formed from the slurry lump segments by slurry-drop surface tension forces acting on the droplet lumps while they travel in a free-state trajectory in the heated air environment. The formation of the spherical droplet shapes occurs prior to the abrasive slurry spheres becoming solidified. The hot air acts as a dehydrating agent that removes some of the water that is contained in the spherical droplets. As the spherical droplets are dehydrated the spherical droplets are solidified into spherical abrasive-colloidal silica beads.

Abrasive agglomerate beads have been in use for some time but they typically have a random range of sizes as they are produced. These abrasive beads are coated on abrasive sheet articles or can be used on fixed abrasive articles including grinding wheels. The production of equal sized abrasive beads, as described here, is not possible with the production processes that are described for manufacturing the prior-art abrasive beads. In one prior art example, non-equal sized abrasive beads are produced by stirring a liquid stream of a slurry of a water based ceramic precursor material mixed with abrasive particles into a container of a dehydrating liquid. The dehydrating liquid is stirred and the slurry liquid tends to break into small lumps due to the stirring action. Faster stirring produces an average of smaller lumps that form into spherical shapes due to surface tension forces acting on the individual liquid slurry lumps. Dehydration of the slurry spheres produces solidified abrasive precursor beads that are heat treated to produce soft ceramic abrasive beads. In another prior art example, non-equal sized abrasive beads are produced by pouring a liquid stream of a slurry of a water based ceramic precursor material mixed with abrasive particles into the center of a wheel of a atomizer wheel that is rotating at a ultra high speed of approximately 37,500 RPM (revolutions per minute). The slurry tends to exit the wheel in ligament slurry streams that break up into individual slurry lumps that travel in a trajectory in a hot air environment that dehydrates the slurry lumps. The lumps form into spherical shapes due to surface tension forces acting on the individual liquid slurry lumps. Changing the rotational speed of the wheel changes the average size of the liquid lumps. Dehydration of the slurry spheres produces solidified abrasive precursor beads that are heat treated to produce soft ceramic abrasive beads.

The well known prior art abrasive beads, produced by these two Howard and Adefris prior art processes, do not have equal bead sizes. The materials of construction, the techniques of forming individual spherical liquid lumps by liquid slurry lump surface tension forces, the dehydration and partial solidification of the spherical slurry lumps by subjecting the spherical lumps to a dehydrating fluid (a dehydrating liquid or hot air), drying to remove non-bound water, further drying to remove bound water and conversion of the solidified spheres into soft ceramic abrasive beads by heat treatment processes (oven heating and furnace processing) and other manufacturing processes that are used in the production of the prior art abrasive agglomerate beads is well known in the art. Many of the same materials of construction, the techniques of forming individual spherical shaped liquid droplets from screen cell liquid slurry lump droplets by liquid slurry droplet surface tension forces, the dehydration and solidification of the spherical slurry droplets by subjecting the spherical droplets to a dehydrating fluid (a dehydrating liquid or hot air), drying to remove non-bound water, further drying to remove bound water to form solidified abrasive particle spheres and the conversion of the solidified spheres into soft ceramic abrasive beads by heat treatment processes (oven heating and furnace processing) and other manufacturing processes, or elements of them, disclosed for and used in the production of the Howard and Adefris prior art abrasive beads can be employed in the manufacture of the equal sized abrasive agglomerate described here. A number of variations in the selection of the abrasive spherical bead materials and the bead manufacturing processes are described here also to provide adequate guidance that someone skilled in the art can easily produce the described equal sized abrasive beads using many of same ways that this same skilled person can produce abrasive beads as described by the Howard and Adefris abrasive bead patents.

The slurry stream lump segments produced by Howard and Adefris from the slurry streams initially have a somewhat rectangular shape that is similar to the somewhat rectangular shape of the initial abrasive slurry lump segments that are produced using the open mesh screens as described here. In all three cases, surface tension forces acting on these somewhat rectangular liquid slurry lumps form them into liquid spherical shapes that are solidified by dehydrating fluids into soft abrasive slurry beads. The same types of heat treatments are employed in all three cases to convert the bead slurry silica ceramic precursor into a somewhat hardened porous ceramic material. This ceramic material acts as a matrix which surrounds and supports the individual diamond abrasive particles that are enclosed within the abrasive bead. The ceramic matrix material is harder and stronger than the typical polymer materials that could also be employed to surround and support the diamond abrasive materials to form abrasive beads. Because of the superior strength and adhesive bonding characteristics of the soft porous ceramic material as compared to polymer binders, abrasive articles that are coated with the porous ceramic matrix materials abrasive beads have superior abrading performance characteristics as compared to the polymer matrix material abrasive beads.

The colloidal oxide material used by both Howard in U.S. Pat. No. 3,916,584 and Adefris in U.S. Pat. No. 6,645,624 for sample preparation is a Ludox LS 30® solution of colloidal silica suspended in water, where the silica comprises 30% by weight of the colloidal solution.

Although not wanting to be bound by theory, it is believed that the density of the abrasive beads that are formed by the dehydrating liquids acting upon the liquid spherical abrasive slurry mixture droplets is a function of the rate of dehydration of the spheres that is provided by the dehydrating fluid. For instance, if a quantity of a solution of colloidal silica that is suspended in water is left to evaporate at room temperature, very substantial shrinkage will occur.

The volume of the solid silica product of this evaporation will typically be less than 10% of the original volume of the liquid colloidal silica solution. If the residual water that exists at the outer shell surface portion of the spherical abrasive mixture beads is removed quickly, the beads will tend to experience limited shrinkage during the dehydrating process. Here, the dehydrated bead outer shell will become partially solidified which will tend to prevent further significant shrinkage of the bead sphere shape. This process results in a partially solidified spherical bead even though all of the residual water has not yet been removed from the interior portion of the bead. A nominal abrasive bead size is established during this portion of the bead dehydration process. When equal sized spherical abrasive slurry bead droplets are subjected to a dehydrating fluid environment that provides consistent bead dehydration rates, these bead droplets will tend to shrink an equal amount before the bead shells become partially solidified. Individual partially solidified beads will also have the same nominal sizes. Once the bead shell becomes partially solidified the shell assumes structural characteristics where the bead shape remains intact unless the bead is subjected to external forces. The structural bead shell will tend to remain spherical and to retain the bead outside diameter when the remaining free water is removed from the bead interior during a subsequent bead drying process. The outer bead shell is made up in part of a porous ceramic precursor matrix. The porous shell allows diffusion, where the free water that is contained in the interior of the bead passes from the bead interior through the porous shell passageways to the bead exterior surface. These solidified beads are then subjected to further heat drying processes that remove the residual water from the interior portions of the beads that have the solidified shells. These dried beads are then exposed to more intense heating processes that remove the bound-water from the bead materials. Bound-water can remain in the bead structure after all the free-state water is removed by some drying processes. Typically the free-state water can be removed from the bead interior when the beads are subjected to temperatures that are above the boiling temperature of the water. Here, the contained heated liquid water is changed to water vapor, which is exhausted from the porous bead body because of the increased volume of the water vapor.

The exact processes of formation of spherical abrasive beads from the slurry mixture of abrasive particles and the colloidal silica particles that are suspended in water is complex. This is the case particularly for all the reactions that take place to form the porous ceramic matrix that surrounds and supports the individual abrasive particles within the envelope of the spherical abrasive beads. However, abrasive beads such as these have been successfully manufactured for years using the basic processes described here and in the abrasive bead manufacturing processes described by Howard in U.S. Pat. No. 3,916,584 and Adefris in U.S. Pat. No. 6,645,624. In these bead manufacturing processes, individual liquid droplets of the slurry mixture are formed and allowed to independently exist in a free state for a short period of time where each droplet is physically separated from other droplets. In this free state surface tension forces acting on the droplets forms the droplets into spherical shapes. These liquid spherical droplets are subjected to a dehydrating liquid that removes enough water from the droplet to partially solidify the droplet beads. Though the dehydration action, the liquid bead droplets become beads that are partially solidified. Each bead contains individual abrasive particles that are surrounded by a porous matrix of ceramic precursor material. This ceramic precursor material originates from the very small colloidal silica particles that were suspended in a water solution where the colloidal silica was mixed with the abrasive particles to form an abrasive slurry mixture. As the water is removed from the abrasive bead structure the very small silica particles form very small structures that are joined together with spaces between the structures. Often when a colloidal suspension of silica particles in a water based is gelled, the individual silica particles are joined together in small strings that have open areas between the silica strings. Silica strings are joined together to form silica structures where there are water filled open spaces between the structures. These structures of silica form a porous matrix of silica that surrounds and supports the individual abrasive particles. The free water that is contained in the volumes between the individual silica structures is removed from the spherical bead by heating processes which leaves a matrix of silica supporting the individual abrasive particles within the bead structure. Bound water requires a heating temperature that is higher than the boiling temperature of the water to remove it from the bead material. The density of the porous ceramic material is a function of the techniques that are used to solidify the beads during the bead dehydration process and the heat treatment processes that follow the dehydration process. Initially the silica forms a ceramic precursor material that supports the individual abrasive particles. After all drying and heat treatment process the silica precursor material is converted to a porous ceramic material.

The abrasive bead manufacturing processes described by Howard in U.S. Pat. No. 3,916,584 and Adefris in U.S. Pat. No. 6,645,624 produce abrasive spherical beads that are solidified on their exterior surfaces sufficiently that the beads do not stick to each other. However, the processes that both Howard and Adrefris use do not form equal sized abrasive slurry droplets. Their non-equal sized bead droplets are dehydrated to form partially solidified non-equal sized abrasive beads. All of the same materials of construction and all of the processes of dehydration and all of the processes of drying and furnace heat treatments that are used by Howard and Adefris for their non-equal sized abrasive slurry droplets can be directly applied to the equal sized abrasive slurry droplets that are produced by open mesh screens or open cell perforated sheets as described here in this invention.

The bead droplet dehydration process described here starts with equal sized spherical abrasive slurry bead droplets. In precision-flatness abrading applications, the diameter of the individual abrasive beads that are coated on the surface of an abrasive article are more important than the volume of abrasive material that is contained within each abrasive bead. An abrasive article that is coated with individual abrasive beads that have precisely the same equal sizes will abrade a workpiece to a better flatness than will an abrasive article that is coated with abrasive beads have a wide range of bead sizes. The more precise that the equal sizes of the volumes of the liquid abrasive slurry droplets are the more equal sized are the diameters of the resultant abrasive beads. Any change in the volumes of the abrasive slurry that are contained in the liquid state droplets, that are initially formed in the bead manufacturing process, affect the sizes, or diameters, of the spherical beads that are formed from the liquid droplets. However, as the diameter of a spherical bead is a function of the cube root of the droplet volume, the diameter of a bead has little change with small changes in the droplet volumes. When droplets are formed by level filling the cell holes in mesh screens or a perforated sheets there is the possibility of some variation of the volumetric size of the droplets. These variations can be due to a variety of sources including dimensional tolerances of the individual cell hole sizes in the mesh screens or the perforated sheets that are used to form the equal sized droplets. Also, there can be variations in the level filling of each independent cell hole in the screens or perforated sheets with the liquid abrasive slurry material. The cell hole sizes can be controlled quite accurately and the processes used to successfully level-fill the cell holes with liquid slurry are well known in the web coating industry. As the mesh screen liquid slurry droplet volumes are substantially of equal size, the diameters of the abrasive beads produced from them are even more precisely equal because of the relationship where the volume of the spherical beads is proportional to the cube of the diameter. Abrasive beads described by Howard indicate a typical bead size variation of from 7:1 to 10:1 for beads having an average bead size of 50 micrometers. These beads having a large 7 to 1 range in size would also have a huge 343 to 1 range in bead contained-volume. The combination of accurately sized cell holes and good-procedure hole filling techniques will result in equal sized liquid abrasive slurry droplets.

These slurry droplets are first dehydrated to form equal sized abrasive beads that have partially solidified external shells. In the abrasive bead manufacturing dehydration processes, the drying processes and the high temperature furnace processing can all be independently controlled to consistently provide the same amount of slurry droplet or bead shrinkage at each process step. The primary process parameters that are controlled in each thermal process event to achieve these consistent process-step shrinkages are temperature levels and process dwell times. Other process parameters can also affect the rate or amount of bead shrinkage in each step. However, the required accuracy of control of these process parameters for the equal sized abrasive beads is similar to the expected accuracy of control that is used to manufacture the non-equal sized abrasive beads as described by both Howard and Adefris.

Beads are typically manufactured in batches where all of the beads in one batch are subjected to the same sequence of process conditions where all of the independent beads in one batch will experience the same amount of shrinkage. Standards that are established for the desired shrinkage that is experienced at any process step can be used to change subsequent process parameters to increase or decrease the amount of shrinkage of the beads in that production batch. By using this technique of measuring the beads at the end each manufacturing process step, process parameter changes can be made to compensate for the actual shrinkage that was a result of earlier process step. Also, the size of the abrasive beads can be measured during a process event and immediate corrective changes can be made to the process parameters so that the nominal or average size of the beads within the batch at the end of that process event will be within the desired or allowable range of sizes already established for that process event. Process changes can be instituted manually or they can be done automatically with the use of feed-back process control equipment to modify the nominal size of the beads. If desired, beads can be sorted by size at the end of different process step and the new smaller sorted batches of beads can be processed individually in subsequent process step to provide beads that all have equal sizes. Or, a batch of beads can be processed and sorted by size after all manufacturing steps are completed. The primary objective is to produce abrasive beads that all have the same nominal or same average size to produce flat and smooth workpiece surfaces. If equal sized beads are produced that have an average size that is less than the desired target size, more of these slightly undersized beads can be coated on an abrasive disk article to provide an abrasive article that has the same desired amount of product functional life. Because the liquid abrasive droplets were all of equal size initially, each individual abrasive bead would contain the same number of individual abrasive particles, even if some of these beads experienced more or less shrinkage during the bead manufacturing process. The size of the liquid droplets that are used to produce a desired size of finished-product abrasive beads is oversized relative to the finished beads by the overall shrink factor that is experienced during all of the manufacturing processes. The overall shrink factor is the sum of the individual shrink factors that occur in each of the process steps. The oversized or undersized abrasive beads that are produced by Howard and Adefris each contain more or fewer individual abrasive particles that the desired nominal sized abrasive bead. It is not practical to take a batch of the Howard or Adefris abrasive beads, where individual beads contain different quantities of abrasive particles, and adjust the outer diameter of the beads to a nominal size by changing the bead manufacturing process parameters as these individual beads would not have consistent abrading characteristics. Beads of equal size that contain more than average abrasive particles would tend to abrade more aggressively than the same sized bead containing the desired average number of contained abrasive particles.

Shrinkage of the beads during the various drying and furnace firing process steps requires that oversized beads are produced from the liquid abrasive slurry which will compensate for this shrinkage. Due to the consistent shrink that is experienced at each process heating step, it is possible to determine the amount that beads are initially oversized to provide the desired size of the finished beads that are coated on an abrasive article. It is possible to control the amount of shrinkage that takes place in each of the various bead manufacturing process steps by changing the process control parameters. Generally, the overall shrinkage of the beads is nominally consistent as is demonstrated by the acceptability of the finished abrasive bead sizes that are produced in the bead manufacturing processes that are described by both Howard in U.S. Pat. No. 3,916,584 and Adefris in U.S. Pat. No. 6,645,624. The nominal finished bead sizes of Howard consistently averaged 50 micrometers. He also started the abrasive bead manufacturing process with initially oversized spherical liquid abrasive slurry droplets to compensate for the shrink he described to provide the 50 micrometer finished abrasive beads.

Both Howard and Adefris have process methods to change the average size of their beads but the process parameters that they use to provide average bead size changes are somewhat casual compared to establishing equal sized slurry droplets as described in this invention. They simply change the velocity of the continuous streams of liquid abrasive slurry relative to the dehydrating fluid, which influences how the liquid abrasive streams break up into stream-segment droplets. There are many complex hydrodynamic factors that take place when the nominal speed of the slurry streams is changed to produce larger or smaller abrasive slurry droplet sizes. One of the primary factors in changing the size of the droplets is the shearing action that the dehydrating fluid imposes on the liquid abrasive stream. Controlling the imposition of predictable and consistent dynamic fluid interface forces at all positions along a narrow slurry stream is very difficult when both the slurry stream and the dehydrating fluids have varying fluid velocities at different locations in the dehydrating fluid vessel. Unless these imposing fluid forces act on the slurry streams in a way that sets up dynamic instabilities at periodic positions along the length of the slurry stream, these instabilities will not break the slurry stream into equal sized stream segments. If the liquid slurry segments are unequal in length, the resultant slurry droplets will not be equal in size. If the liquid slurry droplets are unequal in size, then the abrasive beads produced from these droplets will be unequal in size.

Another factor that is present in the works of both Howard and Adefris is the control of the diameter of the moving liquid slurry streams that are introduced into the dehydrating fluids. In the case of Howard, when a liquid stream of slurry is pored into a dehydrating fluid, there is no control of the diameter of the slurry stream. If a liquid stream of greater diameter is broken up into slurry lump segments by the dynamic impinging forces of a stirred dehydrating liquid, the stream will tend to break into larger volume segments than those resultant segments from a smaller diameter slurry stream. Howard also describes the use of a hollow hypodermic needle to inject a liquid abrasive slurry into a moving dehydrating liquid. The mechanisms of developing slurry droplets from liquid slurry that exits the free end of a small tube that is inserted into a vat of dehydrating liquid are again very complex and are subject to many different process-control operating conditions. These conditions include whether the dehydrating fluid is moving at the time of slurry injection, the velocity of slurry injection, and the velocity and vector direction of the dehydrating liquid relative to the end of the slurry tube. These and many other factors influence the sizes of the slurry droplets and the consistency of droplet sizes of the droplets that are formed from a hypodermic tube. When Adefris uses an ultra-high speed rotary wheel to form filament types of slurry streams that move in a curvilinear fashion through a environment of hot dehydrating air, the control or the importance of control of the diameter of each independent slurry stream that exits the wheel is not described. Any variation in the diameter of one rotating wheel slurry stream relative to the diameter of the other wheel streams will produce slurry droplets in a production bead-batch that are of unequal sizes.

Equal Sized Abrasive Beads from Vibrating Hypodermic Needles

Problem: It is desirable to have equal sized abrasive particle filled spherical beads for coated abrasive sheet articles and fixed abrasive wheel articles.

Solution: Equal sized abrasive beads can be produced with the use of hollow hypodermic needles that are vibrated at controlled frequencies to produced equal sized droplets of liquid abrasive slurry. A slurry of small abrasive particles that are mixed with a water based solution that contains suspended minute particles of silica colloidal can be introduced into the base of a hypodermic needle that has a controlled needle tube inside diameter and needle controlled length. When pressure is applied to the slurry at the base of the tube, slurry exits the exit end of the tube in a stream that has perturbations in the stream diameter. These stream diameter perturbations are periodic as they are caused by the pulsations that are set up in the slurry stream flow as the stream travels down the length of the tube inner diameter. The periodic distance between the small stream diameter perturbation neck-downs is a function of the natural frequency of the liquid slurry flow within the tube. As the perturbed slurry stream exits the tube, the stream has a tendency to break into segments where each slurry segment forms a slurry droplet. The slurry droplets can be dehydrated in a dehydrating fluid to form spherical abrasive beads. The beads can then be further dried and calcined in a furnace to form spherical abrasive beads that have abrasive particles that are surrounded in a porous ceramic matrix. Calcining of the beads by firing them in a furnace sinters the individual contacting silica particles together so that these contacting silica particles are fused together to form a porous ceramic matrix that surrounds and supports the individual abrasive particles that are contained in the beads. A suspension of metal oxide particles in water or a Ludox® LS 30 solution of colloidal silica suspended in water is typically mixed with small abrasive particles to form a liquid abrasive slurry mixture. The individual silica particles that are suspended in the water solution typically have a diameter of 12 nanometers, or smaller. They are very small compared to diamond abrasive particles that typically have sizes of from 0.1 to 3.0 micrometers. Many of the silica particles contained in the silica based porous ceramic matrix are in contact with each of the diamond, or other abrasive material, particles. These abrasive beads can be coated on an abrasive article. The droplets produced by a non-vibrating needle tube can have a wide range of sizes, which is undesirable.

Hypodermic tubes are selected for the manufacture of abrasive beads because they have the small inside diameters that are required to make the small diameter abrasive beads where the beads have finished (dried and calcined) diameters of from 20 to 150 micrometers (0.8 to 0.006 inches). The tubes can eject the slurry droplets directly into heated air streams where they are suspended until surface tension forces create spherical shapes to each droplet before they are solidified. The tubes can also be used to eject a steam of abrasive slurry into a vat of stirred dehydration liquid where the stirred liquid will tend to break up the slurry stream into stream segments. These slurry segments are suspended in the dehydrating liquid during which time surface tension forces act on each segment to form it into a spherical slurry shape before the spherical is solidified into a bead.

To improve the performance of the needle tube system in the manufacture of equal sized abrasive slurry droplets, vibration can be added to the needle tube system. Here, the slurry liquid or the needle body or both the slurry liquid and the needle body can be excited with vibratory excitation sources. As the liquid slurry is forced through the length of the needle body at a controlled flow velocity, there will be fluid flow natural frequency pulsations that are set up in the needle flow tube where the liquid slurry will tend to exit the end of the needle tube in a series of droplets that have equal sizes. This fluid flow natural frequency tendency is not strong enough to consistently produce individual abrasive slurry droplets at the exit end of the tube that have the desired equal droplet sizes. The droplet sizes produced by this fluid flow natural frequency system and the frequency of the fluid flow oscillations is dependent on a number of parameters including: the viscosity and density characteristics of the liquid slurry; the tube inside diameter size; the tube length; the driving pressure that propels the slurry down the length of the tube; and the velocity of the slurry liquid within the tube. A single hypodermic tube can be used to form equal sized abrasive beads or multiple tubes can be ganged together where each of the tubes produce independent streams of equal sized slurry droplets. Vibration, that has a frequency that is close to the natural tube fluid flow natural frequency, can be applied to the physical tube or tubes or to the slurry fluid itself where this applied excitation frequency enhances the fluid flow natural frequency. This applied vibration frequency will oscillate the physical tube apparatus or oscillate the fluid itself in a manner that will enhance the development of individual equal sized slurry droplets that exit the end of the tubes. The applied excitation frequency can also be a frequency that is different than the natural fluid flow frequency where the applied excitation frequency dominates the effects of the fluid flow frequency in forming the equal sized droplets. Both the frequency and the amplitude of the vibration frequency can be controlled to optimize the formation of equal sized abrasive droplets. The excitation vibration can be applied in different directions on the abrasive bead system. Here, one option is to vibrate the end of the tubes to provide a shearing action that is at right angles to the direction of flow of the slurry stream that exits the tubes. Also, the vibration can be applied in a direction that is aligned with the centerline of the tube. Another option is to apply the vibration in three dimensions relative to a fixed X, Y, Z position located at the exit ends of the tubes. Vibration excitation pulsations that are applied to the fluid itself would tend to oscillate the fluid that resides within the tube in a direction along the length of the tube, which would aid in the formation of individual equal sized slurry droplets. Vibration excitation of the fluid can be done with the use of vibration transducers that are placed in the slurry vat that supplies slurry to each of the tubes. Different fluid excitation frequencies and different excitation amplitudes, including frequencies that are multiples of the physical tube frequencies, can be simultaneously applied to the slurry bead production system to enhance the formation of equal sized slurry droplets.

Surface Indented Abrasive Beads

Problem: It is desirable to increase the adhesive bonding strength of abrasive beads that are attached to a backing.

Solution: Abrasive beads can be indented by various methods to increase the surface area of the beads and to provide indentations that are filled or partially filled with the adhesive binder that is used to attach the beads to a backing. The beads can be indented prior to full solidification or the beads can be indented after full solidification. The beads can retain their original spherical shapes or they can be somewhat distorted in shape by the indentation process. In one embodiment, non-solidified beads can be mixed with sharp pointed particles and this mixture can be processed through nipped rollers to indent the beads with the sharp particles. Then the beads can be separated from the sharp particles. In another embodiment, the beads can be blasted with sharp edge particles to indent the beads.

Hydroplaning

The problem of hydroplaning of workpieces at high abrading speeds in the presence of coolant water was unknown for some time as the cause of non-flat surfaces being abraded on precision flat lapped workpieces. The solution to this problem was established as the use of precision thickness raised island abrasive annular disks that are coated with monolayers of diamond particle filled erodible abrasive beads.

Water Coolants Used with Raised Island Abrasive Articles

The water used with high-speed raised island abrading articles performs two functions. One function is to cool the abrasive material and the workpieces and the other function is to clean the system, comprising the abrasive and the workpiece, of the abrading debris during the abrading event.

Typically, coolant water is continuously applied at a location at the central portion of the abrasive disk as the disk rotates or across the surfaces of all of the moving abrasive raised islands at a location that is upstream of the workpiece. Coolant water that is applied to the top flat surfaces of the raised islands wets both the abrasive island top surfaces and the abrasive-contacting bottom surface of the workpiece. As the water is present in the immediate areas of abrading contact it cools both the abrasive material and the workpiece material. In this way the coolant water removes the heat that is generated by the abrading action and overheating of both the abrasive material and the workpiece material is avoided.

Clean-up is maximized and contamination of the lapping machine, the abrasive disks and the workpieces is minimized with this high speed lapping system by using coolant water on the raised island fixed abrasive disks. The system is self-cleaning in that the coolant water washes the grinding debris particles off the workpiece and off the abrasive surfaces and into the recessed channels that exist between the raised island structures. Because the debris is removed from the interface between the abrasive and the workpiece, this removed debris does not cause undesirable scratches on the workpiece surface. Centrifugal forces, that are the result of the high speed rotation of the platen that supports the abrasive disk, moves the coolant water in an outward radial direction in the recessed channel passageways. As the water moves to the outer periphery of the disk it tends to pick up grinding debris that was generated by the abrading action. This moving water flushes the debris radially outward to the outer periphery of the abrasive disk where the water and the debris are flung outward away from the outer periphery of the disk.

This grinding debris is comprised of: broken pieces of abrasive particles; pieces of component materials that are used to bind the abrasive agglomerate beads to the abrasive article; particles that were removed from the workpiece surface; and other solid or liquid materials that were added to enhance the abrading process. Water container devices are typically built into the structure of the lapping machine, in a machine region that surrounds the platen, to collect this spent water and direct it through liquid flow channels into common piping that routes it to a water container vessel. The continuous streams of spent water exiting the disk, containing these debris materials, is easily collected and the small volume of solid abrading debris can be conveniently separated from the water and disposed of. The stream of separated water can be easily filtered and disposed of also.

Chemical additives, solvents, liquids, and other materials that promote or increase the effect of mechanical abrasion of a workpiece, including but not limited to the liquids and other additive materials that are commonly used in chemical mechanical planarization (CMP) abrading, can be added to the coolant water used here to enhance the abrading process. Materials and chemicals that can be added to the water or added as an abrading material to the abrasive surface during the abrading process comprise acids or other chemicals to adjust the chemical PH of the water-based coolant, colloidal solutions of silica and alumina, and ceria material. These water additives can be selected based on the workpiece material and the abrading process conditions.

Stiction Forces

As a workpiece becomes precisely flat and smooth, the coolant water that is present in the interface between the workpiece and the abrasive acts as a drag on the workpiece. When the water film becomes very thin the dragging or stiction force can become very large.

Stiction is defined by Annen in U.S. Patent Application No. 2003/0022604 (Annen et al.) and U.S. Patent Application No. 2003/0207659 (Annen et al.) as the condition in lapping operations whereby the combination of a coolant fluid such as water and the typical smooth abrasive coating creates a condition whereby the fluid acts as an adhesive between the abrasive coating and the workpiece surface which causes these surfaces to stick together with unwanted results. Stiction tends to occur frequently with lapping type abrasive articles where the abrasive particles are imbedded in a binder that provides a smooth surface to these abrasive sheet articles. The shaped abrasive coatings that are applied to the flat top surfaces of the raised island structures is a pattern of shaped abrasive bodies. Each formed shaped body has an individual height and a volume and body base area and where each shape body has raised and recessed portions. The presence of the recessed valley areas between the raised island structures allows fluid flow at the working face of the abrasive article without undesirable stiction taking place.

Workpiece Stiction Forces

Problem: It is desired to construct an abrasive article that minimizes the "stiction" between the surface of a flat surfaced abrasive sheet article and a flat workpiece when water is used as a coolant during a flat lapping abrading process. Here, the workpiece appears to be "attached" or "adhesively bonded" to the abrasive sheet which is referred to as "stiction". This stiction is caused by the very thin continuous interface film layer of water that is in mutual contact with the flat surfaces of both the workpiece and the abrasive. This stiction problem exists at very low abrading speeds but is particularly troublesome during high speed flat lapping processes.

When a typical workpiece holder having a spherical center of rotation is used, the stiction force can pivot or tilt the workpiece during the abrading action thereby causing undesirable non-flat workpiece surfaces. The effect of water film stiction increases as a workpiece surface is made increasingly flat because the interface water film becomes thinner and increasingly uniform in thickness. Also stiction increases as the abrasive particles wear down in height because the water that is located between individual abrasive particles or abrasive agglomerate beads becomes reduced in height. It is well known that the water film shearing force between two flat plates moving with a relative speed will increase proportionately as the water film thickness is reduced and also proportionately increase as the speed is increased. The viscosity of the water provides the resultant water shearing forces. Therefore sliding stiction forces are very large for high speed flat lapping because the interface water films are so thin and the abrading speeds are so large. Workpieces having large surface areas also have large stiction forces. Further, the very small sized abrasive agglomerate beads that are used for high speed flat lapping typically results in large stiction forces as compared to the stiction forces of larger sized conventional abrasive particles that are used for conventional non-flat-lapping abrading action because the interface water films are typically thinner for the beads.

Solution: During flat lapping, water is used as a coolant to remove heat that is generated in localized areas where a flat abrasive surface contacts a flat workpiece surface. This water exists as a thin water film that mutually contacts both the workpiece and the abrasive. The water is used to cool both the workpiece surface and the abrasive particles. Flexible sheet abrasive disks are attached to a rigid flat rotary platen that provides a horizontal abrasive surface. When abrasive disk articles having monolayers of very small sized abrasive agglomerate beads that are continuous coated on the disk flat non-island backing surfaces are used for high speed flat lapping, large stiction forces exist between the workpiece and the abrasive.

During the abrading process water is applied to the moving flat abrasive surface and a rotatable workpiece holder holds the workpiece in flat contact with abrasive. The workpiece holder has a spherical action pivot joint to allow full flat face contact of the workpiece surface with the flat abrasive even with very small perpendicular misalignment of the workpiece holder rotation axis with the abrasive surface. Initially, high spots on the surface of a workpiece are in contact with an abrasive surface before low spots, or low areas, of a workpiece contact an abrasive surface. The contact force applied between the abrasive and the workpiece is concentrated in these small contact areas and this concentrated force tends to create localized heating of small portions of the workpiece surface. Often this localized heating can induce large thermal stress in the workpiece, which can cause localized cracking, or micro-cracks, in the workpiece due to the large temperature gradients that are generated by the localized heating. Temperatures can also become high enough in localized abrasive areas, such as at the tip of a single diamond abrasive particle, that the particle tip can become carburized and dulled if it is not adequately cooled with water. This localized heating can occur even though the average temperature of a somewhat larger area that surrounds the particle tip is quite low where it doesn't even reach a water boiling temperature.

Air can not be used effectively as a coolant to reduce these large temperatures as air is a poor heat transfer medium as it has low convection heat transfer coefficients and also has low thermal mass heat absorption capabilities. Water is a preferred coolant as water because it does not contaminate workpieces and also because of it tremendous cooling capacity, particularly as it boils when heated past its boiling point of 212 degrees F. The boiling water provides both a very large coefficient of convective heat transfer and also large heat energy absorption due to the large heat of fusion of water. Coolant water that boils in the very localized high temperature areas provides excellent cooling in these areas and a low enough temperature to protect a workpiece from thermal stresses or diamond particles from thermal degradation. Here, the localized generated heat that is transferred to the water can form small quantities of steam, which is moved away from the hot spot on the workpiece or abrasive by the moving abrasive. After moving to a cooler area this steam tends to be condensed back into liquid water.

Stiction problems with the use of coolant water become apparent when a conventional non-island continuous surfaced abrasive lapping sheet, having a thin and relatively smooth coat of small abrasive particles, or abrasive beads, is used to flat lap a workpiece surface at high abrading speeds. As the workpiece becomes more flat and smooth the interface water film between the workpiece and the abrasive becomes thinner and stiction becomes more pronounced.

Stiction can manifest itself in two ways. For example, when the interface water wetted workpiece is moved away from the mutually water wetted abrasive in a direction perpendicular to the abrasive surface, the interface water film acts as a bonding agent between the workpiece and abrasive surfaces. This bonding action takes place as the water is basically non-elastic (incompressible, and also, non-stretchable until the vapor pressure of the water is reached) and the volumetric change in the water film volume required as the two surfaces are separated can not easily take place. Upon workpiece separation, an extra volume of replacement water is required at the interior of the workpiece water film area to allow the workpiece to successfully separate from the abrasive surface. This extra water has to flow the long distance across the full radius, or full half-width, of a flat workpiece surface inward to the center of the workpiece from the outer periphery of the workpiece perimeter. This new added volume of water has to travel toward the workpiece surface center through the very small gap that exists between the flat workpiece and flat abrasive sheet mutual surface areas. Water is much too viscous to flow through this very thin interface gap easily so the workpiece appears to be "attached" or "adhesively bonded" to the abrasive sheet when the flat workpiece surface is withdrawn perpendicular from the flat abrasive surface. This bonding or attachment is referred here to as one form of "stiction".

Further, another form of stiction can occur. For example, when a workpiece that has been ground precisely flat and is positioned flat to the flat surface of a very smooth lapping film abrasive sheet with a layer of interface coolant water between the workpiece and the abrasive, a force is required to move the workpiece laterally along the surface of the abrasive. Here the workpiece is slid parallel along the surface of the abrasive. The force required to make this lateral workpiece movement tends to increase dramatically as the workpiece is lapped into a more flat and smooth surface condition. The lateral motion of the workpiece shears the very thin layer of interface coolant water that exists in the gap between the two flat surfaces. The force required to move the workpiece against this water film lateral shearing force increases as the velocity of the motion is increased, as the water film thickness decreases and the surface area size of the workpiece increases. This lateral force is also be referred to as "stiction".

One example of this type of "stiction" can be seen by observing the "adhesive bonding" action that takes place when the water wetted flat surfaces of two glass plates are mutually positioned together with a very thin film of water in the small interface gap between the plates. After the plate are in full-faced flat contact the plates become "adhesively bonded" to each other. Here it is very difficult to pull the two plates apart from each other in a direction that is perpendicular to the plate flat surfaces. Also, it is very difficult to slide one plate along the surface of the other plate.

In addition to these coolant water film viscous water film shearing effects, when abrasive surface particles attached to a moving abrasive sheet article interlock with very small imperfections located on the surface of a workpiece, additional "stiction" forces can be present when a force is applied to slide the abrasive surface along the workpiece surface.

The undesirable effects of stiction that is caused by planar coolant water viscous shearing forces that occur during the latter stages of flat lapping workpiece surfaces can be significantly reduced. This is done by breaking up the continuous abrasive surfaces into small raised island segments and providing relief recessed water passageways between the small abrasive islands. The workpiece can be easily pulled away in a perpendicular direction away from the flat surface of the abrasive as water, or air, from the island-edge recessed passageways can be easily drawn with small "pulling forces" into the individual small interface island areas. The water or air only has to travel short distances from the edges of the small islands to the center of the island surfaces. Because of the short replacement fluid travel distances, the workpieces can be easily pulled away from the abrasive surface with small pulling forces.

When abrasive raised islands are used in place of a continuous abrasive surface the viscous sliding friction (stiction) is also reduced. This reduction of sliding friction occurs in part because the total abrasive surface area that contacts a workpiece surface is reduced because the abrasive surface consists of island areas that have a reduced contact area than does a continuous coated abrasive area. The area of the interface water film that is sheared by the sliding action between the workpiece and the abrasive is substantially reduced because of the smaller raised island abrading contact surface area. In addition, it is well known by those skilled in tribology that textured surfaces have substantially reduced liquid-film sliding friction as compared to sliding contact of continuous surfaced components. As the abrasive raised island surfaces can be considered "textured" surfaces, a substantial reduction of sliding friction or stiction is expected from the same surface effects that take place for other non-abrasive textured surfaces.

Use of a workpiece holder than has a spherical center of rotation that is located at or very close to the plane of the flat abraded surface of the workpiece minimizes rotation of the spherical action workpiece holder due to sliding stiction during the abrading action. Because the workpiece holder does not tend to rotate due to the sliding stiction or friction forces, the workpieces does not tilt during the abrading action and resultant non-flat areas are not abraded into the surface of the workpiece.

FIG. 133 is a cross sectional view of two flat plates in contact with a thin film of water separating the plates. A top flat plate (or workpiece) workpiece 2490 is shown in flat contact with a bottom flat plate 2494 that has a top thin layer of water 2488. The bottom plate 2494 is shown as having a flat surface but this shown plate 2494 can also represent a flat abrasive article, attached to a flat platen, that has a thin continuous coating of abrasive beads where the beads are covered with a thin continuous coating layer of water 2488. The bottom plate 2494 moves relative to the top plate (workpiece) which results in the water 2488, having a water thickness 2486, being sheared by the relative speed between the top plate 2490 and the bottom plate 2494. This water 2488 shearing action results in a "stiction" shearing force 2492 being applied to the top plate 2490 where the shearing force 2492 acts on the water 2488 wetted surface of the workpiece plate 2490. This stiction shearing force 2492 can be substantial in magnitude when the relative speed of the bottom plate 2494 is great and the water film thickness 2486 is small and the plate 2490-to-plate 2494 contact area having a shown contact dimension 2496 is large. The shearing force 2492 tends to tilt the workpiece 2490 and to deflect a workpiece holder (not shown) which actions result in non-flat abraded workpiece 2490 surfaces.

FIG. 133 can also be used as a representation of slurry lapping to show why a flat workpiece that is in abrading contact with an abrasive slurry coated platen slurry lapping must be performed at such slow abrading speeds to provide precision flat workpieces. Here, a top flat plate (or workpiece) workpiece 2490 is shown in flat contact with a bottom flat platen 2494 that has a top thin layer of liquid abrasive slurry 2488. The stiction shearing force 2492 can be substantial in magnitude when the relative speed of the bottom platen 2494 is great relative to the workpiece 2490 and the slurry film thickness 2486 is small and the workpiece plate 2490-to-platen 2494 contact area having a shown contact dimension 2496 is large. Unless the platen is operated at slow abrading surface speeds, the shearing force 2492 will tend to tilt the workpiece 2490 which will result in non-flat abraded workpiece 2490 surfaces.

FIG. 134 is a cross sectional view of a flat plate workpiece in contact with water wetted abrasive bead coated raised islands. This figure compares the use of raised island abrasive articles with continuous coated abrasive articles that shown in FIG. 133. A top flat plate (or workpiece) workpiece 2506 is shown in flat contact with individual raised islands 2498 that are coated with abrasive beads 2500 that are fully wetted by water 2502. The water 2502 wetted islands 2498 have very small water 2502 areas that have relatively small island 2498 abrading contact dimensions 2504 compared to the continuous coated abrading contact dimension 2496. The bottom plate abrasive article 2510 backing to which the islands 2498 are attached moves relative to the top plate (workpiece) 2506 which results in the workpiece 2506 contacting-water 2502 being sheared by the relative speed between the workpiece plate 2506 and the abrasive beads 2500. This water 2502 shearing action results in a "stiction" shearing force 2508 being applied to the workpiece plate 2506 where the stiction shearing force 2508 acts on the water 2502 wetted surface of the workpiece plate 2506. This shearing force 2508 is very small even when the relative speed of the abrasive article 2510 is great. Also, the water 2502 film thickness 2486 is small because the island length dimensions 2504 are small compared to the continuous coated abrading contact dimension 2496 where excess island water 2502 easily escapes over the vertical sides of the islands 2498. The water 2488 that resides in the gap between the workpiece plate 2490 and the continuous coated abrasive 2494 is trapped in the interface gap and can not be easily reduced in thickness 2486 because the interface distance 2496 is substantially greater than the island dimension distance 2504. Because the shearing force 2508 is so small, the force 2508 does not tend to tilt the workpiece 2506 or to deflect a workpiece holder (not shown). This substantially reduced stiction force 2508 results in precision flat abraded workpiece 2506 surfaces.

Interface Layer of Coolant Water

Problem: It is desired to construct an abrasive article that minimizes the formation of thick layers of slow moving water films that become attached directly onto the surface of a horizontal workpiece that is in flat surfaced contact with an abrasive article moving at high abrading surface speeds to perform flat lapping. In this high speed lapping process the workpiece nominally has a flat surface. Continuous coated abrasive bead disk articles have flat surfaces which are required to develop precision flat workpiece surfaces that are also highly polished by the abrading action. These abrasive disk articles that have continuous monolayer coatings of very small sized abrasive particle filled beads can be mounted on flat rotary platens to flat lap workpieces. However, the lapping procedure is quite slow because the disks can not be successfully operated at high abrading speeds. When these continuous coated disks are mounted on high-speed precision-flat rotary platens the workpiece surface are abraded smooth but they are not precisely flat. Because a coolant film of water is applied to the top flat surface of the moving flat abrasive surfaces the workpieces often tend to "float" or "hydroplane" on the water during the abrading process. This hydroplaning action can lift the leading edges of the workpieces and tilt the workpiece relative to the flat abrasive surface. Abrading the tilted workpiece surface results in an undesirable non-flat workpiece surface. The allowable amount of workpiece tilting during high speed lapping is exceedingly small compared to tradition types of abrading processes because the required surface flatness variations of the lapped workpiece are so extremely small.

In high speed lapping, when using a continuous-coated abrasive bead article, coolant water is applied in contact with an abrasive surface that is essentially a "smooth" surface. Because the abrasive disk article gap spaced abrasive beads have such small diameters they form a planar abrasive surface that is smooth to the touch. Here, even the heights of the non-worn monolayer of the typical 0.002 inch (51 micrometer) abrasive beads is very small compared to the typical thickness of the coolant water that is present on the surface of the abrasive.

In addition, as the water coated abrasive surface moves at very high abrading speeds some of the coolant water can even be substantially increased in thickness as the moving water film impacts the leading edge of a stationary workpiece. Also, this layer of water can be dragged under the workpiece by the moving abrasive to form an interface layer of water that exists in the gap between the flat abrasive surface and the flat workpiece surface. Thick layers of interface water under the workpiece surface can prevent portions of a workpiece surface from laying flat against the surface of an abrasive article. This can result in the workpiece being abraded non-flat as the moving abrasive contacts only portions of the workpiece. In some cases the water fluid interface layer can become so thick that the individual abrasive particles can not reach through the thickness of the interface layer to contact a workpiece surface. Here the water interface layer can cause hydroplaning of the workpiece where portions of, or all of, the workpiece is held away from contact with the abrasive particles as the stationary workpiece "floats" on the fast moving water.

Solution: An abrasive article having abrasive coated raised island structures can be used to reduce the effect of hydroplaning of a water-cooled workpiece during abrading, as compared to an abrasive article having a flat abrasive surface. Water is typically applied as a free stream to a flat surfaced non-island continuous-coated abrasive surface moving at a steady surface speed at a location upstream of the stationary workpiece. The continuous abrasive coating can be a continuous coating of spaced abrasive agglomerate beads that are coated on a substrate or it can be a continuous coating of abrasive particles that are mixed with a resin and the abrasive mixture is coated on a substrate. Because the high speed abrasive surface moves at a high speed and the applied water stream travels at relatively low speeds, the portion of the water that contacts the moving abrasive becomes attached to the abrasive and also moves at high speeds. However, the top portion of the layer of the applied water stream that is some distance away from the surface of the abrasive does not initially move at the high speed of the abrasive. The bottom portion of the water that directly contacts the moving abrasive tends to immediately move at the same speed as the abrasive. If there is sufficient distance between the location where the applied water contacts the moving abrasive and the workpiece, all of the applied water film thickness that contacts a workpiece will be moving at the same speed as the abrasive.

When this thick layer of applied coolant water is carried along at high speeds on the flat surface of the abrasive and impacts the leading edge of the workpiece, the water is quickly decelerated as it contacts the workpiece. Sudden deceleration of the water develops a very high water pressure that now exists wherever this water contacts the workpiece leading edge. This high pressure water is then driven into any crevice that exists in the interface gap between the workpiece and the abrasive surface at the leading edge of the workpiece. The high pressure water that penetrates the interface gap can easily lift the front leading edge of the workpiece. Lifting the front edge of the workpiece creates an even larger crevice gap and even more of the high pressure water is injected into the crevice, lifting the front edge of the workpiece to a even higher level. Because the leading edge of the workpiece is lifted by the water, the trailing edge of the workpiece is correspondingly forced down into the moving abrasive and excessive abrading takes place exclusively at the trailing edge. No abrading takes place at the leading edge because the injected water separates the workpiece from the abrasive surface at that location. Abrading only the trailing edge of the workpiece develops a non-flat workpiece surface, which is highly undesirable.

Water is typically applied at the entry of the interface between a workpiece (considered here to be stationary) and the abrasive article, as the abrasive is moving relative to the workpiece. In the case on a continuous flat non-raised island abrasive surface this water is carried into the small gap that exists between the abrasive surface and the workpiece surface. The action of the moving abrasive article carrying the layer of water into the gap space between the abrasive and the workpiece develops a interface layer of water that is attached to the surface of the moving abrasive. This interface layer has film thickness that separates the surface of the workpiece from the surface of the abrasive.

Because there is a relative speed difference between the workpiece and the abrasive flat surfaces there is a velocity gradient across the thickness of the interface layer of water. The portion of the interface layer water film that is in direct contact with the surface of the moving abrasive surface is attached directly to the abrasive surface and is moving at the same velocity as the abrasive surface. Likewise, the portion of the interface layer water film that is in direct contact with the surface of the stationary workpiece surface is attached directly to the workpiece surface and has no velocity. Because the velocity gradient exists across the thickness of the interface layer and because water has substantial viscosity, the interface layer water is sheared by this velocity gradient. The shearing forces that are imposed on the interface layer of water by the moving abrasive surface drags this layer of water deep into the interface gap between the abrasive surface and the workpiece surface.

Water that is drawn into the gap area between the workpiece and the abrasive can separate the workpiece from physical contact with the abrasive due to the thickness of the formed water interface layer. Separation by the interface layer can prevent individual abrasive particles that are coated on the surface of a workpiece from having abrading contact with a workpiece. Full-sized unworn abrasive particles or abrasive beads that are coated on the surface of a abrasive lapping sheet article typically have un-worn sizes or diameters that are only 0.002 inches (51 micrometers). These particles are usually imbedded into a polymer resin binder coating to where only two thirds of the non-worn down individual full-sized abrasive particles are exposed above the surface of the supporting binder layer. When the abrasive particles or abrasive beads are half worn they project much less than 0.001 inch (25 micrometers) from the abrasive binder surface but the thickness of the interface layer remains the same. It becomes more difficult for these worn abrasive beads to maintain abrading contact with the surface of the workpiece as the abrasive wear continues in the presence of substantial interface layers of water.

In high speed lapping operations coolant water is typically applied to the surface of a moving abrasive surface as a liquid spray or a water mist where it is carried under a workpiece surface to temporarily reside in the gap that exists between the workpiece surface and the abrasive surface. Water that already exists in the gap between the workpiece and abrasive is also carried out of the gap by the moving abrasive. The relative abrading speed can be high, medium or low and the speed may be intentionally varied during an abrading process. Further, the workpiece can be stationary, can have a surface speed that is opposed to the abrasive surface speed or the workpiece can have a speed that is in the same direction as the abrasive surface speed. Also, the abrasive can be stationary and the workpiece moved. The abrasive or workpiece can have a rotational motion or a linear motion or it can have a motion geometrical or random pattern. The amount of water that is carried into or out from the gap between the workpiece and the abrasive is also a function of the type of, and size and wear condition of, the abrasive particles, agglomerates or beads. A workpiece having a long dimension in the vector direction of the abrading speed affects the amount of water or water film thickness that is present in the gap. Likewise, the downstream length of the raised island structures, the leading edge shape of the islands and the width of the leading edges of the islands that are attached to a raised island abrasive article will affect the depth of the water gap film.

For high speed lapping, the amount of water that is applied to the surface of an abrasive sheet can affect the water gap film thickness, as does the relative abrading speed. The leading edge geometry of the workpiece surface periphery can have a large influence on the water film thickness. If the workpiece has a knife-edge that is held in close proximity to the abrasive surface, the water that is being carried at high speeds by the abrasive then is deflected off to the side of the workpiece as this carried water film impacts the leading edge side of the workpiece. The water that impacts the side of the workpiece is instantly decelerated from the nominal speed of the abrasive to a standstill velocity, which develops a large dynamic water pressure at the leading edge area of the workpiece. If this high pressure reaches into the gap between the workpiece and the abrasive surface, this high pressure will be applied against some of the leading edge portion of the workpiece flat surface area and will tend to lift the front leading edge area of the workpiece away from the abrasive. When the front workpiece edge is raised, even a very small amount, an angled wedge gap is formed between the workpiece and the abrasive. Then more water is driven into this wedge gap and the workpiece is lifted further from the abrasive. Shallow wedge angles in the gaps between sliding surface components in the presence of a liquid allows the liquid to be driven into the gap which is the fluid flow mechanism for the lubrication of moving components. Once a liquid moving at high speeds enters the gap area, it is drawn into the deeper regions of the gap and will form a high pressure interface boundary layer of liquid in the whole gap area between the two components.

The fluid that exists in the component gaps can produce very high component separation pressures even when a fluid such as air, that has little viscosity, is used. If a workpiece leading edge is rounded or angled, even the slightest amount, coolant water can be driven into this angled area and tend to separate the both the leading edge and the whole surface area of the workpiece from the abrasive surface. Furthermore, when a workpiece has a non-flat defective area at a portion of a leading edge, water can be easily driven into this localized defective area and raise this portion of the workpiece away from the abrasive surface. This is often the case when a workpiece is being flat-ground into a planar shape prior to the whole newly flatten surface receiving polishing action to produce both a flat and smooth surface. There are other issues that are raised in the formation of uniform thickness water interface boundary layers between a workpiece and an abrading surface when the central portion of the workpiece surface is either raised or recessed from the nominal plane of the workpiece surface. Recessed areas produce thicker localized interface boundary layers and raised areas produce thinner localized interface boundary layers. There are large potential advantages to use raised abrasive coated island articles in place of continuous flat surfaced abrasive articles as they can reduce the amount of water that is driven into the gap between a workpiece surface and the abrading surface of the abrasive article.

Figure 113:
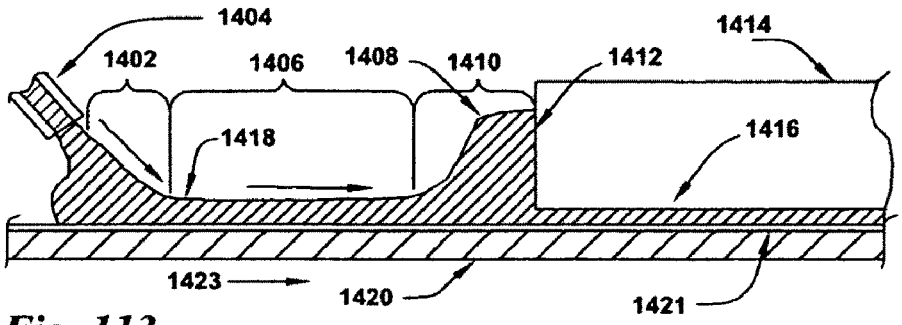
FIG. 113 is a cross sectional view of a stream of coolant water that develops a high pressure when it impacts the leading edge of a workpiece.

FIG. 113 is a cross sectional view of a stream of coolant water that develops a high pressure when it impacts the leading edge of a workpiece where the water is deposited on a moving abrasive surface that carries the water to a workpiece where it impacts the workpiece leading edge. An abrasive backing 1420 having a thin surface coating of abrasive 1421 is shown moving at a high abrading speed during a high speed lapping process. A stream of coolant water 1418 that is shown as flowing at an angle downward from a pipe 1404 where the water 1418 free falls to the surface of the horizontal abrasive 1421 in the water-fall zone 1402. When the water 1418 first contacts the abrasive 1421 in the water-fall zone 1402, the water 1418 has a very low velocity in the abrasive moving direction 1423. The film of water 1418 rapidly picks up speed in the abrasion direction 1423 in the water-acceleration zone 1406 as the abrasive 1421 drags this water 1418 in the shown direction along toward the workpiece 1414.

Within the thickness of the water 1418 that is contained in the water acceleration zone 1406, only that water 1418 that is in direct contact with the abrasive 1421 moves at the speed of the abrasive 1421 at the entry to the zone 1406 while the water that is located at the upper free-surface of the water 1418 at the same entry to zone 1406 has a near-zero horizontal velocity. As the water 1418 that passes through the water-acceleration zone 1406, the water 1418 is sheared by the moving abrasive 1421 across the depth of the water 1418 to form a boundary layer of water 1418 within the water 1418 thickness that exists in the span width of the water-acceleration zone 1406. At the entry to the zone 1406 the water 1418 boundary layer depth is very small compared to the thickness of the water 1418 at that location. Within the boundary layer (not shown) the water 1418 that is contained within the boundary layer has a velocity gradient where the water 1418 that is closest to the abrasive 1421 has a water 1418 velocity that closely matches that of the moving abrasive 1421. At the top surface of the boundary layer, the water 1418 has a localized velocity that closely matches that of the slow moving water 1418 that exists at the top free surface of the water 1418 at that location. As the water 1418 progresses along the water-acceleration zone 1406, the water 1418 at the top free surface increases in velocity and also, the boundary layer of water 1418 progressively increases in thickness. By the time that the water 1418 arrives at the leading edge 1412 of the workpiece 1414 the whole depth of the water 1418 is moving at nearly the full speed of the moving abrasive 1421.

In the water-deceleration zone 1410 the water 1418 decelerates as the water 1418 impacts the leading edge 1412 of the workpiece 1414 and forms a water bank 1408. Because the water 1418 was decelerated, the water 1418 contained in the water bank 1408 is highly pressurized by the impact deceleration event. Some of this pressurized water 1418 is driven into the interface gap 1416 that is located between the flat surfaces of both the workpiece 1414 and the abrasive 1421 to form a water 1418 film that exist in the interface gap 1416. As shown here, the water 1418 that is located in the interface gap 1416 separates the abrasive 1421 from the workpiece 1414 and no abrading of the workpiece 1414 takes place because the abrasive 1421 is separated form the workpiece 1414.

Figure 114:
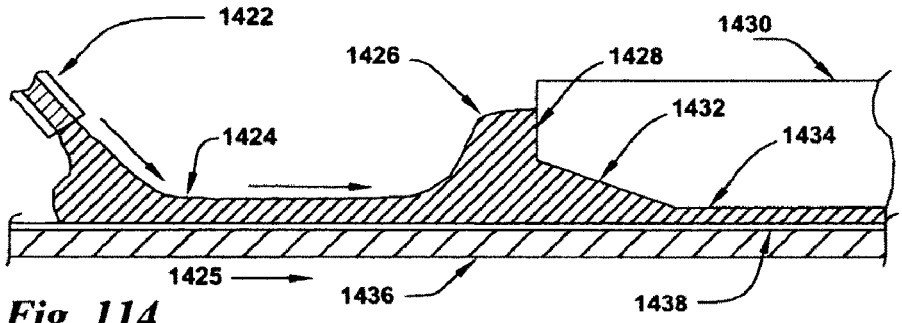
FIG. 114 is a cross sectional view of a stream of coolant water that develops a high pressure when it impacts the leading edge of a workpiece.

FIG. 114 is a cross sectional view of a stream of coolant water that develops a high pressure when it impacts the leading edge of a workpiece where this resultant high pressure can lift the angled leading edge away from an abrasive surface. Here, water is deposited on a moving abrasive surface that carries the water where it impacts an angled-crevice in a workpiece leading edge or a workpiece surface defect that extends some distance from the interior portion of a workpiece surface to the leading edge of a workpiece. An abrasive backing 1436 having a thin surface coating of abrasive 1438 is shown moving at a high abrading speed during a high speed lapping process. A stream of coolant water 1424 is shown as flowing at an angle downward from a pipe 1422 where the water 1424 free falls to the surface of the horizontal abrasive 1438. When the water 1424 first contacts the abrasive 1438 it has a very low velocity in the abrasive moving direction 1425. The film of water 1424 rapidly picks up speed in the abrasion direction 1425 as the abrasive 1438 drags this water 1424 in the shown direction along toward the workpiece 1430. By the time that the water 1424 arrives at the leading edge 1428 of the workpiece 1430 the whole depth of the water 1424 that is positioned just upstream of the water bank 1426 is moving at nearly the full speed of the moving abrasive 1438. The workpiece 1430 has an angled crevice 1432 that extends from the leading edge 1428 of the workpiece 1430 toward the center region of the interface gap 1434 where the crevice 1432 has a substantial width that extends across the width of the workpiece 1430 leading edge 1428.

The water 1424 decelerates as the water 1424 impacts the leading edge 1428 of the workpiece 1430 and forms a water bank 1426. Because the water 1424 was decelerated, the water 1424 contained in the water bank 1426 is highly pressurized by the impact deceleration event. Some of this pressurized water 1424 is driven into the angled workpiece crevice 1432 and also, into the interface gap 1434 that is located between the flat surfaces of both the workpiece 1430 and the abrasive 1438 to form a water 1424 film that exist in the interface gap 1434. As shown here, the water 1424 that is located in the interface gap 1434 separates the abrasive 1438 from the workpiece 1430 and no abrading of the workpiece 1430 takes place because the abrasive 1438 is separated form the workpiece 1430. The pressurized water 1424 acting on the angled area of the workpiece 1430 crevice 1432 also generates a lifting force on the leading edge 1428 portion of the workpiece 1430 that tends to lift the leading edge 1428 away from the abrasive 1438.

When a stream of coolant water being deposited on a moving abrasive surface, the surface carries the water to a position where it impacts an angled workpiece leading edge. The angled workpiece edge can be a result of misalignment of a flat workpiece with a flat abrasive surface. Or, the workpiece is tilted upward at angle due to hydraulic forces that originated with an excess of coolant water impacting the leading edge of a workpiece where this high pressure water raises up the leading edge of the workpiece. In another instance, a localized portion of a workpiece surface is defective relative to a precision planar surface to form an angled crevice. Here, the coolant water is carried deep into the angled workpiece surface region by the water-shearing action that is a result of the applied coolant water being carried along on the moving surface of a flat abrasive surface. When this water is drawn into the angled crevice by the abrasive surface, a fluid pressure is developed in the angle-constrained water by the shearing action imparted by the moving abrasive surface as the water is "wedged" into the angled crevice. When the abrasive surface moves at high speeds, such as occurs in high speed lapping, the pressure that is developed by the shearing action can be very high. This high pressure can thrust the workpiece surface up and away from the abrasive surface even when a large abrading contact force is applied to the workpiece to hold it against the abrasive surface. It is not necessary for the abrasive surface to have a rough surface in order to develop this pressurized floatation of the workpiece.

By analogy, this type of hydraulic floatation of one component part from another is in common use in automotive engine crankshaft journal bearings. Here, both the stationary crankshaft housing and the rotating crankshaft have highly polished surfaces. During engine operation, the crankshaft is suspended at the housing center even when large forces are applied to the crankshaft member. The oil film that is simply present in the journal bearing does not have to be pressurized as the rotation of the crankshaft is all that is needed to lift a stationary temporarily bottomed-out cylindrical crankshaft that rests on the cylindrical surface of the housing. During rotation of the crankshaft, the crankshaft is lifted into a position that is centered in the housing where the surface of the crankshaft does not contact the housing. Hydroplaning is a hydrodynamic event that is well known to those skilled in the art of fluid dynamics and is explained in detail as described in the classical Lubrication Theory analyses as developed by Osborne Reynolds. He defined the large plate separation forces that occur when sliding one slightly-angled flat plate past another flat plate with an interface film of lubricating fluid between the two plate surfaces.

In addition, when the interface gap water is carried out from under the trailing edge of a workpiece by the moving abrasive where the trailing edge has a slight upward angle a negative pressure is developed in this area. This negative pressure creates a downward force on the trailing edge which tends to tilt the workpiece down into the moving abrasive with the result that the trailing edge is angled even more by the abrasive.

Figure 115:
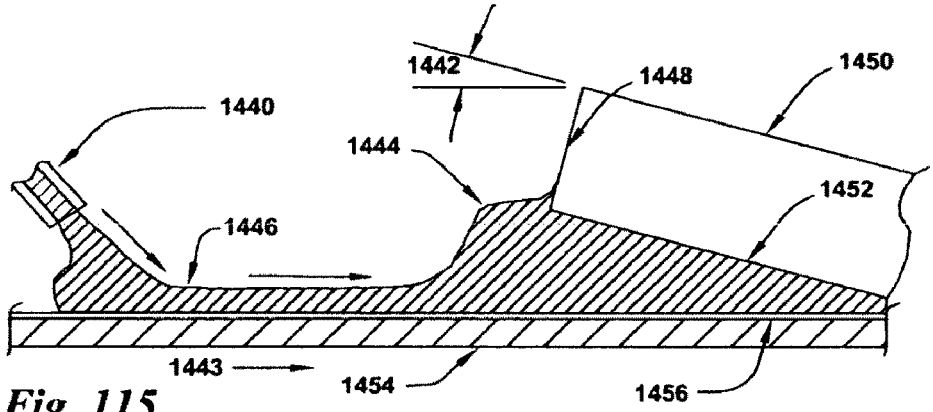
FIG. 115 is a cross sectional view of a stream of coolant water that impacts an angled workpiece leading edge.

FIG. 115 is a cross sectional view of a stream of coolant water being deposited on a moving abrasive surface that carries the water where it impacts an angled workpiece leading edge. An abrasive backing 1454 having a thin surface coating of abrasive 1456 is shown moving at a high abrading speed during a high speed lapping process. A stream of coolant water 1446 is shown as flowing at an angle downward from a pipe 1440 where the water 1446 free falls to the surface of the horizontal abrasive 1456. When the water 1446 first contacts the abrasive 1456 it has a very low velocity in the abrasive moving direction 1443. The film of water 1446 rapidly picks up speed in the abrasion direction 1443 as the abrasive 1456 drags this water 1446 in the shown direction along toward the angled workpiece 1450. By the time that the water 1446 arrives at the leading edge 1448 of the workpiece 1450 the whole depth of the water 1446 that is positioned just upstream of the water bank 1444 is moving at nearly the full speed of the moving abrasive 1456. The workpiece 1450 is tilted from the horizon by an angle 1442. The workpiece 1450 has an angled crevice 1452 that extends from the leading edge 1448 of the workpiece 1450 toward the center region of the workpiece 1450 where the crevice 1452 has a substantial width that extends across the width of the workpiece 1450 leading edge 1448.

The water 1446 decelerates as the water 1446 impacts the leading edge 1448 of the workpiece 1450 and forms a water bank 1444. Some of this water 1446 is carried by shearing action provided by the moving abrasive 1456 into the angled workpiece crevice 1452 between the flat surfaces of both the workpiece 1450 and the abrasive 1456. As shown here, the water 1446 that is located in the crevice gap 1452 separates the abrasive 1456 from the workpiece 1450 and no abrading of the workpiece 1450 takes place because the abrasive 1456 is separated form the workpiece 1450. The shear-pressurized water 1446 acting on the angled area of the workpiece 1450 crevice 1452 generates a significant lifting force on the leading edge 1448 portion of the workpiece 1450 that tends to lift the leading edge 1448 away from the abrasive 1456.

Figure 116:
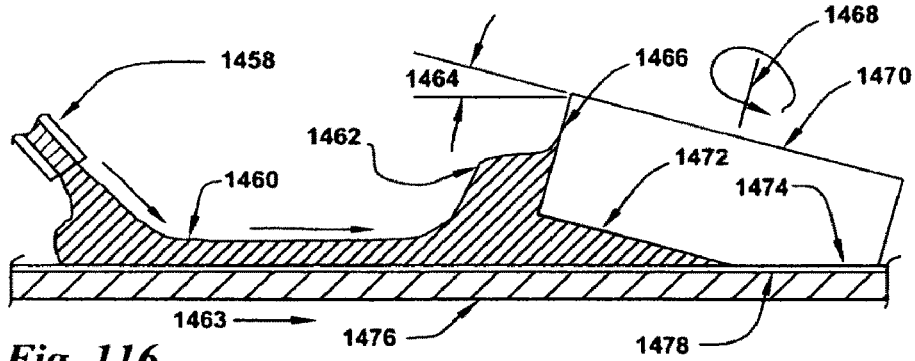
FIG. 116 is a cross sectional view of a stream of coolant water that impacts an angled workpiece leading edge.

FIG. 116 is a cross sectional view of a stream of coolant water being deposited on a moving abrasive surface that carries the water where it impacts an angled workpiece leading edge. Here, the downstream or trailing edge of the workpiece is in abrading contact with a flat surfaced abrasive. An abrasive backing 1476 having a thin surface coating of abrasive 1478 is shown moving at a high abrading speed during a high speed lapping process. A stream of coolant water 1460 is shown as flowing at an angle downward from a pipe 1458 where the water 1460 free falls to the surface of the horizontal abrasive 1478. When the water 1460 first contacts the abrasive 1478 it has a very low velocity in the abrasive moving direction 1463. The film of water 1460 rapidly picks up speed in the abrasion direction 1463 as the abrasive 1478 drags this water 1460 in the shown direction along toward the angled workpiece 1470. By the time that the water 1460 arrives at the leading edge 1466 of the workpiece 1470 the whole depth of the water 1460 that is positioned just upstream of the water bank 1462 is moving at nearly the full speed of the moving abrasive 1478. The workpiece 1470 is tilted from the horizon by an angle 1464. The workpiece 1470 has an angled crevice 1472 that extends from the leading edge 1466 of the workpiece 1470 toward the center region of the workpiece 1470 where the crevice 1472 has a substantial width that extends across the width of the workpiece 1470 leading edge 1466.

The water 1460 decelerates as the water 1460 impacts the leading edge 1466 of the workpiece 1470 and forms a water bank 1462. Some of this water 1460 is carried by shearing action provided by the moving abrasive 1478 into the angled workpiece crevice 1472 between the flat surfaces of both the workpiece 1470 and the abrasive 1478. As shown here, there is no water 1460 that separates the abrasive 1478 from the trailing edge 1474 of the workpiece 1450 and abrading of the workpiece 1450 takes place at the trailing edge 1474. A flat and angled surface is abraded at the trailing edge 1474 of the workpiece 1470. The workpiece 1470 is shown having a workpiece rotation 1468. When the workpiece 1470 trailing-edge abraded-flat 1474 angled section is rotated around to the workpiece leading edge 1466 position, the angled section 1474 will now provide an angled crevice-like entry for the water 1460 being carried by abrasive 1478 shearing action. Then, another new angled section 1474 will be formed at a position on the workpiece 1470 surface that is 180 degrees (opposite) from the original angled section 1474. The once-flat workpiece 1470 now has two angled sections 1474 that are opposed to each other on the workpiece 1470 surface. This pair of opposed angled sections 1474 result in a workpiece 1470 that has an undesirable "saddle-shaped" surface (not shown) that is not precisely flat. These saddle-shaped workpiece surfaces often occur during high speed flat lapping when using abrasive articles that have continuous coatings of abrasives.

Figure 117:
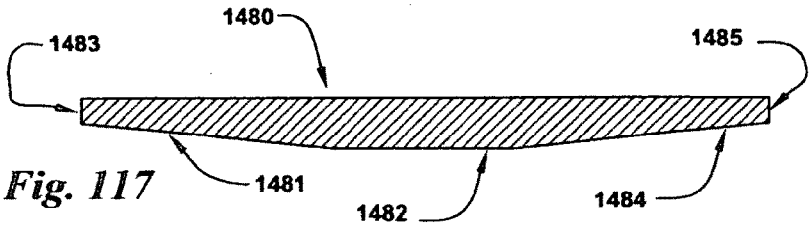
FIG. 117 is a cross sectional view of a workpiece that has an abraded bottom that is angled at both the leading and trailing area portions.

FIG. 117 is a cross sectional view of a workpiece that has an abraded bottom that is angled at both the leading and trailing area portions. The workpiece 1480 has an angled leading edge area 1481 that is angled downward from the leading edge 1483, a flat center section area 1482 and a trailing angled edge area 1484 that is angled upward toward the trailing edge 1485.

Figure 118:
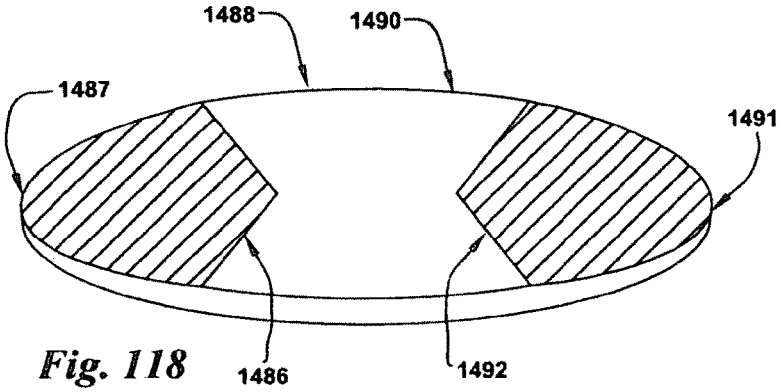
FIG. 118 is an orthographic view of a workpiece that has a saddle-shaped bottom surface.

FIG. 118 is an orthographic view of a workpiece that has a saddle-shaped bottom surface that has an abraded bottom that is angled at both the leading and trailing area portions of the workpiece. The workpiece 1490 has a leading edge area 1486 that is shown angled upward from the leading edge 1487, a flat center section area 1488 and a trailing edge area 1492 that is shown angled downward toward the trailing edge 1491.

Figure 119:
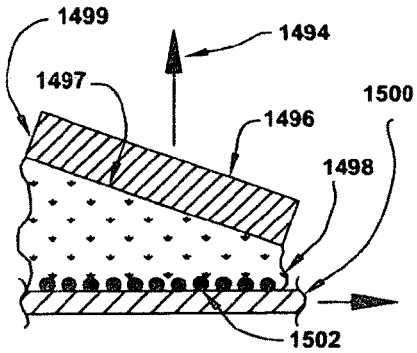
FIG. 119 is a cross sectional view of a workpiece that is angled downward and is abraded by a water-coated moving abrasive article.

FIG. 119 is a cross sectional view of a workpiece that has an abraded bottom that is angled downward from the workpiece leading edge that is abraded by a water coated moving abrasive article. The workpiece 1496 has a leading edge area 1497 that is angled downward from the leading edge 1499 where moving water 1498 is carried in contact with the downward angled surface area 1497 by the moving abrasive article 1500. Abrasive beads 1502 are attached to the surface of the abrasive article 1500. The moving water 1498 creates a lifting force 1494 that forces the workpiece 1496 upward and away from the abrasive beads 1502 thereby preventing any abrading action on the workpiece 1596 surface 1497.

Figure 120:
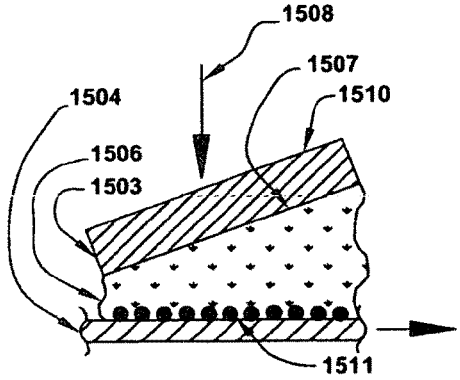
FIG. 120 is a cross sectional view of a workpiece that is angled upward and is abraded by a water-coated moving abrasive article.

FIG. 120 is a cross sectional view of a workpiece that has an abraded bottom that is angled upward from the workpiece leading edge that is abraded by a water coated moving abrasive article. The workpiece 1510 has a leading edge area 1507 that is angled upward from the leading edge 1503 where moving water 1506 is carried in contact with the upward angled surface area 1507 by the moving abrasive article 1504. Abrasive beads 1511 are attached to the surface of the abrasive article 1504. The moving water 1506 creates a suction force 1508 that forces the workpiece 1510 downward toward the abrasive beads 1511.

Figure 121:
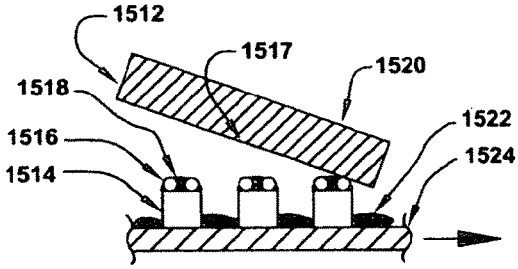

FIG. 121 is a cross sectional view of a workpiece that has an abraded bottom that is angled downward from the workpiece leading edge that is abraded by a water coated moving raised island abrasive article. The workpiece 1520 has a leading edge area 1517 that is angled downward from the leading edge 1512 where the water 1518 wetted abrasive beads 1516 are carried into contact with the workpiece 1520 downward angled surface area 1517 by the moving abrasive article 1524. The abrasive beads 1516 are attached to the top surface of the raised islands 1514 that are attached to the abrasive article 1524 where the beads 1516 are fully wetted by coolant water 1518. Addition excess coolant water 1522 is shown at the bases of the raised islands 1514 and in contact with the top surface of the abrasive article 1524. The moving water 1518 that resides on the top surface of the raised islands 1514 is not constrained between the downward angled area 1517 and the top bead 1516 surfaces of the abrasive article 1524 with the result that this water 1518 that moves with the islands 1514 does not create a substantial hydraulic lubrication-type lifting force that tends to move the workpiece 1520 away from the abrasive beads 1516. Because of the presence of the raised islands 1514, the water 1518 residing at the top of the islands 1514 has a tendency to flow around the individual beads 1516 to provide cooling to these beads 1516 that are heated by the abrading contact action. Also, the abrasive beads 1516 are in direct abrading contact with the workpiece 1520 surface area 1517 instead of being separated from the workpiece 1520 surface area 1517 by an interface layer of water (not shown). The raised island 1514 abrasive article 1524 provides abrading action that effectively produces flat workpiece 1520 surfaces from even workpiece 1520 downward angled surfaces 1517 at the high abrading speeds that are used in high speed flat lapping.

Figure 122:
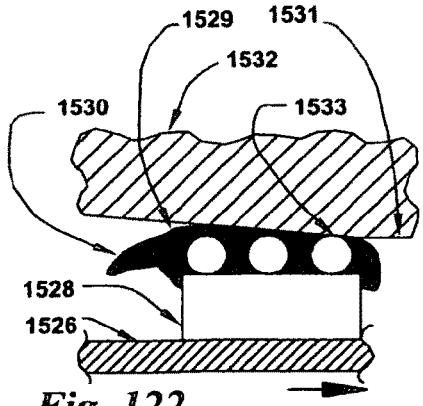

FIG. 122 is a cross sectional view of a workpiece that has an abraded bottom that is angled downward that is abraded by a water coated moving raised island abrasive article. The workpiece 1532 bottom abraded surface is shown as angled downward where the water 1529 wetted abrasive beads 1533 are carried into contact with the workpiece 1532 abraded surface by the moving abrasive article 1526. The abrasive beads 1533 are attached to the top surface of the raised island 1528 that is attached to the abrasive article 1526 where the beads 1533 are fully wetted by coolant water 1529. The excess coolant water 1530 is shown as being pushed off the trailing edge top surface of the island 1528 as the abrasive article 1526 moves relative to the workpiece 1532. The coolant water 1529 that resides on the top surface of the raised islands 1528 is not constrained between the downward angled workpiece 1532 abraded surface and the top bead 1533 surfaces with the result that this water 1529 that moves with the islands 1528 does not create a substantial hydraulic lubrication-type lifting force that tends to move the workpiece 1532 away from the abrasive beads 1533. Because of the presence of the raised islands 1528, the water 1529 residing at the top of the islands 1528 has a tendency to flow around the individual beads 1533 to provide cooling to these beads 1533 that are heated by the abrading contact action. Also, the abrasive beads 1533 are in direct abrading contact with the workpiece 1532, instead of being separated from the workpiece 1532 abraded surface by the water 1529, to create a flattened surface area 1531 portion of the workpiece 1532 even when the workpiece 1532 abraded surface is angled downward when the abrasive article 1526 is moving at the high speeds used during a high speed lapping procedure.

Coolant at Workpiece Leading Edge

Problem: When coolant water is applied some distance upstream of a workpiece in high speed lapping, the coolant water is carried at high speeds on the surface of the moving abrasive disk where it impacts the leading edge of the workpiece. Typically an excess of water is applied to the abrasive surface to assure that sufficient water is present in the very small interface gap between the flat workpiece surface and the flat abrasive surface to provide cooling to both the workpiece and the abrasive. When this high speed excess water decelerates upon impact, a high pressure is created in the bank of excess water that forms at the leading edge of the workpiece. This high pressure water is driven into the interface gap between the workpiece and the flat abrasive surfaces. When the high pressure water penetrates the interface gap at the leading edge of the workpiece the water can raise the leading edge of the workpiece and cause hydroplaning of the workpiece. A workpiece that hydroplanes during the high speed lapping process tends to develop an undesirable non-flat surface during the abrading action.

Solution: Instead of applying the coolant water directly to the surface of the moving abrasive disk some distance upstream of the leading edge of the workpiece, the water can be applied directly at the leading edge of the workpiece. Because the directly applied water is not carried at high speeds along on the surface of the moving horizontal abrasive disk, the water does not impact the leading edge of the horizontal-surface workpiece. The applied water is dripped or flows directly onto the upper surface of the workpiece at locations that are aligned along the leading edge periphery of the workpiece. Some of this applied water simply flows at very low speeds down the workpiece leading edge vertical face wall. An excess of the applied water can build up a water bank at the workpiece leading edge vertical wall but a high pressure will not develop in this water bank because the applied water does not impact the workpiece leading edge at the high abrasive speeds. Water that flows down into the leading edge interface gap openings between the workpiece and the abrasive surface will have a near-zero water pressure. This water will not be driven into the interface gap by the near-zero water pressure. Because there is no water driven into the gap, this cause of workpiece hydroplaning is substantially reduced.

However, applied water that freely flows downward into the interface gap will be carried at low pressure deep into the interface gap as the water contacts the moving abrasive surface and is immediately dragged into the interface gap by the abrasive surface. Cooling of both the workpiece surface and the abrasive surface is effected by this carried-in coolant water. The coolant water can be applied to either raised island or non-raised-island abrasive disk articles.

The water can be applied to the leading edge of a cylindrical shaped workpiece by a curved section of a sprinkler tube positioned above the workpiece where the tube has a curvature that matches the curvature of the periphery of the workpiece. The water manifold tube can have a series of water exit openings along the length of the tube where the openings are on the side of the tube that faces the workpiece. Also, a water spray manifold tube can be used to supply a mist of water to the leading edge workpiece throughout the abrading process. The volumetric flow of the water of the water or water mist can be sequentially varied at different stages or events throughout the abrading process to maximize or minimize the rate of workpiece material removal. This technique of supplying coolant water only to the leading edge periphery of a workpiece is particularly suited for high speed lapping. The workpiece can be held stationary or the workpiece can rotate during the abrading process. The spray or sprinkler tube can have an arc segment curvature shape for a circular disk shaped workpiece where the water tube is stationary and the workpiece rotates. For non-circular workpieces, a water tube can be constructed to have the same curvature-shape as the outer periphery of the workpiece and the water tube mutually rotated with the workpiece. Here, water can optionally be applied only at the leading edge of the workpiece with the use of a rotary-position valve system. Also, water can be applied at the full periphery of the workpiece without additional causing of hydroplaning. For instance, the water that is applied to the outboard sides and to the trailing edge of the workpiece has little or no influence on the hydroplaning of the workpiece because the water that is applied at these locations is not carried into the interface gap. Only the water that is applied at the front leading edge of the workpiece is carried into the interface gap.

FIG. 131 is a top view of a rotating circular workpiece that has coolant water applied at the front leading edge of the workpiece. The workpiece 1368 is shown rotating in the direction 1364 while the workpiece 1368 is in horizontal flat-face contact with moving abrasive 1370 that is moving in the direction 1366. The abrasive 1370 is shown as moving in a linear direction but the abrasive 1370 can be a large rotating abrasive disk or an annular band of abrasive. A water dispersion pipe or tube 1358 is shown as an arc segment that is radially aligned with the front leading edge 1360 of the workpiece 1368 which also has a workpiece trailing edge 1362.

FIG. 132 is a cross section view of a workpiece that has coolant water applied at the front leading edge of the workpiece. The horizontal workpiece 1388 has a front vertical leading edge vertical wall face 1384 and the workpiece 1388 is separated by an interface gap 1386 from the abrasive beads 1400 that are coated on a backing 1372 that is moving in the direction 1392. The backing 1372 has a continuous coating of gap-spaced abrasive beads 1400 coated on the top surface 1398 of the backing 1372. A water manifold pipe 1380 having water exit holes 1394 is filled with coolant water 1378 where the coolant water 1378 exits the pipe 1380 holes 1394 in the form of the shown water droplets 1376. The water 1378 can also be another coolant liquid or a mixture of coolant liquids or a water mist. The water droplets 1376 contact the upper surface 1396 of the workpiece 1388 to form a water bank 1382 that supplies falling water 1374 that runs or falls vertically down the front wall 1384 until the falling water 1374 contacts the top surface 1398 of the moving abrasive backing 1372 and the abrasive beads 1400 which together drag this water 1374 into the interface gap 1386 to form an interface water film 1390. The falling water 1374 can travel down the front vertical wall 1384 due to effects that include, but are not limited to: gravity; capillary action; momentum that is provided by the water pipe 1380 internal water 1378 pressure; or other transfer forces including air jets (not shown); or a combination of these water 1374 transfer effects.

Workpiece Surface Irregularities

An uneven workpiece surface condition and an undesirable or irregular geometric configuration of the front surface of a workpiece both can independently affect the amount of hydroplaning that occurs. Seldom are these irregularities consistent over the surface or around the periphery of a workpiece or are the same for multiple workpieces. This inconsistency results in hydroplaning effects that change from workpiece to workpiece and also change during the flat lap processing of an individual workpiece.

A workpiece typically has a vertical wall-like surface that extends around the periphery of a horizontal flat surfaced workpiece. The out-of-vertical profile of this wall affects the amount of hydroplaning. If a workpiece wall is tapered down and forward toward the abrasive surface to form a upright truncated cone shape, the inclined front edge will tend to throw the impacting water upward which results in a downward force on the leading edge of the workpiece with a corresponding reduction in hydroplaning. An analogy here is a moving snowplow throwing snow upward into the air and where the leading front of the inclined plow is forced downward against the road surface. If the wall is perpendicular, the effect of the impacting water has a neutral effect on hydroplaning. If the wall is tapered upward and forward away from the abrasive surface to form an inverted truncated cone shape having an overhanging front edge, impacting water is trapped under the overhanging inclined front edge. This impacting water tends to drive the leading edge of the workpiece upward away from the abrasive to form an angled gap that is opened even wider at the workpiece leading edge. Here, when the gap is spread further open, even more water is driven into the enlarged angled gap and correspondingly, the trailing edge is driven downward into the abrasive. When a workpiece wall has localized non-vertical defects around its periphery, the hydroplaning behavior will also have a corresponding change around its periphery as the workpiece is rotated during the flat lapping process.

Often there are very small localized gaps that exist in the interface region between the flat lapped workpiece and the flat abrasive surfaces. Individual interface gaps vary in thickness over the surface of the workpiece. Some area portions of the flat workpiece are in direct abrading contact with some areas of the flat abrasive and no interface gap exists in those specific contact areas. However, there are minute gaps in other workpiece areas due in part to the original non-flat areas of the workpiece that are being abraded away during the flat lapping process. Small variations in the thickness of the abrasive disk or non-flat areas of the underlying platen also are sources of these small and localized gaps. Many of the gaps will have individual crack-like gap-area openings at specific locations on the outer periphery of the workpiece but these interface gaps will not exist at other periphery locations because the workpiece will be in direct face contact at these latter locations. The typical size of these small gaps at the start of an abrading procedure can range from less than 0.001 inches (25 micrometers) to 0.010 inches (254 micrometers) or more depending on the initial flatness of the workpiece. For reference, the flatness of a workpiece that has been flat lapped to within 1 lightband represents a flatness that is 11.1 millionths of an inch (11.1 microinches or 0.28 micrometers).

To put these small crack-like gap dimensions in perspective, an abrasive interface gap at the leading edge of a workpiece of only 0.001 inches (25 micrometers) is nearly one hundred times the required 11.1 microinches (0.28 micrometers) flatness of the lapped workpiece. The interface gaps may extend from the inner workpiece surface to the outer perimeter of the workpiece or they may exist only in internal regions of the interface. It is very important to recognize that the flatness accuracy requirements of flat lapping can easily be two orders of magnitude greater than those accuracy requirements for conventional abrading processes. Likewise, the abrasive disk flatness accuracies, the abrasive disk thickness accuracies and the rotating platen dynamic flatness accuracies that are used to provide high speed flat lapping can also be easily two orders of magnitude greater than those accuracy requirements for conventional abrading processes.

Even after a workpiece is abraded precisely flat, some of these very small interface gaps can still exist at the workpiece periphery because of minute localized out-of-flat abrasive surfaces due to disk thickness variations or due to a non-flat platen surface. Here, areas of the abrasive disk may have variations in thickness where some disk areas are lower than others. Also, the flat platen can also have flatness variations where some platen areas are lower than others. An abrasive disk having a precisely uniform thickness can be mounted on a platen having low areas which will result in the abrasive having apparent low areas. A "low spot" area where the localized surface of an abrasive surface is recessed from an abrasive planar surface can contain a shallow lake of surface water that is carried into the interface gap between the workpiece and abrasive surfaces. When the fast moving "lake" water contacts the surface of the workpiece it can have a tendency to "roll up" because of the shearing action on the water surface caused by the workpiece surface. This "rolled up" water will tend to push the workpiece upward away from the flat abrasive surface. A thinner film of surface water that is nominally interspersed between the abrasive beads would be thick enough to only wet the surface of abrasive particles and will have less tendency to "roll up".

Workpiece Rotation Effects

A workpiece is usually rotated during the abrading process to assure that equalized abrading occurs across the full surface of the workpiece. Because the workpiece rotates, the individual interface gaps change periodically at a fixed-in-space location that is downstream of the applied coolant water and that is coincident with the leading edge of the rotating workpiece. Each of these individual gaps that periodically arrive at this fixed location has a unique gap thickness and gap width that spans a tangential segment distance along the periphery of the workpiece.

When workpieces are rotated during the abrading action, the initiation of this hydroplaning induced workpiece tipping action can cause the perpetuation of this effect to continue even after the original out-of-flat defect on the workpiece surface has been abraded away. When the workpiece is tipped up and the trailing edge is abraded excessively a flat wedged shaped portion of the workpiece is formed on the trailing edge side of the workpiece surface. Because the tipped workpiece tends to pivot at the circumferential center of the workpiece, there is little material removed near the workpiece center but an undesirable large amount removed on the disk trailing edge periphery. This formation of the flat wedge shape on the workpiece surface occurs at a location that is diametrically opposed to the original not-flat workpiece defect that allowed the impinging water to cause the tilting effect. When this newly formed wedge gap shape is rotated from the trailing position 180 degrees to the leading position the wedge gap is then presented as an enlarged workpiece periphery interface gap to the high speed water that is driven into it. The impacting water tips the leading edge of the workpiece and another flat wedge is abraded into the workpiece surface at the trailing edge of the workpiece. These two wedge areas are now located 180 degrees from each other on the workpiece. As the workpiece is continued in rotation during the abrading process, the two opposed wedge areas continue to grow in depth until they reach an equilibrium size. Here, a single independent edge defect on a workpiece causes the formation of two independent surface defects. The second defect of the pair was created simply as a function of the existence of the first defect.

The workpiece now has a common occurrence saddle-shaped non-flat surface that was caused by the high speed lapping when using a uniform abrasive coated disk that was mounted on a rotating platen. Saddle shape surfaces on a workpiece disk have two high areas that are opposed to each other and two low areas that are also opposed to each other. Each of the high areas is positioned 90 degrees from the low areas where there are alternating high and low areas around the circumference of the disk. The non-flat surface low areas have their lowest locations at the periphery of the workpiece disk. The process of creating pairs of wedge shaped low spots on a workpiece can be repeated at other periphery crack gap sites due to the effects of hydroplaning during high speed flat lapping. Rotation of the workpiece during this abrading action can produce complex non-flat geometric shapes of the workpiece surface. Other non-flat shapes include convex or concave cone shapes in addition to multiple saddle shapes.

The workpiece exterior surface characteristics can result in the creation of non flat workpiece surfaces in different ways. For instance, the water that is shear-dragged as a interface boundary layer into the interface gaps also tends to produce an uneven gap separation of the workpiece surface and the abrasive surface. In these cases, the moving water is dragged into the gap region between the workpiece and the flat abrasive surface. Water that is dragged into the gap interface creates a high water pressure region in the gap at the leading edge area of the workpiece. This high pressure tends to lift the leading edge of the workpiece even further, which allows even more water to be dragged in by the moving abrasive. This process can continue to where the whole flat surface of the workpiece is partially or even wholly lifted away from the abrasive surface by the interface boundary layer of water that is dragged into the gap. Because this pressurized water now floats the flat workpiece surface away from the abrasive, few of the abrasive particles contact the workpiece in a manner where the workpiece surface is evenly abraded across its surface. This abrading workpiece water floatation effect is analogous to the lubrication effects that take place in a liquid journal bearing where the lubricating oil is dragged into the gap between the cylindrical journal and the bearing internal cylindrical surface by the rotating journal. The journal-centering self-induced interface gap between the rotating journal and the bearing has a thickness that is often less than 0.0005 inches (12 micrometers) but the oil film can support load forces that are in excess of 1,000 lbs. Journal lubrication theory is well known to those skilled in the art of fluid dynamics.

Air Bearing Spherical Offset Workpiece Holder

Problem: A large 2 to 4 inch (5.08 to 10.2 cm) or larger spherical diameter is required to create an offset spherical center of rotation so that a workpiece lapped surface contacts a high speed or low speed lapping or grinding abrasive surface, either for use with diamond sheets of abrasive or slow slurry lapping, to prevent tipping of the workpiece due to abrasive contact forces.

FIG. 133 is used as a representation of slurry lapping to show why a flat workpiece that is in abrading contact with an abrasive slurry coated platen slurry lapping must be performed at such slow abrading speeds to provide precision flat workpieces Solution: A air bearing hemispherical rotor pivot device can be used that has an offset pivot-center workpiece holder where the device has separate annular sectors having different rotor retaining and rotor lubrication functions. The hemispherical rotor section is approximately one half of a full sphere to form a hemispherical workpiece holder rotor that has a flat rotor bottom surface. The upper convex portion of the spherical rotor is nested in and captured by a receptor housing that has a concave surface having a spherical radius that matches the rotor surface to form common annular surface areas that are in conformal contact with each other. The lower flat surfaced portion of the rotor is used to attach a workpiece to abrade an opposed flat surface of the workpiece. A low negative-pressure vacuum of about 13 pounds per square inch gage (psig) can be applied to a large central spherical rotor annular area to develop an "upward" direction force that resists a "downward" force that is applied by high pressure of approximately 40 pounds per square inch gage (psig) air acting on a smaller annular surface area. The upward vacuum force balances out the downward pressurized air bearing thrust force. The annular vacuum or pressurized areas can be individual areas or they can be multiple vacuum or pressurized areas. The pressurized-air gap thickness is adjusted by changing the vacuum and the pressure levels. When the pressurized air bearing areas can be positioned at both the upper and lower portion of the rotor. The lower pressurized annular ring primarily resists radial abrading load forces that are parallel to the abraded workpiece surface. The upper portion resists the workpiece contacting forces that are applied normal to the workpiece flat surface. Because a thin air film separates the rotor and the rotor housing the rotor has a friction free motion. The rotor is designed where the abrading contact surface of a workpiece is approximately located on the plane of the abrading surface to prevent the abrading shearing action forces from rotating the rotor and tilting a workpiece surface during an abrading action.

Figure 123:
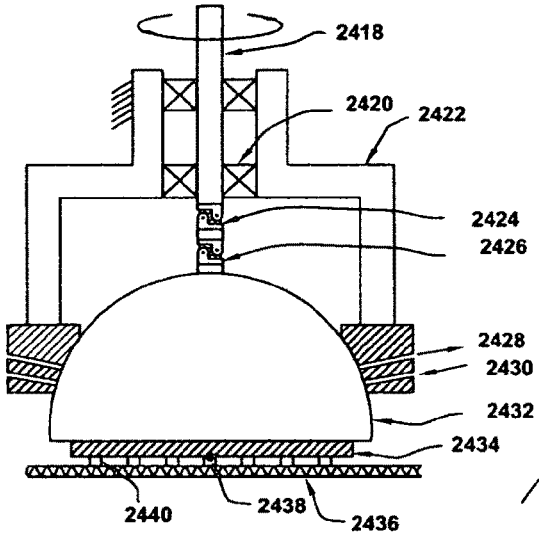
(Prior Art) Fig. 123
Figure 124:
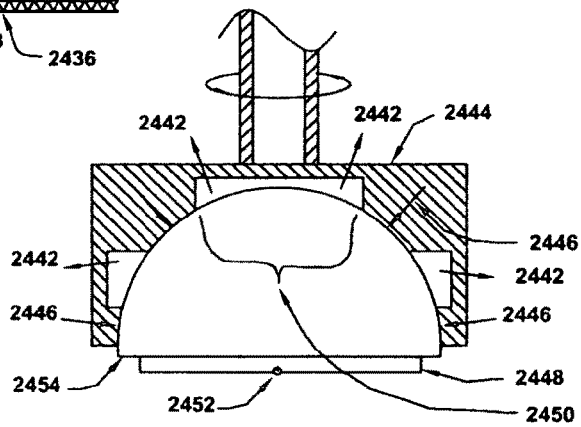
(Prior Art) Fig. 124
Figure 125:
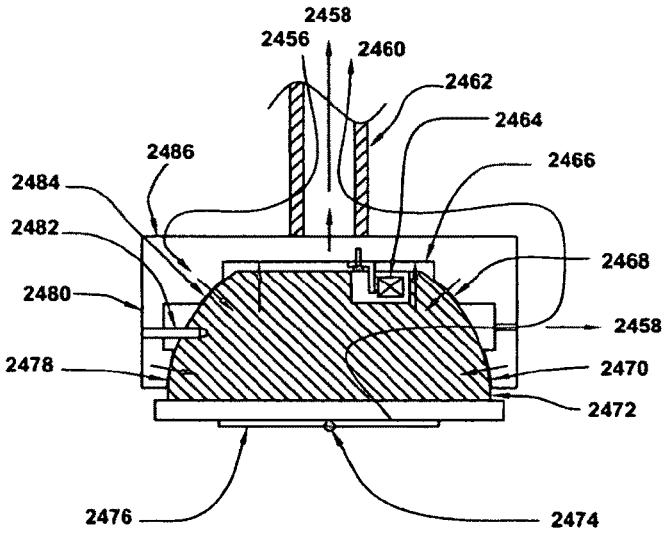
(Prior Art) Fig. 125

FIG. 123, FIG. 124 and FIG. 125 show offset center of rotation workpiece holders as described by Duescher in U.S. Pat. Nos. 6,149,506 and 6,769,969.

FIG. 123 shows a cross section view of an offset rotation center spherical motion workpiece holder with a workpiece in flat contact with a raised island abrasive disk. A rotating spindle shaft 2418 is supported by shaft bearings 2420 that are mounted in a rotor support housing 2422 that has annular concave spherical areas which are in contact with a convex spherical shaped workpiece holder rotor 2432 that has a center of rotation 2438. The housing 2422 concave areas include a vacuum area that has a vacuum passageway 2428 and a pressure area that has a pressurized air passageway 2430. A universal joint 2424 having a spline (not shown) is attached to the shaft 2418 and also another universal joint 2426 that is attached to the workpiece holder rotor 2432 to allow the rotor 2432 to have a spherical rotation in addition to the axial rotation provided by the shaft 2418. The rotor 2432 has an attached flat workpiece 2434 where the workpiece 2434 is in contact with raised islands 2440 that are attached to a backing disk 2436. The spherical rotation of the rotor 2432 allows the flat abraded surface of the workpiece 2434 to be in conformal planar contact with the abrasive coated raised islands 2440. The rotor 2432 rotates within the stationary housing 2422. An air film of pressurized air (not shown) separates the rotor 2432 from the housing 2422.

FIG. 124 shows a cross section view of a spherical motion workholder 2444 having a hemispherical shaped rotor 2454 with an attached workpiece 2448 where the rotor 2454 has a spherical center of rotation 2452 that is located on the abraded surface of the workpiece 2448. Pressurized fluid sources 2446 provides downward forces that counteract vacuum forces that originate from the vacuum area 2450 and the vacuum sources 2442.

FIG. 125 shows a cross section view of a spherical motion workholder having more details of this offset center of rotation design. Here, the fluid pressure source 2456, the counteracting vacuum 2458, the air or fluid and vacuum source lines 2456 and 2460, the vertical restraint vacuum area 2466, and the vertical thrust air pad annular spherical ring 2468 segments act mutually on the workholder 2486 assembly. Fluid pressure can be applied to provide an air bearing film (not shown) by the use of small 0.008 inch (0.02 mm) diameter jeweled orifices (not shown) holes feeding air or another fluid to 0.010×0.010 inch (0.25×0.25 mm) grooves (not shown) in three independent separate segments (not independently shown) that extend for 100 degrees each around the circumference of the spherical ring 2468. Air pressure can also be supplied to optional spherical shaped porous air pads (not shown) that can be substituted for the orifice holes and associated grooves. There is an interrupted gap between the ends of each of the three grooved annular segments where the three segments together form the annular ring 2468. The radial thrust air pad annular ring 2470 has three separate grooves, which are supplied by an individual feed orifice and is separated from the other two grooves. These grooves collectively span the full 360 degree latitude circle of the spherical globe. The spherical center of rotation 2474 allows a workpiece 2476 to freely rotate. The primary radial thrust which counteracts abrasive contact shearing forces that act in the plane of the workpiece abraded surface is provided by the lower pressurized annular ring 2478. Restraining pins 2482 can be used as an anti rotation system to keep the rotor 2472 section from rotating relative to the workpiece holder housing 2480. Also, an anti rotation bearing 2464 can be used to rotate the rotor 2472 about the holder spindle 2462 axis but yet allow the rotor 2472 to have a spherical rotation about the spherical center 2474. The pressurized annular ring fluid bearing section 2484 is used primarily to counteract downward abrasive contact forces which push the workpiece 2476 into the flat surface of the moving abrasive (not shown).

Air Bearing Offset Workpiece Holder

Problem: It is desired to provide a workpiece holder that will present the flat surface of a rotating workpiece to the flat surface of an abrasive disk where the workpiece surface is conformal to the abrasive surface even when there is a misalignment between the workpiece holder axis of rotation and a perpendicular axis that extends from the abrasive surface. The workpiece must maintain this conformal flat surface contact at all times during an abrading process including the time that a rotational abrasive platen is stationary, during the time of platen acceleration, during the abrading process, during platen deceleration and when a new or different abrasive disk is attached to the platen.

When, a typical workpiece holder is rotated while slightly misaligned, some of the workpiece holder components are moved relative to each other with an oscillating motion by contacting mechanical components during each revolution of the workpiece holder. Friction between individual contacting relative-motion components in a workholder system often impedes the movements of the workholder apparatus during an abrasive process. Oscillation induced friction forces in the workpiece holder apparatus can cause non-flat wear patterns on the surface of an abraded workpiece.

Also, static or dynamic forces that are imposed by the moving abrasive disk must not significantly tilt the workpiece during abrading action where this tilting action can cause non-flat patterns to be abraded into the workpiece surface. Particular concern is that the contact abrading forces that are imposed on the surface of the workpiece by the moving abrasive do not tilt portions of the workpiece surface away from the conformal and parallel contact with the flat abrasive surface. Further, there should be a minimum of vibration of the workpiece as the workpiece is rotated at high speeds. This workpiece holder apparatus design must be able to accommodate a wide variety of workpiece shapes and allow these workpieces to be abraded over a wide of abrading surface speeds using a variety of abrading techniques including, but not limited to, slurry lapping, reciprocal lapping, and high speed lapping. The workholder system must be structurally stiff, of low mass inertia, durable, reliable, friction-free, have a convenient workpiece attachment system, easy to set-up and easy to use and also, provide precisely flat and smoothly polished workpiece surfaces particularly when used in high speed lapping operations.

Solution: Workpieces can be mounted on an off-set spherical-action air bearing workpiece holder that allows the workpiece to be positioned conformably flat to the flat surface of an abrasive coated disk and where the workpiece can be rotated at high speeds while maintained in conformal flat contact with the abrasive surface. Here, the workpiece holder has a spherical surface and is rotated within a spherical shaped stationary housing. High speed flat lapping with this device can abrade workpieces that have opposed parallel flat surfaces or workpieces that have two opposed non-parallel flat surfaces. Air bearings are used to separate the moving spherical shaped workpiece rotor from the stationary rotor housing to allow friction-free motion of the rotor when pressurized air is applied to the air bearing surface. In another embodiment, vacuum can be applied to the spherical air bearing to lock the rotor to the housing at any time during a lapping process. When a rotor is locked to the housing, typically the "stationary" housing is rotated to provide rotation to the workpiece as the workpiece contacts moving abrasive attached to a rotary platen.

The workpiece is attached to the nominally flat surface of a removable holder device that also has a convex hemispherical shaped section. This removable hemispherical component of the workpiece holder device is then inserted into a workpiece holder receiver device component that has a concave spherical surface section that has a spherical radius that matches the spherical portion of the removable holder device. There is a very precision fit of the spherical surface sections of the removable holder and the receiver and this precision fit is maintained even when the removable component is rotated relative to the receiver component body. Pressurized air is introduced into the gap between the convex and concave hemispherical surfaces to provide a frictionless air gap between the convex and concave surfaces. The spherical surfaces of the convex removable device and the concave receiver allow the removable workpiece surface to be rotated about a cylindrical axis that is perpendicular to the flat surface of the abrasive. Depending on the alignment of the removable holder component with the abrasive surface there can be some oscillatory motion (wobble) between the convex holder and the concave receiver during each rotation of the workpiece convex holder even though the workpiece surface is in flat conformal contact with the abrasive during each revolution. Because the removable workpiece convex holder is separated from the concave receiver by the air gap there are no oscillatory motion contacting friction forces that exist between the workpiece holder convex and concave components that induce periodic non-flat patterns to be abraded in the workpiece surface during an abrading process.

The workpiece holder receiver device has an upper vacuum chamber that can provide a removable holder restraining force by applying a vacuum to this upper chamber. The receiver spherical surface is constructed to act as an air bearing with the use of a porous surface material such a porous carbon or by the use of air passageways when pressurized air is applied to the receiver. The pressurized air provides a thin film of air in the small gap area that exists between the receiver and the holder spherical surfaces that are in mutual spherical alignment. The vacuum provides a restraining force on the holder and the pressurized air film provides a force that separates the holder from the receiver. These two forces are in balance with each other. Either the vacuum or the pressure can be easily changed to adjust the air gap thickness or the stiffness of the air gap. The pressurized air film that resides in the spherical gap provide a very low friction spherical bearing that allows the holder to freely rotate within the receiver body. There is complete friction-free spherical angular freedom of motion of the workpiece holder but the holder is still constrained to the receiver body with significant structural stiffness. A flexible cable can be attached to the upper portion of the removable workpiece holder to force the workpiece to rotate in a cylindrical direction while the workpiece is constrained in stationary receiver. The cable is flexible enough that a limited tilting motion of the workpiece is allowed so that the workpiece can align conformal to the flat planar surface of the abrasive without imposing significant and undesirable out-of-plane torque forces on the workpiece during an abrading action. Other devices comprised of universal joint shafts or other devices can also be used in place of the flexible cable device. The end of a universal joint shaft that is connected to the removable workholder device can have a hexagonal-ball shaped end that is loosely inserted into a hexagonal shaped receiver hole in the removable workpiece device. The hexagonal ball allows some misalignment of the shaft axis with the receiver hole axis but a positive torsional engagement between the shaft and the removable device is maintained as the shaft rotates the removable device. The loose fit of the hexagon ball in the receiver hole can allow the workpiece convex holder to wobble during rotation without requiring enough periodic flexure of the rotation drive flexible cable to impose significant cable induced periodic forces on the convex holder.

Vacuum that is present in the upper vacuum chamber can optionally also be routed to the workpiece mounting surface via port holes that extend through the thickness of the workpiece holder block to allow quick attachment of the workpiece to the removable workpiece holder device.

The technology employed to provide this spherical air bearing workpiece holder is similar to that employed in air bearing cylinders and rollers as described in detail in U.S. Pat. No. 6,607,157 (Duescher) which is incorporated herein by reference.

When a workpiece holder has components that are changed in position relative to each other with oscillating motions by contacting mechanical devises such as pins and slot, the mass inertia of these components becomes important because a higher inertia requires higher contact forces. Large oscillatory contact forces can result in periodic patterns abraded into workpiece surfaces. Aluminum and titanium materials can be used to construct the components of workpiece holders as they are coolant water resistant and provide good structural stiffness even when the workpiece holders are large enough to hold large workpieces such as 12 inch (300 mm) diameter semiconductor disks. Use of a two-piece workpiece spherical holder that has a air bearing between a cable-driven rotor and a semi-stationary receiver does not use mechanical pins so the problems associated with the periodic acceleration and deceleration of the workpiece holder components is largely eliminated. Here, both the convex holder and the concave receiver can be of significant mass inertia as the receiver has little, if any, oscillation motion and the workpiece holder simply has a steady (non-oscillatory) rotation. A non-aligned rotor appears to wobble as it rotates within the semi-stationary receiver but there are no oscillatory dynamic forces imposed on the workpiece by the stead-state rotation of the workpiece and rotor. The mass inertia of a flexible drive cable or a universal joint shaft that is used to rotate the workpiece rotor is relatively insignificant.

It is preferred that the workpiece is positioned radially on the workpiece holder so that the center of gravity of the workpiece is centered on the workpiece axis of rotation to minimize out-of-balance rotation dynamic force effects on the workpiece holder as the workpiece is rotated. Further it is preferred that the lower lip of the spherical workpiece holder housing extends well below the surface of the workpiece holder rotor flat surface to prevent the spherical edge of a workpiece holder rotor from extending past the spherical lip of the housing as the workpiece rotor is tilted through a tilt angle.

Provision of an air gap between the convex and concave hemispherical components is highly preferred to the use of a more viscous fluid than air or to rubbing contact between low friction materials because an air gap produces essentially a friction-free movement between the convex and concave components. Offset center of rotation workpiece holders can also be used to increase the abrading speed of abrasive slurry lappers.

Figure 126:
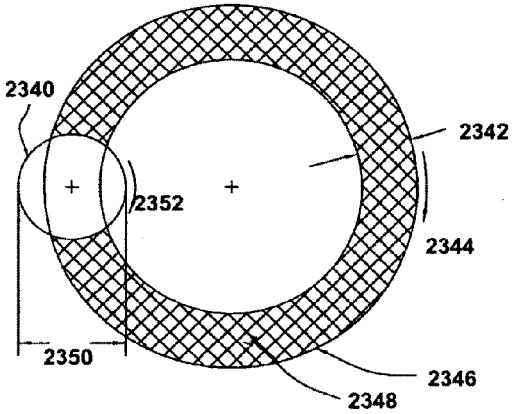

FIG. 126 is a top view of a relatively wide workpiece contacting an annular band of rotating abrasive. The abrasive disk 2346 has an annular band of abrasive 2348 that is rotating in the direction 2344 where the disk 2346 is mounted on the flat surface of a platen (not shown). The abrasive 2348 has an annular width 2342 and the wide workpiece 2340 having a diameter 2350 is shown overhanging the annular abrasive 2348 where the workpiece 2340 rotates in the same rotational direction 2352 as the abrasive direction 2344 to equalize the abrasive 2348 tangential relative abrading speed between the workpiece 2340 and the abrasive 2348 across the full abrasive radial width 2342 and also across the rotating workpiece diameter 2350. Those areas of the rotating workpiece 2340 that extend past the abrasive 2348 and are temporarily not in contact with the abrasive 2348 are not abraded when they are not in contact with the moving abrasive 2348.

Figure 127:
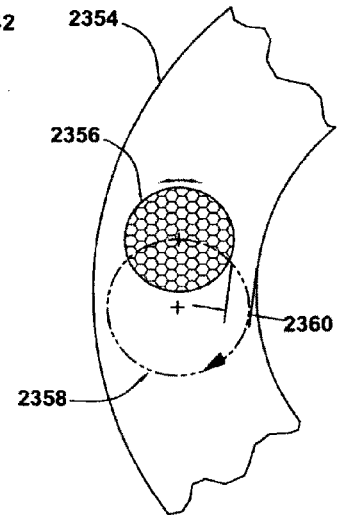

FIG. 127 is a top view of a relatively narrow workpiece contacting a segment of an annular band of rotating abrasive. The annular abrasive disk 2354 has an annular band of abrasive that is rotating and the narrow rotating workpiece 2356 is shown a distance 2360 from the inner radial edge of the disk 2354 abrasive. To equalize the wear across the radial width of the abrasive disk 2354 the workpiece 2356 is moved in an orbital path 2358 where some portions of the workpiece 2356 extends past both the inner and outer radial edges of the annular width of the abrasive disk 2354 during the abrading process to provide even abrasive wear across the full surface of the abrasive disk 2354. The orbital translational path 2358 is shown here as circular but there are variety of other shaped paths that could be used in place of the shown circular path 2358. It is preferred that a continuous motion path be used so that a reciprocating path can be avoided as a reciprocation translational motion imposes acceleration-deceleration forces on the moving workpiece 2356 which can cause the workpiece 2356 to tilt relative to the flat abrasive 2354 surface during an abrading operation. Tilting of the workpiece 2356 during abrading can result in non-flat workpiece 2356 surfaces.

Figure 128:
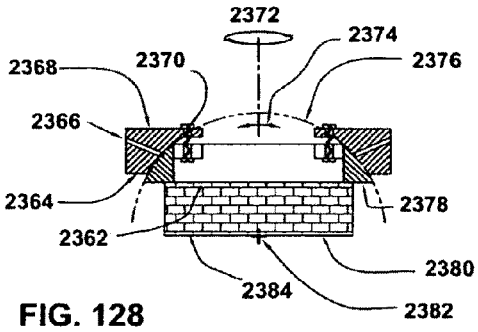

FIG. 128 is a cross section view of a hemispherical workpiece holder apparatus that has a spherical center of rotation that is located on the surface of the workpiece to prevent abrading contact forces from tipping or tilting the workpiece leading edge into the surface of the abrasive. Tilting the leading workpiece edge into the abrasive occurs when the spherical pivot point is located above the abrasive surface, which results in non-flat workpiece surfaces. The workpiece holder apparatus 2368 has a concave hemispherical shaped receiver 2364 that is in spherical contact with a convex hemispherical shaped workpiece holder 2378 where the holder 2378 can rotate through a limited spherical angle 2374 as defined by the spherical radius 2376 having a spherical center of rotation 2382 that is located on the abraded surface 2384 of the workpiece 2380 that is attached to the workpiece holder 2378. The holder 2378 is shown, as an apparatus 2368 configuration option, as held in contact with the receiver 2364 by retainer springs 2370 that are used if it is desired to independently hold the holder 2378 against the receiver 2364. There are numerous other holder retainer systems that can be used in place of the retainer springs 2370 that are shown here. Pressurized air or another fluid is injected at the port hole 2366 to provide a low friction fluid bearing in the mutual spherical gap between the receiver 2364 and the holder 2378. Alternatively, a low friction coating or lubricant can be applied to the spherical surfaces or a low friction polymer or a porous carbon material can be used to construct one or both spherical surfaces of the receiver 2364 or the holder 2378. Provision of an air gap between the convex and concave hemispherical components is highly preferred to the use of a more viscous fluid than air or to rubbing contact between low friction materials because an air gap produces essentially a friction-free movement between the convex and concave components. The workholder apparatus 2368 is rotated in a selected direction 2372 during abrading action where the workpiece surface 2384 is held in flat contact with a flat moving abrasive surface (not shown) even when there is a slight misalignment between the apparatus 2368 receiver 2364 and the abrasive surface or the workpiece mounting surface 2362 of the workpiece 2380 is not parallel to the abraded workpiece surface 2384. There is an anti-rotation pin-and-slot device (not shown) that allows rotation 2372 of the receiver 2364 to transmit rotation to the workpiece holder 2378.

Figure 129:
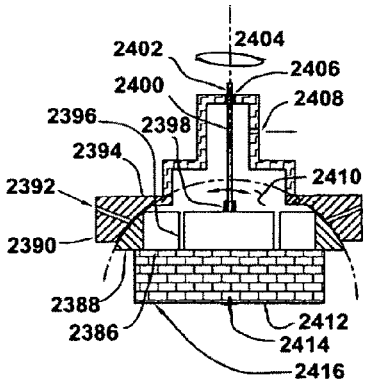

FIG. 129 is a cross section view of a hemispherical workpiece holder apparatus that has a spherical center of rotation that is located on the surface of the workpiece where the workpiece holder is rotated within the body of the apparatus while the workpiece is held in flat surface contact with a flat abrasive surface. Location of the workholder pivot center on the workpiece surface prevents abrading contact forces from tipping or tilting the workpiece leading edge into the surface of the abrasive. Tilting the leading workpiece edge into the abrasive occurs when the spherical pivot point is located above the abrasive surface, which results in non-flat workpiece surfaces. The workpiece holder apparatus 2394 has a concave hemispherical shaped receiver 2390 that is in spherical contact with a convex hemispherical shaped workpiece holder 2388 where the holder 2388 can rotate through a limited spherical angle as defined by the spherical radius having a spherical center of rotation 2414 that is located on the abraded surface 2416 of the workpiece 2412 that is attached to the workpiece holder 2388. The holder 2388 is shown as held in contact with the receiver 2390 by vacuum that is applied at the port hole 2408 to the vacuum chamber 2410. Pressurized air or another fluid is injected at the port hole 2392 to provide a low friction fluid bearing in the mutual spherical gap between the receiver 2390 and the holder 2388. Alternatively, a low friction coating or lubricant can be applied to the spherical surfaces. Also, a low friction polymer or a porous carbon material can be used to construct one or both spherical surfaces of the receiver 2390 or the holder 2388. Provision of an air gap between the convex and concave hemispherical components is highly preferred to the use of a more viscous fluid than air or to rubbing contact between low friction materials because an air gap produces essentially a friction-free movement between the convex and concave components.

The workpiece holder 2388 is rotated in a selected direction 2404 during abrading action where the workpiece surface 2416 is held in flat contact with a flat moving abrasive surface (not shown) even when there is a slight misalignment between the apparatus 2394 receiver 2390 and the flat abrasive surface or when the workpiece mounting surface 2386 of the workpiece 2412 is not parallel to the abraded workpiece surface 2416. A flexible cable shaft or a universal joint shaft 2402 extends through a vacuum-sealed bearing 2406 in the apparatus 2394 where the extended end of the cable or shaft 2400 is loosely inserted into a shaft receiver 2398 that is attached to the workpiece holder 2388. When the shaft 2402 is rotated, the extended shaft 2400 imparts rotation action to the workpiece holder 2388. An alternative method of attaching the workpiece 2412 to the holder 2388 is use of vacuum that is applied to the workpiece mounting surface 2386 from the vacuum chamber 2410 through the vacuum port holes 2396. The workpiece holder 2388 is rotated relative to the stationary receiver 2390 in a selected direction 2404.

Figure 130:
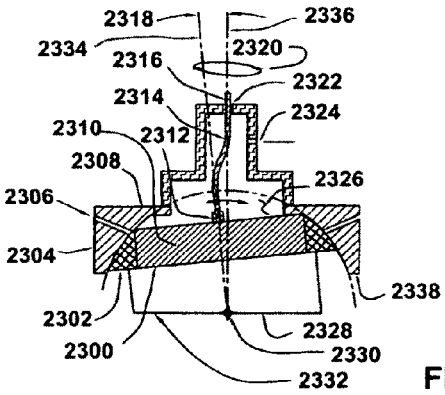

FIG. 130 is a cross section view of a hemispherical workpiece holder apparatus holding a non-flat workpiece where the holder has a spherical center of rotation that is located on the abraded surface of the workpiece. The workpiece holder is rotated within the body of the apparatus while the workpiece is held in flat surface contact with a flat abrasive surface. Location of the workholder pivot center on the workpiece surface prevents abrading contact forces from tipping or tilting the workpiece leading edge into the surface of the abrasive. Tilting the leading workpiece edge into the abrasive occurs when the spherical pivot point is located above the abrasive surface, which results in non-flat workpiece surfaces. The workpiece holder apparatus 2308 has a concave hemispherical shaped receiver 2304 that is in spherical contact with a convex hemispherical shaped workpiece holder 2302 where the holder 2302 can rotate through a limited spherical tilt angle 2318 as defined by the spherical radius having a spherical center of rotation 2330 that is located on the abraded surface 2332 of the workpiece 2328 that is attached to the workpiece holder 2302. The holder 2302 is shown as held in contact with the receiver 2304 by vacuum that is applied at the port hole 2324 to the vacuum chamber 2326. Pressurized air or another fluid is injected at the port hole 2306 to provide a low friction fluid bearing in the mutual spherical gap between the receiver 2304 and the holder 2302. Alternatively, a low friction coating or lubricant can be applied to the spherical surfaces or a low friction polymer. Also, a porous carbon material can be used to construct one or both spherical surfaces of the receiver 2304 or the holder rotor 2302.

The workpiece holder rotor 2302 is rotated in a selected direction 2320 during abrading action where the workpiece surface 2332 is held in flat contact with a flat moving abrasive surface (not shown) even when there is a slight misalignment between the apparatus 2308 receiver 2304 and the flat abrasive surface or when the workpiece holder mounting surface 2300 of the workpiece 2328 is not parallel to the abraded workpiece surface 2332. A flexible cable shaft or a universal joint shaft 2316 extends through a vacuum-sealed bearing 2322 in the apparatus 2308 where the extended end of the cable or universal shaft 2314 is loosely inserted into a shaft receiver 2312 that is attached to the workpiece holder 2302. When the shaft 2316 is rotated, the extended shaft 2314 imparts rotation action to the workpiece holder 2302. An alternative method of attaching the workpiece 2328 to the holder 2302 is the use of vacuum that is applied to the workpiece mounting surface 2300 through the workpiece holder block 2310 from the vacuum chamber 2326 through the vacuum port holes 2324. The workpiece holder 2302 is rotated relative to the stationary receiver 2304 in a selected direction 2320.

The workpiece holder rotor 2302 has a tilted center of rotation axis 2334 and a non-tilted center of rotation axis 2236. The rotor housing 2304 has a housing bottom lip 2338 that nominally extends below the workpiece holder mounting bottom surface 2300.

Large Platens

Very Large Flexible Abrasive Disk Platen

Problem: A very large, 30 to 60 inch (76 to 153 cm) diameter, platen driven at a high rotational speed requires a very precise spindle so that the outboard annular edge is extremely flat for high speed abrasive lapping. The large diameter platens are mounted on the flat cylindrical surface of the spindles. A variation in flatness of the flat surfaced spindle, due to the out-of-round characteristics of the spindle roller or air bearings, is multiplied at the outer platen diameters as these platens overhang the spindle cylindrical edges. The typical 6 inch (15.3 cm) diameter spindle roller bearings are very small in relation to the platen diameter. Extra precise air bearing spindles can be used but they are expensive and limited in capability for supporting grinding contact forces located outboard at the large outer overhung platen diameters. Thick and stiff platens can be used to minimize the abrading force deflection of the overhung platen bodies but these platens have very high inertias which delay acceleration of the platen to the full rotational speed required for high speed grinding or lapping.

Solution: High speed horizontal large diameter platens used for high speed raised island abrasive lapping can be constructed where the primary vertical support of the outer periphery portion of the platen where the abrasive coated raised islands are located is provided by air bearing pads. A driven platen-center spindle primarily provides radial support to the horizontal platen and provides limited vertical support to the platen. The air bearing pads are located on the bottom side of the platen to provide a platen-top flat surface that has a completely open surface for abrading action coolant water flow and for ease of changing abrasive disks. The platen has a stiff outer annular section and an out-of-plane-flexible middle section and a flexible inner section that is attached to the spindle. In another embodiment the composite platen can have a stiff annular outer periphery section, an out-of-plane-flexible annular middle section and a stiff cylindrical plate inner section that attaches to the drive spindle. These very large diameter abrasive platens that are supported by outboard air bearing pads provide a very stiff platen outer section support system that allows the platen to operate at very high speeds with little rotational friction. The air bearing pads also provide support that results in extremely small variations in the flatness of the annular portion of the platen where the annular band of abrasive raised islands is located. Providing this precision flat platen surface allows the precision thickness abrasive raised island sheets to be successfully used in high speed lapping.

When the precision thickness abrasive disks initially "wear-in" on a platen to compensate for small out of plane variations in the platen surface they develop a precisely flat planar abrading surface. Typically these disks are then temporarily removed to install another disk having larger or smaller abrasive grits. Before removal, the disk is typically marked to allow this disk to be reinstalled in the same tangential position on the same platen at a future time by aligning the disk mark with another registration mark on the platen body. This procedure eliminates the requirement that the abrasive disk will have to be "worn-in" again to compensate for small out of plane variations in the platen surface. Abrasive particles are consumed in each wear-in procedure so the realignment procedure extends the abrading life of the abrasive disk.

In one embodiment, a typical small diameter commercial roller bearing spindle, having an 8 inch (20.4 cm) diameter top, or a simple shaft with pillow block bearings can be used as a center support for the flexible-center horizontal platen. A stiff outer radius annular platen section can have an inner section constructed of a thin flat plate section that is coupled to the spindle. The outboard annular platen section would then be supported at discrete positions around its circumference by use of air bearing pads having positive air pressure land areas that surround negative pressure vacuum open areas. A vacuum can be applied to the center of the pad to attract the bottom side of the platen toward the pad surface. High pressure air would be supplied to the narrow outer ring of the air bearing pad, made by New Way Machine Company, Aston, Pa. or Nelson Air Corp of Milford, N.H., to push the platen away from the attractive vacuum force thereby creating stable vibration damped controlled support of the platen. Each pad would be mounted level and the flexibility of the middle annular section would allow the platen outer annular ring to travel at a high surface speed and remain precisely flat when the platen is rotated at high speeds. Further, this very large diameter platen would have minimum inertia that would allow relatively quick acceleration and deceleration of the platen. Grinding and lapping stations would be located above the air pad support stations to provide rigidity to the platen at the locations where abrading forces are imposed on the platen.

FIG. 135 shows a cross section view of a platen that has a thin and flexible annular middle section and a stiff annular outer periphery. Here a platen 1700 that has a stiff outer annular ring 1690 that is driven by a commercial small diameter spindle 1694 or center-support bearing shaft which has a platen center hub 1686. The horizontal flexible platen 1700 having a flexible platen annular middle-section 1688 is supported at discrete points around its periphery by vacuum centered air bearing pads 1676 and 1692 that are positioned on the lower side of the stiff outer platen annular ring section 1690. The air pad 1692 is shown with a positive air pressure land area 1698 and a central recessed vacuum area 1696. The air pad 1692 positive air pressure land area 1698 exerts an upward force on the outer annular platen ring 1690 and the central recessed vacuum area 1696 exerts an opposing counterbalancing downward force on the outer annular platen ring 1690. The workpiece 1678 is mounted to a workpiece holder 1680 that is positioned directly in line with and above one of the air bearing support pads 1676. The workpiece holder 1680 is supported by a spindle 1682 that has spindle bearings 1684 which allow spindle 1682 rotation.

Floating Abrasive Disk Platen

Problem: It is desirable to produce relatively inexpensive but very large diameter abrasive platens that have low inertias, are corrosion resistant and that provide extremely precise flat surfaces at all rotation speeds and abrading contact forces. These platens support precision thickness flexible raised island abrasive sheet disks having very thin layers of abrasive particles that are used in high speed flat lapping. Low platen inertias allow fast rotational acceleration and deceleration of the abrasive disks. It is also desirable to allow quick change of platens for maintenance issues including an event where a platen experiences surface damage or loses surface flatness.

Traditional lapping machines can have rotating spindles that support flat-surfaced platens where flexible abrasive disk articles are vacuum attached to the flat platen surfaces. Both the spindles and the platens must be stiff enough to resist the abrading contact forces without deflecting the outmost radial portion of the abrasive disk surface more than 0.0001 inches (2.5 micrometers) that is required for a typical high speed flat lapping process. Spindles that use axial force-loaded roller bearings to achieve this degree of accuracy typically can not be rotated at high enough speeds to achieve the 10,000 surface feet per minute (SFPM) abrading speed required for high speed flat lapping for small abrasive disks. A 12 inch (30 cm) diameter platen must revolve at 3,184 revolution per minute (RPM) to achieve 10,000 SFPM speeds. However, as the platen diameter is increased, the platen RPM is proportionally decreased to provide this same SFPM. Here, a 36 inch (91 cm) diameter platen only requires 1060 RPM and a 72 inch (183 cm) diameter platen only requires 530 RPM, a rotational speed that is practical for a precision grade roller bearing spindle. Conventional air bearing spindles can provide good stiffness for axial and radial force loads but their flat-surfaced heads are typically limited to 4 to 12 inch (10 to 30 cm) diameters. Air bearings are limited in their capability to withstand spindle tilting forces that are produced by load forces imposed outboard of the flat spindle heads. Liquid bearing spindles can provide even greater stiffness for axial, radial and tilting force loads than air bear spindles but they are limited in speed compared to air bearing spindles.

Commercial air bearing spindles operating at high rotational speeds are precise enough and stiff enough to support flat-plate platens that extend a limited distance past the flat face of the spindle for use with 12, 18 and 24 inch (30, 46 and 61 cm) medium diameter abrasive disks. However, for larger sized 36 to 72 inch (91 to 183 cm) abrasive disks it is difficult and very expensive to manufacture flat surfaced spindles that are capable of providing sufficiently large stiffness to adequately support these large abrasive disks. Also, the abrading forces that are applied perpendicular to the platen outboard flat surfaces tend to substantially deflect the portion of the platen body that overhangs the flat spindle surface unless the platen is very stiff. Stiff platens tend to be very thick and have high rotational inertias that prevent fast platen rotational speed changes. Very small planar deflections of the platen body can easily exceed the 0.0001 inches (2.5 micrometers) very small planar surface variations that are allowable for high speed flat lapping.

Air bearing spindles are substantially limited in the amount tilting forces they can withstand without "bottoming out" the very small air gap that separates the air bearing spindle rotor from the air bearing stationary stator. Those abrading contact forces that are applied perpendicular to the platen outboard flat surfaces when using very large diameter annular band abrasive disks create large spindle tilting forces. Further, a catastrophic tear of an abrasive disk, that typically has a very thin backing material thickness, can occur where a portion of the ripped abrasive disk wedges between the workpiece holder and the platen surface as the platen is rotating at very high speeds. Here, the high energy stored in the rotating platen instantly creates a very large dynamic force that is directed downward on the horizontal platen surface. These catastrophic forces act at the outboard platen locations and produce very large spindle tilting forces. In the event that the allowable tilting force capability for a rotating air bearing spindle is exceeded by static or dynamic abrading load forces, the expensive air bearing spindle can be severely damaged as the spindle rotor and stator surfaces rub together.

For high speed flat lapping, the required out-of-plane variations in the platen flatness at all platen rotational speeds typically are to be less than 0.0001 inches (2.5 micrometers) for all sizes of abrasive disks even for those disks having 72 inch (183 cm) or greater diameters. These flatness tolerances are extremely difficult to achieve when the platen is a flat plate device that substantially overhangs the spindle flat surfaced body.

Solution: A lapping machine can be constructed with the use of conventional air bearing spindles that have 4 to 12 inch (10 to 30 cm) diameter flat-surfaced heads for use with medium diameter 12, 18 and 24 inch (30, 46 and 61 cm) abrasive disks. Nelson Air Corp of Milford, N.H. or Professional Instruments Co. of Minneapolis, Minn. can supply these spindles. Larger diameter air bearing heads are preferred as there is less deflection of the platen bodies because there is less overhanging of the platen edges past the head peripheries. Medium diameter flat platens having surface vacuum port holes and internal air passageways are attached to the flat spindle surface. The platens that are large enough to accommodate these medium abrasive disk sizes that are either flush with the periphery of the spindles or overhang the periphery a limited amount. Vacuum is supplied to the spindle axis shaft-center hole that is connected to the passageways and to the port holes. Flexible abrasive disks are quickly attached to the platen surface by the negative pressure of the vacuum. This vacuum is connected to the rotary spindle shaft through-hole with the use of a rotary union. A preferred platen material is Mic-6® cast aluminum tooling plate that is free from internal stresses, is a good thermal conductor and is dimensionally stable over long periods of time. Other aluminum alloys can also be used for platens.

A unique type of "floating" platen can be used for the large sized 36 to 72 inch (91 to 183 cm) or larger abrasive disks where only an outboard annular band portion of the platen is held precisely flat as the platen is rotated at high surface speeds. Air bearing air pads are used to support the platen at three or more locations around the outer periphery of the platen. The planar flatness of the outer periphery portion of the platen is not dependent on the support of the rotary spindle that is located at the platen center. This is a counterintuitive approach to providing very large and precisely flat platens by substantially reducing the inner diameter planar stiffness of the platen rather than increasing it. It is not practical to provide a large diameter extra-thick platen that overhangs a center-support flat surfaced spindle and which deflects out-of-plane by less than the required 0.0001 inch (2.5 micrometer) when subjected to outboard-radius flat lapping abrading forces. In addition, this approach prevents the platen outboard-position force load tilting effect problem from damaging the spindle. These flexible platens would be for use with flexible abrasive disks that have annular bands of abrasive coated raised islands where the abrasive disks are attached to the platen by the use of vacuum. The abrasive disk is positioned on the platen where the annular band of the abrasive islands is substantially coincident with the platen outer annular band and the annular band of islands is also substantially coincident with the platen support air pads. The radial width of the raised island annular band is also approximately equal to the radial width of the platen annular band.

In one embodiment, the same relatively inexpensive air bearing spindles having 4 to 12 inch (10 to 30 cm) flat-surfaced heads that are used for the medium diameter abrasive disks can be used for this large sized floating platen. Here, a relatively thin large diameter platen is center-mounted on a flat surfaced spindle where the portions of the platen outboard of the spindle head are supported by a number of flat surfaced air bearing support pads. Each flat large surface area support pad would be positioned around the platen circumference near the platen outer diameter to prevent droop of the outer annular ring of the platen. The radial width of the support pad can be narrow relative to the radial width of the annular portion of the platen that provides planar support across the annular width of the raised islands on an abrasive disk. Typically the tangential length of the air bearing support pads would be long relative to the radial width of the support pads. The air bearing support pad surfaces can be rectangular in shape or they can have an annular shape or other shapes. An air film would separate the bottom flat surfaces of the platen and the air bearing support pads. The precisely planar flat position of the floating outer annular portion of the platen at each support pad location is substantially dependent on the support pads and independent of the planar support of the platen-center air bearing spindle. However, very stiff radial support of the platen is provided by the platen-center air bearing spindle. Roller bearing platen center spindles can also be used but air bearing spindles are preferred.

The platen is designed to have an out-of-plane flexibility in the annular portion section of the platen that is located between the spindle head and the platen outer band but yet provide substantial radial and torsional stiffness to the platen. This planar flexibility allows the platen outer annular band portion to have low-force out-of-plane "diaphragm" motions relative to the platen inner hub portion that is attached to the spindle head. This flexibility allows the spindle axis to be slightly misaligned with a perpendicular with the plane of the air bearing pads and also, for small dimensional variations in the spindle flat mounting surface as it rotates. However, if the outer annular band air bearing support pads do not support the outer annular band portion of this flexible-section platen, the outer annular band portion of the platen would tend to droop below the inner portion of the platen that is supported by the horizontal planar spindle flat surface. Just the weight of the platen body would cause this drooping even without the imposition of abrading forces. Drooping of the outboard annular portion of the platen would be completely unacceptable for high speed flat lapping. The outer annular band portion of the platen would have sufficient planar stiffness that the full annular portion of the platen would tend to remain precisely in a plane even when the platen annular band is supported by only a few support pads where there are some tangential gaps between individual support pads.

A large diameter flat circular platen can be attached at the center to a flat surfaced air bearing spindle having a relatively small 12 inch (30 cm) diameter. The platen would have a very substantial overhang past the periphery of the spindle center flat surface particularly when used with a very large 72 inch (183 cm) platen. Instead of using a very thick and massive platen that would provide sufficient stiffness to the overhung portion of the platen, a relatively thin-plate platen is used. The platen top surfaces would have a continuous flat planar surface to support a flexible raised island abrasive disk that has a smooth continuous mounting side surface. The abrasive disk would be attached to the platen by vacuum that is sealed from leakage by the continuous surface of the disk backing sheet that is in continuous flat contact with the platen flat surface. The platen outer annular bands would have radial widths that are greater than the annular width of the raised islands on the abrasive article. Annular bands of the platen are coincident with the annular bands of the abrasive articles.

The preferred operating position of the platen plane is horizontal but the platen plane can also be positioned vertically. The peripheral air bearing support pads provides primary planar support of the platen. The platen-center air bearing or roller bearing spindle provides all of the radial support of the platen. The outer radial portion of the platen tends to "float" relative to the platen inner radial portion that is rigidly fastened to the spindle flat surface because the relatively thin platen inner section has low out-of-plane stiffness. The platen inner section thickness and diaphragm stiffness is controlled to prevent the inner flat spindle surface from affecting precise flat near-contact of the flat annular band surface of the platen with each individual peripheral air bearing support pad surface. It is preferred that the platen center spindle contribute very little to the assumed flatness of the outer periphery of the platen to assure that planar leveling of the localized portions of the platen is controlled individually at each substantially sized air bearing support pad area. In one embodiment, a typical platen can have a relatively thick 0.75 inch (1.9 cm) outer annular band, a relatively thin 0.25 inch (0.6 cm) annular portion of the platen that is located between the flat spindle head and the platen outer band and medium thickness 0.50 inch (1.2 cm) inner circumference at the spindle head location.

The outboard portion of the horizontal platen can be supported at discrete positions around its circumference by the use of combination air-bearing/vacuum pads. A minimum of three evenly spaced platen pad support stations is preferred but additional evenly-spaced support stations are more preferred. A continuous tangential support of the platen annular band is even more preferred. These air-vacuum platen support pads are located only on the bottom side of the platen which allows complete open access of the top surface side of the flexible fixed-abrasive disk article that is mounted on the flat platen surface. The support pads provide platen support to resist the localized downward abrading contact forces that are imposed by forcing the workpiece down on the surface of the abrasive. Workpiece abrading stations are located directly above and concentric with the platen air-bearing/vacuum platen support pad stations.

A film of high pressure air exist between the platen surface and the air bearing land areas at all times. The nominal thickness of this air film is approximately 0.0005 inches (12 micrometers) when both the vacuum and the pressurized air are applied to the air bearing support pads. This interface air film thickness is maintained at this nominal thickness at all rotational speeds of the platen including when the platen is stationary. Contact between the surface of the platen and the air pads is avoided whenever the platen is moving to avoid damage to either the platen surface or the air pad surface. A stationary platen can rest on the surface of the air pads when the air pad pressurized air is interrupted in the same way that the rotor portion of the air bear spindle comes to rest on the spindle body when the spindle pressurized air is interrupted. The nominal air film thickness in an air bearing spindle is typically 0.0005 inches (12 micrometers) or less, depending on the device manufacturer. Air bearing spindles are typically stiffer than roller bearing spindles because of the very small thickness of the air films and the relatively large air film surface areas within the air bearing devices. The typical abrading forces used in high speed flat lapping are very small relative to the contact abrading forces that are present in traditional types of abrading. Because these abrading forces are low and the platen and air films are quite stiff, the abrading surface is maintained in a precisely flat plane during a flat lapping operation.

Dynamic forces that are the result of a catastrophic tear of an abrasive disk that wedges between the workpiece holder and the platen surface are temporarily compensated for by the reduction of the air bearing pad air film thickness. As the air film is reduced in thickness it becomes stiffer and better resists the imposed dynamic force. Contact of the platen and air pad surfaces are avoided and the air film gap thickness resumes it's nominal thickness after the dynamic force event. Permanent planar distortion of the platen is avoided because the out-of-plane temporary distortion of the platen is limited to the very small thickness of the air film.

The air bearing support pads also restrict the localized upward motion of the platen by the use of localized vacuum areas that act on the lower side of the platen surface as the rotating platen moves tangentially relative to the support pads that have stationary locations. Here, the vacuum pulls the surface of the platen down while the opposing air bearing pad surfaces push up on the platen surface. The vacuum portions of the platen support pads are preferred to be in concentric annular ring areas that surround concentric pressurized air bearing land areas. The vacuum areas can capture some of the pressurized air that escapes the adjacent air bearing pad areas. Other concentric or non-concentric configurations of the combination air-bearing/vacuum support pads can be used including concentric rectangular box-like ring areas. Vacuum pads can have raised periphery walls that surround open central vacuum areas where the top surfaces of the raised walls are in close proximity to the platen surface to minimize the leakage of air that is contaminated with abrasive debris into the air pad central vacuum area.

When a 72 inch (183 cm) platen having a 12 inch (30 cm) radial width annular band is used with 72 inch (183 cm) abrasive disk having a 12 inch (30 cm) radial width annular raised island abrasive band for flat lapping 12 inch (300 mm) diameter semiconductor or other workpieces, the radial widths of the air bearing pad devices can also be 12 inches (30 cm) and the tangential lengths of the air bearing pad devices can also be 12 inches (30 cm). Here the approximate planar size of the air pad is approximately equal to the planar size of the workpiece where the full planar area of the workpiece is supported by the air pad. However, air pad surfaces that are considerably smaller than the workpiece surfaces can also be used effectively to support the platen. The area center of the circular semiconductor workpiece would contact the abrasive article at a location that is typically concentric with the area center of the air bearing platen support pad. Multiple air bearing support pads would be space positioned around the circumference of the platen. They may be equal-spaced or with other spacing patterns around the circumference of the platen. Multiple workpiece abrading stations can also be located around the circumference of the platen where a single abrasive disk is used to simultaneously flat lap multiple workpieces.

Air bearing support pads can be constructed from solid metals comprising aluminum or steel. They can also be constructed from porous carbon or other porous materials. Nelson Air Corp of Milford, N.H. can supply solid metal orifice land-area types of air bearing support pads and New Way Machine Company, Aston, Pa. can supply porous carbon types of air bearing support pads. Porous carbon pads that contact a moving platen surface would minimize damage to the platen surface because of the low coefficient of friction of the carbon. However, the porous carbon is fragile and can wear considerably with such contact.

Gap sensors can be installed on the lapping machine to adjust and monitor the pressurized air film gap thickness of each air bearing support pad. The nominal gap size can be adjusted by changing the pressure of the pressurized air or the negative pressure of the vacuum or both. Sensors that can be used comprise capacitance sensors, constant flow rate air gap sensors, laser or ultrasonic sensors. They can be used as single-location devices or they can be positioned at the four outboard corners of an air bearing pad and at the pad center. The sensors can be used to monitor the air bearing support pad air gap thickness when abrading contact loads are applied, when dynamic load events occur, and when the platen is stationary, is operated at slow and at fast speeds. Small deviations in the flatness of the platen surface and the location of these deviations can be determined over the operating life of the lapper machine and this data can be used for scheduling maintenance of the lapper system.

A platen base plate can be constructed from a typical 0.375 inch (0.95 cm) thick MIC 6® cast aluminum tooling plate supplied by Alcoa, Inc of Pittsburgh, Pa., machined to the desired diameter, Blanchard ground to establish flatness and provide a smooth surface finish. Then the platen can be machined to provide spindle mounting holes, a mounting land ring that allows it to be centered on the spindle within 0.0001 inches (2.5 micrometers). Further machining can provide the platen with a raised outer periphery annular land area on both flat sides of the platen and air passageways on one platen surface side. The platen can then be mounted on an air bearing spindle with recessed fasteners and ground flat on both the central mounting areas and the outer periphery annular raised areas where the outer periphery annular areas and the central area are at the same precise elevation. This grinding process can be done by mounting the platen on a grinding machine that has a center air bearing flat surfaced spindle and outer periphery air bearing support pads, a configuration similar to a high speed flat lapping machine. Grinding of the platen can take place at one support pad location using a diamond tool grinder that traverses radially as the platen is rotated. After one side of the platen is ground, the platen can be flipped and the other side ground flat at the same grinding station. The outer annular band of the platen is now precisely flat and both surfaces of the platen are precisely parallel and the platen thickness is precisely equal over the full annular band circumference. The platen can then be hard anodized with a polytetrafluoroethylene (PTFE) impregnation and the platen can then be reground and polished or flat lapped to provide a precisely flat and highly polished annular band surface.

A platen surface cover plate constructed from a typical 0.125 inch (0.32 cm) thick MIC 6® cast aluminum tooling plate can be selected, machined to the desired diameter, provided with vacuum port holes and Blanchard ground to establish flatness and provide a smooth surface finish. This cover plate can be processed the similar to that done for the platen base plate and joined to the platen base plate with threaded fasteners or with an adhesive comprising epoxy. The composite platen having integral vacuum passageways and port holes can then be reground and processes using a similar process as described above for the platen base plate. The total thickness for the described composite platen is approximately 0.5 inches (1.3 cm) but this thickness can be changed to optimize the performance of different platens dependent on the platen diameter, the platen materials and the flat lapper machine performance requirements.

After assembly of the composite platen, it can be accurately center mounted on a vertically positioned frictionless air bearing spindle and very accurately static balanced with the use of threaded fasteners inserted into radial holes in the platen plate periphery.

In one air bearing support pad configuration embodiment, vacuum is applied to the central portion of an air bearing pad to attract the bottom side of the platen toward the pad surface. High pressure air is supplied to the narrow outer ring of a porous carbon air bearing pad, made by New Way Machine Company, to push the platen away from the attractive vacuum force thereby creating a stable vibration damped controlled support of the platen. Each support pad planar surface would be mounted level with the bottom planar surface of the platen. This would allow the rigid platen to have a high surface speed and remain precisely flat when rotated at high speed as supported by the support pads. When the support pads are energized by both the high pressure air and the vacuum that oppose each other, the platen surface is maintained with a very small air, gap in the interface area between the platen and the air bearing. This interface air gap is typically from 0.0001 to 0.0005 inches (2.5 to 12.5 micrometers) and the interconnection between the platen and the air bearing is very stiff. Because of the very large air gap stiffness, the abrading contact force load that is imposed on the interconnection joint during high speed flat lapping results in very little deformation of the pressurized interface air gap and therefore, very little deflection of the platen surface due to the abrading force. During a lapping operation, the platen surface does not contact the surfaces of the platen support pads as they are always separated by a small air gap.

The size of the vacuum areas would be proportioned to the corresponding adjacent pressurized air bearing areas to compensate for the difference in the gage pressure of the vacuum and the pressurized air. For example, 60 psig (pounds per square inch gage) or 4.2 kg per square cm pressure air is often supplied to a porous carbon air bearing with an expected pressure drop of 30 psig drop within the porous carbon and a net support pressure of 30 psig at the support surface of the air bearing. The corresponding surface area of the vacuum ring would be three times larger than the air bearing area for a vacuum that is only 10 psig or (0.7 kg per square cm), out of a 14.7 psig (1.0 kg per square cm) maximum for a perfect vacuum. Proportioning the vacuum surface areas to the pressurized surface areas for an air bearing/vacuum air support pad that is constructed from a non-porous metal would be optimized for the selected average pressure that exists at the pressurized land support areas and the selected vacuum psig level.

Different types of machine bases can be used to construct a high speed lapping machine having a flexible platen. One type uses a framework that is constructed from tubular steel tube sections that are welded together. After the frame weldment is made, the frame can be stress relieved in a high temperature furnace. It can further be subjected to low temperature cycles and the heating and cooling processes can be repeated to assure the absence of residual stresses in the frames that could distort the frame over time. A weldment provides a relatively lightweight frame but the dimensional stability is questionable when considering the required accuracies for flat lapping with very large sized abrasive disks.

Another type of lapping machine base can be constructed from a granite block to provide structural rigidity and dimensional stability. Granite offers a base that can be ground flat and lapped by conventional abrasive finishing techniques as is known to maintain these precision surfaces over very long periods of time as compared to welded machine structures. Granites that can be used comprise Academy Black Granite. The granite base would typically have a thickness of 10 inches (25 cm) and would be hand lapped surface-finished to a precision flatness of 0.0001 inches (2.5 micrometers) or better. The heavy granite base would be three-point mounted in the lapping machine on the same three points that it was supported on during the original granite surface finishing. This very accurate and stable granite base allows all of the critical lapping machine components including the air bearing spindle and all the air bearing support pads to be mounted in a common plane. Each of the air bearing support pads can be attached to Mic-6® cast aluminum tooling plate bases which are ground as an assembly to the same precise height of the air bearing spindle. Both the air pad bases and the spindle can be mounted to the precision flat granite surface. Further, all of the relatively large sized support pad aluminum bases can have piping or passageways for a temperature controlled liquid to maintain the air pads and the granite, by conduction, at a precise temperature for structural stability of the system.

In one embodiment, the platen can be attached to the spindle with a spline-type of coupler that allows the platen to float where the horizontal platen planar vertical position is controlled by air pads that support the outer periphery of the platen. The spline device provides rotational speed control torque to the platen and keeps the platen centered at the spindle axis. Here it is very important that the platen is structurally de-coupled from the drive spindle except for a radial in-plane connection and a platen-to-spindle torsional drive member connection. Floatation of the outboard annular portion of the circular plate platen on the air film must not be substantially influenced by the orientation of the platen-center drive spindle. This assures that the precision flatness of the outer annular band is established and maintained during both short term and long term operation of the platen for high speed lapping.

The platens can be lapped by a high speed flat lapping machine, or can be finish lapped by traditional hand lapping techniques to provide the required flatness, surface finish and parallelism of the two platen flat surfaces that are all required for high speed flat lapping.

Large Air Pad Supported Abrasive Disk Platens

Problem: It is desirable to structurally support very large, 30 to 96 inch (76 to 244 cm) diameter flexible abrasive disk precision flatness platens that are driven at high rotational speeds for flat lapping of semiconductor or other product workpieces. The raised island abrasive disks have an annular band of raised abrasive coated islands at the outer periphery of the disks. These platens must provide abrasive disk mounting surfaces that remain precisely flat at all operating speeds. In addition the large diameter platens must be capable of sustaining the large load forces as a result of catastrophic process events such as the ripping apart of an abrasive sheet disk during a high speed abrading operation. Use of air bearing pads to support the outer periphery of the large diameter platens allows the platen to operate at high surface speeds without exceeding the operating speed limits of mechanical roller bearings.

Single (non-opposed) air pressurized pads where a pressurized single air pad is in near-contact with a platen support member, can be used to support the outer periphery of a platen. However, there is a problem with these devices. They do not have the capability to accurately control the thickness of the air bearing film and therefore, the elevation of the top flat surface of the platen, within the required flatness accuracy of 0.0001 inches (2.5 micrometers) that is necessary for use with precision thickness abrasive coated raised island disks that are used in 10,000 SFM high speed lapping processes. The air bearing air film thickness is controlled by the forces that oppose the pressurized air that is present in the film on the flat surface of the air bearing that is near-contact with the associated platen structure surface. For a single sided air bearing pad, one of the forces that opposes the air film air pressure is the distributed weight of the platen structure. Another opposition force is the spring force that is the result of the out-of-plane distance that the platen structure is intentionally distorted by the reactive force of the air bearing film of air. The platen structure distributed weight force tends not to be evenly distributed around the circumference of the platen because of the localized structural stiffness variations of the platen structure. Likewise, the platen structure distortion spring force tends not to be evenly distributed around the circumference of the platen because of the localized structural stiffness variations of the platen structure.

The desired air pad air film thickness typically ranges from 0.0001 to 0.0005 inches (2.5 to 12.5 microinches), the air pressure supplied to the air pad typically ranges from 60 to 100 psig, an air pad typically has a flat contact surface areas that ranges from 5 to 15 square inches and air pads are used at a minimum of three locations around the periphery of a platen to provide sufficient stability to the platen. Assuming a working air film pressure of 30 psig for three air pads with each having 10 square inches of surface areas for a total of 30 square inches of surface contact area, the "lifting" capability of the pads is 900 lbs which is far in excess of a typical platen assembly that typically would weight less than 200 lbs. The weight of this platen assembly is not sufficient to provide enough force load for operating these air pads. The use of air pads having smaller flat surface areas is not desirable because they do not provide sufficient contact area when a stationary platen assembly rests directly on the air pads when the air pads air supply is interrupted.

It is not desired to intentionally pre-load distort the platen structure sufficiently to provide a substantial spring force to oppose the air film pressure force because of the unknown long term structural material relaxation effects on the platen structure which must maintain its precision flat planar accuracy over long periods of time. Because of the potential variation of the platen structure distributed weight and platen spring forces around the circumference of the platen, the air bearing air film thickness tends to change as the platen is rotated where the stationary air bearing pads provide a constant flow of pressurized air. Here, the pressurized air film acts as a spring where the spring is deflected (air film thickness changes) more or less, as a function of the magnitude of the distributed platen weight and platen structure deflection forces.

It is critical that the thickness of the air bearing film is limited to ranges from 0.0001 to 0.0005 inches (2.5 to 12.5 microinches) in order to provide the desired stiffness that is required of this air bearing platen support system. Because the air that is in the air film is readily compressible, an over-thick air film will simply act as a soft spring rather than as a stiff member. To assure that the air film thickness remains within this narrow range, there must be a substantial force or pressure that acts as a counterbalance to the air film effective air pressure. This effective air film pressure typically is referred to as having an "efficiency" of approximately 35% where the effective air film pressure is approximately 35% of the air pressure that is supplied to an air bearing device. Also, air films that have large thicknesses and soft spring rates can result in very undesirable natural frequency vibrations of the platen as it rotates because of the well known interaction of the air film spring rate and the mass inertia of the platen assembly.

Any changes that occur in the distributed weight or distortion spring forces around the periphery of the platen as it turns can result in platen surface height variations. There are no assurances that these weight distribution and spring distortion forces will remain constant at their specific peripheral platen locations over long periods of time so machining the upper platen surfaces flat when these variations are present will not necessarily provide a precision flat surface over time. It is simply better to minimize their effects on the thickness of the air bearing air film thickness and the platen surface flatness.

Single-side air pads having vacuum sections that provide a vacuum force that opposes the pressurized air bearing air film can be used to support a platen assembly without depending on the platen weight or a platen distortion pre-load spring force to obtain a counterbalancing force. Prevention of the wear of air bearing platen support pads or the associated air bearing pad contact rail members during the operation of a lapping operation is also very desirable. In particular, the use of combination vacuum and pressurized air pads can result in the vacuum drawing in abrasive generated debris into the air bearing apparatus which can result in substantial wear of the precisely flat air bearing surface.

In addition, it is desirable that the upper flat surface of a rotary platen to have a fully exposed planar surface to allow easy access for changing of abrasive disks and to allow the excess coolant water to flow freely in outward radial directions across the full periphery of the platen without being blocked by air bearing support pads that extend above the upper flat surface of the platen. This requires that the platen air bearing support pads contact the portion of a platen structure that is located below the upper flat planar surface of the platen.

Air bearing pads that are used to support the bottom surface of a horizontal platen should also constrain the platen body in a vertical direction, particularly when a platen is flexibly attached to a plate-center spindle and there is some possibility that the platen body can not be restrained in a vertical direction by this flexible connection. Air pads that only provide positive pressure air films on the bottom side of a platen can be used to restrain the platen body in a downward direction but these air pads can not restrain the platen body in an upward direction. A dual-capability composite vacuum and positive pressure air pad can provide limited restraint in an upward direction but even this restraint is removed once the gap between the air pad and the platen becomes large enough that the vacuum seal is broken and the negative restraining force of the vacuum is lost. These large diameter platens have huge inertias and have huge amounts of stored energy when rotated at high speeds. In the event that a platen breaks loose from the spindle or from the air bearing support pads great damage could occur.

Preventing the contamination of semiconductor or other workpiece devices during an abrasive flat lapping operation is very desirable. Because these abrasive disks are coated with water during a lapping operation the abrasive generated debris by the operation is substantially captured by the coolant water, which minimizes the pollution of the ambient atmosphere surrounding the lapping machine by the debris generated during the abrading process. However, carbon particles that tend to be generated with the use of porous carbon air bearings where the carbon sheds particles can also contaminate the environment of a lapping machine.

Corrosion resistant materials of construction are required for the lapping machine and the platen apparatus because of the presence of coolant water that is used in a high speed lapping process. Also, residual material stresses in the platen support apparatus are to be avoided as they can become relaxed over time with the result that the precision flat planar surface of the platen becomes substantially distorted.

Platen support air pads located on the bottom side of the horizontal platen are supplied with high pressure air that is reduced substantially in pressure as this air passes through the bearing structure. As the air is reduced in pressure it expands and is reduced substantially in temperature. This cold air bearing exhaust air travels at high velocities and has very high convection coefficients with the result that the air bearing pad assembly components can be reduced in temperature. Platen air bearing pad support devices mounted to a lapping machine base around the periphery of the platen can use flat surfaced continuous annular rails that are attached to the bottom side of the platen body. These platen-support annular rails provide flat contact surfaces for the air bearing pads. The cooled air bearing exhaust air also cools the annular rail surfaces. Cooling of the annular rail or portions of the annular rail results in thermal contraction of the rail material where the annular rail tends to shrink radially.

Typically, the air bearing annular rail is positioned a substantial distance from the planar platen body to provide sufficient clearance from the platen bottom surface for the upper air bearing pad assembly. However, the rail is also structurally attached to the platen body structure. Shrinkage of the annular rail or portions of the annular rail can result in large thermal stresses being induced in the rail assembly structure. These thermal stresses tend to radially distort the rail which is attached to the platen body. Because the shrinkage-distorted annular air bearing platen support rail is structurally attached to the platen body some distance below the lower planar surface of the platen body, the shrunken annular rail applies a torque to the platen body. This torque tends to diaphragm-distort the flat upper planar surface of the platen. This upper planar surface of the platen is the surface to which the precision thickness raised island abrasive sheet is attached. These out-of-plane platen surface distortions are very highly undesirable because of the very precision planar flatness that is required for high speed flat lapping with the high speed raised island abrasive disks. Any localized distortion of these very large platen flat surfaces that exceed 0.0001 inch (2.5 micrometers) even for a platen that is 72 inches (183 cm) in diameter or more can prevent the effective use of the large platen system for high speed lapping particularly when using interchangeable precision thickness raised island abrasive disks.

In addition, another thermal problem occurs when an annular platen support rail moves at high surface speeds of approximately 10,000 SFPM. Here, when air bearing air-gap films having a thickness ranging from 0.0001 to 0.0005 inches (2.5 to 12.5 micrometers) is present between the platen rail and the air bearing there can be substantial heating of the air film due to shearing action on the very thin air film. Heat generated by the shear-heated air film can increase the temperature of the flat annular rail when the platen is operated at high rotational speeds. The platen support rails tend to be reduced in temperature when the platen is stationary or operating at low rotational speeds. However, the platen support rails tend to be increased in temperature when the platen is operated at high rotational speeds. Platens used for high speed lapping are operated at many different speeds during a lapping process to successfully complete a flat lapping process that produces workpieces that are precisely flat and also have very smoothly polished surfaces. These platen speed changes result in corresponding periodic increased and decreased air bearing annular rail temperature changes throughout a high speed flat lapping process.

When the localized temperature of the portion of the annular rail that is in contact with the platen supporting air bearings lowered, that portion of the rail tends to contract due to thermal shrinkage of the rail material. Likewise, when the localized temperature of the annular air bearing rail is increased, that portion of the rail tends to expand due to thermal expansion of the rail material. Heating or cooling localized portions of an annular rail relative to the non-cooled or non-heated remainder portion of the rail or of the rail support structure results in thermal stresses within the rail body. These thermal stresses can result in very large forces that tend to structurally distort the body of the rail body. Because the distorted annular air bearing platen support rail is structurally attached to the platen body some distance below the lower planar surface of the platen body, the shrunken or expanded annular rail applies a torque to the platen body. This rail-torque tends to distort the platen surface from the precision planar surface required for high speed flat lapping as the air bearing portion of the rail expands or contracts. These torque forces can result in the out-of-plane structural distortion of the precisely flat platen surface as the flat platen outer periphery area tends to "roll-up" when the rail is expanded when heated or the platen flat surface tends to "roll-down" when the rail is cooled and shrinks.

The component parts of a lapping machine platen apparatus must be free of internal material stress to assure that the relaxation of these stress over a period of time do not distort localized component members or the apparatus device with the result that the platen precision flat surface is also distorted. These material internal stresses can be due to a number of causes. One cause is localized thermal shrinkage due to welding of component parts together. Another cause is the roll forming of component part shapes such as flat plate or angle shapes. Other causes include joining of dissimilar materials together, casting or molding components with uneven cooling.

The amount of distortion of the platen out-of-plane top flat surface that is allowable for abrasive raised island disks in a high speed flat lapping process is typically less than 0.0001 inch (2.5 micrometer). It is very difficult to prevent air bearing pad thermal stresses from creating platen planar distortions from exceeding these very minute 0.0001 inch (2.5 micrometer) amounts, especially for large platens that have platen diameters of 72 inches (183 cm). Platen flat surfaces that exceed these distortions simply are not useful for use with the abrasive raised island disks described here in a high speed flat lapping process. Providing these large diameter platens with the required precision in planar flatness over the necessary wide range of platen rotational speeds is very difficult and extremely expensive with conventional roller bearing spindles or even air bearing spindles. It is very desirable to provide very large diameter platens that are affordable enough to allow widespread use of the precision thickness abrasive coated raised island disks. These abrasive disks can provide flat lapped workpiece parts that are produced at production speeds many times faster than can be done with conventional slurry lapping processes.

Solution: Providing a precision flat annular top surface on a composite-thickness platen that has vacuum abrasive disk attachment port holes is critical for use in high speed flat lapping. Composite platens are used to provide vacuum air passageways within the thickness of the platen while providing a continuous flat platen surface that has patterns of discrete vacuum port holes. The abrasive disks are typically top coated with very thin layers of expensive diamond particles and different abrasive disks having different sized abrasive particles are interchanged often over the abrading life of the disks. In addition, the platens must provide a flat annular surface that remains precisely flat over a wide range of platen rotational speeds. Large platen diameters are required to accommodate the large disks that have large radial width annular bands of raised island abrasives. It is preferred that the inner radial width of the annular abrasive band is only modestly reduced from the outer radial width to provide localized abrading surface speeds that have a minimum of variation across the radial width of the annular abrasive band.

Composite vacuum hold-down abrasive disk platens can be supported on flat surfaced roller bearing or air bearing spindles. Roller bearing spindles that are used for small 12 inch (30 cm) abrasive disks tend to be speed limited for reaching the desired 10,000 SFM abrading surface speeds required for high speed flat lapping. Conventional air bearing spindles can be operated at high rotational speeds but they are limited in diameter so the desired large platens must overhang the spindle flat support surface substantially. Any variation of the flatness of the air bearing spindle bearing flat surface is magnified by the platen over-hang distance, which can result in large undesirable out-of-plane flatness variations at the outer annular area of the platen. Most of the abrasive material of annular abrasive disks exists at the outer periphery of the disks which is typically located at the platen over-hang area. Out-of-flatness of the overhang area thereby affects the abrading performance of most of the disk abrasive.

Air bearing spindles are susceptible to damage from dynamic abrading forces that occur at the outer periphery of the platens. Use of platen support air bearings at the outer periphery of the platen minimizes the possibility of damage to the air bearing spindles and minimizes the influence of spindle out-of-flatness variations on the outer periphery of the platen.

Air bearing platen support systems must be rigid and stable over long periods of times and provide precisely flat platen surfaces over a wide range of platen rotational speeds. These systems can be provided by a number of construction approaches. In one embodiment, a precision flat structural machine block surface can be provided and a stress free platen apparatus can be progressively built-up upon the precision flat base surface. Here, the top flat surface of a stable and stiff granite block can be ground and lapped to have a precise flat surface. A stress-free composite assembly of platen support apparatus structural components can be progressively built-up upon the flat surface of the granite block to provide air bearing support rails that are precisely flat and stress free. A stress free platen body can be attached to this air bearing rail support structure. Positive pressure air bearing support pads are preferred instead of combination vacuum and pressurized air pads to prevent the occurrence of abrading debris being drawn into the air bearing pad air film gaps where it could cause wear of the precision flat surface of the air bearing pads.

In another embodiment, a stress-free precision platen structure can be assembled and place on a large diameter precision lathe and all of the critical air bearing and annular abrasive disk surfaces machined or abraded to provide surfaces that will remain precisely flat over a wide range of platen speeds. In another embodiment, a stress free platen assembly is fabricated and mounted on a flat granite block where a machine tool or an abrading tool traverses the platen assembly while the machine tool contacts the flat granite surface around the circumference of the granite block to generate the flat working surfaces on the platen assembly.

An assembly or subassembly or machine frameworks of component metal materials having residual material stresses as a result of welding or heat treatments can be stress relieved by annealing heat treatments and by the application of vibrations to the frameworks.

A very large diameter abrasive platen lapping machine can be constructed by attaching a flat platen plate to an annular air bearing rail structure that is positioned below the flat surface of the horizontal platen. The annular air pad flat rail has continuous flat top and bottom surfaces that extend around the circumference of the platen to provide flat contact surfaces for flat surfaced platen support air pads. The rail structure is structurally attached to the platen body. Flat air bearing surfaces of the annular rails are cantilevered outward from he body of the rail structure to allow both the top and bottom platen support air pads to be located below the top flat surface of the platen. The rail structure is has a large structural moment of inertia to provide structural stiffness to resist out-of-plane deflections caused by localized vertical forces that are imposed perpendicular to the platen flat surface or to the annular flat rail surfaces. The stationary air bearing pads typically are located at stations that are positioned around the circumference of the platen.

Air pads are employed in pairs at each station where one pad contacts the top rail flat surface and the other opposing pad contacts the bottom rail flat surface at a position that directly aligns the flat surfaces of both pads congruent with each other. Pressurized air from the top support pad pushes downward on the annular rail and pressurized air from the bottom pad pushes upward on the rail where the resultant top and bottom pad pressure forces are opposite and coincident. The rail is held at a fixed vertical position in the center between the two opposing support air pads by air films that exist between the pad and the rail flat surfaces. The air film thicknesses that range from 0.0001 to 0.0005 inches (2.5 to 12 micrometers) or more provides very stiff vertical support to the annular rail as the rail and platen structure is rotated. The support pad air films provide a friction-free bearing support of the abrasive platen which can allow rotation of the platen at very high speeds.

A preferred configuration of an air pad platen support system is to construct an independent air pad rail structure assembly having a cantilevered annular rail that extends radially outward from the rail structure assembly. The rail has an annular portion having a typical annular radial width of 2 to 3 inches (5 to 7.6 cm) that contacts rectangular or curved air pads. The flat surfaced air pads have generally rectangular shapes with radial widths of 2 to 3 inches (5 to 7.6 cm) and lengths of from 4 to 12 inches (10 to 30 cm). The pads are located in opposing pairs at various tangential positions around the circumference of the horizontal annular flat surfaced cantilevered portion of the rail. One air pad is width-aligned with the cantilevered radial width of the rail and the other matching pad is located at the same coincident position on the rail. The first pad is flat-positioned with and extends along the upper flat surface of the cantilevered portion of the rail and the second pad is flat-positioned with and extends along the bottom flat surface of the cantilevered portion of the rail. The active flat air bearing surfaces of the pads are generally aligned with the annular cantilevered flat surfaces of the rail where air pressure from the first pad pushes downward on the rail and air pressure from the second pad pushes upward on the rail. The bottom pad supports the weight of the rail structure assembly and the weight of the platen body that is attached to the rail assembly. The bottom pads are rigidly attached to a precision-flat lapping machine base. The upper air pads are also attached to the machine base. The upper air pads can be smaller or larger in air active surface areas than the bottom pads but it is preferred that the area-centers of both the upper and bottom pads are coincident.

Use of precision-flat machine bases allow precision thickness bottom air bearing pads to be replaced where the desired thickness air film gap space between the air pad surface and the platen support rail is uniform across the whole flat surface of the air bearing pad. Pads can be replaced without affecting the functional operation of the lapper system. The upper air bearing pads can be rigidly attached to the machine base or the upper pads can be mounted on floating apparatus devices that allow the pads to seek a conformal flat fits with the flat rail surface. The upper pads can be forced against the rail surface with the use of springs or with use of air cylinders that can be force-deactivated.

Construction of an air bearing pad rail assembly where the cantilevered rail is positioned some distance below the flat bottom surface of the platen body offers the advantage of developing a rail assembly that is lightweight but very stiff structurally. Flat surfaced platen assemblies are then structurally attached to the rail assembly. The stiffness of the composite rail and platen assemblies prevents substantial deflection or distortion of the upper platen surface when any catastrophic dynamic abrading forces are imposed vertically on the flat upper surface of the platen. This prevents permanent distortions of the platen surface. Also, the composite assembly stiffness allows these dynamic abrading forces to be distributed from a single bottom supporting air bearing pad to other adjacent support air pads. Dynamic force distribution prevents permanent damage to individual air bearing pads or the support rail by preventing the rail from contacting the surfaces of the air bearing pads.

A preferred material of construction of both the rail assembly and the platen assembly is stress-free aluminum comprising MIC 6® cast aluminum tooling plate or other stress free aluminum alloy plate. Use of stress free materials reduces the possibility of dimensional changes in the assemblies over a period of time due to relaxation of the internal stress in the material. Aluminum resists corrosion that can be induced by the high humidity environment that can be present due to the use of water coolant for high speed lapping. The preferred method of attaching assembly components to each other is to provide stress free support for the base members and then adhesively bond individual members to each other while all members are supported in a stress free condition. Adhesives comprising structural epoxy systems where a new member is bonded to another member and allowed to solidify prior to adding another member to the assembly. The solidified addition of each member increases the structural moment of inertia stiffness of the composite assembly and reduces the possibility of deformation of the assembly when another new member is added to the assembly. After the last member is bonded to the assembly, the whole assembly is inherently stress free even though the assembly or the sub-assembly comprising the rail assembly is very stiff structurally to enable the assembly to resist dynamic or static forces with little deflection.

Construction of very large diameter platen rail assemblies can be made with composite arc sections of flat plate aluminum that are adhesively bonded together in lapped layers where a solid arc length member is center-layered across the joint of other butt-joined arc members. Dovetail joints can be fabricated at the end of each arc member and the dovetail section members are adhesively bonded together to form stress free large diameter annular ring members. It is preferred that the air pad rail assembly provide the backbone structural stiffness to the platen assembly so that the planar flatness of the upper surface of the platen is controlled by the structural stiffness of the rail subassembly. It is not necessary to provide assembly component members that have precision flatness in the adhesive joint areas because the adhesive material between the component members simply changes slightly in thickness to compensate for non-flat adhesively bonded surfaces. It is also not critical to use low-shrink adhesives because the adhesive shrinkage across the thickness of the adhesive joint is minimal.

The precision flatness of the platen upper surface is controlled by the selection of the lapping machine components and the process of fabricating these components. A process is described here that uses components that are readily available in the marketplace to reliably create very large diameter high speed abrasive lapping machines that are extraordinary in precision and durability. These machines also are constructed at very modest costs compared to the ultra expensive machines that are constructed using conventional machine building techniques.

Some preferred processes of fabrication of the components of the lapper machines that contribute substantially to providing precision flat platen surfaces are described here. Other similar techniques or variations on the ones described can also be employed. First a three-point supported granite block base having area side dimensions in excess of the diameter of the platen is surface lapped to a planar flatness of form 0.00005 to 0.0001 inches (1.2 to 2.5 micrometers), particularly in the annular area that corresponds to the annular ring of raised island abrasives on the abrasive disk that is to be used on the lapper machine. An annular ring plate that is to be used as the air bearing rail for the rail assembly is prepared to provide a precision flat surface on the ring portion that contacts the bottom air bearing pads. To assure that the annular rail is stress free during the time the rail is lapped flat, the annular rail is supported on an annular sealed flat sandwich bag that is filed with interrupted annular lines of epoxy adhesive that extend around the surface of the bag and that are aligned with the annular width of the annular rail plate. The annular rail plate is positioned concentrically with the flat annular epoxy bag that is mounted on a horizontal flat support surface. Then sufficient air is injected into the sealed bag until the annular rail is supported by uniform air pressure under the full flat surface of the rail and the epoxy contacts both the upper flat surface and the lower flat surface of the sealed bag. Constant air pressure is maintained until the epoxy solidifies after which the air pressure is discontinued and the stress free rail is now supported by the epoxy. Then the upper exposed air bearing support surface portion of the rail is lapped precisely flat using lapping procedure techniques well known in the industry.

The annular rail is then mounted with the precision flat surface contacting another annular epoxy filled bag that is mounted on a flat support surface where the epoxy lines compensates for any non-flat areas of the support surface but yet provides rigid support to the rail along the full annular area of the rail. Then a smaller diameter annular spacer member is coated with adhesive and attached concentrically to the annular rail plate with the result that the rail plate now has a cantilevered annular area that is to be used for contact with the platen support air bearings. The spacer member can comprise a number of flat plate layers or a number of individual annular arc segments with staggered joints. After this previous step adhesive is solidified, a interface annular plate is adhesively bonded concentric with the annular spacer plate. The structure of the air bearing rail sub-assembly is now flipped over and supported on another horizontal epoxy air bag where the precision lapped flat surface of the rail is exposed at the top surface of the rail assembly. Then an abrasive grinder assembly is mounted on the top surface of the flat lapped exposed surface and this grinder is moved around the annular surface of the rail to grind the air bearing surface of the cantilevered rail that is on the side of the rail that is opposed to the exposed previously lapped rail surface. After this grinding procedure both of the air bearing pad surfaces of the cantilevered rail are parallel to each other around the circumference of the annular rail and the thickness of the cantilevered rail is uniform around the circumference of the rail. The just-ground surface of the rail can now be lapped to provide a smooth surface finish. If desired the whole rail subassembly can be hard-coat anodized to provide a hard wear resistant surface finish and provide corrosion resistance. The rail assembly would be supported stress free in a frame while the assembly is submerged in the chemical anodizing tank to prevent distortion of the rail assembly during anodizing or other handling procedures. After the anodizing the rail air bearing surfaces can be lapped flat and smoothly polished to provide contact surfaces for the air bearings.

In one embodiment, after fabrication of the air bearing rail subassembly, the subassembly can be supported on the epoxy bag and the composite platen can be concentrically aligned with the rail assembly and then adhesively bonded to the rail assembly to provide a complete platen assembly that is completely stress free. The platen assembly is then balanced to provide smooth vibration free rotation. An air bearing spindle can be used for this vertical balancing procedure.

In another embodiment, a first annular air bearing rail subassembly can be radially balanced, and the subassembly can attached to a subassembly center spindle and supported on the air bearing rails with sets of opposing air bearing pads. Another second air bearing rail subassembly can be concentrically attached to the air bearing supported subassembly. The second air bearing cantilevered air bearing rail surfaces of the attached subassembly can then be precisely machined with a diamond or CBN lathe tool or abrasively ground or polished or a combination of lathe turning and abrading while the assembly is rotated. Other surfaces of the attached second assembly can also be lathe turned or abrasively ground or polished while the attached assembly is rotated by the first subassembly. In addition a composite platen assembly workpiece comprised of a platen body and an air bearing rail subassembly can be mounted on the first subassembly and all desired surfaces of the composite assembly can be machined by lathe tools or abraded with a single attached workpiece set-up, as the composite assembly is rotated, to provide air bearing rail surfaces and a top platen flat surface that are all mutually parallel to each other, are precisely flat and have smooth surface finishes.

The platen support rail assembly and the platen upper abrasive disk support planar surfaces can be progressively machined or abraded or lapped into precision flat planar surfaces by performing the flattening step and then by measuring the obtained flatness with gauging instruments. A flatness map can then be established of the whole planar surface. Then this map can be used to perform corrective lapping or polishing of the high spots identified by the map to further improve the flatness of the planar surfaces. This repetitive process of measuring and applying corrective abrading action can be continued until the planar surfaces satisfy the required flatness criteria for high speed flat lapping. One method of making precision flatness measurements is to mount the flattened platen assembly on air bearing pads and then measure the changes in the height of the planar surface as the surface travels past stationary capacitance sensors over a range of platen rotational speeds. Capacitance sensors can also be translated radially to develop a surface height variance map of the whole measured planar surfaces. Also, the precision flat aluminum surfaces can have a hard-coat anodizing coating applied and this anodized surface can then be abraded progressively with surface mapping to obtain the desired planar flatness. Other surface finishes than anodizing can also be applied before or after the final abrading step.

Sets of single-sided or dual opposing positive-pressure air bearing pads to support large diameter high speed abrasive platens with annular air bearing rails that are located on the bottom side of the horizontal platen can be used to support large diameter platens having flat planar surfaces. The use of opposing air bearing pads to support high speed large diameter flat lapper platens and the associated air bearing thermal stresses in the air bearing support structures due to cooling and heating the air bearing film air can result in the distortion of precision flatness platen surfaces if a continuous overall annular air bearing pad support plate is used. Very small distortions of the annular air bearing rail or rail plate due to thermal stresses can produce substantially large distortions of the planar flatness of the attached platen. Any distortion of the planar flatness of the platen, at the platen location where the attached annular bands of precision thickness raised island abrasive is located, that exceeds 0.0001 inches (2.5 micrometers) tends to prevent the successful repetitive used of these abrasive disks for high speed flat lapping.

The problems associated with thermal shrinkage and expansion of the annular air bearing rails can be substantially reduced by the use of a annular rail that is allowed to flex radially while maintaining a precisely flat continuous annular surface that contacts the platen support air pads. This annular rail radial flexing allows the rail to change its diameter slightly while preventing the associated thermal stress forces from substantially affecting the planar flatness of the upper platen surface that has attached annular abrasive disks. To accomplish this, the annular rail is fabricated from a thick overall annular aluminum plate where the outer portion of the annular rail that contact the air bearing pads is integrally joined with an annular portion that is machined with narrow angled or curved ribs that connect the outer air pad portion with the inner annular plate portion. These ribs are uniform in size and thickness and are evenly spaced around the periphery of the annular rail to assure that the ribs or the attached rail do not distort out-of-plane as the ribs deflect radially with the rail.

The inner annular plate has a radial width that is substantially greater than the narrow annular width of the air pad rail so that the inner annular plate provides an annular body that is very structurally stiff in a radial direction. The thin machine ribs machined from the relatively thick annular plate are quite weak structurally in a radial direction but yet are very stiff in a direction that is perpendicular to the planar surface of the overall annular plate due to the thickness of the annular plate. When the outer annular rail portion of the annular plate is shrunken or expanded due to increased or decreased temperature of the air bearing film air, the diameter of the annular rail tends to increase or decrease. The narrow angled ribs that integrally connect the outer annular rail to the inner annular plate flex radially and allow the outer rail to move closer or further away from the stiff inner annular plate. A small rotation of the outer rail relative to the inner plate occurs when the outer rail moves radially relative to the inner annular plate. This small relative rotation does not affect the performance of the rail in providing a flat annular surface for the platen support air bearing pads. Because the angled ribs are flexible in a radial direction, the changed-diameter outer air pad rail imposes very little force to the radially-stiff inner annular plate.

The diameter change of the outer air bearing contact rail that is caused by thermal expansion or contraction of the rail does not tend to generate thermal stresses within the rail portion of the annular plate. This is because the temperature changes in the rail portion tend to be substantially uniform across the radial width of the rail, around the tangential periphery of the rail and also through the thickness of the rail. Furthermore, the rail is fabricated from aluminum materials that are excellent thermal conductors, which minimizes temperature gradients within the outer air bearing contact rail body. Temperature changes induced in the air bearing annular rail by the contacting air bearing pads tend to be isolated from the inner annular plate by the relatively thin and long ribs that integrally join the narrow outer narrow annular rail to the wide inner annular plate. Here, the outer rail can be cooled or heated with little cooling or heating being induced in the inner annular plate. The thin and long ribs provide long heat transfer paths having high thermal resistances between the chilled or heated outer rail and the inner annular plate. Because of this high radial thermal resistance and the high thermal conductance of the aluminum inner annular plate, the inner annular plate tends not to develop temperature gradients in a radial direction due to temperature changes in the outer rail. The absence of these thermal temperature gradients in the inner annular plate results in minimized thermal stresses and the associated plate member internal forces that would tend to distort the platen planar surface that is structurally attached to the inner annular plate.

The individual ribs can be machined through the thickness of the annular aluminum plate to provide ribs that are thin in width, are long in length and have angled or curvilinear shapes where the outer narrow annular air bearing rail is integrally joined by the ribs to the inner annular plate. The radial flexibility, the planar stiffness and the thermal resistance of the ribs and the overall distortion of the platen planar surface can be explored and optimized with the use of finite element method (FEM) analytical modeling analysis techniques.

These air bearing platen structure system thermal shrinkage and expansions can create substantial platen planar surface distortion problems. Use of annular spring-sections to support the outer annular air bearing contact rails can minimize these distortions. The air bearing pads have the unique capability to provide the required platen planar flatness during high speed flat lapping when using large diameter platens. Use of these air bearing pads to support the periphery portion of a large diameter platen, where the annular band of raised islands are located, offers a high speed lapper system that can be manufactured for a small fraction of the cost of conventional extra-large diameter air bearing spindles, a costly alternative to the air bearing pads.

To provide thermal isolation of the inner annular rail plate from the conductive effects of the cooling generated by the air bearing pads that contact the outer annular air bearing rail, an integral composite assembly that is comprised of: an inner annular plate; a radially flexible and thermally insulating middle annular ring; and an outer annular air bearing rail can be constructed. The middle ring can be constructed with a variety of materials comprising a ring-band of an elastomeric rubber-like material having low thermal conductivity that would be squeeze-distorted in a radial direction only as the outer annular air bearing rail shrinks in diameter as it cools. The middle annular elastomeric rings would provide substantial structural stiffness to the annular outer air bearing rail in a platen-plane direction while providing flexible support to the outer rail in a radial direction. The inner annular plate and the attached structural members would provide sufficient radial structural stiffness to resist the radial direction compressive forces that are imposed on it by the shrunken outer air bearing annular rail that the surface flatness of the structurally attached platen is not distorted by the cooling effects of the air bearing pads. The outer air bearing rail would typically be constructed from aluminum that is an excellent thermal conductor, and temperatures would tend to be uniform within the whole outer rail body with the result that the shrinkage distortion of the outer rail would be only in a radial direction. Upon shrinkage of the outer rail, the middle elastomeric ring would simply be radially squeezed into a more narrow annular ring but the critical co-planar location of the outer air bearing rail relative to the inner annular plate and relative to the platen top planar surface would remain substantially unchanged.

In addition, the annular middle ring having angled radially-flexible ribs can be constructed with a variety of materials comprising polymers or fiber reinforced polymers having low thermal conductivity. These middle rings would provide thermal isolation of a cooled outer air bearing rail from the inner annular plate to prevent the inner annular plate from changing its nominal temperature while the air bearing rail is cooled down. If the inner annular plate is reduced substantially in temperature, the inner annular plate would shrink radially with the result that the structurally coupled platen planar surface can be distorted. The relatively long and narrow but thick-sectioned angled ribs would remain undistorted in a platen planar direction as they flexed in a radial direction. These middle annular rings can be adhesively bonded mutually to the inner annular plates and to the annular outer air bearing rails to form an annular plate integral composite assembly that is comprised of: an inner annular plate; a radially flexible and thermally insulating middle annular ring; and an outer annular air bearing rail.

This platen assembly construction allows shrinkage of the outer air bearing rail due to cooling effects of the air bearings without distorting the planar flatness of the platen surface that supports a precision thickness abrasive disks. This allows these air bearings to be used to support very large diameter platens at the high rotating speeds required for high speed flat lapping.

Precision flatness platen assemblies having the described thermal isolation radial-floatation air bearing rail construction features can also be used for a variety of machines comprising lathes, milling machines, slurring lapping machines and component assembly machines.

The granite base can also be cooled by the expanded and cooled air bearing air but this cooled air has a tendency to uniformly cool the whole annular circumference of the granite base block. When this portion of the granite shrinks uniformly the result is that the whole platen support system uniformly experiences a slight change in elevation with little or no effect on the platen flatness or on the lapping action.

Large diameter platens that are used for high speed lapping that have air bearing pads that support the outer periphery of the platen are described in U.S. Pat. No. 6,769,969 (Duescher) but the platen distortion problems that are associated with the thermal shrinkage of localized portions of the platen support structure by the expanded and cooled air bearing air are not disclosed.

FIG. 136 is a cross section schematic view of the outer radial periphery of a horizontal high speed flat lapper platen and air bearing platen support system. Here the outer periphery of a flat rotary platen is supported on the flat underside of the platen by an air bearing structure using sets of opposed air bearing pads that are positioned at three or more tangential locations around the periphery of the platen. An outer radial periphery portion 1729 of a horizontal high speed flat lapper platen has a precision flat platen 1728 surface that is supported by vertical annular legs 1738 which are attached to an annular air bearing pad span plate section 1732. The extended air bearing pad rail section 1737 and the air bearing pads 1733, 1735 that contact the rail 1737 are shown in this schematic view to allow better visualization of the bending effects of air pads 1733, 1735 cooling and heating the rail 1737 on the flat surface 1728 of the platen. The rail 1737 is an integral and radially extended portion of the air bearing pad span plate section 1732 where the rail 1737 and the span plate 1732 are constructed from solid and full plate thickness aluminum that is a good thermal conductor material. When the rail 1737 is cooled or heated by the air pads 1733, 1735 the rail is increased or decreased in temperature and due to the good thermal conductivity of the plate material, the temperature of the span plate section 1732 is correspondingly increased or decreased. The annular span plate section 1732 then increases or decreases in radial length due to the coefficient of thermal expansion of the span plate section 1732. Due to cooling effects produced by the air bearing pads 1733, 1735, the span plate section 1732 is shown as thermally contracted from an original annular width 1736 to a new reduced annular width 1734. The vertical legs 1738 that are attached to both the span plate section 1732 and the platen 1727 are forced to a new angled position as shown by the angled legs 1740 when the span plate section 1732 contracts in radial length. The platen 1727 that had an original flat platen surface 1728 is shown distorted by the contracted span plate section 1732 into a new downward curved platen 1726 surface. The dimension 1730 shows the downward change in the flatness of the platen 1727 at the outer periphery edge of the platen 1727 due to contraction of the span plate section 1732. The out-of-plane distortion 1730 of the platen 1727 by the shrunken span plate section 1732 can be much larger than the dimensional length change of the span plate section 1732 due to leverage factors that are integral to the design configuration of the outer platen portion 1729 support structure. The legs 1740 act as levers because they have sufficient length to provide clearance from the bottom surface of the platen 1729 for the air pad 1733 and the air pad 1733 support bracket apparatus (not shown). Any change in the out-of-plane distortion 1730 of the platen 1727 where the flatness distortion 1730 exceeds 0.0001 inch (2.5 micrometers) prevents precision thickness raised island abrasive disks from being used effectively for high speed flat lapping.

FIG. 137 is a cross section schematic view of the outer radial periphery of a horizontal high speed flat lapper platen and air bearing platen support system. An outer radial periphery portion 1760 of a horizontal high speed flat lapper platen has a precision flat platen 1742 surface that is supported by vertical annular legs 1756 which are attached to an annular air bearing pad span plate section 1748. The extended air bearing pad rail section 1764 and the air bearing pads 1762, 1766 that contact the rail 1764 are shown in this schematic view to allow better visualization of the bending effects of air pads 1762, 1766 cooling and heating the rail 1764 on the flat surface 1742 of the platen. The rail 1764 is an integral and radially extended portion of the air bearing pad span plate section 1748 where the rail 1764 and the span plate section 1748 are constructed from solid and full plate thickness aluminum that is a good thermal conductor material. When the rail 1764 is cooled or heated by the air pads 1762, 1766 the rail 1764 is increased or decreased in temperature and due to the good thermal conductivity of the plate material, the temperature of the span plate section 1748 is correspondingly increased or decreased. The annular span plate section 1748 then increases or decreases in radial length due to the coefficient of thermal expansion of the span plate section 1748. Due to heating effects produced by the air bearing pads 1762, 1766, the span plate section 1748 is shown as thermally expanded from an original annular width 1750 to a new increased annular width 1752. The vertical legs 1756 that are attached to both the span plate section 1748 and the platen 1758 are forced to a new angled position as shown by the angled legs 1754 when the span plate section 1748 expands in radial length. The platen 1758 that had an original flat platen surface 1742 is shown distorted by the expanded span plate section 1748 into a new upward curved platen 1744 surface. The dimension 1746 shows the upward change in the flatness of the platen 1758 at the outer periphery edge of the platen 1758 due to expansion of the span plate section 1748. The out-of-plane distortion 1746 of the platen 1758 by the elongated span plate section 1748 can be much larger than the dimensional length change of the span plate section 1748 due to leverage factors that are integral to the design configuration of the outer platen portion 1760 support structure. The legs 1756 act as levers because they have sufficient length to provide clearance from the bottom surface of the platen 1758 for the air pad 1762 and the air pad 17621 support bracket apparatus (not shown). Any change in the out-of-plane distortion 1746 of the platen 1758 where the flatness distortion 1746 exceeds 0.0001 inch (2.5 micrometers) prevents precision thickness raised island abrasive disks from being used effectively for high speed flat lapping.

When air bearing rails and pads are used to support a platen, the rails can be cycled through multiple heating and cooling events during a typical lapping procedure. Here the planar platen surface can become unacceptably distorted in both upward and downward directions during different platen speed events that occur independently in the lapping procedure. Cooling and shrinkage of the air bearing rails that results in downward drooping of the rotary platen planar surface tends to occur at low platen speeds when the platen is not moving fast enough to result in substantial shearing of the air pad air film. Heating and expansion of the air bearing rails that results in upward distortion of the rotary platen planar surface tends to occur at high platen speeds when the air pad air film experiences substantial shearing action. Platens are operated at many different speeds during a high speed flat lapping operation so the flat platen surface will tend to move both in upward and downward directions multiple times during the operational lapping procedure. This distortion of the platen planar surface can prevent the effective use of the precision thickness raised island abrasive disks for high speed flat lapping.

The occurrence of cooling and heating of moving rotary members of high speed machine tools by air bearing pads is well known to those skilled in the art of machine tool design. For example, a manual high speed abrasive grinder that is driven by compressed air becomes very cold to an operator's hand when the compressed air expands and is reduced in temperature as the air pressure is reduced within the body of the grinder.

Often, the size of the air gap between an air pad and a machine member will be initially selected by designers to provide the desired air bearing stiffness support for the given machine apparatus application. However, when operating the apparatus, difficulties are often encountered at high air bearing surface speeds. Here, the high operational surface speeds produce heating in the air bearing film because of the high speed shearing of the air film. This heating increases the size of the machine shaft members due to thermal expansion of the member materials. When the shafts grow in size they contact the surface of the air bearing which can destroy the air bearing. To compensate for this shaft size increase, the machine member is often machined to a smaller size to provide an increased thickness air film at low speeds where less shearing-action-heating takes place. However, the increased air gap film thickness due to the undersized shaft often results in substantially decreased stiffness of the air bearing support device, which is highly undesirable. Typically, the air bearing designer attempts to balance the known cooling effects with the expected air film shear heating. However, this technique can cause a significant problem for devices that have the high surface speeds that are present in a high-speed lapper machine where the platen must have substantial air bearing support stiffness at both low and high speeds. The high surface speeds that are present at the air bearing support pads are substantially the same as those required for the high speed abrasive material because the air bearing pads and the annular abrasive are both located at the same approximate radial position on the platen.

FIG. 138 is a cross section view of the outer radial periphery of a horizontal high speed flat lapper platen and air bearing platen support system. A precision flatness granite lapper machine base 1534 supports lower air bearing pads 1572 and air pad brackets 1566 that support upper air bearing pads 1568 where both the pads 1568 and 1572 are attached to the granite machine base 1534 that has a precision flat surface 1535. The horizontal platen 1564 is rotated about a vertical axis and is restrained in a radial direction by a platen drive spindle (not shown) that is attached to the platen disk 1564 planar center. An air bearing annular rail 1570 having a rail 1570 upper flat annular surface 1569 and a lower flat annular surface 1571 where both surfaces 1569 and 1571 are precisely parallel to each other. Both of the annular rail surfaces 1569 and 1571 are shown in contact with the flat surfaces of the air bearing pads 1568 and 1572 respectively. The air bearing pads 1568 and 1572 oppose each other where the annular rail 1570 is sandwiched between them. When pressurized air is supplied to the air pads 1568 and 1572 there is a thin film of pressurized air (not shown) between the flat surfaces of the air pads 1568 and 1572 and the flat surfaces 1569 and 1571 of the annular rail 1570. The upper and lower air pads 1568 and 1572 respectively are used in pair-sets at three or more tangential locations around the circumference of the cylindrical platen disk 1564. The air bearing rail 1570 has a radial width that is approximately equal to the radial width of the air bearing pads 1568 and 1572 and the annular rail 1570 section is integrally attached to an annular rib section 1536 that is integrally attached to an inner annular plate section 1538. The outer rail section 1570, the rib 1536 section and the inner annular support plate section 1538 are all constructed from a single overall annular section 1540 of plate material where individual narrow ribs (not shown) are machined into the overall plate 1540 whereby the outer annular rail section 1570 is separated from the inner plate section 1538 by the rib section 1536. The preferred plate 1540 material is aluminum and the most preferred material is MIC 6® aluminum. The radial width of the annular inner support plate 1538 is substantially wider than the radial width of the outer rail support plate 1570 with the result that the inner support plate 1538 has a radial structural stiffness that is substantially greater than the radial structural stiffness of the outer annular air bearing contact rail 1570. The radial structural stiffness of the annular rib section 1536 is substantially less than the radial structural stiffness of either that of the annular outer rail 1570 or the annular inner support plate 1538. The reduction or increase of the effective diameter of the outer annular rail 1570 due to thermal expansion or thermal contraction of the rail 1570 material is absorbed by the rib section 1536 which has numerous equal sized angled ribs that are equally spaced around the circumference of the outer rail 1570. The angled or curved ribs (not shown) are flexible in a radial direction but provide substantial structural stiffness in a vertical direction due in part to the shown substantial plate material thickness of the overall annular plate 1540. The thickness of the overall plate 1540 material and the radial width of the rib section 1536 and the angle of the ribs and the thickness of the individual ribs and the number of the ribs can be optimized to provide a radial-flexible joint between the outer rail 1570 and the inner annular plate 1538. The overall plate 1540 material is selected from materials that have no residual stresses to provide a plate 1540 that does not change dimensional shape over time by the relaxation of plate material internal residual stresses. The annular support plate 1538 is adhesively bonded (not shown) to stress-free vertical wall annular rings 1542 and 1544 that are also adhesively bonded to an interface plate 1546 to form a stress-free annular air bearing support frame 1548 comprising the overall plate 1540, the rail 1570, the rib section 1536, the inner support plate 1538, the wall rings 1542 and 1544 and the interface plate 1546.

The annular rail 1570 is machined, hand scrapped or lapped to provide that both the air bearing pad contact upper surface 1569 and lower rail flat surface 1571 are precisely flat and parallel to each other either prior to the adhesive bonding assembly of the support frame 1548 or after the support frame 1548 is assembled. The composite platen disk 1564 has vacuum passageways 1550 that connect vacuum port-holes 1562 in the platen surface plate 1552 to allow attachment of abrasive disks 1554 having an annular pattern of attached abrasive 1556 coated raised islands 1558 to the platen surface plate 1552. The abrasive 1556 coated raised islands 1558 are shown in flat surface contact with a workpiece 1560. The platen disk 1564 can be adhesively bonded to the interface plate 1546 prior to or after the air bearing rail 1570 flat annular surfaces are machined or lapped flat and smooth. The flat planar abrasive disk 1554 mounting surface of the platen surface plate 1552 can be machined or lapped precisely flat after the rail 1570 surfaces are machined or lapped precisely flat where the platen 1552 planar surface is precisely parallel to the annular rail 1570 planar surfaces 1569 and 1571, and most preferred to the lower annular surface 1571 because this rail surface 1571 is positioned by the lower air bearing pads 1572 that are mounted on the precision flat granite base 1534. It is preferred that the upper air pads 1568 simply hold the annular rail 1570 down against the lower air pad 1571 because the precision-thickness lower pad 1572 flat top air bearing surfaces are precisely located in a plane by mounting them on the precision-flat granite base 1534 which has a precision planar surface. The upper air pads 1568 can be held by rigid brackets 1566 as shown. Or in another embodiment, the upper air pads 1568 can be held with use of spherical balls (not shown) attached to the brackets 1566 where the balls are positioned in spherical and cylindrical-groove indentations (not shown) in the air pads 1568 that allow the air pads 1568 to assume flat contact with the rail 1569 surface where the air pads 1568 flat contact surfaces "float" in a position that is parallel to the air pad 1568 rail 1569 flat contact surface. In another embodiment, the upper air pads 1568 are held against the annular rail 1570 with the use of air cylinders (not shown) or springs (not shown) to develop a specified force of the annular rail 1570 against the lower air pads 1572 to control the thickness of the air films (not shown) between the pads 1572 and the rail surface 1571.

FIG. 139 is a top view of a section of the outer radial periphery of a horizontal high speed flat lapper platen and air bearing platen support rail having flexible ribs. The overall annular plate 1598 has a relatively radially stiff inner annular plate section 1590, a radially flexible annular rib section 1592 and a moderately radially stiff outer annular rail section 1594. The outer air pad rail 1594, the rib section 1592 and the inner annular plate section 1590 are mutually integral as the individual ribs 1596 are machined from the overall annular plate 1598. In the event that the outer rail section 1594 changes its annular radius due to thermal expansion or contraction, the outer rail 1594 tends to rotate tangentially relative to the inner annular plate 1590 as the angled or curved ribs 1596 flex radially with the result that the radius of the inner annular plate 1590 does not tend to change substantially as a function of these annular rail 1594 thermal shrinkage or expansion effects.

FIG. 140 is a top view of a section of a horizontal high speed flat lapper platen air bearing platen support rail having flexible ribs. The overall annular plate 1578 having an outer periphery 1586 has a relatively radially stiff inner annular plate section 1580, a radially flexible annular rib section 1585 and a moderately radially stiff outer annular rail section 1582. The outer annular plate 1582 has a relatively narrow radial width 1576 and the relatively stiff inner annular plate section 1580 has a relatively wide radial width 1574. The annular rib section 1585 has individual narrow curvilinear ribs 1584 that are angled as shown from a radial direction between the inner annular plate section 1580 and the outer annular air bearing rail section 1582. In other embodiments, the shown angled individual ribs 1584 can have other geometric shapes comprising drilled holes that provide the desired radial flexibility and substantial planar stiffness.

FIG. 141 is a cross section view of the outer radial periphery of a horizontal high speed flat lapper platen and air bearing platen support system having internal temperature stabilizing heat transfer fluid passageways. A precision flatness surfaced granite lapper machine base 1600 supports lower air bearing pads 1640 and air pad brackets 1634 that support upper air bearing pads 1636 where both the pads 1636 and 1640 are attached to the machine base 1600 that has a precision flat surface 1603. The horizontal platen 1632 is rotated about a vertical axis and is restrained in a radial direction by a platen drive spindle (not shown) that is attached to the platen disk 1632 planar center. An air bearing annular rail 1638 having a rail 1638 upper flat annular surface 1639 and a lower flat annular surface 1641 where both surfaces 1639 and 1641 are precisely parallel to each other. Both of the annular rail surfaces 1639 and 1641 are shown in contact with the flat surfaces of the air bearing pads 1636 and 1640 respectively. The air bearing pads 1636 and 1640 oppose each other where the annular rail 1638 is sandwiched between them. When pressurized air is supplied to the air pads 1636 and 1640 there is a thin film of pressurized air (not shown) between the flat surfaces of the air pads 1636 and 1640 and the flat surfaces 1639 and 1641 of the annular rail 1638. Because the pressurized air fed to the air pads 1636 and 1640 is reduced in pressure as it passes through the air pads 1636 and 1640 bodies and also is further reduced in pressure as it passes through the length of the air film this air is reduced in temperature by the air expansion process and tends to cool the surfaces 1639 and 1641 of the rail 1638. Likewise, when the air film is subjected to high shearing rates due to the high relative speed between the moving surfaces 1639 and 1641 and the air pads 1636 and 1640 the air in the air film tends to be heated by this shearing action with the result that the rail 1638 surfaces 1639 and 1641 are raised in temperature. The inner annular plate 1604 is thermally connected to the outer rail 1638 section by the rib section 1602 with the result that the inner plate 1604 is heated or cooled by the rail 1638 when it is heated or cooled.

The upper and lower air pads 1636 and 1640 respectively are used in pair-sets at three or more tangential locations around the circumference of the cylindrical platen disk 1632. The air bearing rail 1638 has a radial width that is approximately equal to the radial width of the air bearing pads 1636 and 1640 and the annular rail 1638 section is integrally attached to an annular rib section 1602 that is integrally attached to an inner annular plate section 1604. The outer rail section 1638, the rib 1602 section and the inner annular support plate section 1604 are all constructed from a single overall annular section 1606 of plate material where individual narrow ribs (not shown) are machined into the overall plate 1606 whereby the outer annular rail section 1638 is separated from the inner plate section 1604 by the rib section 1602. The preferred plate 1606 material is aluminum and the most preferred material is MIC 6® cast aluminum that is stress free and also is a good thermal conductor material. The radial width of the annular inner support plate 1604 is substantially wider than the radial width of the outer support plate 1638 with the result that the inner support plate 1604 has a radial structural stiffness that is substantially greater than the radial structural stiffness of the outer annular air bearing contact rail 1638. The radial structural stiffness of the annular rib section 1602 is substantially less than the radial structural stiffness of either that of the annular outer rail 1638 or the annular inner support plate 1604. The reduction or increase of the effective diameter of the outer annular rail 1638 due to thermal expansion or thermal contraction of the rail 1638 material is absorbed by the rib section 1602 which has numerous equal sized angled ribs that are equally spaced around the circumference of the outer rail 1638. The angled (not shown) ribs are flexible in a radial direction but provide substantial structural stiffness in a vertical direction due in part to the shown substantial plate material thickness of the overall annular plate 1606. The thickness of the overall plate 1606 material and the radial width of the rib section 1602 and the angle of the ribs and the thickness of the individual ribs and the number of the ribs can be optimized to provide a radial-flexible joint between the outer rail 1638 and the inner annular plate 1604.

The annular support plate 1606 is adhesively bonded (not shown) to a solid annular spacer block 1610 that is also adhesively bonded to an interface plate 1618 to form an annular air bearing support frame 1611 comprising the overall plate 1606, the rail 1638, the rib section 1602, the inner support plate 1604 and the interface plate 1618. An inlet pipe 1608 directs a heat transfer fluid 1615 to a lower serpentine spiral fluid passageway 1612 that is shown connected by the passageway 1613 to an upper serpentine spiral fluid passageway 1614 where the outlet pipe 1616 returns the fluid 1615 to a platen spindle rotary union (not shown) that also supplies the fluid 1615 to the inlet 1608. The use of lower serpentine spiral fluid passageways 1612, that is shown connected by the drilled hole passageway 1613 to upper serpentine spiral fluid passageways 1614 that route the fluid 1615 past the surfaces of the spacer block 1610 minimizes the effects of the platen 1632 induced centrifugal forces on the flow of the heat transfer fluid 1615. The moving heat transfer fluid 1615 moving through the lower fluid passageway 1612 maintains the inner annular plate 1604 at a constant desired temperature even though heat is transferred to or from the inner plate 1606 by conduction though the rib section 1602 when the rail 1638 is heated or cooled. The heat transfer fluid 1615 moving through the upper fluid passageway 1614 maintains the interface annular plate 1618 at a constant desired temperature even though heat is transferred to or from the interface plate 1618 by conduction from the rail 1638 or by conduction from the platen plate 1632. Because the inner plate 1606 is held at a constant temperature, the inner plate 1604 neither contracts or expands with the result that the inner plate 1604 does not distort the air bearing support frame 1611. Distortion of the air bearing support frame 1611 would tend to distort the attached precision flat platen 1632 surface plate 1620.

The composite platen disk 1632 has vacuum passageways 1621 that connect vacuum port-holes 1630 in the platen surface plate 1620 to allow attachment of abrasive disks 1622 having an annular pattern of attached abrasive 1624 coated raised islands 1626 to the platen surface plate 1620. The abrasive 1624 coated raised islands 1626 are shown in flat surface contact with a workpiece 1628. The platen disk 1632 can be adhesively bonded to the interface plate 1618.

FIG. 142 is a top view of a section of a horizontal high speed flat lapper platen air bearing platen support rail having flexible ribs and also having internal temperature stabilizing fluid passageways. The overall annular plate 1644 having an outer periphery 1650 has relatively radially stiff inner annular plate section 1654, a radially flexible annular rib section 1649 having individual curvilinear ribs 1648 and a moderately radially stiff outer annular rail section 1646. The outer annular rail plate 1646 has a relatively narrow radial width 1642 and the relatively stiff inner annular plate section 1654 has a serpentine spiral heat transfer fluid passageway 1652 that is shown where the fluid inlet is at the inner spiral radius and the fluid outlet is at the outer spiral radius. The use of lower serpentine spiral fluid passageways 1652 minimizes the effects of the platen (not shown) and overall annular plate 1644 induced centrifugal forces on the flow of the heat transfer fluid 1653.

FIG. 143 is an orthogonal view of a high speed flat lapper platen annular air bearing platen support rail plate. The annular rail plate 1708 has an outer periphery annular air bearing rail 1702 section that is integrally attached to an annular flexible rib section 1707 that is integrally attached to an inner diameter annular support plate section 1704. The rib section 1707 has individual flexible ribs 1706 that are shown here as having narrow curved shapes that extend through the thickness of the overall annular plate 1708. The individual ribs 1706 are machined from the overall plate 1708 to allow the outer air bearing rail section 1702 to flex radially relative to the inner annular plate 1704. Air bearing pads (not shown) contact both the upper and lower surfaces of the air bearing rail section 1702. The overall annular rail plate 1708 is one component of a high speed flat lapper platen annular air bearing support assembly (not shown).

FIG. 144 is a cross section view of a high speed flat lapper platen annular air bearing platen support rail plate. The annular rail plate 1724 has an outer periphery annular air bearing rail 1710 section that is integrally attached to an annular flexible rib section 1712 that is integrally attached to an inner diameter annular support plate section 1714. The rib section 1712 has individual flexible ribs (not shown) that extend through the thickness of the overall annular plate 1724. The inner annular plate section 1714 has a top surface 1716 and a bottom surface 1722. The air bearing rail section 1710 has a top surface 1718 and a bottom surface 1720. Air bearing pads (not shown) contact both the upper top surface 1718 and the lower or bottom surface 1720 of the air bearing rail section 1710. The overall annular rail plate 1724 is one component of a high speed flat lapper platen annular air bearing support assembly (not shown) and the overall annular rail plate 1724 can be fabricated by different techniques to provide precision flat rail surfaces 1718, 1720 and also provide precision flat platen (not shown) top surfaces. In one embodiment, the top and bottom air bearing annular rails surfaces 1718, 1720 can be machined, ground or lapped to have planar surfaces that are precisely flat and smooth and precisely parallel to each other prior to attaching the overall annular plate 1724 to the air bearing support assembly. In another embodiment, the top and bottom air bearing annular rails surfaces 1718, 1720 can be machined, ground or lapped to have planar surfaces that are precisely flat and smooth and precisely parallel to each other after attaching the overall annular plate 1724 to the air bearing support assembly. In further embodiment, the top and bottom air bearing annular rails surfaces 1718, 1720 can be machined, ground or lapped to have planar surfaces that are precisely flat and smooth but are not precisely parallel to each other before or after attaching the overall annular plate 1724 to the air bearing support assembly. In this latter case the bottom air bear rail surface 1720 is supported by air pads (not shown) that are parallel to a granite block base (not shown) but the upper pads are simply aligned upon assembly to the upper rail surface 1718 that is allowed to have a slight cone-shape with good performance of both the upper and lower air pads.

FIG. 146 is a cross section view of a high speed flat lapper platen and lathe tool apparatus. The lathe tool is used to provide parallel precision flat annular air bearing platen support rail plate and platen surfaces. The cylindrical plate platen 1768 is mounted so the platen top planar surface 1772 is positioned vertically and supported on a driven spindle (not shown) that has a horizontal spindle axis 1771. The platen 1768 has an annular outer air bearing pad rail 1784 that is attached to the platen 1768 bottom surface by an annular spacer 1773. Three sets of air pads 1782 and 1786 are positioned at equally spaced locations around the periphery of the platen 1768 where the bottom air pad 1782 contacts the bottom side of the air pad rail 1784 and the top air pad 1786 contacts the top side of the air pad rail 1784. When the platen 1768 is rotationally driven about the axis 1771, the rail 1784 and the platen 1768 are rigidly held by the air pads 1782 and 1786 to allow a lathe tool 1776 to be moved radially along the platen 1768 where the lathe tool 1776 is supported by a precision aligned and rigid bearings 1778. The lathe tool 1776 has three diamond, or other material, cutting material tool bits 1774 and 1780 that are shown which cut the top and bottom surfaces of the air bearing rail 1784 and also the top surface of the platen 1768 simultaneously as the lathe tool 1776 travels radially along the platen 1768 to provide planar top and bottom surfaces of the air bearing rail 1784 and the planar top annular outer surface of the platen 1768 where all three lathe-cut planar surfaces are mutually parallel to each other. This lathe cutting action can be repeated sequentially as the whole platen 1768 and air pad rail 1784 assembly will progressively develop more accurate planar rail 1784 top air bearing pad 1786 and bottom air bearing pad 1782 contact surfaces with each radial surface machining action of the multiple lathe tool 1776. The tool bits 1774 and 1780 are adjusted after each lathe tool 1776 machining pass to remove a minimum amount of planar surface material on each radial pass. Mounting the platen 1768 planar surface vertically during the machining action prevents sagging of the planar surfaces to be machined in locations that are between opposed sets of the air bearing pads 1782 and 1786 that can occur if the platen 1768 were to be mounted with a horizontal planar surface. In another embodiment, abrasive grinder devices can be use in place of the lathe tool bits 1774 and 1780. The rotational speed of the platen 1768 can be optimized to provide vibration-free rotation of the platen 1768 as the radially traversing lathe tool 1776 removes material. This technique of machining the platen 1768 and rail 1784 assembly provides a platen 1768 top planar surface that is precisely flat and is also precisely parallel to a precisely flat bottom planar air bearing rail 1784 surface that contacts the bottom air bearing pad 1782 which is mounted on the surface of a precision flat surfaced granite block (not shown).

FIG. 147 is a cross section view of a peripheral section of a high speed flat lapper platen and lathe tool apparatus. The lathe tool is used to provide parallel precision flat annular air bearing platen support rail plate and platen surfaces. The overall platen assembly 1793 having a cylindrical plate platen 1801 is mounted so the platen top planar surface 1796 is positioned vertically and supported on a driven spindle (not shown) that has a horizontal spindle axis (not shown). The platen 1801 has an annular outer air bearing pad rail 1789 that is attached to the platen 1801 bottom surface 1794 by an annular spacer 1795. Three sets of air pads (not shown) are positioned at equally spaced locations around the periphery of the platen 1801 where the bottom air pad contacts the bottom side 1790 of the air pad rail 1789 and the top air pad contacts the top side 1797 of the air pad rail 1789. When the platen 1801 is rotationally driven, the annular rail 1789 and the platen 1801 are rigidly held by the air pads to allow a lathe tool 1791 to be moved radially along the platen 1801 where the lathe tool 1791 shaft 1804 is supported by a precision aligned and rigid bearings 1806. The lathe tool 1791 has three diamond, or other material, cutting material tool bits 1788, 1799 and 1798 that are shown which cut the top surface 1797 and bottom surface 1790 of the air bearing rail 1789 and also the top surface 1796 of the platen 1801 simultaneously as the lathe tool 1791 travels radially along the platen 1801 to provide planar top surface 1797 and bottom surface 1790 of the air bearing rail 1789 and the planar top annular outer surface 1796 of the platen 1801 where all three lathe-cut planar surfaces 1790, 1797 and 1796 are mutually parallel to each other.

This lathe cutting action can be repeated sequentially as the whole platen 1801 and air pad rail 1789 assembly will progressively develop more accurate planar rail 1789 top air bearing pad surfaces 1797 and bottom air bearing pad surfaces 1790 and the platen 1801 abrasive disk sheet contact surfaces 1796 with each radial surface machining action of the multiple-bit lathe tool 1791. At each progressive lathe tool 1791 machining pass, the lathe tools 1791 will provide machined surfaces 1797, 1790 and 1796 that tend to be more precisely flat than the prior same "non-machined" surfaces 1797, 1790 and 1796. This progressive flattening occurs because the non-flat air bearing rail 1789 air pad surfaces 1790 and 1797 that are moving at high machining speeds tend to be held in a centered position between the two stationary air pads even with the existence of small localized non-flat variations of the surfaces 1790 and 1797. Also the lathe tool 1791 is located between two stations of opposed air pad sets where the individual localized non-flat portions of the air pad rail 1789 surfaces 1790 and 1797 tend to be averaged out at the location of the lathe tool 1791. The tool bits 1788, 1799 and 1798 are adjusted after each lathe tool 1791 machining pass to remove a minimum amount of planar surface material on each radial pass.

Mounting the platen 1801 planar surface vertically during the machining action prevents sagging of the planar surfaces to be machined in locations that are between opposed sets of the air bearing pads that can occur if the platen 1801 were to be mounted with a horizontal planar surface. In another embodiment, abrasive grinder devices can be use in place of the lathe tool bits 1788, 1799 and 1798. The rotational speed of the platen 1801 can be optimized to provide vibration-free rotation of the platen 1801 as the radially traversing lathe tool 1791 removes material. This technique of machining the platen 1801 and rail 1789 assembly provides a platen 1801 top planar surface 1796 that is precisely flat and is also precisely parallel to a precisely flat bottom air bearing rail surface 1790 that contacts the bottom air bearing pad which is mounted on the surface of a precision flat surfaced granite block (not shown). Because the raised island abrasive disk (not shown) has only an annular band of abrasive material that requires a precision flat platen surface 1796 the cutting tool 1791 tool bit 1798 only has to traverse a limited radial distance from the outer periphery of the platen 1801 to provide the flat platen surface 1796 in the annular area directly below the raised islands that provides solid support to the individual abrasive coated raised island structures. The portion of the platen 1801 that is located toward the cylindrical center of the platen 1801 from the inner annular radius of the annular band of raised islands does not require a precision flat planar surface because the heights of the raised island structures prevent contact of a flat-surfaced workpiece with this non-abrasive region of the abrasive disk article. Likewise, the tool bits 1788 and 1799 only have to traverse a limited radial distance because the radial width of the air pad annular rail 1789 is narrow.

The overall platen assembly 1793 comprised of the circular plate platen 1801, the annular spacers 1795, the air bearing rail inner radial annular section 1792, the air bearing annular contact rail 1789 is an assembly that has very substantial structural stiffness because of the resultant annular H-frame box construction that provides a high structural moment of inertia. Because of this stiffness, the platen assembly 1793 having this H-frame construction results in very minimized vertical out-of-plane distortion due to the weight of the platen assembly 1793 in the outer periphery platen assembly 1793 areas that span the air bearing support pads when the assembly 1793 is mounted horizontally on three air bearing pads that are positioned at equal tangential distances around the periphery of the platen 1801. When the platen assembly 1793 planar surface 1796 is mounted in a vertical direction for lathe machining there is even less horizontal out-of-plane distortion of this stiff platen assembly 1793 section because the weight of the platen assembly 1793 in the outer periphery platen assembly 1793 areas that span the air bearing support pads does not act perpendicular to the platen surface 1796. The lathe cutting tool 1791 cutting tool bits 1788, 1799 and 1798 are typically located in this span area. Other machining devices comprising abrasive grinding devices can be used in place of the lathe cutting tool bits 1788, 1799 and 1798. Provisions are made where each of the lathe cutting tool bits 1788, 1799 and 1798 can be position-adjusted independently from each other at different events of the lathe cutting procedure.

The most critical annular surface of the platen assembly 1793 having a horizontal planar surface 1796 is the annular bottom air bearing rail surface 1790 because this is the surface of the assembly 1793 that is in contact with the air bearing support pads that are attached to the horizontal precision flat surface of the granite base. It is preferred that this rail surface 1790 is machined independently to provide it with an annular surface that is precisely flat and planar and has a smooth and hardened surface. During events where the rail surface 1790 is in moving contact with the stationary surfaces of the air bearing support pads, the smooth rail surface 1790 minimizes the wear of the air bearing pad surfaces. It is preferred that precision thickness air pads are used that are mounted on the precision-flat granite surface to assure that damaged air pads can be replaced as required where the air bearing air film thickness of the new replacement pad is substantially the same as that provided by the original pad. In another embodiment, non-precision thickness air bearing pads can be used with non-precision flat granite bases by temporarily attaching the air pads with vacuum to the precision-flat air bearing rail surface 1790 and using an adhesive to bond the air pads to the granite surface. This pad attachment technique is less expensive but the ability to quickly replace damaged air pads is limited.

The top air pad rail surface 1797 is less critical than the bottom rail surface 1790 because the air pad that contacts the top surface 1797 simply provides a constant downward force on the horizontally positioned platen assembly 1793 in addition to the weight of the assembly 1793. It is desired that the air film thickness between the air pads and the bottom rail surface 1790 remains constant at all rotational speeds of the assembly 1793 to provide a stable support for the precision top planar platen surface 1796. A constant downward force on the rail surface 1790 at the supporting air pads provides a constant thickness air film thickness for each supporting pad.

FIG. 148 is a top view of a peripheral section of a high speed flat lapper platen and lathe tool apparatus. The platen air pad annular support plate 1810 has an integral air bearing contact support pad rail 1812 that is machined by a lathe tool 1818 supported by linear bearings 1816 where the lathe tool 1818 has a lathe tool bit 1814 that is in machining contact with the flat annular surface of the air bearing rail 1812. The lathe tool 1816 moves radially relative to the platen plate 1810 as the platen plate 1810 is rotated where the lathe tool 1818 and the tool bit 1814 is positioned in the span area that is located between the opposed air bearing support pad sets 1808 and 1820. A third opposed air bearing support pad set 1822 provides three-point support of the air bearing rail 1812 where the opposed air bearing support pad sets 1808, 1820 and 1822 are preferably positioned equi-distant around the periphery of the air bearing rail 1810. The lathe tool 1816 is shown as machining one side of the air bearing rail 1812 but other lathe tools (not shown) can also machine-flatten the opposite planar side of the annular rail 1812 and the planar platen (not shown) surface.

Annular block air bearing pads 1811 and 1813 are also shown in addition to the air bearing pads 1808 and 1820. The air bearing pads 1811 and 1813 can be used in place of the pads 1808 and 1820 or they can be used in addition to the pads 1808 and 1820 to support the annular plate 1810. The pad 1809 center is a distance 1817 from the cutting edge of the lathe tool bit 1814 and the pad 1813 is located the same distance away from the tool bit 1814 where the total distance between the pad 1811 center and the pad 1813 center is the distance 1815 which is twice the distance 1817. Because the tool bit 1814 cutting edge is located halfway between the pads 1811 and pad 1813, any out-of-plane variation of the air bearing rail 1812 that is present at either the pad 1811 or the pad 1813 locations is reduced by half at the cutting tool 1814 cutting edge. The existing localized air bearing rail 1812 out-of-plane defects are thereby reduced by the cutting tool bit 1814 as the tool bit 1814 traverses radially as the platen plate 1810 is rotated. When the lathe machining process is progressively repeated, the localized out-of-plane defects of the air bearing rail are also progressively diminished. The air bearing pads 1811 and 1813 can have a range of tangential lengths 1809 where the pad lengths 1809 are selected to provide a minimum of out-of-plane movement of the rail 1812 at the rail 1812 location that is in contact with the cutting tool 1814 at the selected rotational speed of the plate 1810. In one embodiment, the air pads 1811, 1808, 1822, 1820 and 1813 can collectively extend tangentially around almost the full circumference of the platen plate 1810 except for enough tangential distance to provide access of the tool bit 1814 to traverse radially to cut the rail 1812 surface. The annular support plate 1810 is shown here by itself but it is attached to the remainder of the platen assembly (not shown) during the air bearing rail 1812 machining procedure described here. Use of sharp cutting tool bits 1814 or abrasive grinding devices (not shown) tend to produce minimum of out-of-plane cutting forces on the rail 1812 that could distort the rail 1812 during the rail 1812 surface machining action.

Techniques are described here that allow the bottom air pad contact surface of the air bearing rails of platen support assemblies to be lapped precisely flat and smooth to provide a reference precision working surface for the platen support assemblies. This precision flat rail reference surface can then be used to establish precision flat top air bearing pad rail surfaces and top platen surfaces that have precision flat planar surfaces that are precisely parallel to the reference bottom rail surface. It is required that the upper platen surface is precisely parallel to the bottom rail surface to provide a flat platen surface that can be used with precision thickness raised island abrasive disks for high speed lapping. It is also required for high speed lapping that the upper air pad rail surface is precisely parallel to the bottom rail surface to provide uniform top air pad pressure forces that act against the bottom air pad with the result that the rail will remain in a constant vertical position at all platen speeds.

In one embodiment, a precision flat surfaced high speed lapper machine can be used with precision thickness abrasive disks having an annular band of abrasive coated raised islands to provide platen assemblies that have precision-flat planar annular bottom air bearing rail surfaces. This is somewhat analogous to using one high speed lapper machine to quickly and inexpensively build other high speed lapper machines.

Once the reference bottom surface of the air bearing rail has a precision flat and smooth planar surface, the other components of the high speed lapper machine can be progressively fabricated by utilizing this reference surface to establish the other ultra-flat and coplanar surfaces required. Most important is for the top annular surface area of the platen that directly supports the annular band area of precision thickness abrasive coated raised islands to be precisely flat and coplanar with the bottom surface of the air bearing pad rail. Because of the structural stiffness of the platen support assembly, the whole annular platen top surface will provide a precision flat surface at the location of the supporting air pads if the coplanar air pad rail bottom surface at those locations remain precisely within a plane as the platen rotational speed is changed. By first establishing the precision flatness of the annular air pad bottom rail surface, the other components of the lapper machine that are critical for flat top surfaced platen operation can be provided at a relatively inexpensive cost by those skilled in the art of machine design and fabrication. The top air pad rail surface can be ground flat and coplanar to the bottom rail surface with the use of a three-point frame apparatus that is attached to the precision bottom rail surface by vacuum-type air bearing pads that precisely control the air film gap between the pads and the rail as the frame is pivoted around the annular rail. The same type of grinding apparatus can be used to grind the annular band abrasive disk mounting surface area of the platen top surface to be precisely flat and coplanar to the bottom rail surface.

A three-point supported granite block can provide a stable base for the platen support assembly. Air pad sets having two opposed air pads can be located around the circumference of the platen to provide three-point support of the platen. An equidistant three-point pad support is preferred because the platen assembly weight loading on each of the three the pads is assured. Each individual air pad can be temporarily attached to the rail surface by applying vacuum to the air pad. While the air pads are attached the platen assembly with the attached pads can be positioned on the flat horizontal surface of the granite and the lower rail pads can be individually bonded to the granite with an adhesive. After the adhesive is solidified, the vacuum can be interrupted and the flat rail now is in contact with the air pads where each individual air pad is in flat conformal contact with the rail surface. Here the granite block provides a strong heavy and stable base and the platen assembly is supported by a precision flat air pad rail that is supported by air pads that individually have flat surfaces that are all coplanar. The granite block is relatively inexpensive because the cost of providing a precision flat granite planar surface was not required. Instead of providing an expensive granite planar surface, expensive precision thickness air pads and then a platen assembly having a precision flat air pad rail to provide a flat platen top annular surface, the precision flat rail is used as a fixture for use with less expensive components.

Individual rail bottom air pads can be replaced with the same ease while maintaining the same system flatness precision by simply removing the target air pad and replacing it with a new one having a lesser thickness. The new pad is adhesively bonded in place by attaching the air pad surface to the rail with vacuum (instead of the pressurized air) while an adhesive that bonds the pad to the granite solidifies. The air pads can be constructed with multiple support layers where the pads are attached to the granite block with fasteners and the adhesive is applied between the air pad support layers.

Likewise the top rail air pads can be temporarily attached to the top rail with vacuum where adhesive is applied between the base support layers after the top air pad support bracket is attached to the granite base with fasteners. Upon removal of the vacuum and the subsequent application of pressurized air to the top and bottom individual air pads the air pad rail becomes separated from the pad surfaces by pressurized air films that exist between the air pad flat surfaces and the top and bottom rail surfaces. Here the air pad rail does not contact either the top or bottom air bearing pads and rotation of the platen assembly is friction free because of the air bearing pads air films.

It is critical that both the opposing top and bottom air bearing pad flat surfaces are mounted in close proximity and precisely parallel to the flat rail surfaces to assure that the air bearing doesn't have side leakage with a resultant reduction in the air bearing applied force support if the air pad is slightly tipped relative to the rail surface. In one embodiment either or both the top or the bottom air pads can be mounted with the use of spherical ball devices that allow the air pad to conform in flat contact with the rail surface. Other mechanical devices can be used in conjunction with the pad-center spherical ball devices to prevent the elongated rectangular or annular air pads from rotating relative to the relatively narrow annular air pad rails.

The average air pressure in the air film that acts against the rail surface during normal operation is typically 35 to 50% of the air pressure supplied to the air pad. It is preferable that at least 60 lbs per square inch (psi) air pressure is supplied to the air pad. At 35% "efficiency" with 60 PSI supplied air, the air bearing can sustain a working load of 21 psi while maintaining a desired air film thickness of 0.0005 inches (12.25 micrometers). Using an air pad having a preferred radial width of 2 inches (5 cm) and a length of 5 inches (12.7 cm) the individual air pad has an active flat surface area of 10 square inches (63.5 square cm), which can sustain a steady force load of 210 lbs (21 times 10) with an air film thickness of 0.0005 inches (12.25 micrometers). The use of three of these air pads located at equal distances around the circumference of the platen could support a platen assembly weight or an applied force load of 610 lbs.

However, a typical large diameter platen assembly would have a total weight of less than 100 lbs, which is a small fraction of the load capacity of the air pads. Also, the typical applied abrading force for high speed lapping is less than 10 lbs, which again, is insignificant relative to the load capacity of the air pads. Further, the typical weight of a workpiece is less than 10 lbs, which again is insignificant relative to the load capacity of the air pads. If desired, larger surface area support pads can be used or additional support pads can be used to support the platen assembly. In addition, higher air pressure can be supplied to the pads to increase the pad load capacity but at a penalty of the expense of supplying the higher pressure air at larger quantities because of the associated higher air flow rates.

When a large load is applied to an air bearing, the air film is squeezed into a smaller thickness because the air film acts as a spring element having a spring constant. The maximum load that an individual air bearing can support is approximately 90% of the applied air pressure times the air bearing contact surface area before the platen assembly rail is forced into contact with the bottom air bearing flat surface. Here, an air pad having width of 2 inches (5 cm) and a length of 5 inches (12.7 cm) the individual air pad having an area of 10 square inches (63.5 square cm), which can sustain a force load of 540 lbs with 60 psi supply air pressure before the rail contacts the pad. The group of 3 air pads on the platen assembly can withstand a load of 1,620 lbs before the rail contacts all the pads.

The maximum load that an air bearing can sustain before contact with the rail is approximately double the working load. At maximum load conditions, the air film is squeezed into a very thin layer which results in a very high flow resistance to the air in the air film gap and a substantial reduction in the air flow rate. At low air flow rates the flow resistance in the air bearing internal restrictor orifices, or within the porous graphite block, is also highly reduced with the result that little air pressure drop occurs across the internal restrictor orifices. The internal orifice pressure drop is approximately one half of the applied pressure to prevent excessive air flow when there are overly-large air film thickness gaps where the pressure drop along the air path length is highly reduced. Because the air bearing internal orifice pressure drop then approaches zero as the air film thickness approaches zero, all of the applied air pressure is exerted on the air film. This increased air film pressure allows a higher load force to be supported for reduced air film thicknesses as compared to typical working load air film thicknesses. It is not practical to operate air bearing devices having nominal extra-thin air film thicknesses because of the high apparatus costs associated with the required super-precise components that are required for these devices.

In a catastrophic event where an abrasive sheet disk becomes torn while the high mass inertia platen is rotating at high speeds, portions of the abrasive disk can become temporarily jammed between the moving platen and the near-stationary workpiece. The resultant dynamic applied load that occurs can be substantial, in part, because of the energy that is supplied by the inertia of the moving platen, which often moves at a speed of 100 mph. However, this dynamic event typically occurs very quickly where the abrasive disk is almost instantly dragged out of contact with the workpiece by the moving platen. The dynamic force can be characterized as a impact force where the force typically builds up in milliseconds and is diminished as quickly. Because of the high mass inertia of the heavy platen assembly, this impact force does not act on the platen for a sufficient amount of time to accelerate the platen assembly downward far enough to drive the rail into contact with the air bearing pad. In addition, the substantial planar stiffness of the platen assembly tends to distribute this impact force to the other air pads that support the platen assembly with the result that the impact force becomes shared by other support air pads These opposing air pads can provide very stiff support to the platen assembly in a direction perpendicular to the platen top surface if there is a significant air pressure present in the air film and, very importantly, that the air film thickness is very small and uniform in thickness across the full flat rail contact surface of the air pad. The typical air film thickness ranges from 0.0001 to 0.0005 inches (2.5 to 12.5 micrometers). This film thickness is present in both the top and bottom rail air pads that are used in opposing sets where the top pad pushes down on the rail at a location directly above the bottom pad. The resultant force of the pressurized air in the top pad film acts to preload or compress the air film between the bottom pad and the rail. Likewise, he resultant force of the pressurized air in the bottom pad film acts to preload or compress the air film between the top pad and the rail. Using opposed air pads having radial widths of 2 inches (5 cm) and lengths of 5 inches (12.7 cm) operating with an air film gap of 0.0005 inches (12.7 micrometers) and pressurized air supplied at 60 lb per sq. inch gage (psig) typically will have a stiffness of 600,000 lb per inch. Here an applied load change of 10 lbs will result in a platen height change of only 0.0000167 inch (0.42 micrometers) if all of this load change is absorbed by the single set of air bearing pads.

Rails having equal surface area sized directly opposing top and bottom air pads and having equal pressure and uniform and equal thickness air films are supported by both air pads at a position that is centered between the opposed pads. As the annular rail is rotated, the centered-rail position is maintained. However, if the rail has a defective flat surface where a larger air gap occurs between the rail and one of the air pads, there is a resultant loss of air pressure in that air pad gap. Because of the reduced air pressure, the force applied by that pad to the opposing pad is reduced and the rail tends to be driven toward the pad that has a larger air film gap. The nominal gap size can change for both the top and bottom air pads if both annular planar rail surfaces are not precisely flat around their full circumference. If not, the air pad gaps will change as the rail and the platen assembly is rotated. At low rotational speeds the platen assembly will tend to follow the gap changes that occur as the rail is turned. Each circumferential location rail-defect position on the platen surface will result in a characteristic low-spot or high spot of the platen surface. As the platen assembly is rotated at higher speeds these out-of-plane variances of the air bearing rail and correspondingly, height variances of the platen top surface, will diminish. The faster a platen moves, the "smoother" the platen surface will be. That is because the out-of-plane acceleration effects of these rail defect forces occur over a shortened period of time and they have less influence on moving the heavy and stiff platen assembly upward and downward. The workpiece abraded material removal rate increases with the abrading speed so the highest rate of material removal occurs at the highest platen speed at the time when the platen surface is the flattest. Little material removal occurs at the lowest platen speeds when there is the most variation in the platen height. This platen flatness speed effect results in flatter workpieces.

Because the nominal 0.0005 inch (12.7 micrometer) air film thickness is so small and due to the fact that this thickness can further be decreased when catastrophic event dynamic forces are applied to the platen it is preferred that the flatness accuracy of the platen rail air bearing contact surfaces to be 0.0001 inches (2.5 micrometer) or less. Even when the rail surface has a flatness variance of 0.0001 inches (2.5 micrometer), the rail and platen assembly will tend to have a height changes of substantially less than this flatness variation at high platen speeds because the rail will travel at the average gap-center position in the much wider 0.0005 inch (12.7 micrometer) air film gap.

Even though the rail air bearing pads provide excellent platen surface height variation control, they provide no support of the platen in a platen radial direction. Instead a needle bearing, a sleeve bearing, a journal bearing or a cylindrical air bearing that is attached to the granite base at the platen center provides low friction radial support to the platen assembly. These bearings are all relatively inexpensive and allow the platen assembly freedom to move along an axis perpendicular to the top flat planar surface of the platen while restraining the platen assembly in a radial direction. Here the air bearing pads provide the platen assembly movement and restraint in the axial direction.

The only abrading contact forces that are applied to the platen assembly are located at the outer periphery annular area of the platen in a location that is centered directly above the air pad support stations. There is no abrading force applied to the inner radius of the flat platen so the platen assembly does not have to be structurally tiff in that area region. This allows the platen body to be relatively thin in the inner radius region which reduces the weight and cost of the platen assembly.

The platen assembly described here is modest in weight but has very high beam stiffness along the circumference of the platen assembly due to H-Frame construction of the platen assembly. Typically the maximum center-span deflection of the platen assembly at the location of a rail or platen grinder head where the air pad supports are spaced 12 inches (30.4 cm) apart would be a very small fraction of the required 0.0001 inch (2.5 micrometer) platen surface flatness required for high speed flat lapping. Center span grinding forces are typically very low because of the typical use of high speed diamond abrasive wheels that have very low rates of diamond wear which provides uniform cut workpiece surfaces across the full traverse of a diamond cutter. The same platen assembly structural stiffness results in even the very large catastrophic forces that occur in the event of an abrasive disk sheet tear being evenly distributed over the full flat surface of the air bearing bottom rail surface pads. These opposed air bearing pads provide an air gap stiffness that is well know to often exceed those of equivalent mechanical roller bearings with the result that even the very large catastrophic abrading forces will not result in the moving rail contacting the air bearing surfaces. Because the abrading contact forces are so low with high speed lapping procedures, these applied forces seldom will cause a "crash" of the rail against the air pads. The platen rotational inertia of the platen assembly is typically minimized because this inertia resists the acceleration and deceleration of the platen. High rotational inertia requires the use of larger platen drive motors and stronger components to quickly bring a platen up to full operating speed. The design of the platen assembly to define the platen assembly weight, rotational inertia, the circumferential out-of-plane stiffness and the platen deflection due to applied force loads can be optimized with the use of finite element modeling (FEM) analyses.

The smooth surfaces of the rails minimizes damage to the air bearing pads in the event that the rail contacts the air pad surfaces when the rail is moving. Porous carbon air pads are particularly sensitive to wear but they do offer the advantage of low friction contact with the smoothly polished rail during these events. Also, the porous carbon air pad surfaces will tend to "wear-in" to match the surface of the rail and yet maintain a uniform distributed air flow across the full contact surface of the air pads because the flow of the air from the pad is controlled by the internal flow resistance thought the porous passageways within the pad. A worn-in pad can perform as well as a non-worn pad in many circumstances.

Platen assemblies having air bearing rails can be supported by two different configuration air bearing pad systems. In one embodiment, opposing pressurized air pads can act on both sides of the rail to center-position the rail between the two pads. In another embodiment, individual vacuum type air pads are positioned on the bottom side only of the rail. To provide a stabilizing counteracting force on the pressurized air pad, the center portion of the air pad has a vacuum area where the negative force created by the negative vacuum pressure acts against the positive force created by the positive air pressure supplied to the combination vacuum-air pad. The negative vacuum pressure is limited to approximately one third of the air film positive pressure so the pad area of the vacuum chamber required to provide an equal opposing force is three times the positive pressure pad area. When the two areas are combined in an individual pad device, the vacuum type air pad has a surface area that is four times greater than an equivalent pressure-only air pad. It is desired to limit the area size of the air pads so use of the much larger vacuum type air pads is considered to be a disadvantage. Use of vacuum air pads allow simpler construction of the rail as only the bottom surface of the rail has to be precisely flat whereas the rail used with opposing pads must have top and bottom rail surfaces that are precisely flat and parallel.

In addition, the stiffness of an opposing air pad system is double that of an equivalent vacuum pad system. This stiffness doubling action occurs because as the rail is deflected down toward the bottom pad, the upward air film force increases as the bottom pad air film thickness decreases. At the same time, as the rail is deflected down toward the bottom pad the downward air film force decreases as the top pad air film thickness increases. The combination of an increased bottom pad force and a decreased top pad force creates the double-stiffness characteristics of opposed air pads. Because the vacuum force provided by a vacuum air pad does not change as the thickness of the pressurized air film of the air pad is reduced, there is no stiffness doubling effect with this type of pad. The platen surface displacement from a plane due to an applied load change for a vacuum pad is twice that of opposing pads. It is desirable that a high speed flat lapping platen assembly has the maximum stiffness possible to provide a planar abrasive surface under all load conditions.

The stiffness of the air bearings is not simply a function of the compressibility of the thin layer of air film that resides between the air bearing and the rail surfaces. Steel bearing material is very stiff so steel roller bearings can carry very large load forces. Comparatively, the load bearing capability of an air bearing is very limited by the relatively small air pressure that exists across the surface of the air bearing. At times, the material compressibility of individual steel roller bearings having small contact areas and large diameters is compared to the compressibility of extraordinary thin layers of air that has relatively very large contact areas. However, the stiffness of an air bearing is more related to how much the air film is squeezed together under load with an associated air film support pressure increase. This is a fluid flow based stiffness factor that is quite non-linear where the stiffness of the air bearing increases dramatically with a reduction in the air film thickness. For instance, a typical air bearing having a stiffness of 1,560,00 lbs/inch with an air film thickness of 0.0001 inches (2 micrometers) only has a stiffness of 520,000 lbs/inch with an air film thickness of 0.0003 inches (7.6 micrometers). Comparatively, the compression of the steel material in a steel roller bearing provides a constant stiffness factor. However, for small loads an air bearing is often much stiffer than a steel roller bearing. High speed flat lapping typically is performed with small applied abrasive contact loads so the high platen assembly stiffness associated with the air bearing support pads provides excellent resistance to out-of-plane deflection of the platen surface due to these loads.

FIG. 149 is a cross section view of a high speed flat lapper platen assembly and a slurry lapper platen. The lapper platen is used to provide a precision flat annular air bearing platen support rail bottom surface. The overall platen assembly 1864 has a cylindrical plate platen 1866 that is attached to the annular air bearing rail 1874 by annular support members 1870 is mounted so that the bottom air bearing contact surface 1880 is in abrading contact with a precision flat surface of an abrading platen 1878. The abrading platen 1878 is rotated about an axis 1876 to allow the abrasive slurry film 1872 to lap the air bearing pad rail surface 1880 precisely flat and also provide a smoothly polished surface 1880. The platen assembly 1864 can rotate about an axis 1868 or the platen assembly 1864 can be held in a stationary position as the weight of the assembly 1864 provides abrading contact forces or pressures that are uniform around the circumference of the air bearing rail 1874. In another embodiment, additional abrading contact forces can be applied to the platen assembly 1864.

FIG. 150 is a cross section view of a high speed flat lapper platen assembly and a raised island abrasive disk lapper platen. The abrasive disk lapper platen is used to provide a precision flat annular air bearing platen support rail bottom surface. The overall platen assembly 1882 has a cylindrical plate platen 1884 that is attached to the annular air bearing rail 1892 by annular support members 1888 is mounted so that the bottom air bearing contact surface 1898 is in abrading contact with a precision flat surface of a precision thickness abrasive disk 1890 having abrasive coated raised islands 1889. The precision flat abrading platen 1896 is rotated about an axis 1894 to allow the abrasive disk 1890 to lap the air bearing pad rail surface 1898 precisely flat and also provide a smoothly polished surface 1898. The platen assembly 1882 can rotate about an axis 1886 or the platen assembly 1882 can be held in a stationary position as the weight of the assembly 1882 provides abrading contact forces or pressures that are uniform around the circumference of the air bearing rail 1892. In another embodiment, additional abrading contact forces can be applied to the platen assembly 1882.

FIG. 151 is a cross section view of an outer periphery section of a high speed flat lapper platen assembly and a raised island abrasive disk lapper platen. The abrasive disk lapper platen is used to provide a precision flat annular air bearing platen support rail bottom surface. The overall platen assembly 1900 has a cylindrical plate platen 1902 that is attached to the annular air bearing rail 1918 by annular support members 1908 and 1914 is mounted so that the bottom air bearing contact surface 1923 is in abrading contact with a precision flat surface of a precision thickness abrasive disk 1910 having abrasive coated raised islands 1920. The precision flat abrading platen 1922 is rotated to allow the abrasive disk 1910 to lap the air bearing pad rail surface 1923 precisely flat and also provide a smoothly polished surface 1923. The platen assembly 1900 can rotate or the platen assembly 1900 can be held in a stationary position as the weight of the assembly 1900 provides abrading contact forces or pressures that are uniform around the circumference of the air bearing rail surface 1923. In another embodiment, additional abrading contact forces can be applied to the platen assembly 1900. The air bearing rail 1918 is shown with an integral angled rib (not shown) section 1916 and an inner integral annular plate section 1912. The abrading platen 1922 has internal vacuum passageways 1925 and vacuum port holes 1924 that are used to attach the abrasive disk 1910 to the surface of the platen 1922.

FIG. 152 is a cross section view of a high speed flat lapper platen assembly and a platen assembly surface grinder system. The abrasive disk lapper platen has a planar precision flat annular air bearing platen support rail bottom surface that is used to provide precision flat planar annular top rail and annular platen top surfaces that are parallel to and coplanar with the bottom rail surface. The overall platen assembly 1930 has a cylindrical flat plate platen 1926 that is attached to the annular air bearing rail 1956 by annular support members 1960. A grinder frame structure 1932 is mounted to the rail 1956 annular bottom surface 1961 with the use of vacuum air bearing pads 1950 that have pad 1950 central-area vacuum areas 1962 where the vacuum area 1962 draws the pad 1950 toward the rail annular bottom planar surface 1961 that has a previously machined or ground precisely flat planar surface. The frame 1932 extends from the three air bearing pads 1950 (one pad is not shown) that provide a three-point attachment of the frame 1932 to the bottom rail surface 1961 where the pads 1950 vacuum areas 1962 draw the pads 1950 toward the rail surface 1961 with a substantial force. However, this vacuum-draw force is resisted by positive pressure air forces from pad 1950 raised land areas 1927 where positive pressure air films (not shown) exist between the pad 1950 land areas 1927 and the rail bottom surface 1961. The air film has a precise thickness that is controlled by adjusting the vacuum levels and the positive air pressure at each pad 1950. The frame 1932 can be rotated around the platen assembly 1930 where the roller bearings 1946 that are mounted on the frame 1932 are in surface contact with the outer periphery of the annular rail 1950 to provide concentric rotation of the frame 1932 about the platen assembly 1930 axis 1931. A rotatable platen top annular surface 1928 grinder 1938 has a grinding wheel 1936 that grinds the annular platen surface 1928 by radial motion of the grinder 1938 as the frame 1932 is rotated about the platen axis 1931. The grinder 1938 is mounted on a vertical driven slide 1940 that is used to adjust the depth of the platen 1926 material removed by the rotating grinder wheel 1936 while the rotating grinder 1938 is driven horizontally in a platen 1926 radial direction by the driven slide 1948.

Likewise, a rotatable air bearing rail 1956 top annular surface 1935 grinder 1944 has a grinding wheel 1934 that grinds the annular rail top surface 1935 by radial motion of the grinder 1944 as the frame 1932 is rotated about the platen axis 1931. The grinder 1944 is mounted on a vertical driven slide 1942 that is used to adjust the depth of the rail top surface 1935 material removed by the rotating grinder wheel 1934 while the rotating grinder 1944 is driven horizontally in a platen 1926 radial direction by the driven slide 1948.

The platen assembly 1930 is supported by uniform pressure leveling bags 1958 that are supported by an annular frame 1954 that is supported by a mounting plate 1952. The flat surfaced leveling bags 1958 are sealed and contain a structural adhesive (not shown) that is in non-solidified wet contact with both the top and bottom flat surfaces (not shown) of the bag. Air pressure is applied to the sealed bag interior while the sealed bag supports the weight of the platen assembly 1930 to provide stress-free and uniform support of the platen assembly 1930 until the adhesive becomes solidified. After the adhesive becomes solidified, the bag air pressure is removed and the bag internal solidified adhesive provides solid and stress free support of the platen assembly 1930 for the duration of the event of precision-flat parallel-surface grinding of the platen surface 1928 and the top rail surface 1935 that herein become coplanar with the rail bottom surface 1961.

FIG. 153 is a cross section view of a high speed flat lapper platen assembly and lapper machine base with opposed air bearing platen assembly support. The platen assembly 1988 is supported by lower level air bearing pads 2006 that are attached to a granite base 2010 and the platen assembly 1988 has a upper rotary drive shaft 2022 that has a top shaft flange 1996 where fastens 1991 are used to attach the assembly 1988 to the flange 1996. The upper portion of the shaft 2022 is supported in a radial direction only by shaft bearings 1990 that are supported by a holder 2009 that is attached to the granite base 2010. The shaft bearings 1990 can be either air bearings or needle bearings that allow the upper shaft 2022 to move freely in a shaft 2022 axial direction. The platen 2003 has a vacuum passageway 1992 that connects vacuum applied at the vacuum entry 2026 of the rotary union 2020 to platen vacuum port holes 1994 via a shaft 2014 passageway 2024 to attach flexible abrasive sheet disks 1998 having raised abrasive coated islands 1986 to the platen 2003. The platen assembly 1988 has annular structural flanges 2008 that attach the air bearing annular rail 1984 to the platen 2003 body. The rail 1984 is captured between the lower air bearing pads 2006 that are attached to the base 2010 and the upper air bearing pads 2004 that are supported by brackets 1982 that are attached to the base 2010 where the rail 1984 is restrained in the vertical direction but the rail 1984 is not restrained in the radial direction by the bearings 2004 and 2006. The horizontal flat-surface-platen 2003 is restrained in a vertical direction by the air pads 2004 and 2006 and the rail is restrained in a radial direction by the shaft bearing 1990. A motor 2028 drives a belt pulley 2030 that drives a belt 2031 that drives a shaft pulley 2018 that is attached to the lower shaft 2014 to rotate the shaft 2014. The lower shaft 2014 is supported by bearings 2016 and the lower shaft 2014 is attached to the upper shaft 2022 by an annular disk coupler 2012 that is torsionally stiff but is flexible along the shaft 2022 axis to allow the platen assembly 1988 axial motion vertical. The open center of the disk coupler 2012 allows vacuum connection along the full vacuum passageways 2024 of both the upper shaft 2022 and the lower shaft 2014.

FIG. 154 is a cross section view of a high speed flat lapper platen assembly and lapper machine base with single-sided vacuum air bearing platen assembly support. The platen assembly 2156 is supported by lower level combination vacuum-pressure air bearing pads 2176 that are attached to a granite base 2180 and the platen assembly 2156 has a upper rotary drive shaft 2200 that has a top shaft flange 2166 where fastens 2158 are used to attach the assembly 2156 to the flange 2166. The upper portion of the shaft 2200 is supported in a radial direction only by shaft bearings 2160 that are supported by a holder 2163 that is attached to the granite base 2180. The shaft bearings 2160 can be either air bearings or needle bearings that allow the upper shaft 2200 to move freely in a shaft 2200 axial direction. The platen assembly 2156 has a vacuum passageway 2162 that connects vacuum applied at the vacuum entry 2192 of the rotary union 2190 to platen vacuum port holes 2164 via a shaft 2200 passageway 2202 to attach flexible abrasive sheet disks 2168 having raised abrasive coated islands 2154 to the platen 2171. The platen 2171 has annular structural flanges 2178 that attach the air bearing annular rail 2157 to the platen 2171 body. The rail 2157 contacts the lower vacuum air bearing pads 2176 that are attached to the granite base 2180. The rail 2157 is restrained in the vertical direction by the combination vacuum-pressure air pads 2176 but the rail 2157 is not restrained in the radial direction by the air bearing pads 2176. The horizontal-flat-surface platen 2171 is restrained in a vertical direction by the air pads 2176 and the rail is restrained in a radial direction by the shaft bearing 2160. The vacuum pads 2176 have a vacuum portion 2174 and air pressurized land areas 2165 where the pressurized areas 2165 are in near-contact with the lower surface area portion 2155 of the annular rail 2157. The annular rail 2157 has an annular ribbed section 2172 that is positioned between the rail 2157 air pad 2176 outer contact area section 2155 and the inner radial section of the rail 2157 where the ribbed section 2172 provide thermal isolation between the rail 2157 outer and inner sections. A motor 2198 drives a belt pulley 2196 that drives a belt 2194 that drives a shaft pulley 2188 that is attached to the lower shaft 2184 to rotate the shaft 2184. The lower shaft 2184 is supported by bearings 2186 and the lower shaft 2184 is attached to the upper shaft 2200 by an annular disk coupler 2182 that is torsionally stiff but is flexible along the shaft 2200 axis to allow the platen assembly 2156 axial motion vertical. The open center of the disk coupler 2182 allows vacuum connection along the full vacuum passageways 2202 of both the upper shaft 2200 and the lower shaft 2184.

FIG. 155 is a top view of a high speed flat lapper platen assembly with a coplanar grinder apparatus that can grind either or both the upper air bearing rail annular surface and the platen top surface annular abrasive disk mounting surfaces precisely flat and precisely coplanar with the bottom rail annular air bearing surface. First an air bearing composite structure platen assembly is constructed and the bottom annular air bearing rail surface is ground or lapped precisely flat across the whole annular rail surface area. Lapping this bottom rail surface flat and smooth can be accomplished using a number of different methods comprising use of a precision lapper machine that has a precisely flat platen having a platen diameter at least as large as the annular rail diameter. This platen rail assembly bottom rail surface lapping can be performed with various machines comprising: a slow moving abrasive slurry lapper machine; or a lapper machine can be operated at low speeds with continuous coated lapping disks; or a high speed lapper using fixed abrasive raised island disks can be used at high speeds.

A composite platen assembly 1978 as shown in FIGS. 146-154 having a precisely flat and smooth annular air bearing support rail bottom surface 1966 is stationary and an A-frame yoke grinder assembly 1970 is mounted to the rail bottom surface 1966 with the use of vacuum-type air bearing support pads 1968, 1976 and 1980. The three air bearing support pads 1968, 1976 and 1980 are spaced from each other to form a three-point mount of the grinder assembly 1970 to the rail surface 1966. A surface grinder 1974 is mounted to the A-frame 1977 between the air pads 1968 and 1976 where the grinder abrasive wheel 1972 is evenly spaced between the air pads 1968 and 1976. A center pivot device (not shown) allows the grinder assembly 1970 to be pivoted about the center of the platen assembly 1978 where the three air pads 1968, 1976 and 1980 are in direct contact with the bottom rail surface 1966 as the grinder assembly is rotated about the platen assembly 1978. The air pads 1968, 1976 and 1980 maintain a precision air gap between them and the rail surface 1966 so the grinder abrasive wheel 1972 is maintained at a precision fixed distance from the rail surface 1966 as the grinder assembly 1970 is rotated. Positioning the grinder wheel 1972 halfway between the air pads 1968 and 1976 reduces the variation of the motion of the grinding wheel 1972 relative to the rail surface 1966 to approximately one half of the surface out-of-plane variation at either air pad 1968 or 1976. Here the grinding wheel 1972 will provide a ground platen assembly 1978 surface that is even more accurate in planar flatness than the bottom rail surface 1966. Likewise the long span distance across the diameter of the platen assembly 1978 that the single support pad 1980 is away from the grinder 1974 side air pads 1968 and 1976 minimizes any out-of-plane variations that occur at the air pad 1980 location on the grinder wheel 1972. The bottom rail surface 1966 is shown as being radially separated from the platen assembly 1978 inner annular plate 1965 by the mutually attached structural ribs 1964.

The grinder wheel 1972 is shown in contact with bottom rail surface 1966 which allows the bottom rail surface 1966 to be reground. The grinder wheel 1972 can also be positioned to be in contact with the top abrasive-disk surface of the platen (not shown) to grind the top annular platen surface flat and smooth and precisely coplanar with the bottom air bearing rail surface 1966 with this same type of grinder assembly 1970 set-up.

FIG. 156 is a cross section view of a high speed flat lapper platen assembly and lapper machine base with opposed air bearing platen assembly support. The platen assembly 2085 is supported by lower level air bearing pads 2090 that are attached to the flat top surface 2088 of a granite base 2086.

The platen assembly 2085 has annular structural flanges 2094 that attach the air bearing annular rail 2092 to the platen 2093 body. The rail 2092 is captured between the lower air bearing pads 2090 that are attached to the base 2086 and the upper air bearing pads 2078 that are supported by brackets 2084 that are attached to the base 2086. The rail 2092 is restrained in the vertical direction but the rail 2092 is not restrained in the radial direction by the bearings 2090 and 2078. The platen assembly 2085 is restrained in a radial direction by a bearing (not shown) that is located at the platen assembly 2085 rotational center. Likewise the horizontal flat-surface-platen 2093 is restrained in a vertical direction by the air pads 2090 and 2078. The support flanges 2094 are minimized in height to minimize the distance between the top granite 2086 surface 2088 and the platen 2093 bottom surface 2086. The air bearing rail 2092 has a lower rail surface 2082 that contacts the lower air bearing pad 2090 and an upper rail surface 2080 that contacts the upper air bearing pad 2078. An adjustable support ball 2076 that contacts the upper air pad 2078 is attached to the support bracket 2084 where the ball 2076 allows the upper air pad 2078 air surface to conformably contact the upper rail surface 2080 without precision machining of the bracket 2084 or the upper air pad 2078.

FIG. 157 is a cross section view of a high speed flat lapper platen assembly and lapper machine base with opposed air bearing platen assembly support where a non-precision flat granite top surface is provided and the air bearing pads are mounted with the use of epoxy sandwich joints. This allows an inexpensive granite base to be used with a platen assembly that has precision flat and coplanar rail air bearing surfaces. Vacuum is used to temporarily attach the support air pads to the precision ground rail surfaces and the epoxy in the sandwich joints solidifies while the vacuum is applied to the air pads. After the epoxy solidifies, positive air pressure is supplied to the air pads to develop a pressurized film of air between the air pads and the annular rail surfaces to support the platen assembly.

The platen assembly 2096 is supported by lower level air bearing pads 2124 that are attached to the flat top surface 2120 of a granite base 2114. The platen assembly 2096 has annular structural flanges 2128 that attach the air bearing annular rail 2126 to the platen 2097 body. The rail 2126 is captured between the lower air bearing pads 2124 that are attached to the epoxy sandwich top plate 2118 having an attached layer of epoxy 2122 that is in contact with the lower sandwich plate 2116 that is attached to the granite base 2114 top surface 2120. The upper air bearing pads 2106 that are attached to the epoxy sandwich bottom plate 2104 having an attached layer of epoxy 2102 that is in contact with the upper sandwich plate 2100 that is attached to the support bracket 2112 that is attached to the granite base 2114 top surface 2120. The rail 2126 is restrained in the vertical direction but the rail 2126 is not restrained in the radial direction by the bearings 2106 and 2124. The platen assembly 2096 is restrained in a radial direction by a bearing (not shown) that is located at the platen assembly 2096 rotational center. Likewise the horizontal flat-surface-platen 2097 having an annular raised area 2098 to which abrasive disks (not shown) are attached is restrained in a vertical direction by the air pads 2106 and 2124. The air bearing rail 2126 has a lower rail surface 2110 that contacts the lower air bearing pad 2124 and an upper rail surface 2108 that contacts the upper air bearing pad 2106. The air bearing rail 2126 lower rail surface 2110 and the upper rail surface 2108 are precisely coplanar to allow equal thickness pressurized air films (not shown) to exist between the upper air pad 2106 and the rail 2126 surface 2108 and between the lower air pad 2124 and the rail 2126 surface 2110 while the platen assembly 2096 is rotated.

FIG. 158 is a cross section view of a high speed flat lapper platen assembly and lapper machine base with a single sided vacuum air bearing is used to support a platen assembly. With this reduced complexity apparatus only the bottom support surface of the air bearing pad rail has to be provided with a precisely flat and smooth planar surface. The platen assembly 2130 is supported by lower level vacuum type air bearing pads 2144 that are attached to the flat top surface 2148 of a granite base 2146. The platen assembly 2130 has annular structural flanges 2152 that attach the air bearing annular rail 2150 to the platen 2132 body. The air bearing rail 2150 is captured by the combination pressure/vacuum air bearing pads 2144 that are attached to the granite base 2146 top surface 2148. The air bearing 2144 has an internal exposed vacuum chamber 2140 where negative pressure vacuum applies a downward force on the rail 2150 air bearing surface 2137. The air bearing 2144 also has air pressurized land areas 2142 that apply an upward force on the rail 2150 air bearing surface 2137. The combination pressure/vacuum air bearing 2144 downward and upward forces on the rail surface 2137 are opposed to each other and allow the formation of a uniform and controlled air film (not shown) thickness between the rail surface 2137 and the air bearing land areas 2142 even when the platen assembly 2130 is rotated. The rail 2150 is restrained in the vertical direction but the rail 2150 is not restrained in the radial direction by the air bearing 2144. The platen assembly 2130 is restrained in a radial direction by a bearing (not shown) that is located at the platen assembly 2130 rotational center. Likewise the horizontal flat-surface-platen 2132 having an annular raised area 2134 to which abrasive disks (not shown) are attached is restrained in a vertical direction by the air bearing pad 2144. The air bearing rail 2150 lower rail surface 2137 and the platen abrasive disk support surface 2134 are precisely coplanar to allow the platen planar annular disk mounting area 2134 to operate with very small surface deviations from a plane as the platen assembly 2130 is rotated. The air bearing rail 2150 has an outer annular ring section 2138 that is attached to the inner rail 2150 annular body by a ribbed annular section 2136 that is used to thermally isolate the inner rail 2150 section from the air bearing 2144 expanded-air cooling effects.

Platen Support Devices for Lapper Machine

Problem: It is desired to fabricate large diameter platens that have internal vacuum passageways connected to vacuum port holes that are used to attach flexible abrasive disks to the platen surface where these platens do not require expensive composite layered platen structures.

Solution: Platens can be constructed from a single layer sheet material that has annular and radial grooves cut into the top surface of the platen where these grooves have attached covers that route vacuum passageways from the platen center to annular disk attachment paths that have vacuum port holes. These grooves typically have a flat bottom surfaces or ledges to accommodate covers that have the same width as the grooves to allow these pre-machined covers to be adhesively bonded to the groove ledges or bottoms. The covers that extend radially from the platen center would provide sealed passageways to route the vacuum from the platen center to the port-hole covered annular grooves that extend around the platen circumference. The annular grooves would be radially positioned under the flexible abrasive covered raised island annular portions of the abrasive disks that are attached to the platen to provide maximum hold-down support of the abrasive that is subjected to abrading contact forces. These platen vacuum passageways can be used for flexible continuous coated abrasive disks or for flexible backing raised island abrasive disks.

Multiple annular vacuum passageways can be used for large diameter abrasive disks and single annular passageways can be used for small diameter abrasive disks. Each of the continuous coated or annular band raised island abrasive disks would have a backing sheet that extends continuously over the full diameter of the abrasive disk so that vacuum leakage would not occur at the portion of the abrasive disk that is inboard radially from the outer annular vacuum passageways. In the event that the vacuum port holes become worn due to the ingestion of abrasive particles or the passageways become plugged with grinding debris, the cover can simply be removed from the groove and a substitute new cover can be adhesively attached in place. The covers can be fabricated from the same material as the platen body or the covers can be fabricated from a variety of materials comprising metals, steel, stainless steel, polymers, composite materials, or inorganic materials. Port holes can be fabricated by using port-hole inserts that are bonded or mechanically crimped or bonded into the cover structures where the inserts are fabricated from a variety of materials comprising metals, polymers, ceramics, and jewels. The radial and the annular port hole covers can be fabricated as individual annular sections that can be adhesively attached to the grooves. New covers would be fabricated to fit flush with the top flat surface of the platen to minimize the necessity of re-machining the top surface of the platen after new replacement covers are installed.

FIG. 159 is a top view of a flat lapper platen assembly that has radial and annular covers over vacuum passageway grooves. A flat surfaced platen 2036 has annular groove covered passageways 2032 and 2038 that have vacuum port holes 2034. Radial flat-bottomed covered grooves 2040 route vacuum from the platen center vacuum passageway 2044 to the annular passageways 2032 and 2038. The annular passageway 2032 has an annular cover segment 2042.

FIG. 160 is a cross section view of a portion of a flat lapper platen assembly that has vacuum passageway grooves and groove covers. A flat surfaced platen 2052 has grooved vacuum passageways 2046 that are covered with U-shaped covers 2048 that have vacuum port holes 2050.

FIG. 161 is an orthographic view of a portion of annular vacuum groove U-shaped cover plate that has vacuum port holes. The annular cover plate 2054 has vacuum port holes 2056.

FIG. 162 is a cross section view of a portion of a flat lapper platen assembly that has round bottomed vacuum passageway grooves and groove covers. A flat surfaced platen 2058 has round-bottomed grooved vacuum passageways 2057 that are covered with flat covers 2064 that have vacuum port holes 2062. The covers 2064 are bonded to the grooves 2057 upper flat ledges 2063 with an adhesive 2060.

FIG. 163 is an orthographic view of a portion of annular vacuum groove flat cover plate that has vacuum port holes. The annular flat cover plate 2068 has vacuum port holes 2056.

Platen Support Devices for Lapper Machine

Problem: When lapping machines having air bearing supported large diameter platens are moved or shipped it is required that the platen assembly air bearing contact rails are not in direct contact with the air bearing pads to avoid surface damage to either the rail or the air bearings. During the time that a lapper machine is moved, air pressure is not typically supplied to the air pads with the result there is no air film that separates the air pad and rail surfaces. Because the heavy rotatable platen assembly rail rests in direct contact with the stationary air pads, transport vibratory or shock motions will tend to move the surface of the platen assembly rail relative to the air bearing pads. This relative motion can easily damage either the pad or the rail surfaces because of the presence of large dynamic forces that force the two surfaces together where either surface can abrade the other surface. Any abrasion of either surface is highly undesirable because of the very small air film thickness that is typically present between the two surfaces when the air bearing pads are pressurized with air to support the platen assembly. A defect that is caused by this abrading action that changes the gap by even less than 0.0001 inch (2.5 micrometers) can easily degrade the performance of the air bearing support system. In addition, any abrading scratches that are present on the smooth rail surface can abrade surfaces of the air bearing pads if the rail comes into contact with the pads as the platen assembly rotates.

In addition it is desirable to support a platen assembly when air bearing pads are temporarily attached to an annular air bearing rail with vacuum while an adhesive that indirectly bonds the air pads to a granite base solidifies. This platen assembly support system allows the adhesive to solidify when the pad assemblies are in a stress free state because the pad assemblies do not support the platen assembly weight during the adhesive solidification event.

Solution: A number of devices can be used to independently support the heavy platen assembly while the lapper machine is moved. In one embodiment, wedge-type of screw jacks can be place at three locations around the periphery of the platen assembly to provide a three-point support where the weight of the platen assembly is evenly distributed to each of the three jacks. These jacks can be raised and lowered independently by manual motion or can be motor driven. Using shallow-angle wedge slides that are driven axially with the use of screws can provide extremely accurate vertical adjustment of each slide jack, especially when a stepper motor is used to drive the slide screw. All three slides can be mechanically or electrically coupled to raise or lower the platen assembly.

The platen assembly is free to move a limited amount in an axial direction because of the air bearing or needle bearing that allows this axial motion while restraining the platen assembly in a platen radial direction. Likewise, use of a dual-diaphragm motor shaft drive coupler allows a limited amount of axial motion where the platen assembly rail can be moved from contact with the air bearing pads as desired. When the slides are reversed, the lowered jacks loose contact with the platen assembly which allows the platen assembly to operate with thin desired air films between the rails and the air bearing support pads. The lifting screw jacks contact the platen assembly at locations other than the rail air bearing contact surfaces to prevent damage to the rail air bearing contact surfaces.

Workpiece Holder Perpendicular Axis Support

Problem: When lapping machines having rigid axis workpiece holders it is necessary that the axis alignment is precisely perpendicular to the surface of the rotating platen to provide workpieces that are precisely flat. If a rotating workpiece axis is not perpendicular then the workpiece surface develops a cone-shape. Also, the abrading contact shear force increases substantially at the later stages of lapping when the abrasive moving relative to the workpiece shears the thin film of coolant water in the gap between the very flat workpiece and abrasive surfaces. This shearing force is also applied to the abrasive end of the workpiece holder, which tends to pivot the workpiece holder axis away from a precise perpendicular alignment with the platen planar surface. It is desired to align a workpiece holder rotational axis precisely perpendicular to the planar surface of a platen and to maintain this perpendicular alignment even when the workpiece and the workpiece holder device is subjected to abrading contact forces that change during a high speed lapping procedure.

Solution: Conventional abrasive machines are used to produce flat surfaced workpieces that are precisely flat. These same machines can also produce workpieces that opposed surfaces that are precisely flat and parallel to each other. One type of grinding machine used for this is a backgrinding machine that has a rotating abrasive disk that is mounted on a rigid frame where the contacting abrasive is translated across the surface of a stationary workpiece that is supported on a rigid platform. First one surface of a workpiece is abraded flat. Then the workpiece is flipped over and the opposed workpiece surface is machined flat with the abrasive head to produce opposed workpiece surfaces that are parallel. The backgrinder cuts a planar path across the width of the workpiece by cutting a series of circular "lines" across the width of the workpiece surface much like the cutting action of a lathe. All of the abrading action is concentrated in a small annular ring area of the workpiece surface. The head of the backgrinder can be tilted at slight angles to concentrate the workpiece cutting action to be focused at either the leading or trailing peripheral annular bands of abrasive disk. However, the depth of cut varies across the width of the workpiece as the grinder head translates to assure that all portions of the workpiece surface is ground by the rotating abrasive disk in a single abrading pass.

Typically the localized abrading contact pressures between the contacting abrasive particles and the workpiece surface are very high relative to high speed lapping as a whole deep layer of workpiece material has to be removed in one translating grinding pass to provide a uniform planar workpiece surface. These backgrinder high abrading pressures result in substantially greater workpiece material subsurface damage as compared to high speed lapping that has very low abrading contact pressures and where these low pressures are uniformly spread over the whole flat surface of the workpiece. Secondary tilting of the backgrinder because of the water shear adhesion between the workpiece and the abrasive doesn't occur because there is no flat-surface planar contact between the abrasive and the workpiece. Instead only a narrow annular ring of abrasive is in contact with a localized portion of the partially flattened workpiece surface. Also, backgrinders are inherently more rigid machines because of their relatively simple design. Operation of a backgrinder only requires that the grinder head is pre-set at a cut depth elevation and the head is traversed across the workpiece part surface. The abrading contact pressures are not actively controlled with backgrinders during an abrading event. High speed lappers have much more complex machine operations which results in more complex machine designs that can be more susceptible to tilting of the workpiece holder axis during a lapping operation.

Tilting of workpiece holder heads with abrasive slurry lapping machines is not typically an issue because workpieces are simply laid flat on an abrasive slurry coated rotating platen. Also, slurry lapping with free-mounted workpieces can not produce parallel opposed lapped surfaces. In slurry lapping, the workpiece surfaces "seek their own planar surface due to the highest portions of the surface being abraded away. When a workpiece is flipped over and the second surface is lapped, there is no reason that the two opposed lapped surfaces will be parallel.

In high speed lapping two primary different types of workpiece holders can be used. One primary type has a rigid spindle where a workpiece is rigidly mounted on a rotating shaft that holds the workpiece against the abrasive coated raised islands disks that are mounted to the platen. The axis of the workpiece holder shaft must be precisely perpendicular to the precisely flat platen surface at all times throughout the abrading procedure to provide a precisely flat workpiece surface. A slight tilt to the workpiece holder axis will result in a cone-shaped workpiece surface. The surface of the finished workpiece is perpendicular to the axis even if the original unfinished workpiece surface was not perpendicular when first mounted on the workpiece holder. To produce a workpiece that has parallel opposing surfaces, first one surface of a workpiece is abraded flat. Then the workpiece is flipped over and the opposed workpiece surface is abraded flat to produce opposed workpiece surfaces that are parallel.

A second primary type of high speed flat lapping workpiece holder is one that allows the workpiece surface to conformably contact the flat abrasive surface. As the workpiece is lowered to the abrasive, the spherical-action workpiece holder rotates to allow best-fit flat contact of the uneven workpiece surface with the precisely flat planar abrasive surface. In addition, the spherical action workpiece holder has an off-set center of rotation that is positioned at the abrasive surface to prevent undesirable tilt-rotation of the workpiece due to abrading contact forces. The two spherical action components that comprise the workpiece holder form a low friction air bearing device when pressurized air is applied to the device. Also, vacuum can be applied to the spherical workpiece holder to temporarily lock the two spherical action components together to create a rigid workpiece holder. Vacuum or pressurized air can be applied to the same spindle axis shaft rotary union port to either lock or "float" the workpiece holder. Various spherical action workpiece holders are shown in FIGS. 123, 124 and 125. Spherical action floating workpiece holders can be used to produce single-sided workpiece surfaces by high speed lapping. They can also be used to independently produce flat opposed workpiece surfaces that are not precisely parallel to each other. However spherical action floating workpiece holders can be used to produce one workpiece surface by high speed lapping. Then the workpiece holder can be locked to provide a rigid workpiece holder and the workpiece holder spindle axis can be aligned with the platen planar surface. Then the workpiece is flipped over and the opposed workpiece surface is abraded flat to produce opposed workpiece surfaces that are parallel.

Special design features of the workpiece holder spindle assembly can provide active precise perpendicular alignment of the workpiece holder spindle axis with the platen planar surface. The bottom portion of the vertical workpiece holder spindle closest to the abrasive surface can be rigidly mounted to a stiff granite base with a spherical bearing that allows the workpiece holder axis to be pivoted. Also, the top portion of the vertical workpiece holder spindle can be mounted with a spherical bearing that is positioned by two stepper motor driven screw slides having travel axes that are at right-angles to each other that allow the top of the workpiece holder axis to be independently moved along two orthogonal axes. Here the "X" and "Y" positions of the top of the spindle can be actively changed to align the spindle perpendicular with the planar surface of the abrasive platen.

The perpendicular alignment of the workpiece holder spindle with the planar surface of the stationary platen can be made by attaching an arm having a distance sensor at its free end to the workpiece holder and rotating the arm to two or more angular positions around the circumference of the platen. Measurements of the distance between the arm sensor and the platen can be used to establish the perpendicular error between the workpiece holder axis and the platen surface. These error measurements can also be used as inputs to a control system that drives the two steeper motor slides whereby the top end of the workpiece holder spindle is positioned to have precision perpendicular alignment with the platen surface. In one embodiment, after a dual-stepper motor slide system is used to align the rigid workpiece holder spindle perpendicular to the platen, an air bearing spherical rotation workpiece holder can positioned in flat contact with the platen and locked to the rigid holder spindle by applying vacuum to the spherical holder surfaces. This now-rigid rotating workpiece holder can be used to rigidly hold workpieces in abrading contact with the annular abrasive disks attached to the rotating flat surfaced platen. A workpiece can be abraded flat and then flipped-over and re-mounted to the workpiece holder and a flat surface can be abraded on the opposing side of the workpiece where both workpiece planar surfaces are precisely parallel to each other.

In another embodiment, the bending deflection of the workpiece holder spindle apparatus axis from a precision alignment that is perpendicular to the platen planar surface, due to abrading contact shear forces, can be measured during an abrading event with the use of laser interferometer devices. These laser devices can measure changes in the top spindle position relative to reflective mirrors that are attached to the rigid granite bases that support the workpiece holder spindle apparatus during an abrading event. The spindle bottom position tends to remain fixed and is resistant to these shearing forces because the spindle bottom is structurally supported from the granite base and is closer to the granite base than is the spindle top support structure. As the abrading shear forces between the workpiece surface and the flat abrasive surface increase due to a reduced interface water film thickness as the workpiece becomes flatter, the increased abrading shear forces are applied to the workpiece holder assembly. Because this assembly structure has an equivalent spring-constant stiffness, the increased abrading shear force can deflect the workpiece holder axis as the spindle top structure moves in response to these abrading shear forces. Here, the spindle axis error motion can be dynamically measured by these laser interferometer devices and these motion errors can be used to re-position the spindle top with the stepper motor slides to maintain the original perpendicular alignment. This dynamic adjustment of the workpiece spindle perpendicular alignment during an abrading event can be made as a function of abrading forces or they can be made from other sources of spindle alignment errors comprising the thermal growth of lapping machine components.

Any dynamic motion of the planar alignment of the moving platen relative to the granite base during abrading events can be accurately measured with the use of capacitance gage devices and these platen position error measurements can also be used to maintain the perpendicular alignment of the workpiece spindle with the platen flat abrasive surface. Here, capacitance sensors can be mounted on the granite base and used to sense the displacement of the bottom side of the platen assembly. In addition these capacitance sensors can be used to measure very minute sub-micrometer changes in the planar flatness of the platen as a function of the circumferential location on the platen. These sensors can provide assurance that the required extremely flat platen planar annular surfaces are provided for the mounting of precision thickness raised island abrasive disks for high speed flat lapping operations.

FIG. 164 is a cross section view of an adaptive controlled workpiece holder rotational axis position alignment system of a high speed lapper machine. A platen 2211 having a flat surface 2210 is mounted to a rigid granite base 2212 where a workpiece holder 2215 workpiece (not shown) mounting surface 2246 is aligned perpendicular to the platen 2211 surface 2210 that supports an abrasive disk (not shown). A gap sensor 2248 measures a gap 2252 between the sensor 2248 and the platen surface 2210 and a gap sensor 2214 measures a gap 2206 between the sensor 2214 and the platen surface 2210. The two sensors 2214 and 2248 supply gap measurements to an adaptive control unit (not shown) that activates either or both the drive motors 2224 and 2240 that are connected by pivot link arms 2226 and 2238 that move the top position of a workpiece holder 2215 shaft housing 2244. A spherical action bearing 2228 couples the top of the shaft housing 2244 to the link arms 2226 and 2238 and a spherical action bearing 2216 couples the bottom of the shaft housing 2244 to the lapper machine (not shown) structure. The shaft housing 2244 supports shaft bearings 2220 and 2218 that support the workpiece holder 2215 driven shaft 2236 that drives the workpiece holder 2215. The driven shaft 2236 is shown having a perpendicular misalignment angle 2234 between an axis 2230 that is perpendicular to the platen surface 2210 and the shaft 2236 axis 2232. Laser inferometer sensors 2222 and 2242 mounted on the housing 2244 top can be used with laser reflectors 2208 and 2250 that are mounted on the base 2212 to align and actively maintain the alignment of the workpiece holder 2215 shaft 2236 during the lapping process operation where the shaft 2236 is perpendicular to the platen 2211 surface 2210. Likewise the platen 2211 gap sensors 2214 and 2248 can actively maintain the shaft 2236 perpendicular alignment to the platen 2211 surface 2210 during the lapping process operation.

Hydrodynamic Air Bearing for High Speed Platens

Problem: It is desirable to limit the quantity of high pressure air that is supplied to air bearing pads that support large diameter circular abrasive platens that operate at high speeds. Annular flat surfaced guide rails that structurally support the outer diameter portion of large 30 to 96 inch (76 to 244 cm) diameter platens provide precision flat surfaces are contacted by air bearing pads. These pads are supplied with substantial quantities of high pressure and very clean air to develop a thin film of air that separates the flat air pad surface from the flat rail surface as the platen is rotated. Providing large quantities of this filtered air is expensive.

Solution: The air bearing pads typically are located at stations that are positioned around the circumference of the platen. The annular air pad flat rails have continuous flat top and bottom surfaces that extend around the circumference of the platen and the rails are structurally attached to the platen body. Air pads are employed in pairs where one pad contacts the top rail flat surface and the other pad contacts the bottom rail flat surface at a position that directly aligns the flat surfaces of both pads congruent with each other.

The outer periphery of an annular platen support rail typically moves at high tangential surface speeds of approximately 10,000 SFPM. Because the annular air bearing platen support rail is located near the outer periphery of the platen, the tangential surface speed of the support rail is also very high, being just somewhat less than the 10,000 SFPM of the outer periphery of an annular platen. When the annular support rail move at these very high surface speeds while an air bearing air film having a thickness ranging from 0.0001 to 0.0005 inches (2.5 to 12.5 micrometers) is present between the platen rail and the air bearing there is a substantial amount of air that is dragged into the gaps between the air bearing flat surfaces and the flat surface of the annular rail due to shearing action on the air film. The air that is dragged into these air bearing gaps tend to apply a air-pressure force on the rail surface at each of the opposing air bearing pad locations.

Use of air bearing pads that have tapered leading edges tend to force increased quantities of air into the gaps. As the platen support rail travels at high surface speeds and approaches pads that have shallow-angle leading edges, the rail can successfully drive air at great induced air pressures into downstream areas of the support pads that are flat and are positioned in close proximity to the flat surface of the moving rail. Here the air pressure that is induced in the gap between the rail and the pad can successfully support the platen and maintain the platen support rail in a centered position between the two opposing pads. Typically the platen only rotates in one direction so there is only one leading edge for the air bearing pads.

Air pressure can be supplied to the air bearing pads when the platen is stationary or moving at low speeds but the supply air to the air bearing pads can be reduced or eliminated after the platen rotates at high surface speeds. Because the high pressure air pad supply air no longer expands as the air pressure is reduced as it passes through the air pad assembly, the cooling effect of the expanded air is reduced. However, the high shearing action on the air that is drawn into the tapered pads tends to heat the air and also, to heat the pad and the rail. Air consumption for each pad is reduced for operating cost savings. In addition, less contamination of the lapping machine environment takes place as less high pressure supply air is exhausted from the pads. Furthermore, high pressure air is not forced through the body of porous carbon air bearings which reduces the number of carbon particles that are carried from the interior of the bearing body to the lapping machine environment. Generally, the tapered faces of the air bearing pads only have to be located on one end of the pads because the platen would tend to rotate in one direction only.

Developing of shear induced high pressure structure-supporting air floatation films at high relative surface speeds with use of tapered inlet gaps is a hydrodynamic process that is well known to those skilled in the study of fluid dynamics and is explained in detail as described in classical lubrication theory analyses as developed by Osborne Reynolds. This analytical work can be used to optimize the leading edge taper angle and the lengths of the tapered section and the flat contact section of the air bearing pads to provide the required dynamic support of the moving platen assembly that is practical with the dimension tolerances that can be provide for all the associated components of the air bearing pad platen support system.

FIG. 145 is a side view of a section of a horizontal high speed flat lapper platen air bearing platen support rail and tapered-edge air bearing pads. The air bearing annular rail 1658 is shown centered between an upper air bearing pad 1666 and a lower air bearing pad 1674. There is a upper air bearing film of air 1668 between the upper air pad 1666 flat contact surface and the rail 1658 upper flat surface and a lower air bearing film of air 1672 between the lower pad 1674 flat contact surface and the rail 1658 lower flat surface. The moving air bearing rail 1658 is rotated in the direction shown as 1670 in near-contact with the stationary upper air pad 1666 and the stationary lower air pad 1674. When the annular platen support rail is stationary, pressurized air is supplied to both the pads 1666 and 1674 to maintain the pressurized air films 1668 and 1672 where the pressurized air film 1672 supports the weight of the platen assembly at the outer annular area of the platen. The upper air pad 1666 has a linear rail-contact section 1664 where the air film 1668 is uniform in thickness and the upper pad 1666 also has a leading-edge tapered section 1662. Air is drawn into the stationary upper tapered wedge section 1662 by the rail 1658 that has a high surface speed as the rail 1658 is rotated at a high speed. The air is drawn into the tapered wedge section 1662 having a taper angle 1660 by air-shearing action provided by the moving rail 1658 surface. As the drawn-in air progresses further into the stationary wedge 1662 section, the air gap in the tapered wedge section 1662 is reduced and the localized air pressure rises. When the air is further drawn into the linear section 1664, the air film 1668 is already at a sufficiently high pressure to apply a normal force between the lower air pad 1674 and the rail 1658. Likewise, air is drawn into the stationary lower tapered wedge section 1662 by the rail 1658 where air is drawn into the lower tapered wedge section 1662 having a taper angle 1656 by air-shearing action provided by the moving rail 1658 surface. Again, as the drawn-in air progresses further into the stationary wedge 1662 section, the air gap in the tapered wedge section 1662 is reduced and the localized air pressure rises. When the air is further drawn into the linear section 1664, the air film 1672 is already at a sufficiently high pressure to apply a normal force between the upper air pad 1666 and the rail 1658. The air pressure of the upper air film 1668 acts normally against the rail 1658 which forces the rail downward against the lower air film 1672 which also has a shear developed air pressure that acts normally upward against the annular rail 1658 surface. These opposing air films 1668 and 1672 provide forces that tend to center the rail 1658 between the upper air pad 1666 and the lower air pad 1674 when the rail 1658 moves at high surface speeds and induces high pressures in the air films 1668 and 1672. Because the moving rail 1658 induces these high pressures in the air films 1668 and 1672 it is not necessary to supply expensive pressurized air to the air pads 1666 and 1674 during these air bearing rail 1658 high speed events. When the rail 1658 slows down, the supply of pressurized air can be resumed to the air pads 1666 and 1674.

Semiconductor Abraded With a Flat Abrasive Raised Island

Problem: It is desired to avoid eroding out the soft metal interconnect paths in the surface of a semiconductor by loose abrasive particles or by elevated particles that are attached to an abrasive article that are moved while in contact with the semiconductor flat surface.

Solution: Eroding of the metal paths of a semiconductor is avoided by the use of raised island abrasive disks that have precision flat surfaced rigid raised island structures that are coated with a monolayer abrasive particles where the overall thickness of the abrasive disk article is precisely controlled and the abrasive disk is mounted on a platen that provides a precision flat disk mounting surface over the full range of the platen operating speeds. The top flat area surfaces of the abrasive islands are substantially larger than the semiconductor metal interconnect paths which allows each individual abrasive island to bridge across the narrow metal paths. Because the island abrasive surfaces that contact the semiconductor flat face material are supported by the parent substrate ceramic material on either side of the metal paths, the abrasive particles that are rigidly attached to the island top flat surfaces, individual abrasive particles can not penetrate down into the relatively soft metal material as the abrasive moves across the metal paths. Here, the metal path is abraded flat in a common plane with the localized surface of the semiconductor ceramic base material as the abrasive islands move across the surface of the semiconductor workpiece device.

FIG. 165 is a cross section view of a semiconductor workpiece, having embedded metal interconnect paths, that is abraded by a flat surfaced raised island abrasive disk. The raised island abrasive disk 2526 has a flexible abrasive disk backing sheet 2530 that has raised island structures 2524 that are attached to the backing sheet 2530 where the abrasive disk 2526 is attached to a precision-flat platen (not shown). The raised island 2524 has a thin precision thickness abrasive layer 2522 that is comprised of a monolayer of abrasive particles or abrasive particle filled abrasive beads. The abrasive 2522 is in flat surface contact with the semiconductor 2520 top surface 2528 where the abrasive 2522 bridges across the metal paths 2532 which are embedded in the surface 2528 of the semiconductor 2520. The semiconductor 2520 has a bottom surface 2534 that is supported by a planar support device (not shown).

A rotatable abrasive lapper machine platen assembly apparatus is described that is attached to a lapper machine frame with the lapper machine platen assembly apparatus comprising: a circular shaped rotatable horizontal platen having a front surface and a back surface; and where the platen planar front surface has a precision flat surface. The platen has a platen radius, an outer circumference, a periphery and a platen front surface outer platen annular portion that extends radially to the outer circumference wherein the abrasive disk is positioned concentric with the circular platen. The platen assembly has a platen center of rotation axis that is perpendicular to the platen planar front surface outer annular planar portion surface where the rotational axis is concentric with the circular platen. A flexible abrasive disk can be secured in conformable flat contact with the platen front surface outer annular planar portion where the abrasive disk is positioned concentric with the circular platen. The platen assembly has a driven platen shaft where one end of the driven platen shaft is attached to the circular platen at the platen center of rotation and the axis of the shaft is concentric with the platen center of rotation axis. A rotary driven platen shaft bearing is attached to the lapper machine frame where the platen shaft bearing is mounted concentric with the platen center of rotation axis where the shaft bearing restrains the platen assembly in a circular platen radial direction but allows the platen assembly free motion along the platen center rotational axis. The platen assembly has a composite annular rail support plate that is structurally attached to the circular platen back surface where the annular rail support plate is concentric with the circular platen center of rotational axis. The composite rail support plate has an inner annular portion, a middle annular portion and a cantilevered outer annular portion where the inner, middle and outer portions are all structurally integral portions of the composite annular rail support plate. The composite rail support plate inner annular portion is structurally attached at the outer diameter of the composite rail support plate inner annular portion to the composite rail support plate middle portion at the inner diameter of the composite rail support plate middle annular portion. The composite rail support plate middle annular portion is structurally attached at the outer diameter of the composite rail support plate middle annular portion to the composite rail support plate outer portion at the inner diameter of the composite rail support plate outer annular portion where the composite rail support plate outer annular portion is cantilevered radially outward from the composite rail support plate middle annular portion. The composite rail support plate middle annular portion has a middle annular portion thickness that is constructed to provide stiff structural interconnection of the attached cantilevered composite rail support plate outer annular rail portion to the composite rail support plate inner annual portion in a platen center of rotation axial direction but where the composite rail support plate middle annular portion provides a platen radially flexible connection between the cantilevered composite rail support plate outer rail annular portion and the composite rail support plate inner rail annular portion. The composite rail support plate middle annular portion also provides thermal insulation of the composite rail support plate cantilevered outer rail plate portion from the composite rail support plate inner rail plate portion. The composite rail support plate cantilevered outer annular portion has a lower annular rail air bearing contact surface that faces away from the platen planar front surface where this lower rail contact surface is precisely flat and smoothly polished and where the lower annular rail air bearing contact surface is co-planar with the platen planar front surface outer annular planar portion surface. Multiple combination-air-bearing pads that are mounted on the lapper machine frame around the periphery of the platen have air bearing pad flat face contact surfaces where the air bearing pad contact surfaces are in near-contact with the composite rail support plate outer annular portion lower cantilevered annular rail contact surface to support and restrain the platen assembly in a vertical direction along the platen center of rotation axis when the platen assembly is stationary or rotationally moving. A sustained pressurized air film is provided between the air bearing pads contact surfaces and the polished lower air bearing rail surface by pressurized air that is supplied to the air bearing pads. The flat surfaced combination-air-bearing pads have a pressurized air film air bearing pad portion that provides a positive force against the polished lower air bearing rail surface and an air bearing pad vacuum portion that provides a negative force against the polished lower air bearing rail where the air bearing pressurized air film force opposes the air bearing vacuum portion force.

The composite annular rail support plate middle annular portion can be manufactured from a metal, a polymeric or a fiber reinforced polymeric material and has machined or molded or attached elongated ribs where the ribs have two rib ends, a rib thickness, a rib longitudinal length and a rib width where the rib thickness is equal to the full thickness or a partial thickness of the composite annular rail support plate middle portion where the ribs extend equally spaced in a tangential direction around the composite annular rail support plate middle portion where the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

In another embodiment, the composite annular rail support plate middle annular portion ribs longitudinal lengths are angled from 35 to 55 degrees from a radial line from the platen center of rotation.

In another embodiment, the composite annular rail support plate middle annular portion is constructed from an elastomeric material having low thermal conductivity to provide thermal insulation of the composite annular rail support plate outer annular rail portion from the composite annular rail support plate annular inner rail portion but also where the elastomeric annular middle portion provides a radially flexible connection between the composite annular rail support plate outer rail annular portion and the composite annular rail support plate inner rail annular portion.

In a further embodiment, the platen assembly has fluid passageways that allow fluid coolants to establish and maintain a constant temperature of the composite annular rail support plate inner rail plate portion of the platen assembly when the air bearing support pads provide cooling to the composite annular rail support plate cantilevered outer annular portion. A process for manufacturing an abrasive lapper machine platen assembly apparatus comprises providing a rotatable abrasive lapper machine platen assembly apparatus comprising a circular shaped rotatable horizontal platen having a front surface and a back surface with the circular platen having a platen radius, a platen outer circumference and a platen outer periphery. The circular platen front surface has an outer annular planar portion where the platen outer annular planar portion extends radially to the circular platen outer circumference and a flexible abrasive disk can be secured in conformable flat contact with the circular platen front surface outer annular planar portion where the abrasive disk is positioned concentric with the circular platen. The platen assembly has a platen center of rotation axis that is perpendicular to the platen front surface outer annular planar portion surface where the platen center of rotation axis is concentric with the circular platen. The platen assembly has a driven platen shaft where one end of the driven platen shaft is attached to the circular platen at the platen center of rotation and the axis of the shaft is concentric with the platen center of rotation axis. A rotary driven platen shaft bearing is attached to the lapper machine frame where the platen shaft bearing is mounted concentric with the platen center of rotation axis and where the shaft bearing restrains the platen assembly in a circular platen radial direction but allows the platen assembly free motion along the platen center rotational axis. The platen assembly has a composite annular rail support plate that is structurally attached to the circular platen back surface where the annular rail support plate is concentric with the circular platen center of rotational axis and the composite rail support plate has an inner annular portion, a middle annular portion and a cantilevered outer annular portion where the inner, middle and outer portions are all structurally integral portions of the composite annular rail support plate. The composite rail support plate inner annular portion is structurally attached at the outer diameter of the composite rail support plate inner annular portion to the composite rail support plate middle portion at the inner diameter of the composite rail support plate middle annular portion. The composite rail support plate middle annular portion is structurally attached at the outer diameter of the composite rail support plate middle annular portion to the composite rail support plate outer portion at the inner diameter of the composite rail support plate outer annular portion where the composite rail support plate outer annular portion is cantilevered radially outward from the composite rail support plate middle annular portion. The composite rail support plate middle annular portion having a middle annular portion thickness is constructed to provide stiff structural interconnection of the attached cantilevered composite rail support plate outer annular rail portion to the composite rail support plate inner annual portion in a platen center of rotation axial direction but where the composite rail support plate middle annular portion provides a platen radially flexible connection between the cantilevered composite rail support plate outer rail annular portion and the composite rail support plate inner rail annular portion. The composite rail support plate middle annular portion also provides thermal insulation of the composite rail support plate cantilevered outer rail plate portion from the composite rail support plate inner rail plate portion. The composite rail support plate cantilevered outer annular portion has a lower annular rail air bearing contact surface that faces away from the platen planar front surface where this lower rail contact surface is precisely flat and smoothly polished and where the lower annular rail air bearing contact surface is co-planar with the platen planar front surface outer annular planar portion surface. Multiple combination-air-bearing pads that are mounted on the lapper machine frame around the periphery of the platen have air bearing pad flat face contact surfaces where the air bearing pad contact surfaces are in near-contact with the composite rail support plate outer annular portion lower cantilevered annular rail contact surface to support and restrain the platen assembly in a vertical direction along the platen center of rotation axis when the platen assembly is stationary or rotationally moving. A sustained pressurized air film is provided between the air bearing pads contact surfaces and the polished lower air bearing rail surface by pressurized air that is supplied to the air bearing pads. The flat surfaced combination-air-bearing pads have a pressurized air film air bearing pad portion that provides a positive force against the polished lower air bearing rail surface and an air bearing pad vacuum portion that provides a negative force against the polished lower air bearing rail where the air bearing pressurized air film force opposes the air bearing vacuum portion force.

The composite annular rail support plate middle annular portion can be manufactured from a metal, polymeric or a fiber reinforced polymeric material has machined or molded or attached elongated ribs that extend the full thickness or a partial thickness of the composite annular rail support plate middle portion where the ribs extend around the composite annular rail support plate middle portion and the ribs are angled from 20 to 70 degrees from a radial line from the platen center of rotation.

In another embodiment the composite annular rail support plate middle annular portion ribs are angled from 35 to 55 degrees from a radial line from the platen center of rotation also the ribs provide thermal isolation of the outer rail portion from the inner rail portion.

In a further embodiment, the composite annular rail support plate middle annular portion is constructed from an elastomeric material having low thermal conductivity to provide thermal insulation of the composite annular rail support plate outer annular rail portion from the composite annular rail support plate annular inner rail portion but also where the elastomeric annular middle portion provides a radially flexible connection between the composite annular rail support plate outer rail annular portion and the composite annular rail support plate inner rail annular portion.

In a further embodiment, the platen assembly has fluid passageways that allow fluid coolants to establish and maintain a constant temperature of the composite annular rail support plate inner rail plate portion of the platen assembly when the air bearing support pads provide cooling to the composite annular rail support plate cantilevered outer annular portion.

A rotatable abrasive lapper machine platen assembly apparatus is described that is attached to a lapper machine frame with the lapper machine platen assembly apparatus comprising: a circular shaped rotatable horizontal platen having a front surface and a back surface; and where the platen planar front surface has a precision flat surface. The platen has a platen radius, an outer circumference, a periphery and a platen front surface outer platen annular portion that extends radially to the outer circumference wherein the abrasive disk is positioned concentric with the circular platen. The platen assembly has a platen center of rotation axis that is perpendicular to the platen planar front surface outer annular planar portion surface where the rotational axis is concentric with the circular platen. A flexible abrasive disk can be secured in conformable flat contact with the platen front surface outer annular planar portion where the abrasive disk is positioned concentric with the circular platen. The platen assembly has a driven platen shaft where one end of the driven platen shaft is attached to the circular platen at the platen center of rotation and the axis of the shaft is concentric with the platen center of rotation axis. A rotary driven platen shaft bearing is attached to the lapper machine frame where the platen shaft bearing is mounted concentric with the platen center of rotation axis where the shaft bearing restrains the platen assembly in a circular platen radial direction but allows the platen assembly free motion along the platen center rotational axis. The platen assembly has a composite annular rail support plate that is structurally attached to the circular platen back surface where the annular rail support plate is concentric with the circular platen center of rotational axis. The composite rail support plate has an inner annular portion, a middle annular portion and a cantilevered outer annular portion where the inner, middle and outer portions are all structurally integral portions of the composite annular rail support plate. The composite rail support plate inner annular portion is structurally attached at the outer diameter of the composite rail support plate inner annular portion to the composite rail support plate middle portion at the inner diameter of the composite rail support plate middle annular portion. The composite rail support plate middle annular portion is structurally attached at the outer diameter of the composite rail support plate middle annular portion to the composite rail support plate outer portion at the inner diameter of the composite rail support plate outer annular portion where the composite rail support plate outer annular portion is cantilevered radially outward from the composite rail support plate middle annular portion. The composite rail support plate middle annular portion has a middle annular portion thickness that is constructed to provide stiff structural interconnection of the attached cantilevered composite rail support plate outer annular rail portion to the composite rail support plate inner annual portion in a platen center of rotation axial direction but where the composite rail support plate middle annular portion provides a platen radially flexible connection between the cantilevered composite rail support plate outer rail annular portion and the composite rail support plate inner rail annular portion. The composite rail support plate middle annular portion also provides thermal insulation of the composite rail support plate cantilevered outer rail plate portion from the composite rail support plate inner rail plate portion. The composite rail support plate cantilevered outer annular portion has a upper annular rail air bearing contact surface that faces toward the platen planar front surface and has a lower annular rail air bearing contact surface that faces away from the platen planar front surface wherein both the upper and the lower rail contact surfaces are precisely flat and smoothly polished and wherein both the upper and lower annular rail air bearing contact surface are co-planar with the platen planar front surface outer annular planar portion surface. Multiple sets of opposed upper and lower air bearing pads are mounted on the lapper machine frame around the periphery of the platen have air bearing pad flat face near-contacts respectively with both the upper and the lower cantilevered annular rail contact surfaces at the same platen circumferential locations to support and restrain the platen assembly in a vertical direction along the platen center of rotation axis when the platen assembly is stationary or moving with a sustained pressurized air film between the opposed air bearing contact surfaces and the polished upper and lower air bearing rail surfaces. The opposed upper and lower air bearing pads each create a pressurized air film between the opposed flat surfaced air bearing contact surfaces and the polished upper and lower air bearing rail surfaces where the air bearing rail outer portion is vertically suspended between the opposed air bearing pads when pressurized air is supplied to the air pads.

Here, the composite annular rail support plate middle annular portion can be manufactured from a metal, a polymeric or a fiber reinforced polymeric material has machined or molded or attached elongated ribs where the ribs have two rib ends, a rib thickness, a rib longitudinal length and a rib width where the rib thickness is equal to the full thickness or a partial thickness of the composite annular rail support plate middle portion where the ribs extend equally spaced in a tangential direction around the composite annular rail support plate middle portion whereby the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

Also, the composite annular rail support plate middle annular portion ribs longitudinal lengths can be angled from 35 to 55 degrees from a radial line from the platen center of rotation.

Further, the composite annular rail support plate middle annular portion can be constructed from an elastomeric material having low thermal conductivity to provide thermal insulation of the composite annular rail support plate outer annular rail portion from the composite annular rail support plate annular inner rail portion but also where the elastomeric annular middle portion provides a radially flexible connection between the composite annular rail support plate outer rail annular portion and the composite annular rail support plate inner rail annular portion.

Also, the platen assembly can have fluid passageways that allow fluid coolants to establish and maintain a constant temperature of the inner rail plate portion of the platen assembly when the air bearing support pads provide cooling to the cantilevered outer annular portion.

A process for manufacturing an abrasive lapper machine platen assembly apparatus can comprise providing a rotatable abrasive lapper machine platen assembly apparatus comprising a circular shaped rotatable horizontal platen having a front surface and a back surface where the platen has a outer circumference, a periphery and an outer platen annular portion that extends radially to the outer circumference. Here, the platen assembly has a platen center of rotation axis that is perpendicular to the platen planar front surface wherein the rotational axis is concentric with the circular platen and the platen assembly has a composite annular rail support plate that is structurally attached to the circular platen back surface where the annular rail support plate is concentric with the circular platen center of rotational axis. The composite rail support plate has an inner annular portion, a middle annular portion and a cantilevered outer annular portion where the inner, middle and outer portions are all structurally integral portions of the composite annular rail support plate. The composite rail support plate inner annular portion is structurally attached at the outer diameter of the composite rail support plate inner annular portion to the composite rail support plate middle portion at the inner diameter of the composite rail support plate middle annular portion. The composite rail support plate middle annular portion is structurally attached at the outer diameter of the composite rail support plate middle annular portion to the composite rail support plate outer portion at the inner diameter of the composite rail support plate outer annular portion where the composite rail support plate outer annular portion is cantilevered radially outward from the composite rail support plate middle annular portion. The composite rail support plate middle annular portion has a middle annular portion thickness that is constructed to provide stiff structural interconnection of the attached cantilevered composite rail support plate outer annular rail portion to the composite rail support plate inner annual portion in a platen center of rotation axial direction but where the composite rail support plate middle annular portion provides a platen radially flexible connection between the cantilevered composite rail support plate outer rail annular portion and the composite rail support plate inner rail annular portion. The composite rail support plate middle annular portion also provides thermal insulation of the composite rail support plate cantilevered outer rail plate portion from the composite rail support plate inner rail plate portion and the composite rail support plate cantilevered outer annular portion has a lower annular rail air bearing contact surface that faces away from the platen planar front surface. Machining or abrading the lower annular rail outer contact surfaces can produce a precision flat planar lower rail contact surface that is smoothly polished and where the lower rail surface is precisely co-planar with the platen planar front surface outer annular planar portion surface where machining or abrading the platen front surface provides that it is precisely co-planar with the lower rail air bearing contact surface.

Here, the composite annular rail support plate middle annular portion can be manufactured from a metal, a polymeric or a fiber reinforced polymeric material has machined or molded or attached elongated ribs where the ribs have two rib ends, a rib thickness, a rib longitudinal length and a rib width where the rib thickness is equal to the full thickness or a partial thickness of the composite annular rail support plate middle portion where the ribs extend equally spaced in a tangential direction around the composite annular rail support plate middle portion where the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

Also, the composite annular rail support plate middle annular portion ribs longitudinal lengths are angled from 35 to 55 degrees from a radial line from the platen center of rotation.

The composite annular rail support plate middle annular portion can be constructed from an elastomeric material having low thermal conductivity to provide thermal insulation of the composite annular rail support plate outer annular rail portion from the composite annular rail support plate annular inner rail portion but also where the elastomeric annular middle portion provides a radially flexible connection between the composite annular rail support plate outer rail annular portion and the composite annular rail support plate inner rail annular portion.

Here, the platen assembly can have fluid passageways that allow fluid coolants to establish and maintain a constant temperature of the composite annular rail support plate inner rail plate portion of the platen assembly when the air bearing support pads provide cooling to the composite annular rail support plate cantilevered outer annular portion.

A rotatable abrasive lapper machine platen assembly apparatus can have a precision flat planar surface whereby a flexible abrasive disk can be secured in conformable flat contact with the platen flat surface where the platen has a platen front surface, a platen outer circumference, a platen periphery and an platen front surface outer platen annular portion that extends radially to the outer circumference wherein the abrasive disk is positioned concentric with the circular platen. Here, the platen has a platen center of rotation axis that is perpendicular to the platen planar front surface wherein the rotational axis is concentric with the circular platen and a vacuum supply passageway located at the platen axis center is connected to one or more radial vacuum passageway slot grooves having slot groove widths and bottom slot groove surfaces that are machined into the platen surface. One or more vacuum annular tangential slot grooves having slot groove widths and bottom slot groove surfaces are machined into the platen outer annular portion surface where the annular tangential slot grooves intersect the radial vacuum passageway slot grooves to provide a vacuum passageway connection between the radial slot grooves and the annular tangential slot grooves. The vacuum annular tangential slot grooves are annular slot groove segments that tangentially span an angular portion of the platen front surface outer platen annular portion or the annular tangential slot grooves extend around the full circumference of the platen thereby intersecting one or more of the radial slot grooves. The radial vacuum passageway slot grooves and the annular tangential slot grooves have slot groove cover plates where the slot groove cover top surfaces are flush with the platen planar front surface outer platen annular portion where open vacuum passageways exist between the slot groove cover plates and the bottom slot groove surfaces of the radial vacuum passageway slot grooves and where the slot groove cover plates are attached to the platen surface. The radial vacuum passageway slot grooves and the annular tangential slot grooves cover plates have slot groove cover widths that match the slot groove widths and the machined slot groove annular path configuration of the slot grooves. The annular tangential slot groove covers have vacuum port holes that connect the vacuum passageways to the front surface of the platen to allow the force produced by the vacuum to act on the bottom mounting side of the abrasive disk whereby the flexible abrasive disk acts as a vacuum seal to the vacuum supplied by the grooved vacuum slot passageways with the result that the abrasive disk is bonded to the flat platen surface by the forces provided by the vacuum.

Here, the slot groove cover plates can be adhesively bonded to the platen front surface and the slot groove cover plates are adhesively bonded to the platen front surface with a bonding adhesive that allows the slot groove cover plates to be removed without damaging the platen front surface whereby a slot groove cover plate can be replaced.

What is claimed:

1. A rotatable abrasive lapper machine platen assembly attached to a lapper machine frame, the assembly comprising:

a) a circular-shaped rotatable horizontal platen having
   i) a front surface and
   ii) a back surface;

b) the circular platen having a platen radius, a platen outer circumference and a platen outer periphery;

c) the circular platen front surface having an outer annular planar portion where the platen outer annular planar portion extends radially to the circular platen outer circumference;

d) a flexible abrasive disk secured in conformable flat contact with the circular platen front surface outer annular planar portion wherein the abrasive disk is positioned concentric with the circular platen;

e) the platen assembly having a platen center of rotation axis that is perpendicular to the platen front surface outer annular planar portion surface wherein the platen center of rotation axis is concentric with the circular platen;

f) the platen assembly having a driven platen shaft where one end of the driven platen shaft is attached to the circular platen at the platen center of rotation and the axis of the shaft is concentric with the platen center of rotation axis;

f) a rotary driven platen shaft bearing attached to the lapper machine frame wherein the platen shaft bearing is mounted concentric with the platen center of rotation axis wherein the shaft bearing restrains the platen assembly in a circular platen radial direction, but allows the platen assembly free motion along the platen center rotational axis;

g) the platen assembly having a composite annular rail support plate attached to the circular platen back surface where the annular rail support plate is concentric with the circular platen center of rotational axis;

h) the composite rail support plate having an inner annular portion, a middle annular portion and a cantilevered outer annular portion where the inner, middle and outer portions are all structurally integral portions of the composite annular rail support plate;

i) wherein the composite rail support plate inner annular portion is attached at the outer diameter of the composite rail support plate inner annular portion to the composite rail support plate middle portion at the inner diameter of the composite rail support plate middle annular portion;

j) wherein the composite rail support plate middle annular portion is attached at the outer diameter of the composite rail support plate middle annular portion to the composite rail support plate outer portion at the inner diameter of the composite rail support plate outer annular portion whereby the composite rail support plate outer annular portion is cantilevered radially outward from the composite rail support plate middle annular portion;

k) wherein the composite rail support plate middle annular portion has a middle annular portion thickness that provides interconnection of the attached cantilevered composite rail support plate outer annular rail portion to the composite rail support plate inner annual portion in a platen center of rotation axial direction, but whereby the composite rail support plate middle annular portion provides a platen radially flexible connection between the cantilevered composite rail support plate outer rail annular portion and the composite rail support plate inner rail annular portion;

l) wherein the composite rail support plate middle annular portion provides thermal insulation of the composite rail support plate cantilevered outer rail plate portion from the composite rail support plate inner rail plate portion;

m) the composite rail support plate cantilevered outer annular portion having a lower annular rail air bearing contact surface that faces away from the platen planar front surface whereby this lower rail annular contact surface is flat and polished and wherein the lower annular rail air bearing contact surface is co-planar with the platen planar front surface outer annular planar portion surface;

n) wherein multiple combination-air-bearing pads that are mounted on the lapper machine frame around the periphery of the platen have air bearing pad flat face contact surfaces where the air bearing pad contact surfaces are in near-contact with the composite rail support plate outer annular portion lower cantilevered annular rail contact surface to support and restrain the platen assembly in a vertical direction along the platen center of rotation axis when the platen assembly is stationary or rotationally moving;

o) wherein a sustained pressurized air film is provided between the air bearing pads contact surfaces and the polished lower air bearing rail surface by pressurized air that is supplied to the air bearing pads;

p) wherein the flat surfaced combination-air-bearing pads have a pressurized air film air bearing pad portion that provides a positive force against the polished lower air bearing rail surface and an air bearing pad vacuum portion that provides a negative force against the polished lower air bearing rail where the air bearing pressurized air film force opposes the air bearing vacuum portion force.

2. The assembly of claim 1 wherein the composite annular rail support plate middle annular portion is manufactured from a metal, a polymeric or a fiber reinforced polymeric material and has elongated ribs where the ribs have at least two rib ends, a rib thickness, a rib longitudinal length and a rib width, wherein the rib thickness is equal to the full thickness or a partial thickness of the composite annular rail support plate middle portion where the ribs extend equally spaced in a tangential direction around the composite annular rail support plate middle portion whereby the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

3. The assembly of claim 2 wherein the composite annular rail support plate middle annular portion ribs longitudinal lengths are angled from 35 to 55 degrees from a radial line from the platen center of rotation.

4. The assembly of claim 1 wherein the composite annular rail support plate middle annular portion is constructed from an elastomeric material having low thermal conductivity to provide thermal insulation of the composite annular rail support plate outer annular rail portion from the composite annular rail support plate annular inner rail portion but also wherein the elastomeric annular middle portion provides a radially flexible connection between the composite annular rail support plate outer rail annular portion and the composite annular rail support plate inner rail annular portion.

5. The assembly of claim 1 wherein the platen assembly has fluid passageways that allow fluid coolants to establish and maintain a controlled temperature of the composite annular rail support plate inner rail plate portion of the platen assembly when the air bearing support pads provide cooling to the composite annular rail support plate cantilevered outer annular portion.

6. A process for manufacturing an abrasive lapper machine platen assembly comprising:

a) providing a rotatable abrasive lapper machine platen assembly comprising a circular shaped rotatable horizontal platen having
   i) a front surface and
   ii) a back surface;

b) the circular platen having a platen radius, a platen outer circumference and a platen outer periphery;

c) the circular platen front surface having an outer annular planar portion where the platen outer annular planar portion extends radially to the circular platen outer circumference;

d) whereby a flexible abrasive disk can be secured in conformable flat contact with the circular platen front surface outer annular planar portion wherein the abrasive disk is positioned concentric with the circular platen;

e) the platen assembly has a platen center of rotation axis that is perpendicular to the platen front surface outer annular planar portion surface wherein the platen center of rotation axis is concentric with the circular platen;

f) the platen assembly has a driven platen shaft where one end of the driven platen shaft is attached to the circular platen at the platen center of rotation and the axis of the shaft is concentric with the platen center of rotation axis;

f) a rotary driven platen shaft bearing is attached to the lapper machine frame wherein the platen shaft bearing is mounted concentric with the platen center of rotation axis wherein the shaft bearing restrains the platen assembly in a circular platen radial direction but allows the platen assembly free motion along the platen center rotational axis;

g) the platen assembly has a composite annular rail support plate that is structurally attached to the circular platen back surface where the annular rail support plate is concentric with the circular platen center of rotational axis;

h) the composite rail support plate has an inner annular portion, a middle annular portion and a cantilevered outer annular portion where the inner, middle and outer portions are all structurally integral portions of the composite annular rail support plate;

i) wherein the composite rail support plate inner annular portion is structurally attached at the outer diameter of the composite rail support plate inner annular portion to the composite rail support plate middle portion at the inner diameter of the composite rail support plate middle annular portion;

j) wherein the composite rail support plate middle annular portion is structurally attached at the outer diameter of the composite rail support plate middle annular portion to the composite rail support plate outer portion at the inner diameter of the composite rail support plate outer annular portion whereby the composite rail support plate outer annular portion is cantilevered radially outward from the composite rail support plate middle annular portion;

k) wherein the composite rail support plate middle annular portion having a middle annular portion thickness that is constructed to provide stiff structural interconnection of the attached cantilevered composite rail support plate outer annular rail portion to the composite rail support plate inner annual portion in a platen center of rotation axial direction but whereby the composite rail support plate middle annular portion provides a platen radially flexible connection between the cantilevered composite rail support plate outer rail annular portion and the composite rail support plate inner rail annular portion;

l) wherein the composite rail support plate middle annular portion also provides thermal insulation of the composite rail support plate cantilevered outer rail plate portion from the composite rail support plate inner rail plate portion;

m) the composite rail support plate cantilevered outer annular portion has a lower annular rail air bearing contact surface that faces away from the platen planar front surface whereby this lower rail contact surface is precisely flat and smoothly polished and wherein the lower annular rail air bearing contact surface is co-planar with the platen planar front surface outer annular planar portion surface;

n) providing multiple combination-air-bearing pads that are mounted on the lapper machine frame around the periphery of the platen have air bearing pad flat face contact surfaces where the air bearing pad contact surfaces are in near-contact with the composite rail support plate outer annular portion lower cantilevered annular rail contact surface to support and restrain the platen assembly in a vertical direction along the platen center of rotation axis when the platen assembly is stationary or rotationally moving;

o) providing a sustained pressurized air film between the air bearing pads contact surfaces and the polished lower air bearing rail surface by pressurized air that is supplied to the air bearing pads;

p) providing flat surfaced combination-air-bearing pads have a pressurized air film air bearing pad portion that provides a positive force against the polished lower air bearing rail surface and an air bearing pad vacuum portion that provides a negative force against the polished lower air bearing rail where the air bearing pressurized air film force opposes the air bearing vacuum portion force.

7. The process of claim 6 wherein the composite annular rail support plate middle annular portion is manufactured from a metal, polymeric or a fiber reinforced polymeric material has machined or molded or attached elongated ribs that extend the full thickness or a partial thickness of the composite annular rail support plate middle portion where the ribs extend around the composite annular rail support plate middle portion and the ribs are angled from 20 to 70 degrees from a radial line from the platen center of rotation.

8. The process of claim 7 wherein the composite annular rail support plate middle annular portion ribs are angled from 35 to 55 degrees from a radial line from the platen center of rotation also the ribs provide thermal isolation of the outer rail portion from the inner rail portion.

9. The process of claim 6 wherein the composite annular rail support plate middle annular portion is constructed from an elastomeric material having low thermal conductivity to provide thermal insulation of the composite annular rail support plate outer annular rail portion from the composite annular rail support plate annular inner rail portion but also wherein the elastomeric annular middle portion provides a radially flexible connection between the composite annular rail support plate outer rail annular portion and the composite annular rail support plate inner rail annular portion.

10. The process of claim 6 wherein the platen assembly has fluid passageways that allow fluid coolants to establish and maintain a constant temperature of the composite annular rail support plate inner rail plate portion of the platen assembly when the air bearing support pads provide cooling to the composite annular rail support plate cantilevered outer annular portion.

11. A rotatable abrasive lapper machine platen assembly attached to a lapper machine frame, the lapper machine platen assembly apparatus comprising:

a) a circular shaped rotatable horizontal platen having
   i) a front surface and
   ii) a back surface;

b) the circular platen having a platen radius, a platen outer circumference and a platen outer periphery;

c) the circular platen front surface having an outer annular planar portion where the platen outer annular planar portion extends radially to the circular platen outer circumference;

d) whereby a flexible abrasive disk can be secured in conformable flat contact with the circular platen front surface outer annular planar portion wherein the abrasive disk is positioned concentric with the circular platen;

e) the platen assembly has a platen center of rotation axis that is perpendicular to the platen front surface outer annular planar portion surface wherein the platen center of rotation axis is concentric with the circular platen;

f) the platen assembly has a driven platen shaft where one end of the driven platen shaft is attached to the circular platen at the platen center of rotation and the axis of the shaft is concentric with the platen center of rotation axis;

f) a rotary driven platen shaft bearing is attached to the lapper machine frame wherein the platen shaft bearing is mounted concentric with the platen center of rotation axis wherein the shaft bearing restrains the platen assembly in a circular platen radial direction but allows the platen assembly free motion along the platen center rotational axis;

g) the platen assembly has a composite annular rail support plate that is structurally attached to the circular platen back surface where the annular rail support plate is concentric with the circular platen center of rotational axis;

h) the composite rail support plate has an inner annular portion, a middle annular portion and a cantilevered outer annular portion where the inner, middle and outer portions are all structurally integral portions of the composite annular rail support plate;

i) wherein the composite rail support plate inner annular portion is structurally attached at the outer diameter of the composite rail support plate inner annular portion to the composite rail support plate middle portion at the inner diameter of the composite rail support plate middle annular portion;

j) wherein the composite rail support plate middle annular portion is structurally attached at the outer diameter of the composite rail support plate middle annular portion to the composite rail support plate outer portion at the inner diameter of the composite rail support plate outer annular portion whereby the composite rail support plate outer annular portion is cantilevered radially outward from the composite rail support plate middle annular portion;

k) wherein the composite rail support plate middle annular portion having a middle annular portion thickness that is constructed to provide stiff structural interconnection of the attached cantilevered composite rail support plate outer annular rail portion to the composite rail support plate inner annual portion in a platen center of rotation axial direction but whereby the composite rail support plate middle annular portion provides a platen radially flexible connection between the cantilevered composite rail support plate outer rail annular portion and the composite rail support plate inner rail annular portion;

l) wherein the composite rail support plate middle annular portion also provides thermal insulation of the composite rail support plate cantilevered outer rail plate portion from the composite rail support plate inner rail plate portion;

m) the composite rail support plate cantilevered outer annular portion has a upper annular rail air bearing contact surface that faces toward the platen planar front surface and has a lower annular rail air bearing contact surface that faces away from the platen planar front surface wherein both the upper and the lower rail contact surfaces are precisely flat and smoothly polished and wherein both the upper and lower annular rail air bearing contact surface are co-planar with the platen planar front surface outer annular planar portion surface;

n) wherein multiple sets of opposed upper and lower air bearing pads that are mounted on the lapper machine frame around the periphery of the platen have air bearing pad flat face near-contacts respectively with both the upper and the lower cantilevered annular rail contact surfaces at the same platen circumferential locations to support and restrain the platen assembly in a vertical direction along the platen center of rotation axis when the platen assembly is stationary or moving with a sustained pressurized air film between the opposed air bearing contact surfaces and the polished upper and lower air bearing rail surfaces;

o) wherein the opposed upper and lower air bearing pads each create a pressurized air film between the opposed flat surfaced air bearing contact surfaces and the polished upper and lower air bearing rail surfaces where the air bearing rail outer portion is vertically suspended between the opposed air bearing pads when pressurized air is supplied to the air pads.

12. The apparatus of claim 11 wherein the composite annular rail support plate middle annular portion is manufactured from a metal, a polymeric or a fiber reinforced polymeric material and has elongated ribs where the ribs have two rib ends, a rib thickness, a rib longitudinal length and a rib width where the rib thickness is equal to the full thickness or a partial thickness of the composite annular rail support plate middle portion where the ribs extend equally spaced in a tangential direction around the composite annular rail support plate middle portion whereby the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

13. The apparatus of claim 12 wherein the composite annular rail support plate middle annular portion ribs longitudinal lengths are angled from 35 to 55 degrees from a radial line from the platen center of rotation.

14. The apparatus of claim 11 wherein the composite annular rail support plate middle annular portion is constructed from an elastomeric material having low thermal conductivity to provide thermal insulation of the composite annular rail support plate outer annular rail portion from the composite annular rail support plate annular inner rail portion but also wherein the elastomeric annular middle portion provides a radially flexible connection between the composite annular rail support plate outer rail annular portion and the composite annular rail support plate inner rail annular portion.

15. The apparatus of claim 11 wherein the platen assembly has fluid passageways that allow fluid coolants to establish and maintain a constant temperature of the inner rail plate portion of the platen assembly when the air bearing support pads provide cooling to the cantilevered outer annular portion.

16. A process for manufacturing an abrasive lapper machine platen assembly comprising:

a) providing a rotatable abrasive lapper machine platen assembly apparatus comprising a circular shaped rotatable horizontal platen having
   i) a front surface and
   ii) a back surface;

b) wherein the platen has a outer circumference, a periphery and an outer platen annular portion that extends radially to the outer circumference;

c) the platen assembly has a platen center of rotation axis that is perpendicular to the platen planar front surface wherein the rotational axis is concentric with the circular platen;

d) the platen assembly has a composite annular rail support plate that is structurally attached to the circular platen back surface where the annular rail support plate is concentric with the circular platen center of rotational axis;

e) the composite rail support plate has an inner annular portion, a middle annular portion and a cantilevered outer annular portion where the inner, middle and outer portions are all structurally integral portions of the composite annular rail support plate;

f) wherein the composite rail support plate inner annular portion is structurally attached at the outer diameter of the composite rail support plate inner annular portion to the composite rail support plate middle portion at the inner diameter of the composite rail support plate middle annular portion;

g) wherein the composite rail support plate middle annular portion is structurally attached at the outer diameter of the composite rail support plate middle annular portion to the composite rail support plate outer portion at the inner diameter of the composite rail support plate outer annular portion whereby the composite rail support plate outer annular portion is cantilevered radially outward from the composite rail support plate middle annular portion;

h) wherein the composite rail support plate middle annular portion having a middle annular portion thickness that is constructed to provide stiff structural interconnection of the attached cantilevered composite rail support plate outer annular rail portion to the composite rail support plate inner annual portion in a platen center of rotation axial direction but whereby the composite rail support plate middle annular portion provides a platen radially flexible connection between the cantilevered composite rail support plate outer rail annular portion and the composite rail support plate inner rail annular portion;

i) wherein the composite rail support plate middle annular portion also provides thermal insulation of the composite rail support plate cantilevered outer rail plate portion from the composite rail support plate inner rail plate portion;

j) the composite rail support plate cantilevered outer annular portion has a lower annular rail air bearing contact surface that faces away from the platen planar front surface;

k) machining or abrading the lower annular rail outer contact surfaces to produce a precision flat planar lower rail contact surface that is smoothly polished and wherein the lower rail surface is precisely co-planar with the platen planar front surface outer annular planar portion surface;

l) machining or abrading the platen front surface to be precisely co-planar with the lower rail air bearing contact surface.

17. The apparatus of claim 16 wherein the composite annular rail support plate middle annular portion that is manufactured from a metal, a polymeric or a fiber reinforced polymeric material has machined or molded or attached elongated ribs where the ribs have two rib ends, a rib thickness, a rib longitudinal length and a rib width where the rib thickness is equal to the full thickness or a partial thickness of the composite annular rail support plate middle portion where the ribs extend equally spaced in a tangential direction around the composite annular rail support plate middle portion whereby the rib ends are attached to both the inner and outer radii of the rail support plate middle annular portion and the rib longitudinal lengths are angled from 20 to 70 degrees from a radial line from the platen center of rotation and the number of ribs contained in a composite annular rail support plate middle annular portion ranges from 4 to 200.

18. The apparatus of claim 17 wherein the composite annular rail support plate middle annular portion ribs longitudinal lengths are angled from 35 to 55 degrees from a radial line from the platen center of rotation.

19. The apparatus of claim 16 wherein the composite annular rail support plate middle annular portion that is constructed from an elastomeric material having low thermal conductivity to provide thermal insulation of the composite annular rail support plate outer annular rail portion from the composite annular rail support plate annular inner rail portion but also wherein the elastomeric annular middle portion provides a radially flexible connection between the composite annular rail support plate outer rail annular portion and the composite annular rail support plate inner rail annular portion.

20. The apparatus of claim 16 wherein the platen assembly has fluid passageways that allow fluid coolants to establish and maintain a constant temperature of the composite annular rail support plate inner rail plate portion of the platen assembly when the air bearing support pads provide cooling to the composite annular rail support plate cantilevered outer annular portion.

21. A rotatable abrasive lapper machine platen assembly apparatus having a precision flat planar surface whereby a flexible abrasive disk can be secured in conformable flat contact with the platen flat surface;

a) the platen has a platen front surface, a platen outer circumference, a platen periphery and an platen front surface outer platen annular portion that extends radially to the outer circumference wherein the abrasive disk is positioned concentric with the circular platen;

b) the platen has a platen center of rotation axis that is perpendicular to the platen planar front surface wherein the rotational axis is concentric with the circular platen;

c) a vacuum supply passageway located at the platen axis center is connected to one or more radial vacuum passageway slot grooves having slot groove widths and bottom slot groove surfaces that are machined into the platen surface;

d) wherein one or more vacuum annular tangential slot grooves having slot groove widths and bottom slot groove surfaces are machined into the platen outer annular portion surface where the annular tangential slot grooves intersect the radial vacuum passageway slot grooves to provide a vacuum passageway connection between the radial slot grooves and the annular tangential slot grooves;

e) the vacuum annular tangential slot grooves are annular slot groove segments that tangentially span an angular portion of the platen front surface outer platen annular portion or the annular tangential slot grooves extend around the full circumference of the platen thereby intersecting one or more of the radial slot grooves;

h) wherein the radial vacuum passageway slot grooves and the annular tangential slot grooves have slot groove cover plates where the slot groove cover top surfaces are flush with the platen planar front surface outer platen annular portion where open vacuum passageways exist between the slot groove cover plates and the bottom slot groove surfaces of the radial vacuum passageway slot grooves and wherein the slot groove cover plates are attached to the platen surface;

i) wherein the radial vacuum passageway slot grooves and the annular tangential slot grooves cover plates have slot groove cover widths that match the slot groove widths and the machined slot groove annular path configuration of the slot grooves;

j) wherein the annular tangential slot groove covers have vacuum port holes that connect the vacuum passageways to the front surface of the platen to allow the force produced by the vacuum to act on the bottom mounting side of the abrasive disk whereby the flexible abrasive disk acts as a vacuum seal to the vacuum supplied by the grooved vacuum slot passageways with the result that the abrasive disk is bonded to the flat platen surface by the forces provided by the vacuum.

22. The assembly of claim 21 wherein the slot groove cover plates are adhesively bonded to the platen front surface.

23. The assembly of claim 21 where the slot groove cover plates are adhesively bonded to the platen front surface with a bonding adhesive that allows the slot groove cover plates to be removed without damaging the platen front surface whereby a slot groove cover plate can be replaced.

* * * * *